US008535158B2

(12) United States Patent
Kelly et al.

(10) Patent No.: US 8,535,158 B2
(45) Date of Patent: Sep. 17, 2013

(54) NETWORKED GAMING SYSTEM COMMUNICATION PROTOCOLS AND METHODS

(75) Inventors: Bryan Kelly, Alamo, CA (US); Dennis Lockard, Tracy, CA (US); Jeffrey Tallcott, Pleasanton, CA (US); John Kroeckel, San Ramon, CA (US); Gennady Soliterman, San Ramon, CA (US); Reddy Rupanagudi, Pleasanton, CA (US)

(73) Assignee: Bally Gaming, Inc., Las Vegas, NV (US)

( * ) Notice: Subject to any disclaimer, the term of this patent is extended or adjusted under 35 U.S.C. 154(b) by 833 days.

(21) Appl. No.: 12/291,845

(22) Filed: Nov. 12, 2008

(65) Prior Publication Data

US 2009/0227364 A1 Sep. 10, 2009

Related U.S. Application Data

(63) Continuation-in-part of application No. 11/938,644, filed on Nov. 12, 2007, and a continuation-in-part of application No. 11/938,666, filed on Nov. 12, 2007, and a continuation-in-part of application No. 11/470,606, filed on Sep. 6, 2006, and a continuation-in-part of application No. 10/943,771, filed on Sep. 16, 2004.

(60) Provisional application No. 60/865,649, filed on Nov. 14, 2006, provisional application No. 60/987,402, filed on Nov. 12, 2007, provisional application No. 60/987,266, filed on Nov. 12, 2007, provisional application No. 60/987,259, filed on Nov. 12, 2007, provisional application No. 60/987,274, filed on Nov. 12, 2007, provisional application No. 60/987,234, filed on Nov. 12, 2007.

(51) Int. Cl.

| | |
|---|---|
| ***A63F 9/00*** | (2006.01) |
| ***A63F 13/00*** | (2006.01) |
| ***G06F 13/00*** | (2006.01) |
| ***G06F 9/24*** | (2006.01) |

(52) U.S. Cl.
USPC ..... 463/42; 463/16

(58) Field of Classification Search
USPC ..... 463/16, 17, 42
See application file for complete search history.

(56) References Cited

U.S. PATENT DOCUMENTS

| | | | |
|---|---|---|---|
| 3,662,105 | A | 5/1972 | Hurst et al. |
| 4,448,419 | A | 5/1984 | Telnaes |
| 4,676,506 | A | 6/1987 | Crouch |

(Continued)

FOREIGN PATENT DOCUMENTS

| | | |
|---|---|---|
| AU | 704691 | 4/1997 |
| EP | 0769769 | 4/1997 |

(Continued)

*Primary Examiner* — Omkar Deodhar
*Assistant Examiner* — Reginald Renwick
(74) *Attorney, Agent, or Firm* — Paul Hickman; Marvin Hein

(57) ABSTRACT

A system, method and apparatus for a gaming system is provided. The gaming system includes a rewards server and a separate gaming or slot accounting server. The system may further include a separate player tracking server. The system further includes one or more game machines. The game machines may include a base game, rewards tracking module, and a game management module. Further details will be apparent from the description, drawings and claims.

20 Claims, 166 Drawing Sheets

(56) References Cited

U.S. PATENT DOCUMENTS 4,718,672 A 1/1988 Okada
4,837,728 A 6/1989 Barrie et al.
4,856,787 A 8/1989 Itkis
4,948,134 A 8/1990 Suttle et al.
5,332,219 A 7/1994 Marnell, II et al.
5,342,047 A 8/1994 Heidel et al.
5,393,057 A 2/1995 Marnell, II
5,429,361 A 7/1995 Raven et al.
5,575,717 A 11/1996 Houriet, Jr. et al.
5,599,231 A 2/1997 Hibino et al.
5,643,086 A 7/1997 Alcorn et al.
5,655,961 A 8/1997 Acres et al.
5,664,999 A 9/1997 Kurihara
5,702,304 A 12/1997 Acres et al.
5,725,428 A 3/1998 Achmuler
5,741,183 A 4/1998 Acres et al.
5,752,882 A 5/1998 Acres et al.
5,759,102 A 6/1998 Pease et al.
5,769,716 A 6/1998 Saffari et al.
5,770,533 A 6/1998 Franchi
5,779,545 A 7/1998 Berg et al.
5,796,389 A 8/1998 Bertram et al.
5,809,482 A 9/1998 Strisower
5,816,918 A 10/1998 Kelly et al.
5,820,459 A 10/1998 Acres et al.
5,833,536 A 11/1998 Davids et al.
5,833,540 A 11/1998 Miodunski et al.
5,836,817 A 11/1998 Acres et al.
5,851,148 A 12/1998 Brune et al.
5,876,284 A 3/1999 Acres et al.
5,885,158 A 3/1999 Torango et al.
5,919,091 A 7/1999 Bell et al.
5,935,002 A 8/1999 Falciglia
5,951,397 A 9/1999 Dickinson
5,967,896 A 10/1999 Jorasch et al.
5,973,696 A 10/1999 Agranat et al.
5,984,779 A 11/1999 Bridgeman et al.
6,008,784 A 12/1999 Acres et al.
6,010,404 A 1/2000 Walker et al.
6,015,346 A 1/2000 Bennett
6,039,648 A 3/2000 Guinn et al.
6,041,347 A 3/2000 Harsham et al.
6,068,552 A 5/2000 Walker et al.
6,071,190 A 6/2000 Weiss et al.
6,077,163 A 6/2000 Walker et al.
6,083,105 A 7/2000 Ronin et al.
6,089,975 A 7/2000 Dunn
6,093,100 A 7/2000 Singer et al.
6,102,394 A 8/2000 Wurz et al.
6,102,798 A 8/2000 Bennett
6,110,041 A 8/2000 Walker et al.
6,113,495 A 9/2000 Walker et al.
6,135,884 A 10/2000 Hedrick et al.
6,149,522 A 11/2000 Alcorn et al.
6,159,097 A 12/2000 Gura
6,162,122 A 12/2000 Acres et al.
6,244,958 B1 6/2001 Acres
6,254,483 B1 7/2001 Acres
6,257,981 B1 7/2001 Acres et al.
6,267,675 B1 7/2001 Lee
6,280,328 B1 8/2001 Holch et al.
6,293,866 B1 9/2001 Walker et al.
6,302,790 B1 10/2001 Brossard
6,312,333 B1 11/2001 Acres
6,315,666 B1 11/2001 Mastera et al.
6,319,125 B1 11/2001 Acres
6,319,127 B1 11/2001 Walker et al.
6,332,099 B1 12/2001 Heidel et al.
6,358,150 B1 3/2002 Mir
6,364,765 B1 * 4/2002 Walker et al. ..... 463/16
6,364,768 B1 4/2002 Acres et al.
6,364,769 B1 4/2002 Weiss et al.
6,371,852 B1 4/2002 Acres
6,375,567 B1 4/2002 Acres
6,375,569 B1 4/2002 Acres
6,409,602 B1 6/2002 Wiltshire et al.
6,431,983 B2 8/2002 Acres
6,457,099 B1 9/2002 Gilbert
RE37,885 E 10/2002 Acres et al.
6,488,585 B1 12/2002 Wells et al.
6,565,434 B1 5/2003 Acres
6,569,017 B2 5/2003 Enzminger et al.
6,595,856 B1 7/2003 Ginsburg et al.
6,607,441 B1 8/2003 Acres
6,645,077 B2 11/2003 Rowe
6,652,378 B2 11/2003 Cannon et al.
6,682,423 B2 1/2004 Brosnan et al.
6,712,697 B2 3/2004 Acres
6,712,698 B2 3/2004 Paulsen et al.
6,712,702 B2 3/2004 Goldberg et al.
6,722,985 B2 4/2004 Criss-Puszkiewicz
6,722,986 B1 4/2004 Lyons et al.
6,749,510 B2 6/2004 Globbi
6,749,511 B2 6/2004 Day
6,800,030 B2 10/2004 Acres
6,832,956 B1 12/2004 Boyd et al.
6,832,958 B2 12/2004 Acres et al.
6,843,724 B2 * 1/2005 Walker et al. ..... 463/25
6,866,586 B2 3/2005 Oberberger et al.
6,884,174 B2 4/2005 Lundy et al.
6,908,391 B2 6/2005 Gatto et al.
6,910,964 B2 6/2005 Acres
6,916,247 B2 7/2005 Gatto et al.
6,935,957 B1 8/2005 Yates et al.
6,945,870 B2 9/2005 Gatto et al.
RE38,812 E 10/2005 Acres et al.
7,007,278 B2 2/2006 Gungabeesoon
7,025,674 B2 4/2006 Adams et al.
7,043,641 B1 5/2006 Martinek et al.
7,093,040 B1 8/2006 Mach
7,103,650 B1 9/2006 Vetrivelkumaran et al.
7,111,845 B2 9/2006 Walker et al.
D531,333 S 10/2006 Acres et al.
7,124,413 B1 10/2006 Klemm et al.
7,201,662 B2 4/2007 LeMay et al.
7,290,072 B2 10/2007 Quraishi et al.
7,291,068 B2 11/2007 Bryant et al.
7,297,062 B2 11/2007 Gatto et al.
7,393,280 B2 7/2008 Cannon
7,542,487 B2 6/2009 Gatto et al.
7,780,525 B2 8/2010 Walker et al.
7,896,735 B2 3/2011 Kelly et al.
7,950,999 B2 5/2011 Morrow et al.
2001/0007828 A1 7/2001 Walker et al.
2001/0031654 A1 10/2001 Walker et al.
2001/0046893 A1 * 11/2001 Giobbi et al. ..... 463/24
2002/0002075 A1 1/2002 Rowe
2002/0016206 A1 2/2002 Yoshimi et al.
2002/0065136 A1 5/2002 Day
2002/0111206 A1 8/2002 Van Baltz et al.
2002/0142846 A1 10/2002 Paulsen
2002/0152120 A1 10/2002 Howington
2002/0183105 A1 12/2002 Cannon et al.
2003/0013532 A1 1/2003 Rowe et al.
2003/0032474 A1 2/2003 Kaminkow
2003/0054878 A1 3/2003 Benoy et al.
2003/0060247 A1 3/2003 Goldberg et al.
2003/0083943 A1 5/2003 Adams et al.
2003/0100372 A1 5/2003 Gatto et al.
2003/0171149 A1 9/2003 Rothschild
2003/0181241 A1 9/2003 Oakes et al.
2004/0002378 A1 1/2004 Acres et al.
2004/0002383 A1 1/2004 Lundy et al.
2004/0038733 A1 * 2/2004 Walker et al. ..... 463/25
2004/0054445 A1 3/2004 Vollmer et al.
2004/0072618 A1 4/2004 Bartholomew et al.
2004/0100490 A1 5/2004 Boston et al.
2004/0142750 A1 7/2004 Glisson et al.
2004/0166940 A1 8/2004 Rothschild
2004/0198496 A1 10/2004 Gatto
2004/0214622 A1 10/2004 Atkinson
2004/0254013 A1 12/2004 Quraishi et al.
2004/0259640 A1 12/2004 Gentles et al.
2005/0009599 A1 * 1/2005 Ryan ..... 463/29

| | | | | |
|---|---|---|---|---|
| 2005/0020340 | A1 | 1/2005 | Cannon | |
| 2005/0032573 | A1 | 2/2005 | Acres et al. | |
| 2005/0054439 | A1 | 3/2005 | Rowe et al. | |
| 2005/0137017 | A1 | 6/2005 | Lechner et al. | |
| 2005/0141509 | A1 | 6/2005 | Rabie et al. | |
| 2005/0153768 | A1 | 7/2005 | Paulsen | |
| 2005/0172336 | A1 | 8/2005 | Gatto | |
| 2005/0181873 | A1* | 8/2005 | Bond | 463/36 |
| 2005/0209006 | A1 | 9/2005 | Gatto | |
| 2005/0209007 | A1 | 9/2005 | Gatto | |
| 2005/0221898 | A1 | 10/2005 | Gatto | |
| 2005/0223219 | A1 | 10/2005 | Gatto | |
| 2005/0233811 | A1 | 10/2005 | Gatto | |
| 2005/0282637 | A1 | 12/2005 | Gatto | |
| 2006/0046819 | A1 | 3/2006 | Nguyen et al. | |
| 2006/0068906 | A1 | 3/2006 | Morrow | |
| 2006/0100010 | A1 | 5/2006 | Gatto | |
| 2006/0111178 | A1* | 5/2006 | Gallaway et al. | 463/25 |
| 2007/0117608 | A1* | 5/2007 | Roper et al. | 463/16 |
| 2007/0167210 | A1 | 7/2007 | Kelly et al. | |
| 2007/0167226 | A1* | 7/2007 | Kelly et al. | 463/29 |
| 2007/0232385 | A1 | 10/2007 | Pace | |
| 2007/0259709 | A1 | 11/2007 | Kelly et al. | |
| 2008/0139283 | A1 | 6/2008 | Kelly et al. | |
| 2009/0069087 | A1 | 3/2009 | Kelly et al. | |
| 2009/0124362 | A1* | 5/2009 | Cuddy et al. | 463/27 |
| 2009/0197670 | A1 | 8/2009 | Kelly et al. | |
| 2009/0197671 | A1 | 8/2009 | Kelly et al. | |
| 2009/0197672 | A1 | 8/2009 | Kelly et al. | |
| 2009/0209333 | A1 | 8/2009 | Kelly et al. | |
| 2009/0227363 | A1 | 9/2009 | Kelly et al. | |
| 2009/0227364 | A1 | 9/2009 | Kelly et al. | |
| 2009/0247302 | A1 | 10/2009 | Kelly et al. | |
| 2009/0270174 | A1 | 10/2009 | Kelly et al. | |
| 2009/0270175 | A1 | 10/2009 | Kelly et al. | |

FOREIGN PATENT DOCUMENTS

| | | | |
|---|---|---|---|
| EP | 1004970 | A | 5/2000 |
| EP | 1074955 | A | 2/2001 |
| GB | 2042234 | A | 9/1980 |
| GB | 2121569 | | 7/1986 |
| GB | 2092796 | A | 7/2001 |
| WO | WO9623288 | A | 8/1996 |
| WO | WO0007099 | | 2/2000 |
| WO | WO2004004855 | | 1/2004 |
| WO | WO2004024260 | | 3/2004 |

* cited by examiner

500

502

504

600

602

604

Better Pay Tables
for increased EGM wagering

900

902

904

906

1000

1002

1004

1804

| Field | Description |
|---|---|
| Asset Number | Slot machine identification number. |
| Casino ID | Unique, 3-digit property identifier. |
| Client IP Address | Network address of the IVIEW. |
| GMU ID | Unique identification number of the Game Monitoring Unit (GMU). This number is assigned by the Slot Management System upon initial connection. |
| IVIEW ID | Unique number used to identify the IVIEW device. This number is a manufacturer-assigned value. |
| IVIEW Version | Version of code currently installed on the IVIEW device. |
| **Field** | **Description** |
| LRS | Status of the Live Rewards Server (LRS) that the IVIEW is communicating with. Status: Connected or Not Connected. |
| GMU = | Status of IVIEW connection to the Game Monitoring Unit (GMU) - Connected or Not Connected. |
| Server IP Address | Network location of the Bally Live Rewards server. |

FIG.18C

1900

| | | | |
|---|---|---|---|
| iView sync Interval | 15 min | Jurisdiction Limit | $200 |
| Live Rewards Volume for Attract mode | 50 | Auto-Play System Games | OFF |
| Live Rewards Volume Game | 45 | | |

Refresh

Close

FIG.19A

1902

| Field | Description |
|---|---|
| Auto-Play System Games | Determines whether a randomly selected Bally Live Rewards game plays automatically once the player has accrued enough play points. This setting is defined through the LRS, under Global Settings |
| iVIEW Sync Interval | Defines the number of minutes between each IVIEW synchronization with the LRS to download global settings. These settings are defined through the LRS, under Global Settings. |
| Jurisdiction Limit | Indicates the jurisdictional limit for handpaid jackpots. This setting is defined through the LRS, under Global Settings. |
| System Game Volume for Attract Mode | Volume setting for attract movie. This setting is defined through the LRS, under Global Settings. |
| System Game Volume Game | Volume setting for Bally Live Rewards games. This setting is defined through the LRS, under Global Settings. |

FIG.19B

- Live Rewards Management
  - Games Management
    - Global Settings
    - Live Rewards Start Rules
    - Prizes - Conversions
    - Assign Games to Player
    - Activate WEA
    - Report Configurations
    - Pay Tables
      - Copy Pay Table Sets
      - Modify Pay Table Sets
      - Manage Pay Table Sets
      - Import Pay Table Sets
  - Player Management
    - Clear PIN Lockout
    - Banned Players
    - Player Session Activity
    - Active Player Sessions
    - Debit/Credit Player Account
  - Reports
    - Transaction Details

2502

Assign Games to Player Type

Select Player Type: Silver

Currently Assigned Games

| GID | Game Name | Pay Table Set | Notes | Remove |
|---|---|---|---|---|
| 100 | Blue Spot Bingo | Bingo-Member | Bally Default | Remove Game |
| 101 | Payday Poker | Poker-Member | Bally Default | Remove Game |
| 103 | Casino Challenge | Tournaments-Member | Bally Default | Remove Game |
| 102 | Castle Crasher | Castle Crasher Silver G2E | Default for G2E Silver | Remove Game |

Add New Game

FIG.25A

2802

- Live Rewards Management
  - Games Management
    - Global Settings
    - Live Rewards Start Rules
    - Prizes - Conversions
    - Assign Games to Player
    - Activate WEN
    - Report Configurations
    - Pay Tables
      - Copy Pay Table Sets
      - Modify Pay Table Sets
      - Manage Pay Table Sets
      - Import Pay Table Sets
  - Player Management
    - Clear PIN Lockout
    - Banned Players
    - Player Session Activity
    - Active Player Sessions
    - Debit/Credit Player Account
  - Reports
    - Transaction Details
    - Gameplay Details
    - Patron Summary/Details
    - WEN Summary
    - Liability Report
    - Settings Change History
    - Notification Messages
  - User Authorization
    - Create New User Copy Pay Table Sets

*Select an existing pay table set as a template

| | GID | Game Name | PlayerTypeDesc | Pay Table Set Name | Notes |
|---|---|---|---|---|---|
| Choose | 100 | Blue Spot Bingo | Silver | Bingo-Member | Bally Default |
| Choose | 101 | Payday Poker | Silver | Poker-Member | Bally Default |
| Choose | 100 | Blue Spot Bingo | Gold | Bingo-Gold | Bally Default |
| Choose | 100 | Blue Spot Bingo | Platinum | Bingo-Platinum | Bally Default |
| Choose | 101 | Payday Poker | Platinum | Poker-Platinum | Bally Default |
| Choose | 101 | Payday Poker | Gold | Poker-Gold | Bally Default |
| Choose | 105 | Casino Challenge | Silver | Tournaments-Member | Bally Default |
| Choose | 105 | Casino Challenge | Gold | Tournaments-Gold | Bally Default |
| Choose | 105 | Casino Challenge | Platinum | Tournaments-Platinum | Bally Default |
| Choose | 102 | Castle Crasher | Silver | Castle Crasher - Silver G2E | Default for G2E - Silver |
| Choose | 102 | Castle Crasher | Gold | Castle Crasher - Gold G2E | Default for G2E - Gold |
| Choose | 102 | Castle Crasher | Platinum | Castle Crasher - Platinum G2E | Default for G2E - Platinum |

New Pay Table Set

| | |
|---|---|
| Pay Table Set Name | |
| Player Type | Silver |
| Notes | |

Copy View

FIG.28A

4102

- Live Rewards Management
  - Games Management
    - Dated Sessions
    - Live Rewards Start Rules
    - Prices / Conversions
    - Assign Games to Player
    - Activate MLM
    - Report Configurations
    - Pay Tables
      - Copy Pay Table Sets
      - Modify Pay Table Sets
      - Manage Pay Table Sets
      - Import Pay Table Sets
  - Player Management
    - Clear Pin Lockout
    - Banned Players
    - Player Session Activity
    - Active Player Sessions
    - Debit/Credit Player Account
  - Reports
    - Transaction Details
    - Connecting Details
    - Patron Summary Details
    - MLM Summary
    - Liability Report
    - Settings change History
    - Notification Messages Player Session Activity Dates Between November 05 2006 Time 20 : 00 : 00 And November 06 2006 Time 20 : 00 : 00

Player Card# 897766543 Show

Session Deposits | Session Withdrawals | Session Games | Close

Session Withdrawals

| Session# | Item# | Transaction Date/Time | Source | Source# | SourceDetails | Bucket | Value | Jurisdiction | Status |
|---|---|---|---|---|---|---|---|---|---|
| 553 | 1046 | 11/6/2006 11:27:49 AM | Game Play | 181 | BEGIN GAME | Threshold Counter | 40.00 | NO | Committed |
| 553 | 1041 | 11/6/2006 11:27:37 AM | Game Play | 180 | BEGIN GAME | Play Points | 100.00 | NO | Committed |
| 553 | 1042 | 11/6/2006 11:27:59 AM | Game Play | 180 | BEGIN GAME | Threshold Counter | 34.00 | NO | Committed |
| 553 | 1033 | 11/6/2006 11:26:58 AM | Game Play | 178 | BEGIN GAME | Play Points | 100.00 | NO | Committed |
| 553 | 1034 | 11/6/2006 11:26:58 AM | Game Play | 178 | BEGIN GAME | Threshold Counter | 45.00 | NO | Committed |
| 553 | 1025 | 11/6/2006 11:26:30 AM | Game Play | 176 | BEGIN GAME | Play Points | 100.00 | NO | Committed |
| 553 | 1026 | 11/6/2006 11:26:30 AM | Game Play | 176 | BEGIN GAME | Threshold Counter | 141.00 | NO | Committed |
| 553 | 1017 | 11/6/2006 11:26:02 AM | Game Play | 174 | BEGIN GAME | Play Points | 100.00 | NO | Committed |
| 553 | 1018 | 11/6/2006 11:26:02 AM | Game Play | 174 | BEGIN GAME | Threshold Counter | 98.00 | NO | Committed |
| 553 | 1008 | 11/6/2006 11:25:27 AM | Game Play | 172 | BEGIN GAME | Play Points | 100.00 | NO | Committed |
| 553 | 1009 | 11/6/2006 11:25:27 AM | Game Play | 172 | BEGIN GAME | Threshold Counter | 31.00 | NO | Committed |
| 553 | 1000 | 11/6/2006 11:25:03 AM | Game Play | 170 | BEGIN GAME | Play Points | 100.00 | NO | Committed |
| 553 | 1001 | 11/6/2006 11:25:03 AM | Game Play | 170 | BEGIN GAME | Threshold Counter | 56.00 | NO | Committed |
| 553 | 994 | 11/6/2006 11:24:31 AM | Game Play | 168 | BEGIN GAME | Play Points | 100.00 | NO | Committed |
| 553 | 995 | 11/6/2006 11:24:31 AM | Game Play | 168 | BEGIN GAME | Threshold Counter | 72.00 | NO | Committed |

... 13 14 15 16 17 18 19 20 21 22

FIG.41A

- Ice Rewards Management
  - Games Management
    - Global Settings
    - Ice Rewards Start Rules
    - Prizes - Conversions
    - Assign Games to Player
    - Activate NEW
    - Report Configurations
    - Pay Tables
      - Copy Pay Table Sets
      - Modify Pay Table Sets
      - Manage Pay Table Sets
      - Import Pay Table Sets
  - Player Management
    - Clear Pin Lockout
    - Banned Players
    - Player Session Activity
    - Active Player Sessions
    - Debit/Credit Player Account
  - Reports
    - Transaction Details
    - Gameplay Actions
    - Points Summary/Details
    - NEW Summary

4202

Prizes - Conversions

| PrizeType | Cashable | Dollar Value | Jurisdictional Include | Mapped PlayerTypes | Expire Day(s) |
|---|---|---|---|---|---|
| 100-Cash | True | 1.0000 | True | • Gold<br>• Platinum<br>• Silver | 0 |
| 101-Bonus Points | True | 0.0500 | False | • Gold<br>• Platinum<br>• Silver | 0 |
| 102-Play Points | False | 0.0100 | False | | 30 |
| 103 Threshold Counter | False | 0.0100 | False | | 30 |

FIG.42A

4502

- Live Rewards Management
  - Games Management
    - Global Settings
    - Live Rewards Start Rules
    - Points Conversions
    - Assign Games to Player
    - Activate VIEW
    - Resort Configurations
    - Pay Tables
      - Copy Pay Table Sets
      - Modify Pay Table Sets
      - Manage Pay Table Sets
      - Import Pay Table Sets
  - Player Management
    - Clear PIN Lockout
    - Banned Players
    - Player Session Activity
    - Active Player Sessions
    - Debit/Credit Player Account
  - Reports
    - Transaction Details
    - Gateway Details
    - Patron Summary/Details
    - [illegible] Summary Settings Changes History Dates Between October 01 2006 Time 20 : 00 : 00 And November 06 2006 Time 20 : 00 : 20

○ Global Settings ○ Live Rewards Start Rules ◉ Games ○ Pay Table Sets ○ Banned Players ○ User Changes ○ Users Session Log Show Select Export Format PDF Save/Open

| Event Timeline | | Wizard | Activity | Reason | Primary User | Secondary User |
|---|---|---|---|---|---|---|
| 11/3/2006 4:[illegible] PM | 70-Platinum | 102-Castle Crasher | ADD | for G2I | Admin | Bally |
| 11/3/2006 4:[illegible] PM | 60-Gold | 102-Castle Crasher | ADD | for G2I | Admin | Bally |
| 11/3/2006 4:[illegible] PM | 50-Silver | 102-Castle Crasher | ADD | for G2I | Admin | Bally |
| 10/23/2006 2:57:36 AM | 70-Platinum | 103-Casino Challenge | ADD | Bally Default Games | Admin | Bally |
| 10/23/2006 2:[illegible]:29 AM | 60-Gold | 103-Casino Challenge | ADD | Bally Default Games | Admin | Bally |
| 10/23/2006 2:[illegible]:21 AM | 50-Silver | 103-Casino Challenge | ADD | Bally Default Games | Admin | Bally |
| 10/20/2006 5:09:50 AM | 70-Platinum | 101-Payday Poker | ADD | Bally Default Settings | Admin | Bally |
| 10/20/2006 5:09:38 AM | 70-Platinum | 100-Blue Spot Bingo | ADD | Bally Default Settings | Admin | Bally |
| 10/20/2006 5:[illegible] AM | 60-Gold | 101-Payday Poker | ADD | Bally Default Settings | Admin | Bally |
| 10/20/2006 5:09:05 AM | 60-Gold | 100-Blue Spot Bingo | ADD | Bally Default Settings | Admin | Bally |

1 2 ...

FIG.45A

4700
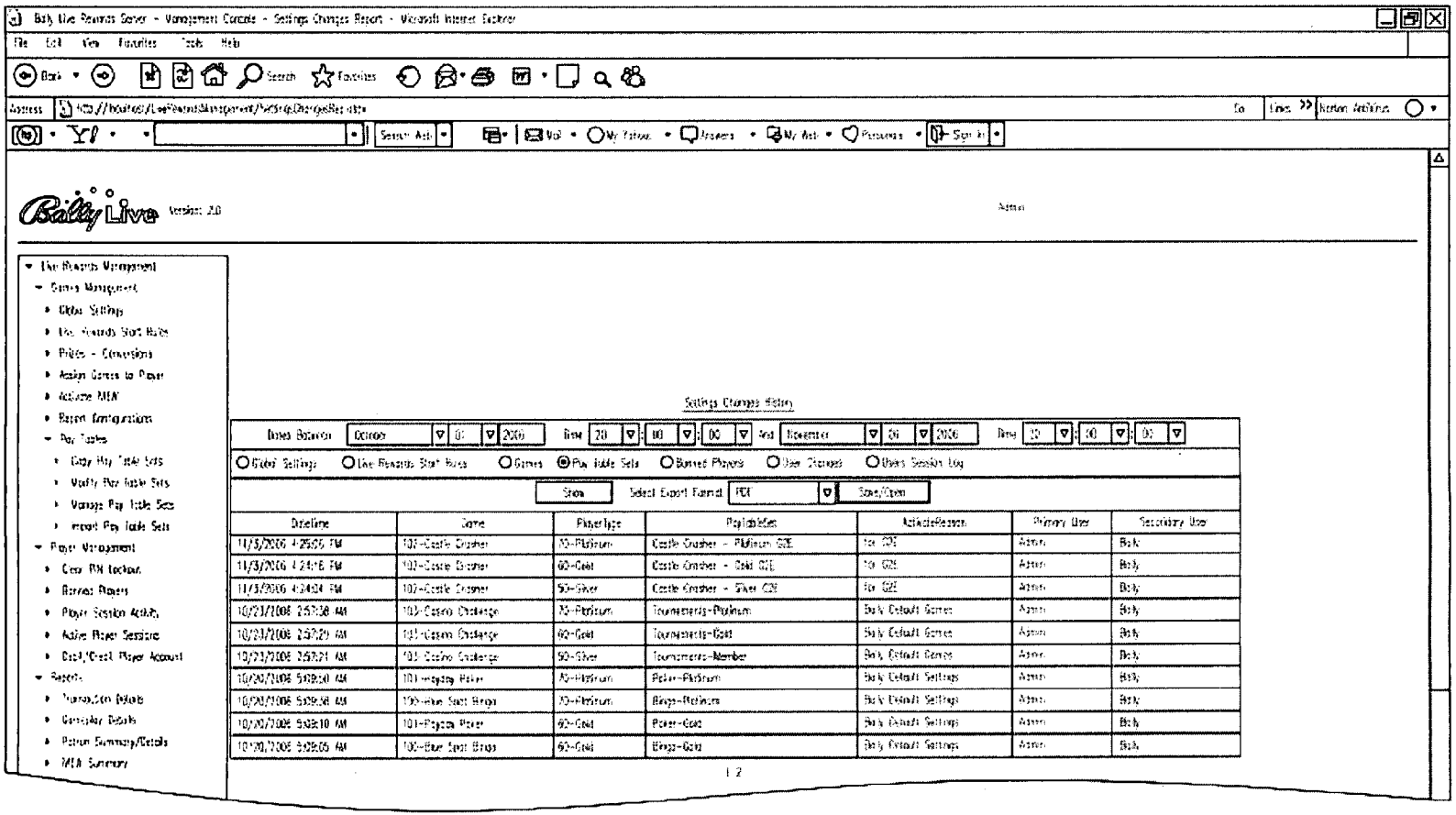
Bally Live
Version 2.0
Settings Changes Report
Date Range
Select Export Format
Date/time
Game
Player Type
Machine/Game
Player Type
Secondary Type
Bally Default Settings
Bally Default Game
Bally Default Game
Bally Default Settings
Bally Default Settings
Bally Default Settings

4702

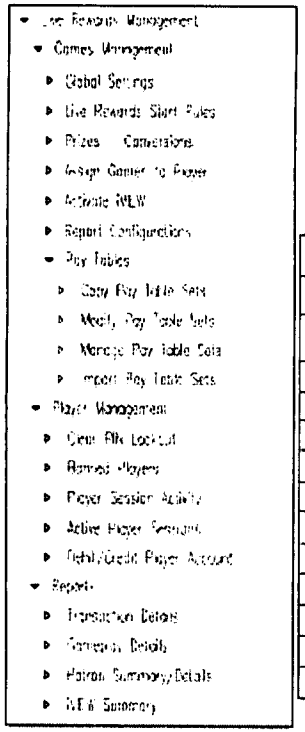

Settings Changes History

Dates Between October 01 2006 Time 20 : 00 : 00 And November 06 2006 Time 20 : 00 : 00

Global Settings | Live Rewards Start Rules | Games | Pay Table Sets | Banned Players | User Changes | Users Session Log Show | Select Export Format PDF | Save/Open

| DateTime | Game | PlayerType | PayTableSet | ActivateReason | Primary User | Secondary User |
|---|---|---|---|---|---|---|
| 11/3/2006 4:25:06 PM | 102-Castle Crusher | 70-Platinum | Castle Crusher - Platinum G2E | for G2E | Admin | Bally |
| 11/3/2006 4:24:19 PM | 102-Castle Crusher | 60-Gold | Castle Crusher - Gold G2E | for G2E | Admin | Bally |
| 11/3/2006 4:24:04 PM | 102-Castle Crusher | 50-Silver | Castle Crusher - Silver G2E | for G2E | Admin | Bally |
| 10/25/2006 2:57:35 AM | 103-Casino Challenge | 70-Platinum | Tournaments-Platinum | Bally Default Games | Admin | Bally |
| 10/25/2006 2:57:29 AM | 103-Casino Challenge | 60-Gold | Tournaments-Gold | Bally Default Games | Admin | Bally |
| 10/25/2006 2:57:21 AM | 103-Casino Challenge | 50-Silver | Tournaments-Market | Bally Default Games | Admin | Bally |
| 10/20/2006 5:09:50 AM | 101-Payday Poker | 70-Platinum | Poker-Platinum | Bally Default Settings | Admin | Bally |
| 10/20/2006 5:09:39 AM | 100-Blue Spot Bingo | 70-Platinum | Bingo-Platinum | Bally Default Settings | Admin | Bally |
| 10/20/2006 5:09:10 AM | 101-Payday Poker | 60-Gold | Poker-Gold | Bally Default Settings | Admin | Bally |
| 10/20/2006 5:09:05 AM | 100-Blue Spot Bingo | 60-Gold | Bingo-Gold | Bally Default Settings | Admin | Bally |

1 2

FIG.47A

4802

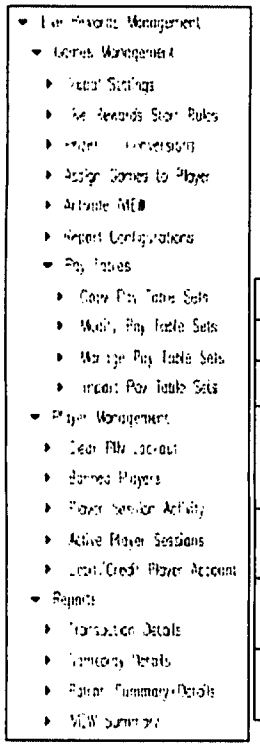

Settings Changes History

Dates Between October 01 2006 Time 20 : 00 : 00 And November 06 2006 Time 20 : 00 : 00

Global Settings | Live Rewards Start Rules | Games | Pay Table Sets | Banned Players | User Changes | Users Session Log Show | Select Export Format PDF | Save/Open

| DateTime | Player Type | Actual Rate | Live Rewards Game Start Threshold | Base Game (Normal Play) - Occurence | Base Game (Normal Play) - Increment | Base Game (Max Bet) - Occurence | Base Game (Max Bet) - Increment | Session Time - Occurence | Session Time - Increment | Session Continuation - Occurence | Session Continuation - Increment | Reason | Primary User | Secondary User |
|---|---|---|---|---|---|---|---|---|---|---|---|---|---|---|
| 10/20/2006 5:02:56 AM | 70-Platinum | 0.2500 | 100 | 1 | 1 | 1 | 0 | 0 | 0 | 0 | 0 | Bally Default Settings | Admin | Bally |
| 10/20/2006 5:02:37 AM | 60-Gold | 0.2500 | 100 | 1 | 1 | 1 | 0 | 0 | 0 | 0 | 0 | Bally Default Settings | Admin | Bally |
| 10/20/2006 5:02:15 AM | 50-Silver | 0.2500 | 100 | 1 | 1 | 1 | 0 | 0 | 0 | 0 | 0 | Bally Default Settings | Admin | Bally |

FIG.48A

5002

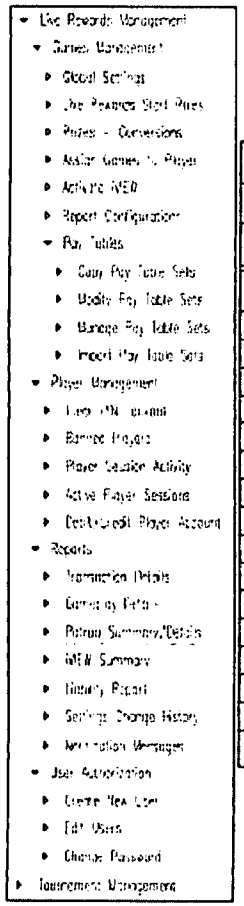

Patron Account Activity Summary/Details

Dates Between November 02 2006 Time 20 : 00 : 00 And November 05 2006 Time 20 : 00 : 30

Summary Details Player Card#

Show Select Export Format PDF Save/Open

| PLRCardNo | PLRName | Total Games Played | Total Games Won | Total Play Points In | Total Play Points Out | Total Threshold Counter In | Total Threshold Counter Out | Total Bonus Points In | Total Bonus Points Out | Total Cash In($) | Total Cash Out($) |
|---|---|---|---|---|---|---|---|---|---|---|---|
| 000000139 | Robert.Luciano | 0.00 | 0.00 | 0.00 | 0.00 | 0.00 | 0.00 | 0.00 | 0.00 | 0.00 | 0.00 |
| 000000145 | Richard.Haddrill | 0.00 | 0.00 | 0.00 | 0.00 | 0.00 | 0.00 | 0.00 | 0.00 | 0.00 | 0.00 |
| 000001380 | Jon.Lisi | 0.00 | 0.00 | 0.00 | 0.00 | 0.00 | 0.00 | 0.00 | 0.00 | 0.00 | 0.00 |
| 000220130 | Brendan.McCarthy | 0.00 | 0.00 | 0.00 | 0.00 | 0.00 | 0.00 | 0.00 | 0.00 | 0.00 | 0.00 |
| 000220134 | Colt.Bellair | 0.00 | 0.00 | 315.00 | 0.00 | 9.00 | 0.00 | 0.00 | 0.00 | 0.00 | 0.00 |
| 000220135 | Chad.Mistarua | 1.00 | 1.00 | 182.25 | 100.00 | 20.00 | 20.00 | 200.00 | 0.00 | 0.00 | 0.00 |
| 000220136 | Derek.Mocberry | 0.00 | 0.00 | 30.00 | 0.00 | 2.00 | 0.00 | 0.00 | 0.00 | 5.00 | 0.00 |
| 000220137 | Jeff.Connors | 0.00 | 0.00 | 15.00 | 0.00 | 1.00 | 0.00 | 0.00 | 0.00 | 0.00 | 0.00 |
| 000220138 | Rob.Jackson | 0.00 | 0.00 | 0.15 | 0.00 | 2.00 | 0.00 | 0.00 | 0.00 | 5.00 | 2.00 |
| 000220139 | Michael.Fiske | 0.00 | 0.00 | 18.75 | 0.00 | 7.00 | 0.00 | 0.00 | 0.00 | 10.00 | 1.00 |
| 000220140 | Evan.Bard | 0.00 | 0.00 | 0.00 | 0.00 | 0.00 | 0.00 | 0.00 | 0.00 | 0.00 | 0.00 |
| 000220141 | Tom.Reilly | 0.00 | 0.00 | 15.00 | 0.00 | 5.00 | 0.00 | 0.00 | 0.00 | 10.00 | 0.00 |
| 000220142 | Tom.Sansone | 2.00 | 1.00 | 255.00 | 200.00 | 10.00 | 10.00 | 340.00 | 0.00 | 10.00 | 0.00 |
| 000220143 | Chris.Schwab | 1.00 | 1.00 | 152.10 | 100.00 | 51.00 | 50.00 | 40.00 | 0.00 | 15.00 | 0.00 |
| 000220144 | Jerry.McGowan | 0.00 | 0.00 | 0.95 | 0.00 | 5.00 | 0.00 | 0.00 | 0.00 | 35.00 | 0.00 |

FIG.50A

5402

- Live Rewards Management
  - Games Management
    - Global Settings
    - Live Rewards Start Rules
    - Prizes Conversions
    - Assign Games to Player
    - Activate WEM
    - Player Configurations
    - Pay Tables
      - Copy Pay Table Sets
      - Modify Pay Table Sets
      - Manage Pay Table Sets
      - Import Pay Table Sets
  - Player Management
    - Clear PIN Lockout
    - Banned Players
    - Player Session Activity
    - Active Player Sessions
    - Debit/Credit Player Account
  - Reports
    - Transaction Details
    - Gameplay Details
    - Player Summary/Details
    - WEM Summary
    - Liability Report
    - Settings Change History
    - Notification Messages
  - User Administration
    - Create New User
    - Edit Users
    - Change Password
- Tournament Management Player Account Activity Summary/Details Dates Between November 02 2006 Time 20 : 00 : 00 And November 05 2006 Time 20 : 00 : 00

Summary Details Player Card# Show Select Export Format PDF Save/Open

| PlRCardNo | PlRName | Total Games Played | Total Games Won | Total Play Points In | Total Play Points Out | Total Threshold Counter In | Total Threshold Counter Out | Total Bonus Points In | Total Bonus Points Out | Total Cash In($) | Total Cash Out($) |
|---|---|---|---|---|---|---|---|---|---|---|---|
| 000000139 | Robert,Lapiana | 0.00 | 0.00 | 0.00 | 0.00 | 0.00 | 0.00 | 0.00 | 0.00 | 0.00 | 0.00 |
| 000000145 | Richard,Indelli | 0.00 | 0.00 | 0.00 | 0.00 | 0.00 | 0.00 | 0.00 | 0.00 | 0.00 | 0.00 |
| 000001560 | John,Link | 0.00 | 0.00 | 0.00 | 0.00 | 0.00 | 0.00 | 0.00 | 0.00 | 0.00 | 0.00 |
| 000220100 | Brendan,McCarthy | 0.00 | 0.00 | 0.00 | 0.00 | 0.00 | 0.00 | 0.00 | 0.00 | 0.00 | 0.00 |
| 000220134 | Gail,Belen | 0.00 | 0.00 | 315.00 | 0.00 | 0.00 | 0.00 | 0.00 | 0.00 | 0.00 | 0.00 |
| 000220135 | Cher,Medema | 1.00 | 1.00 | 182.95 | 100.00 | 20.00 | 20.00 | 200.00 | 0.00 | 0.00 | 0.00 |
| 000220136 | Jack,Moeberg | 0.00 | 0.00 | 30.00 | 0.00 | 2.00 | 0.00 | 0.00 | 0.00 | 0.00 | 0.00 |
| 000220137 | Jeff,Connors | 0.00 | 0.00 | 15.00 | 0.00 | 1.00 | 0.00 | 0.00 | 0.00 | 0.00 | 0.00 |
| 000220138 | Rob,Jacobsen | 0.00 | 0.00 | 0.15 | 0.00 | 2.00 | 0.00 | 0.00 | 0.00 | 0.00 | 2.00 |
| 000220139 | Marc,Tissier | 0.00 | 0.00 | 48.75 | 0.00 | 7.00 | 0.00 | 0.00 | 0.00 | 10.00 | 1.00 |
| 000220140 | Fran,Baull | 0.00 | 0.00 | 0.05 | 0.00 | 0.00 | 0.00 | 0.00 | 0.00 | 0.00 | 0.00 |
| 000220141 | Tom,Reily | 0.00 | 0.00 | 45.00 | 0.00 | 3.00 | 0.00 | 0.00 | 0.00 | 10.00 | 0.00 |
| 000220142 | Tom,Santoro | 2.00 | 1.00 | 255.00 | 200.00 | 10.00 | 10.00 | 240.00 | 0.00 | 10.00 | 0.00 |
| 000220143 | Chris,Schaub | 1.00 | 1.00 | 182.10 | 100.00 | 61.00 | 50.00 | 40.00 | 0.00 | 15.00 | 0.00 |
| 000220144 | Jerry,McGovern | 0.00 | 0.00 | 0.25 | 0.00 | 5.00 | 0.00 | 0.00 | 0.00 | 56.00 | 0.00 |

1 2

FIG.54A

5502

- Live Rewards Management
  - Game Management
    - Global Settings
    - Live Rewards Start Rules
    - Prizes Conversions
    - Assign Games to Player
    - Activate VEM
    - Reset Configurations
    - Pay Tables
      - Copy Pay Table Sets
      - Modify Pay Table Sets
      - Manage Pay Table Sets
      - Import Pay Table Sets
  - Player Management
    - Clear PIN Lockout
    - Suspect Players
    - Player Session Activity
    - Active Player Sessions
    - Clear Credit Player Account
  - Reports
    - Transaction Details
    - Gaming Details
    - Patron Summary/Details
    - Visit Summary
    - Liability Report
    - Settings Change History
    - Notification Messages
  - User Administration
    - Create New User Transaction Details Dates Between November 05 2006 Time 20 : 00 : 00 And November 06 2006 Time 23 : 00 : 00

Source ALL Player Card# Prize Type ALL Prize Type ALL

Source Id

Show Select Export Format PDF Save/Open

| Tran# | TranDateTime | PLPCardNo | Source | SourceId | Source Details | PrizeType | TranType | TranValue | Jurisdiction | Status |
|---|---|---|---|---|---|---|---|---|---|---|
| 901 | 11/6/2006 9:16:26 AM | 000422534 | View | 20534742-454E-4E4F-2042-0050C2062877 | View direct deposit | Play Points | Credit | 0.05 | NO | Committed |
| 902 | 11/6/2006 9:16:26 AM | 000422534 | View | 20534742-454E-4E4F-2042-0050C2062877 | Threshold Counter | Threshold Counter | Credit | 1.00 | NO | Committed |
| 903 | 11/6/2006 11:17:03 AM | 000422534 | View | 20534742-454E-4E4F-2042-0050C2062877 | View direct deposit | Play Points | Credit | 38.75 | NO | Committed |
| 904 | 11/6/2006 11:17:03 AM | 000422534 | View | 20534742-454E-4E4F-2042-0050C2062877 | View direct deposit | Threshold Counter | Credit | 19.00 | NO | Committed |
| 905 | 11/6/2006 11:17:04 AM | 000422534 | Game Play | 148 | BEGIN GAME | Play Points | Debit | 100.00 | NO | Committed |
| 906 | 11/6/2006 11:17:04 AM | 000422534 | Game Play | 148 | BEGIN GAME | Threshold Counter | Debit | 26.00 | NO | Committed |
| 907 | 11/6/2006 11:17:43 AM | 000422534 | View | 20534742-454E-4E4F-2042-0050C2062877 | View direct deposit | Play Points | Credit | 112.50 | NO | Committed |
| 908 | 11/6/2006 11:17:43 AM | 000422534 | View | 20534742-454E-4E4F-2042-0050C2062877 | View direct deposit | Threshold Counter | Credit | 54.00 | NO | Committed |
| 909 | 11/6/2006 11:17:44 AM | 000422534 | Game Play | 149 | BEGIN GAME | Play Points | Debit | 100.00 | NO | Committed |
| 910 | 11/6/2006 11:17:44 AM | 000422534 | Game Play | 149 | BEGIN GAME | Threshold Counter | Debit | 54.00 | NO | Committed |
| 911 | 11/6/2006 11:18:21 AM | 000422534 | View | 20534742-454E-4E4F-2042-0050C2062877 | View direct deposit | Play Points | Credit | 96.75 | NO | Committed |
| 912 | 11/6/2006 11:18:21 AM | 000422534 | View | 20534742-454E-4E4F-2042-0050C2062877 | View direct deposit | Threshold Counter | Credit | 47.00 | NO | Committed |
| 913 | 11/6/2006 11:18:22 AM | 000422534 | Game Play | 150 | BEGIN GAME | Play Points | Debit | 100.00 | NO | Committed |
| 914 | 11/6/2006 11:18:22 AM | 000422534 | Game Play | 150 | BEGIN GAME | Threshold Counter | Debit | 47.00 | NO | Committed |
| 915 | 11/6/2006 11:18:27 AM | 997766543 | View | 20534742-454E-4E4F-2042-0050C2064099 | View direct deposit | Play Points | Credit | 100.50 | NO | Committed |

1 2 3 4 5 6 7 8 9 10 ...

FIG.55A

58-1

| | Live Rewards Session Accounts |
|---|---|
| | |
| | |
| STEP# | Event |
| | |
| | |
| | |
| | |
| | Starting Values |
| 1 | Player #123 inserts 1st of his/her cards or logs in |
| 2 | Create Session(iVIEWID#176,Player#123) message sent to server |
| 3 | Player Wagers $20 over 80 base games and earns 5 play points and 80 STC's |
| 4 | DEPOSIT(5PP,80STC) message sent from iVIEW to Session account |
| 5 | BEGIN_GAME(10PP) message to Server from iVIEW |
| 6 | Server DEBITS session account by cost to play (10PP and All STC) |
| 7 | iView Begins a 10 Play Point Game and all STC's |
| 8 | Player Wins $10.00 on iView Poker game |
| 9 | END_GAME_DEPOSIT($10) message sent from iVIEW to Session account |
| 10 | Player Wagers $4 over 16 base games and earns 1 play point and 16 STC's |
| 11 | Player removes player card or logs out |
| 12 | CloseSession(iVIEWID#176,Player#123) message sent to server |
| | |
| | |
| | |
| | |
| 16 | Player #123 re-inserts card or logs into the same iVIEW |
| 17 | CreateSession(iVIEWID#176,Player#123) message sent at server |
| 18 | Player Wagers $100 over 110 games and earns 25 play points and 110STC |
| | |
| | |
| | |

FIG.58-1

58-2

| SERVER Sub-ACCOUNT MEW ID 176 | | | | | |
|---|---|---|---|---|---|
| PlayPoints (PP) | StartThrCtr (STC) | Live Reward Game Wins Cash | Play Points Earned since last deposit (PP) | PP Display Value includes PP on LRS | StartThrCtr Earned since last deposit (STC) |
| | | | | | |
| Session #1 Opened | | | | | |
| 10 | 50 | $0 | 0 | 10 | 0 |
| 10 | 50 | $0 | 5 | 15 | 80 |
| 15 | 130 | $0 | 0 | 15 | 0 |
| 15 | 130 | $0 | 0 | 15 | 0 |
| 5 | 0 | $0 | 0 | 5 | 0 |
| 5 | 0 | $0 | 0 | 5 | 0 |
| 5 | 0 | $0 | 0 | 5 | 0 |
| 5 | 0 | $10 | 0 | 5 | 0 |
| 5 | 0 | $10 | 1 | 6 | 16 |
| 6 | 16 | $10 | 0 | 6 | 0 |
| 0 | 0 | $0 | 0 | 0 | 0 |
| Session #1 Closed | | | | | |
| | | | | | |
| | | | | | |
| Session #3 Opened | | | | | |
| 0 | 0 | $0 | 0 | 0 | 0 |
| 0 | 0 | $0 | 25 | 25 | 110 |
| 0 | 0 | $0 | 25 | 25 | 110 |
| 0 | 0 | $0 | 25 | 25 | 110 |
| 0 | 0 | $0 | 25 | 25 | 110 |
| 0 | 0 | $0 | 25 | 25 | 110 |

FIG.58-2

58-3

| iView Values | | | SERVER ACCOUNT for Player Card#123 | | |
|---|---|---|---|---|---|
| STC Display Value Includes STC on LRS | $$ Temp On iView | $$ Display Value | PlayPoints PP | StartThrCtr (STC) | Live Reward Game Wins Cash |
| | | | 10 | 50 | – |
| | | | 10 | 50 | – |
| 50 | $0 | $0 | – | – | – |
| 130 | $0 | $0 | – | – | – |
| 130 | $0 | $0 | – | – | – |
| 130 | $0 | $0 | – | – | – |
| 0 | $0 | $0 | – | – | – |
| 0 | $0 | $0 | – | – | – |
| 0 | $10 | $10 | – | – | – |
| 0 | $0 | $10 | – | – | – |
| 16 | $0 | $10 | – | – | – |
| 16 | $0 | $10 | – | – | – |
| 0 | $0 | $0 | 6 | 16 | $10 |
| | | | 6 | 16 | $10 |
| | | | – | – | – |
| | | | – | – | – |
| | | | – | – | – |
| | | | – | – | – |
| 0 | $0 | $0 | – | – | – |
| 110 | $0 | $0 | – | – | – |
| 110 | $0 | $0 | – | – | – |
| 110 | $0 | $0 | – | – | – |
| 110 | $0 | $0 | – | – | – |
| 110 | $0 | $0 | – | – | – |

FIG.58-3

58-4

| | |
|---|---|
| | |
| | |
| | |
| | |
| | |
| 28 | DEPOSIT(25PP,110STC) message sent from iVIEW to Session account |
| 29 | BEGIN_GAME(5PP) message to Server from iVIEW |
| 30 | Server DEBITS session account by cost to play (5PP and all STC) |
| 31 | iVIEW Begins a 5 Play Point Tournament Game |
| 32 | END_GAME sent from iVIEW to LRS |
| 33 | LRS determines player wins tournament ($30.00) |
| 34 | Player removes player card or logs out |
| 35 | CloseSession(iVIEWID#176,Player#123) message sent to server |
| | |
| Notes: | |
| 1 | At BEGIN_GAME:StartThrCtr-always set to zero in a session account after a successful |
| 2 | At BEGIN_GAME:Play Points-are deducted in session account by the cost to play this |
| 3 | Upon Player Tracking Card insertion a session account is created and all values from |
| 4 | The First card in reserves the Master Player account values into Session Account for |
| 5 | A Second Card inserted of the same card number immediately following the First |
| 6 | Each player plays against his/her own session account. This way they can't spend |
| 7 | When a player pulls his card or logs out the session is closed and the session |
| 8 | Any other player account values will be treated the same way. Including Player |
| 9 | There will be no sub-accounts if all cards removed |
| 10 | Note that is the case of the player playing an LRS tournament the cash winnings |
| 11 | When player removes their card all PP and STC are transferred to the player |
| 12 | For this example to play a game the minimum PP needed is 5 and the |
| | |

FIG.58-4

58-5

| | | | | | |
|---|---|---|---|---|---|
| 0 | 0 | $0 | 25 | 25 | 110 |
| 0 | 0 | $0 | 25 | 25 | 110 |
| 0 | 0 | $0 | 25 | 25 | 110 |
| 0 | 0 | $0 | 25 | 25 | 110 |
| 0 | 0 | $0 | 25 | 25 | 110 |
| 25 | 110 | $0 | 0 | 25 | 0 |
| 25 | 110 | $0 | 0 | 25 | 0 |
| 20 | 0 | $0 | 0 | 20 | 0 |
| 20 | 0 | $0 | 0 | 20 | 0 |
| 20 | 0 | $0 | 0 | 20 | 0 |
| 20 | 0 | $30 | 0 | 20 | 0 |
| 20 | 0 | $30 | 0 | 20 | 0 |
| 0 | 0 | $0 | 0 | 0 | 0 |
| Session #3 Closed | | | | | |
| | | | | | |
| | | | | | |
| begingame transaction | | | | | |
| Bonus Game for the selected pay table | | | | | |
| the master account as transferred into the session account | | | | | |
| this iVIEW and Player ID | | | | | |
| card will get all zeros for his session account | | | | | |
| each others account values or winnings | | | | | |
| account values are added back into the Master account | | | | | |
| Club Points | | | | | |
| | | | | | |
| are never transferred to the iView but are stored only in player's LRS account until successful | | | | | |
| session account before closing the account | | | | | |
| minimum STC is 100 | | | | | |
| | | | | | |

FIG.58-5

58-6

| | | | | | |
|---|---|---|---|---|---|
| 110 | $0 | $0 | – | – | – |
| 110 | $0 | $0 | – | – | – |
| 110 | $0 | $0 | – | – | – |
| 110 | $0 | $0 | – | – | – |
| 110 | $0 | $0 | 10 | – | $9 |
| 110 | $0 | $0 | 10 | – | $9 |
| 110 | $0 | $0 | 10 | – | $9 |
| 0 | $0 | $0 | 10 | – | $9 |
| 0 | $0 | $0 | 10 | – | $9 |
| 0 | $0 | $0 | 10 | – | $9 |
| 0 | $0 | $30 | 10 | – | $9 |
| 0 | $0 | $30 | 10 | – | $9 |
| 0 | $0 | $0 | 30 | – | $39 |
| | | | | | |
| | | | | | |
| | | | | | |
| | | | | | |
| | | | | | |
| | | | | | |
| | | | | | |
| | | | | | |
| | | | | | |
| transfer to the base game | | | | | |
| | | | | | |
| | | | | | |

FIG.58-6

| STEP # | iView Values | | | |
|---|---|---|---|---|
| | Play Points Earned since last deposit (PP) | PP Dispoly Value Includes PP on LRS | StartThrCtr Earned since last deposit (STC) | STC Display Value Includes STC on LRS |
| 1 | | | | |
| 2 | | | | |
| 3 | | | | |
| 4 | | | | |
| 5 | | | | |
| 6 | | | | |
| 7 | | | | |
| 8 | | | | |
| 9 | | | | |
| 10 | | | | |
| 11 | | | | |
| 12 | | | | |
| | 0 | 6 | 0 | 16 |
| | 10 | 16 | 84 | 100 |
| | 10 | 16 | 84 | 100 |
| 16 | 10 | 16 | 84 | 100 |
| 17 | 10 | 16 | 84 | 100 |
| 18 | 10 | 16 | 84 | 100 |
| | 0 | 16 | 0 | 100 |
| | 0 | 16 | 0 | 100 |
| | 0 | 11 | 0 | 0 |
| | 0 | 11 | 0 | 0 |
| | 0 | 11 | 0 | 0 |
| | 0 | 11 | 0 | 0 |
| | 0 | 11 | 0 | 0 |
| | 0 | 11 | 0 | 0 |
| | 0 | 0 | 0 | 0 |
| 28 | | | | |
| 29 | | | | |
| 30 | | | | |
| 31 | | | | |
| 32 | | | | |
| 33 | | | | |
| 34 | | | | |
| 35 | | | | |

59-2

| | | SERVER Sub-ACCOUNT iView ID 473 | | | |
|---|---|---|---|---|---|
| $$ TEMP On iView | $$ Display Value | PlayPoints (PP) | StartThrCtr (STC) | Live Reward Game Wins Cash | STEP # |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | Session #2 Opened | | | 13 |
| $0 | $10 | 6 | 16 | $10 | 14 |
| $0 | $10 | 6 | 16 | $10 | 15 |
| $0 | $10 | 6 | 16 | $10 | |
| $0 | $10 | 6 | 16 | $10 | |
| $0 | $10 | 6 | 16 | $10 | |
| $0 | $10 | 6 | 16 | $10 | |
| $0 | $10 | 16 | 100 | $10 | 19 |
| $0 | $10 | 16 | 100 | $10 | 20 |
| $0 | $10 | 11 | 0 | $10 | 21 |
| $0 | $10 | 11 | 0 | $10 | 22 |
| $0 | $10 | 11 | 0 | $10 | 23 |
| $0 | $10 | 11 | 0 | $10 | 24 |
| $0 | $9 | 11 | 0 | $9 | 25 |
| $0 | $9 | 11 | 0 | $9 | 26 |
| $0 | $0 | 0 | 0 | $0 | 27 |
| | | | | | |
| | | | | | |
| | | | | | |
| | | | | | |
| | | | | | |
| | | | | | |
| | | | | | |
| | | | | | |

FIG.59-2

59-3

| Event |
| --- |
| |
| |
| |
| |
| |
| |
| |
| |
| |
| |
| |
| |
| |
| |
| |
| |
| Player #123 inserts 2nd of his/her cards or logs in |
| Create Session (iVIEWID#473,Player#123) message sent to server |
| Player Wagers $40 over 84 base games |
| and earns 10 play points and 84 STCs on iVIEW |
| |
| |
| |
| DEPOSIT (10PP,103STC) message sent from iVIEW to Session account |
| BEGIN_GAME (5PP) message to Server from iVIEW |
| Server DEBITS session account by cost to play (5PP and All STC) |
| iVIEW Begins a 5 Play Point Bingo game |
| Player loses the iVIEW game |
| END_GAME_DEPOSIT($0) message sent from iVIEW to Session account |
| Player Cashes out $1 from session account to base game |
| Player removes player card or logs out |
| Close Session (iVIEWID#473,Player#123) message sent to server |
| |
| |
| |
| |
| |

FIG.59-3

7600

Session A - [24x80]

File Edit View Communication Actions Window Help

SPSGB001 System Games Global Setup 5/24/06 14:10:25

Edit Record

Corp ID...: B
Prop ID...: 1

Auto Play ..... N
Auto Play ID ..... 12345678 1235 ABCD 1234 12345678ABC (Y/N)
PIN Required ..... N (Y/N)
Hand Pay Limit ..... .00
Idle Reset Time ..... 0
Dollars Played to Earn Point ..... .25
Points Earned to Play a Game ..... 5
Winnings Deposit Location ..... I (I-iSeries, G-Game, E-eBonus)
Days to Keep Winnings Active ..... 001
Carded Player Winning Type ..... C (C-Cashable, N-Non-Cashable)
Non-Carded Player Winning Type ..... C (C-Cashable, N-Non-Cashable)
Card Levels Supported ..... Y -Low Y -Mid Y -High
No Activity Days to Purge ..... 5

F12=Cancel ENTER=process

MA d 05/014

1902 - Session successfully started \\acsc-file-01\HP4100_DEV on NetO2:

FIG. 76

NETWORKED GAMING SYSTEM COMMUNICATION PROTOCOLS AND METHODS

CROSS REFERENCE TO RELATED APPLICATIONS

This application is a continuation-in-part of both U.S. Ser. No. 11/938,644 and U.S. Ser. No. 11/938,666, both filed on Nov. 12, 2007, both of which claim the benefit of U.S. Ser. No. 60/865,649, filed on Nov. 14, 2006, and both of which were a continuation-in-part of U.S. Ser. No. 11/470,606, filed on Sep. 6, 2006, and U.S. Ser. No. 10/943,771, filed Sep. 6, 2004; and this application claims the benefit of U.S. Ser. No. 60/987,234, U.S. Ser. No. 60/987,274, U.S. Ser. No. 60/987,259, U.S. Ser. No. 60/987,266, U.S. Ser. No. 60/987,274 and U.S. Ser. No. 60/987,402, all filed on Nov. 12, 2007, all of which are hereby incorporated by reference herein in their entirety.

This application is also related to U.S. Ser. No. 11/065,757, filed Feb. 24, 2005, which is a continuation-in-part of U.S. Ser. No. 10/243,912, filed on Sep. 13, 2002, both of which are hereby incorporated by reference herein in their entirety.

This application is further related to U.S. Ser. No. 12/291,836, filed Nov. 12, 2008, U.S. Ser. No. 12/291,833, filed Nov. 12, 2008, U.S. Ser. No. 12/291,847, filed Nov. 12, 2008, U.S. Ser. No. 12/291,846, filed Nov. 12, 2008, U.S. Ser. No. 12/291,835, filed Nov. 12, 2008, U.S. Ser. No. 12/291,842, filed Nov. 12, 2008, U.S. Ser. No. 12/291,834, filed Nov. 12, 2008, U.S. Ser. No. 12/291,843, filed Nov. 12, 2008, U.S. Ser. No. 12/291,832, filed Nov. 12, 2008, all of which are hereby incorporated by reference herein in their entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The field of the invention relates to wagering games, and more specifically to networked gaming systems and methods which offer or provide games, such as systems-based games, to players based on player patronage.

2. Description of the Related Art

Various networked gaming systems have been developed over the years beginning at least in the 1980's. With acceptance and utilization, users such as casino operators have found it desirable to increase the computer management of their facilities and expand features available on networked gaming systems. For instance, there are various areas in the management of casinos that is very labor intensive, such as reconfiguring gaming machines, changing games on the gaming machines, and performing cash transactions for customers.

Amongst the services that may be provided include player rewards based on game play and other patronage. Player tracking systems and servers may be implemented as part of networked gaming systems. To facilitate communication between the various components on the system, various communication protocols may be implemented.

There continues to be a need for improved protocols as information needs grow and as various features and aspects are implemented on the networked gaming systems.

SUMMARY OF THE INVENTION

In one aspect of the invention, a network-based game is provided through a player interface console based upon play of a base game. The network-based game is provided through a game server connected to a computerized management system.

In an embodiment, a method for implementing a networked gaming system is provided. The method includes operating one or more gaming machines. The method further includes operating a rewards server. The method also includes identifying a user at one of the one or more gaming machines. The method also includes identifying the user as a bonus-qualified user responsive to the user meeting a threshold winning level and responsive to verification of available funds in the user account at the rewards server. Identifying the user as a bonus qualified user causes authorizing debit of an account of the user at the rewards server upon successful qualification for a bonus mode involving at least another of the one or more gaming machines. Identifying the user as a bonus qualified user also causes initiating a game history ID reflective of transactions of the bonus mode and sending a record of the authorizing and the game history ID to the one of the one or more gaming machines from the rewards server when the bonus mode is initiated.

Further aspects, features and advantages of various embodiments of the invention may be apparent from the following detailed disclosure, taken in conjunction with the accompanying sheets of drawings.

BRIEF DESCRIPTION OF THE DRAWINGS

FIGS. 9A-1, 9A-2, 9A-3, 9A-4, 9B-1, 9B-2 (collectively, FIG. 9) illustrate a cashing out sequence beginning from a main game panel on a player console in accordance with one or more embodiments of the present invention.

FIGS. 18, 19 illustrate a screenshot of the Device Configuration in the employee function pages at the iVIEW.

FIGS. 25, 25A (collectively referred to as FIG. 25) illustrate a pair of screenshots of the Live Rewards Server Assign Games to Player feature. This is where specific games and their pay table sets are assigned to specific club levels of players.

FIGS. 28, 28A (collectively referred to as FIG. 28) illustrate a pair of screenshots of the Live Rewards Server Copy Pay Table Sets feature. Other pay table sets can be copied as a means to quickly setup slightly modified pay table sets.

Every debit and credit is accounted for on what iVIEW, what session, what time, as are all bucket balances.

Figure 39:
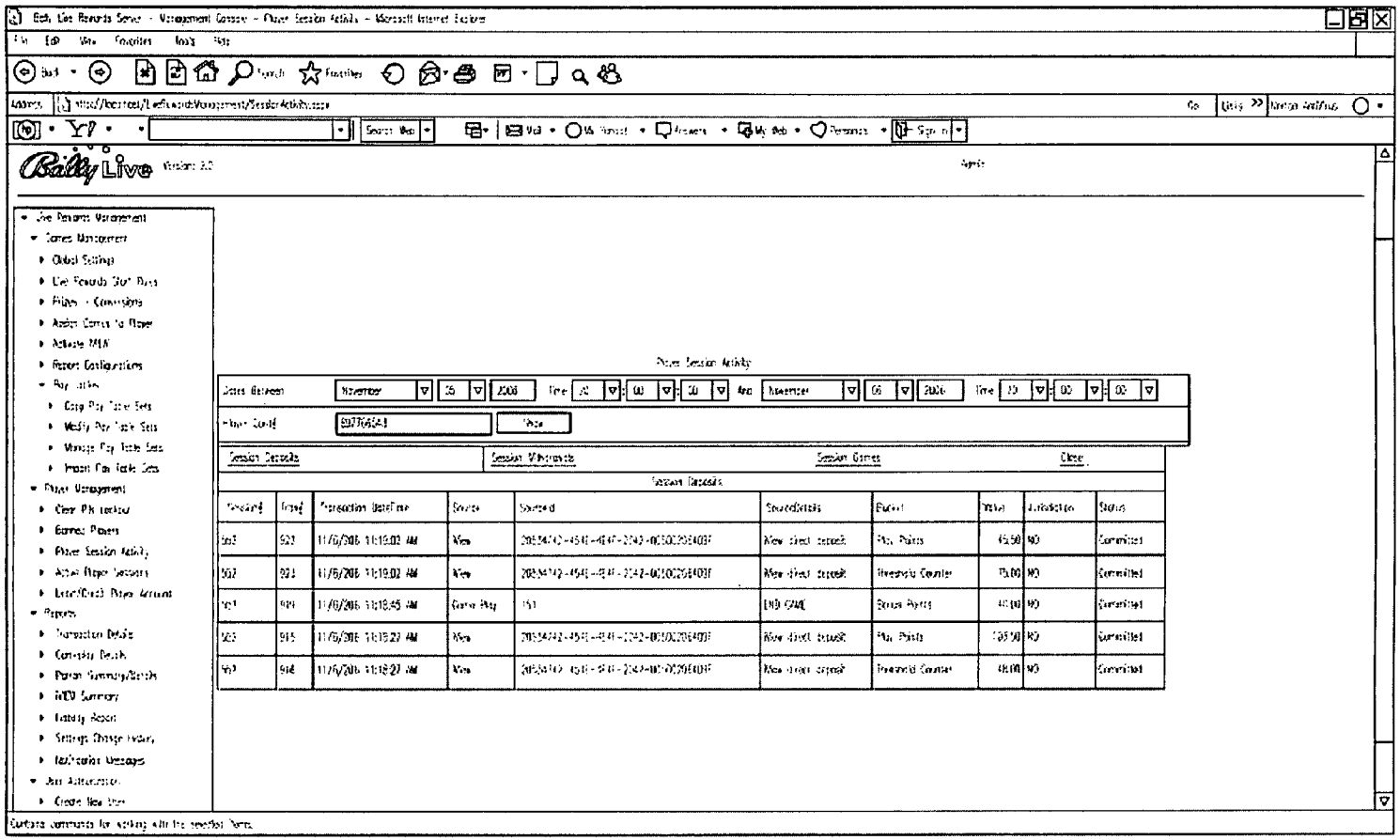
Figure 39A:
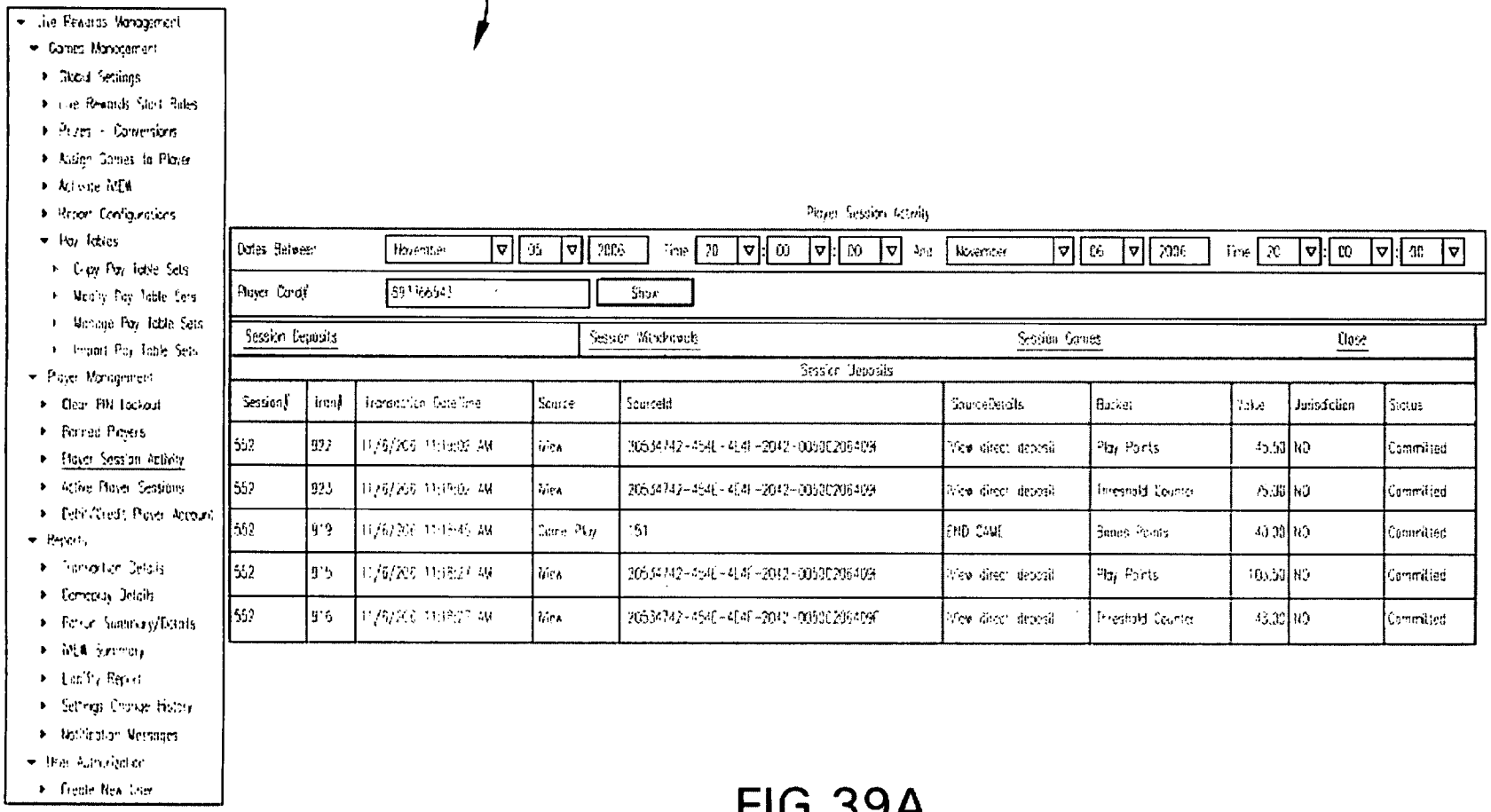

FIGS. 39, 39A (collectively referred to as FIG. 39) illustrate a pair of screenshots of the Live Rewards Server Player Session Deposits feature. Every transaction for an actively playing person is tracked here including deposits, bucket affected, current balances, who initiated the transaction, and what is the status on the pending transaction (committed, rolled back, cancelled, etc.)

Figure 40:
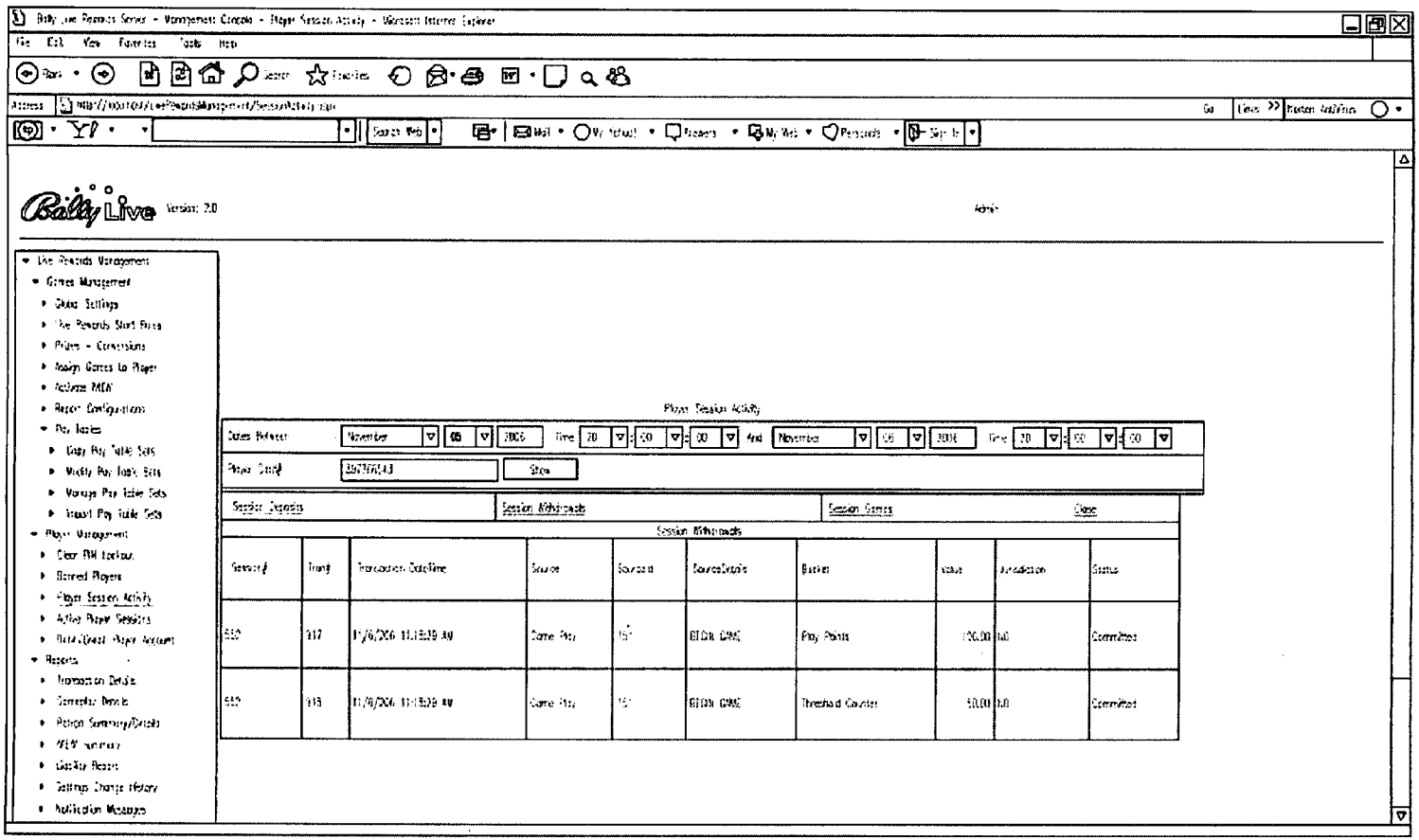
Figure 40A:
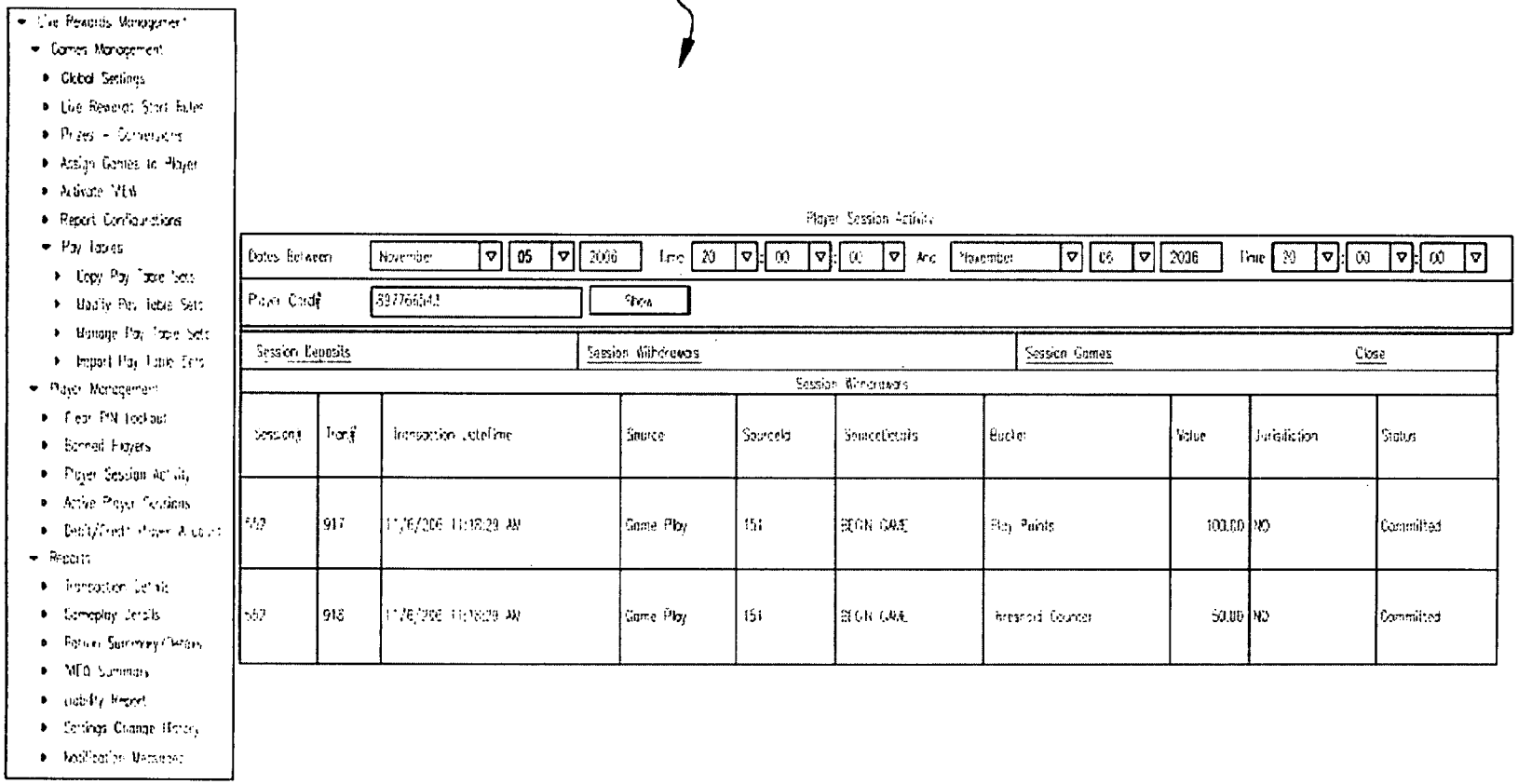

FIGS. 40, 40A (collectively referred to as FIG. 40) illustrate a pair of screenshots of the Live Rewards Server Player Session Withdrawals feature. Every withdrawal transaction to the player account for an actively playing player is shown here. For example: if you spend your accrued play points, it gets debited from your player card account or if your cash winnings are transferred from the iVIEW to the slot machine, it gets debited from your Live Rewards account and credited to your main player account on the casino management system or onto the slot machine itself.

Figure 41:
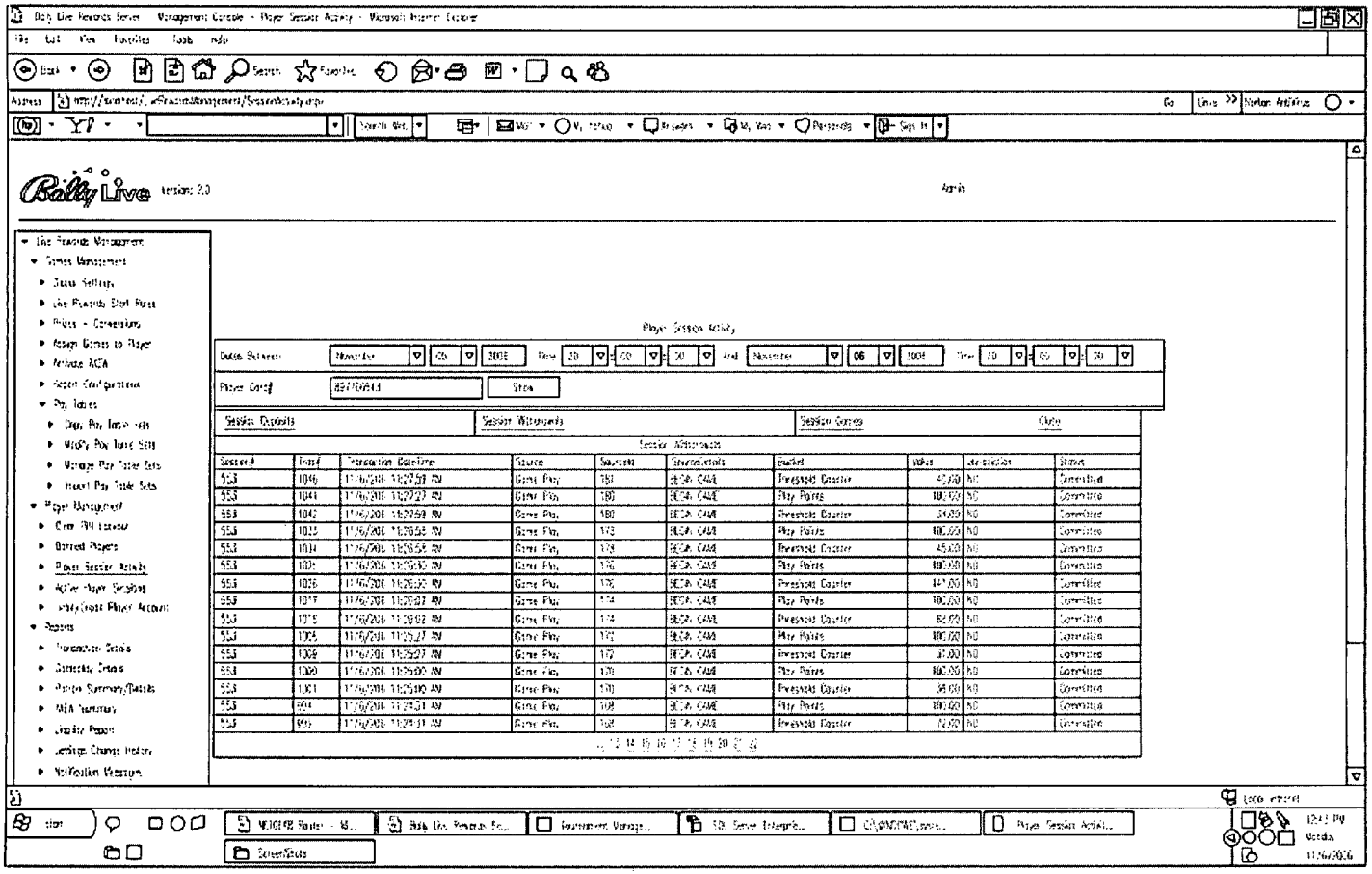

FIGS. 41, 41A (collectively referred to as FIG. 41) illustrate a pair of screenshots of the Live Rewards Server Player Session Game Activity. All game transactions for a specific player are shown on this screen.

Figure 42:
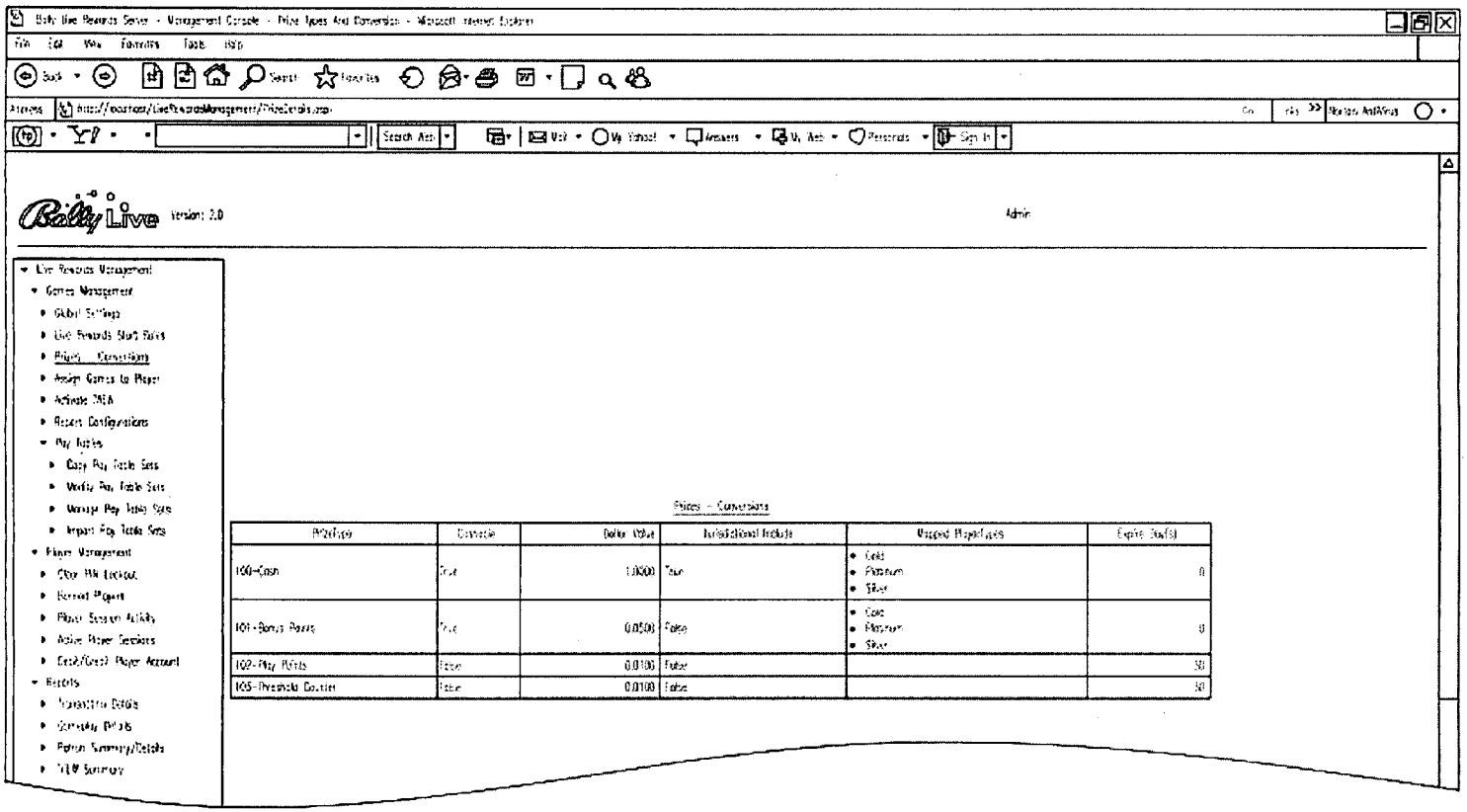

FIGS. 42, 42A (collectively referred to as FIG. 42) illustrate a pair of screenshots of the Live Rewards Server Prizes-Conversion screen. This screen shows casino personnel which types of prizes are configured for which types of players, they effective cost or value of the prize types and what are the currently configured expire rules for these player account buckets.

Figure 43:
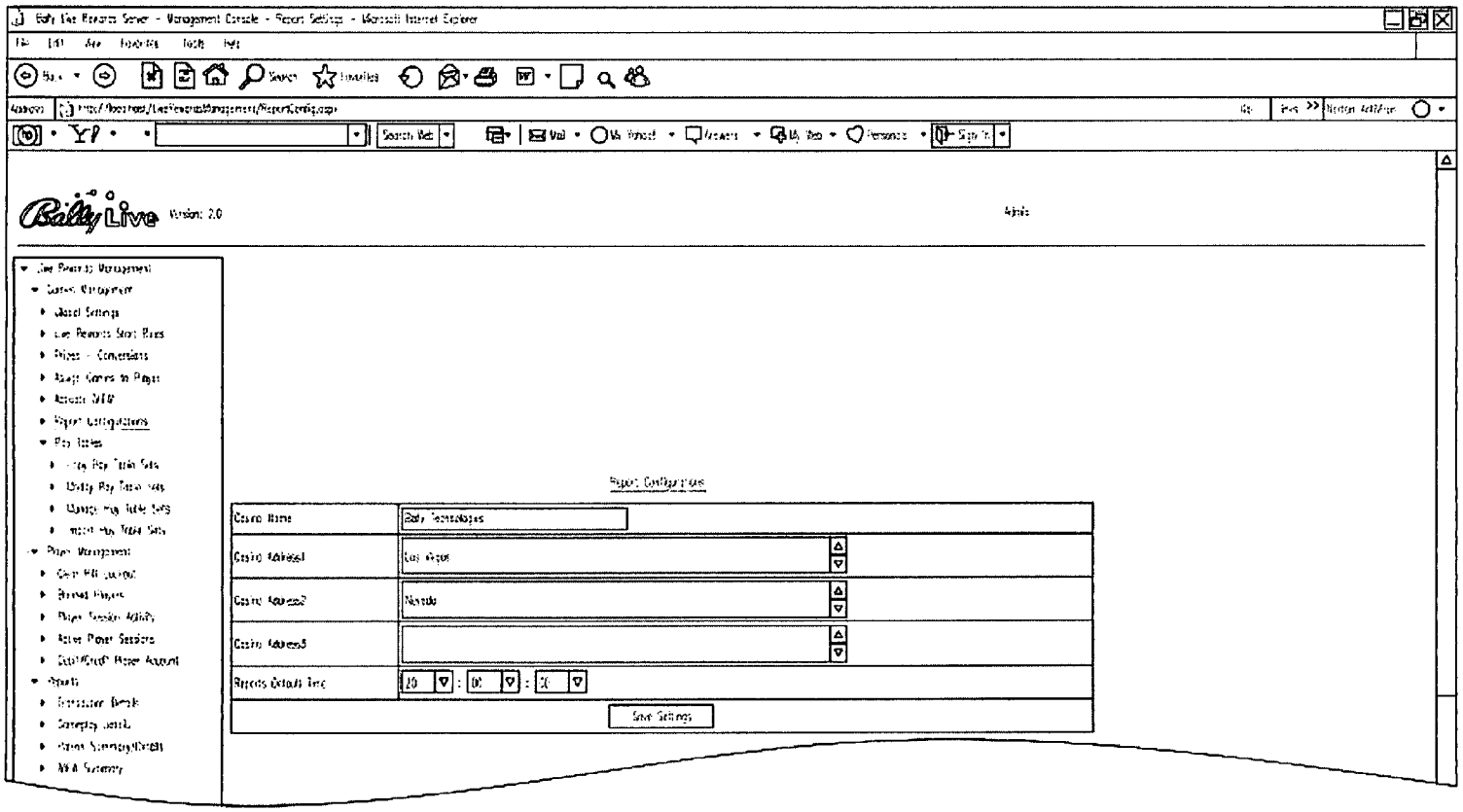
Figure 43A:
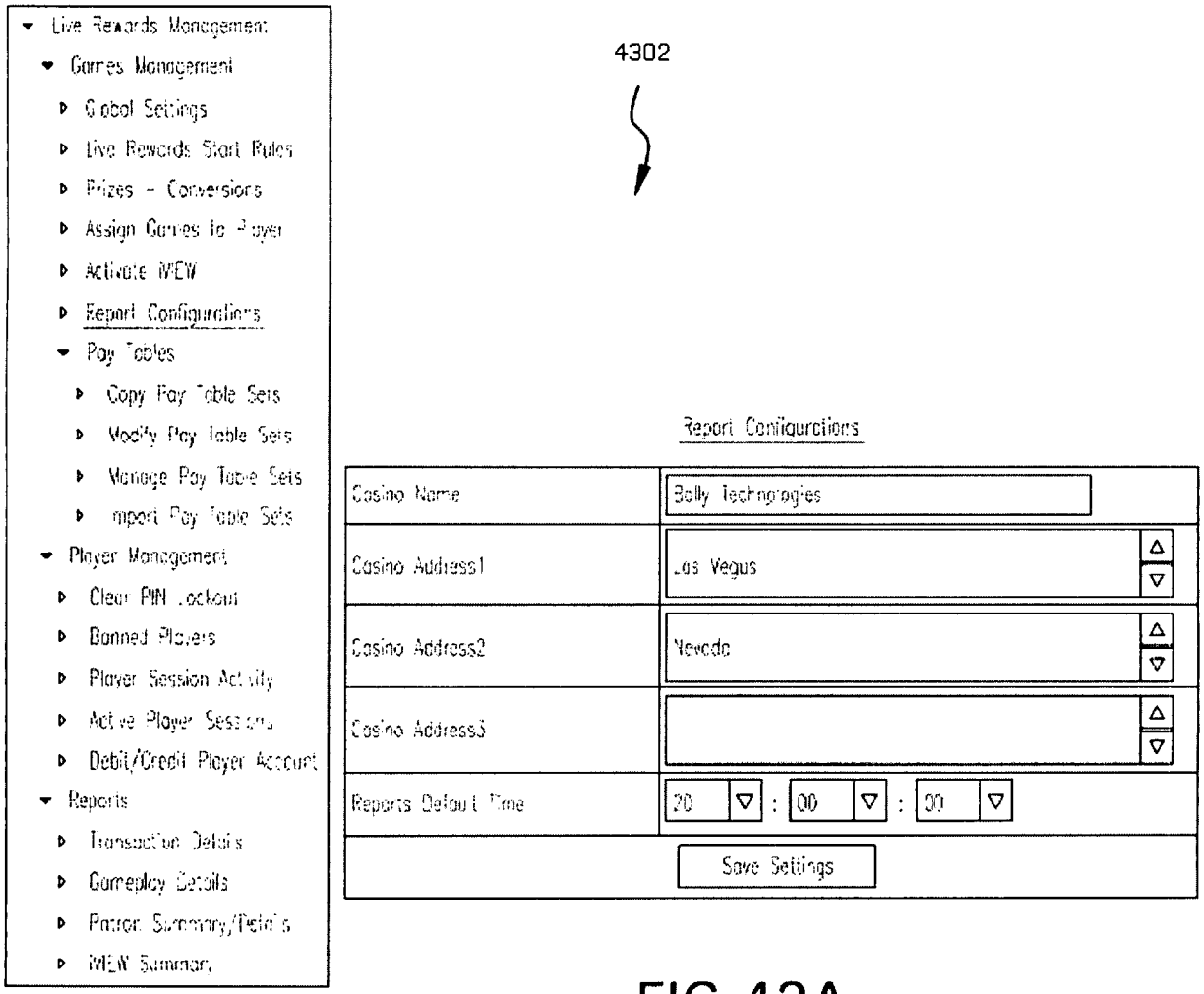

FIGS. 43, 43A (collectively referred to as FIG. 43) illustrate a pair of screenshots of the Live Rewards Server Report configurations feature. All reports will be configured with this information. Also the time that the reports will run once a day can be configured here.

Figure 44:
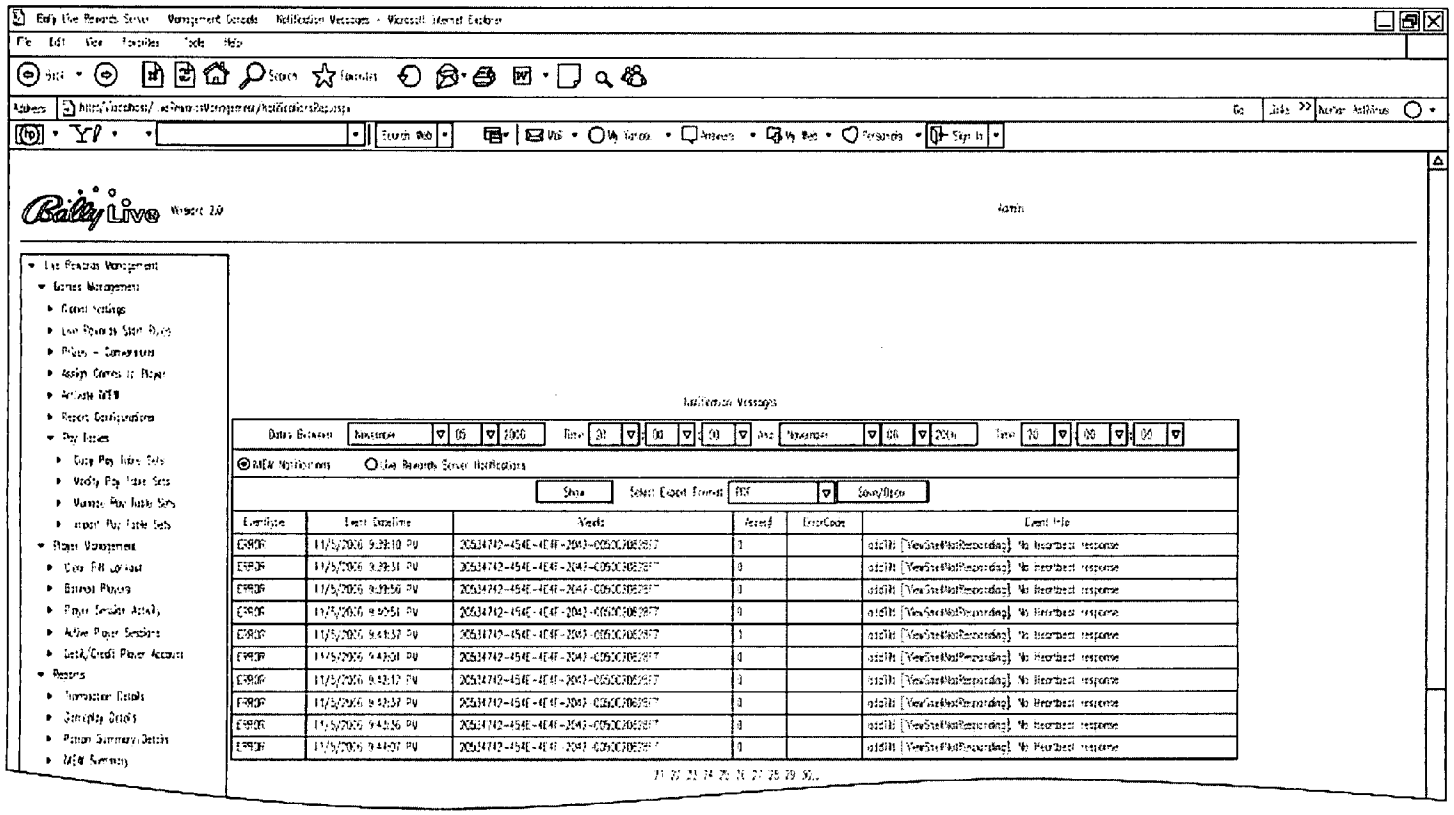
Figure 44A:
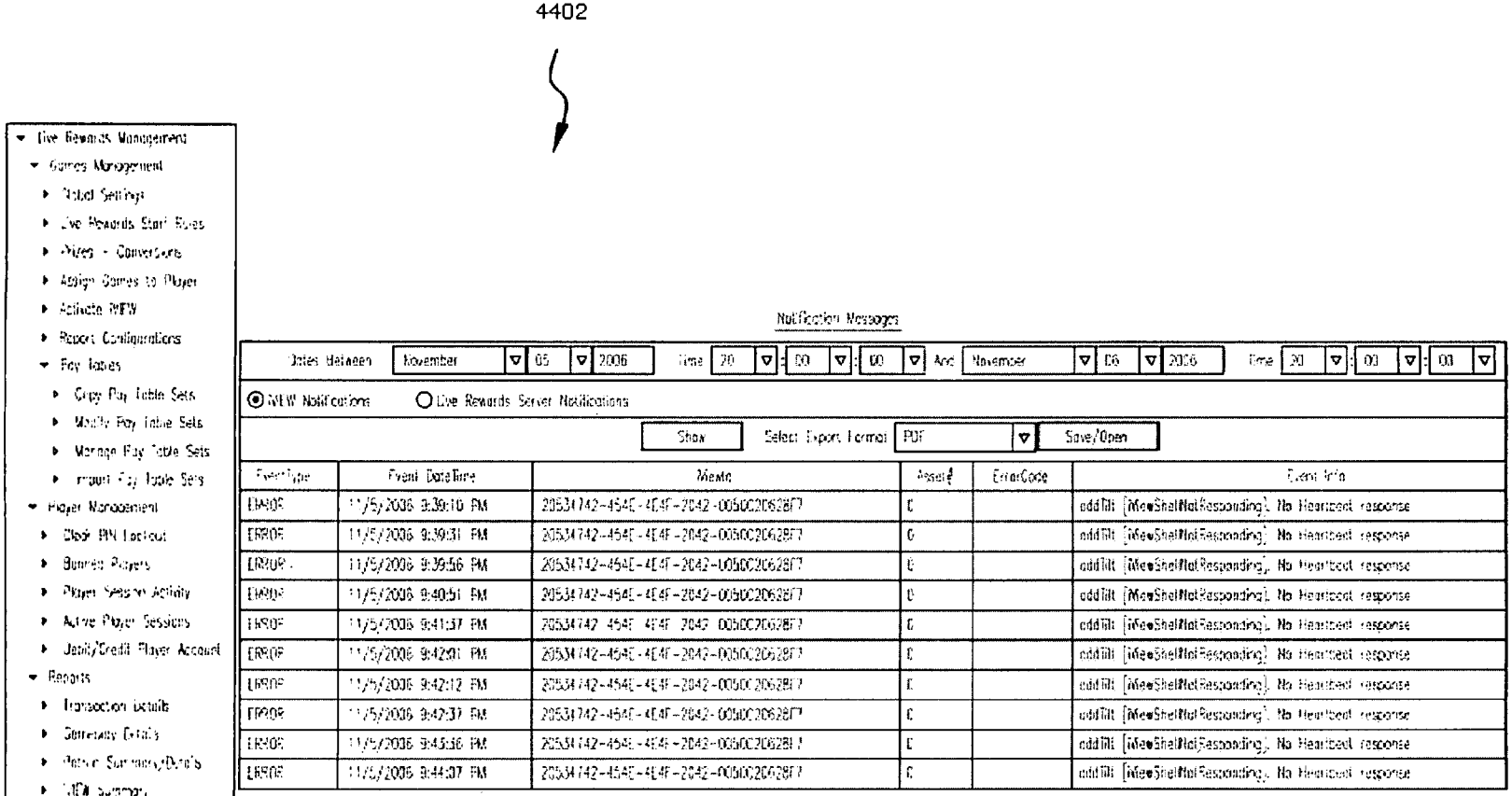

FIGS. 44, 44A (collectively referred to as FIG. 44) illustrate a pair of screenshots of the Live Rewards Server Notification Messages report. All iVIEW events and Live Rewards server events are logged to this page. This feature is used to help casino personnel view error or other events for maintenance and customer service reasons.

Figure 45:
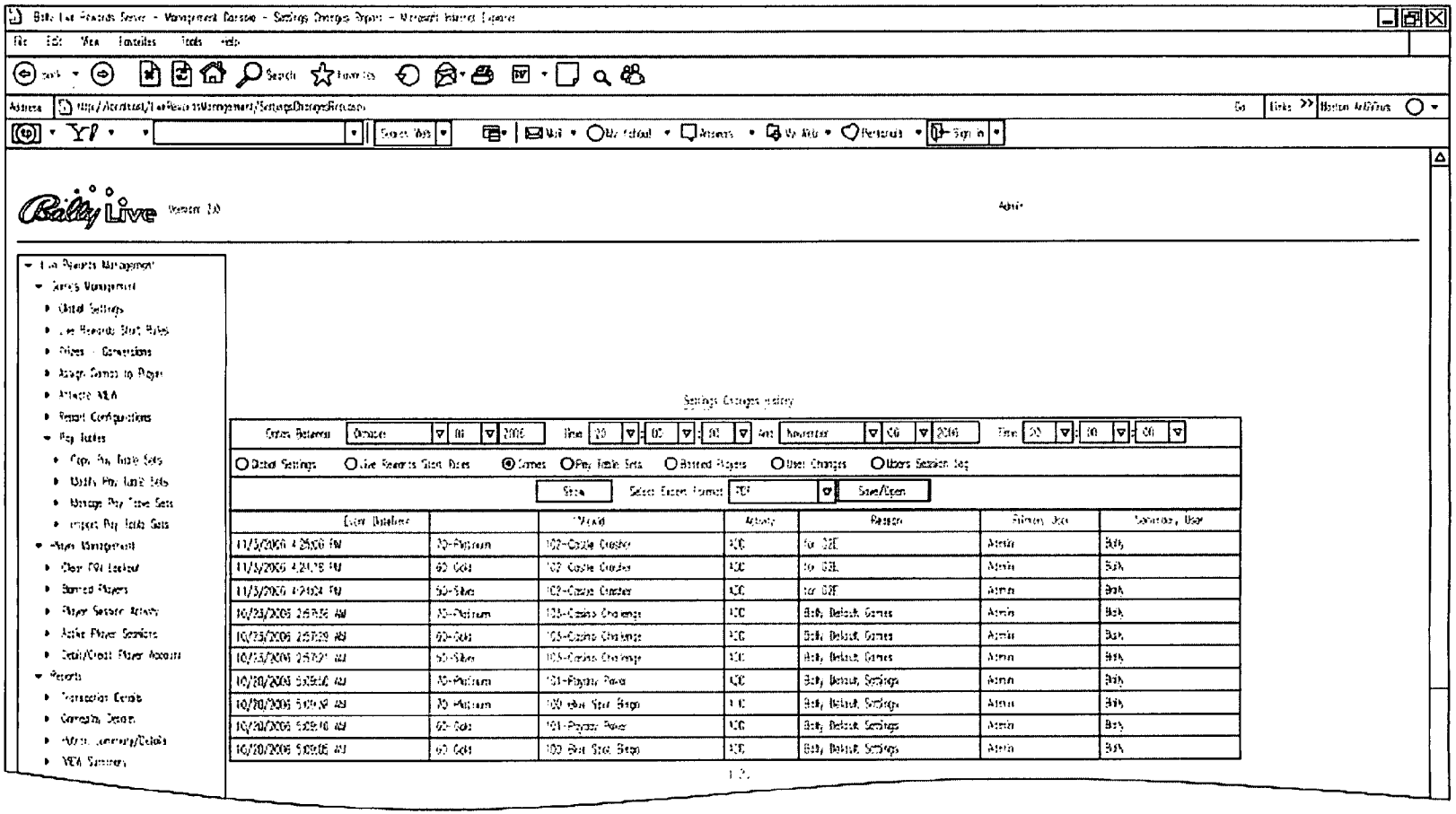

FIGS. 45, 45A (collectively referred to as FIG. 45) illustrate a pair of screenshots of the Live Rewards Server Games Settings Changes History report. All settings that are changed to the Live Rewards server are viewable here. What was changed, who did it and time are the types of data shown. Regulators use this to monitor for compliance reasons.

Figure 46:
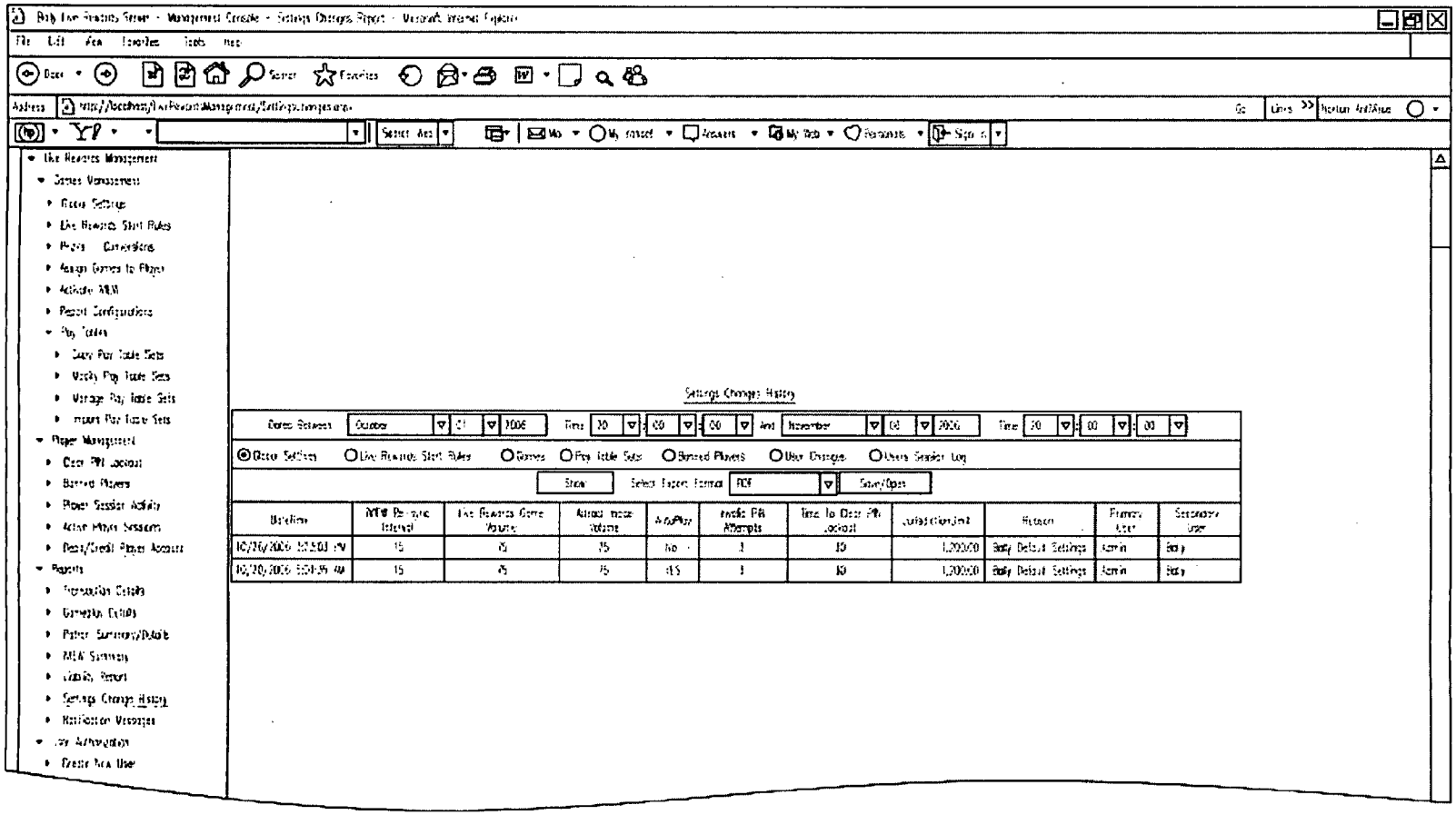
Figure 46A:
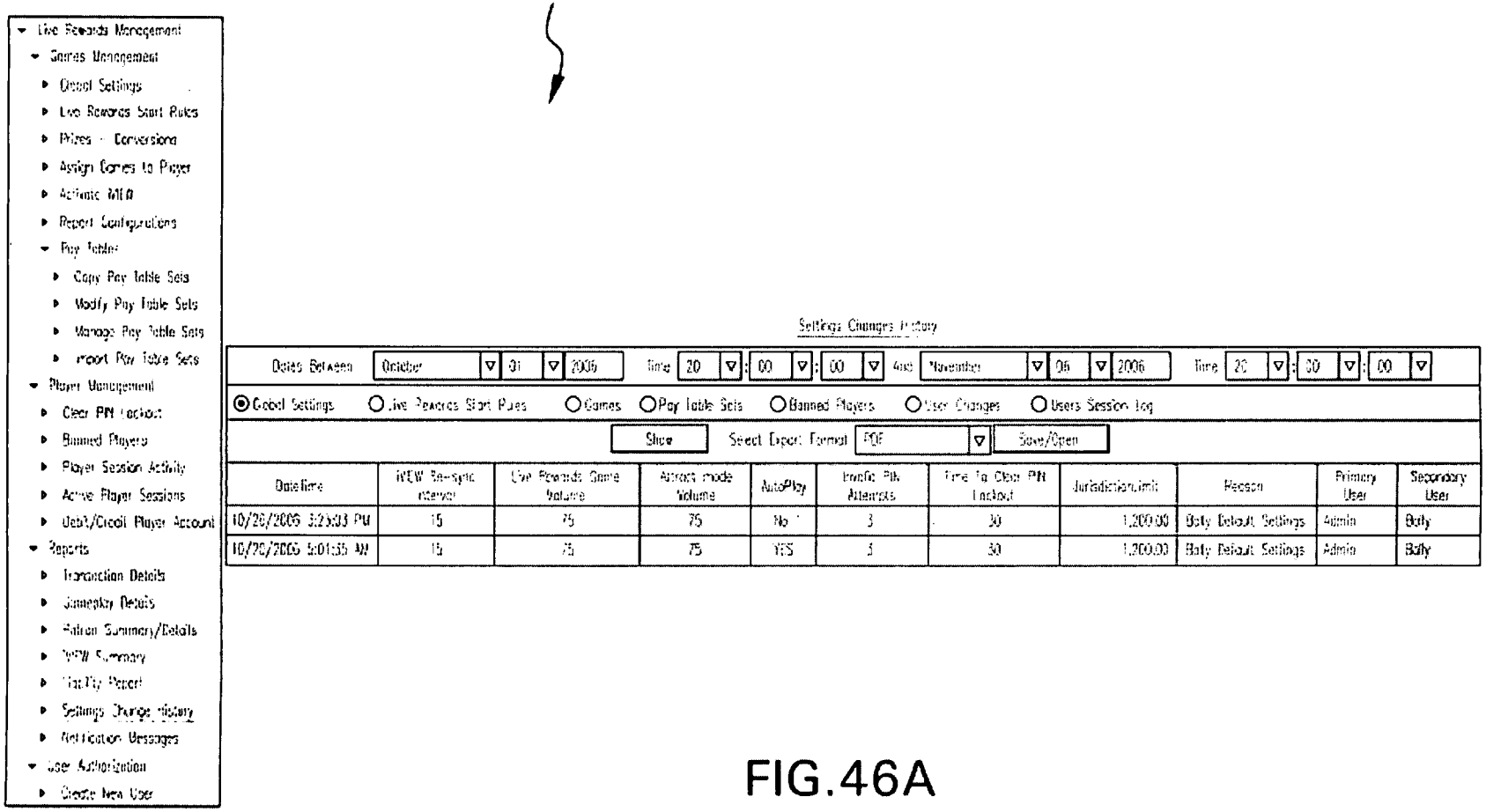

FIGS. 46, 46A (collectively referred to as FIG. 46) illustrate a pair of screenshots of the Live Rewards Server Global Settings Change History report. All settings that are changed to the Live Rewards server are viewable here in this report. What was changed, who did it and time are the types of data shown. Regulators use this to monitor for compliance reasons.

FIGS. 47, 47A (collectively referred to as FIG. 47) illustrate a pair of screenshots of the Live Rewards Server Pay Table Settings Change History report. All settings that are changed to the Live Rewards server are viewable here. What was changed, who did it and time are the types of data shown. Regulators use this to monitor for compliance reasons.

Figure 48:
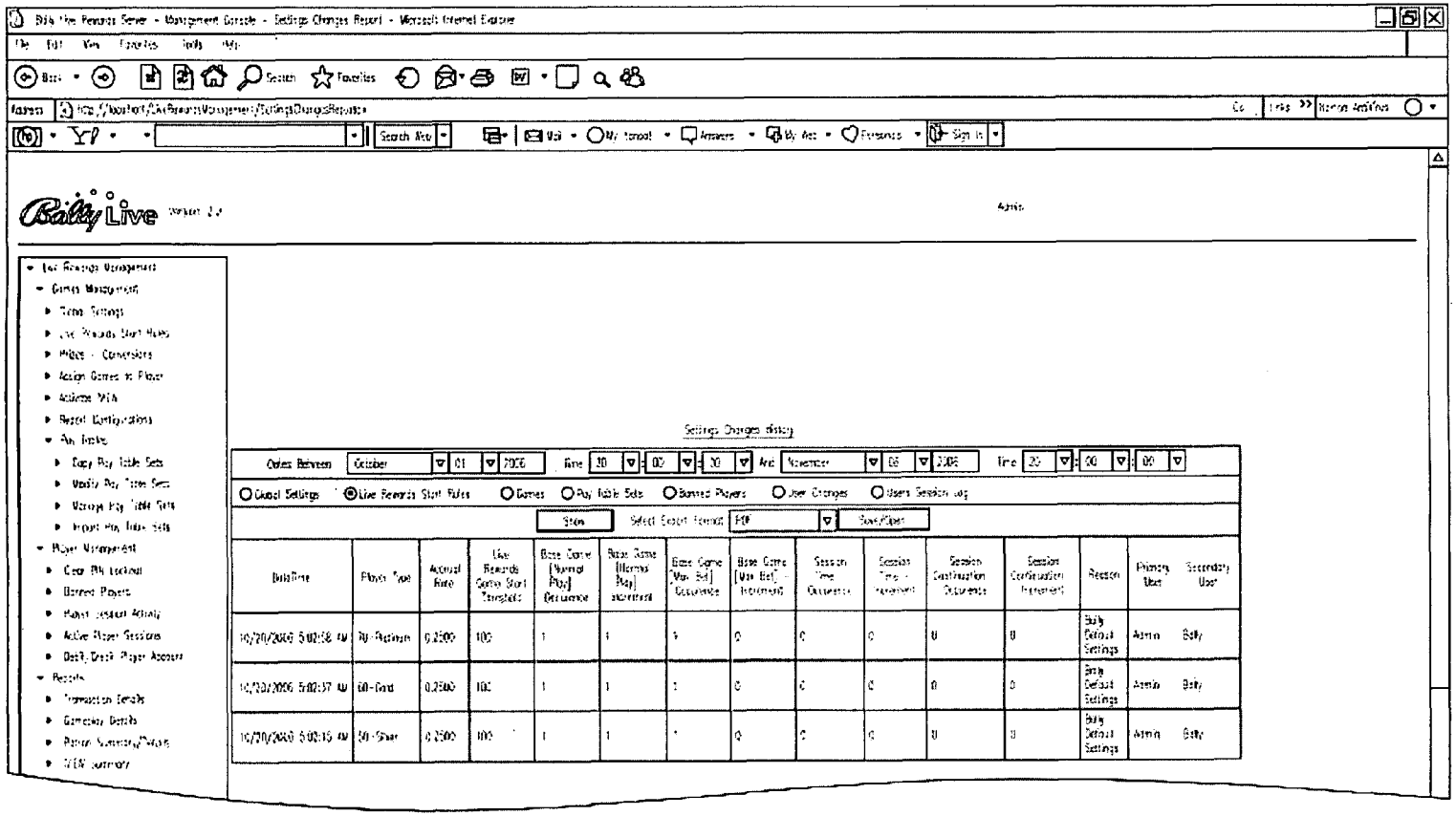

FIGS. 48, 48A (collectively referred to as FIG. 48) illustrate a pair of screenshots of the Live Rewards Server Live Rewards Start Rules Settings Change History report. All settings that are changed to the Live Rewards server are viewable here. What was changed, who did it and time are the types of data shown. Regulators use this to monitor for compliance reasons.

Figure 49:
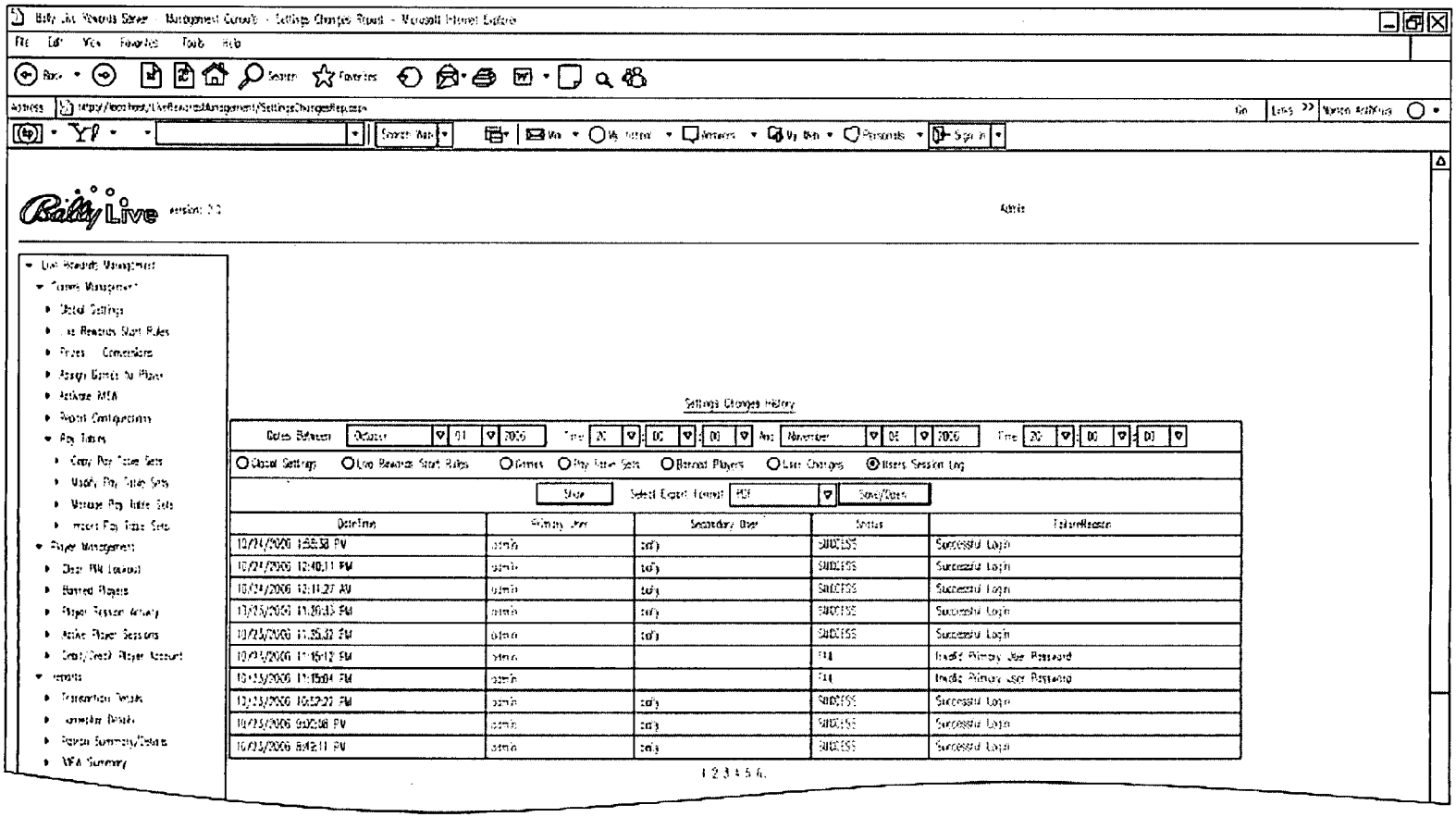
Figure 49A:
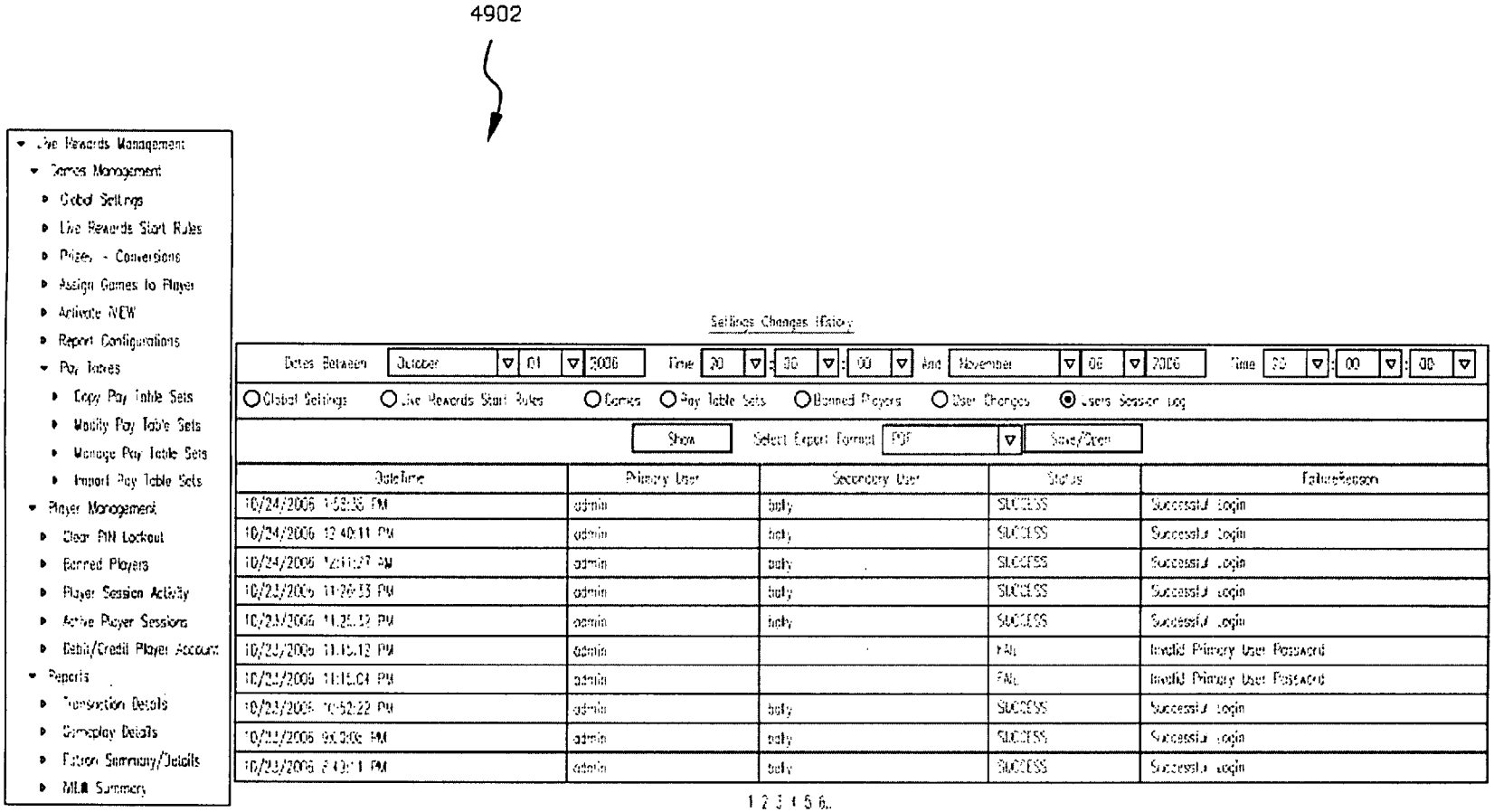

FIGS. 49, 49A (collectively referred to as FIG. 49) illustrate a pair of screenshots of the Live Rewards Server User Session Logs report. All logins, attempted, successful, failures are logged here. Regulators use this to monitor for compliance reasons.

Figure 50:
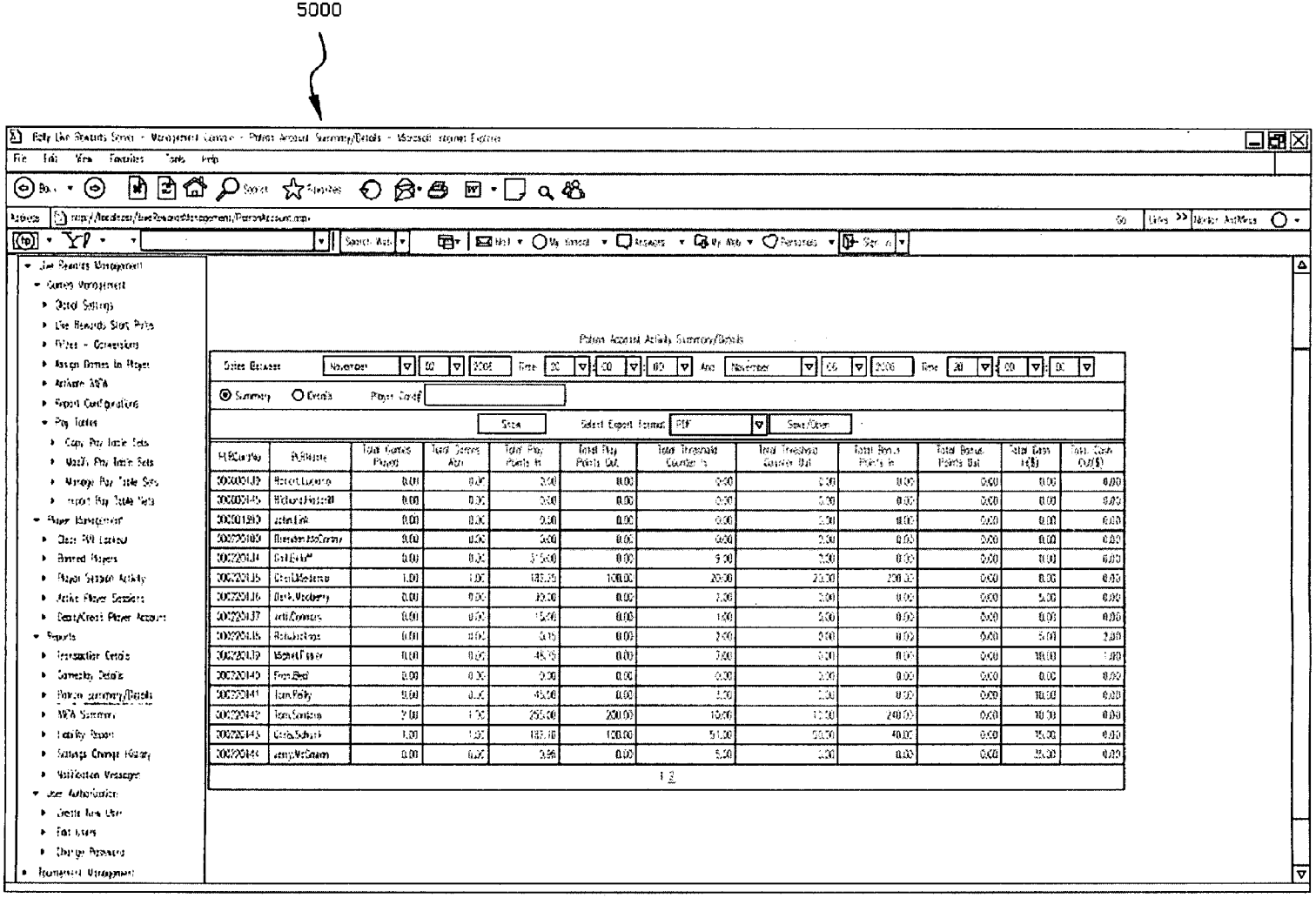

FIGS. 50, 50A (collectively referred to as FIG. 50) illustrate a pair of screenshots of the Live Rewards Server Patron Summary/Details report. Various game play history, debits, credits, wins/losses are shown here for specific players in a specific time range. Summary or details pages are available.

Figure 51:
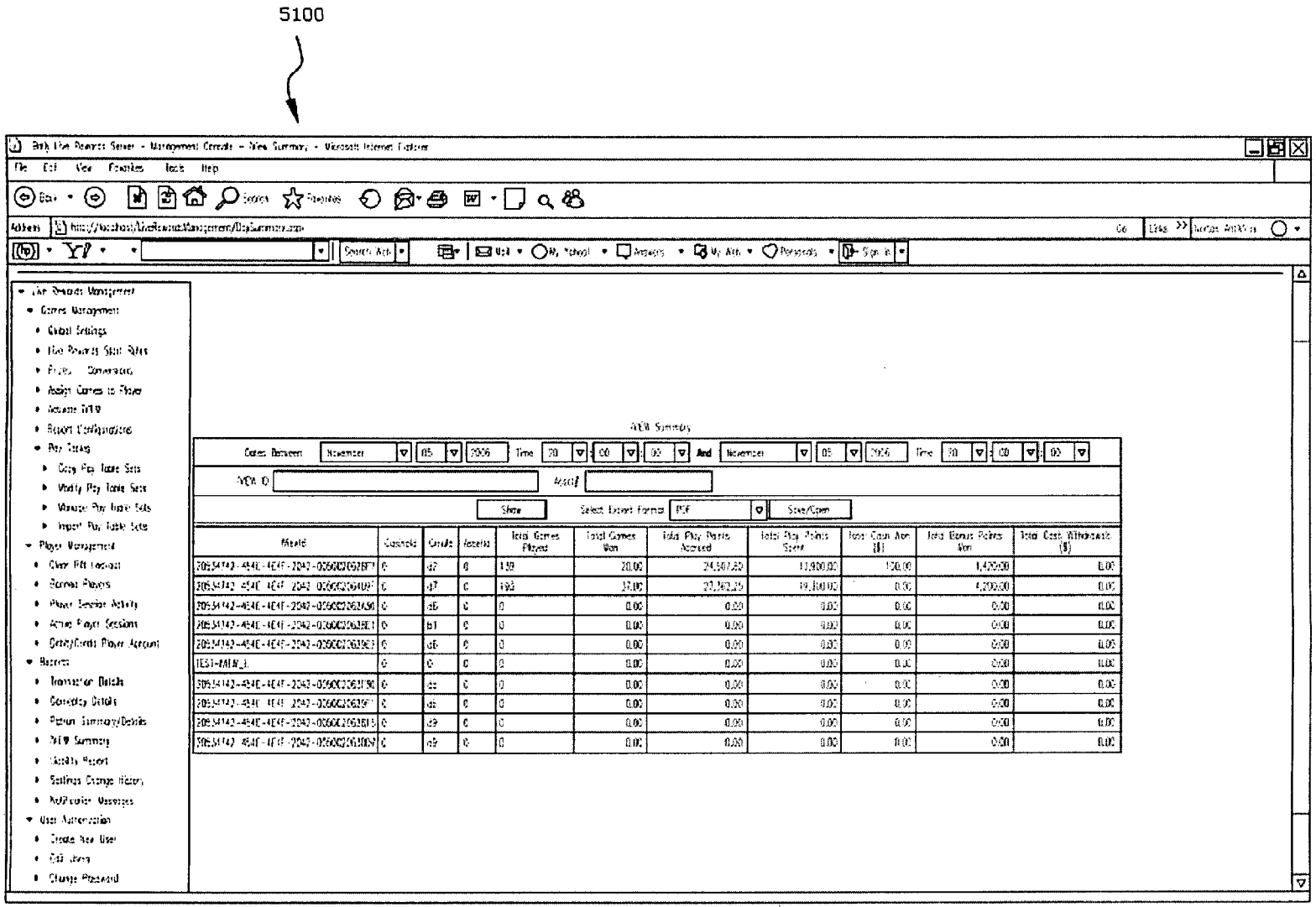
Figure 51A:
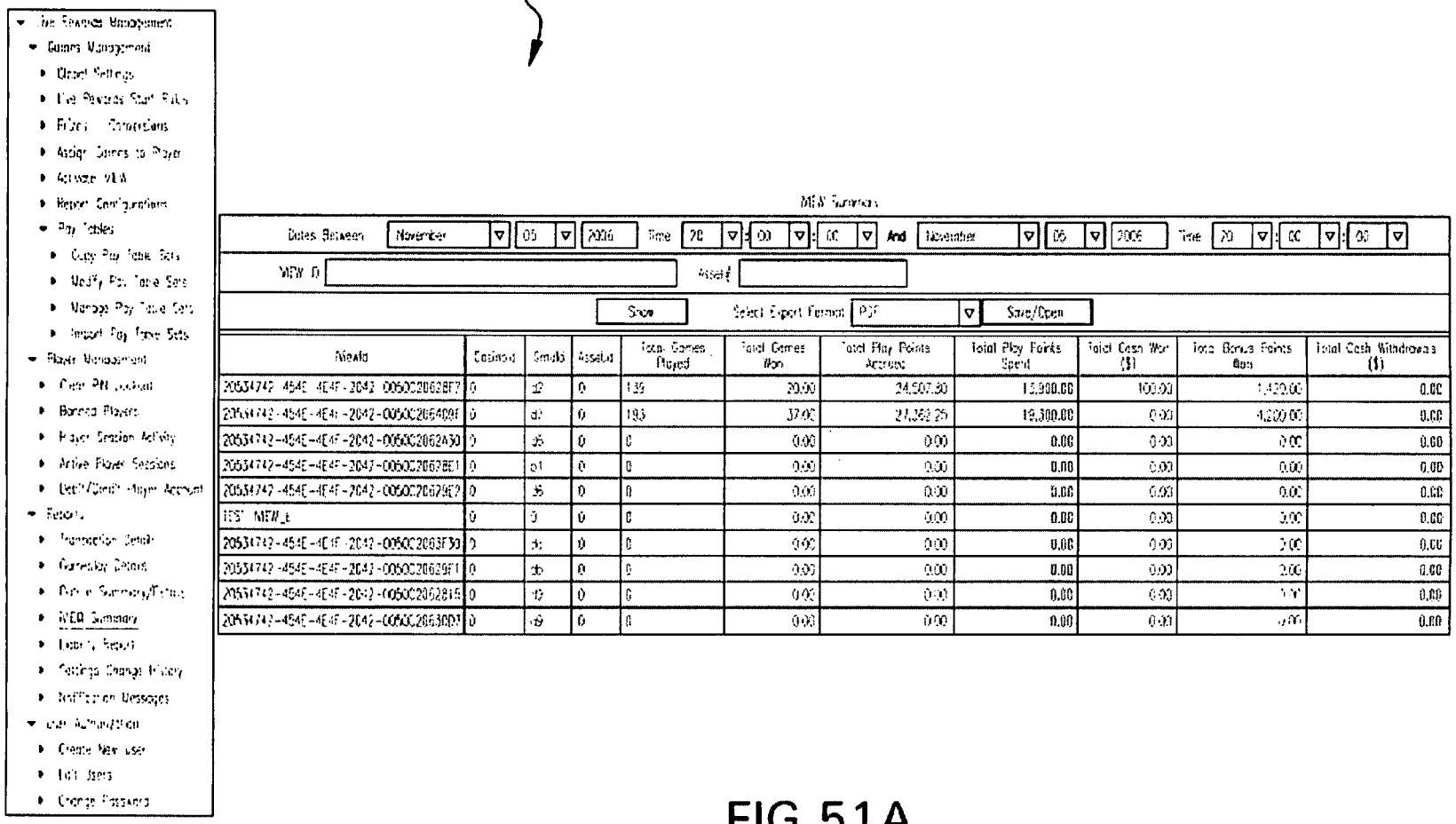

FIGS. 51, 51A (collectively referred to as FIG. 51) illustrate a pair of screenshots of the Live Rewards Server iVIEW summary report. Device specific reports (independent of player) is shown here.

Figure 52:
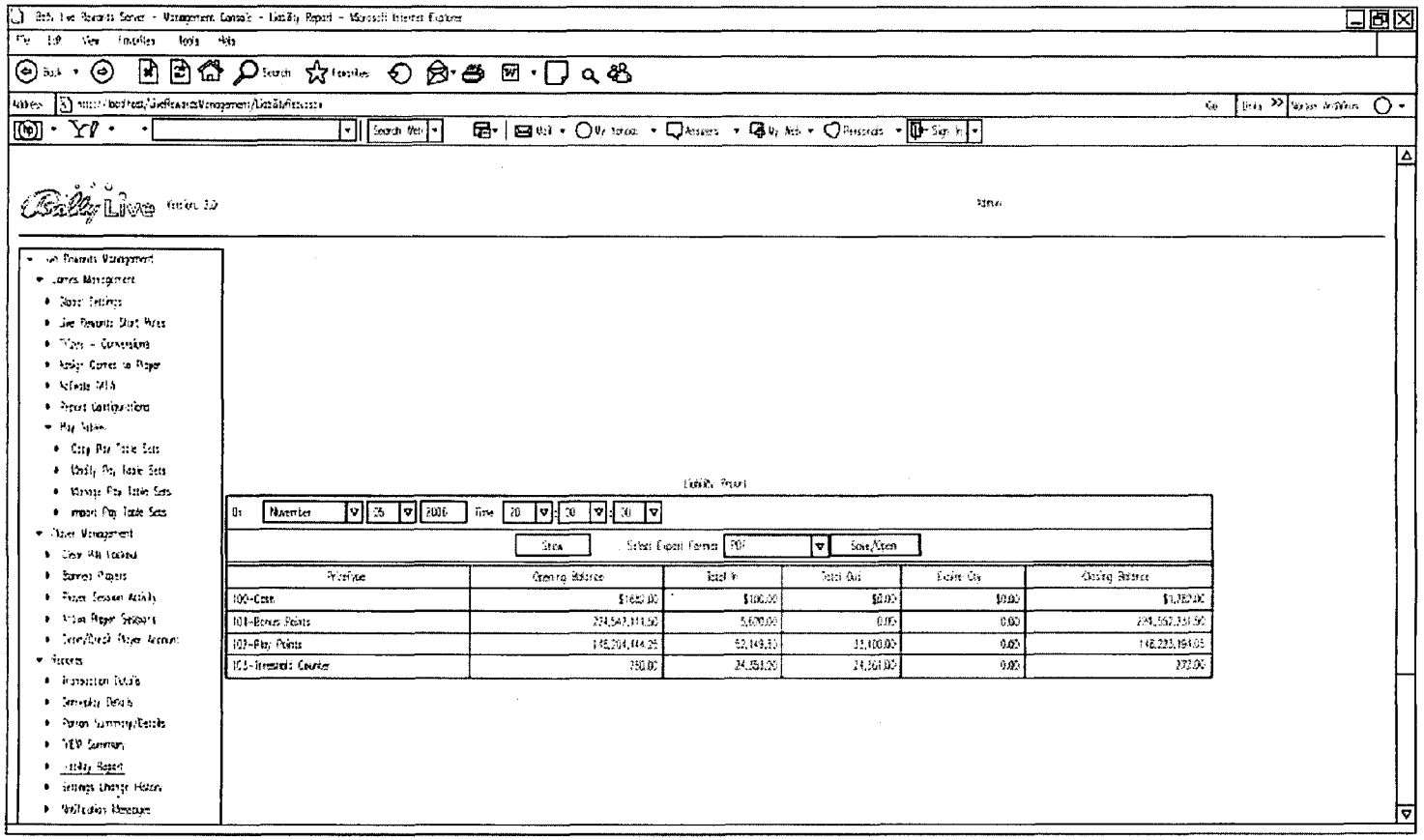
Figure 52A:
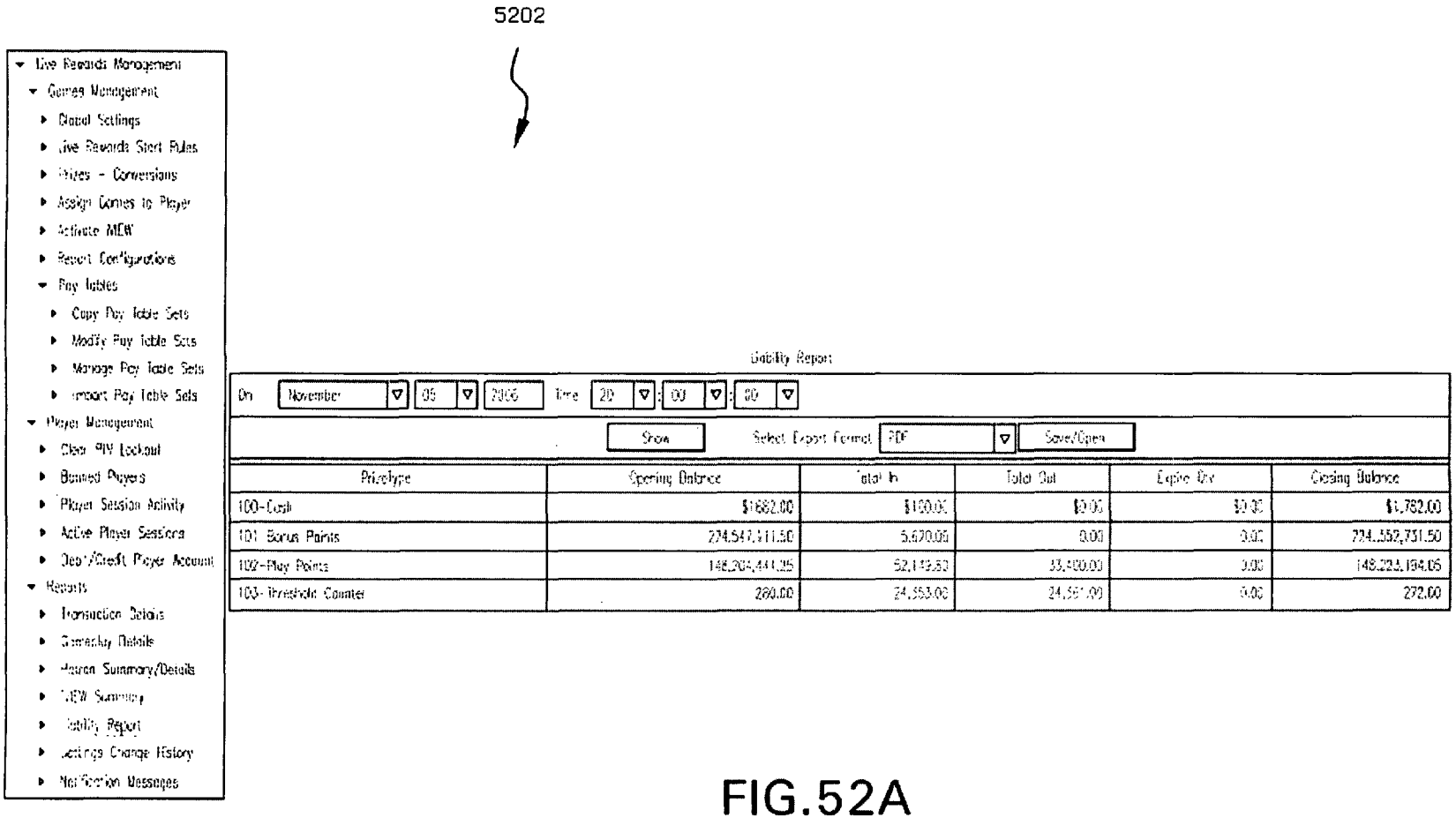

FIGS. 52, 52A (collectively referred to as FIG. 52) illustrate a pair of screenshots of the Live Rewards Server Liability Report report. The total liability to the casino is shown here for all buckets types for all players combined.

Figure 53:
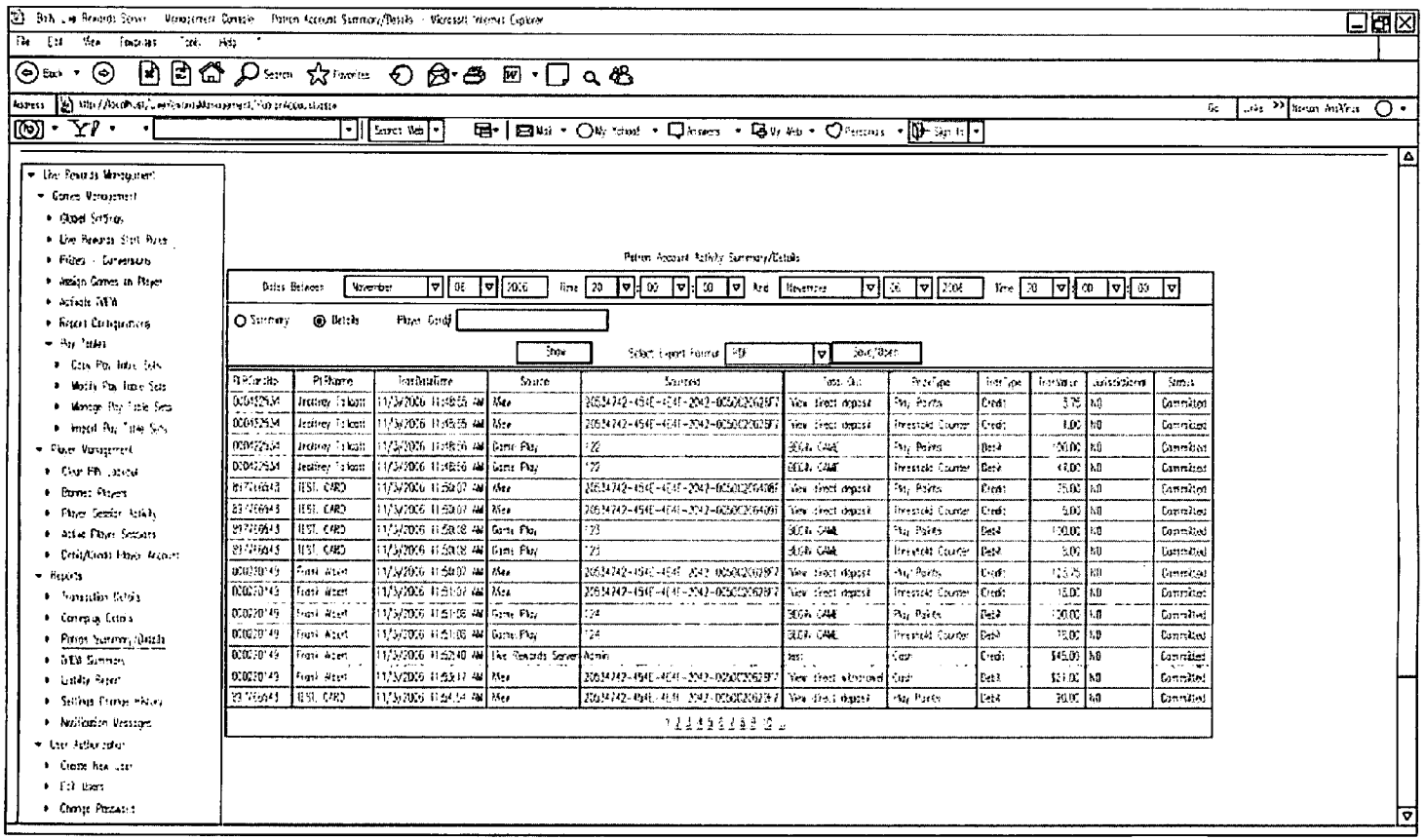
Figure 53A:
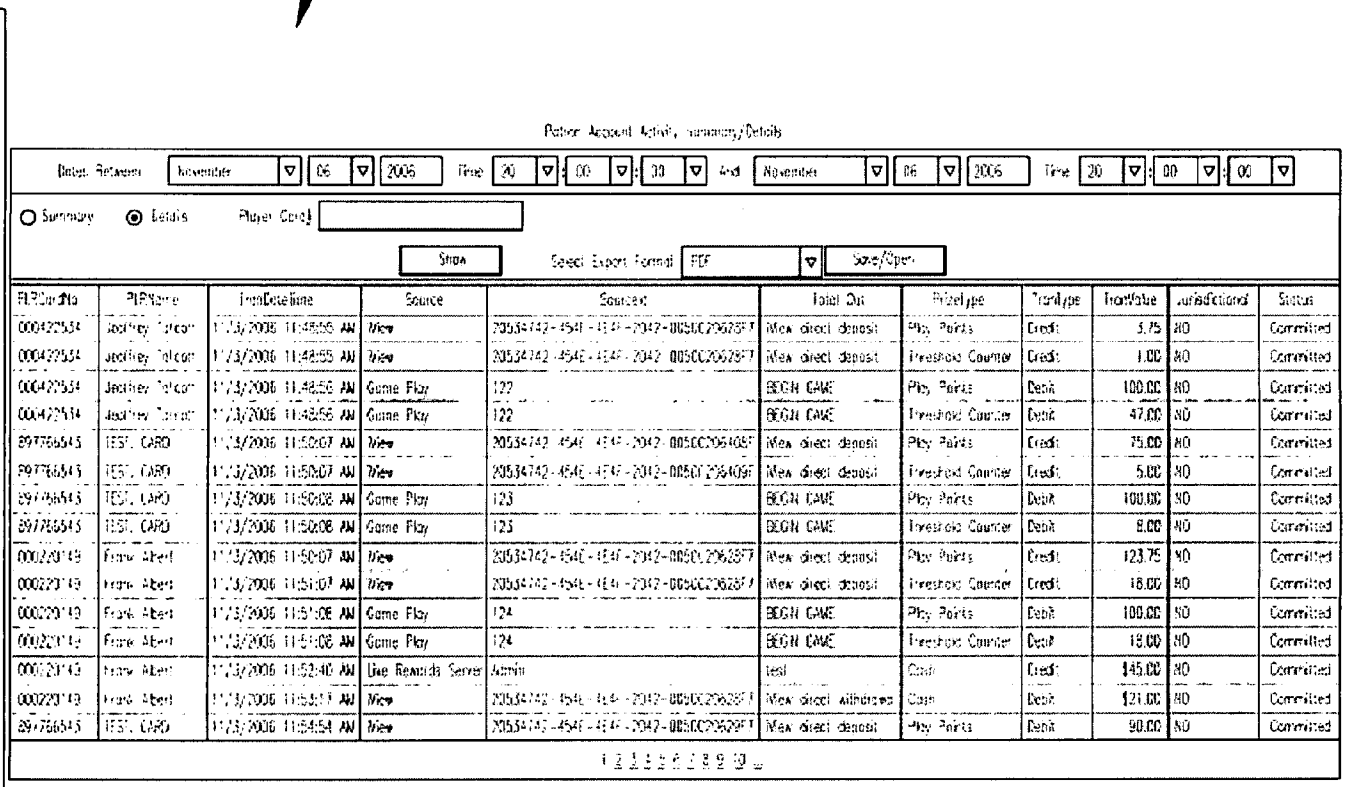

FIGS. 53, 53A (collectively referred to as FIG. 53) illustrate a pair of screenshots of the Live Rewards Server Patron Details report. Summary or detailed data is available on a specific player or all players. This shows the individual transaction details.

Figure 54:
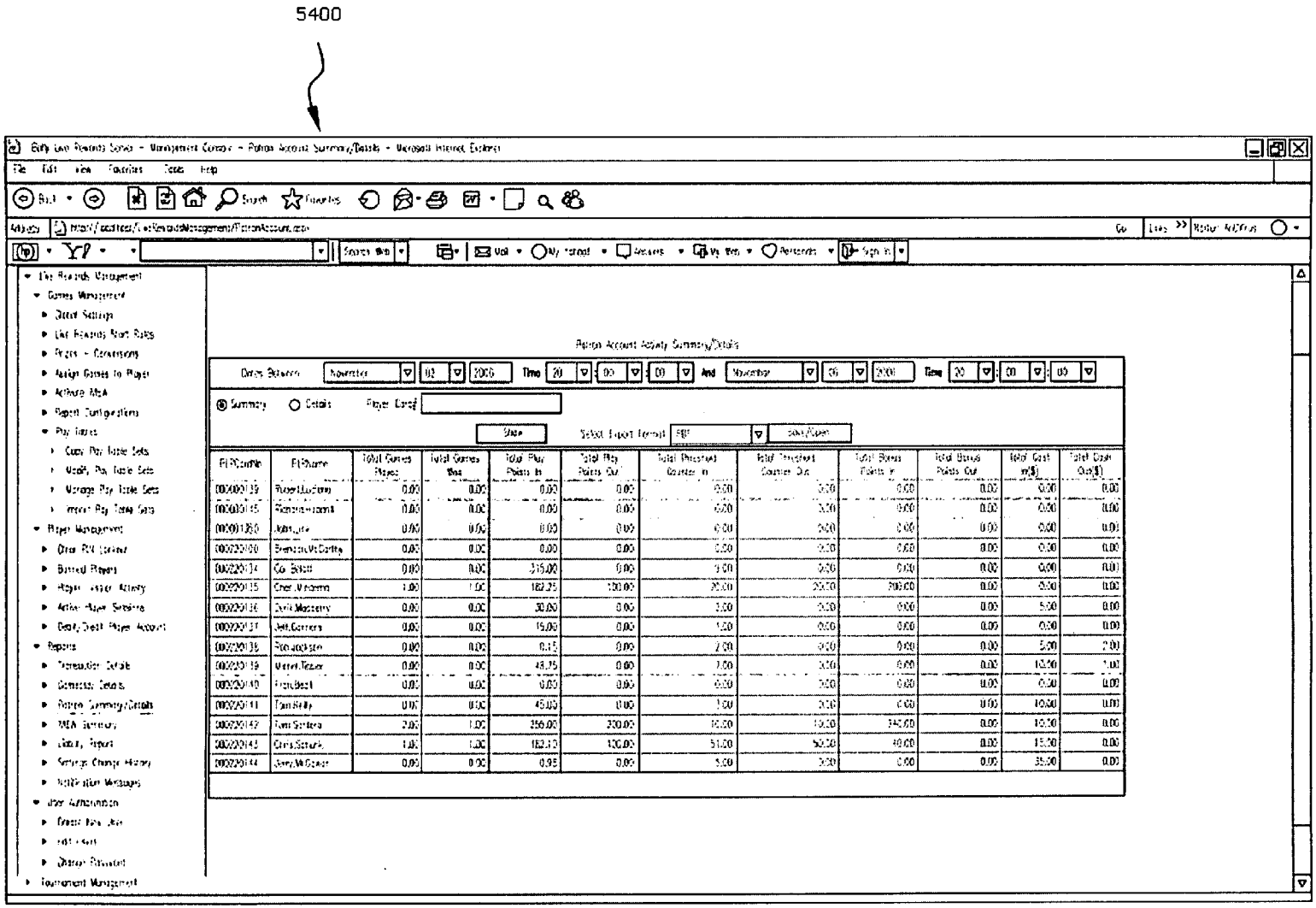

FIGS. 54, 54A (collectively referred to as FIG. 54) illustrate a pair of screenshots of the Live Rewards Server Summary report. Summary data for each player or all players is shown here.

Figure 55:
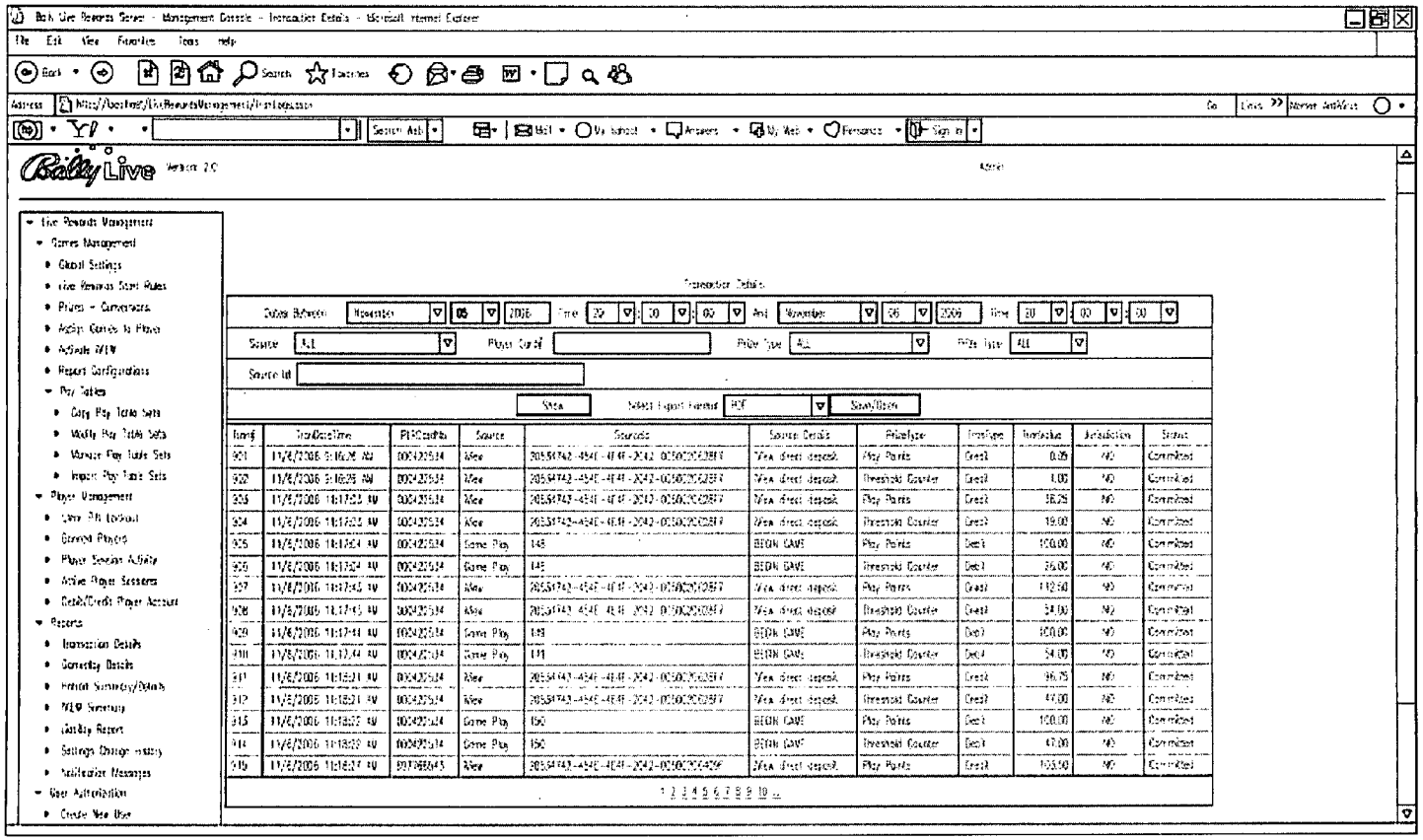

FIGS. 55, 55A (collectively referred to as FIG. 55) illustrate a pair of screenshots of the Live Rewards Server Transaction Details report. All transactional data is logged and is viewable here. Transactions are debit/credits to the player accounts. The transaction ID, data/time, which player card, source of transaction, source ID, prize type, transaction type (debit/credit), transaction value, jurisdictional event, status is shown.

Figure 56:
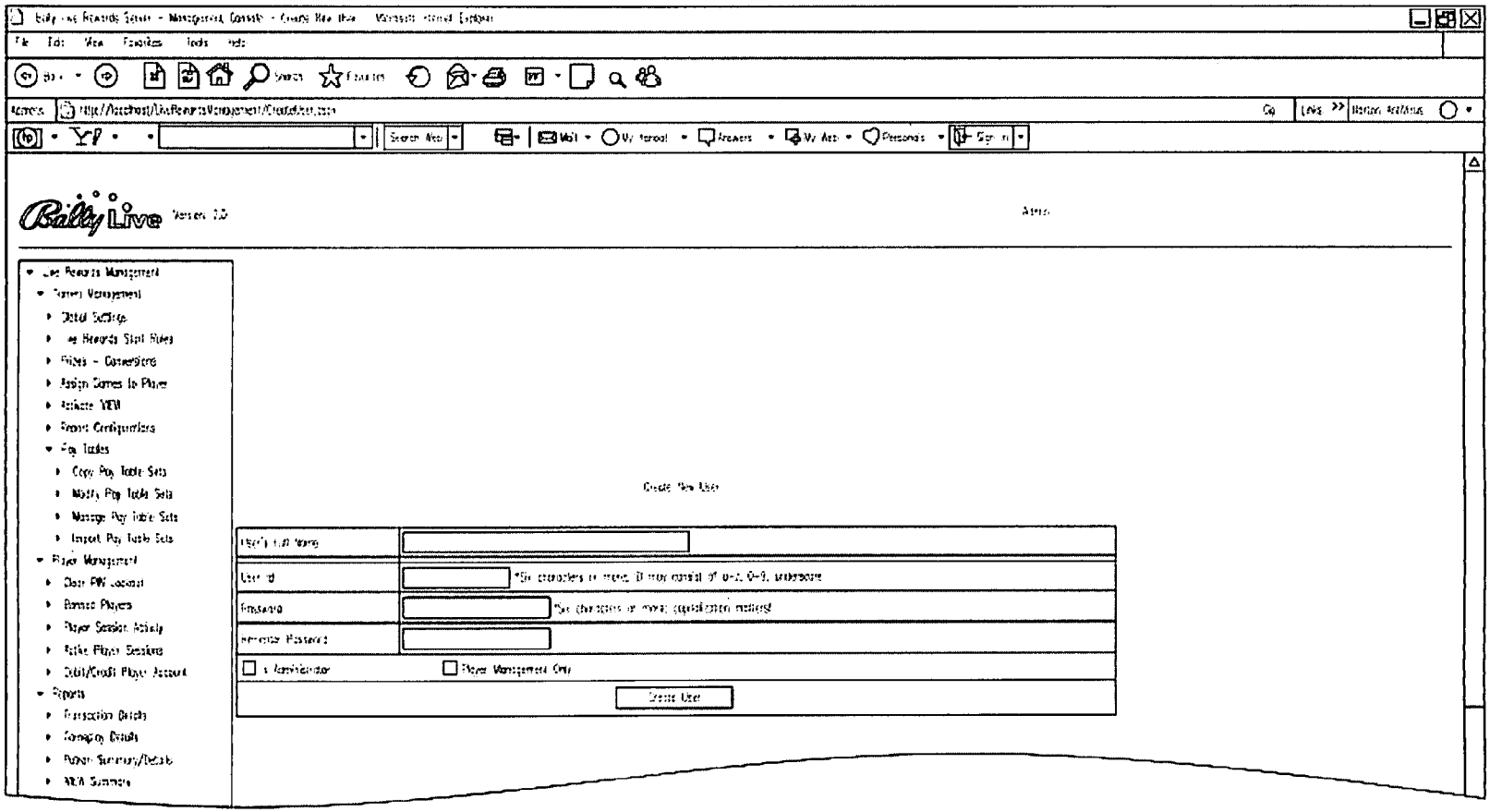
Figure 56A:
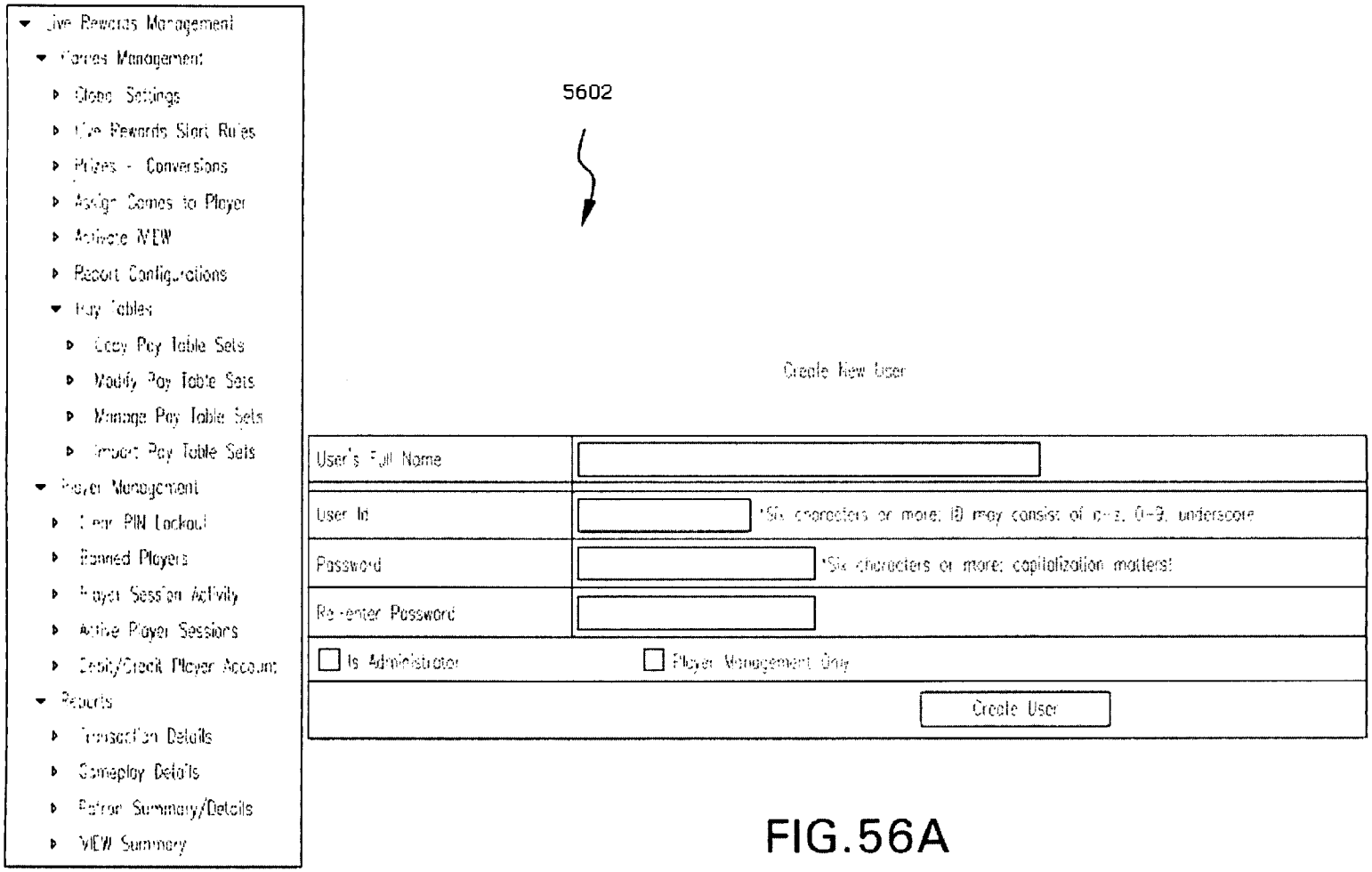

FIGS. 56, 56A (collectively referred to as FIG. 56) illustrate a pair of screenshots of the Live Rewards Server Create New User feature. New users are given administrator roles (all features), reports only, and/or Player management rights only.

FIGS. 57-1, 57-2, 57-3 (collectively referred to as FIG. 57) illustrate a flowchart of two players playing using the same player card and inserting them into two different slot machines player tracking systems at different times. The cards are both create child session accounts from the same parent master player account. The available funds for each player are shown throughout the sessions of each person.

FIGS. 58, 58-1, 58-2, 58-3, 58-4, 58-5, 58-6 (collectively referred to as FIG. 58) illustrate a spreadsheet showing the Live Rewards Session accounts and how they work throughout a series of 36 steps. This spreadsheet shows 1 sub account playing on iVIEW ID 176 using player card #123. This person is the first to put in the player card. The session buckets for this player are shown and the master server buckets or meters are shown.

Figure 58:
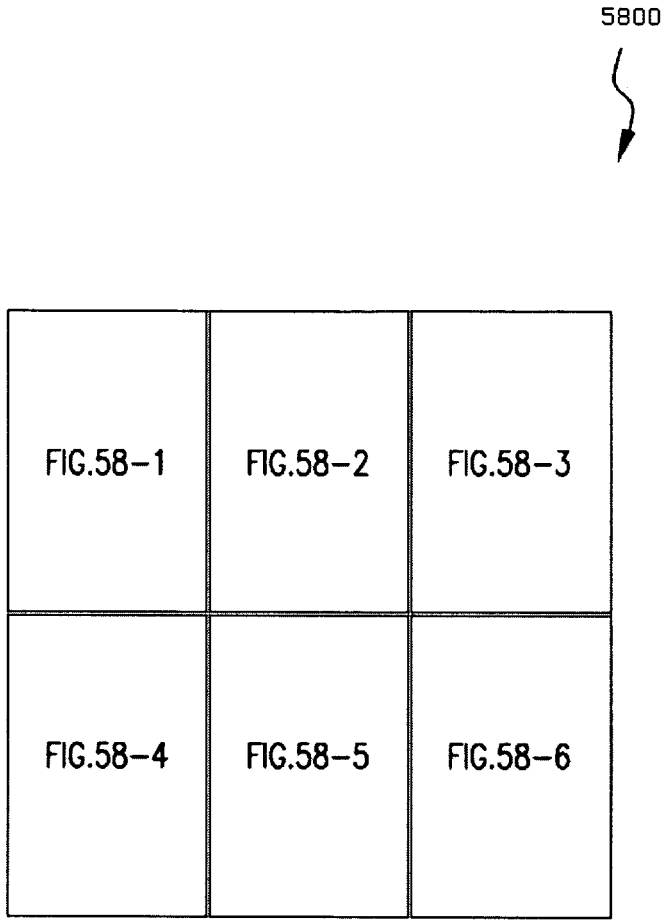

FIGS. 59-1, 59-2, 59-3 (collectively referred to as FIG. 59) are the continuation of FIG. 58 to the right side of the spreadsheet. This shows the $2^{nd}$ player playing on iVIEW ID 473 using player card #123 as well. This player inserts his card at step 13 and is the $2^{nd}$ session account off of the parent account.

Figure 60:
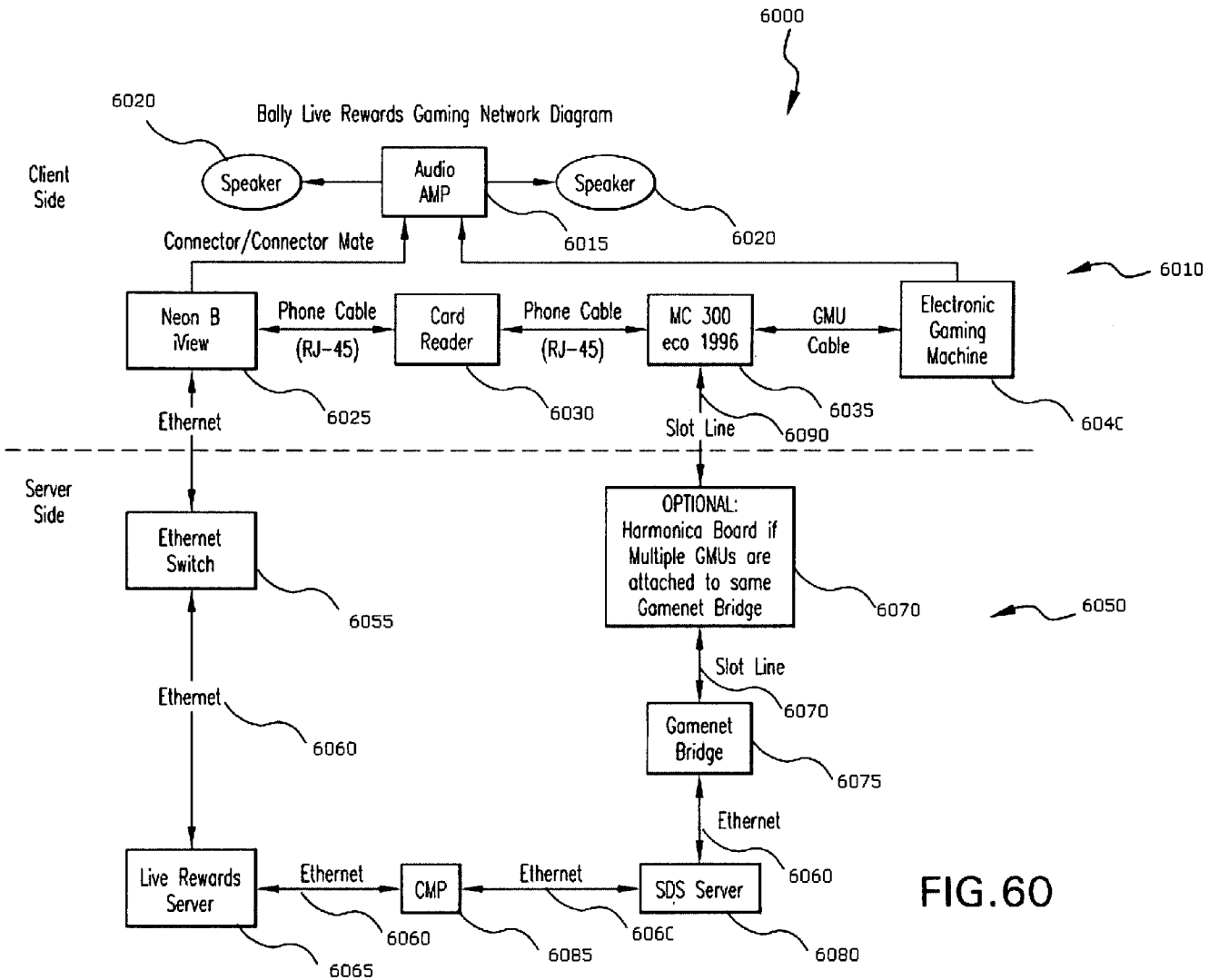

FIG. 60 illustrates a network diagram of the Live Rewards Gaming system. This figure shows how the client side is configured together as well as how the slot management system and CMP/CMS systems are linked to the Live Rewards Server.

Figure 61:
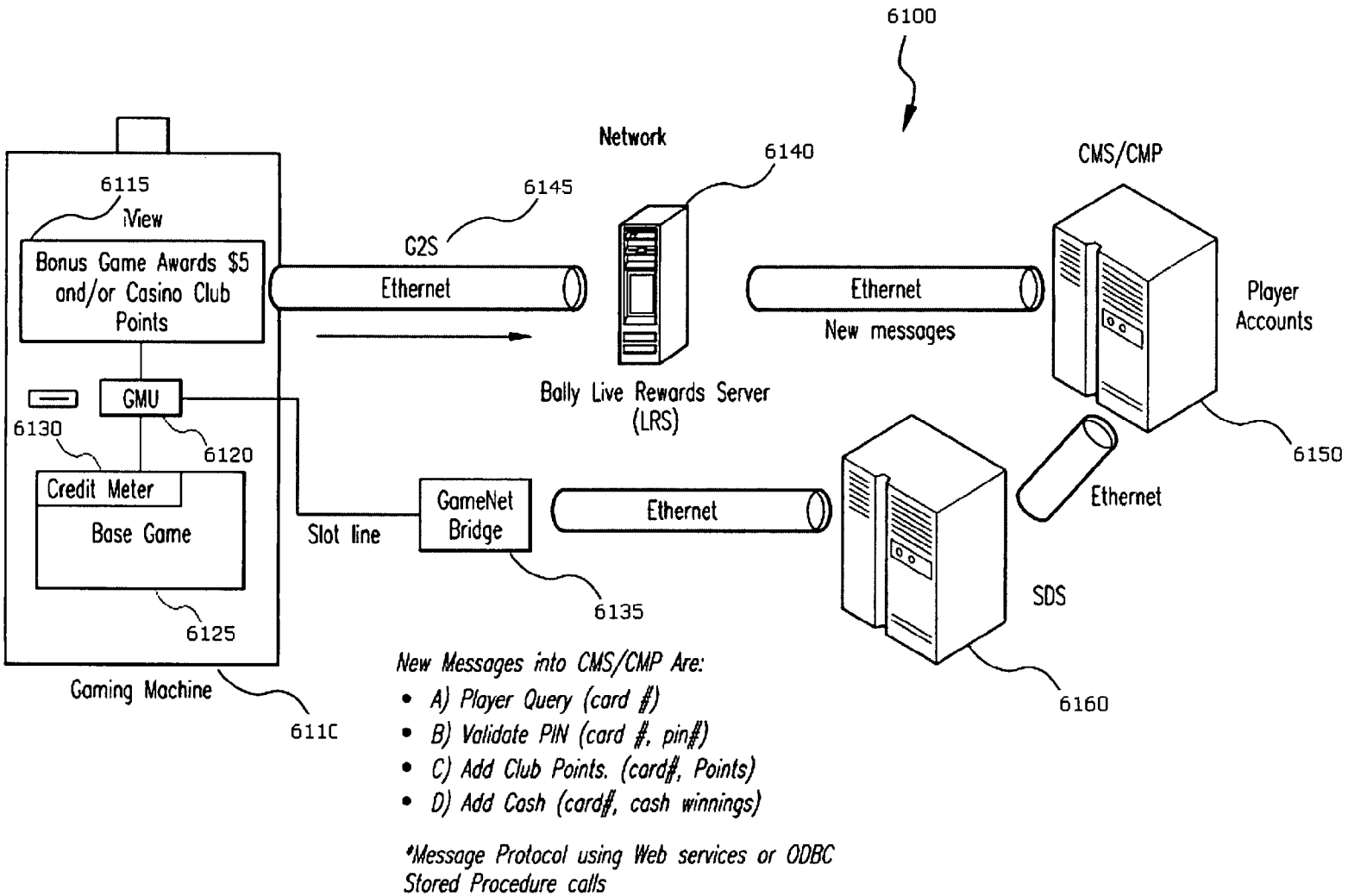

FIG. 61 illustrates a network diagram of the Live Rewards Gaming system. This figure shows how the client side is configured together as well as how the slot management system and CMP/CMS systems are linked to the Live Rewards Server.

Figure 1:
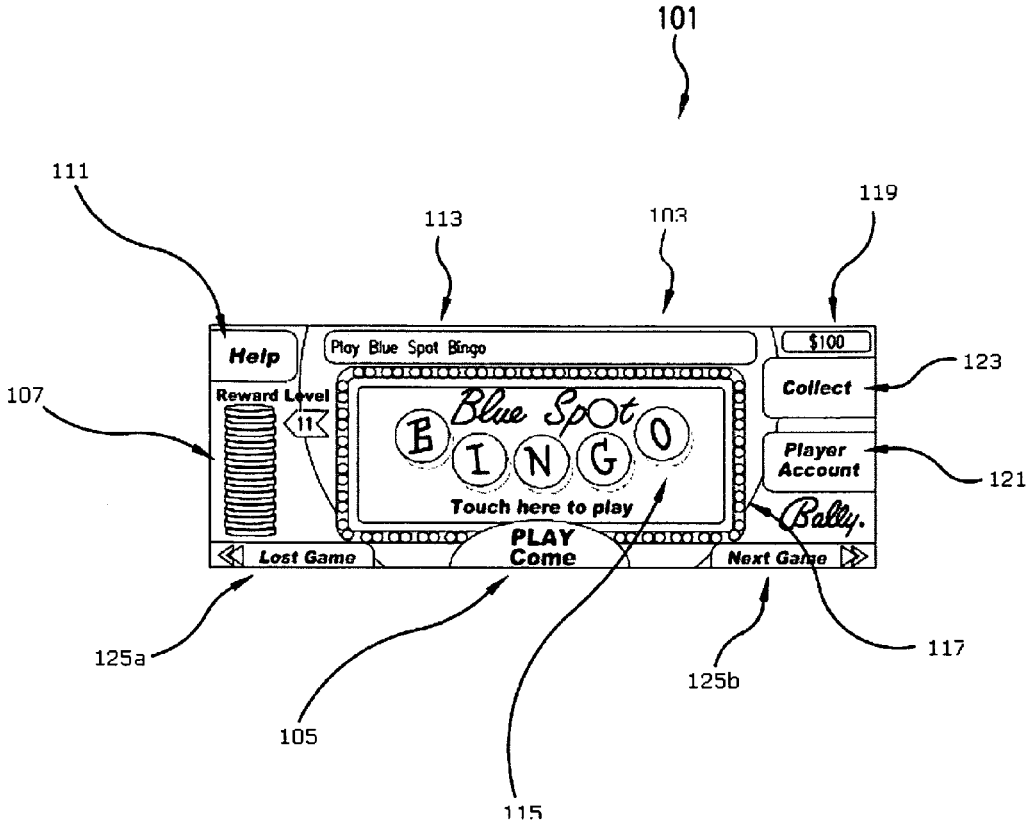
FIG. 1 illustrates a main game panel on a player console in accordance with one or more embodiments of the present invention.
Figures 1, 9A:
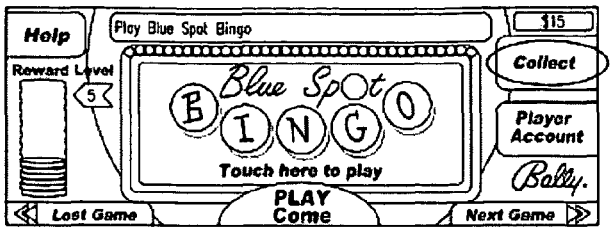
Figures 2, 9A:
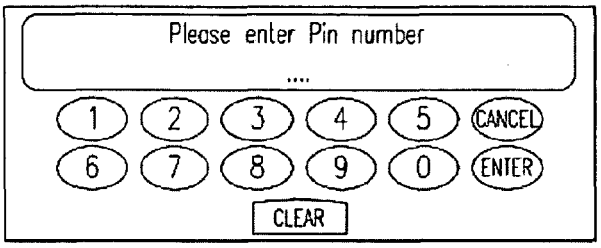
Figures 3, 9A:
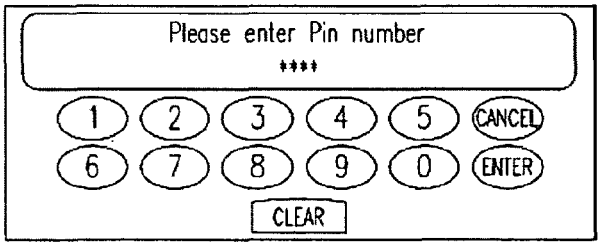
Figures 4, 9A:
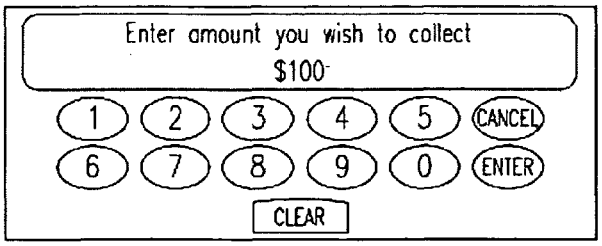
Figures 1, 9B:
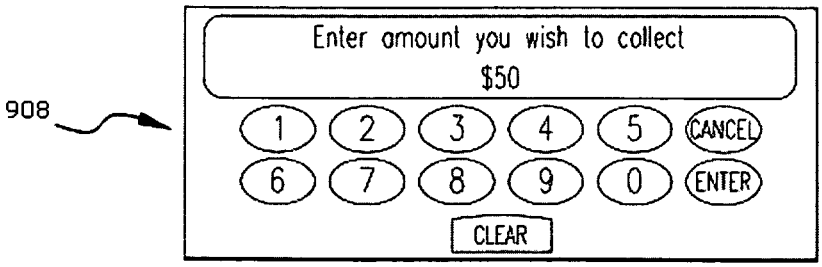
Figures 2, 9B:
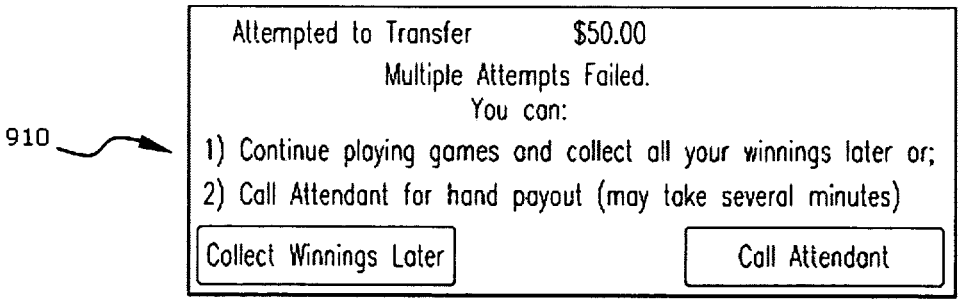
Figure 32:
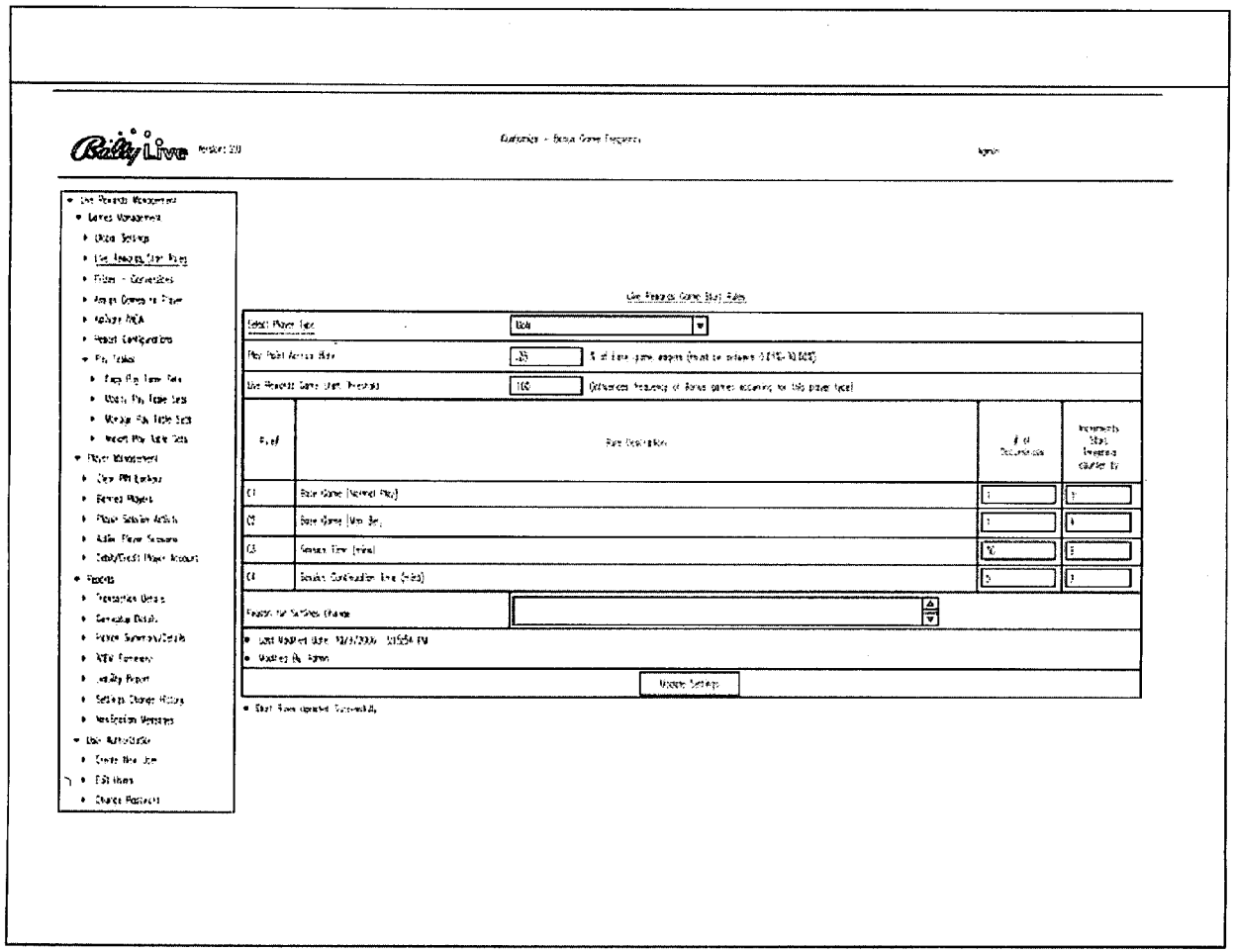
FIGS. 32, 32A (collectively referred to as FIG. 32) illustrate a pair of screenshots of the Live Rewards Server Game Start Rules. This is where the casino operator configures the rules for a player earning bonus games. This is player type specific. How many play points are accrued for X amount of wagering required. A start threshold is configured here as another means to control the Bonus game frequency. A base game even, a max bet event, a session time event, and session continuation time event are configured to increment a players specific threshold counter by a certain amount. Once the player has enough Threshold counter points (over the threshold) and the player has enough play points for the game then the selected game will be able to be played by the player.
Figures 1, 62:
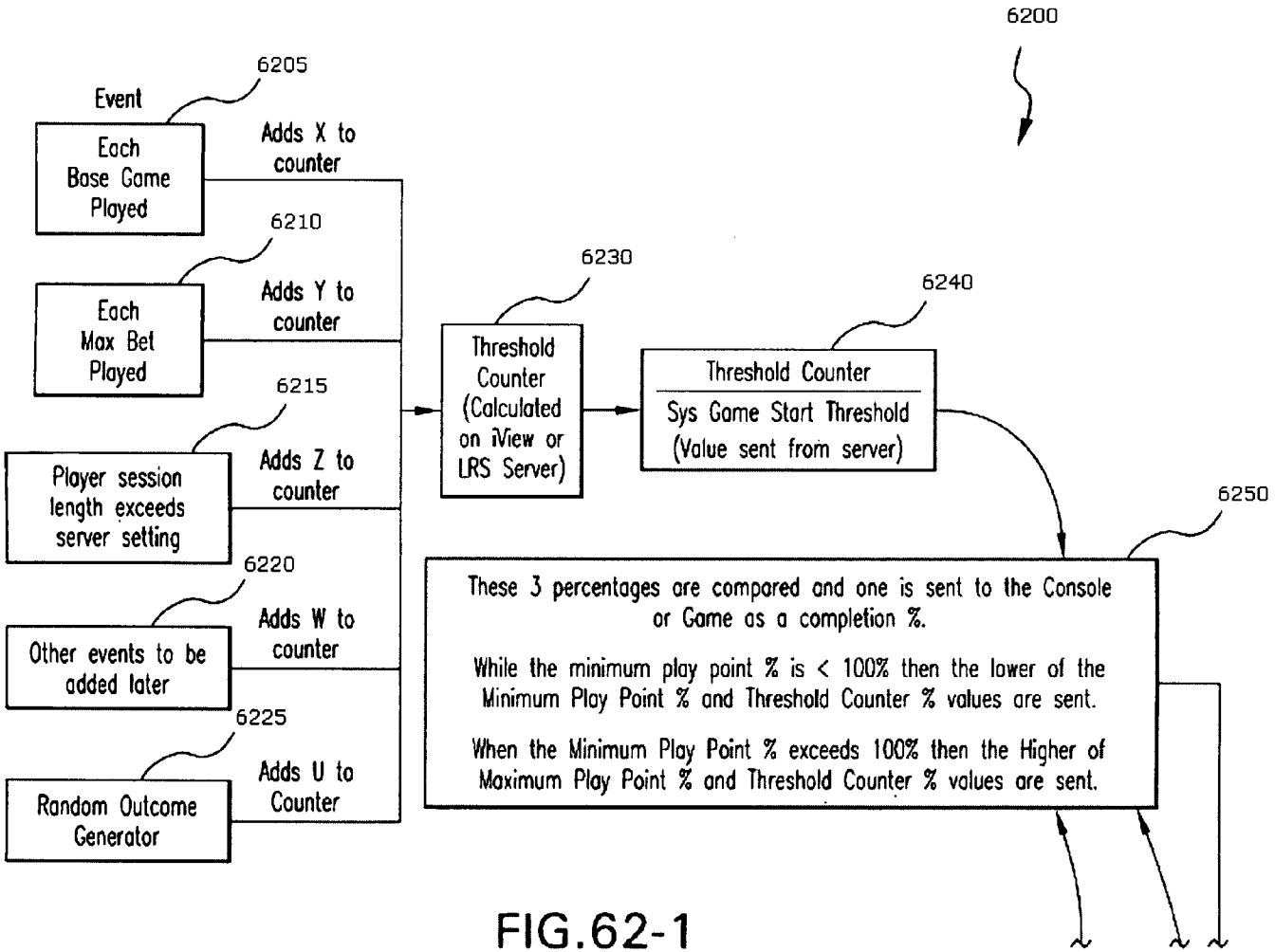
Figures 2, 62:
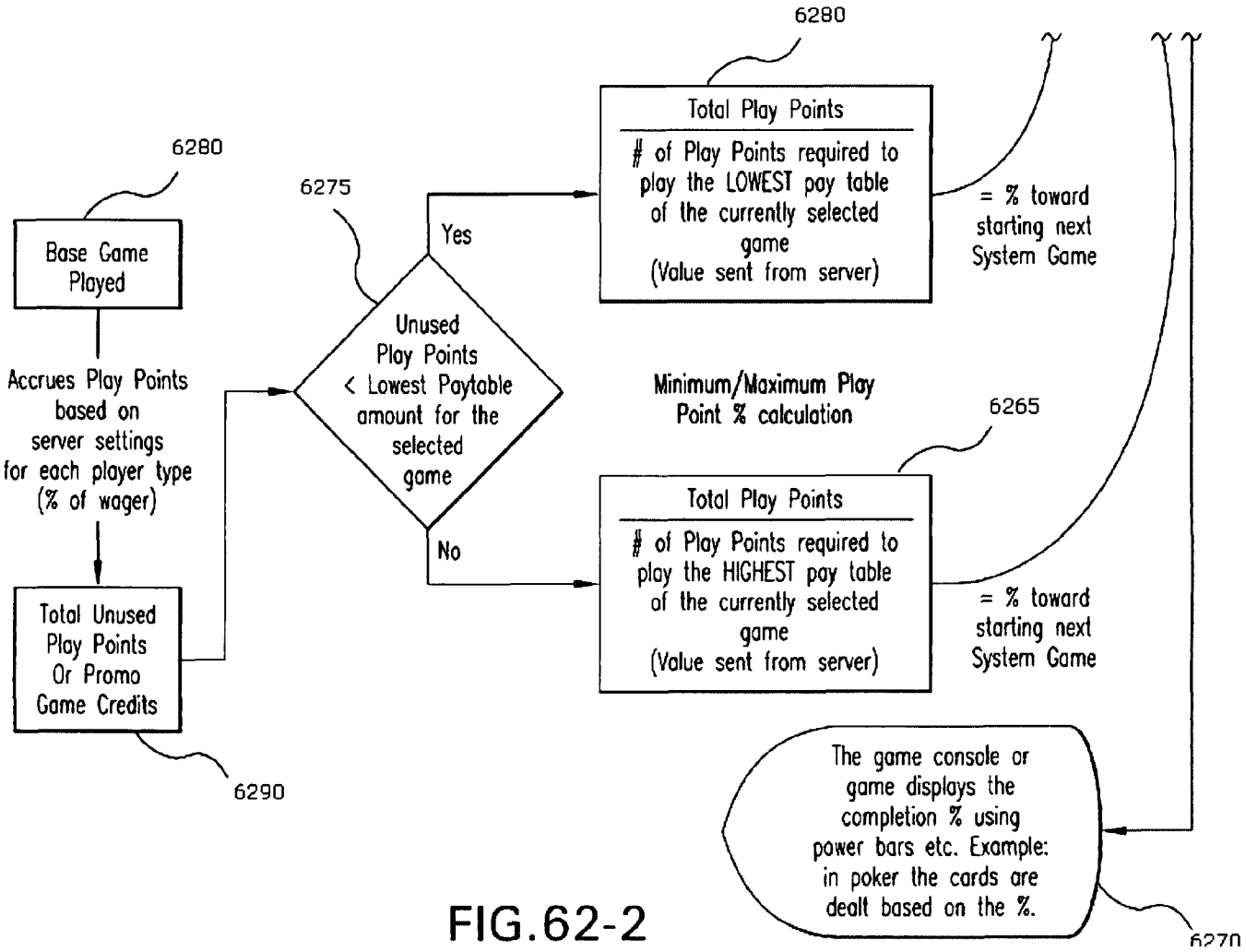

FIGS. 62-1, 62-2 (collectively referred to as FIG. 62) illustrate a software flowchart showing how the Live Rewards bonus game frequency of play is controlled. The server side variables are configured as shown in FIG. 32. Events contribute to a threshold counter. The threshold counter and the cost of the game are used to control the frequency of a player being able to play a live rewards game. Even if the player has enough play points to play the game may no be enabled to play unless the business rules on this figure are achieved.

Figures 1, 63:
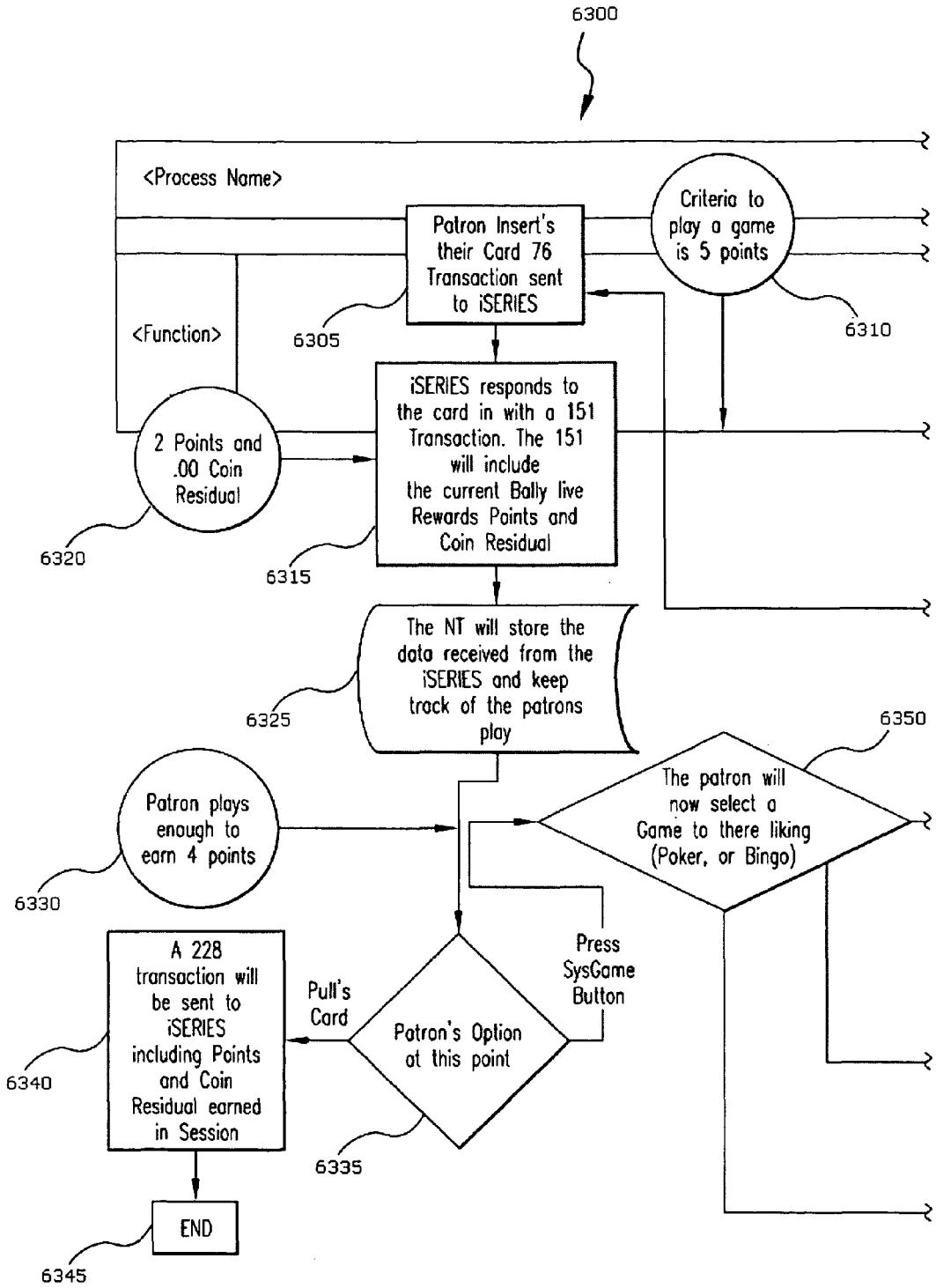
Figures 2, 63:
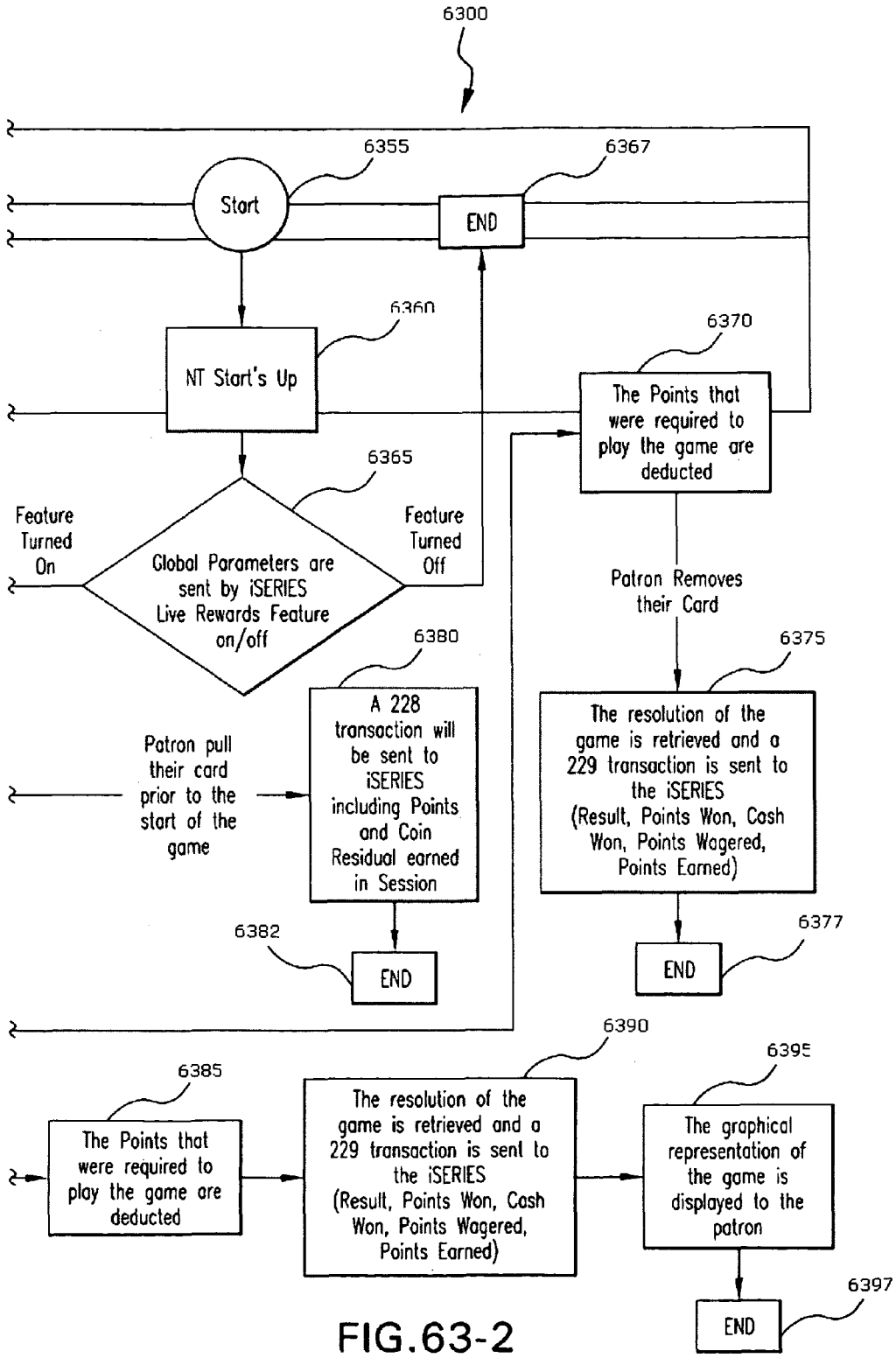

FIGS. 63-1, 63-2 (collectively referred to as FIG. 63) illustrate a software flowchart of the ACSC Live rewards transactions both on the client and in the server.

Figure 64:
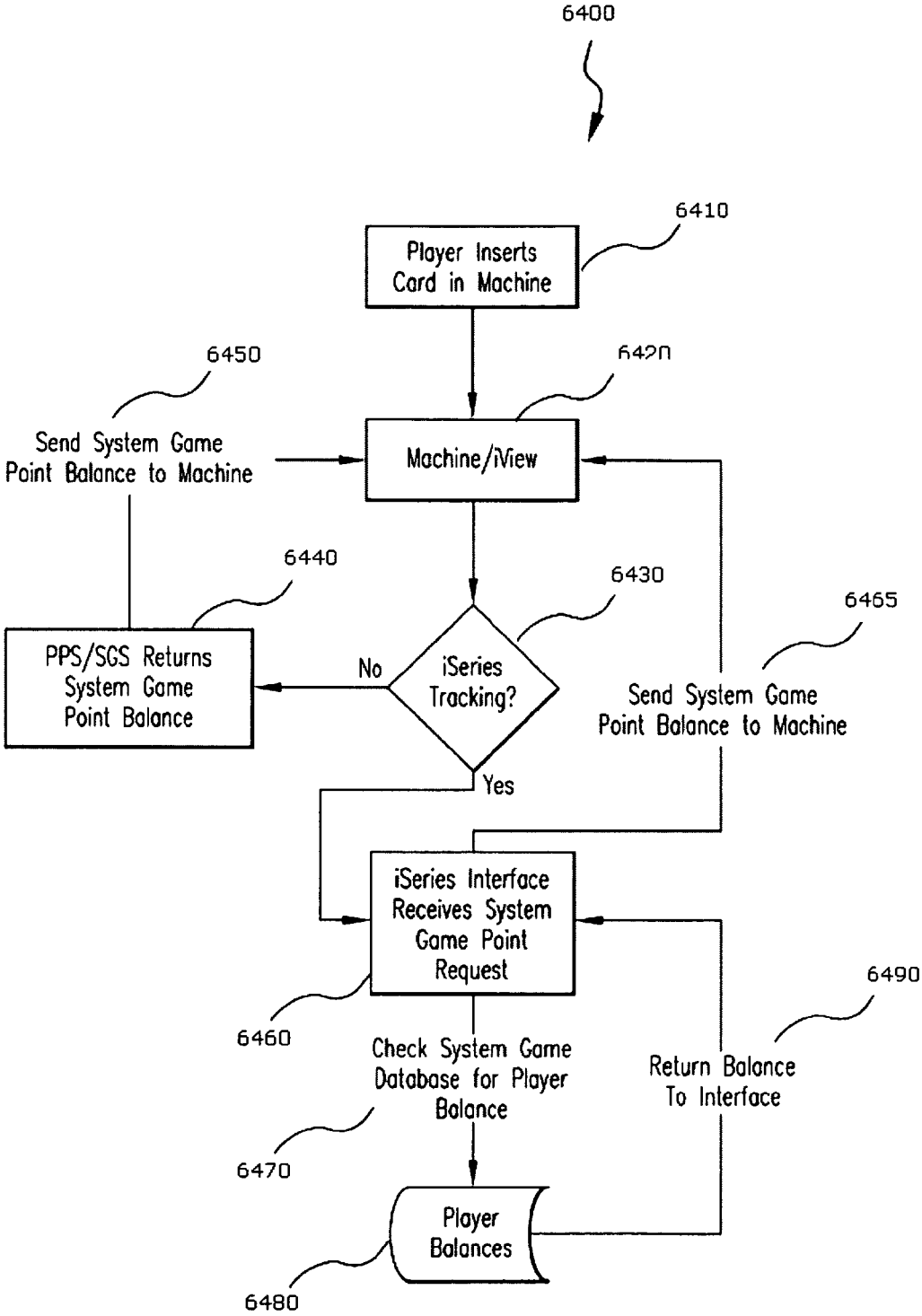

FIG. 64 illustrates a flowchart of the ACSC iSERIES Live Rewards Card in Process.

Figure 65:
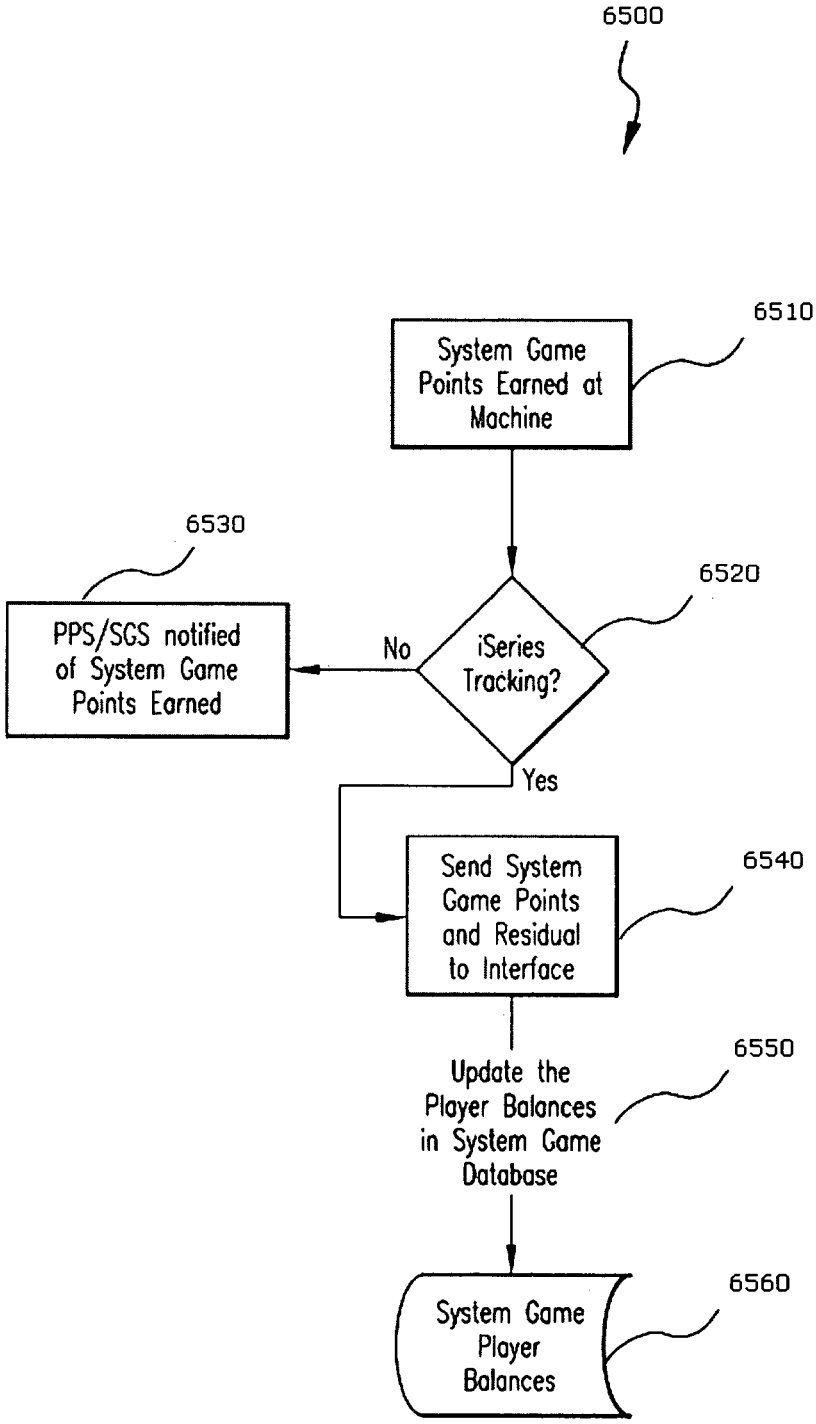

FIG. 65 illustrates a flowchart of the ACSC iSERIES Live Rewards Play Points Earned Process.

Figure 66:
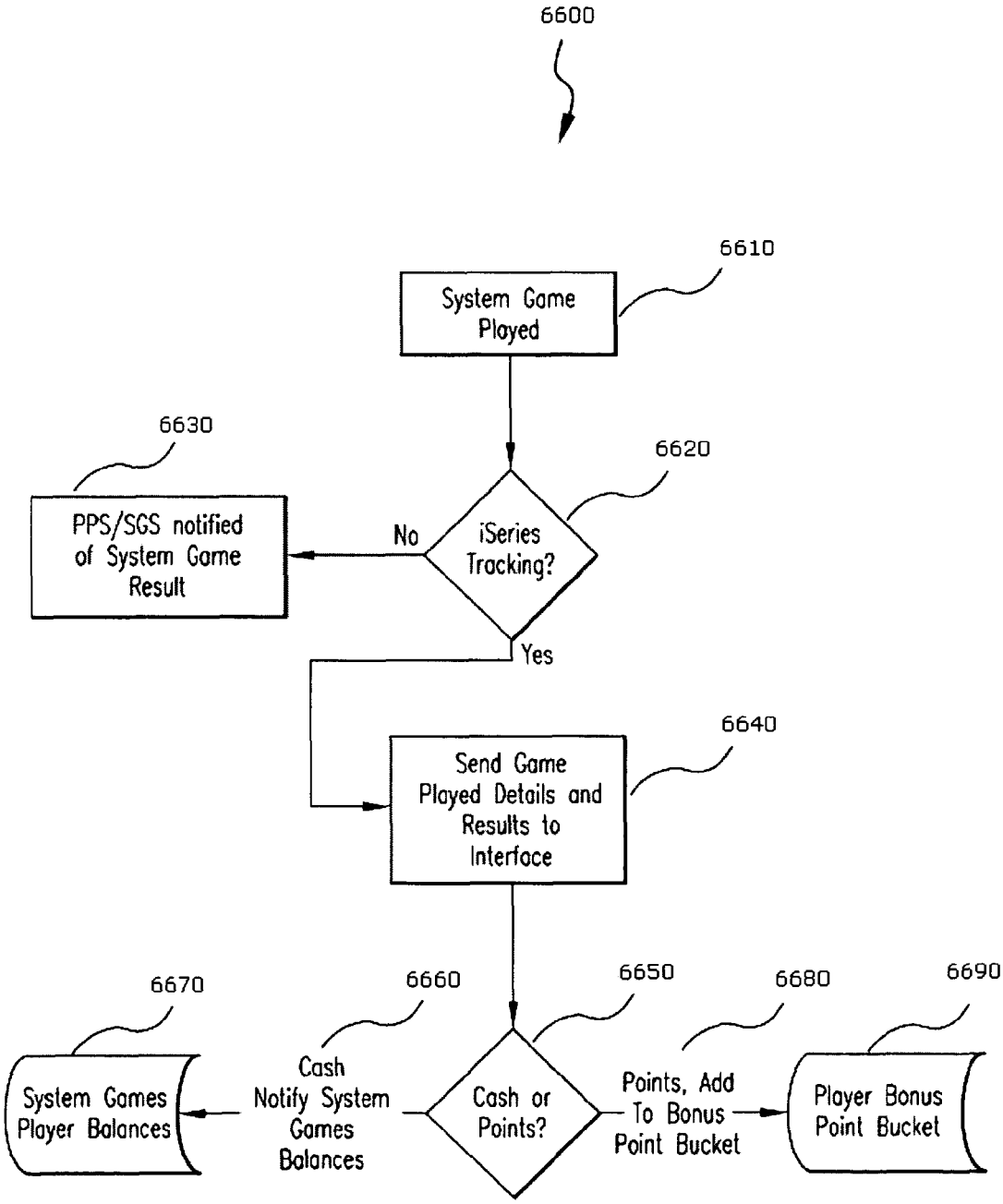

FIG. 66 illustrates a flowchart of the ACSC iSERIES Live Rewards Game Outcome Results Process.

Figure 67:
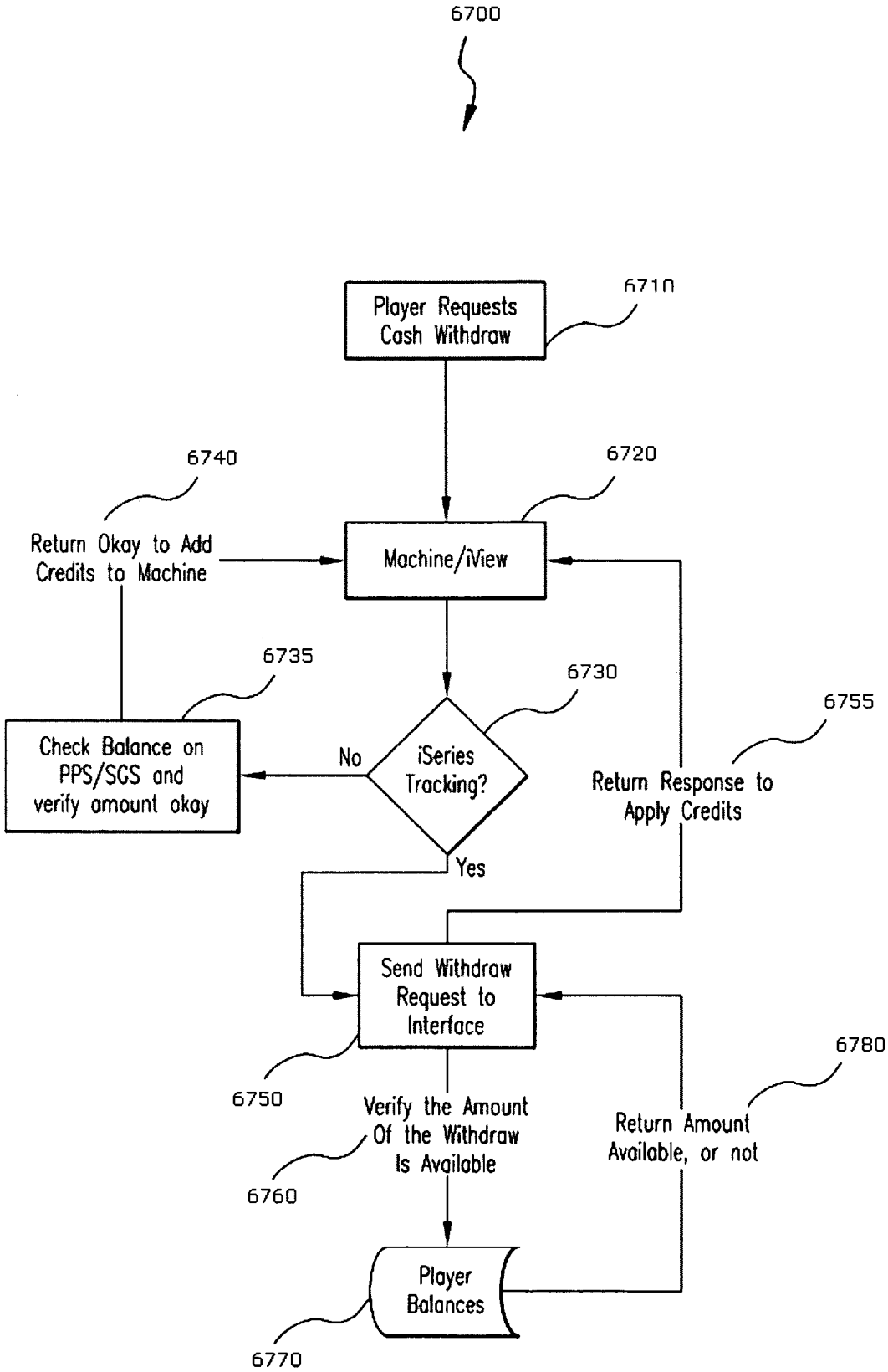

FIG. 67 illustrates a flowchart of the ACSC iSERIES Live Rewards Cash/Points Withdrawal process.

Figure 68:
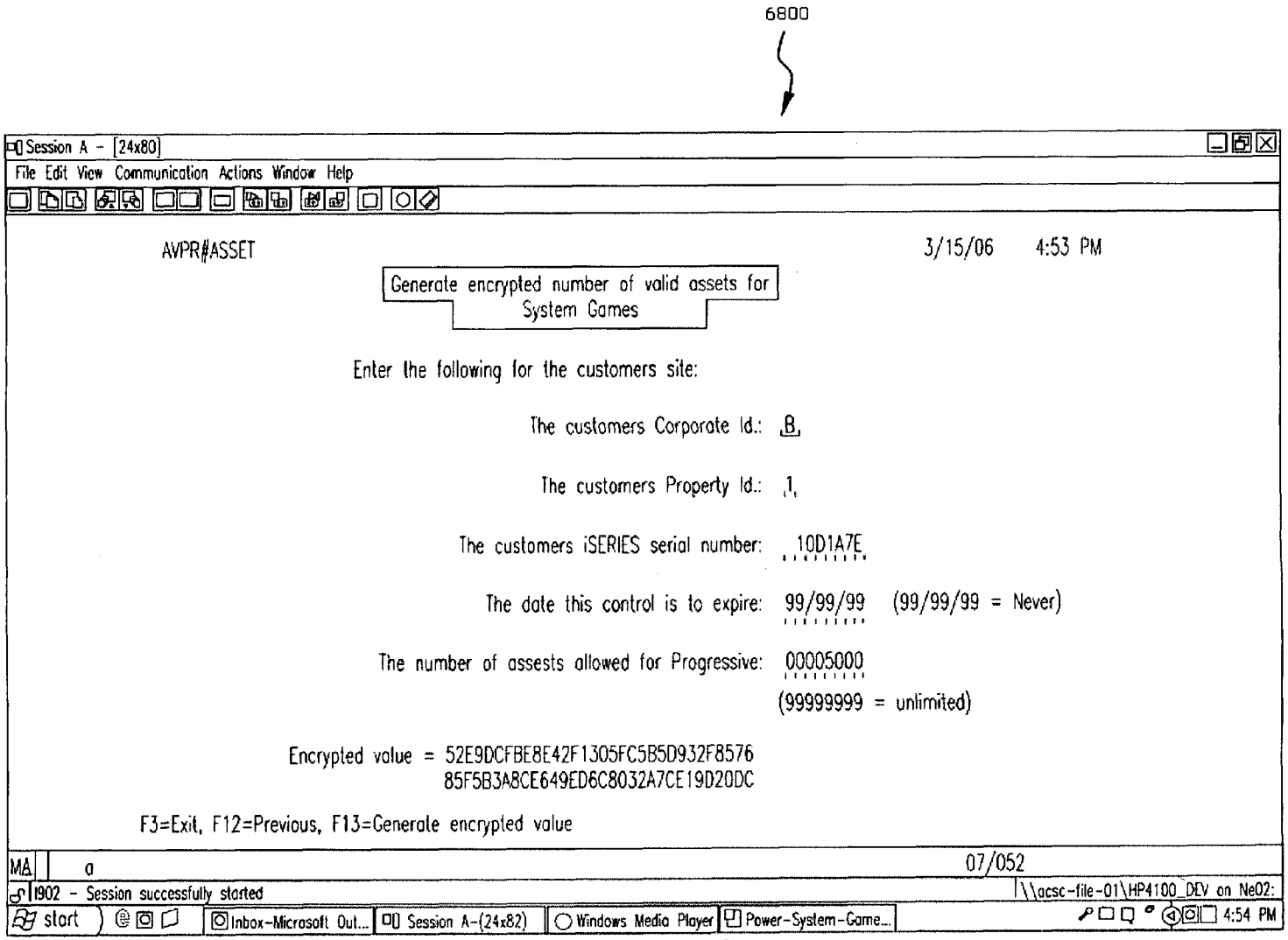

FIG. 68 illustrates a screenshot of the ACSC iSERIES user interface to generate encrypted number of valid assets for System Games. It is part of the license management of the Live Rewards Server.

Figure 69:
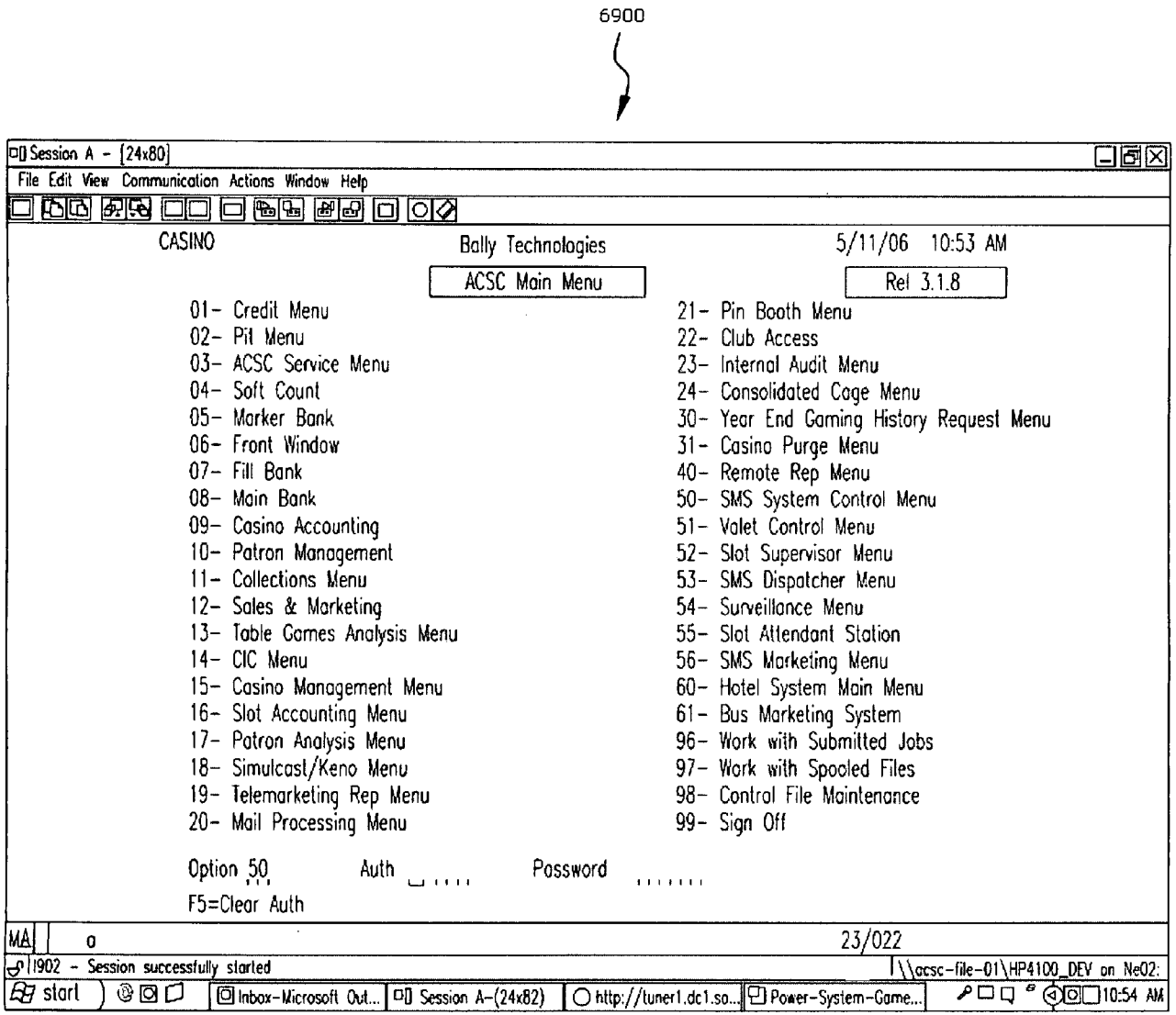

FIG. 69 illustrates a screenshot of the ACSC iSERIES administration page. From this page all sub menus are allowed to be accessed.

Figure 70:
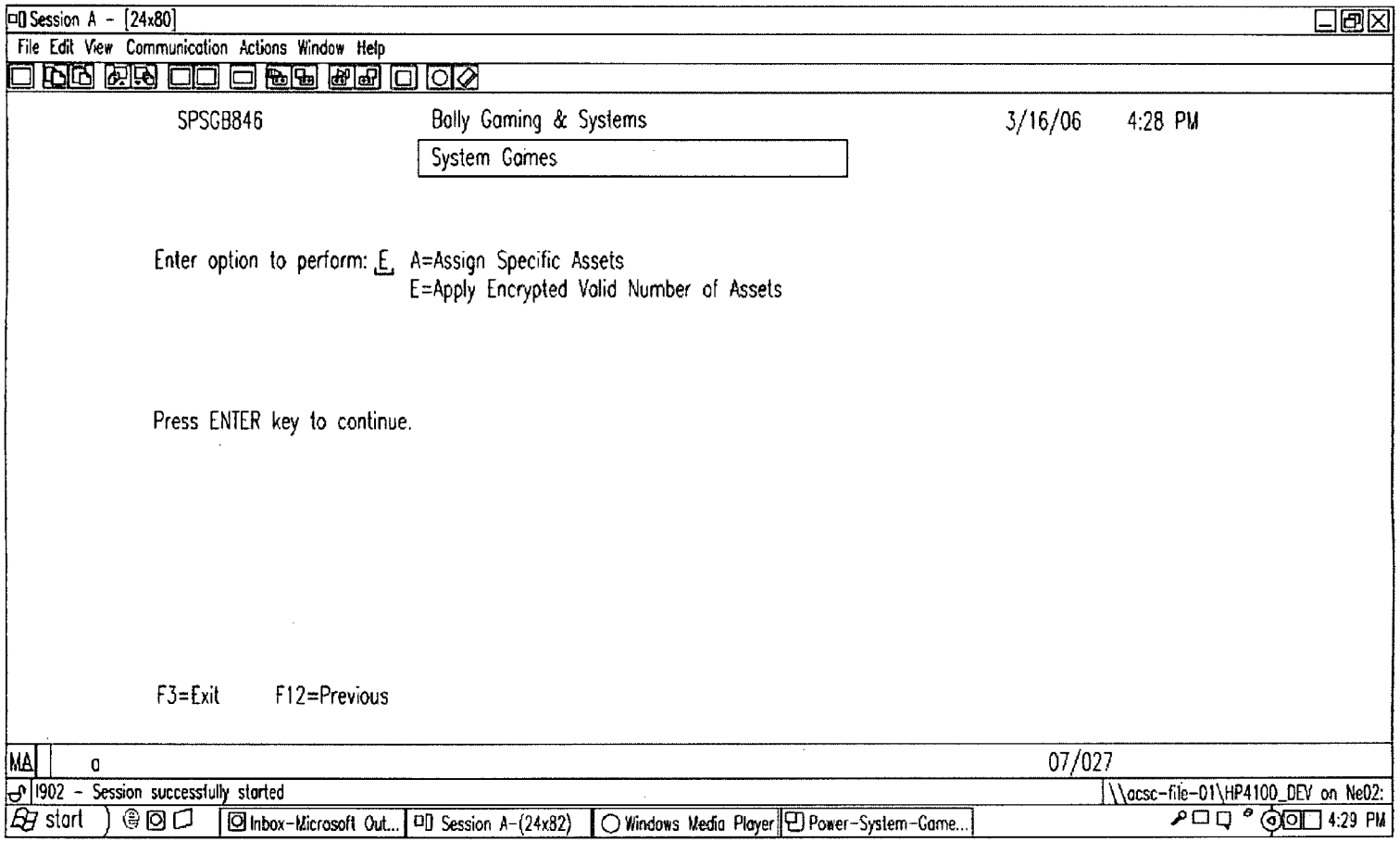

FIG. 70 illustrates a screenshot of the ACSC iSERIES Live Rewards administration page. This is where the player assigns specific Asset numbers (EGMS or game devices) to run Live Reward System Games. This is also where the encrypted license management keys are entered.

Figure 71:
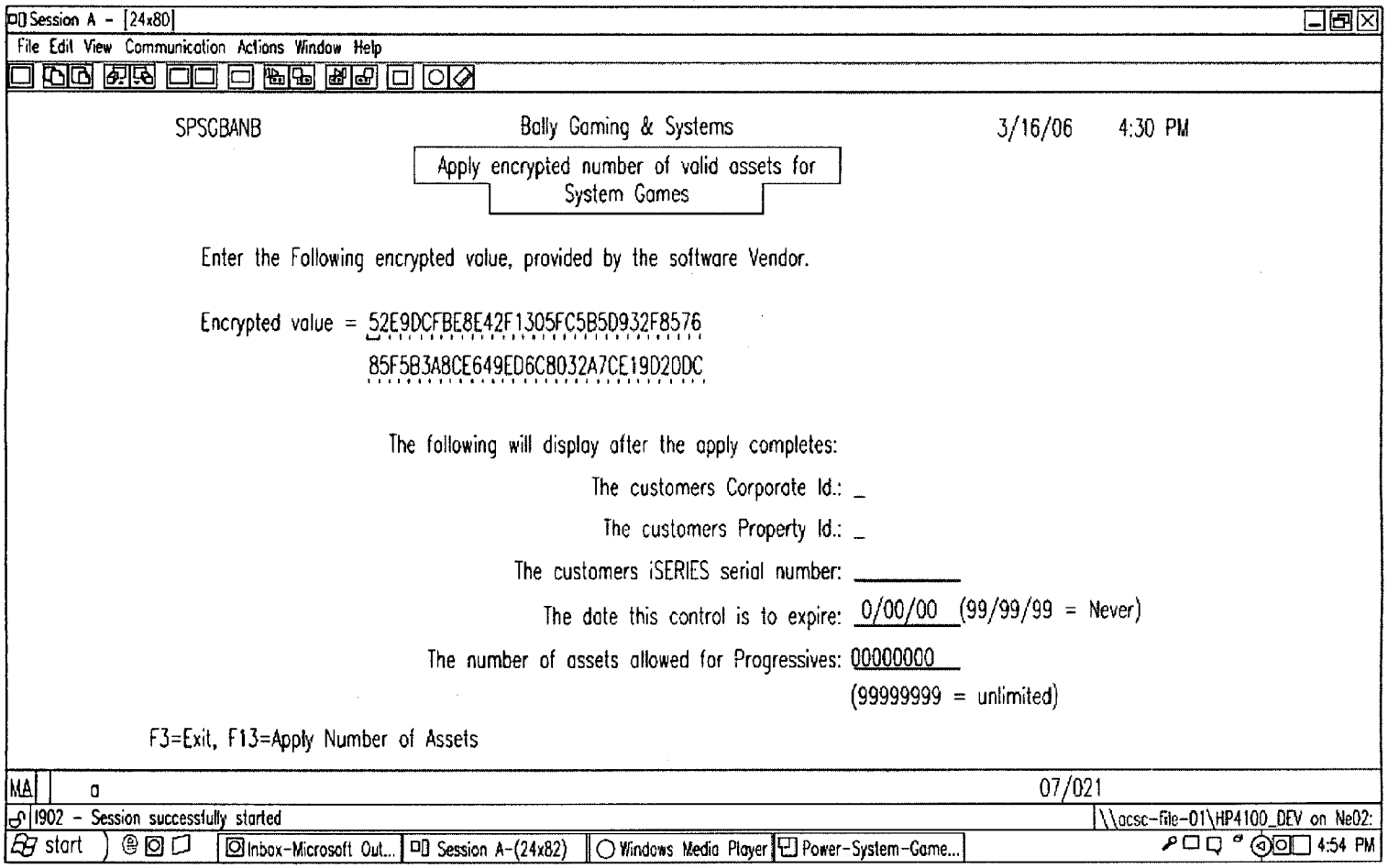

FIG. 71 illustrates a screenshot of the ACSC iSERIES Live Rewards administration page where a the casino applies the encrypted number of valid assets to Run Live Rewards.

Figure 72:
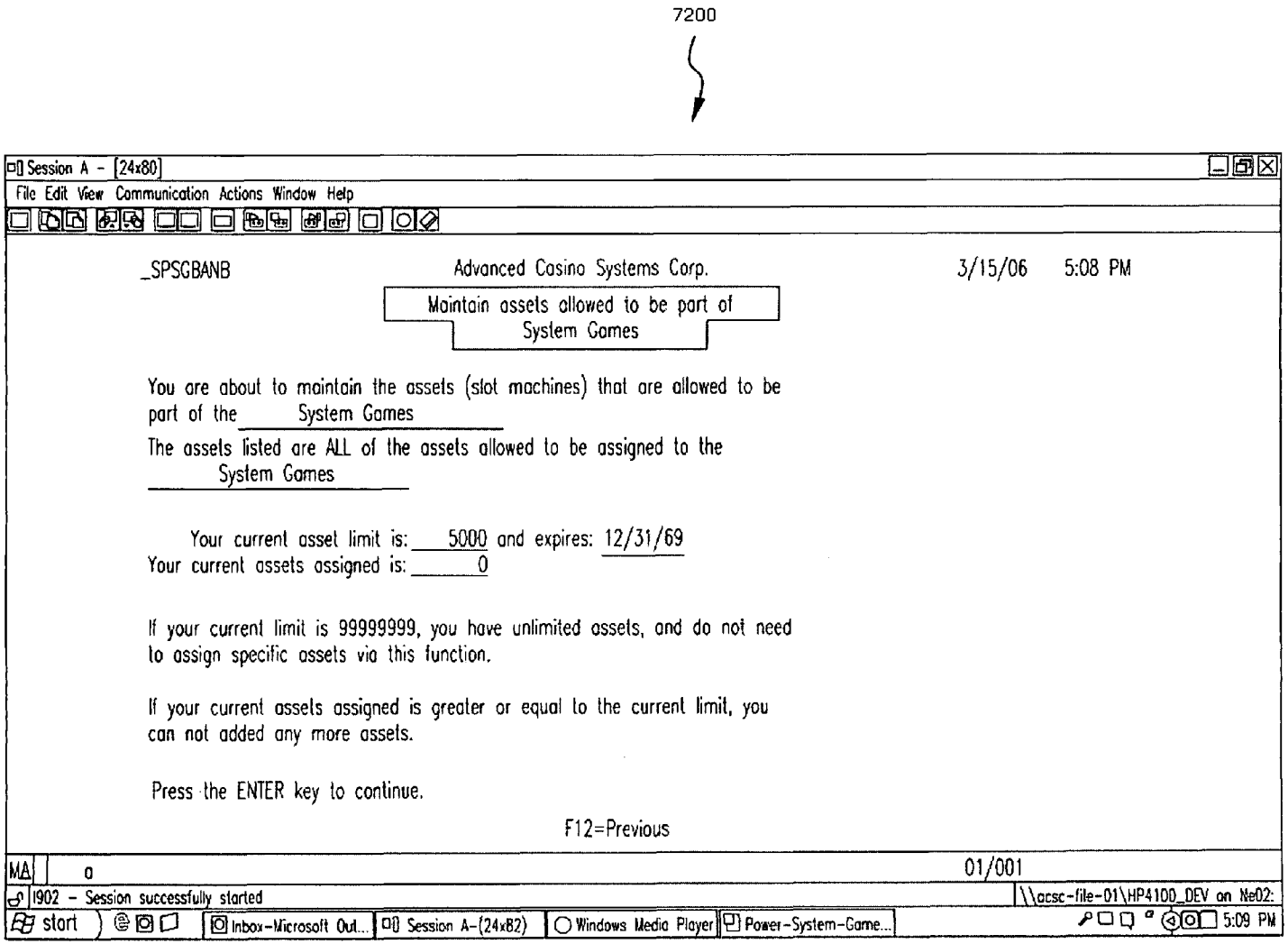

FIG. 72 illustrates a screenshot of the ACSC iSERIES Live Rewards administration page where the total number of Asset licenses available and unsent are shown.

Figure 73:
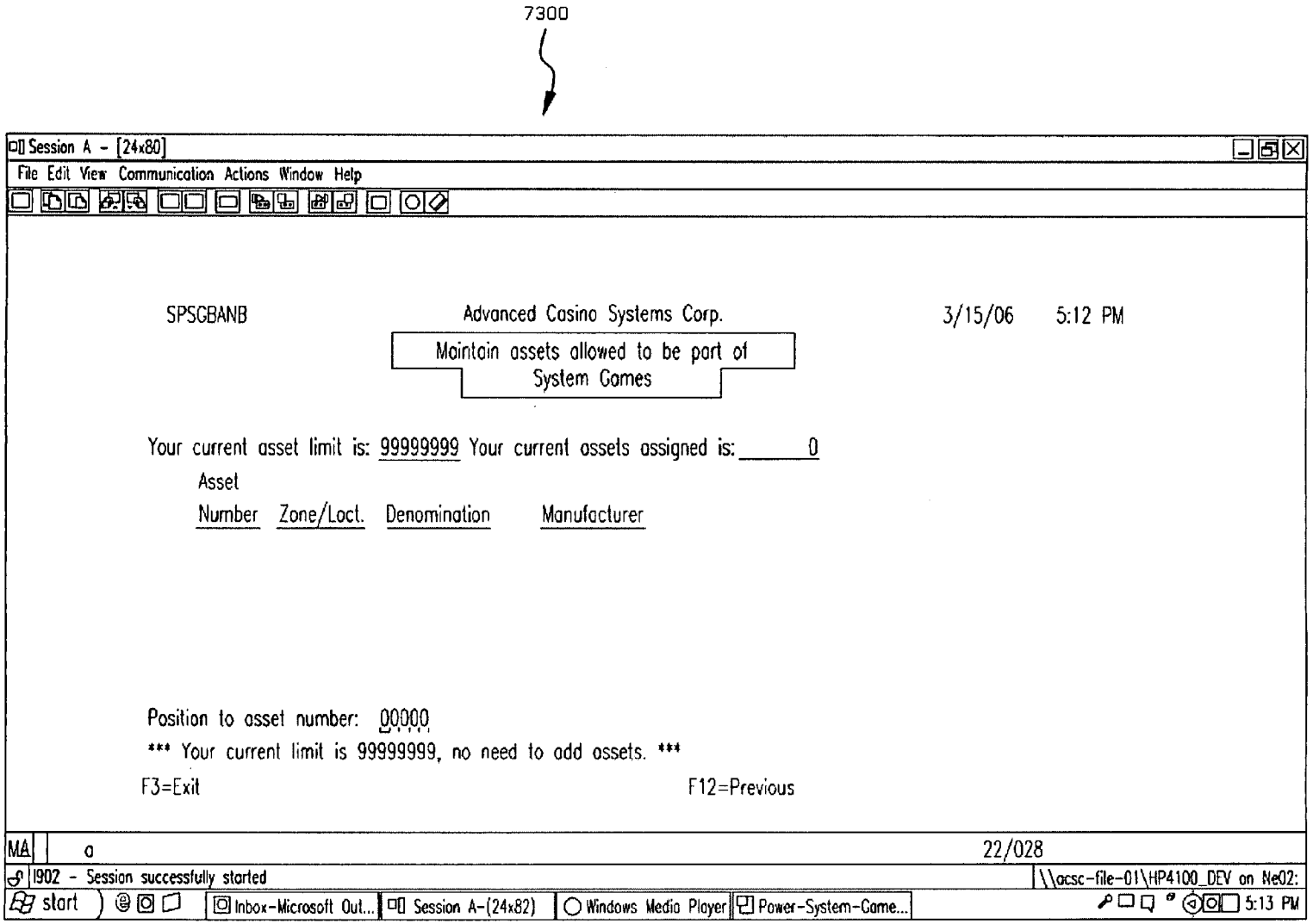

FIG. 73 illustrates a screenshot of the ACSC iSERIES Live Rewards administration page where the site can maintain assets allowed to be part of the System Games. This site has an unlimited number of licenses.

Figure 74:
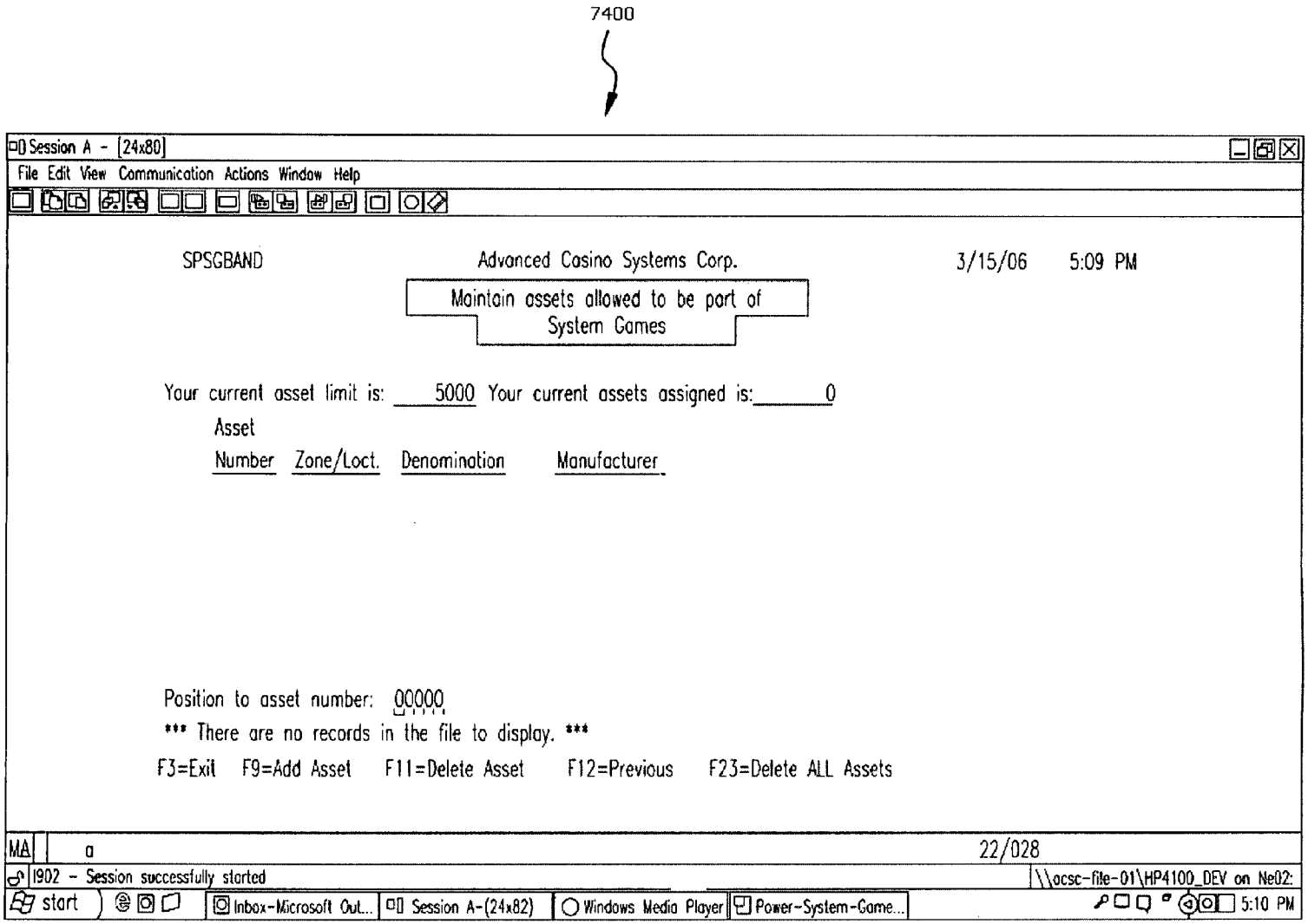

FIG. 74 illustrates a screenshot of the ACSC iSERIES Live Rewards administration page where the site can maintain assets allowed to be part of the System Games. This site has a 5000 licenses available to be assigned.

Figure 75:
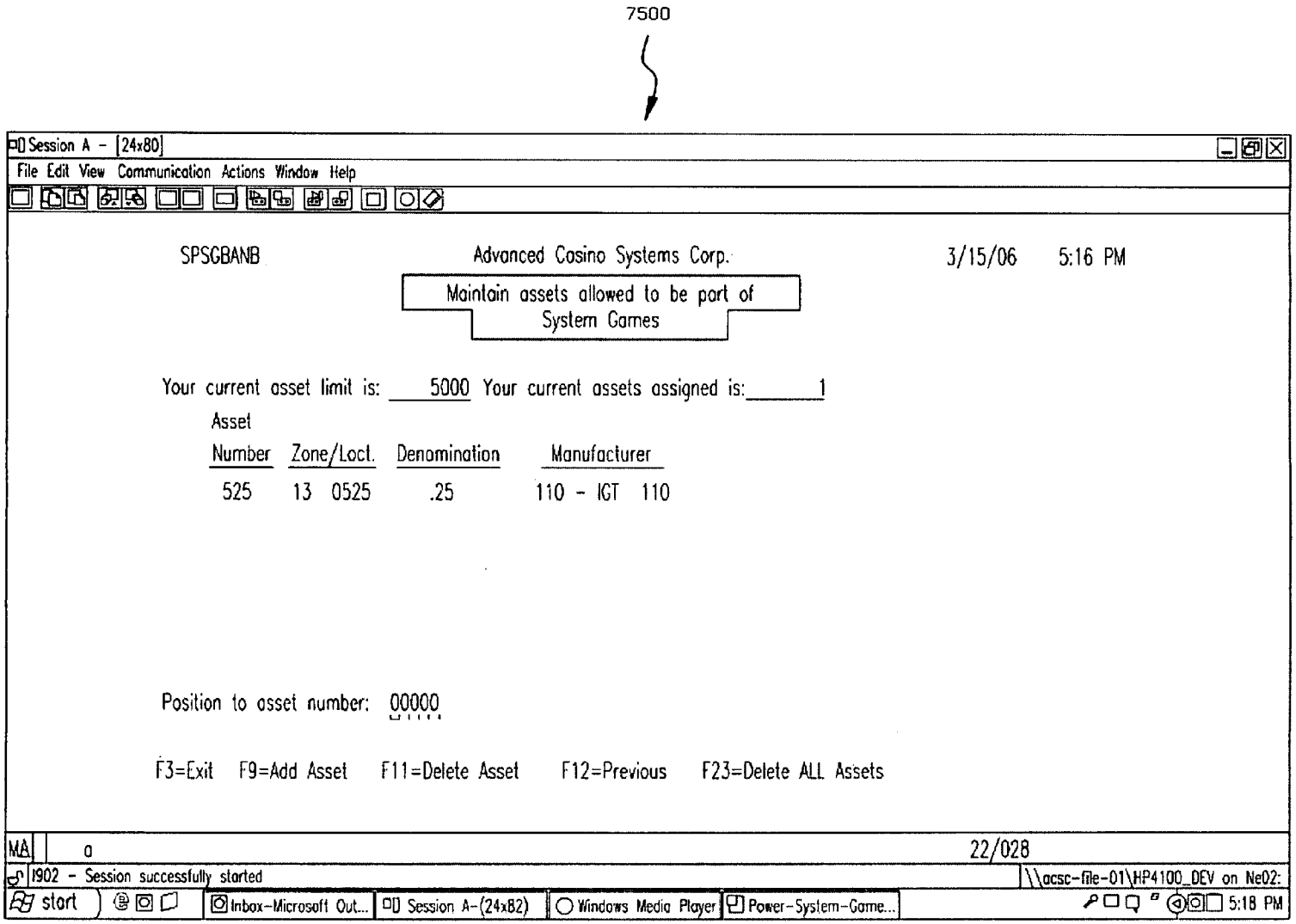

FIG. 75 illustrates a screenshot of the ACSC iSERIES Live Rewards administration page where the site can maintain assets allowed to be part of the System Games. This site has a 5000 licenses available to be assigned. The site is assigning a specific asset number of 525 to be allowed to run the Live Rewards system game product.

FIG. 76 illustrates a screenshot of the ACSC iSERIES Live Rewards administration page where the site can control various global features.

FIGS. 77, 77-1, 77-2, 77-3, 77-4, 77-5, 77-6 (collectively referred to as FIG. 77) illustrate a database schema for the Live Rewards Server.

FIGS. 78-1, 78-2, 78-3 (collectively referred to as FIG. 78) illustrate a flowchart of the Boot-up recovery process of the live rewards games on iVIEW.

Figure 79:
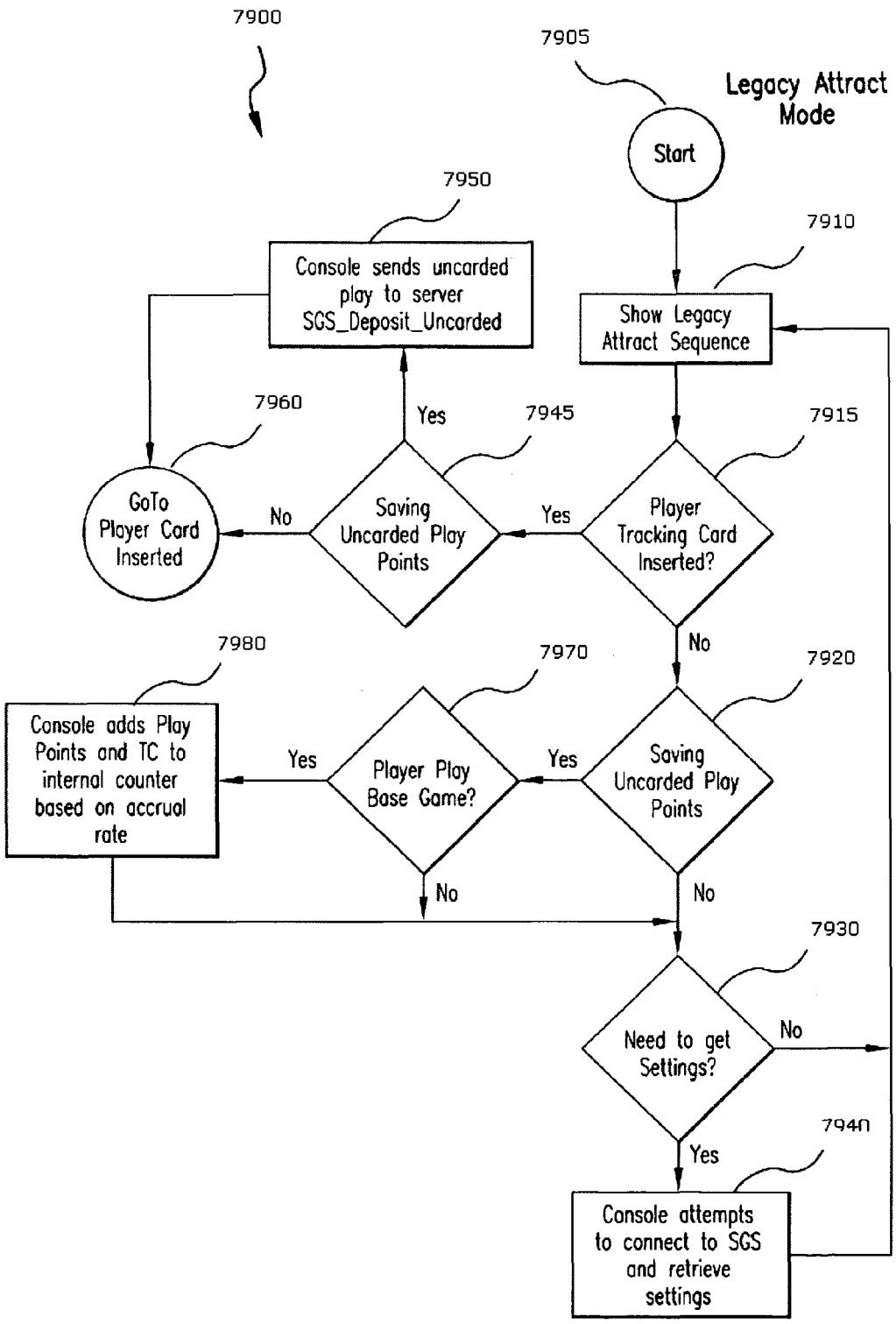

FIG. 79 illustrates a flowchart of the Attract mode logic.

Figure 80:
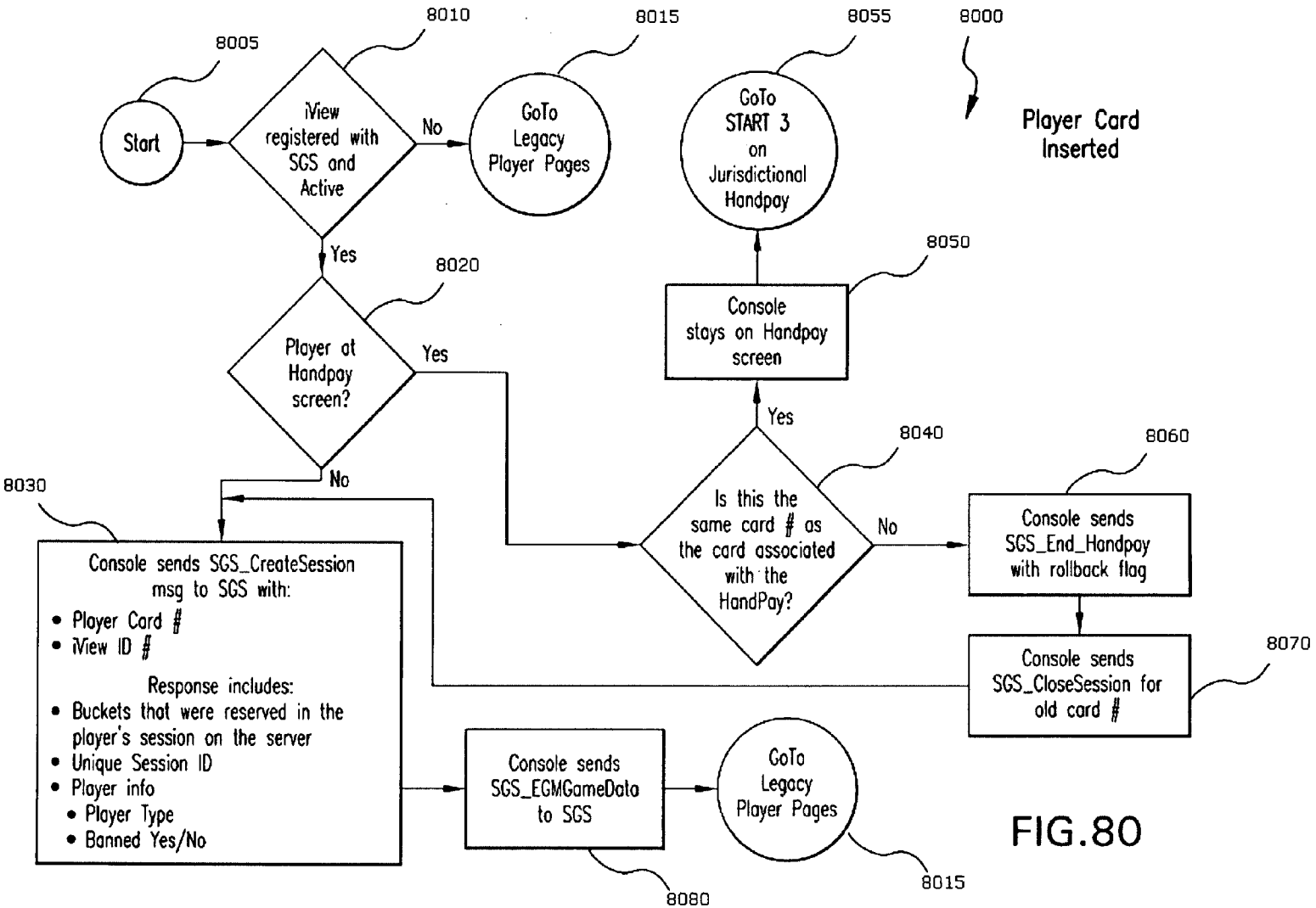

FIG. 80 illustrates a flowchart of what happens at Player Card insertion time.

FIGS. 81-1, 81-2, 81-3 (collectively referred to as FIG. 78) illustrate a flowchart of what happens when the player interacts with the Legacy Player Pages.

FIGS. 82-1, 82-2, 82-3 (collectively referred to as FIG. 82) illustrate a flowchart of what happens when the on the System Game Console Main game screen.

Figures 1, 83:
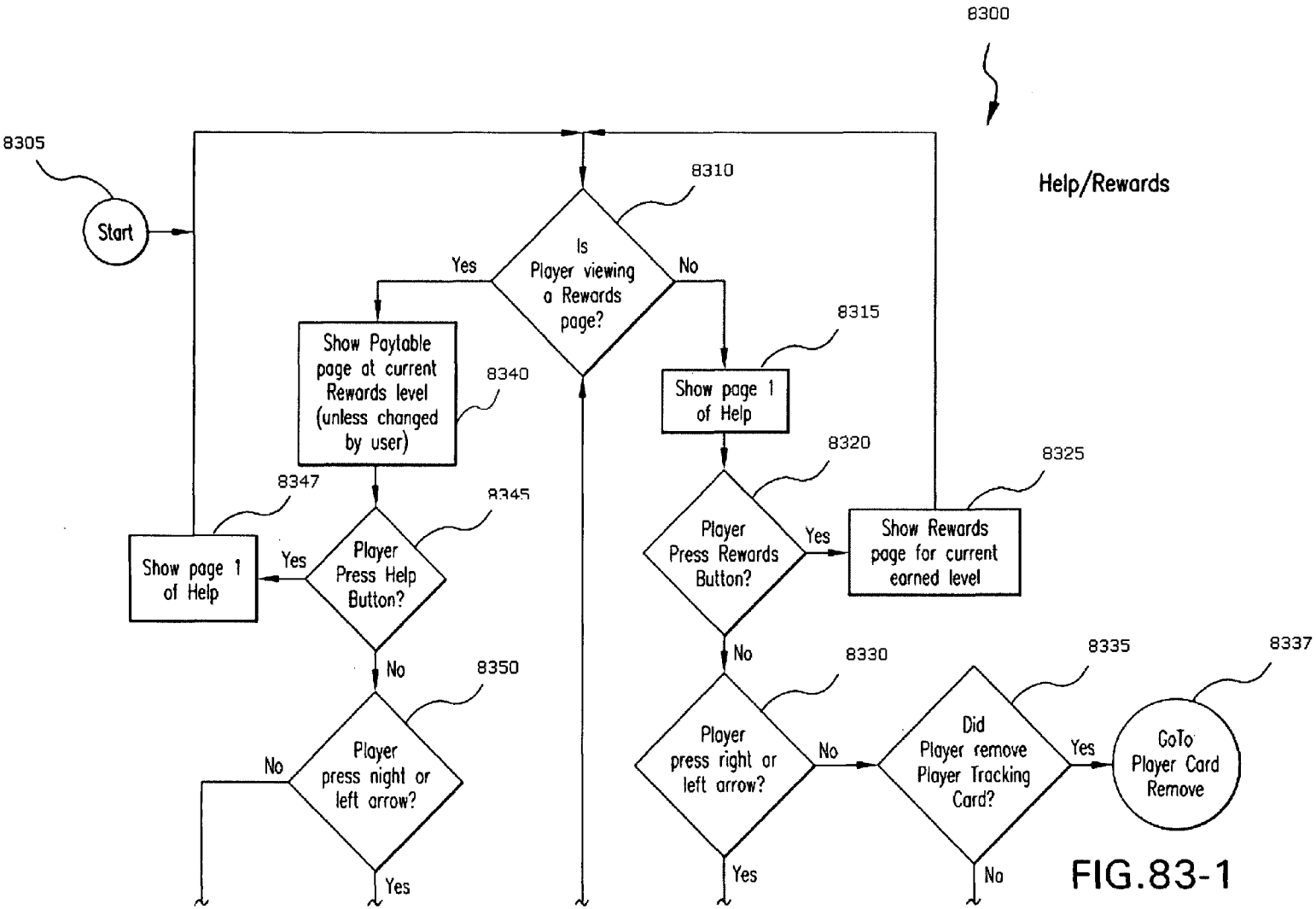
Figures 2, 83:
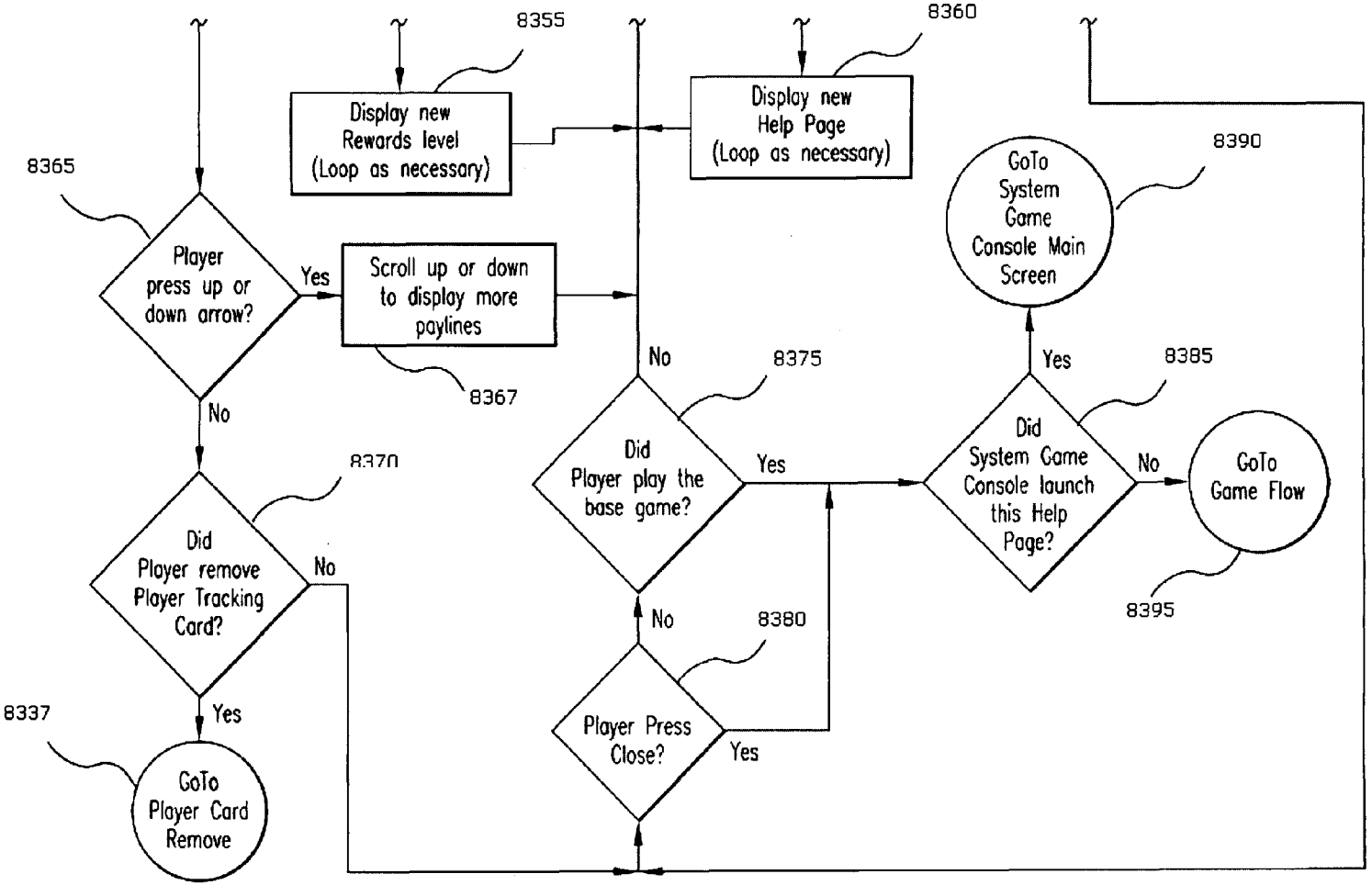

FIGS. 83-1, 83-2 (collectively referred to as FIG. 83) illustrate a flowchart of what happens when the player enters the Help/Rewards pages on the iVIEW.

FIGS. 84-1, 84-2, 84-3 (collectively referred to as FIG. 84) illustrate a software flowchart of what happens during the game play process.

FIGS. 85-1, 85-2, 85-3 (collectively referred to as FIG. 85) illustrate a software flowchart of what happens during the cash out process.

FIGS. 86-1, 86-2, 86-3 (collectively referred to as FIG. 86) illustrate a software flowchart of what happens during a regular cash out procedure.

Figure 87:
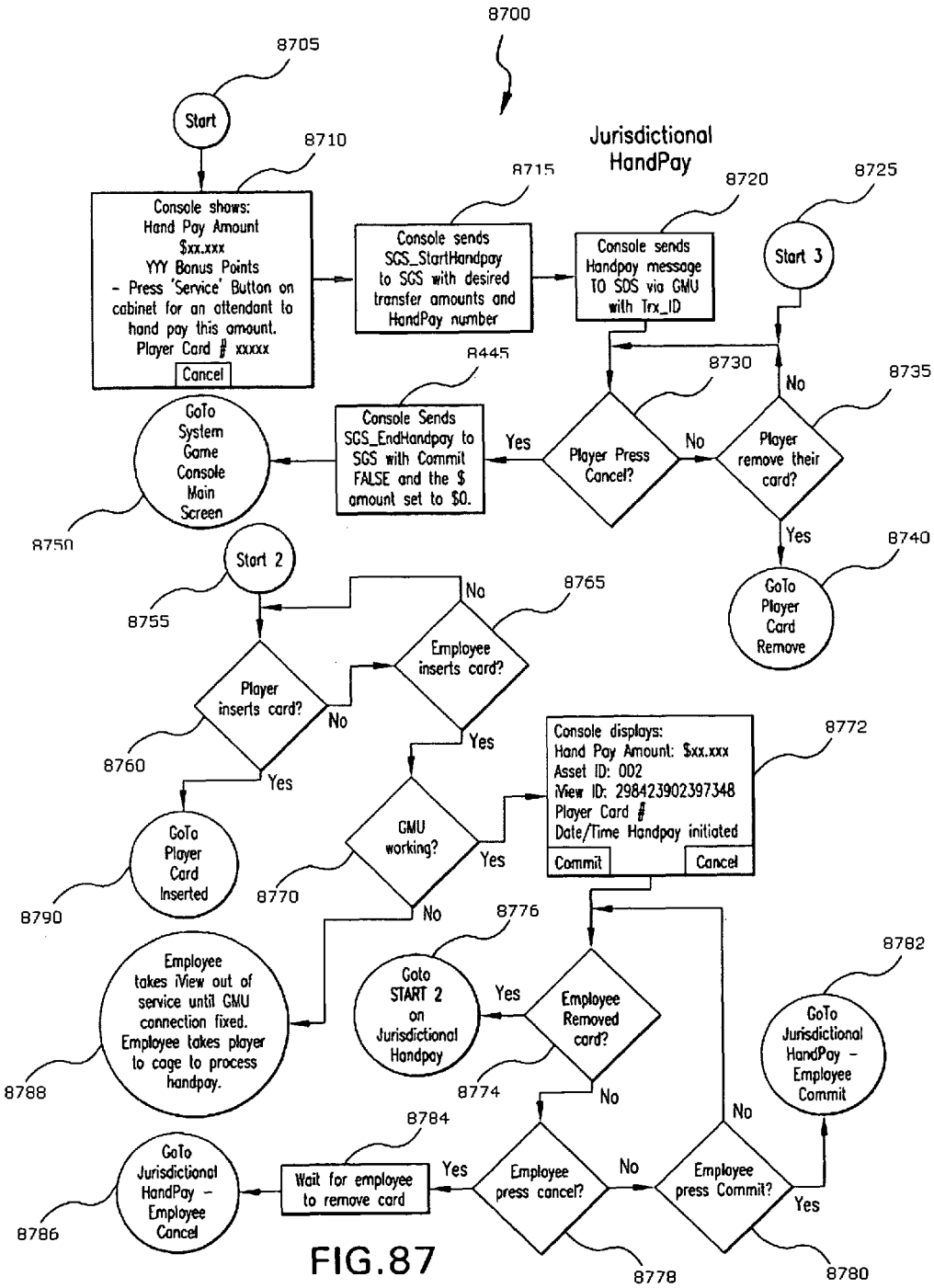

FIG. 87 illustrates a software flowchart of what happens during a jurisdictional Hand pay.

Figure 88:
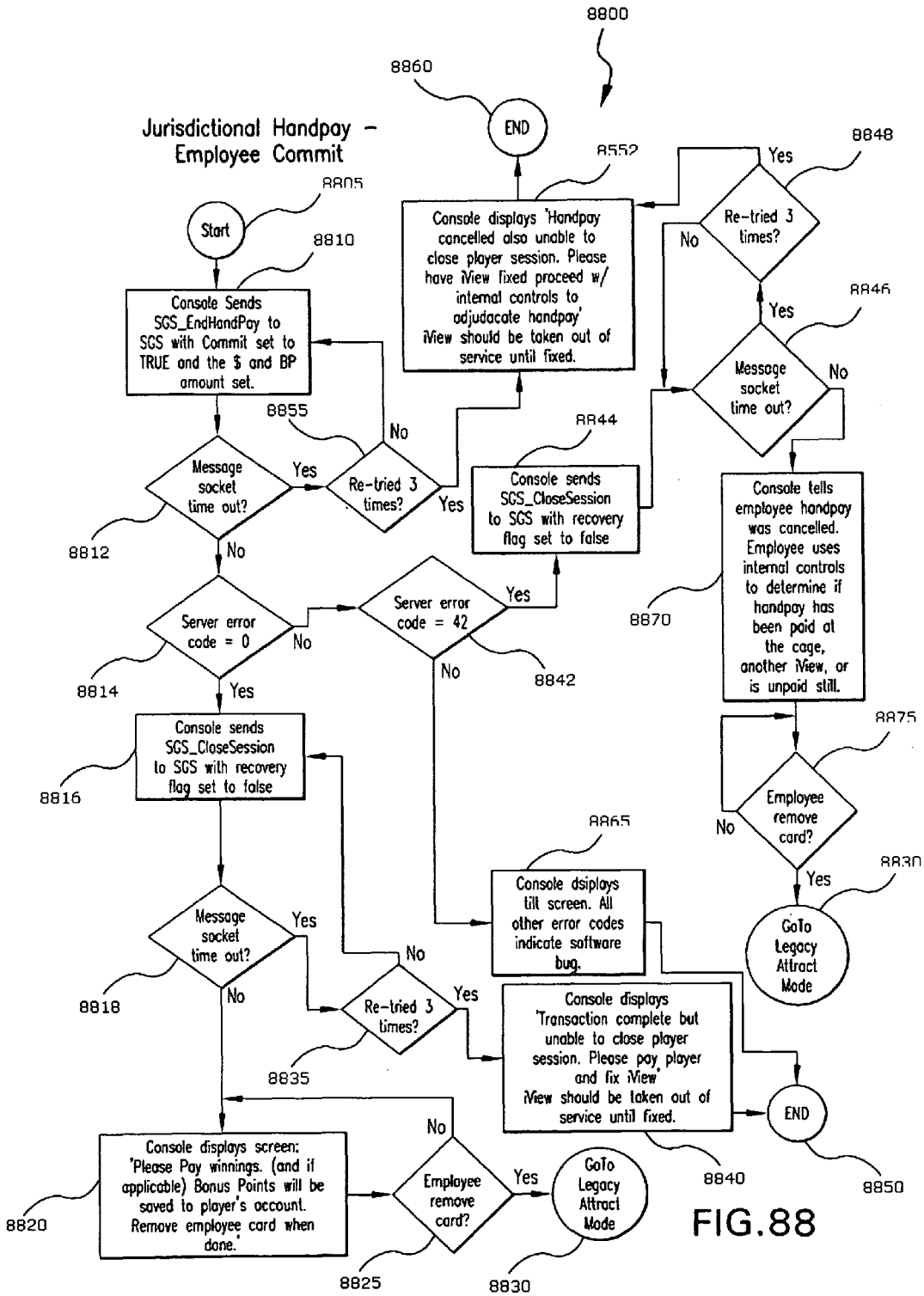

FIG. 88 illustrates a software flowchart of what happens when the employee commits the hand pay.

Figure 89:
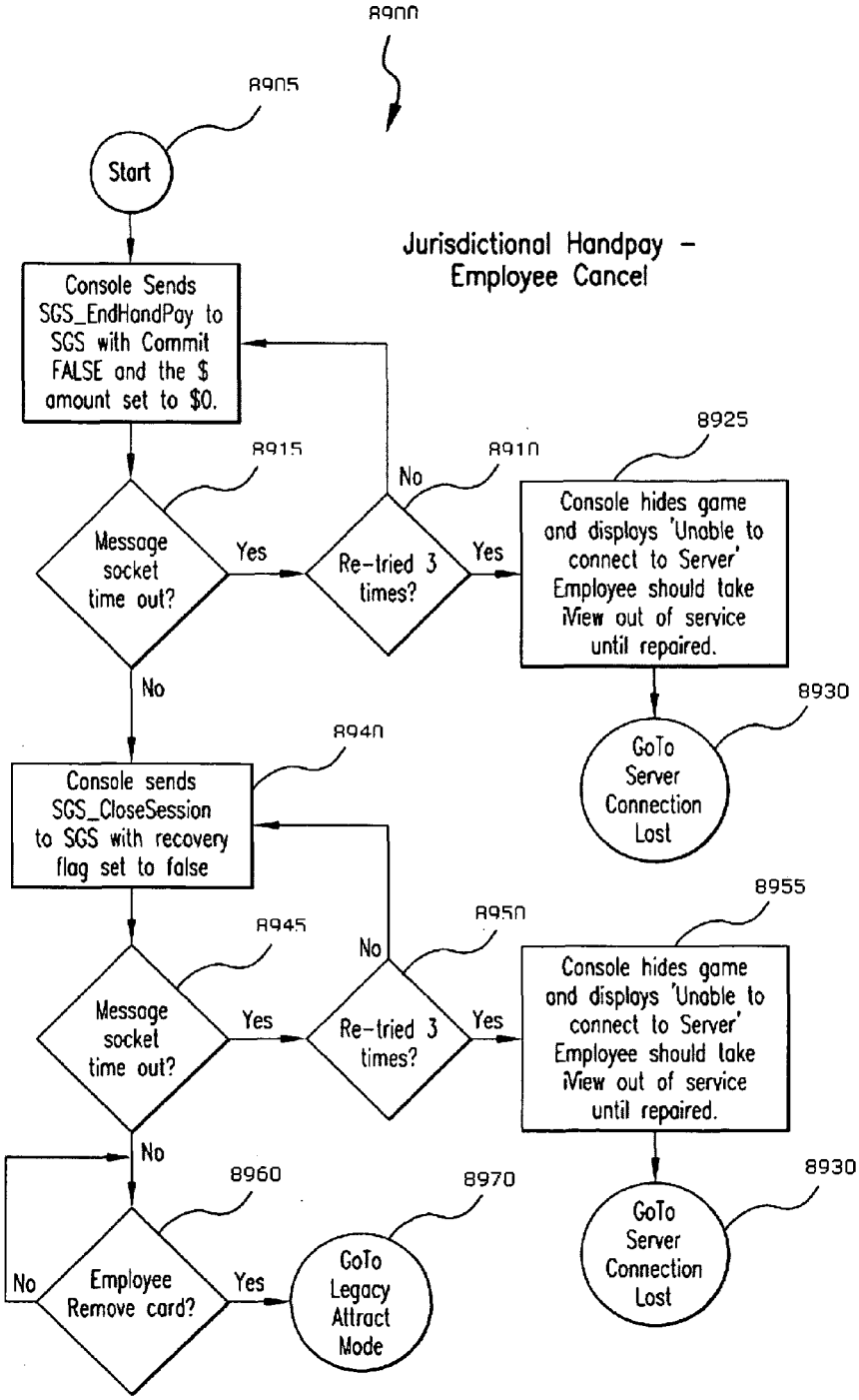

FIG. 89 illustrates a software flowchart of what happens when the employee cancels the hand pay.

Figure 90:
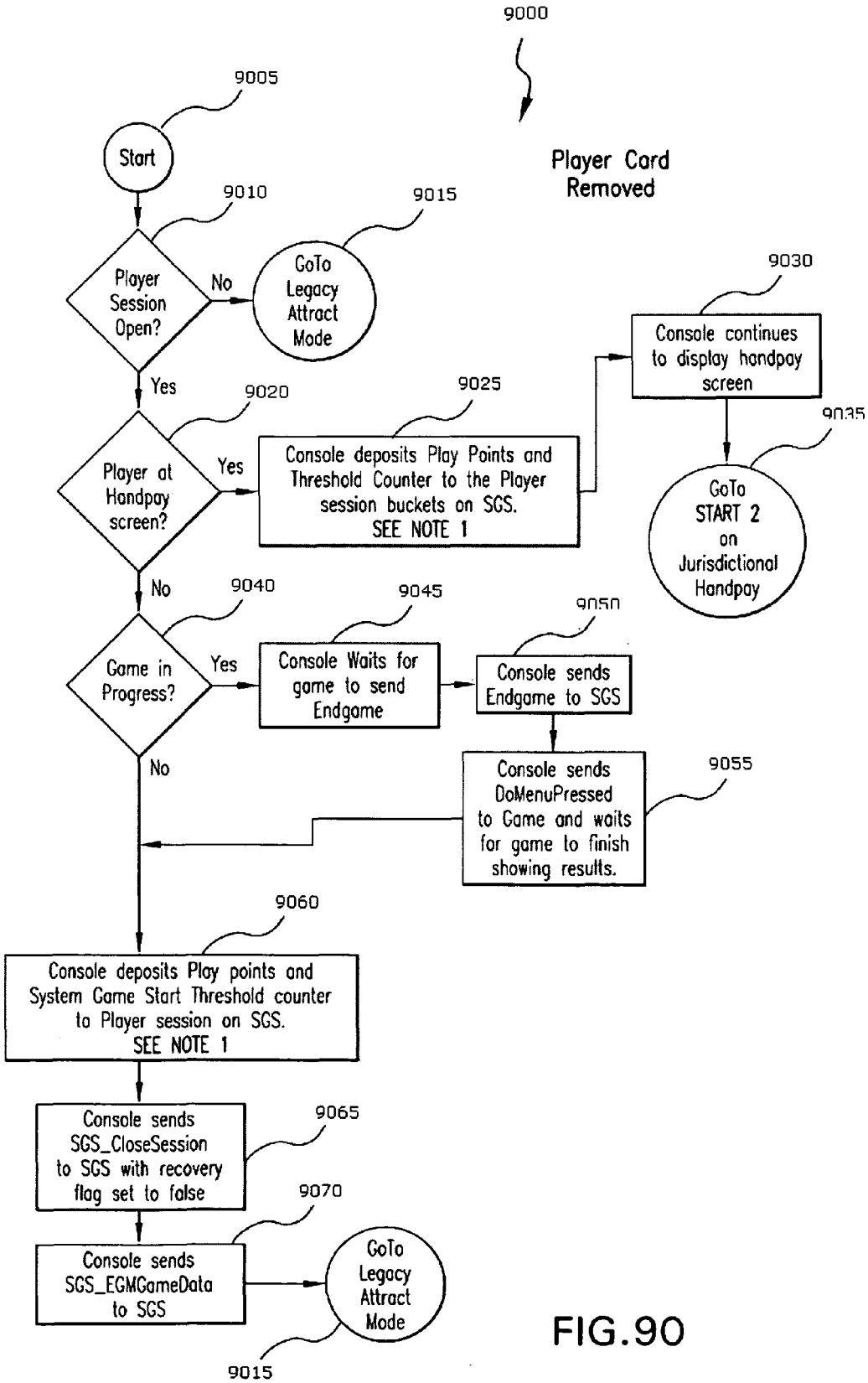

FIG. 90 illustrates a software flowchart of what happens when the player removes the player card.

Figure 91:
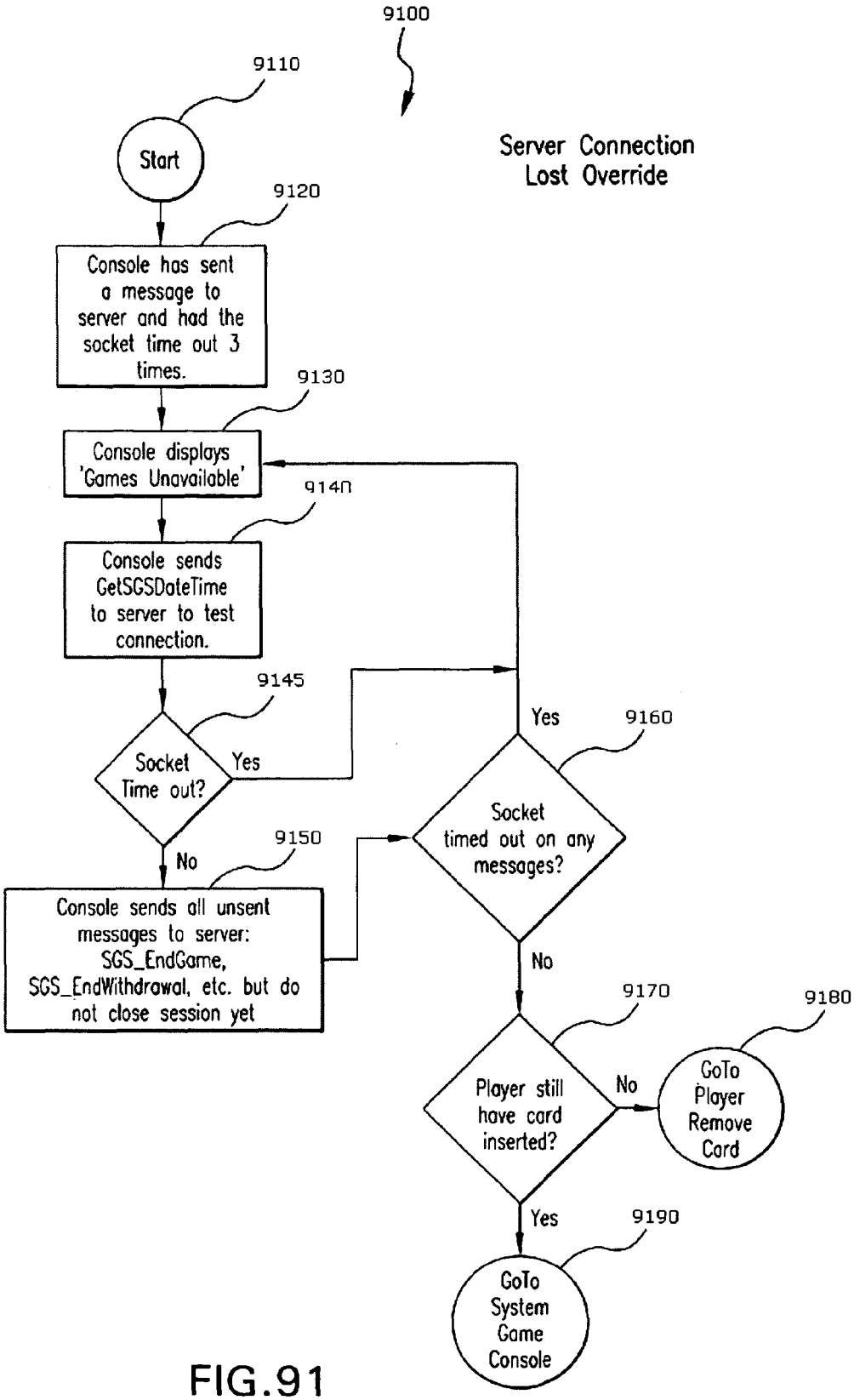

FIG. 91 illustrates a software flowchart of what happens when the server connection is lost from the iVIEW.

Figure 92:
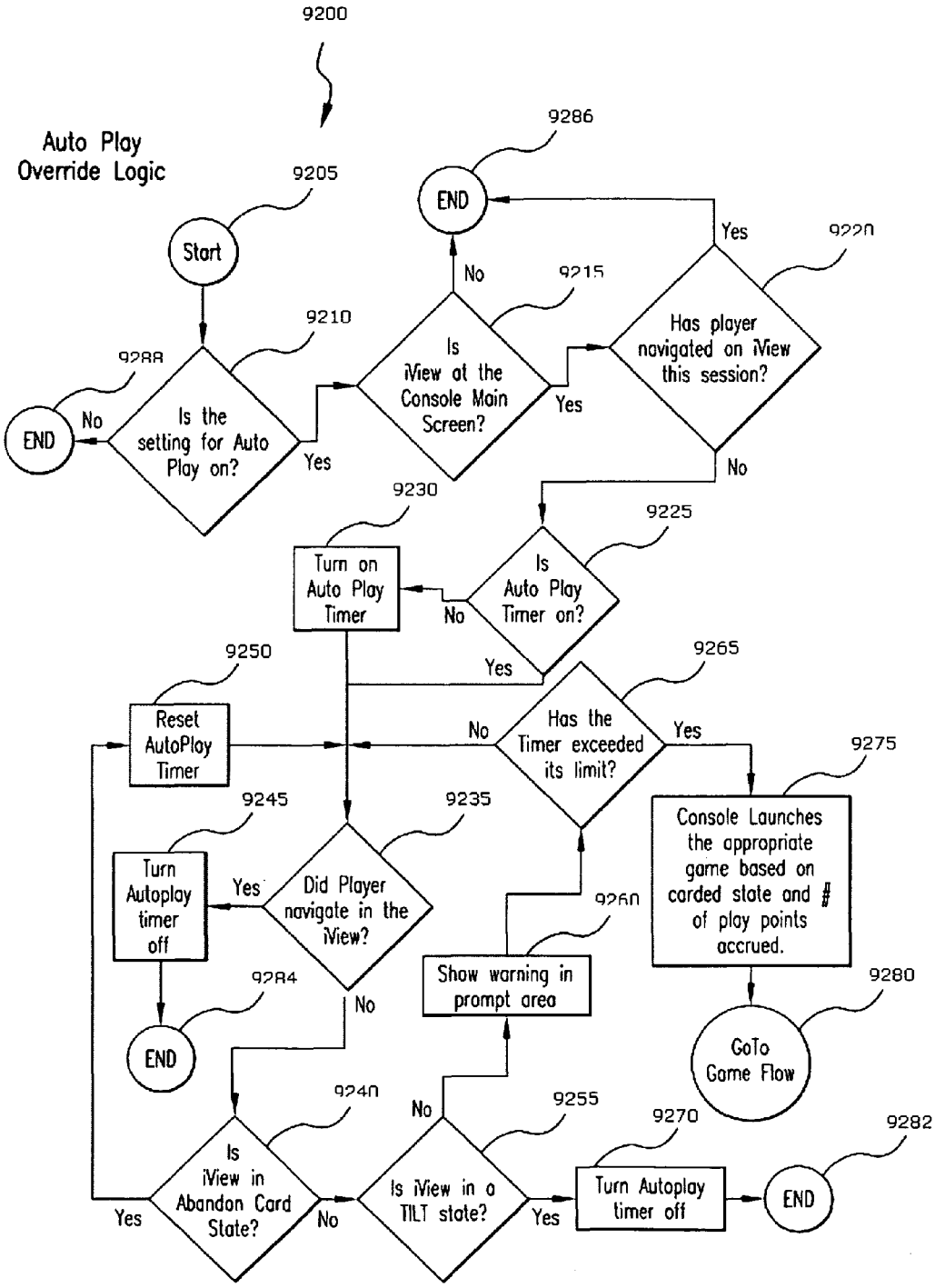

FIG. 92 illustrates a software flowchart of how the Auto Play logic works.

Figure 93:
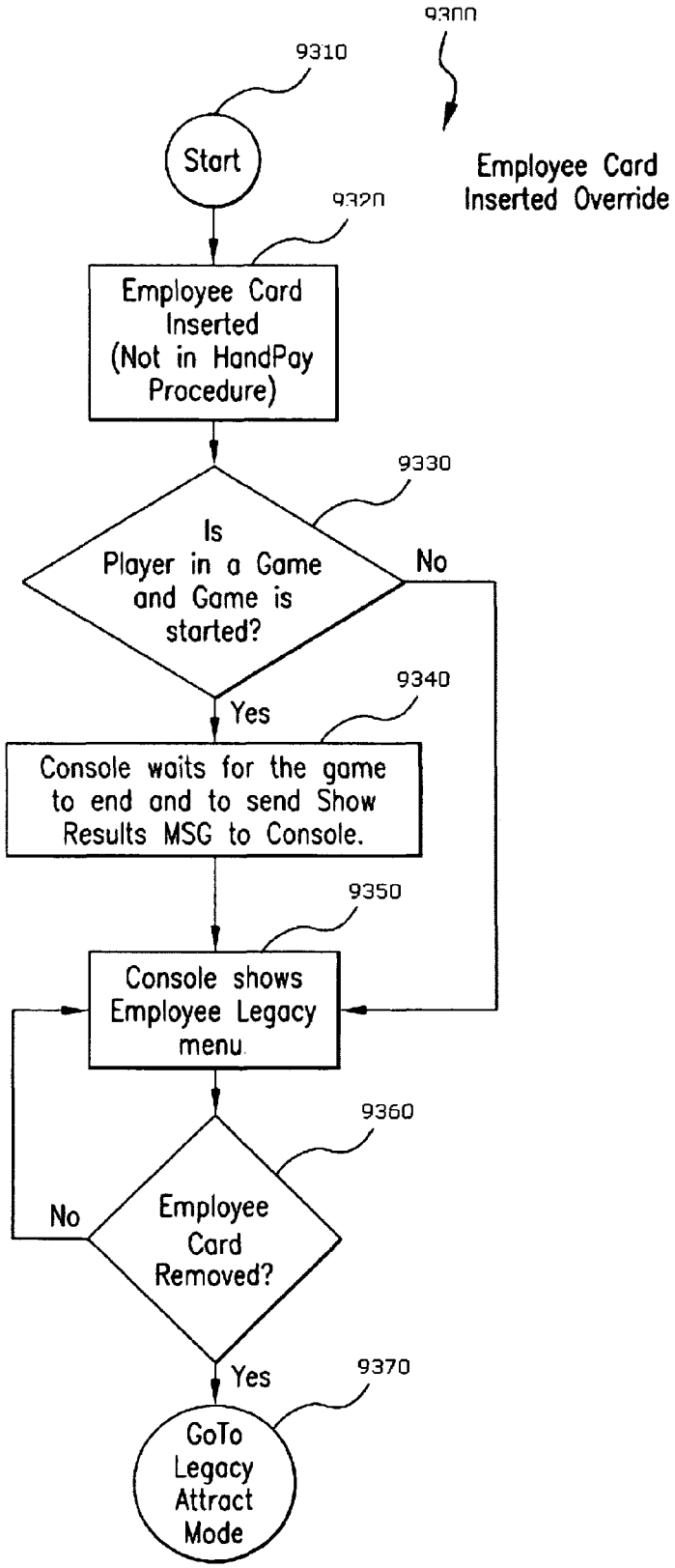

FIG. 93 illustrates a software flowchart of what happens when the employee card is inserted.

Figure 94:
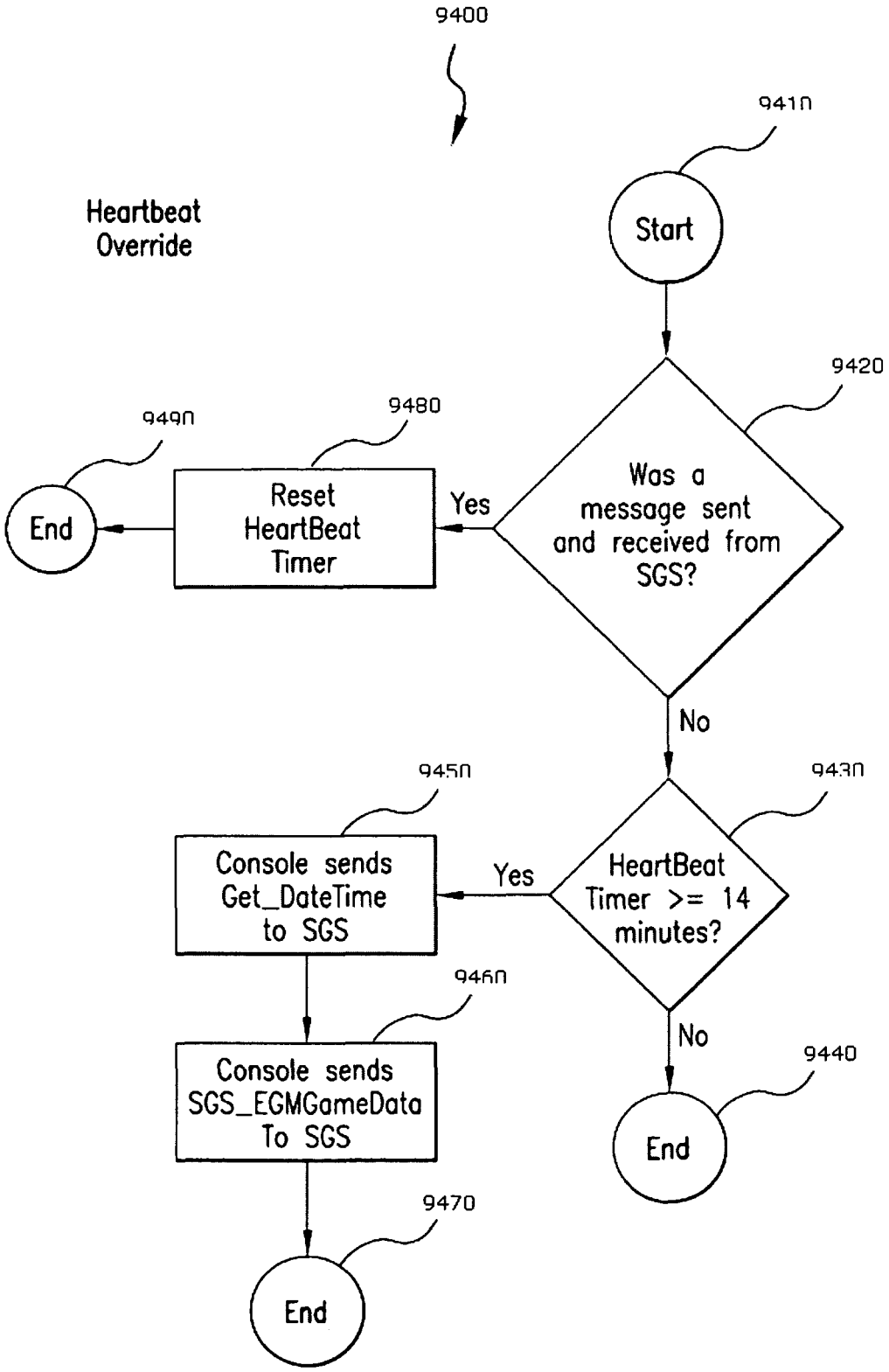

FIG. 94 illustrates a software flowchart of heartbeat messages from the iVIEW to the Live Rewards server or SGS.

Figure 95:
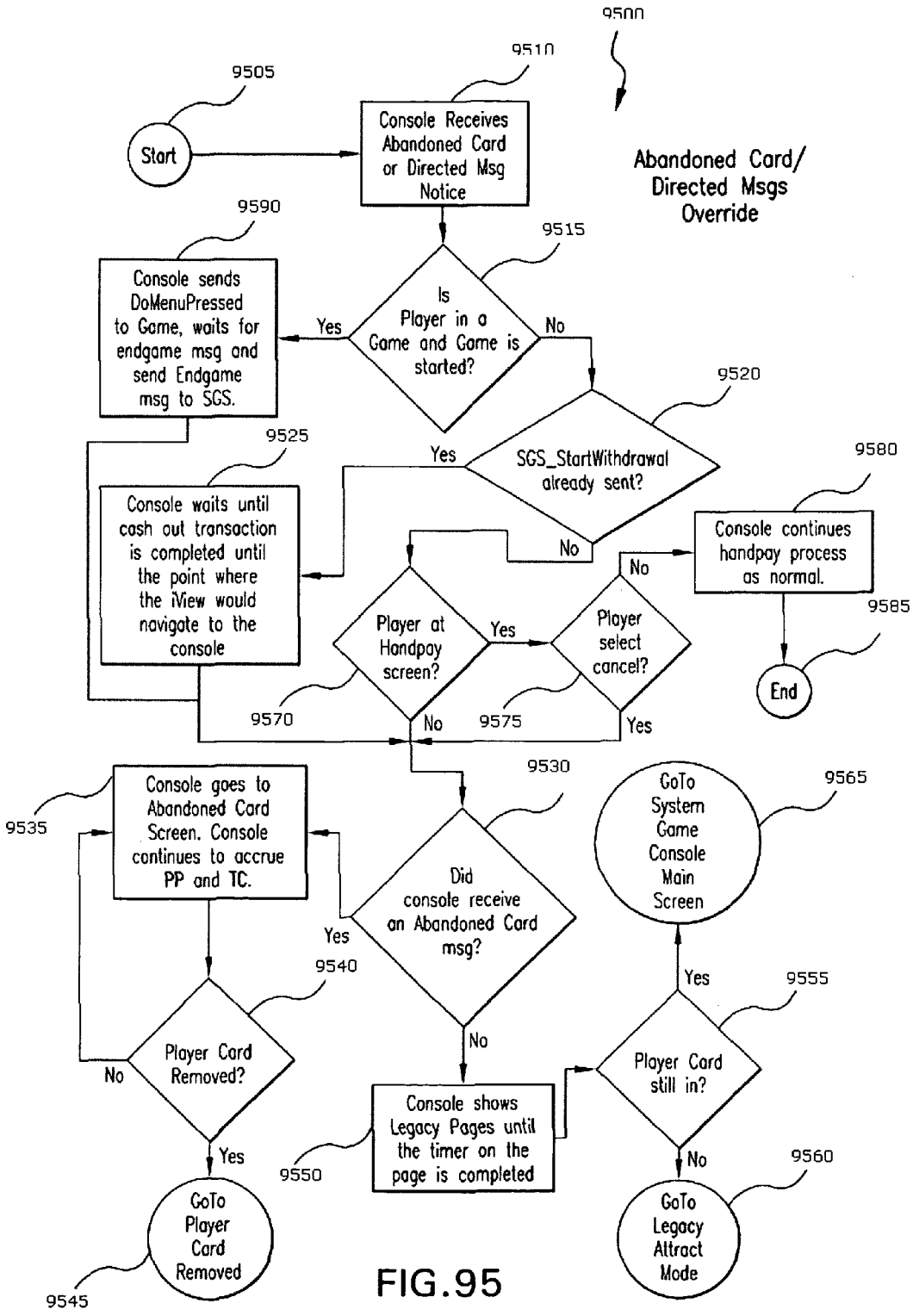

FIG. 95 illustrates a software flowchart of what happens when abandoned player cards or directed messages come in from the Game monitoring unit.

Figure 96:
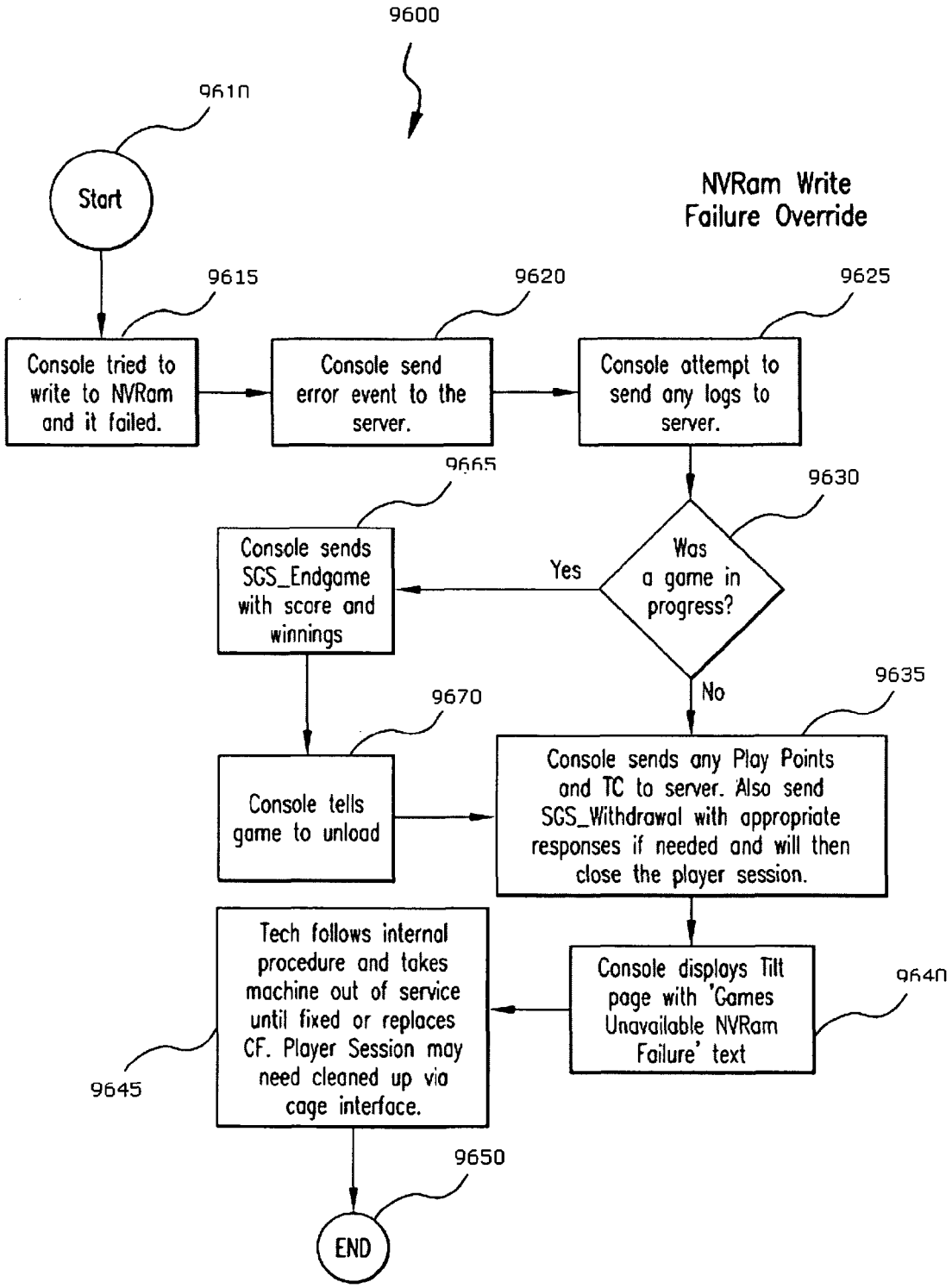

FIG. 96 illustrates a software flowchart of what happens when the writing to the non-volatile memory fails.

Figure 97:
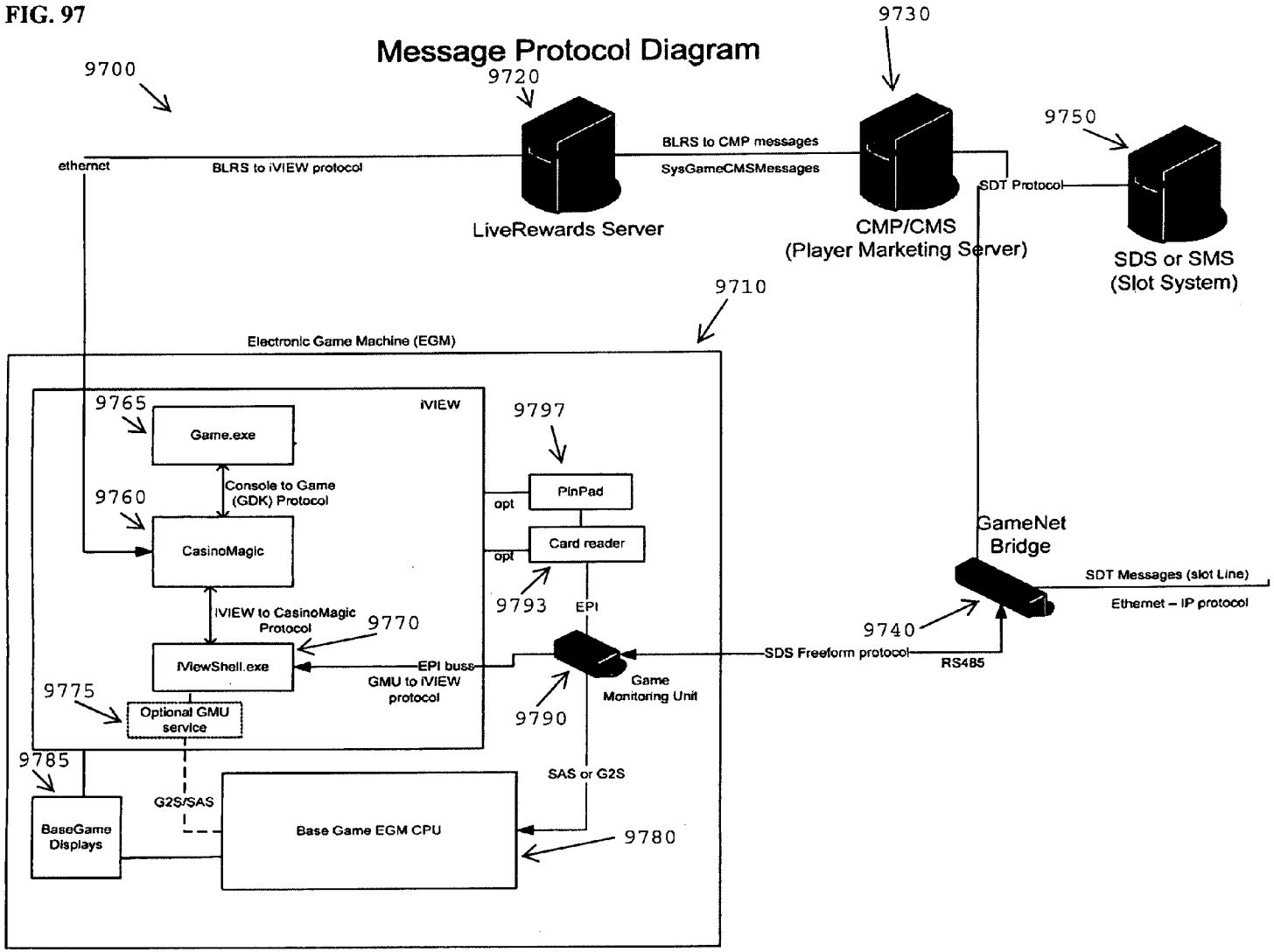

FIG. 97 illustrates a message protocol diagram for a gaming network including a Live Rewards server.

Figure 98:
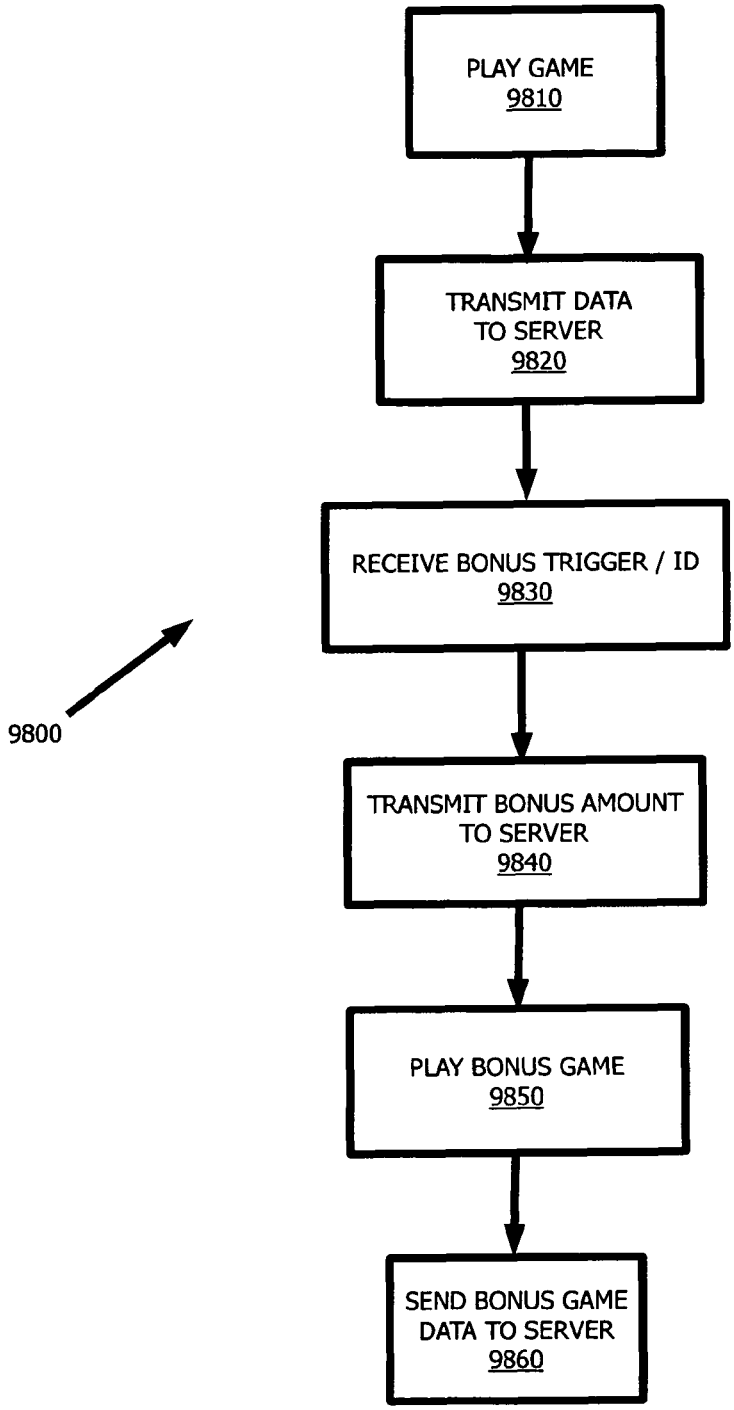

FIG. 98 illustrates an embodiment of a process of operating a game such as may be used in the system of FIG. 97.

Figure 99:
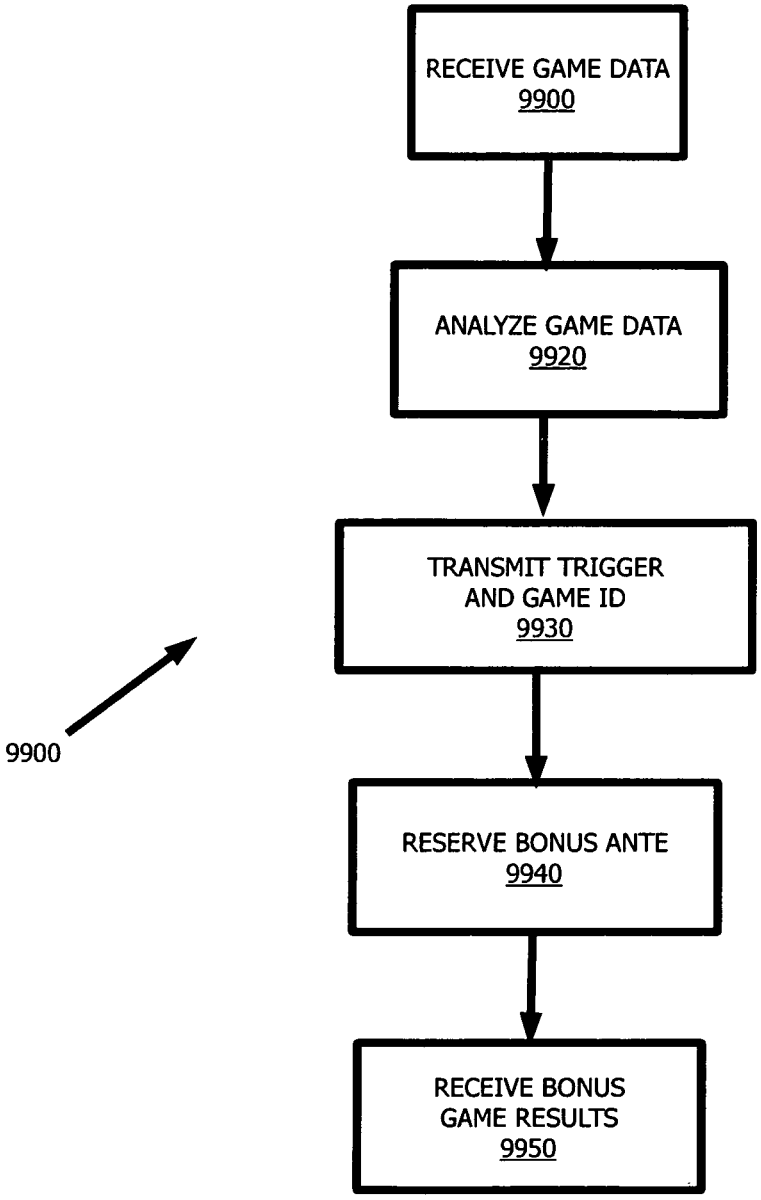

FIG. 99 illustrates an embodiment of a process of operating a rewards server such as may be used in the system of FIG. 97.

Figure 100:
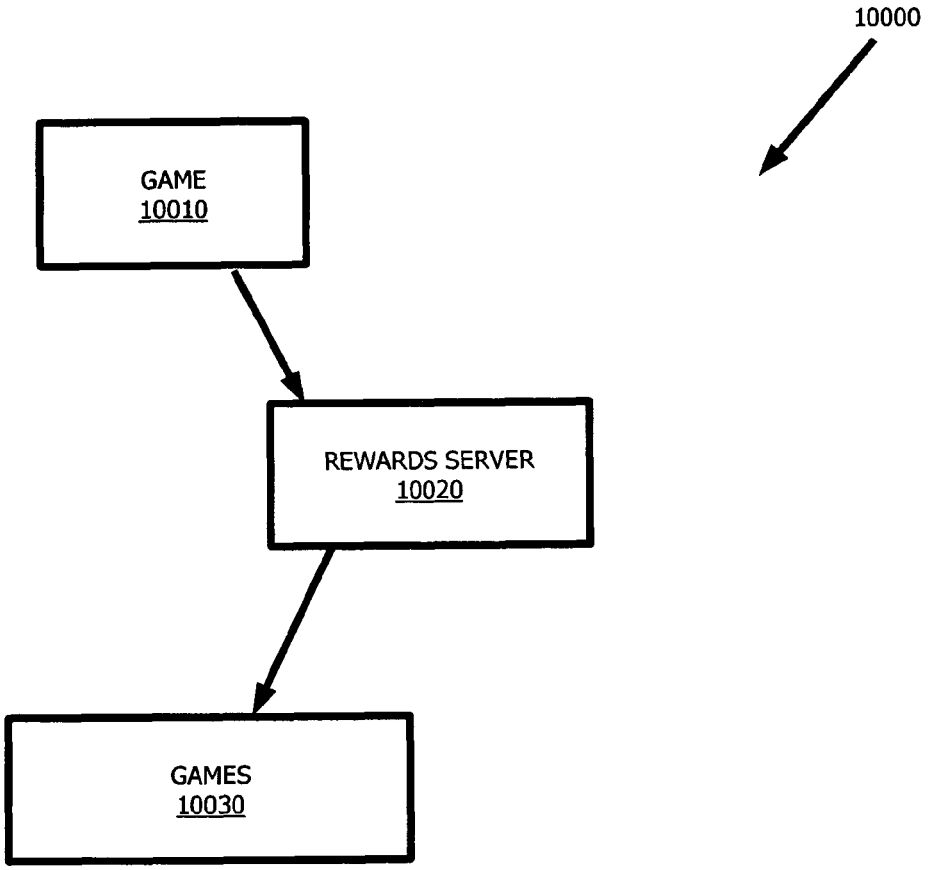

FIG. 100 illustrates an embodiment of a system using the game and rewards server of FIGS. 98 and 99.

DETAILED DESCRIPTION OF THE PREFERRED EMBODIMENTS

Referring generally to FIG. 1-23, a gaming rewards system, such as Bally Live Rewards, lets you offer carded players exciting bonus games through your existing gaming machines with networked player interface units, such as Bally iVIEW-equipped slot machines. This remarkable advancement in technology creates a thrilling gaming experience designed specifically to increase wagering activity. Once a Player's Club card is inserted into the slot machine, each bet on the base game brings the player closer to earning bonus game play. Once the minimum game play requirements have been met, the bonus game either starts automatically or the player can press a button to start the game. Bonus game winnings can be awarded in cash (to be transferred to the base game through an electronic funds transfer) or in bonus points.

In one or more embodiments, Live Rewards bonus games require base game play; they cannot be played directly. Live Rewards uses high-resolution, animated graphics, quality sound, and a touch-screen display to provide players with bonus game content. This content is managed by the Live Rewards Server (LRS) through the Windows-based Live Rewards management application. There are currently two bonus games available through Live Rewards: Blue Spot Bingo and Payday Poker.

The Live Rewards user interface runs on the iVIEW display, allowing customers to play bonus games and transfer their cash winnings to the base game. Players can choose from two Live Rewards bonus games: Blue Spot Bingo and Payday Poker.

Live Rewards has two distinct counters that determine the player's bonus game experience: play points and game start threshold.

Play points are used to determine the pay table used for the bonus game—the more play points a player accrues, the higher the payout amount (equal to one cent for determining prizes on bonus game pay tables) of the corresponding pay table. A play point is defined as one cent of every dollar bet at the base game. This is a pre-set, non-configurable value that has no actual monetary value and cannot be redeemed. The rate at which a player accrues play points is determined by players club membership level and is configured through the Live Rewards Server.

Players track play point accrual through the Reward Level indicator on the left-hand side of the screen. As play points are accrued and the reward level increments, the player sees poker chips stack up. When game play begins, the number of play points used for the game is determined by the number of play points accrued minus the number of play points in the highest qualifying Pay table.

The game start threshold determines when a player has played enough base games to start a bonus game.

For each base game played, the player earns a TC (Threshold Counter), which is depicted on the user interface as a light surrounding the selected game logo. A player earns a TC based on the number of games played the time spent playing, and the maximum bet for each game.

Play points and the game start threshold may be programmed directly on the gaming machines or may be managed remotely from a networked server, such as the Bally Live Rewards Server (LRS).

Play Points are the unit currency used by the player to play a Live Rewards game. Play points are earned based on Base Game Wager times and the accrual rate set for each Player's Club level. Play Points have no redeemable value, but are considered to be worth $0.01 for the purpose of deriving the Live Rewards game Pay tables. You cannot adjust this value. In one or more embodiments, play points are restricted to the play of Live Rewards games and are not cashable.

Play Points earned on the iVIEW are transferred to the player's session account on the LRS before any Live Rewards game begins and at player card removal. Play Points are decremented from the player's server account when a Live Rewards game is played.

The amount of Play Points decremented is determined by the amount of Play Point accumulated when the player has played a number of games equal to the Live Rewards Game Start Threshold. The number of Play Points determine, which Pay Table the player receives with the Pay Table that takes the maximum number of earned Play Points being automatically selected. In one or more embodiments, Play Points are awarded only by play of base game and are not awarded by any other means.

The number of Play Points awarded is equal to the product of the following equation:

Play Points=[Base Game Wager (in dollars)×Accrual Rate (set by BLRS)]/[Value of Play Points (in dollars)]

Client Side processing of Play Points (PP) and Threshold counters (TC's)

1) On card-in the client may register the player's card number to the iVIEW and receive the values of the reserve account for display purposes.
2) As the player plays the base game PP and TC's may accrue on the client.
3) At Card-out, Recovery start-up, and before a Begin Game is sent to the LIVE REWARDS SERVER all PP and TC accrued on the iVIEW are transferred to the LIVE REWARDS SERVER.
4) When the iVIEW has determined the player has accrued enough TC and PP for a game (combined total of reserve account and remaining PP's and TC's on iVIEW) the iVIEW allows the player the option to start a game. If the player elects to start a game:
   a) All PP's and TC's are transferred via 3-stage commit to LIVE REWARDS SERVER.
   b) Current totals in reserve account are returned to iVIEW.
   c) If total is still acceptable to starting a game iVIEW sends a Begin Game message to LIVE REWARDS SERVER that includes the number of PP's and TC's to be used.
   d) Based on server setting send a −1 for TC's to be used may use them all.
   e) LIVE REWARDS SERVER sends a response back to the iVIEW that includes a History ID number (HID) and a success or Fail.
   f) If Success is returned iVIEW proceeds to play the system game.
   g) At game conclusion a End Game messages sent to LIVE REWARDS SERVER Via 2 stage commit (stage 1 of the 3 stages was Begin Game). The end game contains the value of any winnings the player won.
   h) Winnings in the End Game are stored in the player's reserve account.
5) Bonus Points (BP's) are immediately transferred to CMS from LIVE REWARDS SERVER.
6) Cash winnings in the reserve account are shown to the player and accessible after Pin-in for AFT transfer from LIVE REWARDS SERVER to the base game.
7) On recovery any PP's, TC's, BP's and cash are transferred to LIVE REWARDS SERVER.
8) On recovery, If a Begin Game was sent and an End game was not completed the End game is sent with a recovery status and the LIVE REWARDS SERVER rolls back the PP's and TC's used for the incomplete game are rolled back into the player's account and any reserve account for this card#/iVIEW ID is also rolled back into the player's account.
9) If the player is playing slowly and a Begin Game, End Game, or card out has not occurred in (Heartbeat time length—1 minute) the iVIEW sends a heartbeat to the LIVE REWARDS SERVER to keep the player's reserve account reserved.

Referring now to the drawings, wherein like reference numbers denote like or corresponding elements throughout the drawings, and more particularly referring to FIG. 1, player console 101 is shown, such as may be utilized to provide games, such as wagering games, to eligible patrons based upon pre-selected criterion, in accordance with one or more embodiments.

Referring further to FIG. 1, player console 101 may comprise a touch sensitive display and a console processor board and be constructed as part of a player interface unit, such as a commercially available Bally iView, which may include a touch panel display, wherein the display shown on player console 101 in each of the respective figures may be conventionally generated by a microprocessor, digital signal processor, or controller using coding to generate the respective fields shown. The respective fields or areas of the display may be pressure sensitive to allow a player to transmit requests, inquiries, or commands. In another alternative, there may be keys or buttons that may surround or be situated about the perimeter of the display portion of player console 101. In an alternative, player console 101 may be conventionally generated on a wireless device, such as a Blackberry cellular phone or a tablet-style laptop computer.

In one or more aspects, player console 101 connects with a gaming apparatus, such as a gaming server or gaming machine, that may include one or more games, such as video games, for example the Blue Spot Bingo game shown in the figures, or electronic card games, such as the Payday poker game shown in the figures. The games may be executed on the gaming server or gaming machine, in which case player console 101 displays the game driven remotely, receives the signals to display the game information, and transmits requests or commands from the player. Player console 101 may have programming imposed restrictions on game play, such as playing thresholds to be achieved by a player prior to the player console game being enabled.

In one or more alternatives, player console 101 may display various games that are available for play, where any of the games may be selected by a player, such as by pressing the surface area in the case of a touch-sensitive display or an adjacent button. The game software may reside on a supporting game processor board which may be connected directly to the display portion of player console 101 or the game software or portions thereof may reside on the console processor board. In one or more alternatives, when a player selects a game, the game software may be transmitted from a server or gaming machine onto the console processor board.

Continuing to refer to FIG. 1, player console 101 displays a main panel 103 for a bingo game, in the example panel, the game is Blue Spot Bingo. As part of the display panel, a rewards level accumulator 107 is shown which displays the current player reward level, where the reward level is determined by the amount played on the base game. In the example, the player has reached reward level 11 and the rewards level accumulator 107 may be illuminated up to the level achieved. For example, reward level 11 may correspond to an eighty percentile level on the rewards level accumulator 107 and eighty percent of the scale may be illuminated green, while the remaining portion may be unlit. The panel 103 further shows a help area 111 which may be pressed to bring forward an informational display panel that may include the rules for playing the game and a paytable. Also, shown is a name section 113 displaying the name of the current game selected on player console 101 and a central name section 115 with the logo for the game.

The central name section 115 of the main panel 103 may include a perimeter of lights 117 which may illuminate as a player plays a base game and earns sufficient playing points to play the bonus game with player console 101. The base game may be a game that is played in a gaming machine that house player console 101 or it may be any game that a player plays and accumulates points that may be reflected on player console 101. As a player plays one or more base games, the green lights may illuminate sequentially around the perimeter 117 and correspond to playing points accrued by the player. By example, a player may accumulate one player point for every dollar wagered or there may be some other basis connected to the player's wagering. Once all the lights around the perimeter 117 of the central name section 115 have been illuminated, then the player has accumulated sufficient player points to play the bonus game.

The main panel of player console 101 further may include a promotional cash level area 119 providing a display of the promotional cash available to transfer to a game, such as a base game, a player account 121 area that may be touch sensitive to bring forward a player account panel which may contain player points and available funds accessible through a player account which may by example be maintained on a player account server connected over a network with player console 101. The main panel 103 may further include a funds collection area 123 that may bring forward a funds request panel which may allow a player to draw funds down to a base game or gaming machine and be either used for further wagering or cashed out if the funds have no restrictions, such as funds that may be used only for play on one of the games of a casino operator.

The main panel of player console 101 may further include a game selector area or areas 125*a*, 125*b* which may be touch sensitive and enable a player to scroll backward, such as is shown by the area labeled "Last Game" 125*a* referring to a previous game's main panel, or, scroll forward, such as by pressing the area labeled "Next Game" 125*b* to view a next bonus game's main panel from a list of available games.

In addition, the main panel of player console 101 may include a game initiator area 105 with a header, such as "Play Game". The game initiator area 105 may be illuminated when sufficient points have been accrued by a player to play the bonus game. Illumination of the game initiator area 105 may alert a player that the player is eligible to play the bonus game. Alternatively, by pressing the button, the player may initiate the sequence of panels 127*a*, 127*b*, 127*c*, 127*d* shown in FIG. 3 below. At any time before the bonus game begins by selection of the blue spot numbers, a player may return to the main panel of FIG. 1 and browse for other games of interest.

Figure 3A:
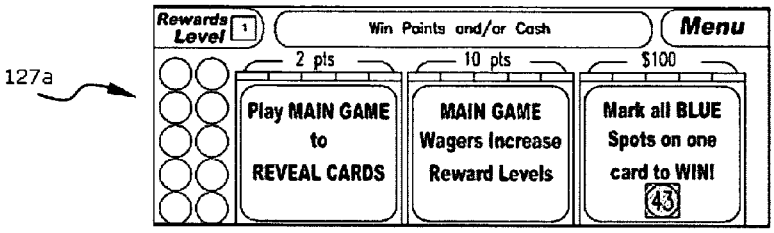
FIGS. 3A, 3B, 3C, 3D illustrate a sequence of example game panels on a player console showing a bingo game from beginning to end in accordance with one or more embodiments of the present invention.

In a further alternative, the player may be required to meet the threshold requirements of FIG. 1 before the player may open the panel shown in FIG. 3A in exchange for the accumulated player points. At which point, the player must continue to play the main game to accumulate additional player points to fully initiate the game sequence shown of panels 127*a*, 127*b*, 127*c*, 127*d* in FIG. 3A-D as described below.

Figures 2A, 2B, 2C:
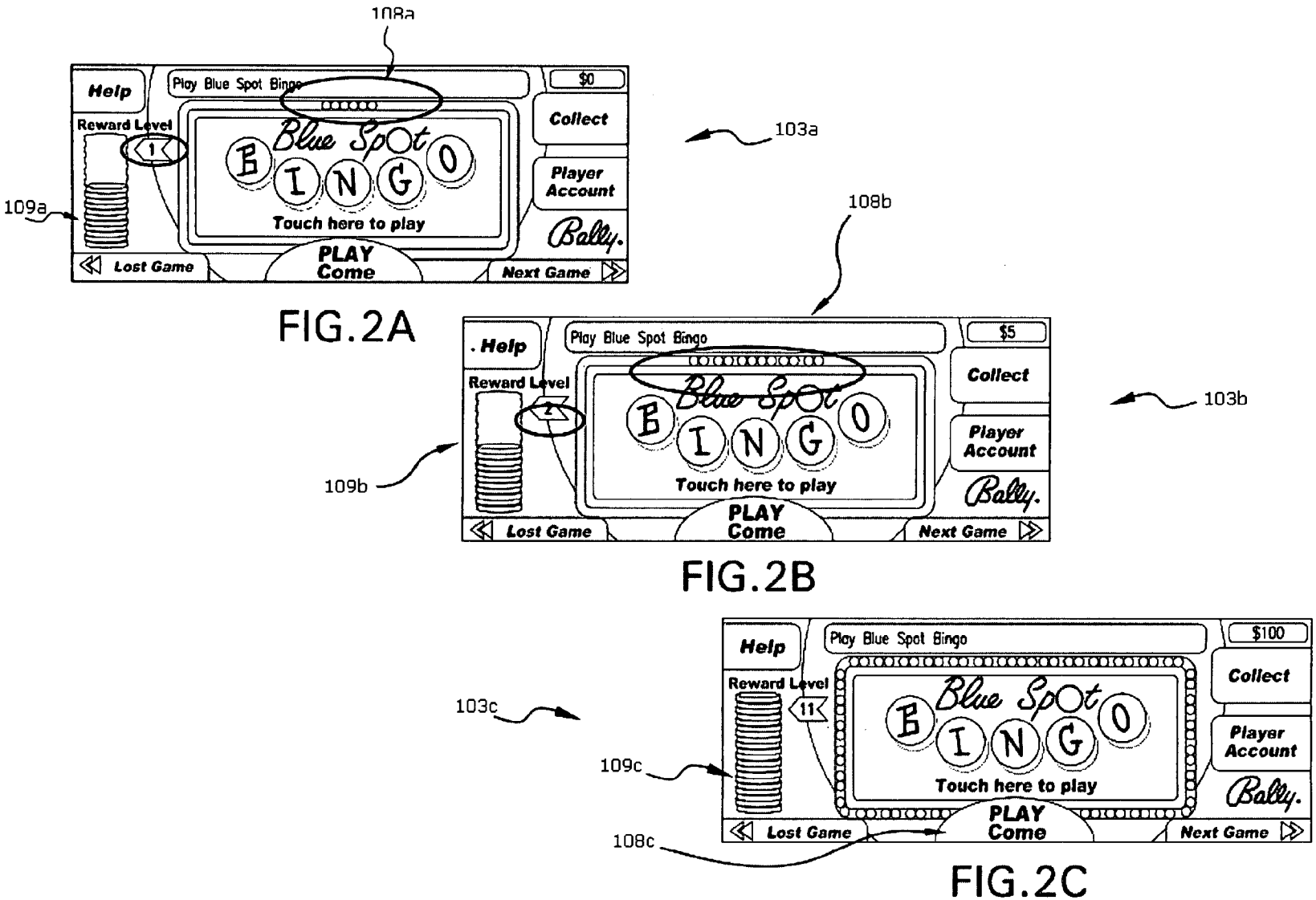
FIGS. 2A, 2B, 2C illustrate a main game panel on a player console at various stages of game play of a player in accordance with one or more embodiments of the present invention.

Referring to FIGS. 2A, 2B, and 2C, the main panel 103 (103*a*, 103*b*, 103*c*, 103*d*) of the Blue Spot Bingo game is displayed on player console 101 where the perimeter lights are shown with a beginning string of lights 108*a* illuminated, then a longer string of perimeter lights 108*b* illuminated until all the perimeter lights are illuminated. Simultaneously, the reward level indicator 109*a*, 109*b*, 109*c* (which may be associated with a player point accumulator that may be installed on the console processor board or remotely, such as on a player tracking server) may increase to correspond to threshold levels achieved by a player's play, such as player reward level "1", "2", and "11" shown in the figures as 109*a*, 109*b* and 109*c* respectively, and points accumulated. The perimeter lights may illuminate as playing thresholds are met by the player until all the lights are illuminated. At this point, the "Play Game" area may illuminate to indicate that the game play threshold has been met to play the bonus game and to indicate that the "Play Game" area is enabled so that the player may initiate the bonus game play.

The reward level achieved by a player may be used to determine a paytable associated with the bonus game. Apart from the number of points accrued, the reward level may be determined by denomination played by a player, for example a penny slot machine player may only be able to achieve level '3', whereas, with a nickel denomination slot machine, a player may be able to achieve level "5", and so forth. In addition, the number of coins per line may be a determinant on reward level that may be achieved, so that a player playing the minimum per line may achieve certain levels less than the highest level while a player playing maximum bets per line may achieve the highest reward level.

Figure 3B:
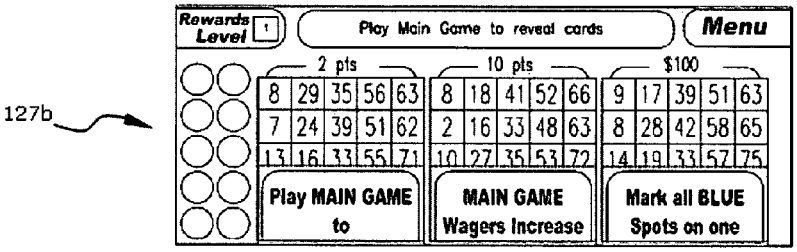
Figure 3C:
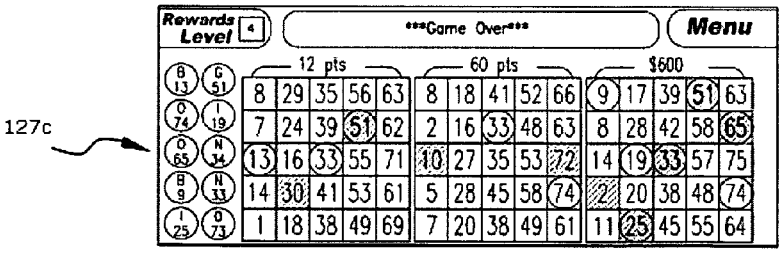

Referring to FIGS. 3A, 3B, 3C, a sequence of panels show the example Blue Spot bingo game from beginning to finish of the game. The initial panel sequence of the bingo bonus game displays each of three bingo cards fully covered, FIG. 3A. In order to uncover the cards for play, the player must continue to play a base game to accumulate points and achieve thresholds which cause a portion of one or more cards to be uncovered (FIG. 3B) until as in FIG. 3C the cards are completely uncovered. The numbers that are selected for the player, are shaded on each card, such as shaded 'blue' to correspond to the name of the bingo game Blue Spot Bingo. The selected numbers on the cards may be selected randomly such as through a program operating the game. Alternatively, the numbers may be selected by a player where the player may be permitted a maximum number of selections on each card. In the example shown, card one and two have only two numbers that are selected and that need to be matched and card three has five numbers that are selected. The bingo numbered balls appear one at a time as they are drawn or simulated to be drawn from a pool of numbers corresponding to a range, such as one through seventy-five. The drawn numbers that match to the numbers on the card are marked, such as by circling as shown in FIG. 3C. Additionally, the matched numbers may be illuminated. If all the shaded numbers on a card are circled, then the player wins the award that is associated with the bingo card. In FIG. 3C, the potential awards for each card are listed above the card which as an example are 12 points, 60 points, and $600, respectively. It may be noted in the example that the cards with the lower potential awards have the least amount of numbers that need to be matched and therefore have the greater likelihood of being a winning card.

Figure 3D:
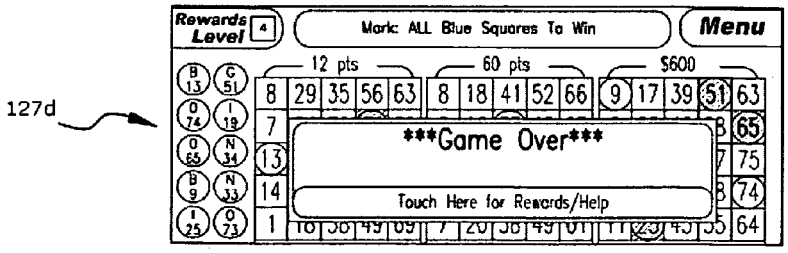

The amount of the potential award corresponds to the rewards level, which by example is "4" as shown in the rewards level indicator on the panel of FIG. 3C. In the example, no card had all matching numbers, so the game is over and no award is given to the player and a "Game Over" caption is displayed in the upper display area while the player may continue to see the respective cards for a short period on FIG. 3C. After the short period, such as ten seconds, has passed, a panel as shown in FIG. 3D may be displayed which includes a large game ending placard area displayed across the cards indicating the game is over, for example "*Game Over*". On the game ending placard, a further informational area may be included that may be touch sensitive to enable a player to access the rewards/help panel, which may provide the player with the rules and potential rewards available for the game.

Further referring to FIGS. 3A, 3B, 3C, an informational panel may be located at the top and when the game is initially ready to play with all the cards covered, additional information may be provided on the cover of each card, such as "Play Main Game to Reveal Cards", "Main Game Wagers Increase Reward Levels", and "Mark all Blue Spots on one card to Win". Additionally, on each panel may be a menu button area which may be touch sensitive and allowing a player to restore the main game panel as shown in FIG. 1.

Figure 4A:
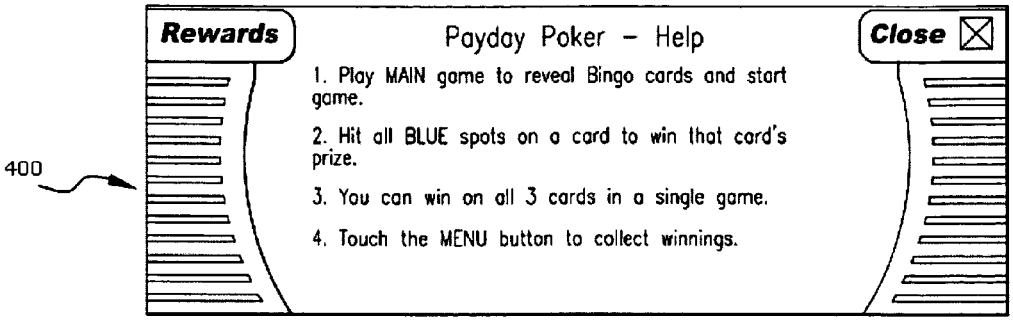
FIGS. 4A, 4B illustrate a rewards and a help panel on a player console providing information about an associated game, such as bingo or poker, in accordance with one or more embodiments of the present invention.
Figure 4B:
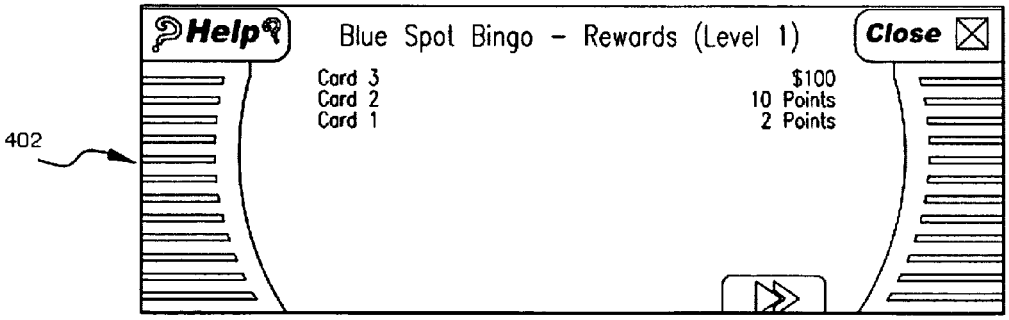

Referring to FIGS. 4A, 4B, panels 400, 402 are shown that may be displayed when a player presses the help or rewards/help buttons shown in FIG. 3C or FIG. 1. In the example, FIG. 4A displays the initial help screen and provides the rules of the game, such as the name of the game (the current example figure has the incorrect name a the top of the help screen, it should be "Blue Spot Bingo"), the requirements for the player to be eligible to play the game by playing a main game to uncover the bingo cards, the requirement that each of the blue spots on a card must be matched by the drawn bingo ball numbers to be a winner and that there can be more than one winning card, an instruction that the player may touch the menu button to collect any winnings. The help panel 400 also may include a touch sensitive rewards button and a close button. By pressing the rewards button, a reward panel 402 as in FIG. 4B may be displayed to inform a player of the rewards for each of the bingo cards that may be obtained in accordance with the rewards level. For example, FIG. 4B shows the rewards for level one for each of the cards one, two, and three to be two points, ten points, and one hundred dollars, respectively. In addition to touch sensitive help and close buttons, an arrows button is displayed which enables a player to scroll through each of the levels and corresponding rewards. The close button enables a player to request the main game panel to be displayed.

Figure 5A:
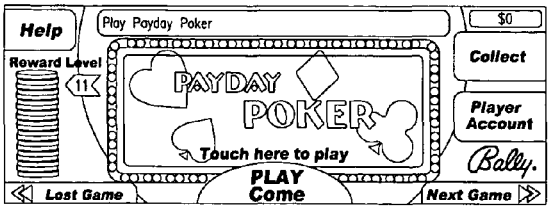
FIGS. 5A, 5B, 5C illustrate a sequence of example game panels on a player console showing a poker game from beginning to game play in accordance with one or more embodiments of the present invention.
Figure 5B:
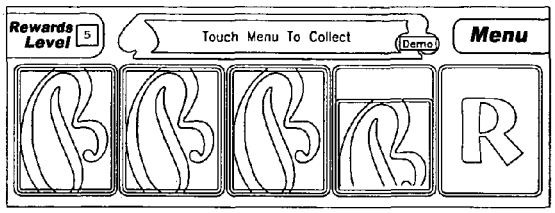
Figure 5C:
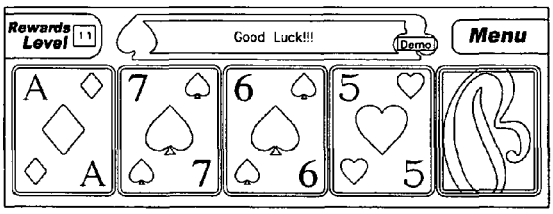

Referring to FIGS. 5A, 5B, and 5C, a second game, Payday Poker is shown, via panels 500, 502, 504 which has similar functional aspects as described above with respect to the Blue Spot Bingo game. As in FIG. 1, FIG. 5A has a perimeter light area about the central game name display area where portions of the lights are illuminated as the player plays a base game, accumulates player points, and achieves thresholds. Once the perimeter lights are fully illuminated the "Play Game" button may be illuminated and activated so that the player may initiate the initial game sequence which is a panel such as shown in FIG. 5B where there are five card places which are initially empty. As the player plays the base game and achieves thresholds, a covered card begins to appear until it is complete, then a next card begins to appear as the player continues to play and achieve thresholds. In the FIG. 5B example, the player has achieved a number of thresholds and has acquired or drawn three complete covered cards and has partially met the needed thresholds to obtain the fourth card. When the player has obtained five covered cards, the hand is complete and then each card may be sequentially uncovered to show the player what hand of cards has been drawn, the process of uncovering the cards being shown in FIG. 5C. The process of uncovering may be automatic or the player may initiate the uncovering by pressing on each card; the cards may only be uncovered after a complete hand has been drawn. In the event that a winning combination has been obtained, then the player may select another panel to collect the winnings, such as by pressing the "Menu" button to return to the main game panel and then pressing the "Collect" button.

Figure 6A:
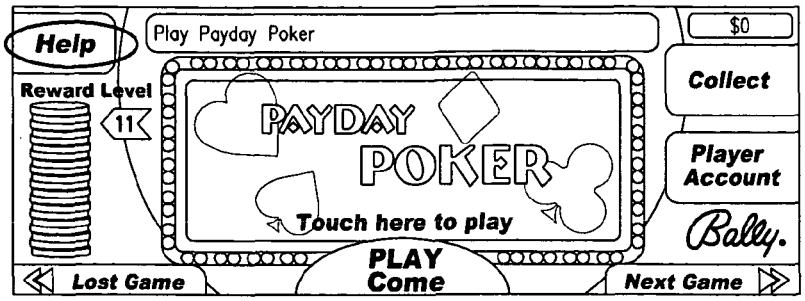
FIGS. 6A, 6B, 6C illustrate a main game, rewards and help panel on a player console providing information about an associated poker game in accordance with one or more embodiments of the present invention.
Figure 6B:
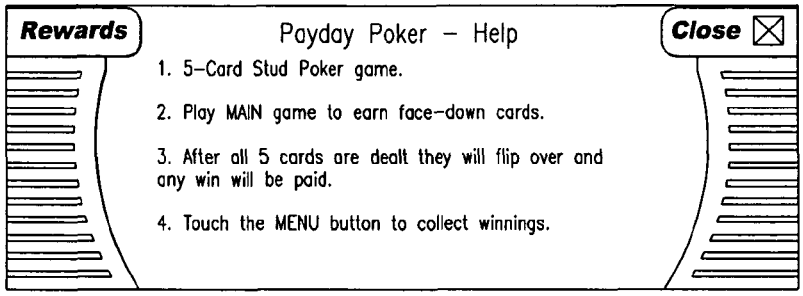
Figure 6C:
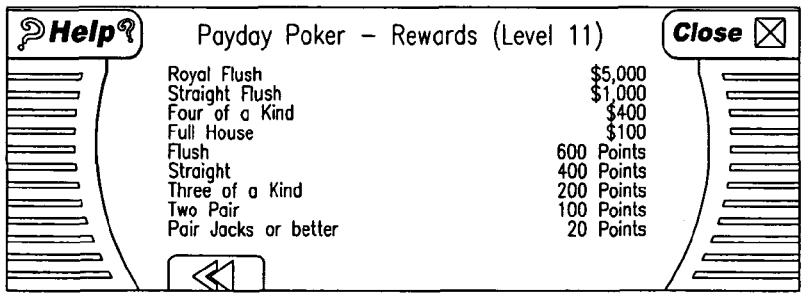

Referring to FIGS. 6A, 6B, and 6C, an example main panel 600, help panel 602, and rewards panel 604 are shown for the example bonus game Payday Poker. From the main panel 600, a player may access the help panel 602 by pressing the "Help" button on the main panel 600. As in the earlier described game, the help panel 602 may provides the name of the game, a description as to how the game is played and the game requirements, an instruction as to how to collect winnings. The help panel 602 may further include touch sensitive "Rewards" and "Close" buttons enabling a player to request the display of the potential rewards for each rewards level or return to the main panel 600. In the case of the Payday Poker Game, FIG. 6C, shows the potential rewards, via panel 604 for a player reaching level eleven to include: $5000 for a Royal Flush, $1000 for a Straight Flush, $400 for Four of a Kind, $100 for a Full House, 600 points for a Flush, 400 points for a Straight, 200 points for Three of a Kind, 100 points for Two Pair, and 20 points for Jacks or better. In the example, level eleven is the highest level and the arrow button points left to indicate that the only further selections are at the lower levels.

Figure 7A:
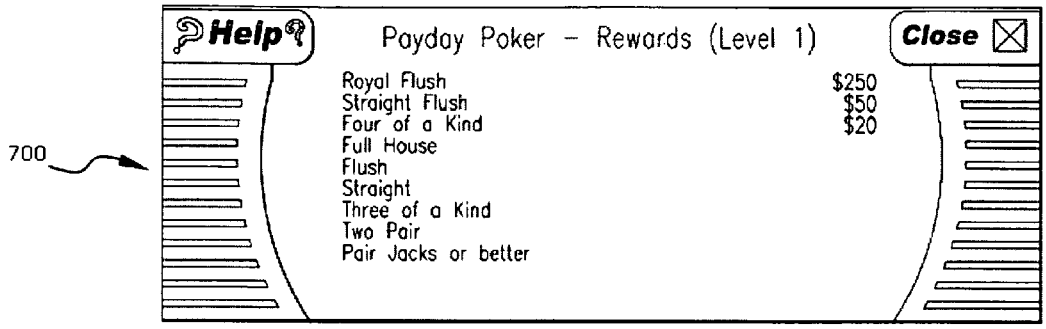
FIGS. 7A, 7B (collectively, FIG. 7) illustrate a contrast between level one rewards versus level five rewards as shown on a rewards panel on a player console in accordance with one or more embodiments of the present invention.
Figure 7B:
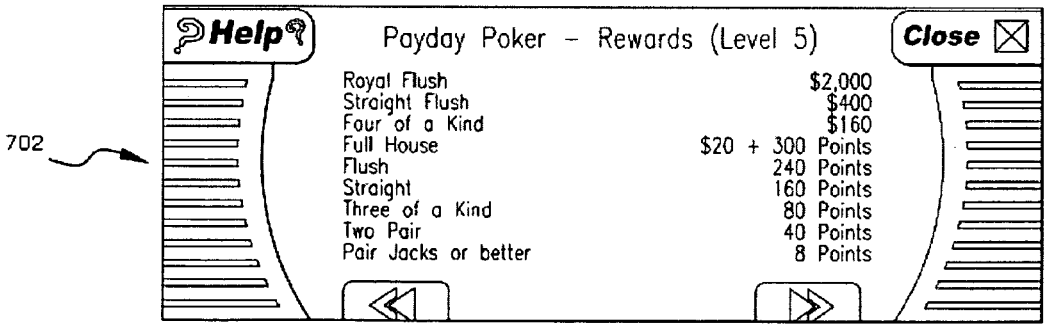

Referring to FIG. 7, an example partially shown rewards panel 700 associated with level one and a rewards panel 702 associated with level five illustrate the different potential rewards for the respective levels, such as the potential reward for a Royal Flush for a level one player is $250 while a level five player may receive $2000. As discussed above, various determinants may be utilized to elevate the rewards level, such as points, denomination wagered, and amounts wagered per line.

Figure 8A:
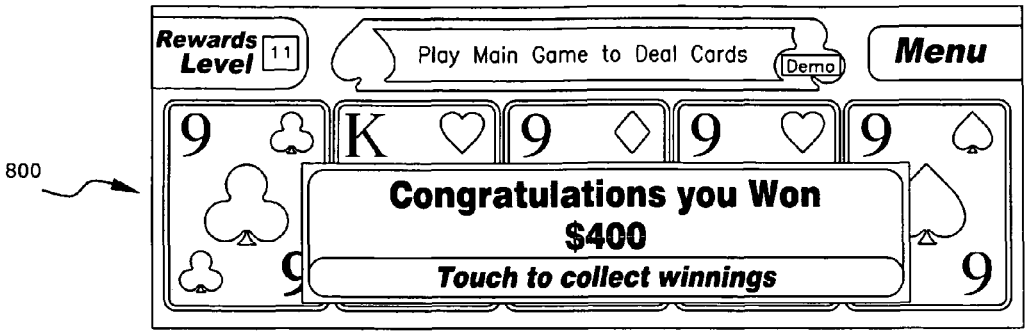
FIGS. 8A, 8B, 8C illustrate game ending panels on a player console with various outcomes in accordance with one or more embodiments of the present invention.
Figure 8B:
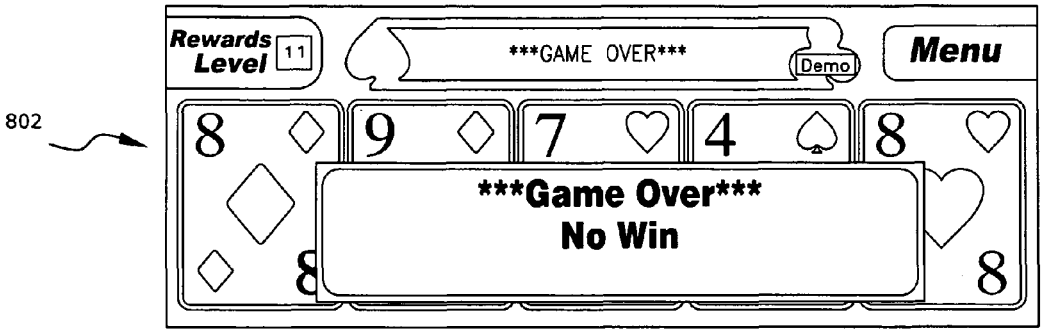
Figure 8C:
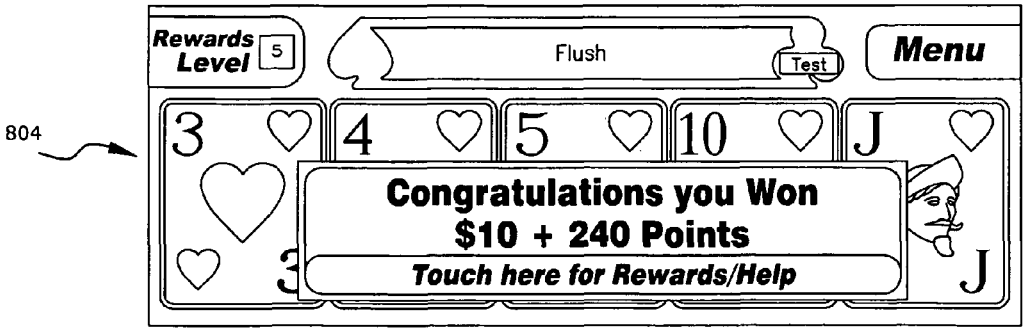

Referring to FIGS. 8A, 8B, and 8C, example game concluding panels 800, 802, 804 are shown with a banner section partially covering the uncovered hand of cards. An upper display section indicates the status of the hand and the banner section indicates whether the player has won an award. In the case of FIG. 8A, the player has Four of a Kind and is a level 11 player, so the win is $400 and the display indicates "Congratulations you win $400". In the case of FIG. 8B, the player has a losing hand and the display indicates "Game Over" and "No Win". In the case of FIG. 8C, the player has a Flush which is shown in the upper display window and the banner displays "Congratulations you Won $10+240 points". To return to the main screen, the players may simply press the "Menu" button. Alternatively, an additional button may appear such as a "Collect Winnings" touch sensitive panel as part of the banner, FIG. 8A or the banner may have a "Rewards/Help" touch sensitive panel, FIG. 8C.

Referring to FIGS. 9A-1 through 9B-2, a sequence flow of panels 900, 902, 904, 906 is shown by example for a player to collect cash winnings. In the example shown, Bally Live Rewards may be cashed out from the main game panel by pressing the touch sensitive "Collect" button. By example, cash winnings shown in the main display panel may be transferred to the base game through an electronic funds transfer. Alternatively, a player may leave cash winnings in a player account until another gaming session. As shown, when the player presses the "Collect" button, a panel is displayed for entering the player's personal identification number (PIN). If the PIN is correct, then a panel is displayed requesting the player to enter the amount to be collected. By default, the total amount in the player's account may appear on the display. The player may withdraw any portion thereof. Once the transaction is complete, the player may be returned to a main menu screen. In the event that the transaction fails after multiple attempts, the player may be provided a "Call Attendant" button or a "Continue Playing" button.

Figure 10A:
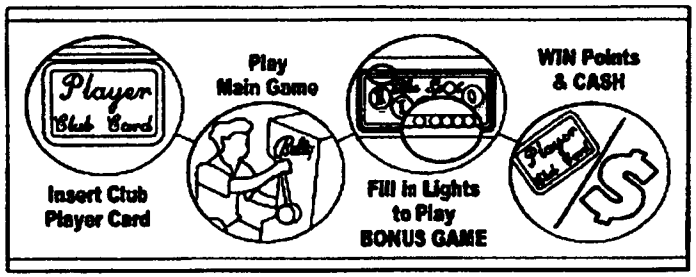
FIGS. 10A, 10B, 10C (collectively, FIG. 10) illustrate a sequence of advertising panels on a player console in accordance with one or more embodiments of the present invention.
Figure 10B:
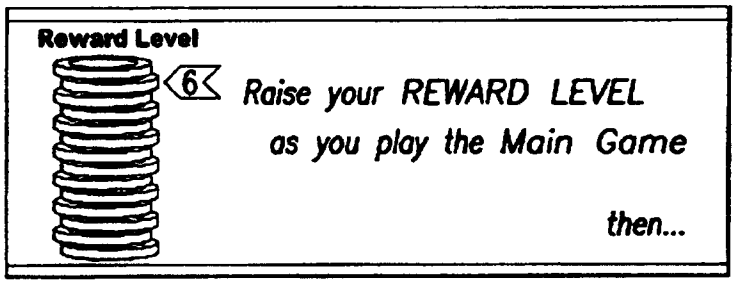
Figure 10C:
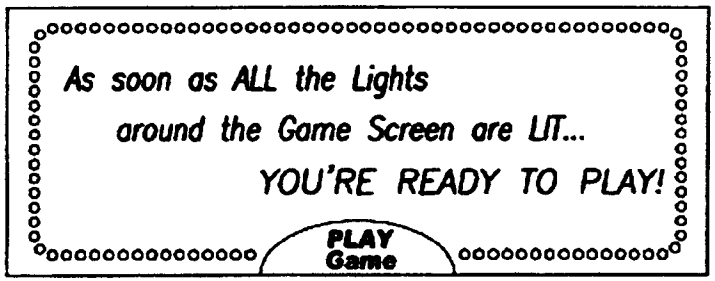

Referring to FIG. 10, a sequence of advertising panels 1000, 1002, 1004 is shown that may be displayed when player console 101 has been inactive for a period of time, such as when no game points are being accumulated by a player. Alternatively, the advertising panels 1000, 1002, 1004 may appear when an associated base game has been inactive for a pre-determined period of time, such as five minutes. In another alternative, an associated base game may be active, but a player may not have been identified, such as with a playing card, and the advertising panels 1000, 1002, 1004 may be shown. The advertising panels 1000, 1002, 1004 may provide information apprising a player how to participate in the bonus games, how to achieve reward levels, and how to initiate game play by achieving the thresholds of play through playing points.

Figure 11A:
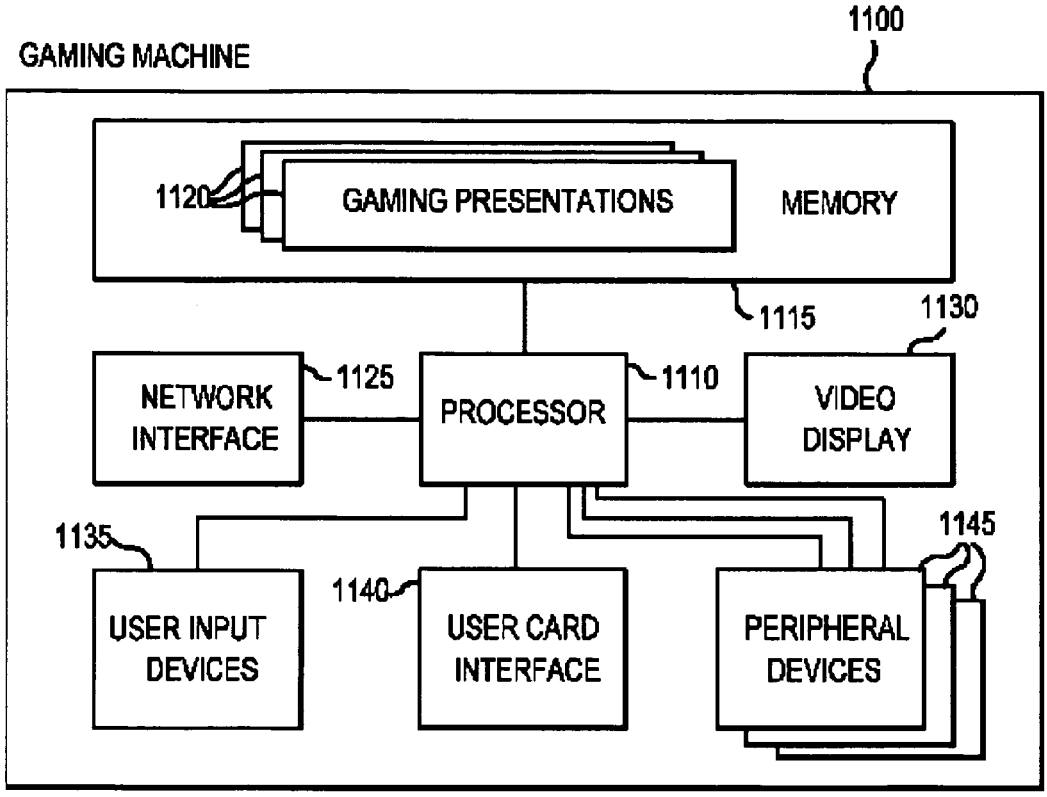
FIG. 11A illustrates an example high-level block diagram of a gaming machine in accordance with various embodiments.
Figure 11B:
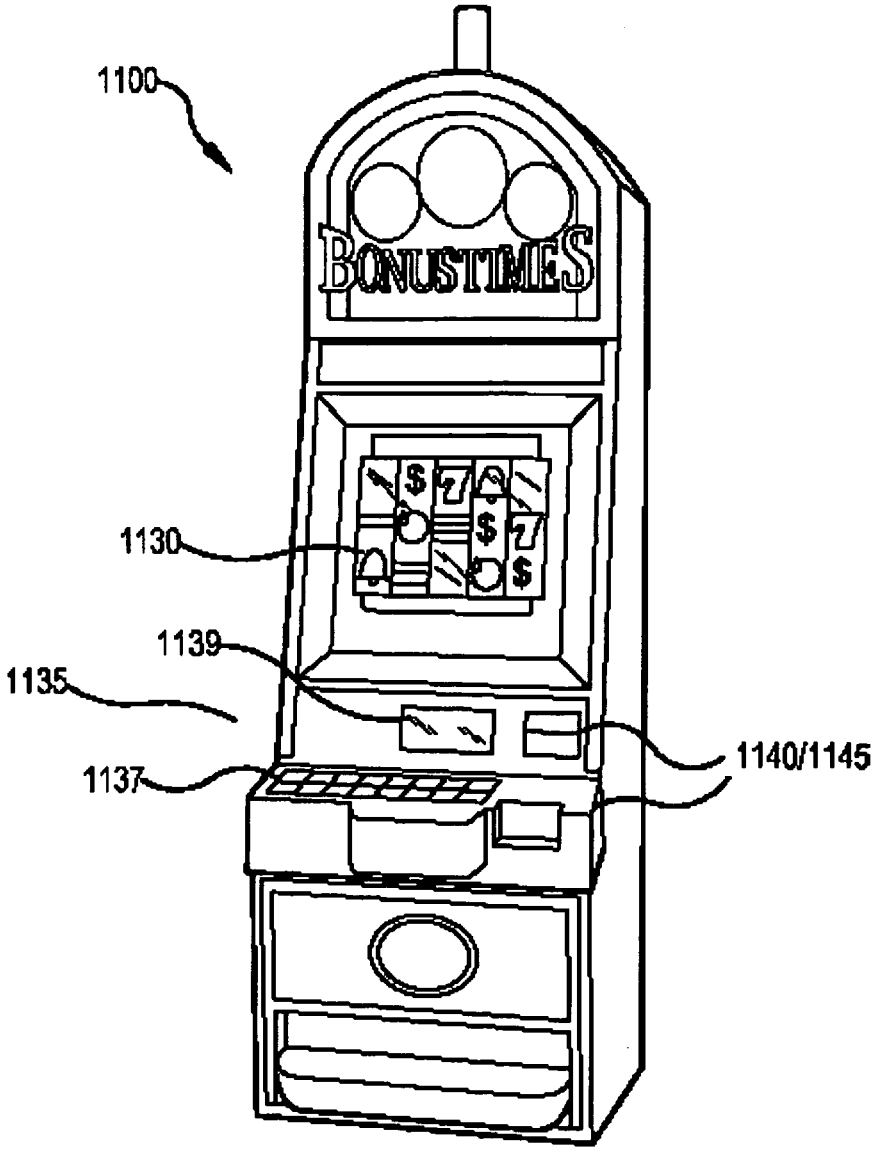
FIG. 11B illustrates an example gaming machine in accordance with various embodiments.

Referring to FIGS. 11A and 11B, a block diagram and front view of example gaming machine 1100 are shown, respectively. Gaming machine 1100 may include apparatus and/or software for implementing one or more player-centric rewards processes as discussed above and in accordance with one or more embodiments. Typically, gaming machine 1100 is implemented as an electronically functional device using conventional personal computer technology with few or no moving parts; however gaming machine 1100 may also be implemented as an electro-mechanical or mechanical device.

For example, gaming machine 1100 as shown in FIGS. 11A and 11B may include a game printed circuit board including game processor 1110, memory 1115 which may store the game machine operating system and game presentation software 1120, network interface 1125 for connecting to an operator's network, video display 1130 which may display a game driven by processor 1110 and may have fields for example displaying player credits, wager, win amount, etc., user input devices 1135 which may provide buttons or video fields for a user to communicate with gaming machine 1100 through processor 1110, user card interface 1140 which may provide a device for transmitting player card information to processor 1110, and peripheral devices 1145 such as a bill acceptor or ticket dispenser, etc.

In the example of a video gaming machine, game processor 1110 communicatively connects to video display 1130 which displays images of reels that function equivalently as mechanical or electro-mechanical reels, user interface unit including user input devices 1135 which provides information to a patron and permits patron communications with the game processor and/or a network connected through network interface 1125, user card interface 1140 which provides a device for receiving and reading player card information, and peripheral devices 1145, such as a bill reader for receiving and reading various bill denominations, coupons, and/or credit vouchers, and, a voucher printer which may be combined with the bill reader and may print credit vouchers when a patron wishes to cash out and/or print rewards vouchers when a patron accepts an award.

Video display 1130 may be any of a variety of conventional displays, such as a high resolution LCD flat panel, and may have touch screen display functionality so that a patron can make software-enabled selections which may be associated with the game. Apart from its conventional functionality in presenting a game for a patron, gaming machine 1100 may include award software which may be stored in memory 1115 and hardware which may be part of or connected to the game board to implement one or more player-centric rewards processes as disclosed above by example. Video display 1130 may include a separate user display such as an LCD touch screen display with interactive capability for communication between a user, gaming machine 1100, or a network connectable through network interface 1125.

Memory 1120 may include both memory internal and external to processor 1110. External memory may include a hard drive, flash memory, random access memory (RAM), read only memory (ROM), and any other conventional memory associable with a printed circuit board.

In the event that gaming machine 1100 is connected to a network, then the rewards software and hardware may be implemented wholly or partly externally and may be communicatively connected to the user interface unit for notifying patrons of rewards and receiving patron communications, such as award acceptances. For instance, gaming machine 1100 may have a game management unit (GMU) which connects to a slot management (SMS) and/or casino management (CMS) network system. The GMU may in turn connect to the game board and the user interface unit. The player-centric rewards may be driven through the GMU, either directly or indirectly through the SMS and/or CMS which is discussed more fully below.

Referring to FIGS. 11A and 11B, typically, gaming machine 1100, such as Bally's S9000 Video Slot machine, comprises microprocessor 1110, such as an Intel Pentium-class microprocessor, and non-volatile memory 1115 operable to store a gaming operating system, such as Bally's Alpha OS, and one or more gaming presentations 1120, such as Bally's Blazing 7's or Bonus Times for example, operable and connected on a printed circuit motherboard with conventional ports and connections for interfacing with various devices and controlling the operation of gaming machine 1100. Memory 1115 may store one or more software modules operable with the OS to implement one or more reward processes, such as are described above in relation to FIG. 1-10.

Gaming machine 1100 may include network interface 1125 operable to download one or more gaming presentations 1120 from the one or more gaming servers (not shown) and to otherwise communicate with networked devices and servers for various purposes; however, one or more player-centric award processes as described above by example may be implemented with or without network support depending on implementations as is described further below. Gaming machine 1100 may further comprise a video display 1130, through which gaming presentations are presented to the user; however, electro-mechanically driven reels may be implemented in place of or together with video display 1130. Gaming machine 1100 may further comprise user interface devices 1135, such as a keyboard (not shown) which may be used to enter a pin number or for the selection of various options, various player selectable buttons 1137 including bet one, bet all and the like, as well as a touch screen which may be incorporated with video display 1130 or display 1139, such as an iView TFT display. Gaming machine 1100 also includes user card interface 1140, which is operable to accept a user card that identifies a user as a casino patron to the gaming environment. Gaming machine 1100 may further include one or more peripheral devices 1145, such as a bill/ticket acceptor, ticket printer, and various other devices. As shown in FIG. 11B, user card interface 1140 and peripheral devices 1145, such as a bill acceptor may be implemented adjacent to each other or may be part of the same housing structure while connecting differently to perform their respective functions. In the event a network connection exists, then the user interface unit may provide a communication link for a patron with an SMS and/or CMS network.

In one or more embodiments, gaming machine 1100 includes microprocessor 1110, which may implement the programming logic of the gaming presentations and control the operation of various hardware and software components of the gaming machine, as well as, one or more peripheral devices 1145. For example, microprocessor 1110 may be operable to activate various components of the gaming machine 1100 and, in the event of a network connection, to download one or more gaming presentations 1120 from the gaming server. In response to a user input to initiate play and the placement of a wager, the microprocessor 1110 may be configured to retrieve the requested gaming presentation 1120 from memory 1115 and to commence the play of the game. The microprocessor 1110 may be configured to randomly select a game outcome from a plurality of possible outcomes and to cause the video display 1130 to depict indicia representative of the selected game outcome. In the case of slots, for example, mechanical or simulated slot reels may be rotated and stopped to display symbols on the reels in visual association with one or more pay lines. If the selected outcome is one of the winning outcomes defined by a pay table, the microprocessor 1110 may be configured to award the player with a number of credits associated with the winning outcome. Conventionally, in such gaming machines, a player may wager multiple credits on one or more lines depending upon the programming or physical limitations of the gaming machine.

In one or more embodiments, gaming machine 1100 includes user input devices 1135, which may include various gaming controls, such as standard or game-specific push-buttons, a "bet" button for wagering, a "play" button for commencing play, a "collect" button for cashing out, a "help" button for viewing a help screen, a "pay table" button for viewing the pay table(s), a "call attendant" button for calling an attendant, and a "rewards button" for viewing player reward information and accepting various rewards, such as opportunities to play bonus games and obtain additional player awards. User input devices 135 may also include various game-specific buttons known to those skilled in the art. User input devices 1135 may also include a keyboard, a pointing device, such as a mouse or a trackball, or any other input devices. In one or more embodiments, user input devices 1135 may also comprise an embedded additional user interface (not depicted), such as an iView™ interface, as described in commonly owned U.S. patent application Ser. No. 10/943,771, entitled USER INTERFACE SYSTEM AND METHOD FOR A GAMING MACHINE, which is hereby incorporated in its entirety by reference herein. The content provided through the embedded additional user interface may include, for example, advertisements, promotion notifications, useful gaming information, user rewards information and any other content that may be of interest to the casino patron.

In one or more embodiments, the gaming machine 1100 also includes user card interface 1140, which is operative to accept user cards containing the patron's identification information, such as the patron's ID number. User interface 1140 may be configured to accept magnetic cards, smart (chip) cards, electronic keys and the like. It will be appreciated, however, that such user information may be stored in other forms or on other media for subsequent retrieval. For example, the user information can be stored on an RFID device, electronic key, or other portable memory device. Likewise, using biometrics or other techniques, user information may be retrieved from the game machine or from a remote storage device via a network. In an example embodiment, the system may recognize three different levels of user cards. For example, level one cards may identify frequent casino patrons, i.e., those who have a well-established history of playing at the given casino and/or whose wagering at the casino exceeds a specified threshold amount. Therefore, level one patrons will be entitled to the greatest degree of service, various promotions and rewards from the casino since they have met or exceeded a game threshold. The level two cards may identify patrons who frequent the casino, but whose spending at the casino is not as extensive as those of the level one card holders. Lastly, the level three cards may identify new casino patrons, i.e., those who do not yet have a consistent history of playing at the given casino. The degree of service, promotions and rewards offered to the level two and level three card holders likely will differ from that offered to the level one card holders, as will be described in a greater detail hereinbelow. The gaming system may be configured to recognize fewer or greater numbers of card levels, and that promotions and/or credits associated with each card level may differ.

In one or more embodiments, gaming machine 1100 includes one or more peripheral devices 1145. For example, peripheral devices 1145 may include a player identification device, such as a magnetic card reader that accepts a player-identification card issued by the casino. Peripheral devices 1145 may also include a credit receiving device, such as a coin acceptor, a bill acceptor, a ticket reader, and a card reader, which may be used for placing wagers. The bill acceptor and the ticket reader may be combined into a single unit. The card reader may, for example, accept magnetic cards, such as credit cards, debit cards, and smart (chip) cards coded, i.e., cards loaded with credits or that designate an account for use via the gaming machine 1100.

According to the methodology of various example embodiments, a patron may insert a player card to provide identification information to gaming machine 1100. A player-centric rewards process, such as disclosed above, may be implemented through a player-centric rewards program stored on permanent storage accessible by the game processor or other local processor, such as a processor connected to a Bally iView or similar unit, and activated by a signal from the card reader. The player-centric rewards program may be a program or programs that may implement the process described by FIG. 1-10 through execution by processor 1110 on the motherboard or by a processor on the user interface board of gaming machine 1100.

The information from the card reader may be processed through a subroutine to determine player eligibility for player-centric rewards. If the player is determined to be eligible, then the program may provide a display of a main bonus game panel on player console 101 which may be integrated as part of the display 1139. The program may accumulate player points based on play of the base game, such as may be displayed on display 1130, or receive the player point information from another processor, such as game processor 1110, a GTM processor, or an external processor such as a server processor. As the player reaches pre-determined thresholds, the bonus game may be selected by the player and the game process may proceed as described above with regards to FIG. 1-10. In accordance with the program processing, the patron player level may be determined based on the current and/or previous gaming sessions, a set of potential prizes or prize levels may be determined for which the patron's player level is eligible, and the potential awards for the bonus game may be determined based on the achieved player level. In an alternative embodiment, the patron's player level may be identified at the beginning of play and the potential bonus game awards may be determined for which the patron's player level is eligible, gaming machine 1100 may display a message viewable by patron showing the reward level for which the patron is eligible. Gaming machine 1100 may also provide encouragement to the patron to win an award and achieving higher award levels by displaying entertaining video images and/or providing audible messages, such as cheerleaders making a 'GO' cheer and/or displaying a fireworks display when pre-programmed threshold levels of play are met by a player.

Upon determining a reward level that is to be offered to the patron, then an instruction from the player-centric award program may direct the processor to transmit a notification to the patron, such as by displaying an informational message on display 1130 or 1139 advising the patron that he has qualified for an award level and providing the patron with one or more options for responding to the notification, such as that the player may have accumulated sufficient points to play a bonus game or encouraging the player to play additionally in order to achieve the needed player point level or to increase the player's reward level. Thereafter, the player may view display 1139 and make selections as to a bonus game as previously described with respect to FIG. 1-10. When the patron completes play, as by removing the player card from the card reader, then the player points may be stored so that the player may add to the player points during a future session.

In one or more example alternative embodiments, a player's player points, wager amounts per line, and denomination wagered may be stored in temporary storage, such as by example one or more registers of a game microprocessor, a player interface microprocessor, digital signal processor, or controller associated with a player interface such as a Bally iView, or a processor associated with a Bally GMU or GTM which may be communicatively connected to the game motherboard and the player interface. Alternatively, the temporary storage may comprise an onboard (motherboard or daughter board) conventional memory, such as random access memory (RAM), or, an off-board connected conventional memory, such as a conventional hard-drive, or, a connected printed circuit board with a conventional processor, controller, and/or memory. The temporary storage values may be utilized to determine thresholds achieved and/or rewards level of an eligible patron during a gaming session. The respective processor controlling the temporary storage location may accumulate player points based on the number of credits wagered in accordance with a player reward program, such as one which may include an instruction set to implement a type of player-centric award process as described above with respect to FIG. 1-10. After each play, the player points and other player-centric data may be used to evaluate whether a threshold has been met or whether a reward level has changed in accordance with the programmed player-centric award procedure executed by game processor. When the player points either equal or exceed the required threshold to play a selected bonus game, then the patron may then play the bonus game and vie for one or more of the potential player awards. The programmed player-centric award procedure may then initiate a subroutine to play the game and determine an award to be offered to the player. The player point will be deducted from the player's account and the player may again begin accumulating player points for the next bonus game opportunity. Once the processor determines the award to be offered, then the procedure instruction set may include an instruction for the game processor to send an award notification to the patron through, by example, display 1130 or display 1139, or by printing a voucher redeemable at one of the operator facilities providing patron services. In the event of a display notification, the patron may by example be provided the option of having a redeemable voucher printed or, in the case of a cash award, of having credits uploaded onto the credit meter for further play on gaming machine 1100. Alternatively, the game processor may cause an electronic award record to be created and transmitted to a data location associable with and accessible on behalf of the patron. Such a data location may be a permanent storage connected to the gaming machine or may be a memory stick or magnetic strip connected to the patron's player card. In the case of records being stored on a patron's player card, a patron may access the award by utilizing a machine readable device for dispensing rewards or by presenting the patron's player card to an operator's representative, such as at a cashier's cage.

In one or more alternative embodiments, a player's accumulated player points may be obtained from information stored or machine readably inscribed on or about patron's player card through the use of user card interface 1140 which may have a receptacle to receive player cards or may have a scanner enabling a proximity scan of the information on the patron's player card. The patron's player card may contain the information such as through the use of a memory strip. In such cases, user card interface may have a read-write capability to enable writing the ending state for the player points and/or reward levels at the time the patron concludes play on a given gaming session. Thus, a patron may play different gaming machines and play at different times while retaining the state of the patron's player points and rewards level and being able to continue to accumulate player points during each gaming session without losing the totals and levels reached from the prior session.

Alternatively, when the patron completes play at a given gaming machine, as by removing the player card from the gaming machine card reader, then the player points and/or rewards level may be reset to their zero or initial value. In other words, there is no retained state that is saved at the end of a gaming session for the purpose of bonus game eligibility. Also, the player points will be re-initialized after each instance where the patron reaches the threshold to play a bonus game and the player determines to play the bonus.

Figure 12A:
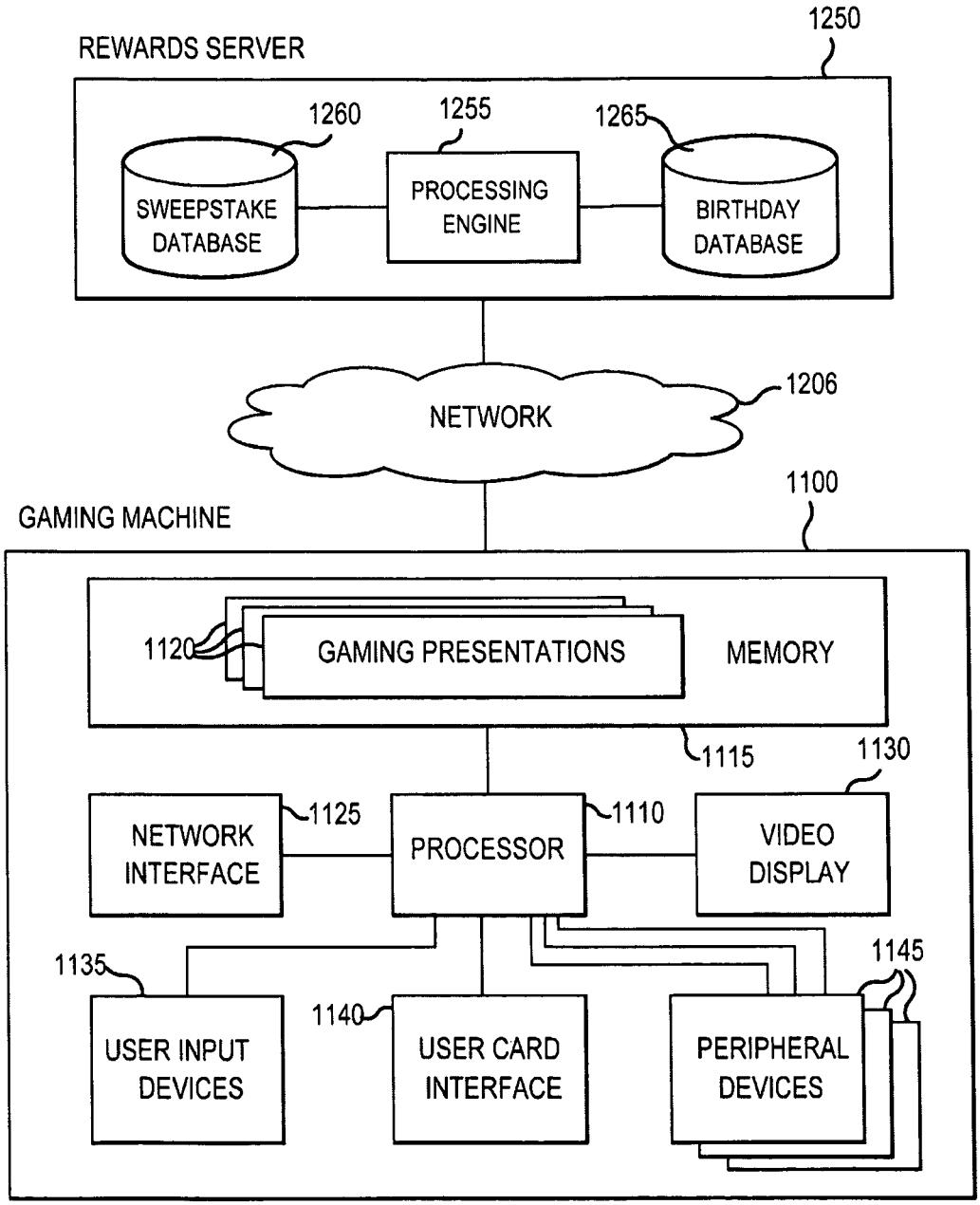
FIGS. 12A and 12B illustrate a simple block diagram of a rewards server connecting over a network to a representative example gaming machine in accordance with various embodiments.

Referring to FIG. 12A, a simple block diagram of rewards server 1250 connecting over network 1206 to representative example gaming machine 1100 is shown. Processing engine 1255 may comprise a conventional personal computer, such as an Intel or AMD microprocessor-based computer, or, any other conventionally available computers capable of performing general purpose computing and gaming specific applications, such as Dell, Sun Microsystems or IBM computers. Databases, such as databases 1260, 1265, may comprise one or more conventional hard drives or other storage media for storing patron records which may be written, updated, and accessed through processing engine 1255, and, for storing programs executable by processing engine 1255. The stored programs may include one or more procedures, subroutines, or sets of coding for performing or enabling player-centric rewards processing such as are outlined in the description of FIG. 1-10. For connecting the various devices, such as servers at the back-end and gaming machines 1100 at the front end, network fabric 1206 may include, but is not limited to, an IP-based local area network backbone, such as Ethernet. As may be appreciated, other functionally comparable network backbones may be utilized.

For instance, in an example system such as is shown in FIG. 12A, gaming machine 1100 may utilize network interface 1125 to connect with rewards server 1250 through network 1206. A player card connectable through user card interface 1140 to gaming machine 1100 may contain sufficient information which when read such as by user card interface 1140 may be used to identify a player at gaming machine 1100 either directly from the information stored on the card and/or by transmitting player card identification information to query a network-connected server and database containing player records such as rewards server 1250 or a separate player tracking server (not shown) and accessing a patron's player records remotely. Once the patron's records have been accessed, a query may be sent to rewards server 1250 either from gaming machine 1100, a player tracking server, a host computer connected to various servers connected to the network, or other conventional network communicating device inquiring whether the patron is eligible to receive a player-centric reward, such as a bonus game. Responsive to the query, rewards server 1250 may transmit a patron reward message to gaming machine 1100 which may cause a message and/or video to be displayed for viewing by the patron on either an iView-type display, a main display, or other information medium, for example a speaker, apprising the patron of an available reward, possibility of a reward based on continued play, and/or providing an entertaining audio and/or video transmission.

In one example embodiment, the patron's player records including current player points and reward level may be downloaded to gaming machine 1100 from rewards server 1250, a player tracking server (not shown), or some other networked computer and/or database. As the patron proceeds to play, the player points and/or rewards level may be incremented or decremented as discussed more fully above until the player points matches or exceeds the threshold required to play the selected bonus game, at which point, the patron may become eligible for a player-centric award as discussed more fully above. As also discussed above, the patron's information may be utilized to compare against possible player-centric rewards, such as a bonus game, to determine the patron's eligibility. In another embodiment, the player points and/or rewards level may be maintained and updated on a server, such that as a patron plays, information is sent to the server concerning each play and the player points and rewards level are incremented or decremented in accordance with a procedure such as is shown and discussed more fully above with reference to FIG. 1-10.

In the case of a network-connected player database and/or server accessible by one or more gaming machines 1100 as through network interface 1125 over network 1206, an operator may identify and rate players, either through direct data input or conventional software designed to perform the identification and rating functions on a host computer or player tracking server based upon play over a period of time. Based upon the player rating, a procedure may be implemented as with a computer module executed by rewards server processing engine 1255 that associates ratings of players with operator determined tiered player levels and according to the tiered player levels establishes eligibility for player-centric rewards as discussed above. The eligibility information may by example be stored according to player tier levels or on an individual player basis, in a player tracking database which may be updated either in real-time or on a periodic basis through the player tracking server. When a player inserts a player card or otherwise identifies themself, a gaming machine may access and utilize the information stored on the networked system to determine the eligibility of a player for player-centric rewards. In the case where the player-centric rewards bonus program resides on the gaming machine, then it may begin execution upon determining that the player at the gaming machine is eligible and requests to play the game.

Alternatively, the player-centric rewards bonus program may reside on a server, such as rewards server 1250, remote from gaming machine 1100. In which case, gaming machine 1100 may simply provide the incrementing and comparison functions, and transmit a message to the server when the threshold is met for an award to be offered to a patron. For instance, when a player is identified at a gaming machine as eligible for player-centric rewards, then the player-centric rewards bonus program may begin executing such as through processing engine 1255. The instruction set may include sending a message to gaming machine 300 to set and increment a player point counter in accordance with play by the eligible player and to send a message to the server, for example, when the player points reach or exceed one or more thresholds associated with the bonus game.

In another alternative, the gaming machine may provide game play information on a real-time basis to the server which may perform the incrementing and comparison functions, as well as the rewards processing. Upon the server executing a bonus game and determining an award to be offered, the server may create and store a record which may be associated with the patron's player information and may also send a message to gaming machine 1100 to notify a patron of the award offer. In the case of an award, a patron may be required to make a collect request as by pressing a 'collect' button or key and/or by entering a personal identification number (PIN). Alternatively, in each case discussed above, an award may simply be automatically credited to gaming machine 1100 without any further action required by the patron. Conditions may or may not be included with an award or award offer, such as that the patron utilize or redeem the award within a period of time which may be determined by an operator.

Continuing to refer to FIG. 12A, in one or more embodiments, user input devices 1235 may include a processor, memory, and associated components as may be implemented on a printed circuit board and the player points and reward level of a player may be received by this circuitry and related software for decrementing or incrementing as the case may be upon each play by the patron. In these example implementations, the wager information may be passed from microprocessor 1110 or another processor with access to wagering information, in accordance with an instruction from the processor in order that the player points and/or rewards level be correctly adjusted.

In one or more example embodiments, a game monitoring processor unit, such as a Bally game monitoring unit (GMU), may be implemented separate from microprocessor 1110 and the processor that may be included with user input devices 1135, such as Bally's iView, but may be connected to both for receipt of gaming information and player information, respectively. In these example implementations, the player points and/or rewards level may be maintained with the game monitoring processor unit and the wager information will be passed to it from or in accordance with an instruction from microprocessor 1110.

In each of the examples described above, the player points and/or rewards level may be incremented or decremented by a gaming and/or one or more related processors incorporating programming to effect steps, such as in accordance with the processes described by example with respect to FIG. 1-10. When the pre-determined number of plays is reached by the patron then a signal may be sent to display 1139 (FIG. 11B) (incorporated with user input devices 1135) and a celebratory show may be presented to the patron from a memory (which may be part of user input devices 1135 or otherwise stored on gaming machine 1100) to apprise the patron that the patron is eligible for an award. In the case, where gaming machine 1100 is not network connected, then the bonus game program may be initiated to determine whether the player wins and what award the patron may receive, such as player points and/or cash awards.

Continuing to refer to FIG. 12A, rewards server 1250 includes processing engine 1255 which may communicatively connect to sweepstake database 1260 and birthday database 1265. As shown, gaming machine 1100 may include network interface 1125, such as one or more conventional network PCMCIA cards or a Bally ACSC NT-board, GMU, or GTM, to facilitate IP-based or address-based communication of some form with other networked devices, such as the rewards server 1250 and the like. Through the network, microprocessor 1110 may communicate with rewards server 1250 to facilitate execution of various rewards transactions. In one or more embodiments, the network interface 1125 may be used to download one or more gaming presentations or other software and/or data from the gaming server. To facilitate placement of wagers using a credit or debit card through a credit card reader (not shown) that may be connected to gaming machine 1100 as by example through user input devices 1135, user card interface 1140, and/or peripheral devices 1145, network interface 1125 may be used to communicate with a banking server (not depicted), which connects to a financial institution that has issued the financial card, conduct a credit card authentication process, and then credit the requested amount to gaming machine 1100. The accounting server issues credit confirmation to gaming machine 1100, which in turn allows the casino patron to place the desired wager on the machine and to proceed with the game. In a progressive gaming network environment, where several gaming machines 1100 compete for a single jackpot prize, the network interface 1125 may be used to communicate with other gaming machines 1100, as well as with a game monitoring server (not depicted) to synchronize a jackpot value and other parameters.

Figure 12B:
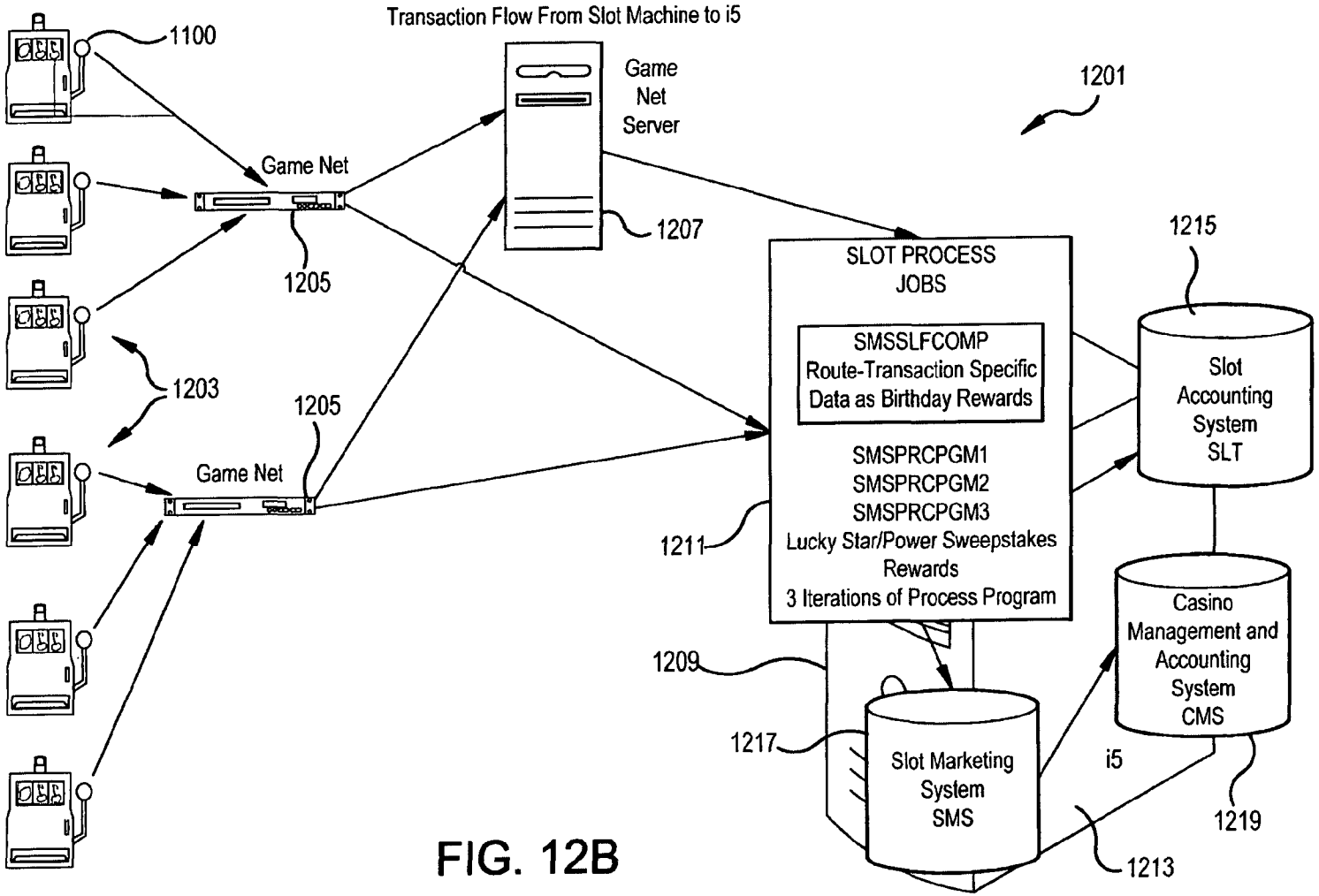

Referring to FIG. 12B, networked gaming system 1201 is shown in accordance with one or more aspects of the invention wherein banks 1203 of gaming machines 1100 are connected to router 1205, router 1205 connects to router server 1207 and multiple backend subsystems 1209 including player-centric rewards programming enabling the executing of slot process jobs 1211. By example, networked gaming system 1201 may be conventionally architected such as with conventional Bally gaming machines and a conventionally available ACSC SMS and CMS products implemented with the IBM iSeries products with modifications to selected portions of the player tracking software to incorporate the player-centric rewards such as those described above with respect to FIG. 1-10.

Routers 1205, such as a conventionally available Bally ACSC Game Net device, may be programmed to consolidate gaming data and other communications from respective bank 1203 of gaming machines 1100 into packets and to transmit the packets according to the routers programming to game net server 1207 and/or pre-determined portions of multiple backend systems 1209. Routers 1205 may receive a notification of each transaction at their respective banks 1203, modify the information prior to transmission to router server 1207, such as a conventionally available Bally ACSC Game Net server, and selected portions of multiple backend subsystems 1209 according to router 1205 programming. For example, when a patron inserts the patron's card in a card reader of gaming machine 1100, the information is read from the player card and transmitted to router 1205 which in turn sends the player information to selected portions of multiple backend subsystems 1209 and a query may be made whether the patron is eligible for a player-centric reward, such as a bonus game. Additionally, upon a patron playing sufficiently to match the bonus game's requisite player points, router 1205 connected to the respective player's gaming machine 1100 may be programmed to transmit a message to a rewards server, such as shown in FIG. 12A, which may be implemented as part of multiple backend subsystems 1209.

Multiple backend systems 1209, such as may be conventionally architected using Bally's ACSC SMS and CMS iSeries-based products, may be programmed to process player-centric slot process jobs 1211. The iSeries-based products implemented in the Bally architecture may include i5 server 1213, which are originally manufactured by IBM and programmed by Bally to perform networked gaming systems functions. Amongst the programming that may be implemented may be player-centric rewards programming to perform the steps described in the figures and description herein.

To accomplish various networked gaming systems functions including player-centric rewards processing, multiple backend systems 1209 may include slot accounting system (SLT) 1215, slot marketing system (SMS) 1217, and casino management and accounting system (CMS) 41219. Each of the respective systems may be under the centralized control of a host computer the function of which may be performed by i5 server 1213. Additionally the respective functions of systems 1215, 1217, 1219 may be implemented through programming of separate servers or a single server such i5 server 1213. A workstation (not shown) may connect to i5 server 1213 and may include a conventional display, keyboard, and mouse enabling an operator (user) to run respective programs associated with systems 1215, 1217, 1219 and modify the operation of the respective systems through the selection of various options such as player-centric rewards criteria. For example, upon a patron inserting a player card into a gaming machine 1100 connected to networked gaming system 1201, a message may be sent to i5 server 1213 that contains patron information and initiates one or more slot process jobs 1211 according to the programming of i5 server 1213 to determine whether the patron is eligible to play a bonus game.

Programming of i5 series 1213 may be triggered upon receipt of the patron information that includes sending selected patron information and a query to slot marketing system 1217. In parallel, series 1213 may send patron and gaming machine 1100 identifying information and a transaction report to slot accounting system 1215. On determination of a patron's eligibility for a birthday reward, SMS 1217 may send a message to CMS 1219 to make a record of the transaction and a message may also be sent from multiple backend systems 1209 to gaming machine 1100 notifying the patron of the birthday reward. Similarly, slot process jobs 1211 may be initiated on i5 series 1213 upon a patron meeting the playing criteria for eligibility for one or more player-centric rewards, such as Bally Live Rewards.

One or more aspects are described in the following example discussion as may relate to the system and rewards shown in the figures:

What is Live Rewards?

Live Rewards lets you offer carded players exciting bonus games through your existing iVIEW-equipped slot machines. This remarkable advancement in technology creates a thrilling gaming experience designed specifically to increase wagering activity. Once a Player's Club card is inserted into the slot machine, each bet on the base game brings the player closer to earning bonus game play. Once the minimum game play requirements have been met, the bonus game either starts automatically or the player can press a button to start the game. Bonus game winnings can be awarded in cash (to be transferred to the base game through an electronic funds transfer) or in bonus points. Live Rewards bonus games require base game play; they cannot be played directly. Live Rewards uses high-resolution, animated graphics, quality sound, and a touch-screen display to provide players with bonus game content. This content is managed by the Live Rewards Server (LRS) through the Windows-based Live Rewards management application. There are currently two bonus games available through Live Rewards: Blue Spot Bingo and Payday Poker.

About the Player Interface

The Live Rewards user interface runs on the iVIEW display, allowing customers to play bonus games and transfer their cash winnings to the base game. Players can choose from two Live Rewards bonus games: Blue Spot Bingo and Payday Poker.

Play Point and Game Play Indicators

Live Rewards has two distinct counters that determine the player's bonus game experience: play points and game start threshold.

Play points are used to determine the pay table used for the bonus game—the more play points a player accrues, the higher the payout amount (equal to one cent for determining prizes on bonus game pay tables) of the corresponding pay table. A play point is defined as one cent of every dollar bet at the base game. This is a pre-set, non-configurable value that has no actual monetary value and cannot be redeemed. The rate at which a player accrues play points is determined by players club membership level and is configured through the Live Rewards Server. Players track play point accrual through the Reward Level indicator on the left-hand side of the screen. As play points are accrued and the reward level increments, the player sees poker chips stack up. When game play begins, the number of play points used for the game is determined by the number of play points accrued minus the number of play points in the highest qualifying Pay table. The game start threshold determines when a player has played enough base games to start a bonus game. For each base game played, the player earns a TC (Threshold Counter), which is depicted on the user interface as a light surrounding the selected game logo. A player earns a TC based on the number of games played the time spent playing, and the maximum bet for each game.

What Are Play Points?

Play Points are the unit currency used by the player to play a Live Rewards game. Play points are earned based on Base Game Wager times and the accrual rate set for each Player's Club level. Play Points have no redeemable value, but are considered to be worth $0.01 for the purpose of deriving the Live Rewards game Pay tables. You cannot adjust this value. Play points are restricted to the play of Live Rewards games and are not cashable. Play Points earned on the iVIEW are transferred to the player's session account on the LRS before any Live Rewards game begins and at player card removal. Play Points are decremented from the player's server account when a Live Rewards game is played.

The amount of Play Points decremented is determined by the amount of Play Point accumulated when the player has played a number of games equal to the Live Rewards Game Start Threshold. The number of Play Points determine, which Pay Table the player receives with the Pay Table that takes the maximum number of earned Play Points being automatically selected. Play Points are awarded only by play of base game and are not awarded by any other means.

The number of Play Points awarded is equal to the product of the following equation:

$$=[\text{Base Game Wager (in dollars)}\times\text{Accrual Rate (set by BLRS)}]/[\text{Value of Play Points (in dollars)}]$$

Client Side processing of Play Points (PP) and Threshold counters (TC's):

1—On card-in the client may register the player's card number to the iVIEW and receive the values of the reserve account for display purposes.

2—As the player plays the base game PP and TC's may accrue on the client.

3—At Card-out, Recovery start-up, and before a Begin Game is sent to the LIVE REWARDS SERVER all PP and TC accrued on the iVIEW are transferred to the LIVE REWARDS SERVER.

4—When the iVIEW has determined the player has accrued enough TC and PP for a game (combined total of reserve account and remaining PP's and TC's on iVIEW) the iVIEW allows the player the option to start a game. If the player elects to start a game:

a—All PP's and TC's are transferred via 3-stage commit to LIVE REWARDS SERVER.

b—Current totals in reserve account are returned to iVIEW.

c—If total is still acceptable to starting a game iVIEW sends a Begin Game message to LIVE REWARDS SERVER that includes the number of PP's and TC's to be used.

d—Based on server setting send a −1 for TC's to be used may use them all.

e—LIVE REWARDS SERVER sends a response back to the iVIEW that includes a History ID number (HID) and a success or Fail.

f—If Success is returned iVIEW proceeds to play the system game.

g—At game conclusion a End Game messages sent to LIVE REWARDS SERVER Via 2 stage commit (stage 1 of the 3 stages was Begin Game). The end game contains the value of any winnings the player won.

h—Winnings in the End Game are stored in the player's reserve account.

5—Bonus Points (BP's) are immediately transferred to CMS from LIVE REWARDS SERVER.

6—Cash winnings in the reserve account are shown to the player and accessible after Pin-in for AFT transfer from LIVE REWARDS SERVER to the base game.

7—On recovery any PP's, TC's, BP's and cash are transferred to LIVE REWARDS SERVER.

8—On recovery, If a Begin Game was sent and an End game was not completed the End game is sent with a recovery status and the LIVE REWARDS SERVER rolls back the PP's and TC's used for the incomplete game are rolled back into the player's account and any reserve account for this card#/iVIEW ID is also rolled back into the player's account.

9—If the player is playing slowly and a Begin Game, End Game, or card out has not occurred in (Heartbeat time length—1 minute) the iVIEW sends a heartbeat to the LIVE REWARDS SERVER to keep the player's reserve account reserved.

Referring generally to FIG. 13-22, authorized casino employees can access Live Rewards information from the iVIEW, as appropriate. The Live Rewards employee functions allow employees to perform maintenance and trouble-shooting tasks from the slot floor. From the iVIEW, an employee can:

view information on the currently installed Live Rewards program, iVIEW and GMU.

view iVIEW settings as defined under Global Settings on the Live Rewards Server.

view individual game play, withdrawal and hand pay records of transactions that occurred at the iVIEW.

clear the iVIEW device's Non-Volatile Random Access Memory (NV-RAM).

remove the iVIEW from service ("un-register").

The chart below refers to fields shown in FIG. 20 and includes report data available at the employee interface at the gaming device:

| Field | Description |
|---|---|
| Buckets Spent | Type and amount of reward for the specified transaction. For example, 100 P.P would be $100.00 in Play Points. |

-continued

| Field | Description |
|---|---|
| | Additional reward, or bucket, types are: Threshold Counter, Bonus Points, and Cash |
| Closed By | Identification number of the employee who completed the Live Rewards hand pay on the slot machine. |
| Closed Date Time | Date and time hand pay was cleared from the slot machine. |
| Created Date Time | Date and time slot machine went into hand pay mode. |
| End Date Time | Date and time specified session is terminated. End date/time format: DD/MM/YYYY HH/MM/SS (AM or PM). |
| Game | Name of Live Rewards game played during the specified transaction. |
| Hand pay Type | Reason game has gone to a hand pay: 1 - Winnings exceed jurisdictional limit; 2 - Unable to transfer winnings to the base game. |
| HID | History Identification Number. A unique sequential number generated by the system. The purpose of the HID is to track game play information, including when play started, when play ended, as well as the associated score, pay level, reward level, buckets spent, and buckets won. This information can also be viewed through the LRS. |
| iVIEW ID | A unique identification code of the iVIEW device. The iVIEW ID is an alphanumeric value of 50 characters, including special characters. |
| Player Card # | Player Card Number. A unique 20-character number that is associated with a particular player. |
| Prizes | Dollar amount of the hand pay. |
| Prize Value | Dollar amount of the winnings transferred from the LRS to the game. |
| Reward Level | Name of pay table that was applied to the specified game. |
| Score | The result of the last played game and the current pay level number. |
| Session ID | Identification code that is generated for by the system for every session. A session begins at player card in and ends at player card out. |
| Session Trans # | Transaction number generated by the iVIEW for each withdrawal and deposit that occurs between player card in and player card out. |
| Start Date Time | Date and time specified session is created. Start date/time format: DD/MM/YYYY HH/MM/SS (AM or PM). |
| Status | For a hand pay status, indicates hand pay has been Completed, is still Open, or has been Cancelled. For a withdrawal status, indicates withdrawal is pending (Open), has been completed (Success) or could not be completed (Failed). |
| Trans Date Time | Date and time of the transaction when it was created. The date is in DD/MM/YYYY format, and the time in HH/MM/SS AM or PM format. |
| Winnings | Dollar amount won during the specified transaction. |

Figure 13:
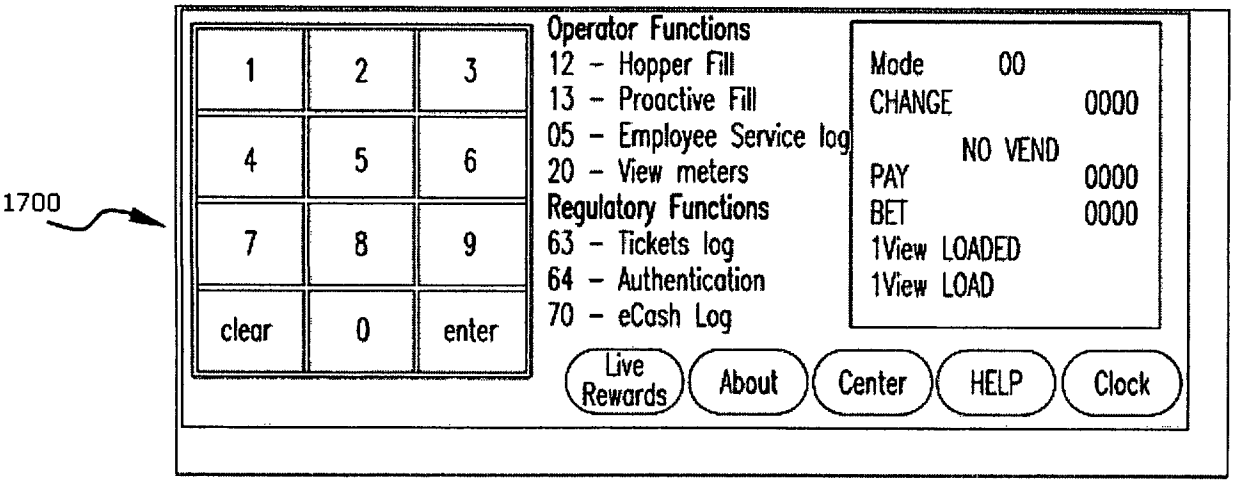
FIGS. 13, 14 illustrate a pair of screenshots to access the Live Rewards employee functions at the iVIEW device.

Referring to FIG. 13, an Operator Menu panel 1700 is shown such as may be displayed on an operator interface unit that may be integrated as part of a player interface unit, such as a Bally iView, connected to a gaming machine. The operator interface unit may include the Operator Menu panel 1700 that may be displayed on a touch-sensitive display and a card reader that may receive and read an operator card. Upon insertion of an operator card by a casino operator technician, the operator menu panel 1700 may be displayed. To gain access to the functionality of the menu panel 1700, the technician may enter a pin number and demonstrate that the person with the card is authorized to access the various menu functions. As shown, a keypad is provided for entering the pin number and to enter numbers associated with the various operator functions, such as 12—Hopper Fill, 13—Proactive Fill, 05-Employee Service Log, 20—View meters, and various Regulatory Functions, such as 63—Tickets Log, 64—Authentication, 70—eCash Log. Additionally, there may be additional keys, such as Bally Live Rewards, About, Center, Help, and Clock. When a function key number is entered on the key pad, a function display area may provide information about the requested function as is associated with the gaming machine. For example, in the function display area where the View Meters key number has been entered, the Mode, Change, Pay, Bet, iView Loaded, iView Load meters/registers names are displayed along with information stored in the meter.

Figure 14:
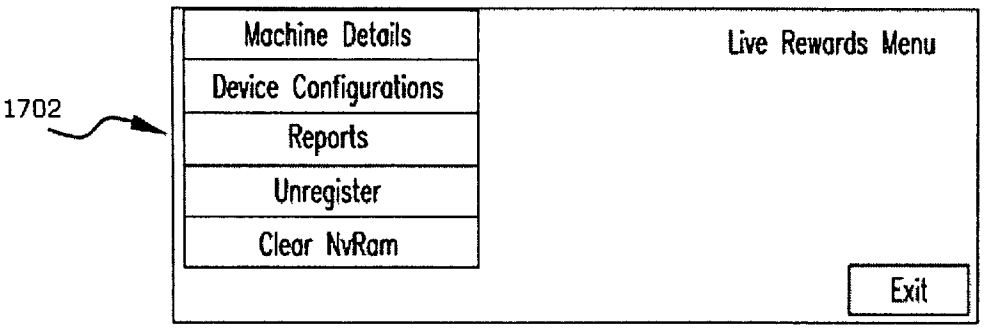

Referring to FIG. 14, an operator Live Rewards menu panel 1702 is shown such as may be displayed on an operator interface unit. The additional keys on the operator menu panel 1702 provide additional menus for obtaining additional information about the gaming machine and operating system. For example, by pressing the Live Rewards key, an operator Live Rewards menu panel 1702 may be displayed providing an operator with additional key options, such as Machine Details, Device Configurations, Reports, Unregister, Clear NvRam (Non-volatile random access memory), and Exit (to return to the operator menu panel 1700).

Figure 15:
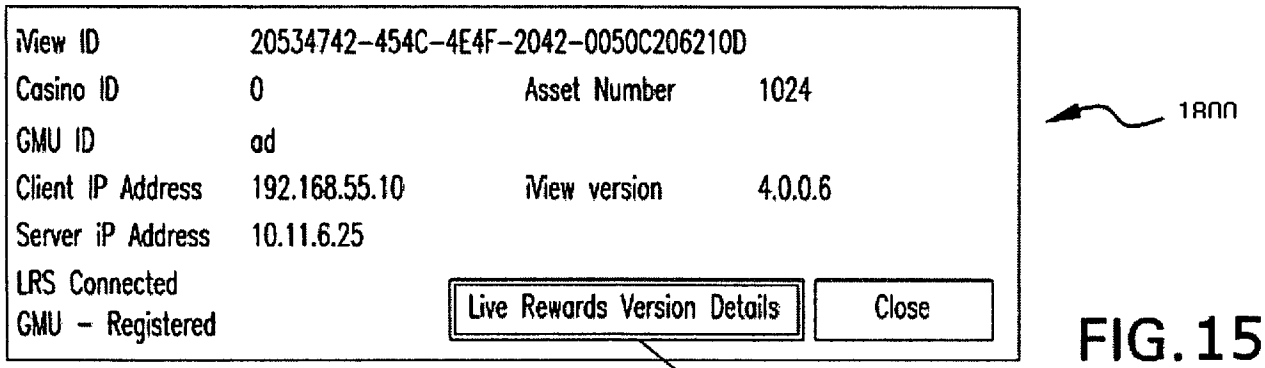
FIGS. 15, 16, 17 illustrate a series of screenshots showing the Machine Details in the employee function pages at the iVIEW.

Referring to FIG. 15, a Machine Details panel 1800 is shown such as may be displayed on an operator interface unit. For example, by pressing the Machine Details key on the operator Live Rewards menu panel 1702, the machine details panel 1800 may be displayed and provide information, such as iView ID (identification data), Casino ID, Asset Number, GMU (gaming management unit) ID, Client IP address, Server IP address, iView version, LRS (Connected or Unconnected), and GMU=(Registered or Unregistered). The panel 1800 may additionally provide a key for Version Details and Close (to return to the previous menu panel).

Figure 16:
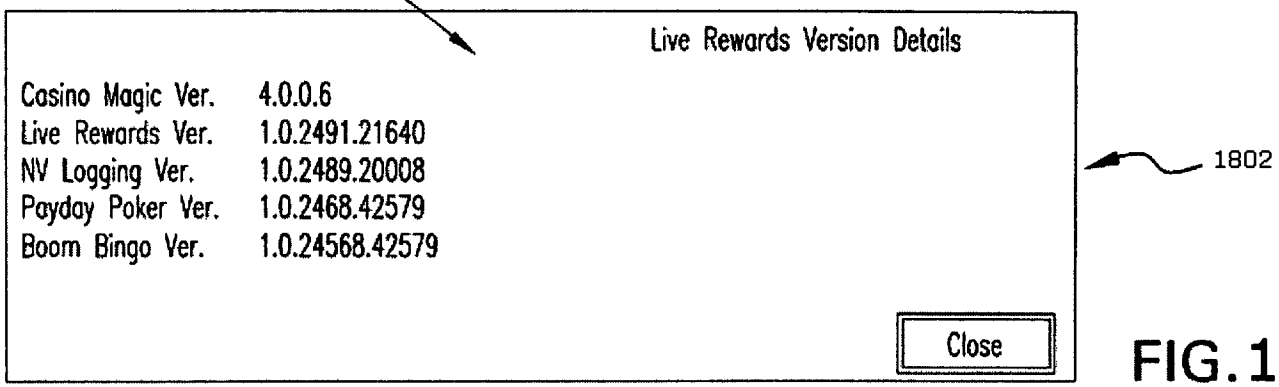

Referring to FIG. 16, a Version Details panel 1802 is shown such as may be displayed on an operator interface unit. For example, by pressing the Version Details key on the Machine Details panel 1800, the Version Details panel 1802 may be displayed to provide the names of various components associated with the gaming machine, such as Casino Magic Version, Live Rewards Version, NV Logging Version, Payday Poker Version, and Boom Bingo Version, and the associated ID information.

Figure 17A:
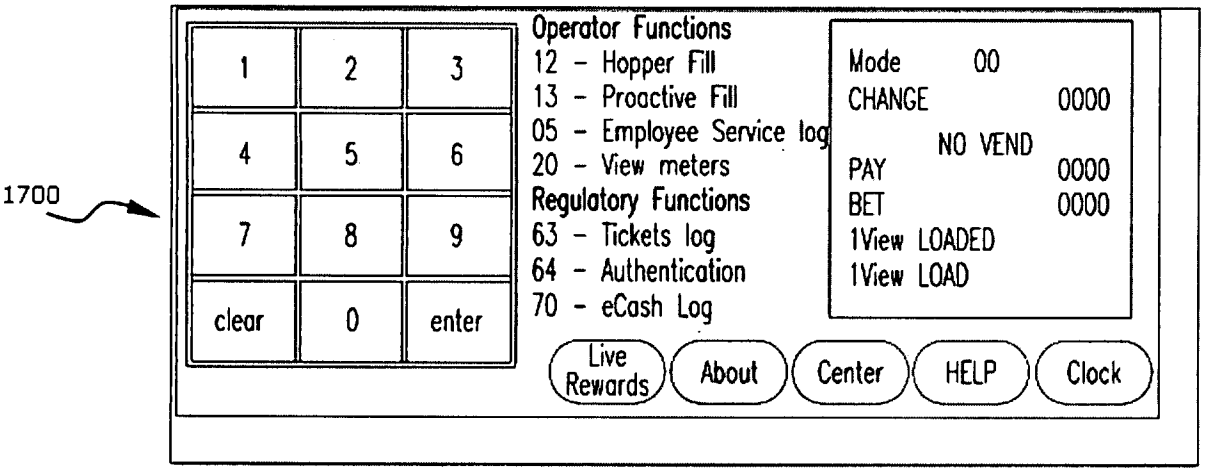
Figure 17B:
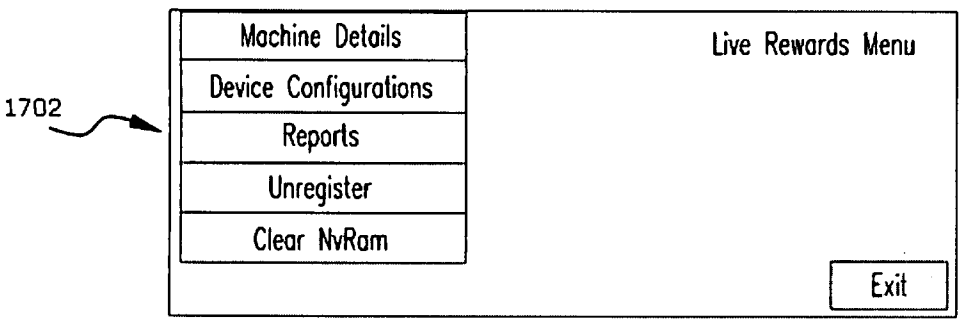

Referring to FIG. 17, a Help panel 1804 is shown such as may be displayed on an operator interface unit. For example, by pressing the Help key on the Operator Menu panel 1700, various fields displayed of the associated panels may be listed by name and associated description, such as Asset Number if Slot machine identification number, Casino ID//Unique 3 digit property identifier, Client IP Address//Network address of the iView, GMU ID//Unique identification number of the Game Monitoring Unit assigned by the Slot Management System (such as a Bally SMS) upon initial connection, iView ID//Unique number used to identify the iView device assigned by the manufacturer, iView version//Version of code currently installed on the iView device, LRS//Status of the Live Rewards Server (LRS) that the iView is connected or not connected, GMU=//Status of iView connection to the Game Monitoring Unite (GMU)—Connected or Not Connected, Server IP Address//Network location of the Bally Live Rewards server.

Figure 18A:
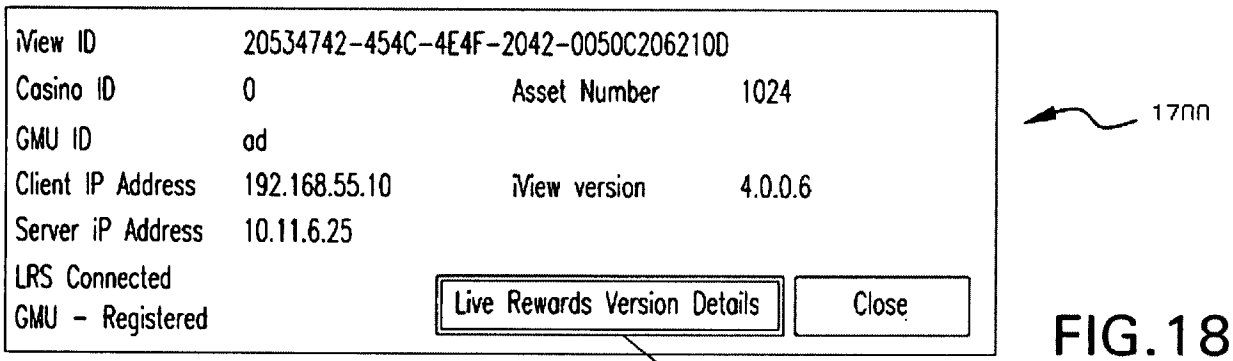
Figure 18B:
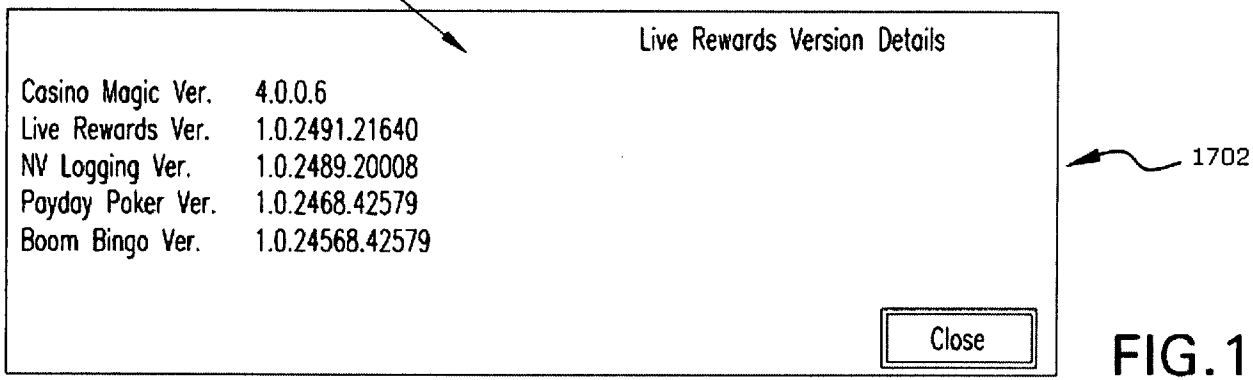

Referring to FIG. 18, a Device Configuration panel 1900 is shown such as may be displayed on an operator interface unit. For example, by pressing the Device Configuration key on the operator Live Rewards menu panel 1702, the Device Configuration panel may be displayed and show the iView settings as defined under Global Settings on the Live Rewards Server. The Device Configuration panel 1900 may include Refresh and Close keys. By pressing the Refresh key the most recent settings received by the iView may be displayed.

Referring to FIG. 19, a second Help panel 1902 is shown such as may be displayed on an operator interface unit. The second Help panel 1902 may be a rollover panel associated with the first Help panel, such as with a scrolling capability, and include Field names and descriptions, such as: Auto-Play System Games//Determines whether a randomly selected Bally Live Rewards game plays automatically once the player has accrued enough play points—this setting is defined through the LRS, under Global Settings; iView SyncInterval//Defines the number of minutes between each iView synchronization with the LRS to download global settings—these settings are defined through the LRS, under Global Settings; Jurisdiction Limit//Indicates the jurisdictional limit for hand-paid jackpots—this setting is defined through the LRS, under Global Settings; System Game Volume for Attract Mode//Volume setting for attract movie—this setting is defined through the LRS, under Global Settings; System Game Volume Game—Volume setting for Bally Live Rewards games—this setting is defined through the LRS, under Global Settings.

Figure 20A:
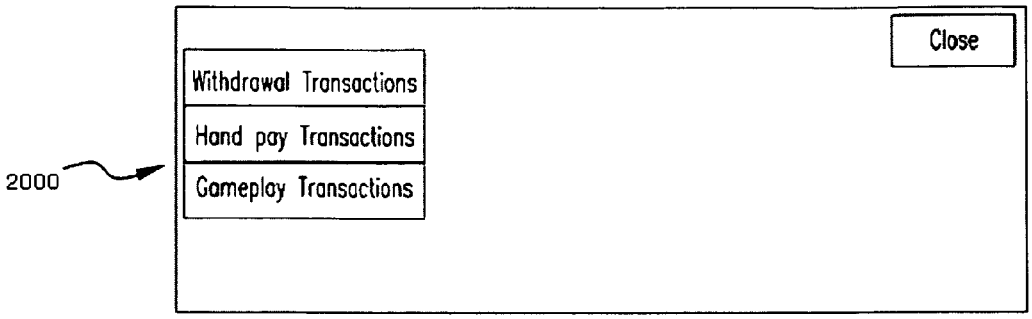
FIGS. 20A, 20B, 20C, 20D (collectively referred to as FIG. 20) illustrate a series of screenshots of the Reports available on iVIEW showing Withdrawal transactions, Hand pay transactions, and game play transactions. These pages are seen in the employee function pages FIGS. 21A, 21B (collectively referred to as FIG. 21) illustrate a series of screenshots shown to the employee if the device is to be taken out of service. These pages are seen in the employee function pages.
Figure 20B:
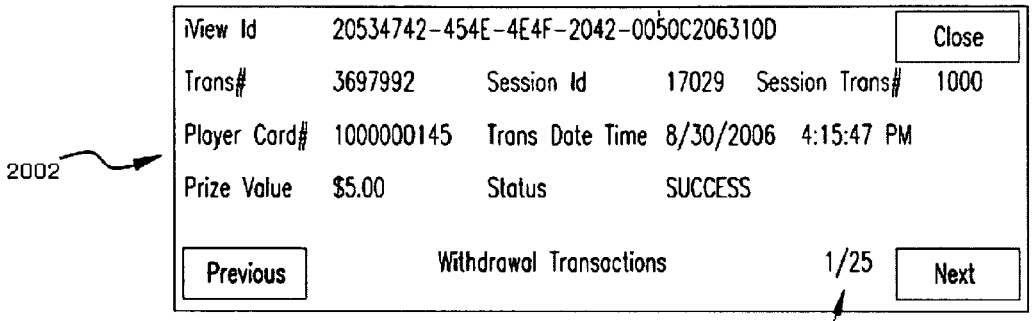
Figure 20C:
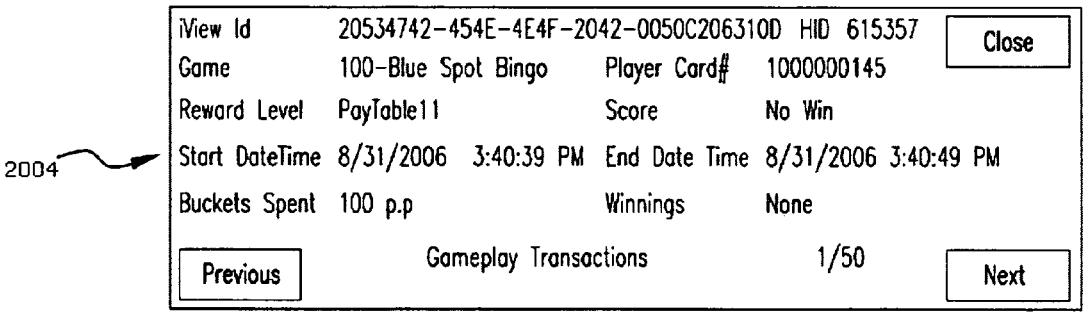
Figure 20D:
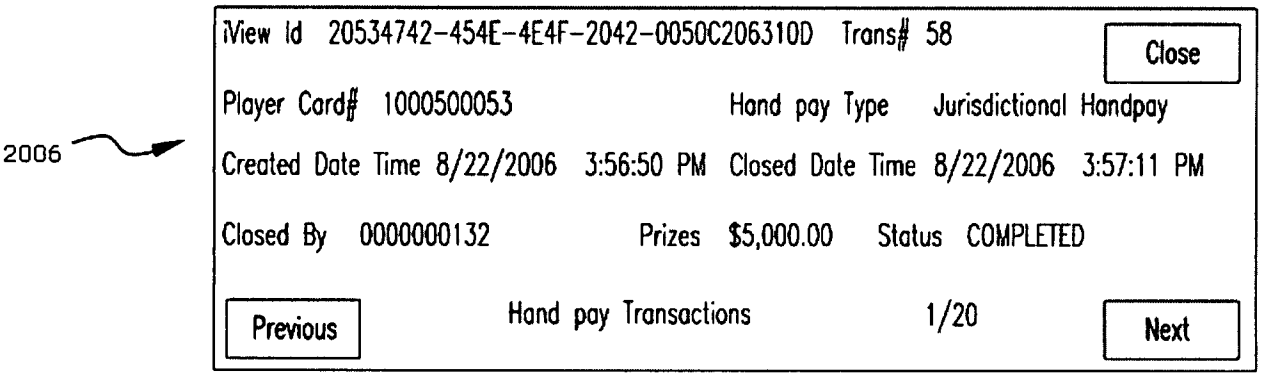

Referring to FIG. 20A, B, C, D, several transaction-related report panels 2000, 2002, 2004, 2006 are shown such as may be displayed on an operator interface unit. A Transaction Main panel 2000 may be displayed by pressing the Reports key. The Transaction Main panel 2000 may include a Withdrawal Transactions, Hand pay Transactions, and Gameplay Transactions keys. By pressing each of the respective keys, a panel may be displayed corresponding to a Withdrawal Transactions 2002, Hand pay Transactions 2004 and Gameplay Transactions panel 2006.

Figure 21A:
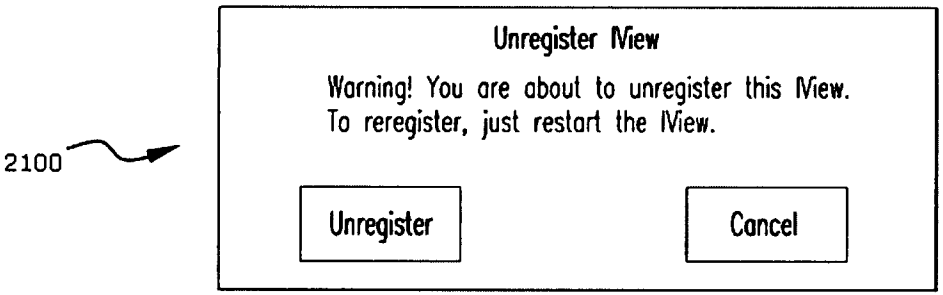
Figure 21B:
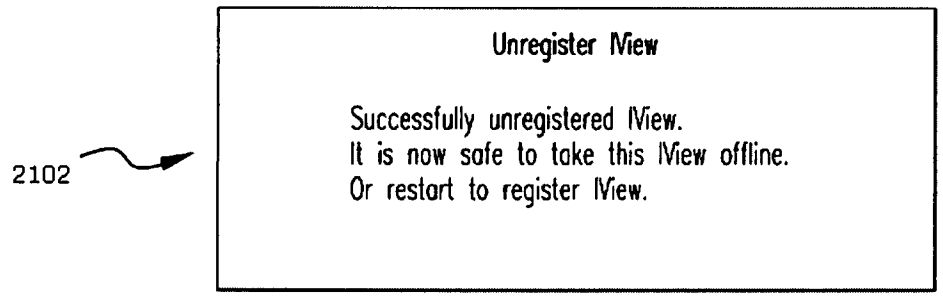

Referring to FIG. 21A, B, two Unregister panels 2100, 2102 are shown such as may be displayed on an operator interface unit to unregister an iView apparatus from the gaming network as for example when a gaming machine is removed from the casino floor.

Figure 22:
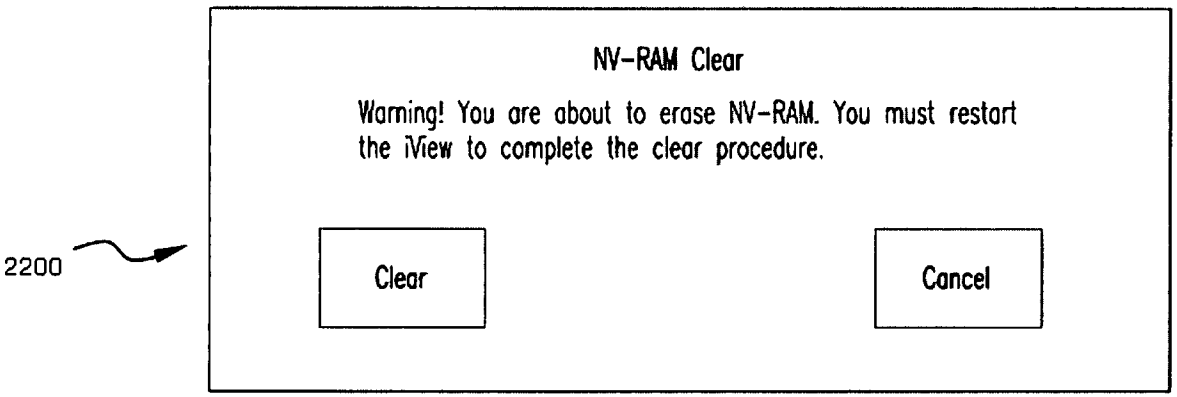
FIG. 22 illustrates a screenshot of the Clear NV-RAM on the iVIEW. This allows the battery backed ram or other iVIEW storage device to be cleared of its variables and re-initialize itself back to its original state as if Live Rewards was never run on the device.

Referring to FIG. 22, an NV Ram clear panel 2200 is shown such as may be displayed on an operator interface unit to erase the non-volatile random access memory of a gaming machine.

Figure 23:
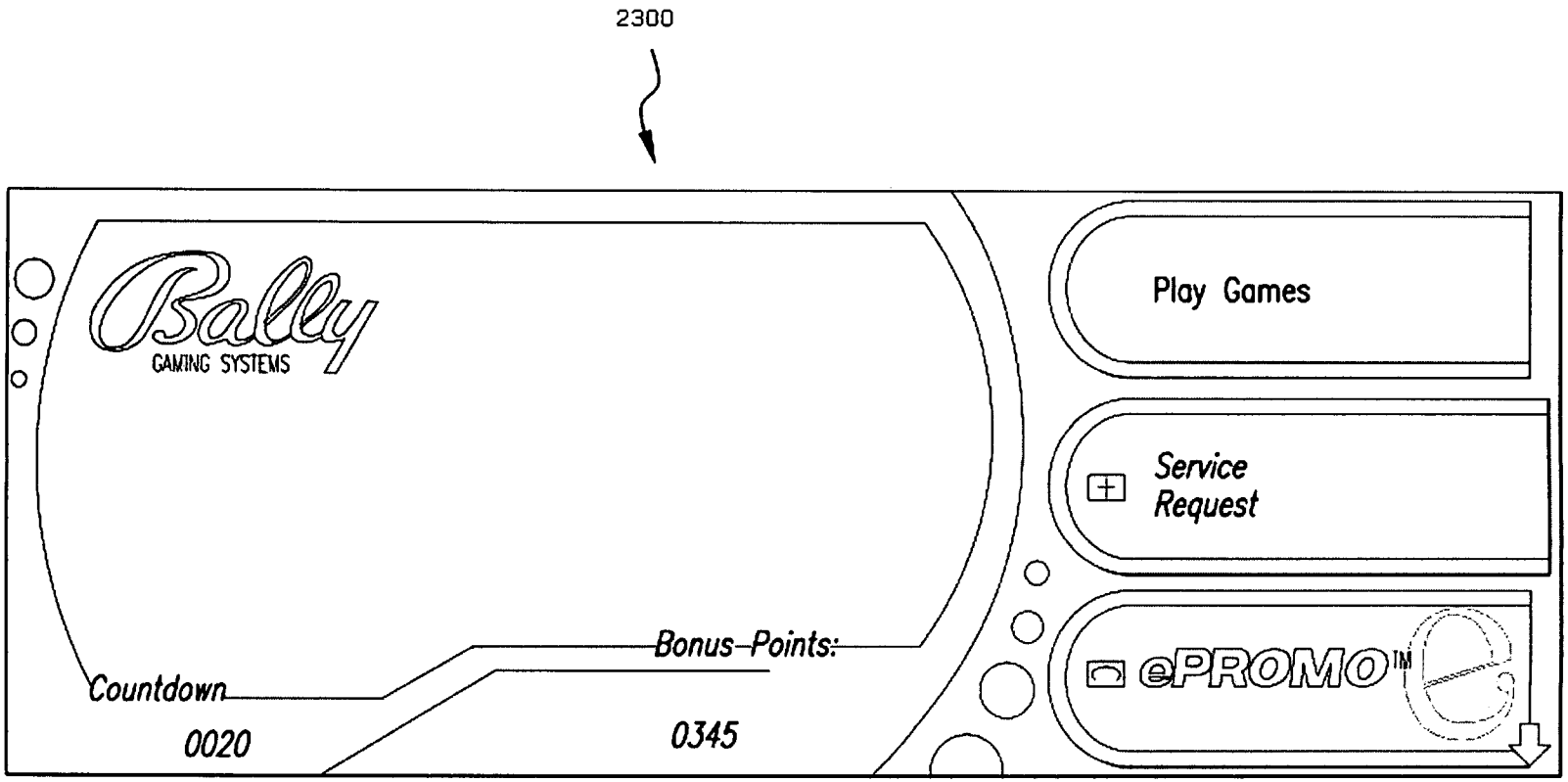
FIG. 23 illustrates a screenshot of the Player Page shown to the player after a valid player card insertion at the Player Tracking panel. The player can select ePromo (funds transfers to the gaming device), Service Request, or Play Games and enter the live Rewards gaming portal on the iVIEW.

Referring to FIG. 23, a Main iView display 2300 is shown such as may be displayed on a player interface unit to display a player's accumulated bonus points and a countdown for qualifying to play a reward game. The Main iView display may include Play Games, Service Request and ePromo keys. Once the player qualifies, the Play Game key may allow a player to activate a reward game. FIG. 23 is a screenshot of the Player Page shown to the player after a valid player card insertion at the Player Tracking panel. The player can select ePromo (funds transfers to the gaming device), Service Request, or Play Games and enter the live Rewards gaming portal on the iVIEW. If the player selects the Play Games button then they will be taken to the Live Rewards Game Console where they can select from multiple games. If the player earns enough play points and threshold counter points then they will automatically be taken from this screen and the default game will be auto-played. This is to ensure that a player gets their bonus game even if they don't touch the user interface at all. When a player exits the Live Rewards page by Pressing Player account this is the page they return to. This is the default page that a carded in player would see during their session.

Referring generally to FIG. 24-56, the Live Rewards Management Application enables:

activate, control and registers iVIEW devices.

store player information related to Live Rewards.

set up the rules for accessing Live Rewards.

assign different reward criteria to different player types.

control the types of winnings available to the player (cash or bonus points).

manage bonus game Pay tables.

generate reports related to Live Rewards activity.

Getting Assistance

Click Contact Info link at the bottom of any screen. The Contact Info screen may provide contact information as well as office locations worldwide for service related assistance, such as from the manufacturer.

Figure 24:
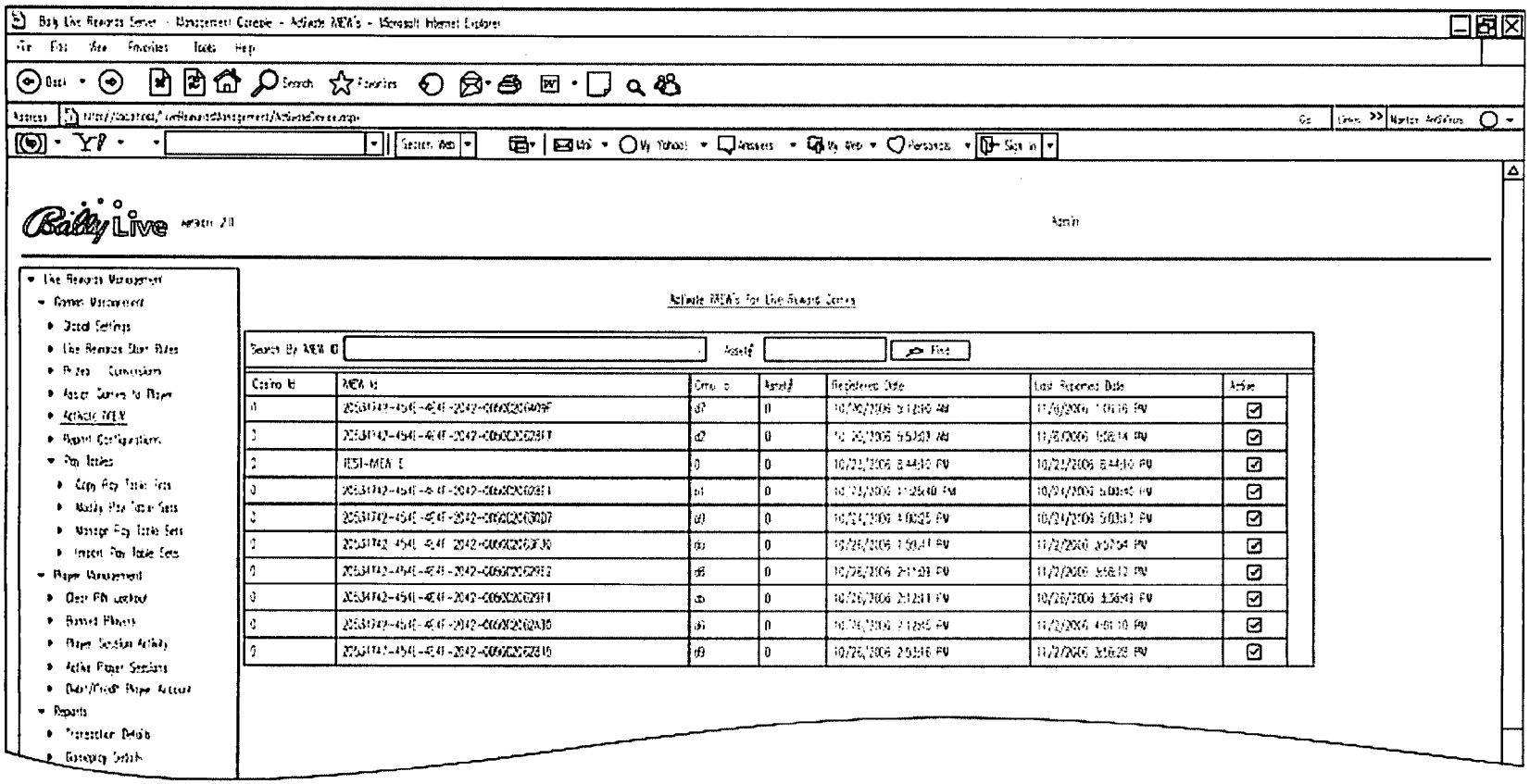
FIGS. 24, 24A (collectively referred to as FIG. 24) illustrate a pair of screenshots of the Live Rewards Server Activate iVIEW for Live Rewards Games. Live Rewards can be enabled or disabled for each gaming device on the casino floor.
Figure 24A:
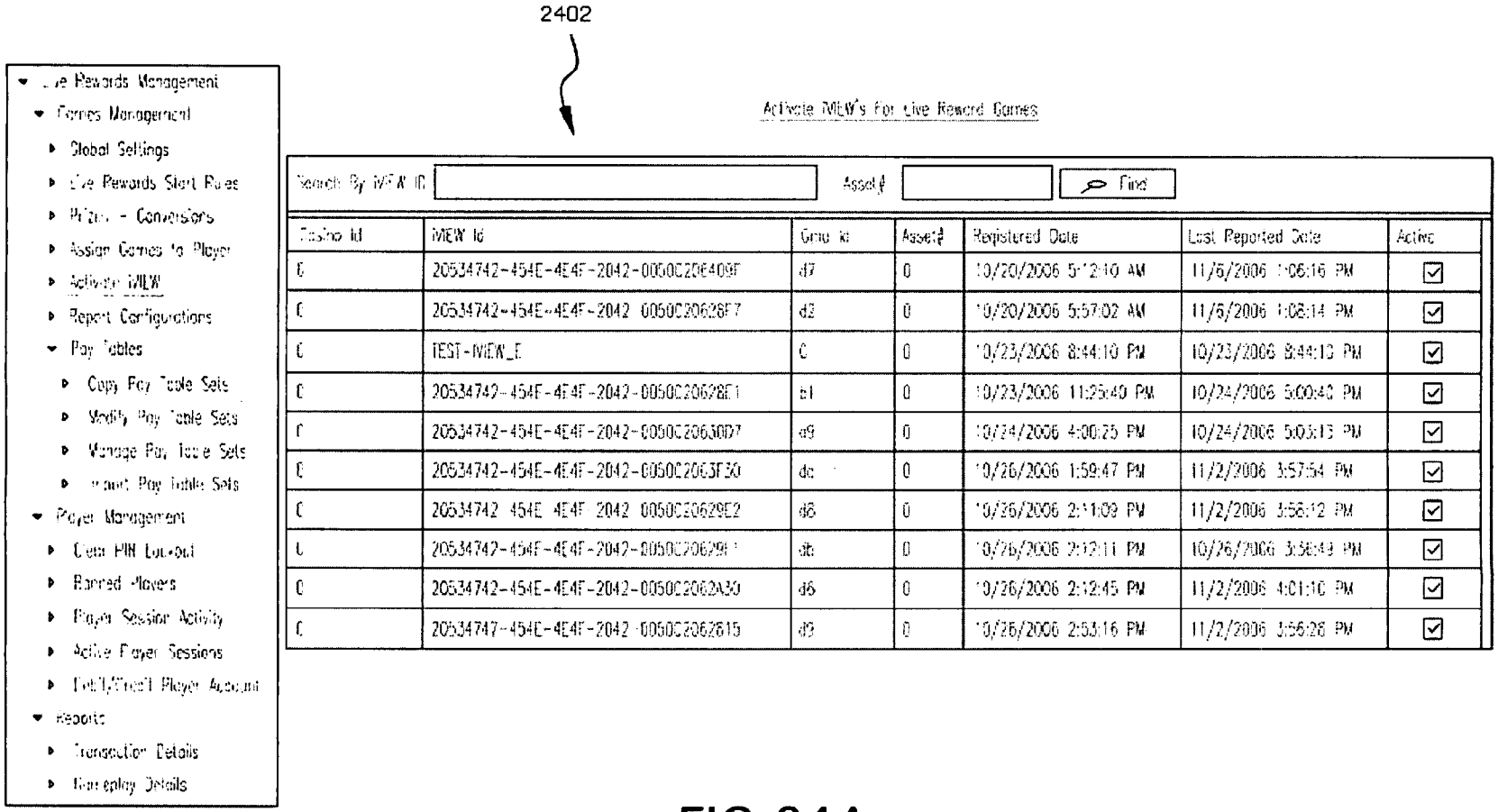

Referring to FIG. 24, an Activate iView panel 2400 is shown such as may be displayed on an Operator Control Console, such as a Bally Control Panel, connected to a server network, such as a Bally SMS & CMS. The operator control console may comprise a conventional personal computer with coding implemented to execute various processes associated with the network servers and gaming machines. The Activate iView panel may include fields for a Casino ID, iView ID, GMU Id, Asset Number, Registered Date, Last Reported Date, and Active. Associated with each field may be data for each of the player interface units that are connected to the system. A closeup view of the panel 2402 is shown in FIG. 24A.

Activating and De-Activating iVIEW Devices

Each iVIEW may automatically register with the Live Rewards application when it boots for the first time and sends a registration message to the LRS for activation. Once the iVIEW is activated, it downloads the global settings from the LRS and updates its global settings accordingly. It is then ready to play Live Rewards games. The registration information includes base game data, identification code of Asset, iVIEW, casino and network identification code of the iVIEW device (GMU Id). The LRS requires successful registration of iVIEW prior to any game being played on the specific iVIEW. As a security measure, by default, all games may be deactivated for a specific iVIEW at initial registration and games may be enabled in the LRS for that iVIEW.

In one or more embodiments, iView devices may be separately authorized and un-authorized to play Live Rewards Games. This may be done after registering the iVIEW devices to the slot machines. Plus, the user through the Operator Control Console can also activate and de-activate all iVIEW devices in the casino floor.

The following steps outline a process that may be implemented through conventional coding on the operator control console to activate/de-activate iVIEW devices:

STEP 1. From the Live Rewards Management menu, go to Games Management submenu and select Activate iVIEW. System displays the list of all iVIEW devices and its details.

Following is the list of fields and their description for the Activate iVIEW's For Live Reward Games screen:

| Field Name | Description |
|---|---|
| Casino Id | A unique identification code of the casino. The Casino Id can be an alphanumeric value of 4 characters. |
| iVIEW Id | A unique identification code of the iVIEW device. The iVIEW Id can be an alphanumeric value of 50 characters including special characters. |
| Gmu Id | A unique network identification code of the iVIEW device. The Gmu Id can be an alphanumeric value of 32 characters including special characters. |
| Asset# | A unique identification code of the Slot machine. The Asset# can be an alphanumeric value of 8 characters. |
| Registered Date | The Registration date of the iVIEW device on the slot machine. The date is in DD/MM/YYYY format, and time in HH/MM/SS format AM or PM format. |
| Last Reported Date | The last date and time the iVIEW device connected to the LRS. The date is in DD/MM/YYYY format, and time in HH/MM/SS AM or PM format. |
| Active | This checkbox allows you to activate or deactivate the iVIEW device. |

STEP 2. Select/clear the Active checkbox of the required iVIEW devices which has to be activated/de-activated. or, Optionally, to search and then select, the required iVIEW devices, do the following:

A. Type any/both:

iVIEW Id in Search By iVIEW ID field.

Asset number in Asset# field.

B. Click Find.

C. Select/clear the Active checkbox of the required iVIEW devices.

STEP 3. Click Update to update the iVIEW devices according to the selection. System updates and confirms the same by displaying the message as shown below.

STEP 4. Click Activate All to activate all iVIEW devices in the casino floor. System confirms the same by displaying the message as "All iVIEW's Activated Successfully".

STEP 5. Click De-activate All to de-activate all iVIEW devices. System confirms the same by displaying the message as "All iVIEW's De-activated Successfully".

Figure 25:
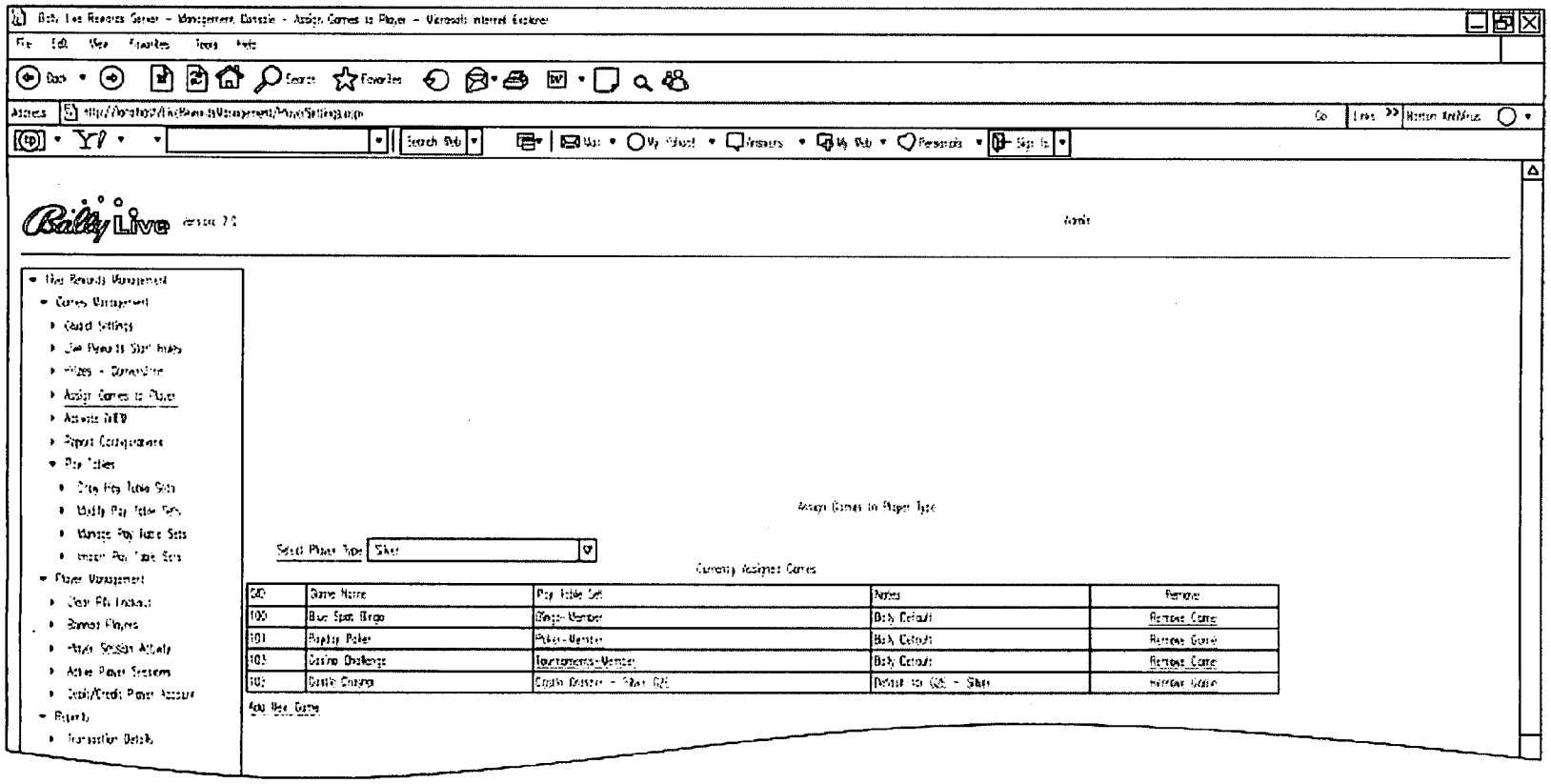

Referring to FIG. 25, an Assign Games to Player Type panel 2500 is shown such as may be displayed on an Operator Control Console, such as a Bally Control Panel, connected to a server network, such as a Bally SMS & CMS. A closeup view of the assign games to player type panel 2502 is shown in FIG. 25A. The operator control console may comprise a conventional personal computer with coding implemented to execute various processes associated with the network servers and gaming machines. The Assign Games to Player Type panel may include fields for a Select Player Type, Game ID, Game Name, Pay Table Set, Notes, Remove, and Add New Game. For each Player Type, such as Silver, Gold, Platinum, the associated available games and paytables may be displayed. The Remov filed permits the operator to remove a game from a selected player type's pool of games that may be played as a rewards game.

Assigning Games to the Player Type

The Player's Club can designate up to three player types, which usually correspond to the amount the player wages in the casino (for example, Silver, Gold and Platinum). Once the Pay table sets are ready, you can assign them to the requisite Live Rewards game and to the player type.

To View Details of Currently Assigned Games

Purpose: To view details of all currently assigned games, Pay Table Sets and winnings for the particular player type.

Procedure: Follow these steps to view the currently assigned games and details of the mapped Pay Table Sets.

STEP 1. From the Live Rewards Management menu, go to Games Management submenu and select Assign Games to Player.

STEP 2. By default, system selects lowest level player type. However, select required Player Type from Select Player Type drop-down list. System displays currently assigned games details, if any, as shown below.

STEP 3. Select required Pay Table Set link. System displays details of the selected Pay Table Set and its winnings as shown below.

STEP 4. Click Close to close this Pay Table Set view.

To Delete a Game

Purpose: To remove and un-assign a game from the player type.

Procedure: Follow these steps to remove the game.

STEP 1. From the Live Rewards Management menu, go to Games Management submenu and select Assign Games to Player.

STEP 2. By default, system selects lowest level player type. However, you can select required Player Type from Select Player Type drop-down list. System displays currently assigned games details, if any.

STEP 3. Click Remove Game link to move out the selected Live Reward game that is currently assigned to any player type. System displays Remove a Game section.

STEP 4. Type Reason for Removing Game (Mandatory).

STEP 5. Click Remove Game from Remove a Game section. System un-assigns and removes the game along with its game settings. It confirms the same by displaying the message as shown below. The game is then available in the LRS, so that you can use it for other player types, if needed.

STEP 6. Optionally, click Close to close Remove a Game section.

Adding Games

Procedure: Follow these steps to add a Live Reward game to the player type.

STEP 1. From the Live Rewards Management menu, go to Games Management submenu and select Assign Games to Player.

STEP 2. By default, system selects lowest level player type. However, select required Player Type from Select Player Type drop-down list. System displays currently assigned games details, if any.

STEP 3. Click Add New Game link. System displays Adding a New Game section as shown below.

STEP 4. Select required Game Name from drop-down list.

STEP 5. Select required Pay Table Set from drop-down list. You can see the same notes in Pay Table Set Notes field, that was entered while creating the selected Pay Table Set. This cannot be altered. Optionally, click View link to view the selected Pay Table's structure and its details.

STEP 6. Type Reason for Adding Game (May be mandatory).

STEP 7. Click Add Game. System assigns the selected player type to the selected Live Reward game and confirms the same by displaying a confirmation message.

STEP 8. Optionally, click Close to close the Adding a New Game section.

Figure 26:
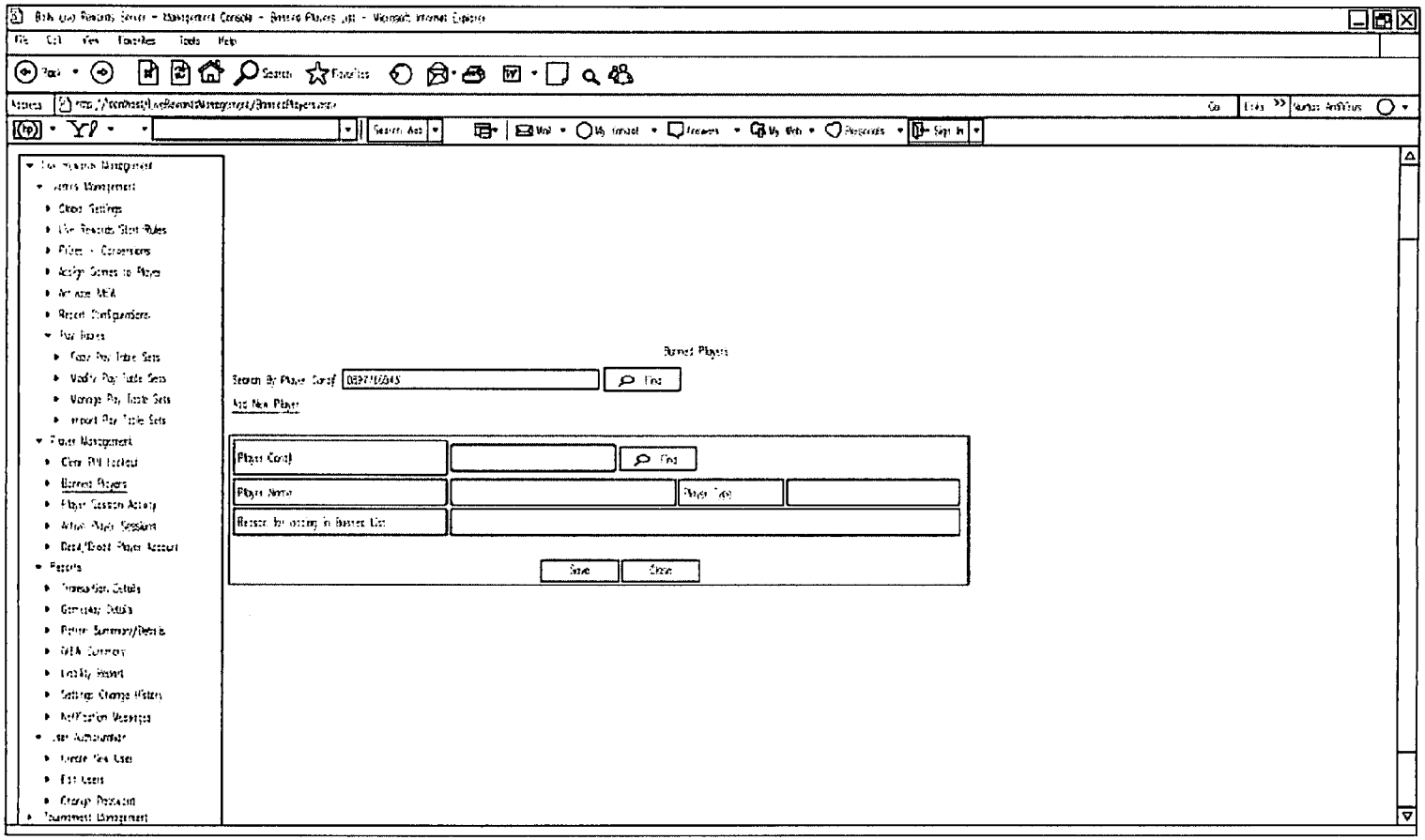
FIGS. 26, 26A (collectively referred to as FIG. 26) illustrate a pair of screenshots of the Live Rewards Server Ban Players user interface. Specific players can be prohibited to play the Live Rewards product.
Figure 27:
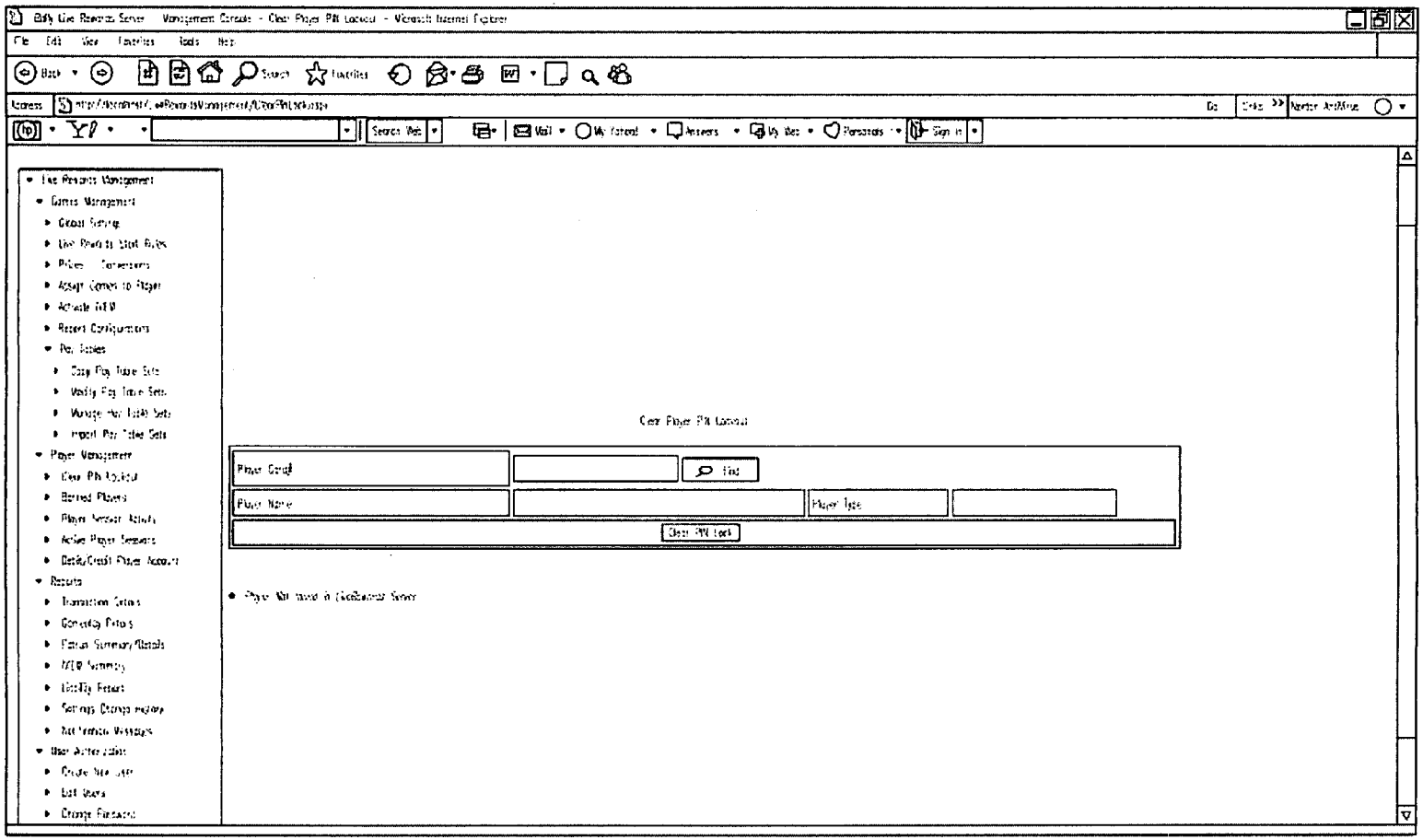
FIGS. 27, 27A (collectively referred to as FIG. 27) illustrate a pair of screenshots of the Live Rewards Server Clear PIN lockout function. Players that enter their PIN (personnel identification number) wrong too many times in a row have their account locked. This interface for casino personnel will allow the lock to be cleared.
Figure 29:
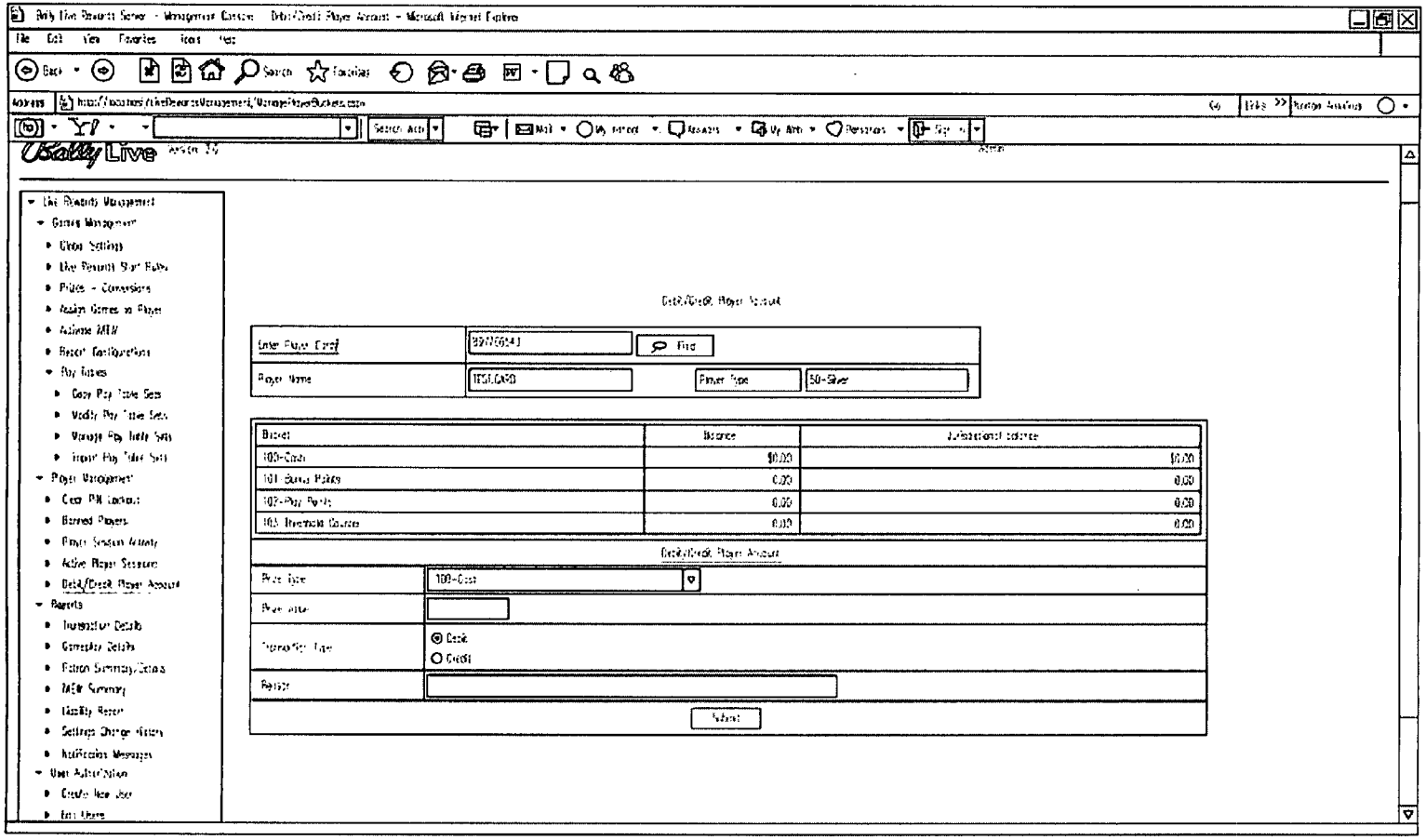
FIGS. 29, 29A (collectively referred to as FIG. 29) illustrate a pair of screenshots of the Live Rewards Server Debit/Credit Player Account feature. A player has 4 player buckets that are non-restricted for use and 4 that are Jurisdictional and may require a hand pay to collect the value. This screen gives the casino personnel the ability to debit or credit any of the buckets.

Referring generally, to FIGS. 26, 27, 29, a Player Management menu is shown on the left of each of the respective panels. The Player Management menu enables a user to select which of the panels and options that are to be accessed. The Player Management menu is all about the Players. You can access/play Live Rewards games only if you have a Player Card. A Player Card is a magnetic striped card that identifies the player. This is encoded with privileges and benefits. When inserted into the card reader, the card is read by the player-tracking system. The server identifies the player, maintains a record of the games played and alerts the player to a rating system. Once the player inserts the card into the card reader, the LRS creates a session for the player after validating the player's card number with the casino management system. When the player takes out the card, the session is closed. In casinos same player cards are sometimes used by multiple players. Therefore, once a session is closed, the corresponding player's balances are credited to the main account. The player gets back the balances the next time the card is inserted in any other slot machine.

For example: Two players have used the same card for playing Live Rewards games. Therefore, only one account is maintained in the LRS for that player card. For this reason, the LRS creates a separate session for each of these players. All game play details and winnings go to their respective sessions and once the card is removed, all balances are updated in the main account.

In one or more embodiments, at any given point of time, only one Pay table set is mapped to the Live Rewards games in accordance to the player type. There can be any number of player types in the casino that is maintained in their CMS. Live Rewards game features like global settings, start rules, and Pay Table Sets are delineated based on these player types.

Inside the Player Management section of the Live rewards server administration pages is the following feature:

Viewing Active Player Sessions

Purpose: To view the active session details of players (status of the session may be 'Open'). This happens due to any flaw in the iVIEW devices or the slot machines breaking the communication with Live Reward Server. Plus, you can do the following:

View players main account and players session balances.

Cancel pending game play.

Cancel pending hand pay.

Suspend the session.

Close the session.

Procedure: Follow these steps to view active player session details.

STEP 1. From the Live Rewards Management menu, go to Player Management submenu and select Active Player Sessions. System displays list of all player sessions whose status is 'open'. Following is the list of fields, column headers and their description for the Active Player Sessions screen.

STEP 2. Optionally, do the following

A. Type Player Card Number in Search By Player Card# field to view the session details of a particular player.

B. Click Find or press Enter. System retrieves the details of the specified player card number alone.

Cancel Pending Game Play

If any discrepancy occurs in the iVIEW device while a player is playing Live Rewards game, that is, before the game ends, the player can contact a casino employee to cancel the game play. On canceling, the player gets back the play points into the main account. There can be only one pending game for any iVIEW device and a session.

Purpose: To cancel the pending game play and restore play points spent on playing that game.

Procedure: Follow these steps to cancel the pending game play.

STEP 1. From the Live Rewards Management menu, go to Player Management submenu and select Active Player Sessions. System displays list of all the player sessions whose status is 'open'.

STEP 2. Optionally, do the following

A. Type Player Card Number in Search By Player Card# field to view the session details of a particular player.

B. Click Find or press Enter. System retrieves the details of the specified player card number alone.

STEP 3. Select required session by clicking Choose link. System displays the selected session's details in Session Details display section. If the selected session has any pending game play, system displays corresponding transaction number in Pending Game play field, else system displays '0' (zero).

Cancel Pending Hand Pay

The canceling of the hand pay may be helpful for the following reasons:

If the iVIEW device is not functioning, when the casino staff collects the IRS form from the player and commits the tax amount.

If the LRS finds some other player card in the iVIEW device other than the players who triggered the hand pay. On informing the appropriate reasons by the player, the casino employee cancels the hand pay and commits the amount collected. There can be only one pending hand pay for any iVIEW device and a session.

Purpose: To cancel a pending hand pay and.

Procedure: Follow these steps to cancel the pending hand pay.

STEP 1. From the Live Rewards Management menu, go to Player Management submenu and select Active Player Sessions. System displays list of all the player sessions whose status is 'open'.

STEP 2. Optionally, do the following

A. Type Player Card Number in Search By Player Card# field to view the session details of a particular player.

B. Click Find or press Enter. System retrieves the details of the specified player card number alone.

STEP 3. Select required session by clicking Choose link. System displays the selected session's details in Session Details display section. If the selected session has any pending hand pay, system displays corresponding transaction number in Pending hand pay field, else system displays '0' (zero).

Handling Pending Withdrawal

If there occurs any discrepancy in the iVIEW devices during transferring the winnings from the iVIEW devices, or if the transaction fails or locked due to some reasons, player can contact casino employee for assistance. The LRS indicates the identification and amount of transaction in Pending Withdrawal# and Transaction Amount fields respectively. The casino employee enters the amount that got transferred in Commit field.

Purpose: To commit the transaction amount which is pending and deposit the balance amount to the player's account.

Procedure: Follow these steps to commit transaction amount.

STEP 1. From the Live Rewards Management menu, go to Player Management submenu and select Active Player Sessions. System displays list of all the player sessions whose status is 'open'.

STEP 2. Optionally, do the following

A. Type Player Card Number in Search By Player Card# field to view the session details of a particular player.

B. Click Find or press Enter. System retrieves the details of the specified player card number alone.

STEP 3. Select required session by clicking Choose link. System displays the selected session's details in Session Details display section.

STEP 4. Type transferred amount in Commit_Amount field. The employee finds out the amount transferred by using the slot machine's internal records. NOTE: If the selected session has any pending transaction, system displays corresponding transaction identifier, else system displays '0' (zero).

Suspend Player Session

The Live Rewards management application provides a Session job monitor that runs all time to monitor the functioning of all iVIEW devices across the casino floor. If there are any devices that are not communicating with the LRS, it further detects for any open sessions and suspends those sessions. This session job monitor is an internal service which runs all time and checks for fault in the iVIEW devices every fifteen minutes.

Purpose: To suspend the player session manually, whose status is 'open', if any discrepancy or flaw arises in the iVIEW devices. System credits the winnings of the player to their main account.

Procedure: Follow these steps to suspend the active player session.

STEP 1. From the Live Rewards Management menu, go to Player Management submenu and select Active Player Sessions. System displays list of all the player sessions whose status is 'open'.

STEP 2. Optionally, do the following

A. Type Player Card Number in Search By Player Card# field to view the session details of a particular player.

B. Click Find or press Enter. System retrieves the details of the specified player card number alone.

STEP 3. Select required session by clicking Choose link. System displays Session Details section. NOTE: If the player card gets struck in the iVIEW device and if the player does not report to the cage, the session job monitor detects this fault and suspends the corresponding player session that is opened. Then the session balances go to the player main account. Player gets the balances on inserting the card into another device.

Close Active Player Session

When the player finds that there is discrepancy in the functioning of iVIEW device, that is, when the iVIEW crashes, the player can collect the cash winnings from cage. The casino employee inspects the transaction and session corresponding to the player card number and, manually closes the corresponding suspended transaction and sessions, end the game. Then the winnings are debited to the player's main account.

Purpose: To close the suspended player sessions.

Procedure: Follow these steps to close the player session.

STEP 1. From the Live Rewards Management menu, go to Player Management submenu and select Active Player Sessions. System displays list of all the player sessions whose status is 'open'.

STEP 2. Optionally, do the following

A. Type Player Card Number in Search By Player Card# field to view the session details of a particular player.

B. Click Find or press Enter. System retrieves the details of the specified player card number alone.

STEP 3. Select required session by clicking Choose link. System displays Session Details section.

STEP 4. Click Close Session. System suspends the session and you see the confirmation message as 'Session Closed'. NOTE: Any withdrawals, open games, and hand pays may be cleared before closing a session.

Figure 26A:
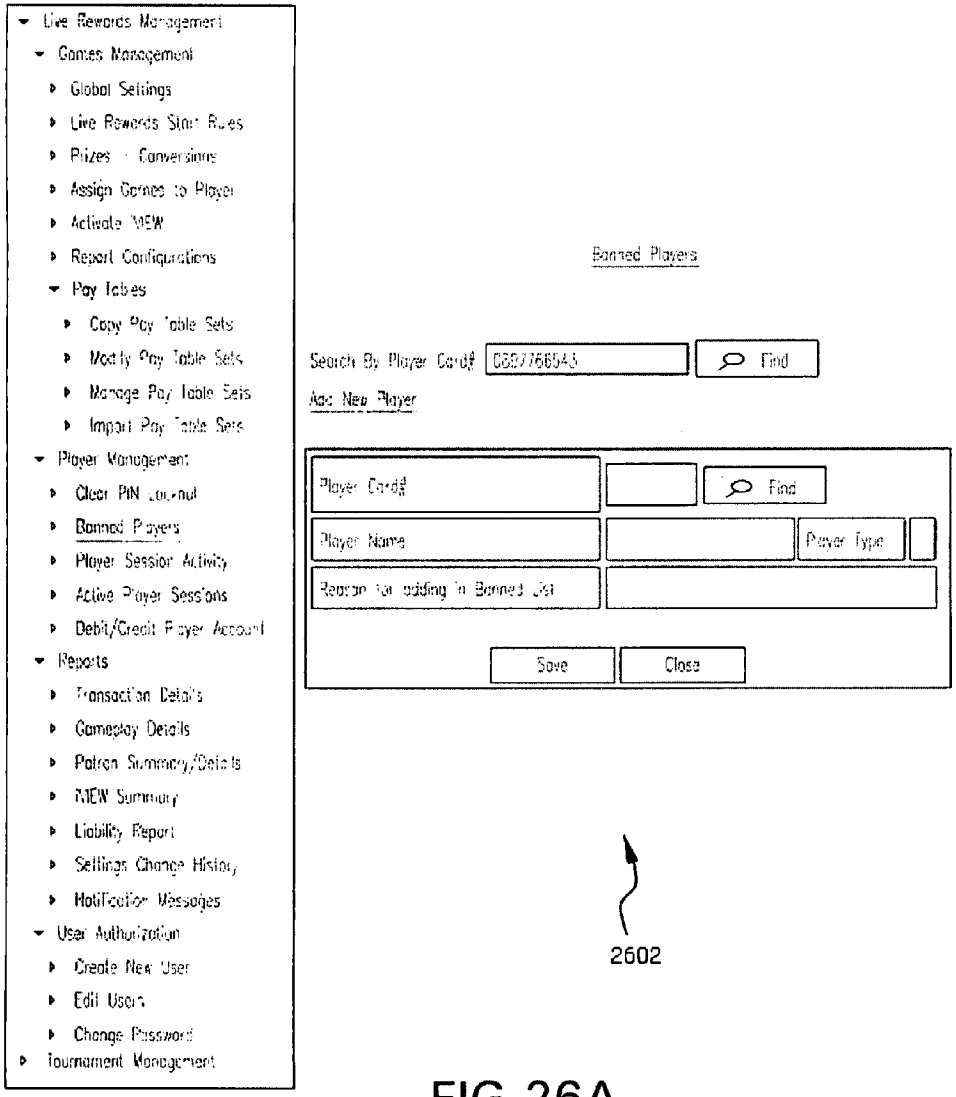

Referring to FIG. 26, a Banned Players panel 2600 is shown such as may be displayed on an Operator Control Console, such as a Bally Control Panel, connected to a server network, such as a Bally SMS & CMS. A closeup view of the banned players panel 2602 is shown in FIG. 26A. The operator control console may comprise a conventional personal computer with coding implemented to execute various processes associated with the network servers and gaming machines. The Banned Players panel may include fields for a Search by Player Card Number, Add New Player, Player Card Number, Player Name, Player Type, Reason for adding in Banned List. The Add New Player field provides fields for entering the player information of a banned player not previously listed in the associated database.

Forbidding Players

If the player is violating or abusing any casino policies, promotions or privileges according to the agreement laid between the casino and the Player, then a database may be created to list banned players from playing Live Rewards games. Any user with player management permissions can ban the player. If a player inserts a player card then the Live Rewards server is checked for a banned player flag being set. If so then the player is blocked from playing Live Rewards games entirely.

Procedure: Follow these steps to ban the player.

STEP 1. From the Live Rewards Management menu, go to Player Management submenu and select Banned Players. System displays the list of all banned players.

STEP 2. Click Add New Player link. System displays a section.

STEP 3. Type Player Card Number (May be mandatory).

STEP 4. Click Find. System displays Player Name and Player Type in the respective fields. This allows the user to verify that the correct player is being banned.

STEP 5. Type reason for banning the player in Reason for adding in Banned List field (May be mandatory).

STEP 6. Click Save. System saves the record after validating the specified Player Card Number and displays the confirmation message as shown below. If the specified Player Card Number is not found in the LRS application which is connected to the casino's CMS/CMP application, then the system displays an error message as shown below.

STEP 7. Optionally, click Close to close the Add New Player section.

Querying a Banned Player

Procedure: Follow these steps to find a player and its details in the banned player list.

STEP 1. From the Live Rewards Management menu, go to Player Management submenu and select Banned Players. System displays the list of all banned players.

STEP 2. Type Player Card Number in Search By Player Card# (This may be a mandatory input).

STEP 3. Click Find. System displays the details of the banned player as shown below.

Permitting the Prohibited Players

Purpose: To allow the banned players to play the Live Rewards games. Any user (casino staff) logged in to the application can do this task.

Procedure: Follow these steps to remove the player from banned list.

STEP 1. From the Live Rewards Management menu, go to Player Management submenu and select Banned Players.

STEP 2. Type Player Card Number in Search By Player Card# (This may be a mandatory input).

STEP 3. Click Find. System displays the details of the banned player in grids.

STEP 4. Click Remove Player link. System displays the selected Player Card# in a section.

STEP 5. Type reason for removing the player from the list of banned players in Reason for deleting from Banned List field (This may be a mandatory input).

STEP 6. Click Remove Player. System removes the player from the banned list and displays the confirmation message as shown below.

STEP 7. Optionally, click Close to close the Remove Player section.

Figure 27A:
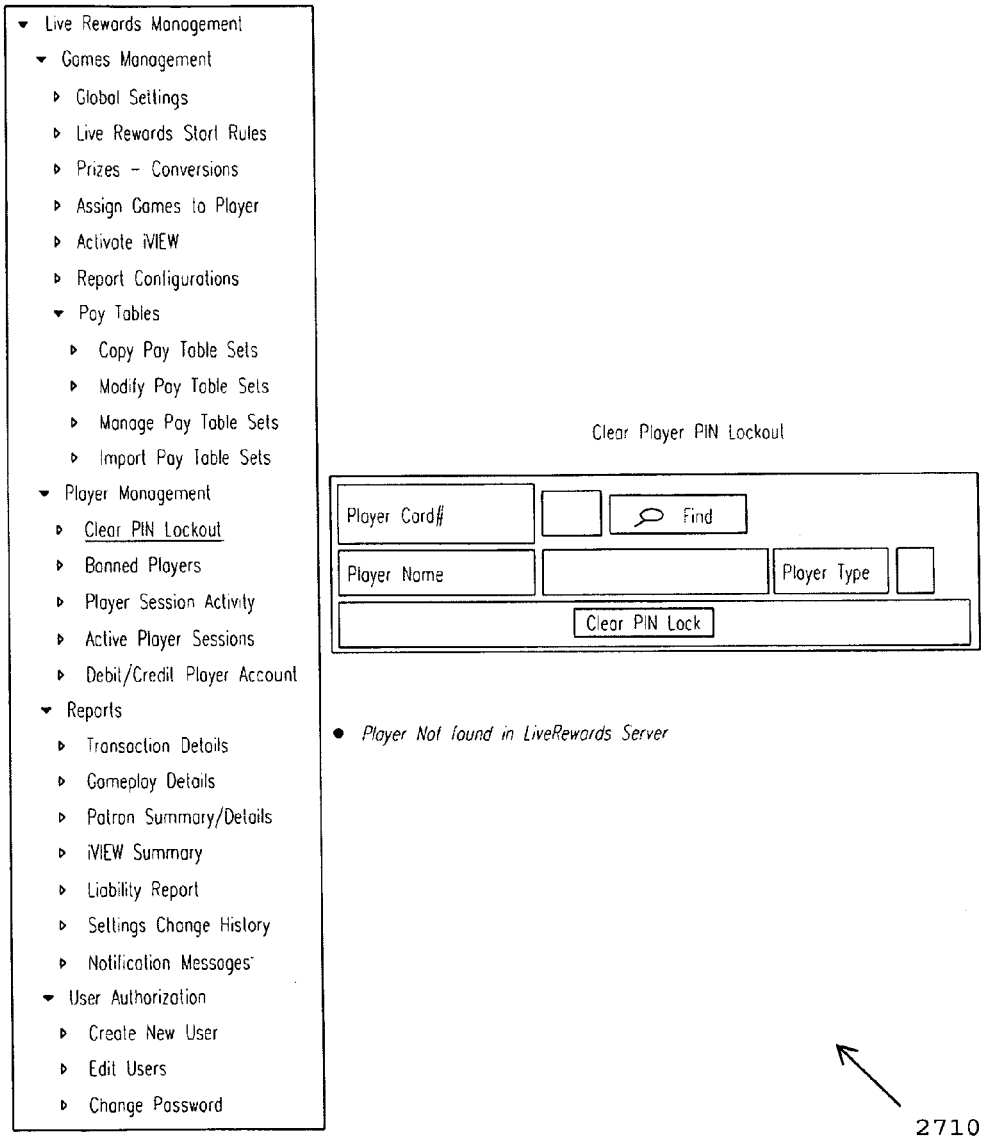

Referring to FIG. 27, a Clear Player PIN Lockout panel 2700 is shown such as may be displayed on an Operator Control Console, such as a Bally Control Panel, connected to a server network, such as a Bally SMS & CMS. FIG. 27A illustrates a closeup view of panel 2710. The operator control console may comprise a conventional personal computer with coding implemented to execute various processes associated with the network servers and gaming machines. The Clear Player PIN Lockout panel may include fields for a Enter Player Card Number, Player Name, and Clear PIN Lock. The Enter Player Card Number field provides an input area for entering a card number and a Find field for sending a request to search the database for the Player Name and Player Type. Upon locating the player, the Clear PIN Lock field may be activated to clear the player lockout.

Clear PIN Lockout

Purpose: If the player enters an incorrect PIN multiple times and exceeds the limit set in the global settings, the player's account is locked for a time period. With the "Clear PIN Lockout" screen, you can unlock the player's account by allowing them to try again.

Procedure: Follow these steps to unlock the player's account.

STEP 1. From the Live Rewards Management menu, go to Player Management submenu and select Clear PIN Lockout.

STEP 2. Type player card number in Enter Player Card# field (May be mandatory).

STEP 3. Click Find. System displays Player Name and Player Type in the respective fields If the specified Player's account is locked, only then the Clear PIN Lock is enabled. Plus, system displays an notification message as "Player Not Locked".

STEP 4. Click Clear PIN Lock. System unlocks the specified player's account and displays a confirmation message.

Figure 28:
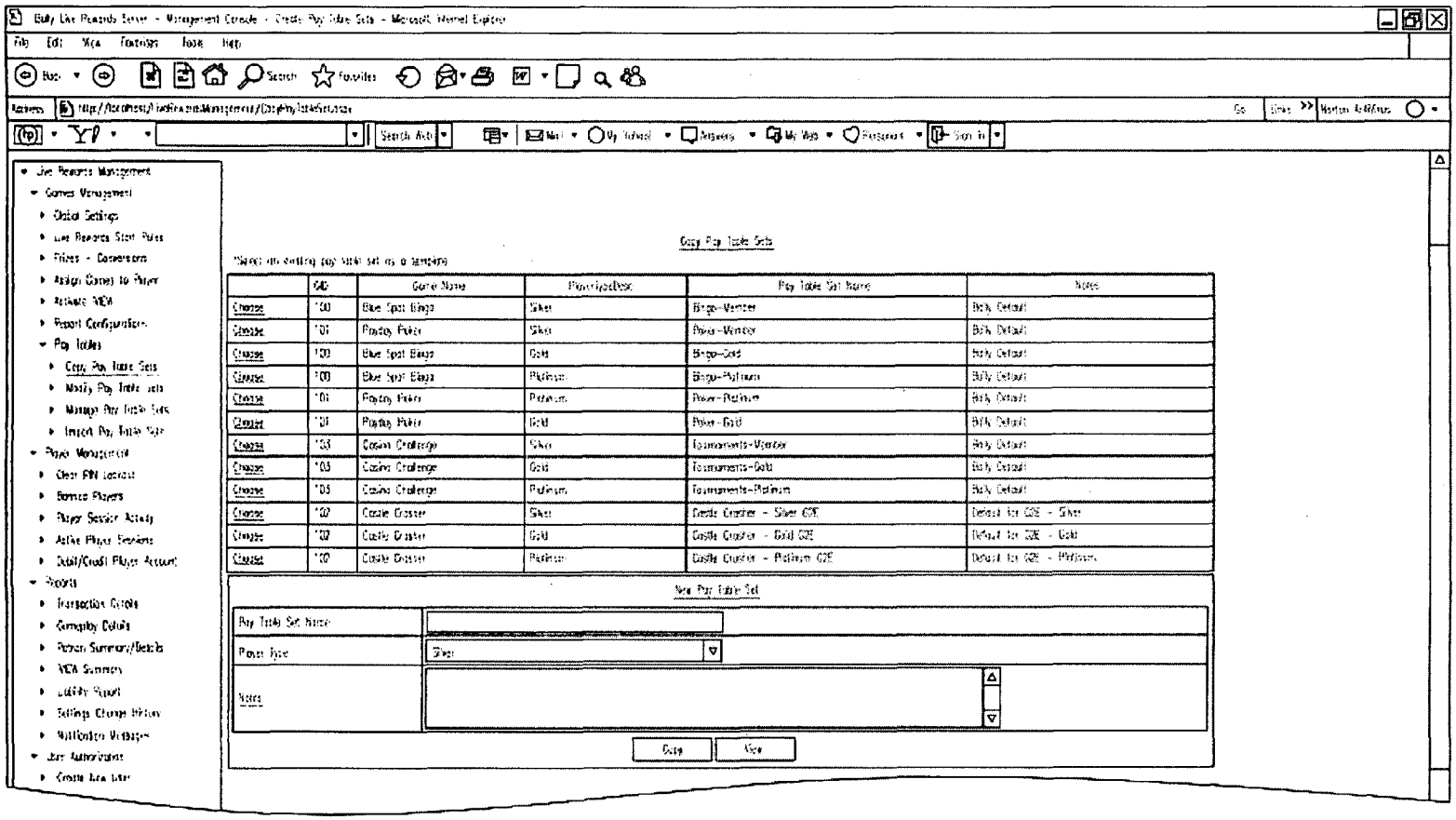

Referring to FIG. 28, a Copy Pay Table Sets panel 2800 is shown such as may be displayed on an Operator Control Console, such as a Bally Control Panel, connected to a server network, such as a Bally SMS & CMS. A closeup view of the pay table sets panel 2802 is shown in FIG. 28A. The operator control console may comprise a conventional personal computer with coding implemented to execute various processes associated with the network servers and gaming machines. The Copy Pay Table Sets panel may include fields for a Choose, Game ID, Game Name, Player Type, Pay Table Set Name, Notes, Copy, View and a New Pay Table Set area including fields for Pay Table Set Name, Player Type, Notes. By selecting the Choose field the associated Pay Table Set Name may populate the New Pay Table Set. The Player Type may be selected for the New Pay Table Set.

Copying Pay Table Sets

Purpose: To copy the existing Pay table set as a template, so you can alter and assign it according to your current requirements.

Procedure: Follow these steps to copy Pay table set.

STEP 1. From the Live Rewards Management menu, go to Play Tables submenu and select Copy Pay Table Sets. The system displays all the existing Pay table sets. (Following is the list of fields and their description for the Copy Pay Table Sets screen.)

STEP 2. Click Choose to select a Pay table set. The system displays Pay Table Set Name, Player Type and Notes in the New Pay Table Set section.

STEP 3. Type the new Pay table Set Name [Mandatory]. This should be unique. The maximum length is 30 characters (including spaces and special characters).

STEP 4. Select your required Player Type from the drop-down list.

Figure 29A:
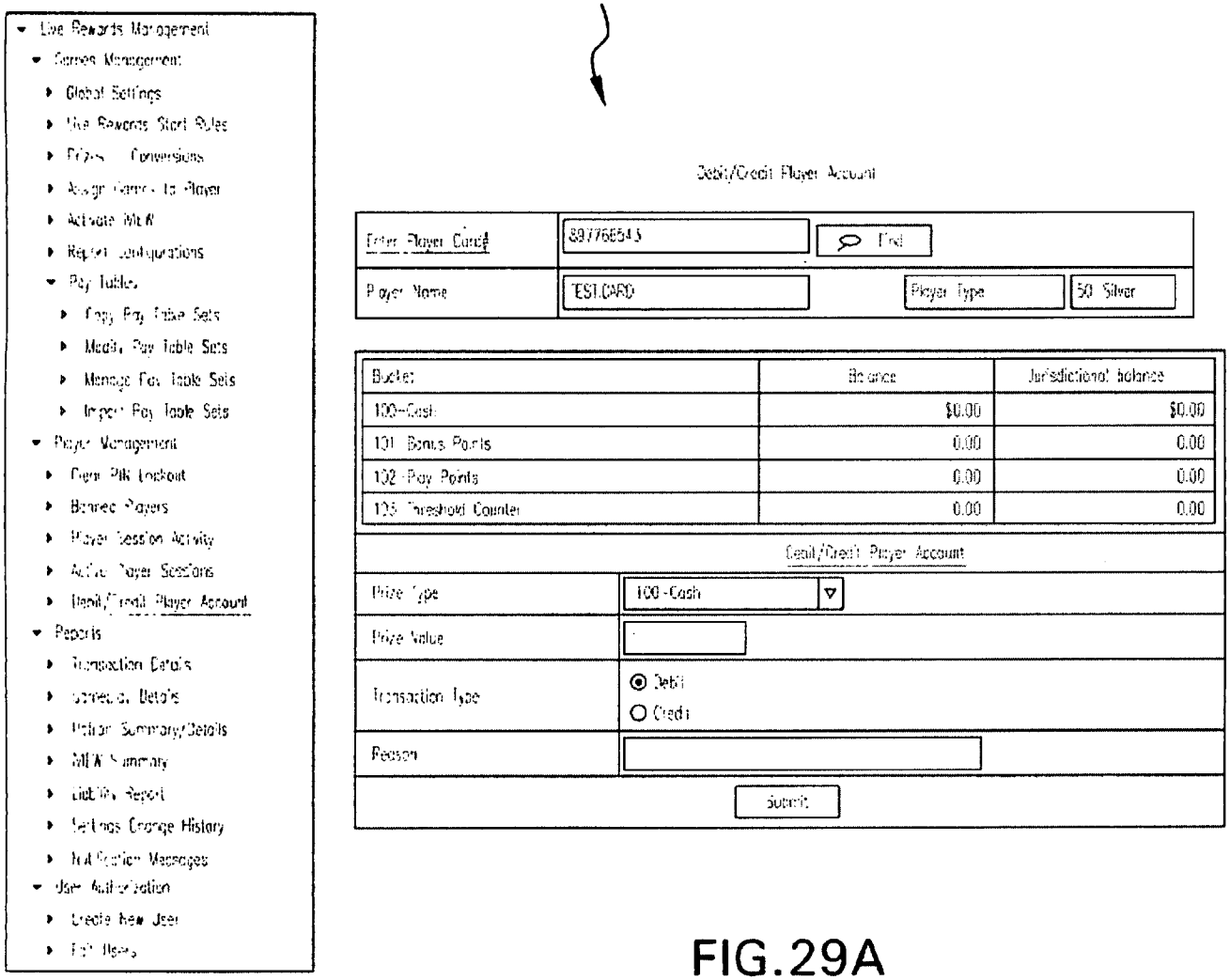

Referring to FIG. 29, a Debit/Credit Player Account panel 2900 is shown such as may be displayed on an Operator Control Console, such as a Bally Control Panel, connected to a server network, such as a Bally SMS & CMS. A closeup view of the debit/credit player account panel 2902 is shown in FIG. 29A. The operator control console may comprise a conventional personal computer with coding implemented to execute various processes associated with the network servers and gaming machines. The Debit/Credit Player Account panel may include fields for an Enter Player Card Number, Player Name, Player Type, Bucket, Balance, Jurisdictional Balance, Debit/Credit Player Account, Prize Type, Prize Value, Transaction Type, Reason, and Submit.

Debiting/Crediting Player Account

Purpose: If the casino wants to give promotions to their players, they can credit the winnings (cash or bonus), play points and threshold counter to the player account. Plus, you can also use this application to manage the players account in case of any discrepancy in the iVIEW devices.

Procedure: Follow these steps to debit/credit the player account.

STEP 1. From the Live Rewards Management menu, go to Player Management submenu and select Debit/Credit Player Account.

STEP 2. Type Player Card Number in Enter Player Card# (May be mandatory).

STEP 3. Click Find or press Enter. System displays Player Name, Player Type and the player bucket details along with Jurisdictional balance in the respective fields.

STEP 4. By default, the system selects the Cash Prize Type. However, select required Prize Type from the drop-down list.

STEP 5. Type Prize Value (Mandatory). This may be a numeric value and there is no need to input any currency sign.

STEP 6. By default, system selects transaction type as 'Debit'. However, select required Transaction Type option. NOTE: The system displays an error message as "Player Notfound in Live Rewards Server" if the specified player card number is not found in the LRS, which in turn checks with casino management system.

A casino may decide to give a player free Live Rewards games without any wagering whatsoever. At registration or other time that the casino sees fit they may credit enough Play Points and Threshold counter points into the player account to enable these free bonus games at the iVIEW or other game play device.

Figure 30:
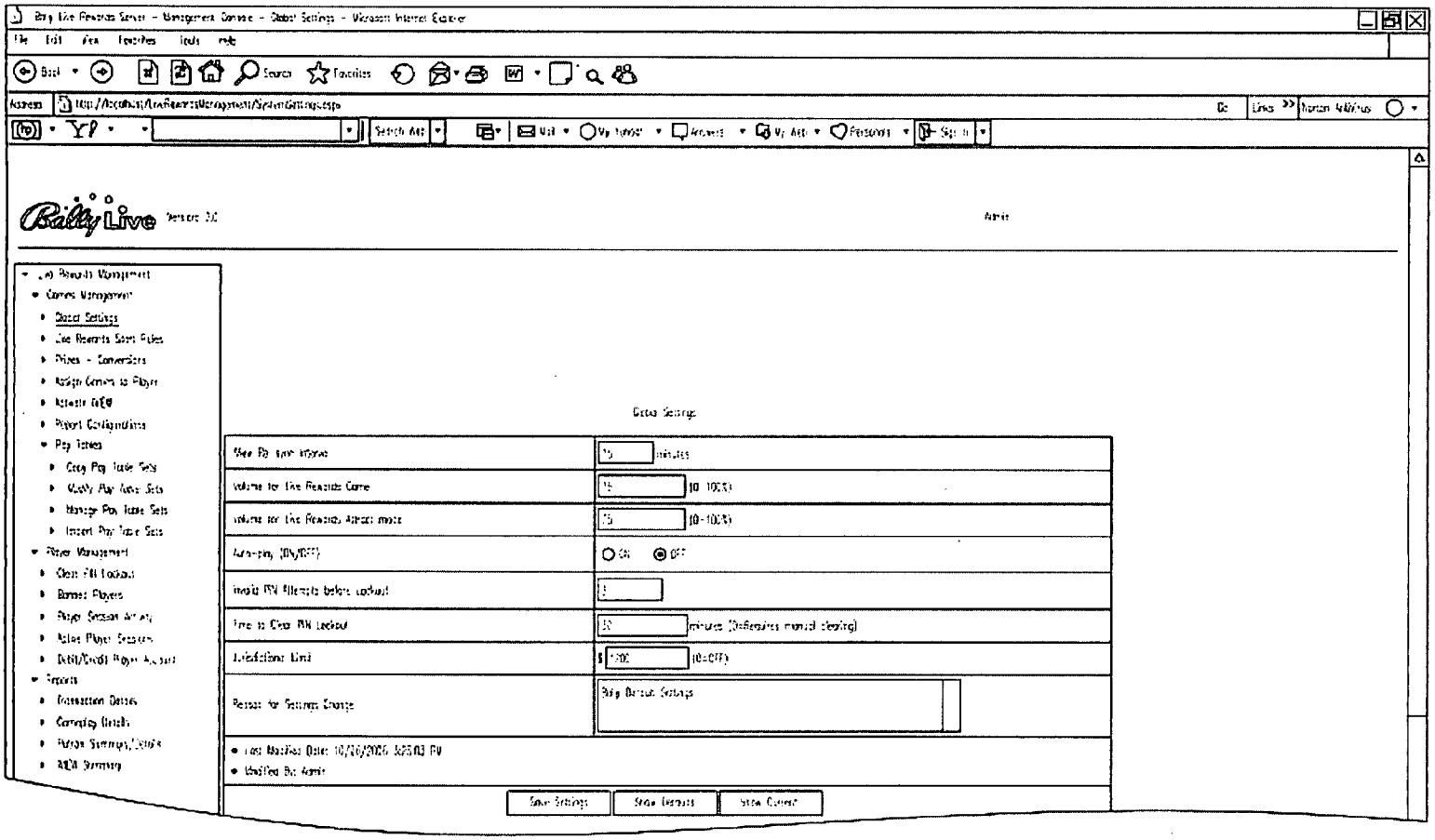
FIGS. 30, 30A (collectively referred to as FIG. 30) illustrate a pair of screenshots of the Live Rewards Server Global Settings feature. Various variables are configured here and these settings are sent to the iVIEW for use.
Figure 30A:
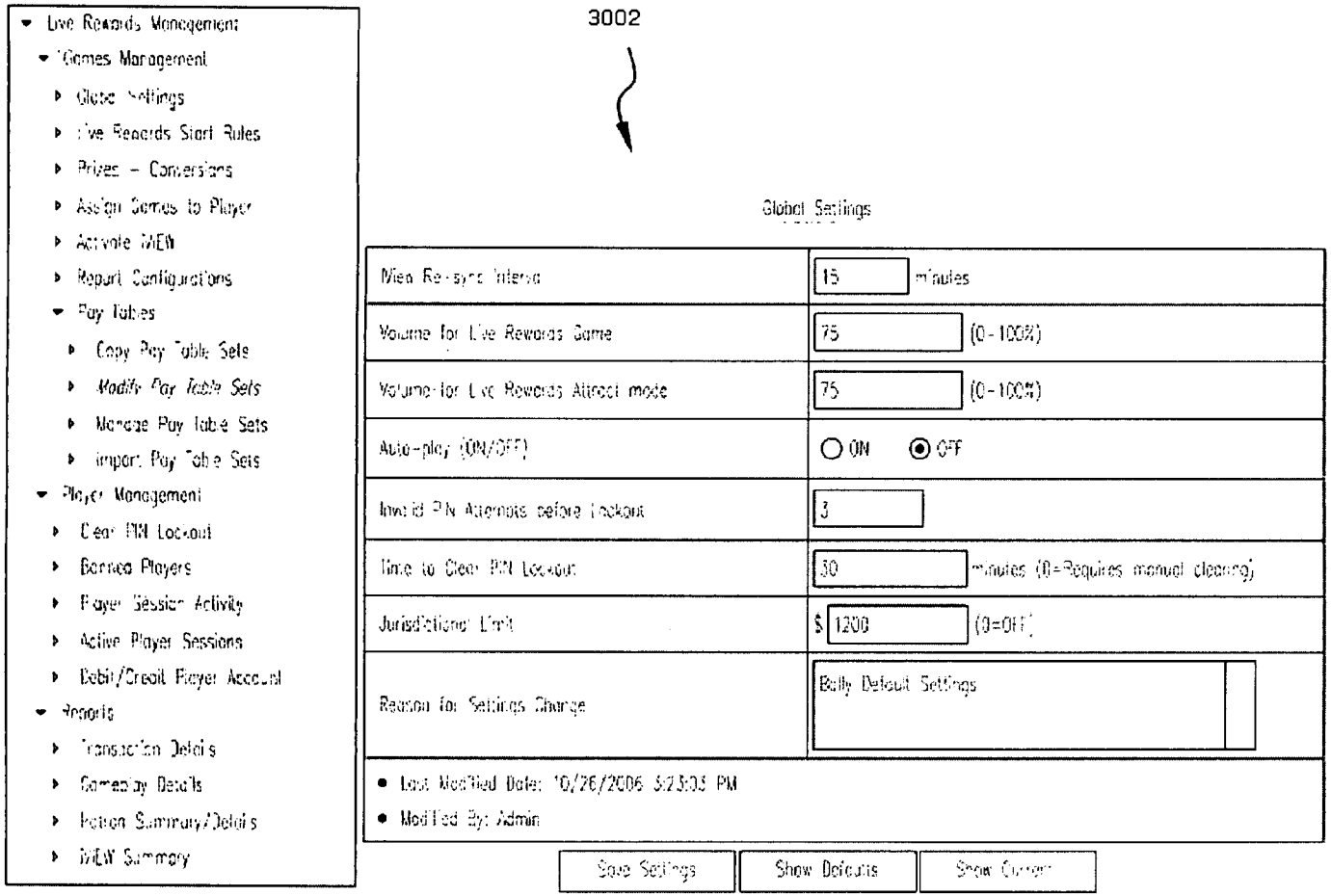

Referring to FIG. 30, a Global Settings panel 3000 is shown such as may be displayed on an Operator Control Console, such as a Bally Control Panel, connected to a server network, such as a Bally SMS & CMS. A closeup view of the global settings panel 3002 is shown in FIG. 30A. The operator control console may comprise a conventional personal computer with coding implemented to execute various processes associated with the network servers and gaming machines. The Global Settings panel may include fields for an iView Re-sync Interval, Volume for Live Rewards Game, Volume for Live Rewards Attract mode, Auto-play (On/Off), Invalid PIN Attempts before Lockout, Time to Clear PIN Lockout, Jurisdiction Limit, Reason for Settings Change, Last Modified Date, Modified By, Save Settings, Show Defaults, and Show Current.

Global Settings

Live Rewards game functions based on the global settings. The global settings affect all iVIEW devices on a casino floor.

To View Default Global Settings

Procedure: Follow these steps to view the's default global Live Rewards settings.

STEP 1. From the Live Rewards Management menu, go to Games Management submenu and select Global Settings. For regulatory purposes, two Administrators, typically managers having administrative rights, are required to log on to access Games Management submenu and its options.

Set Up Global Settings

Purpose: To view current global settings information and revise global options, use the Global Settings screen. Two Administrator (Admin) users may be logged in to change the global settings.

With this screen you can:

View global settings of the Live Rewards.

Set re-sync time interval, so that iVIEW connects to the LRS after every re-sync interval specified and updates the global settings.

Set speakers volume on iVIEW for attracting players to Live Rewards.

Set speakers volume on iVIEW for game related announcements.

Set invalid PIN attempts, for the number of times a player can enter an incorrect PIN (within the time limit) before the system locks the player's account.

Set time to unlock the Player's PIN giving them a chance to try again.

Set the Jurisdiction limits for the winning amount. A player whose winnings exceeds this value requires a hand payout.

Procedure: Follow these steps to set the global settings.

STEP 1. From the Live Rewards Management menu, go to Games Management submenu and select Global Settings.

STEP 2. Type required re-sync interval (in minutes) in iVIEW Re-Sync Interval field, so that iVIEW connects to the LRS after every re-sync interval specified and downloads these global settings to it (may be mandatory). The default time is 15 minutes. However, this can be set between 0 to 999 minutes (approximately 16 hours 39 minutes).

STEP 3. Type required percentage of volume of the speakers on the analog potentiometers on the iVIEW audio mixer/amplifier board in Volume for Live Rewards Game field for the different types of Live Rewards game (may be mandatory). The minimum percentage is zero and maximum percentage is 100.

STEP 4. Type required percentage of volume of the speakers on the iVIEW in Volume for Live Rewards Attract mode field to attract the players towards Live Rewards game (may be mandatory).

For example, when there are no players on the slot machines, to attract them to the Live Rewards game, some game movie with sounds is played on iVIEW device. The minimum percentage is zero and maximum percentage is 100.

STEP 5. Select Auto-play by clicking the required radio buttons (ON/OFF). If you set Auto-play to ON, iVIEW starts a Live Rewards game automatically for the player once the player accrues the required play points. If the player interacts with the iVIEW player interface in any way, autoplay is deactivated for the remainder of the player session.

STEP 6. Type maximum number of attempts the player can try entering the PIN number in Invalid PIN Attempts before Lockout field before the system locks the player's account (may be mandatory). This may be a numeric value between 0 to 9999. The system prompts for the player's PIN number before transferring cash winnings to the slot machine.

STEP 7. Type time to clear the locked player account in Time to Clear PIN Lockout field (may be mandatory). This is a numeric value between 0 to 999 minutes (approximately 16 hours 39 minutes).

STEP 8. Type Jurisdiction Limit (in dollars). The jurisdiction limit may be set between 0 to 9999 dollars. This is for submitting tax to the government from the players whose combined value of applicable awards for any single game win is over this specified limit for any Live Rewards games.

STEP 9. Type reason for changing the settings in Reason for Settings Change field (may be mandatory). This can be a alphanumeric value of 50 characters including special characters. NOTE: If you specify zero in Time to Clear PIN Lockout field, then the locked account can only be cleared manually. NOTE: The minimum value is 'Zero' and the default value is '$1200'. These global settings are affected only when the iVIEW next connects to the server after the elapse of current re-sync interval and the iVIEW device goes to Attract mode state. After the elapse, system does the following:

Updates the Last Modification Date as current date and time.

Updates the Modified by as logged in User ID.

iVIEW downloads these global settings from LRS after every re-sync interval specified and updates it accordingly. NOTE: Player accounts are maintained in the LRS. If the player wins an award that exceeds the Jurisdictional Limit the Base Game does not tilt. The player has the option to collect the award at their leisure. When a Player opts to collect a Jackpot, player is instructed to press the service button and await a casino employee.

To View Current Global Settings

Procedure: Follow these steps to view the current global Live Rewards settings.

STEP 1. From the Live Rewards Management menu, go to Games Management submenu and select Global Settings.

STEP 2. Click Show Current. System displays the current global settings, which is in function for all iVIEWs across the casino floor as shown below. These settings are in effect for all iVIEWs on the casino floor.

Figure 31:
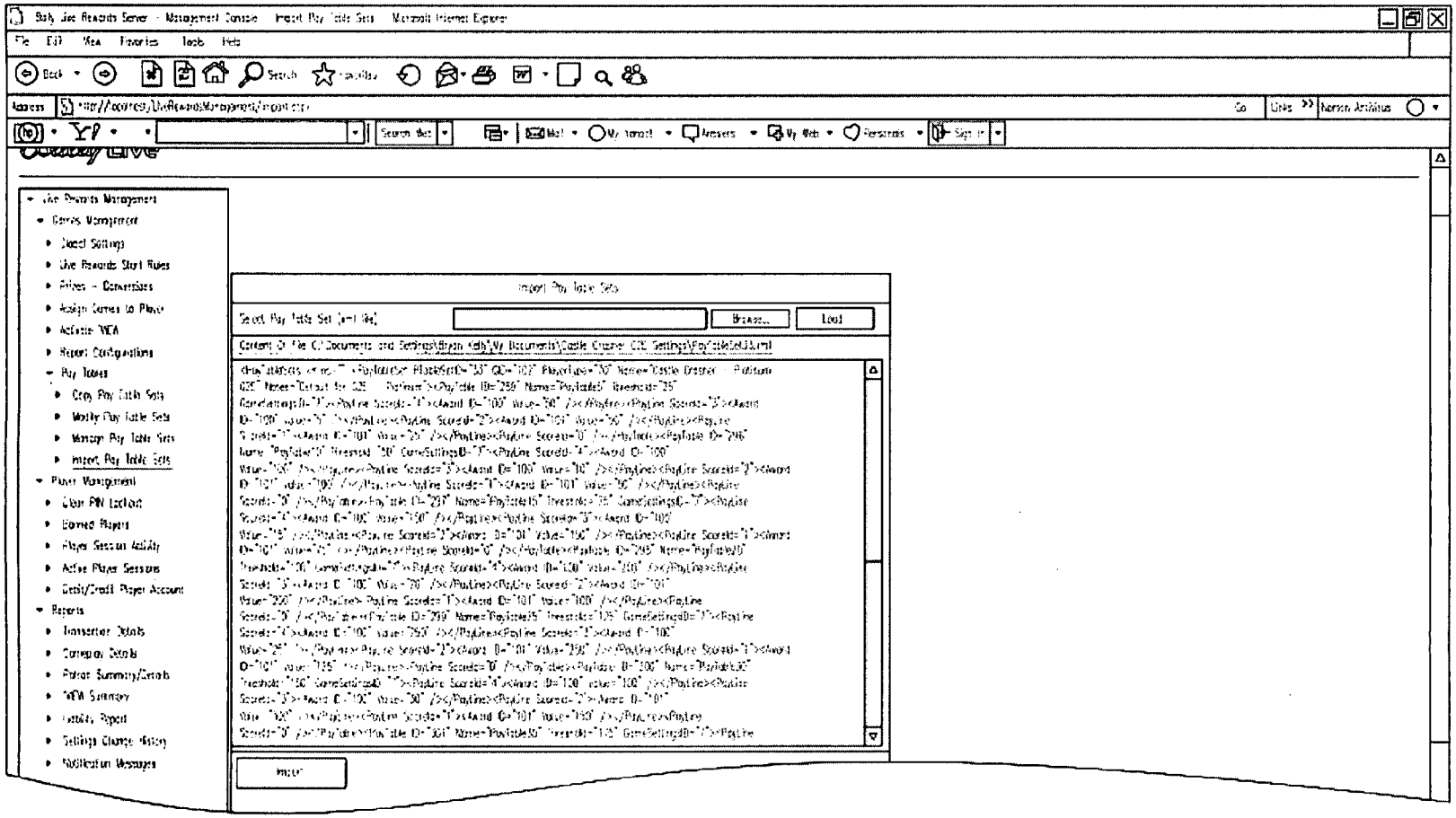
FIGS. 31, 31A (collectively referred to as FIG. 31) illustrate a pair of screenshots of the Live Rewards Server Import Pay Table Sets feature. This allows casino personnel to import different pay tables for a particular game ID. The files are in XML format.
Figure 31A:
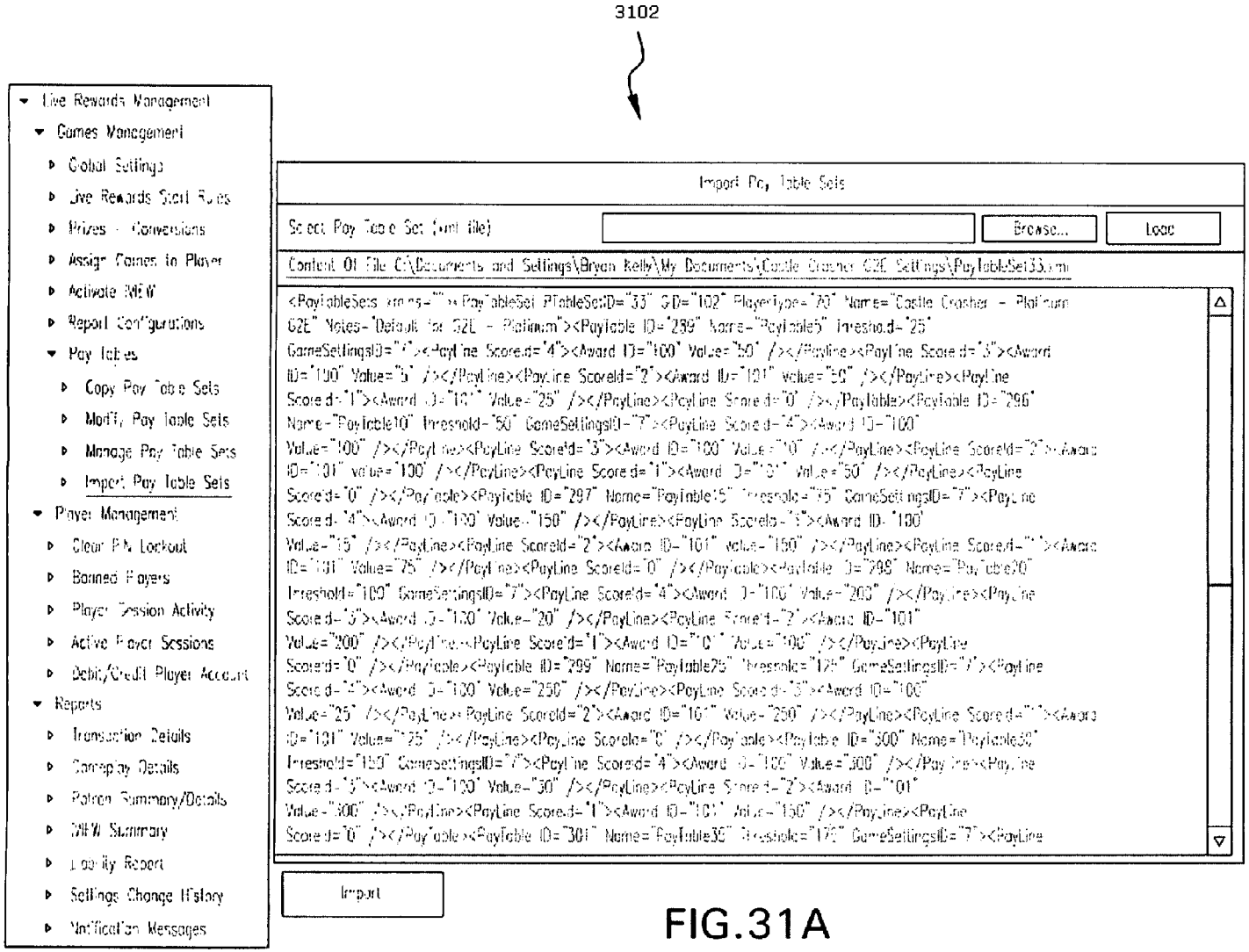

Referring to FIG. 31, an Import Pay Table Sets panel 3100 is shown such as may be displayed on an Operator Control Console, such as a Bally Control Panel, connected to a server network, such as a Bally SMS & CMS. A closeup view of the import pay table sets panel 3102 is shown in FIG. 31A. The operator control console may comprise a conventional personal computer with coding implemented to execute various processes associated with the network servers and gaming machines. The Import Pay Table Sets panel may include fields for a Select Pay Table Set, Browse, Load, and Import. The Select Pay Table Set field provides a field for entering a paytable file. The Browse field enables a user to browse accessible files and directories to locate a particular pay table file. The Load field is activatable upon locating a file to upload the located pay table file. The Import field may be used to Import the identified pay table file to a pay table database.

Figure 32A:
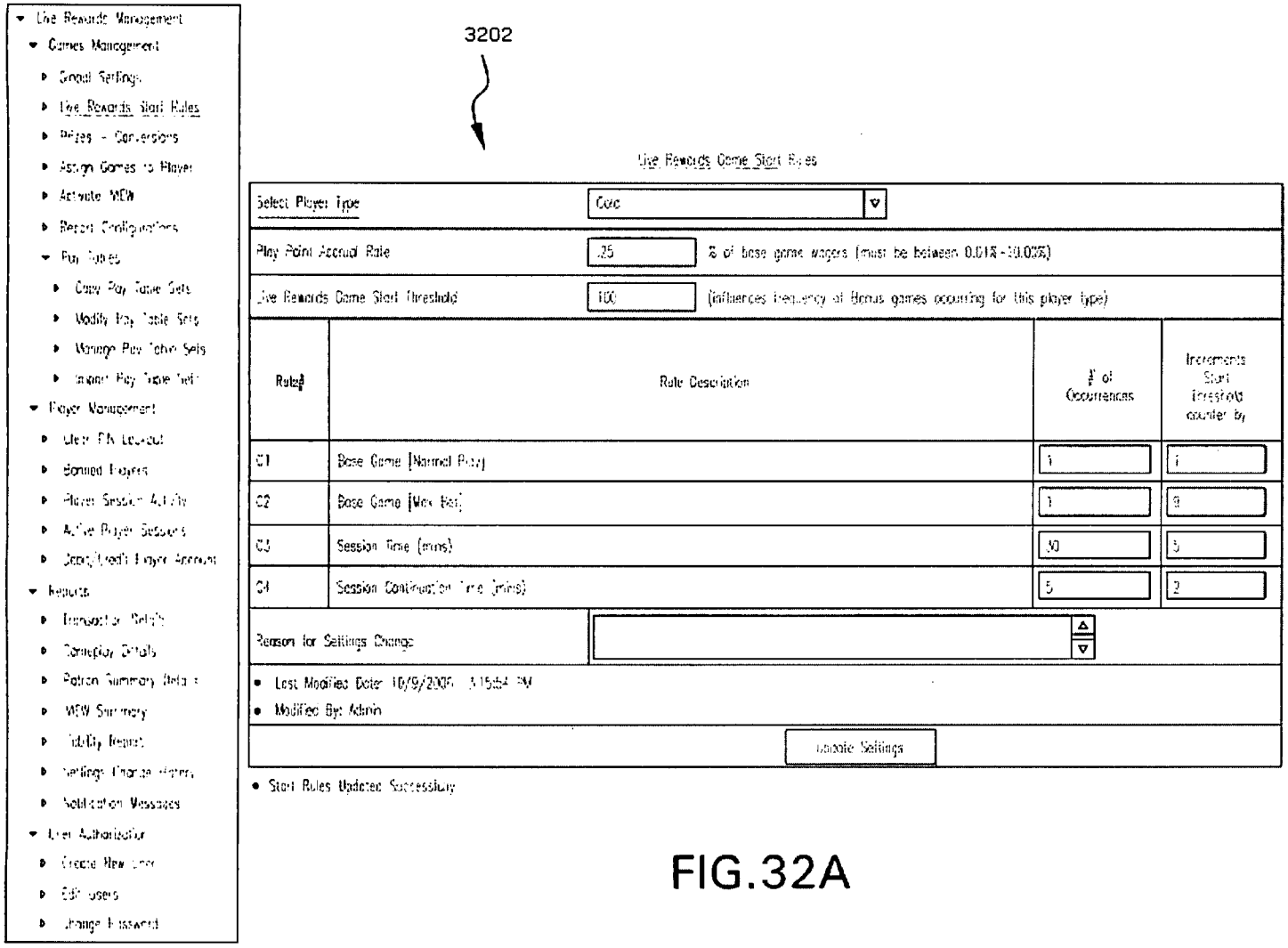

Referring to FIG. 32, a Customize—Bonus Game Frequency panel 3200 is shown such as may be displayed on an Operator Control Console, such as a Bally Control Panel, connected to a server network, such as a Bally SMS & CMS. A closeup view of the live rewards game start rules panel 3202 (an instance of a customization panel 3200) is shown in FIG. 32A. The operator control console may comprise a conventional personal computer with coding implemented to execute various processes associated with the network servers and gaming machines. The Customize—Bonus Game Frequency panel may include fields for a Live Rewards Game Start Rules, Select Player Type, Play Point Accrual Rate, Liverewards Game Start Threshold, Rule Number, Rule Description, Number of Occurrences, Increments Start Threshold Counter By Selected Number of Units, Reasons for Settings Change, Last Modified Date, Modified By, Update Settings, and Start Rules Updated Successfully. Associated with the Select Player Type field may be a selectable area for choosing a player type, such as Silver, Gold, Platinum. Associated with the Play Point Accrual Rate may be an editable field for inserting a number, such as 0.25, where the number may be selected between 0.01-10% of base game wagers. The Live Rewards Game Start Threshold may include an editable field for inserting a number, such as 100, to influence the frequency of Bonus games occurring for this player type.

Set Up the Rules for Accessing Live Rewards

Live Rewards is a Marketing tool. Only if you play the base games you can get the Live Rewards game. This is basically for promotion to increase the revenue for the base games. The more you bet, more the chances for getting the Live Rewards game.

Purpose: To set up the conditions for accessing/playing the Live Rewards game on iVIEW device. These conditions are set for each player type. This allows the casino to determine how often a player plays a Live rewards game and how fast the player earns Play Points. Two Administrator (Admin) users may be logged in to set the rules for accessing Live Rewards game.

Procedure: Follow these steps to set up the rules.

STEP 1. From the Live Rewards Management menu, go to Games Management submenu and select Live Rewards Start Rules.

STEP 2. Select Player Type from Select Player Type drop-down list.

STEP 3. Type accrual rate (in percentage, Mandatory) of base game wagers in Play Point Accrual Rate. This can be within 0.01% to 10.00%. Accrual Rate is the percentage of base game played to be accumulated as play points. For example, if you bet 100 dollars in slot game and the accrual rate is set as 0.25%, then, Play Points=$100×0.0025/$0.01=25. You accrue 25 play points.

STEP 4. Type Live Rewards Game Start Threshold (Mandatory). This may be a numeric value greater than zero. System Game start threshold is a counter to access a Live Rewards. This allows to set the length of time between Live Reward games.

For example, if you have accrued 25 threshold counters by playing base game and the threshold is set to 75, then you may have to accrue 50 more threshold counters to access Live Rewards. The threshold counter for the player increases based on the rules defined in the Rule Table (see below). These rules determine how the player earns Threshold Counters. The table below explains these Rules:

| Rule Number | Rule Description | Explanation |
|---|---|---|
| 01 | Base Game [Normal Play] | A single play on the slot machine for any wager amount. This is when you hit the Spin button on a slot machine. |
| 02 | Base Game [Max Bet] | For a maximum wager, when you hit the Maximum button on the slot machine or manually max out the bet on a base game and initiate play. |
| 03 | Session Time | If you play the base game for a length of time, for example 30 minutes. |
| 04 | Session Continuation Time (in minutes) | If you continue to play the base game more than a session, for example 5 minutes. |

STEP 5. For the rules 1 to 4 in the Rule Table, do the following

A. Type required number of occurrences for the corresponding rule in # of Occurrences column. This should be a numeric value and the minimum is zero. This may be a numeric value greater than or equal to zero. Setting a value to zero means that this rule may not be in effect.

B. Type required number of threshold counters that gets added to player account in Increments Start Threshold counter by field. This should be a numeric value and the minimum is zero. This may be a numeric value greater than or equal to zero.

For example: If base game, "Normal Play" and "Max Bet" both have the # of Occurrences set to 1 and they both have the increments counter by value set to 1, then:

If the player places a Normal bet they may receive 1 threshold counter.

If they made a Max bet they would receive 2 total counters, 1 for the normal bet and 1 for the max bet.

STEP 6. For regulatory purposes, type Reason for Settings Change (May be mandatory).

STEP 7. Click Update Settings. System updates the settings and confirms the same by displaying the message as shown below. These start rules settings are affected only when the iVIEW connects to the server after the elapse of current re-sync interval. After the elapse, system does the following:

Updates the Last Modification Date as current date and time.

Updates the Modified by as logged in User ID.

iVIEW downloads these start rules from the LRS after every re-sync interval specified and updates it accordingly.

Pay tables in the Live Rewards Management Application

Pay tables determine what a player wins for a given outcome of a game. In the Live Rewards, each game is assigned its own Pay table set for each Player's Club level. The Pay table set has many different individual Pay tables within it, which allows the player to spend more play points for a single game for the opportunity to win a greater prize. Pay tables are represented as "Reward Levels" on the Live Rewards game screens.

Each Pay table has several pay levels that define the winning combination of the game. The more the money you bet on base game, more the play points you accrue and richer the Pay table you get. You can have as many Pay table sets as you want in the Live Rewards Server. Provides default Pay table sets for each type of Live Rewards. Later, a Pay table set can be duplicated and altered to meet the requirements. However, the default Pay table cannot be altered. A Pay table set can used by a Live Rewards game, it can be altered.

The Pay table is an XML document containing reward information based on three factors:

Game Name

Pay Table Entry

Game Score

All game Pay tables can be adjusted to suit your requirements. Each game Pay table set is independent of the other. Players playing in dollar machine and penny machine gets the Live Rewards at same time but the player at dollar slot machine gets richer Pay table than the player at penny slot machine. Provides default Pay tables for each type of Live Rewards games. These are imported into the LRS (live rewards server) during installation along with the game settings. It is up to the game designer to decide the winning combinations for the game, to decide different pay levels. So, there can be multiple pay levels and hence the pay lines for a Pay table. Thus, in one or more embodiments, you can change the game by setting up the payout for a game. A user can duplicate and alter these Pay tables for different payouts of the game, but cannot delete or change the defaults.

A Pay table set is a collection of Pay tables. You cannot alter or delete those Pay table sets that have been used for Live Rewards games.

The initial Live Rewards games have 100% Pay tables, as these are directly linked to game play. Statistically and over time, Live Rewards winnings equal the sum of the Play Points wagered on the Live Rewards games (assuming no Play Point expiration and removal from player accounts.)

Two Administrator (Admin) users may be logged on to access the following Pay Tables Menu Options:

Copy Pay Table Sets

Modify Pay Table Sets

Manage Pay Table Sets

Import Pay Table Sets

Generally, the pay levels or winning probabilities for any Pay table may not be changed by a casino operator as there may be regulatory or other concerns. If a casino operator wants to have such changes made then the manufacturer of the system, such a Bally Technologies should be contacted.

Figure 33:
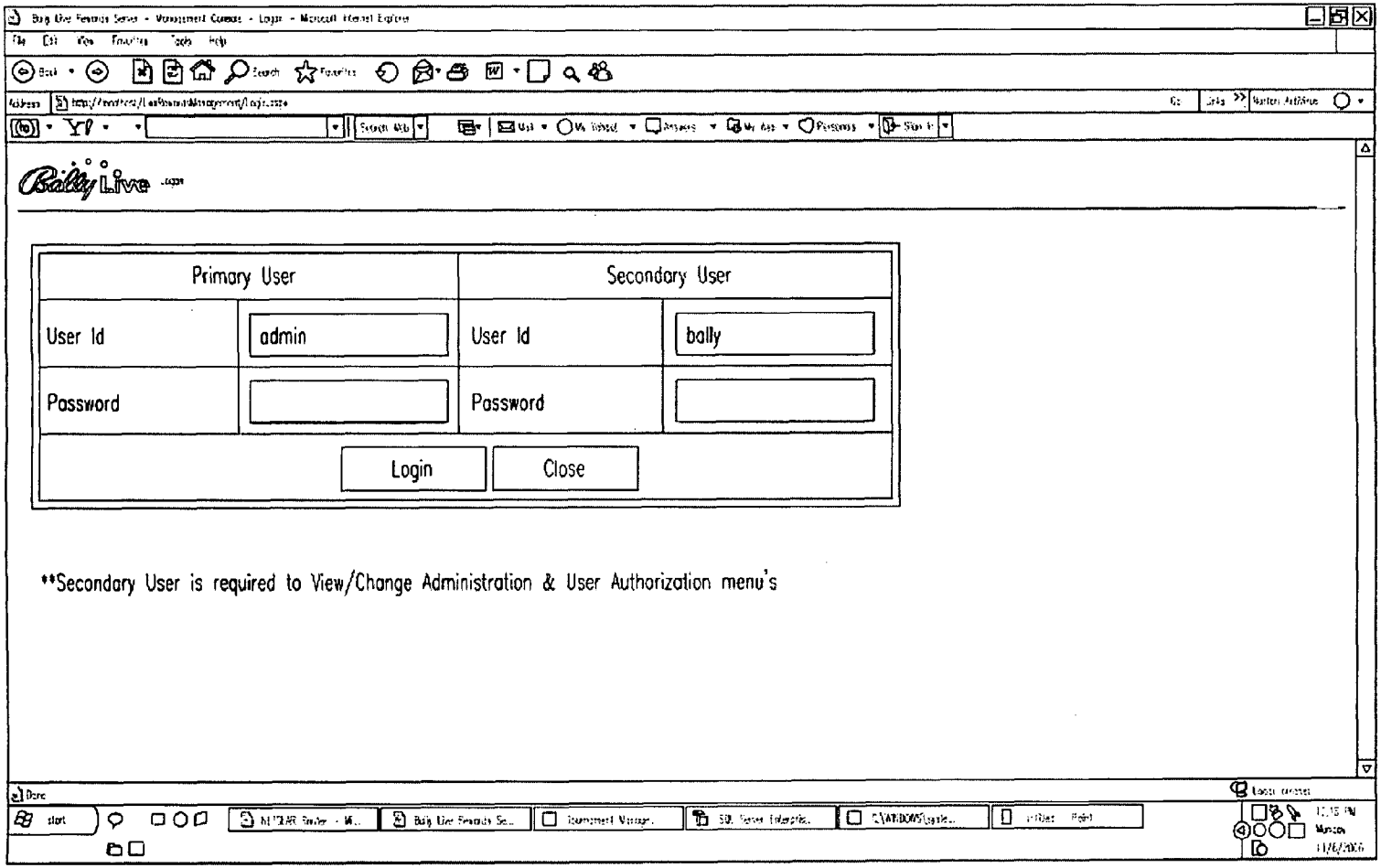
FIG. 33 illustrates a screen shot of the Live Rewards Server login page. Two users with administrator rights are required to modify any settings.

Referring to FIG. 33, a Logon panel 3300 is shown such as may be displayed on an Operator Control Console, such as a Bally Control Panel and/or a Bally Live Rewards Server Management Console, connected to a server network, such as a Bally SMS & CMS. The operator control console may comprise a conventional personal computer with coding implemented to execute various processes associated with the network servers and gaming machines. The Logon panel may include fields for a Primary User and a Secondary User where each field may include an input area for a User ID and Password, and a Login and Close field. A Notice field may further be displayed to provide explanatory information, such as "Secondary User is required to View/Change Administration & User Authorization menus."

Figure 34:
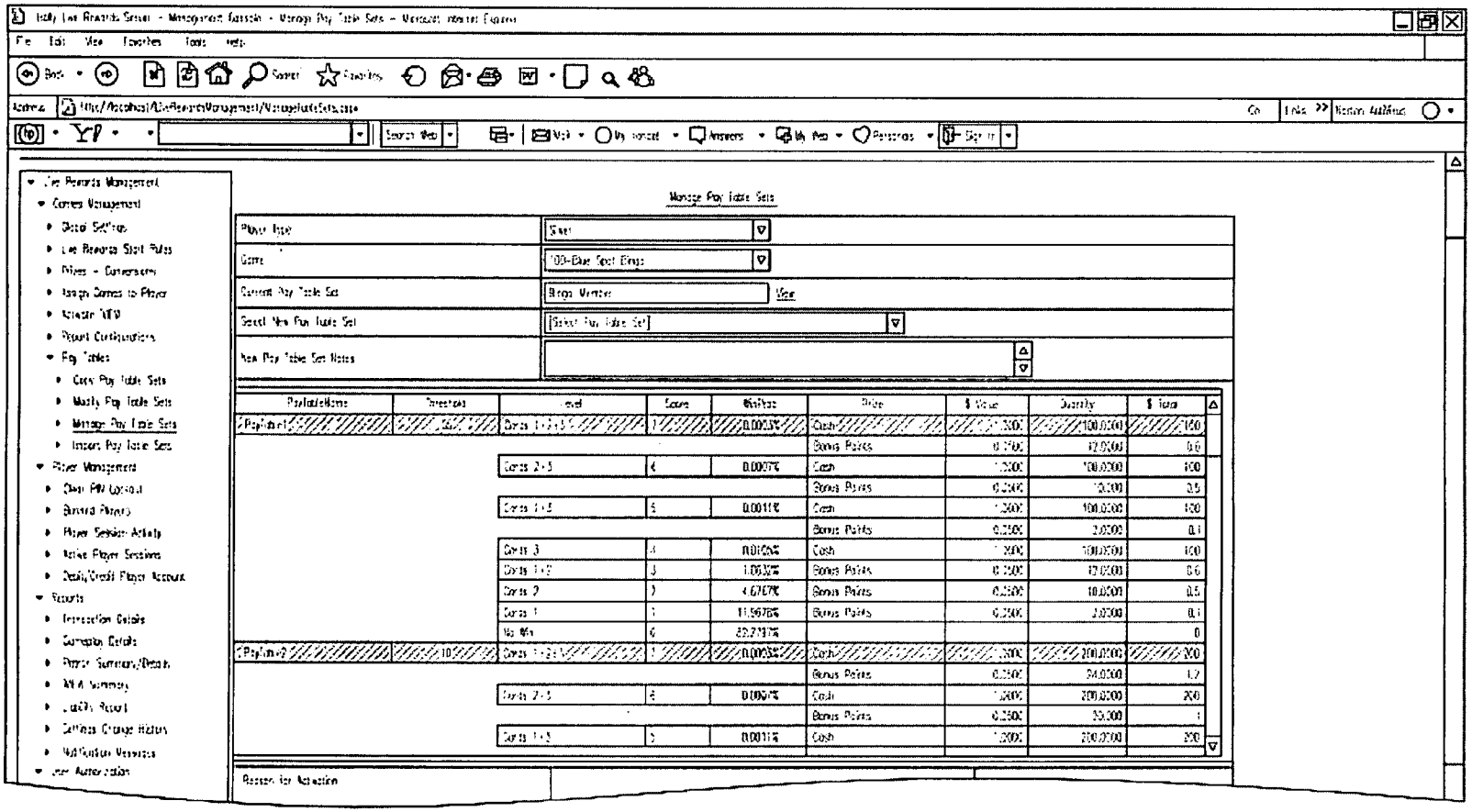
FIGS. 34, 34A (collectively referred to as FIG. 34) illustrate a pair of screenshots of the Live Rewards Server Manage Pay Table Sets feature. This page allows the casino attendant select different pay table sets for specific games for specific play types. This is showing the Blue Spot Bingo being configured.
Figure 34A:
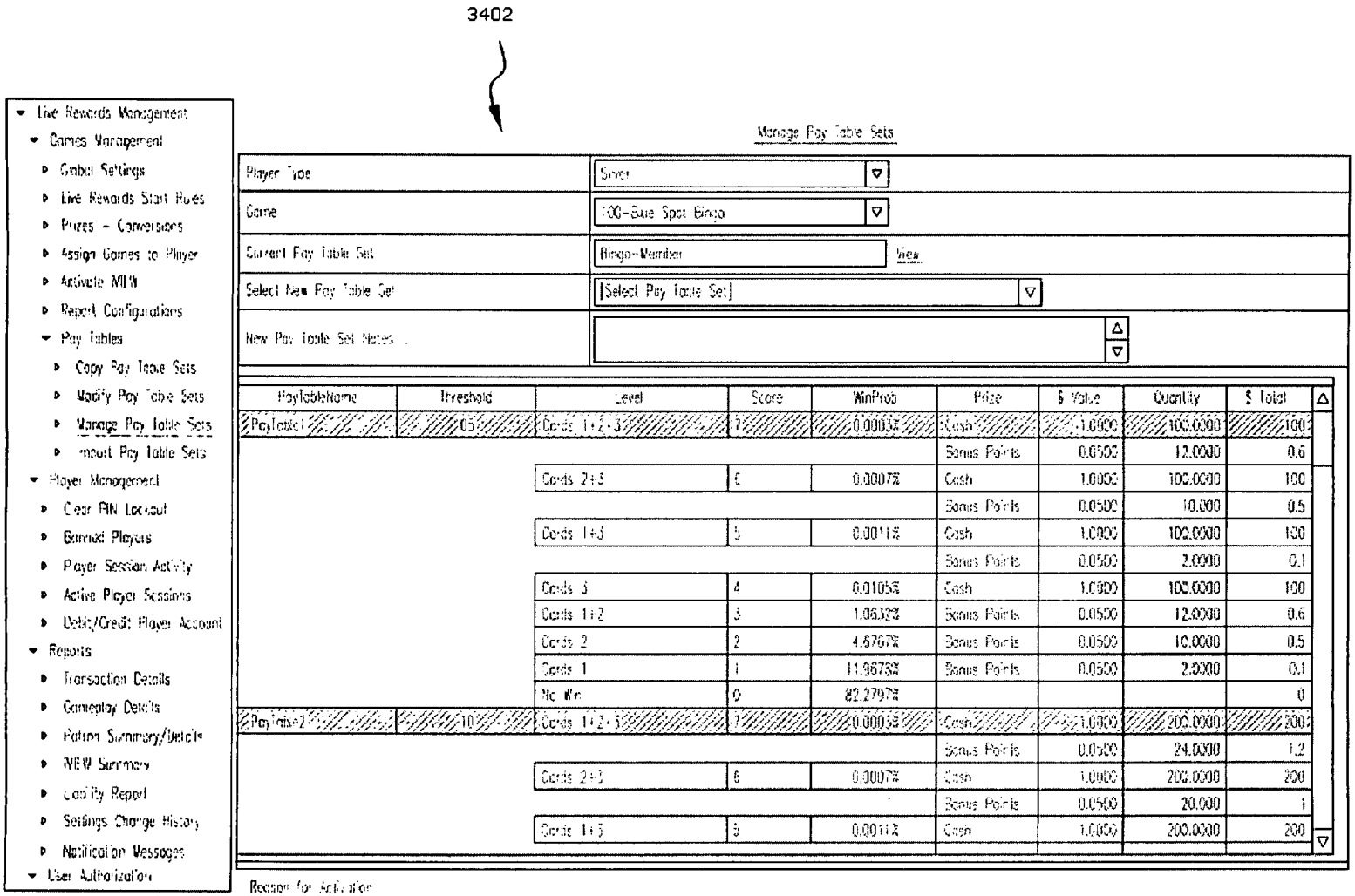
Figure 35:
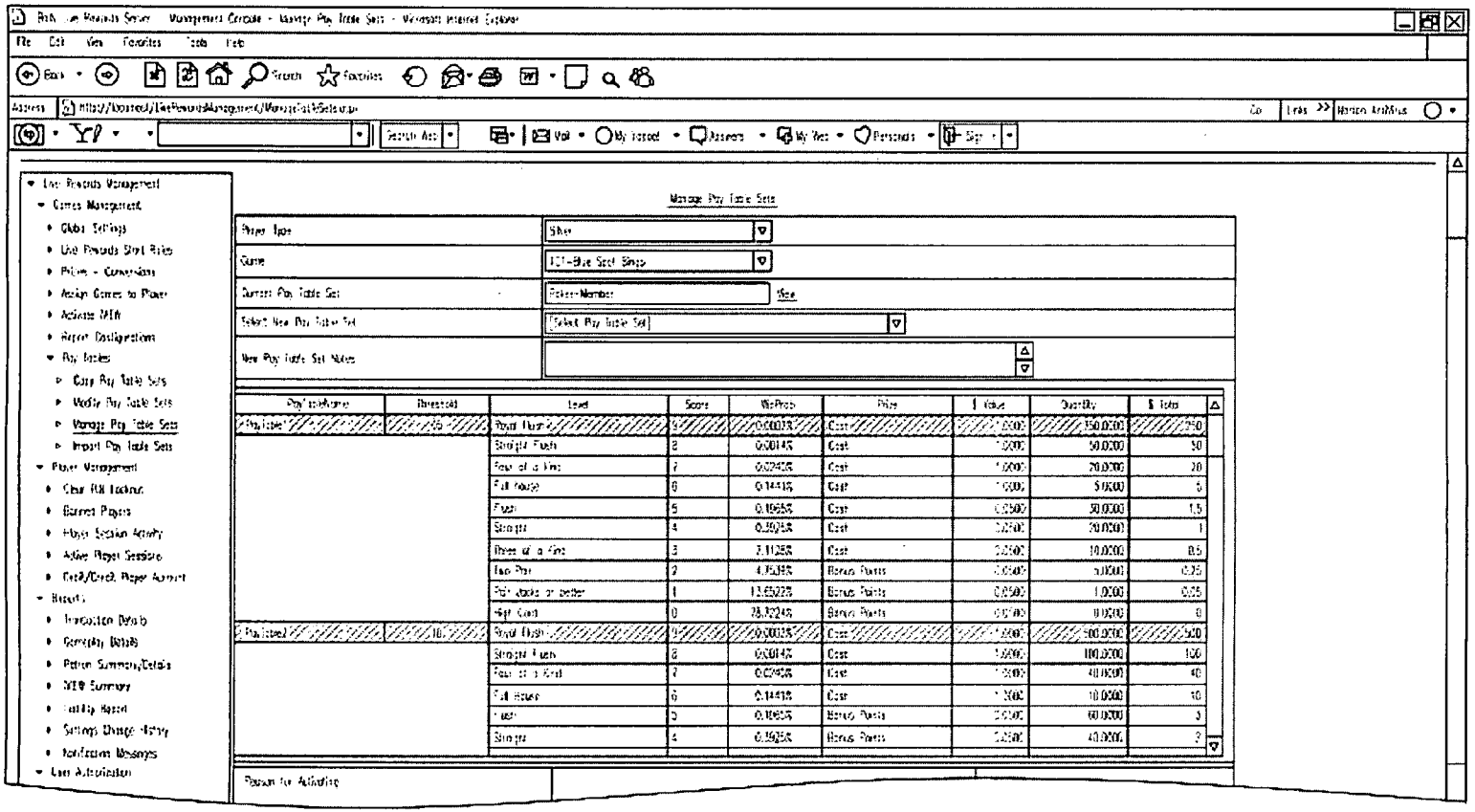
FIGS. 35, 35A (collectively referred to as FIG. 35) illustrate a pair of screenshots of the Live Rewards Server Manage Pay Table Sets feature. This page allows the casino attendant to select different pay table sets for specific games for specific play types. This is showing the PayDay Poker being configured.
Figure 35A:
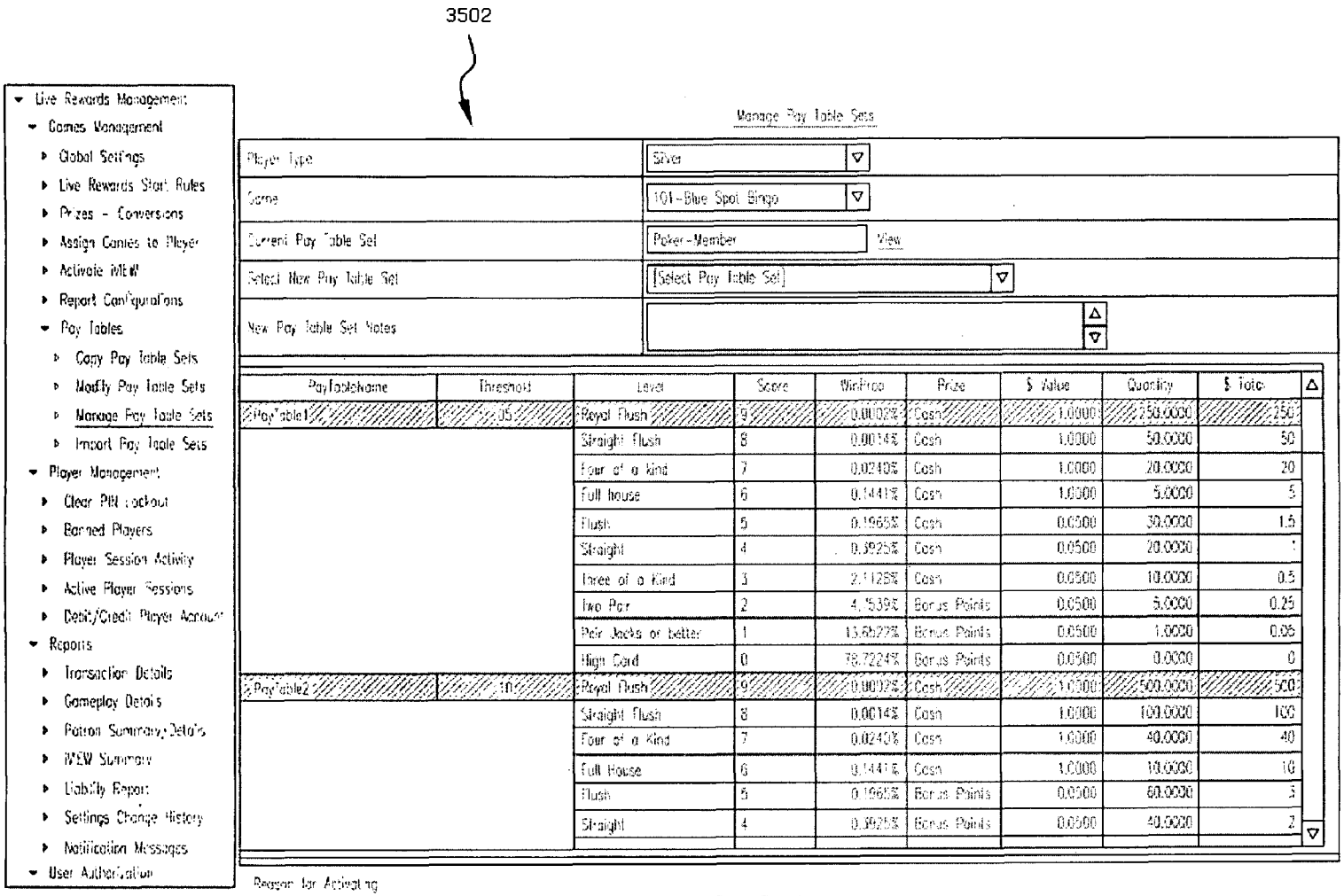

Referring to FIGS. 34 and 35, a Manage Pay Table Sets panel 3400 (and 3500) is shown such as may be displayed on an Operator Control Console, such as a Bally Control Panel and/or a Bally Live Rewards Server Management Console, connected to a server network, such as a Bally SMS & CMS. The operator control console may comprise a conventional personal computer with coding implemented to execute various processes associated with the network servers and gaming machines. The Manage Pay Table Sets panel may include fields for a Player Type, Game, Current Pay Table Set, Select New Pay Table Set, New Pay Table Set Notes, Current Pay Table Summary, and Reason for Activating. The Current Pay Table Summary may include fields for the Pay Table Name, Threshold, Level, Score, Win Probability, Prize, $ Value, Quantity, $ Total.

Re-Assigning Pay Table Sets

Purpose: To assign the Live Reward game to a new Pay table set, depending on the player type. This overrides the currently assigned Pay table set. In other words, there can be only one Pay table set active for one Live Rewards game for a given player.

Procedure: Follow these steps to re-allot a Pay table set for the game and the player type.

STEP 1. From the Live Rewards Management menu, go to Play Tables submenu and select Manage Pay Table Sets.

STEP 2. Select required Player Type from drop-down list.

STEP 3. Select required Game from drop-down list. System displays currently assigned Pay table set for the game and the player type in Current Pay Table Set field.

STEP 4. Select a new Pay table set from Select New Pay Table Set drop-down list. The system displays the comments entered in the New Pay Table Set Notes field when the Pay table set was imported/copied/modified.

STEP 5. Type your comments for re-allotting in Reason for Activating field. In one or more embodiments, any Pay table set that has been assigned to a particular game and player type cannot be re-assigned to another game or some other player type. Click View to view the details of currently assigned Pay table set. This link is adjacent to Current Pay Table Set field. The system displays only those Pay table sets which can be used for re-assigning in Select New Pay Table Set field.

Deleting Pay Table Sets

Purpose: To delete a Pay table set. In other words, to delete all Pay tables that belong to a set. However, for auditing purposes, you cannot delete the used and provided Pay table sets.

Purpose: Follow these steps to delete a Pay table set.

STEP 1. From the Live Rewards Management menu, go to Play Tables submenu and select Modify Pay Table Sets.

STEP 2. Select required Player Type from drop-down list.

STEP 3. Select required Game from drop-down list. System displays currently assigned Pay table set for the game and the player type in Current Pay Table Set field.

STEP 4. Select a Pay table set from Select New Pay Table Set drop-down list.

STEP 5. Click Delete. System deletes the selected Pay table set and displays a confirmation message, Pay Table Set Deleted Successfully. Click View to view the details of currently assigned Pay table set. This link is adjacent to Current Pay Table Set field. In one or more embodiments, those Pay tables which have been used for any Live Rewards games cannot be deleted.

Figure 36:
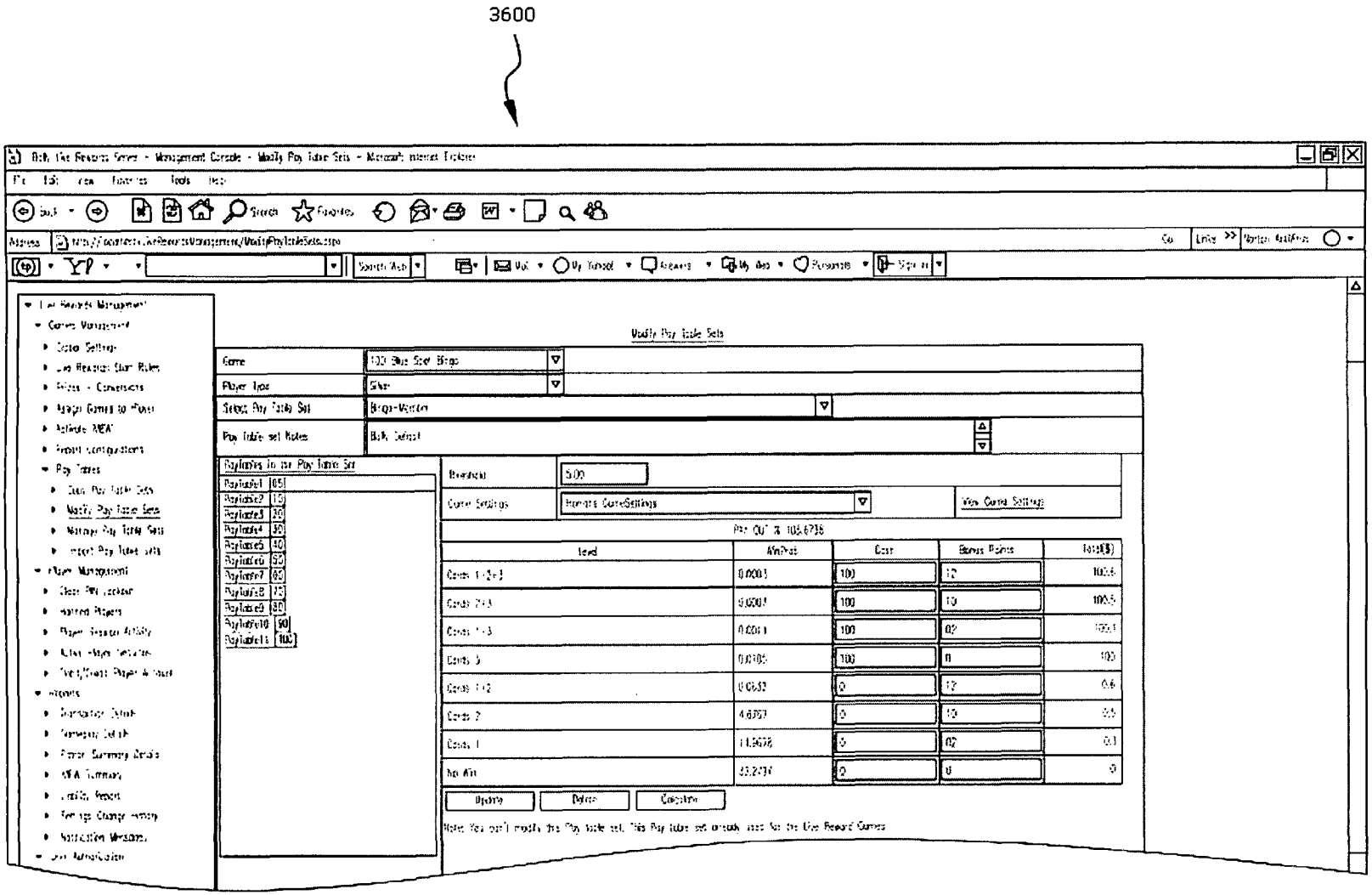
FIGS. 36, 36A (collectively referred to as FIG. 36) illustrate a pair of screenshots of the Live Rewards Server Modify Pay Table Sets feature. This page allows the casino attendant to edit a pay table set. The cost to play each level is set here shown as Threshold or Play Points required. The specific game settings used for this PayTable can be modified (view game settings). And the specific amount of cash and/or Bonus Points can be set for each winning combination in a game. This is showing how Blue Spot Bingo is configured.
Figure 36A:
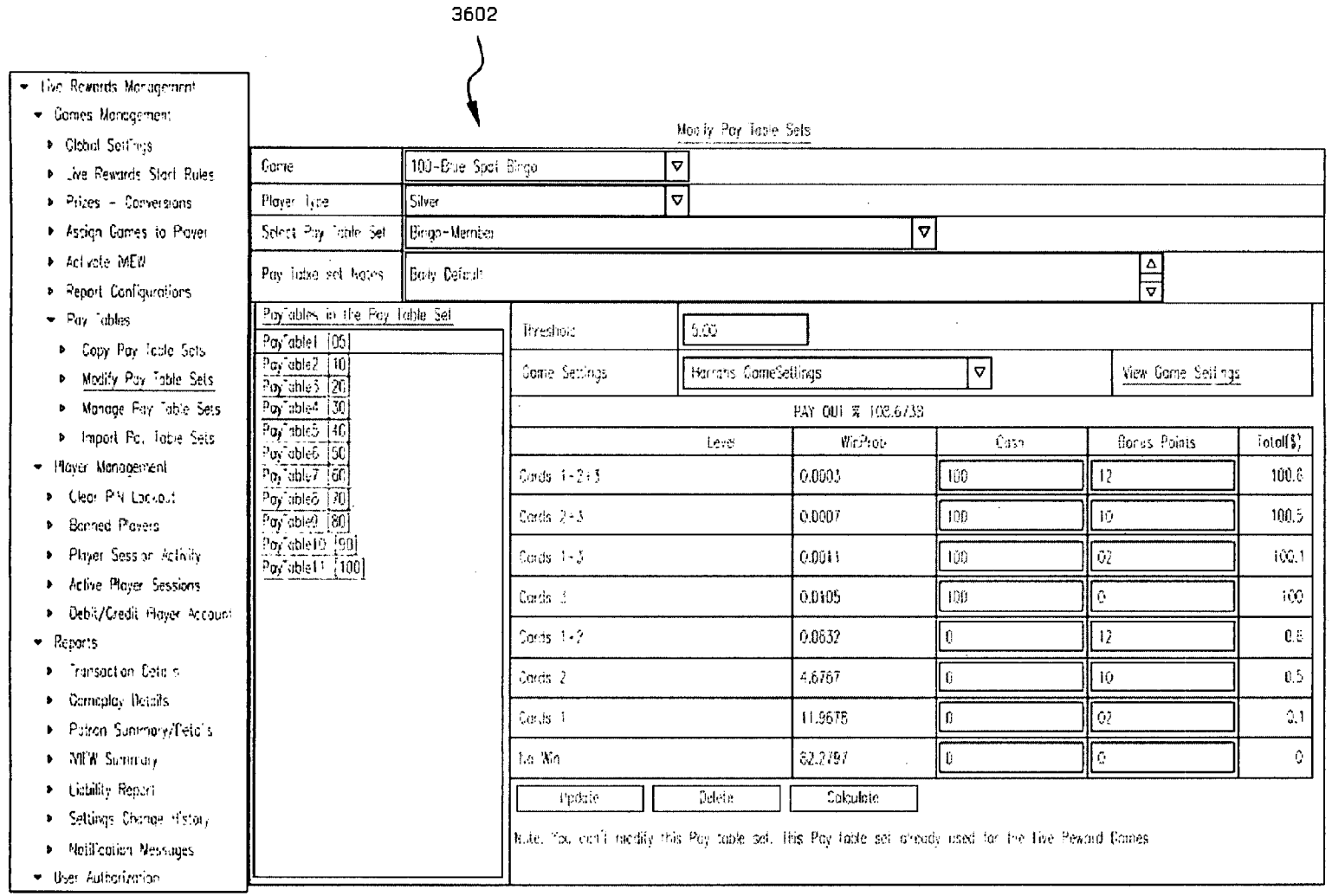

Referring to FIG. 36, a Modify Pay Table Sets panel 3600 is shown such as may be displayed on an Operator Control Console, such as a Bally Control Panel and/or a Bally Live Rewards Server Management Console, connected to a server network, such as a Bally SMS & CMS. A closeup view of the modify pay table sets panel 3602 is shown in FIG. 36A. The operator control console may comprise a conventional personal computer with coding implemented to execute various processes associated with the network servers and gaming machines. The Modify Pay Table Sets panel may include fields for a Player Type, Game, Select Pay Table Set, Pay Table Set Notes, Pay Tables in the Pay Table Set, Threshold, Game Settings, View Game Settings, Pay out % and Pay out table. The Pay out table may include fields for Card Level, Win Probability, Cash, Bonus Points, $ Total (adding cash & dollar value of bonus points). Additional fields may be included for Update, Delete, Calculate (the % pay outs), and Informational, such as "Note: You can't modify this Pay table set. This Pay table set already used for the Live Reward Games."

Modifying Pay Table Sets

Purpose: To change the details of replicated Pay table set according to your current requirements. Plus, you can change, calculate and view the new payout percentage on the basis of cash amount and bonus points of each pay level of the Pay table.

Procedure: Follow these steps to change the values of Pay table set and to calculate payout percentage.

STEP 1. From the Live Rewards Management menu, go to Pay Tables submenu and select Modify Pay Table Sets. Following is the list of fields and their description for the Modify Pay Table Sets screen. In one or more embodiments, those Pay table sets which have not yet been activated for a Live Reward game may be modified by a casino operator.

STEP 2. Select required Game from drop-down list. System displays the mapped player type in Player Type field.

STEP 3. Select required Pay table set from Select Pay Table Set drop-down list.

System displays following details of the selected game and Pay table set:

Comments entered in Pay Table Set Notes field while the Pay table set was copied/imported/modified.

List of all Pay tables of the selected Pay table set under Pay Tables in the Pay Table Set section.

Game Settings: The predefined set of rules or mechanics established for a Live Reward game by the game designers. These settings are loaded at the time of LRS installation.

Payout Percentage. This is different for each Pay table. This tells how much the game is paying back to you.

By default, system displays subsequent details of the first Pay table—

Threshold value

Different Pay levels

Win probability

Cash

Bonus Points, and

Total

If you have selected a Pay table set that has been used for any Live Reward game, the system displays the warning message: You can't modify this Pay Table Set. This Pay Table Set already used for the Live Reward Games. Click View Game Settings link, if you want to view the game settings of the selected game. System displays the same in a separate window. The buttons Update, Delete, Calculate and Create New Pay Table may be enabled only if you can modify the values of the Pay table set.

STEP 4. Click the required Pay table link from the Pay-.Tables in the Pay Table Set section. Pay tables are numbered and arranged in ascending order relating to threshold of a Pay table. On clicking, the system displays the play point value, winning probability, cash, bonus points and total corresponding to the list of all Pay Levels of the selected Pay table.

STEP 5. Optionally, you can change the Play Point value according to your requirements, which effects the current Payout percentage. This may be greater than zero.

STEP 6. Type following for the corresponding pay level, if required in PAY OUT section of the screen:

Amount to be given as cash winnings, if the player attains a particular pay level in Cash column. By default, system takes cash as 'zero'.

Bonus points to be given as bonus points winnings, if the player attains a particular pay level in Bonus Points column. By default, system takes bonus points as 'zero'.

STEP 7. Click Calculate to view and have an idea of the updated payout percentage and total winnings based on the current values you have entered for the selected Pay table. Total is the addition of Cash and Bonus Points for each pay level. The number in brackets is the number of play points needed to earn the Pay table.

| Field Name | Description |
|---|---|
| Game | This is a drop-down list which displays the list of all Bally Live Reward games that are available in the casino. |
| Player Type | The description/name of the player type. |
| Select Pay Table Set | This is a drop-down list which displays the list of all paytable sets. |
| Pay Table Set Notes | The comments entered while the paytable set was imported/copied/modified (for example, the purpose of the new Paytable set). |
| Threshold | The number of play points required to obtain the corresponding paytable. This is the cost of the paytable. This must be a numeric value greater than or equal to zero, which can accept four decimal values. |
| Game Settings | The predefined set of rules or mechanics established for a Bally Live Reward game by the game designers. This is loaded during installation in XML format. |
| Level | List of all Pay Levels for a defined paytable. |
| WinProb | Winning probability of the corresponding pay level. |
| Cash | Amount that can be won when the player attains the corresponding pay level. This must be a numeric value greater than or equal to zero. |

-continued

| Field Name | Description |
|---|---|
| Bonus Points | Count of points that can be earned when the player reaches the corresponding pay level. This must be a numeric value greater than or equal to zero. |
| Total | System calculates and displays the total dollar value of the corresponding cash bonus points for each pay level. |

Figure 37:
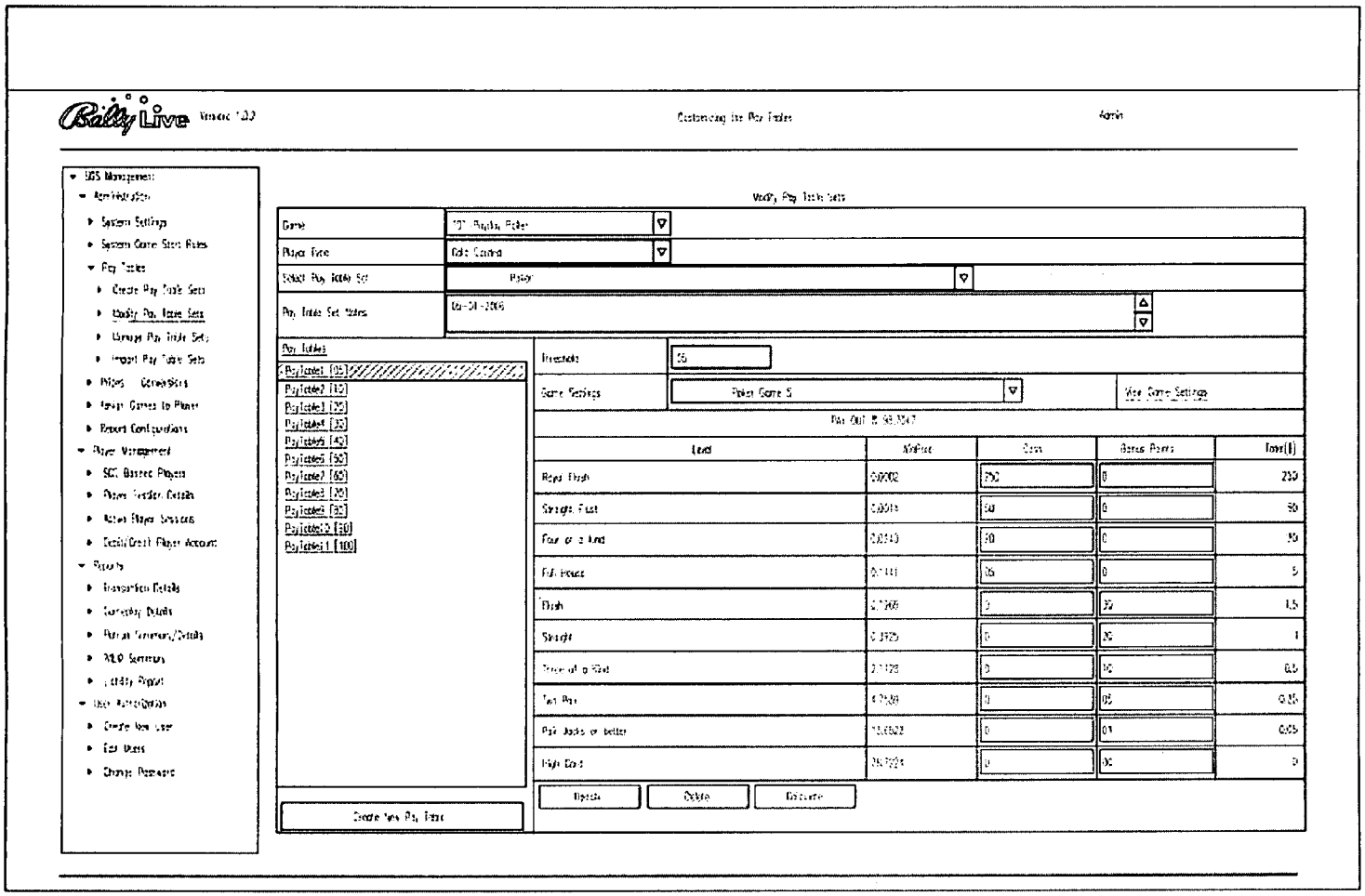
FIGS. 37, 37A (collectively referred to as FIG. 37) illustrate a pair of screenshots of the Live Rewards Server Modify Pay Table Sets feature. This page allows the casino attendant to edit a pay table set. The cost to play each level is set here shown as Threshold or Play Points required. The specific game settings used for this PayTable can be modified (view game settings). And the specific amount of cash and/or Bonus Points can be set for each winning combination in a game. This is showing how PayDay Poker is configured.
Figure 37A:
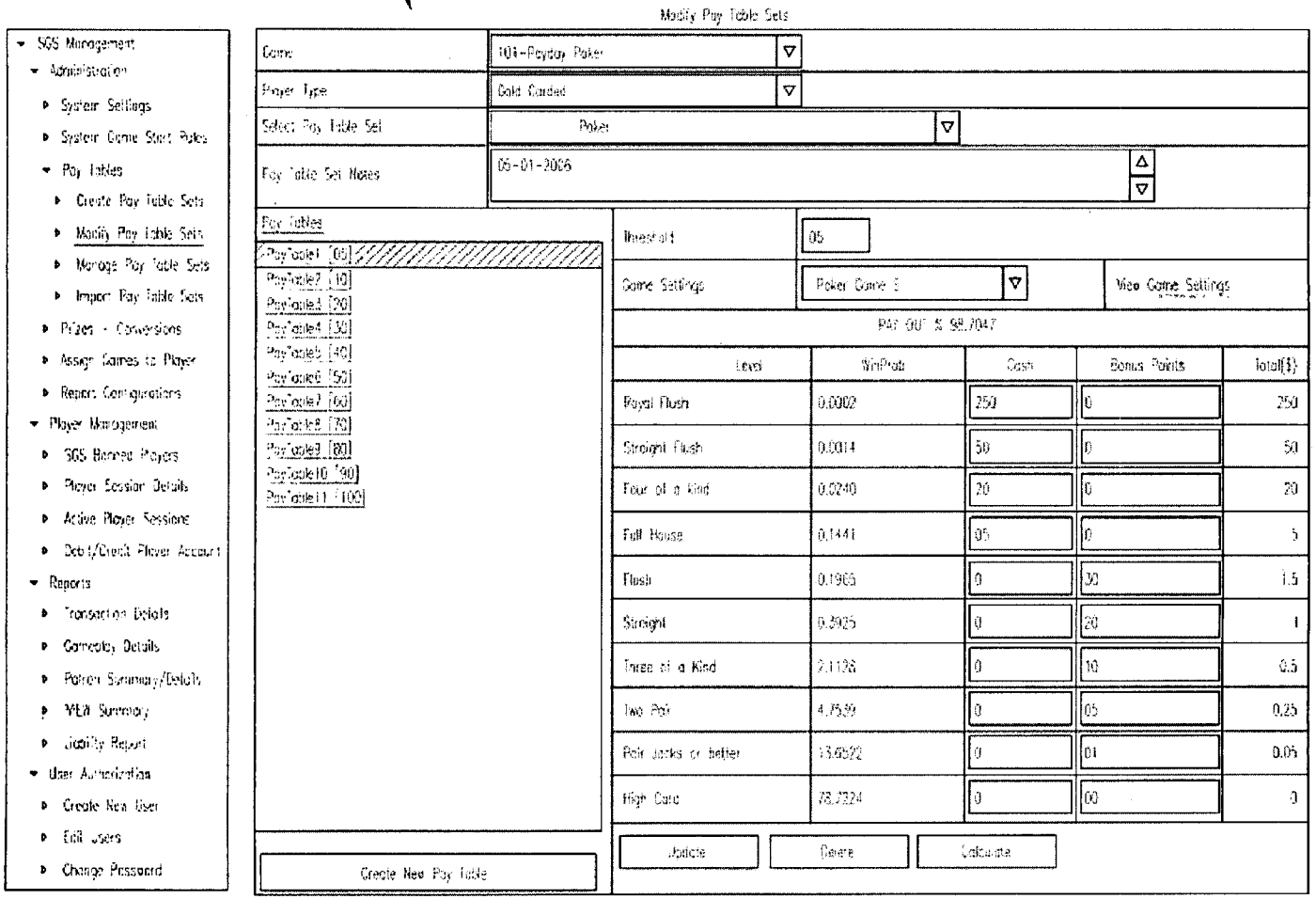

Referring to FIG. 37, a Customizing the Pay Tables panel 3700 is shown such as may be displayed on an Operator Control Console, such as a Bally Control Panel and/or a Bally Live Rewards Server Management Console, connected to a server network, such as a Bally SMS & CMS. A closeup view of the customizing pay tables panel 3702 is shown in FIG. 37A. The operator control console may comprise a conventional personal computer with coding implemented to execute various processes associated with the network servers and gaming machines. The Customizing the Pay Tables panel may include fields for a Player Type, Game, Select Pay Table Set, Pay Table Set Notes, Pay Tables in the Pay Table Set, Threshold, Game Settings, View Game Settings, Pay out % and Pay out table. The Pay out table may include fields for Level (Winning Combination), Win Probability, Cash Pay out, Bonus Points Pay out, $ Total Pay out (adding cash & dollar value of bonus points). Additional fields may be included for Update, Delete, Calculate (the % pay outs), and Create a New Pay table.

Purpose: To create a Pay table within an existing Pay table set.

Procedure: Follow these steps to create a Pay table.

STEP 1. From the Live Rewards Management menu, go to Play Tables submenu and select Modify Pay Table Sets.

STEP 2. Select required Game from drop-down list. System displays the mapped player type in Player Type field.

STEP 3. Select a Pay table set from the Select Pay Table Set drop-down list. System displays corresponding details of the selected game and Pay table set.

STEP 4. Click Create New Pay Table. System displays Creating New Pay Table section.

STEP 5. Select required Pay table from the Select Existing Pay Table drop-down list. System displays the Threshold value of the selected Pay table.

STEP 6. Type Pay Table Name for the new Pay table to be created (May be mandatory, may be unique).

STEP 7. Type Multiplier value (Mandatory). Thus, a newly created Pay table has a play point value equal to selected Pay table's play point cost, multiplied by the value you have entered. This may be a numeric value greater than or equal to zero. The newly created Pay table automatically multiplies all awards from the template Pay table by the multiple value. These awards can then be manually altered to suit your needs.

STEP 8. Click Create. System creates a Pay table and displays a confirmation message, New Pay Table Created Successfully. In one or more embodiments, a Pay table set that has been utilized for Live Reward games may not be modified.

Deleting a Pay Table from its Set

Purpose: To remove a Pay table from its Pay table set.

Procedure: Follow these steps to delete a Pay table.

STEP 1. From the Live Rewards Management menu, go to Play Tables submenu and select Modify Pay Table Sets.

STEP 2. Select required Game from drop-down list. System displays the mapped player type in Player Type field.

STEP 3. Select required Pay table Set from Select Pay Table Set drop-down list. System displays corresponding details of the selected game and Pay table set.

STEP 4. Click the required Pay Table link from the Pay. Tables in the Pay Table Set section. System displays the play point value, winning probability, cash amount, bonus points and total dollar value of the rewards, corresponding to the list of all Pay Levels of the selected Pay table.

STEP 5. Click Delete. System removes the selected Pay table from its set and displays a confirmation message as shown below. In one or more embodiments, Pay tables from those Pay table sets that are not yet used for Live Rewards games may be deleted. You can notice the deletion of Pay Table9 from the pay table set.

Exporting Pay Table Sets

Purpose: To export a Pay table set into XML format. This can be used by game designers as a reference for defining the game settings and structure while creating new Pay table sets.

Procedure: Follow these steps to export a Pay table set.

STEP 1. From the Live Rewards Management menu, go to Play Tables submenu and select Modify Pay Table Sets.

STEP 2. Select required Player Type from drop-down list.

STEP 3. Select required Game from drop-down list. System displays currently assigned Pay table set for the game and the player type in Current Pay Table Set field.

STEP 4. Select new Pay table set from Select New Pay Table Set drop-down list. System displays the comments entered in New Pay Table Set Notes field when the Pay table set was imported/copied/modified. STEP 5. Click Export. System displays File Download dialog box.

A. Click Open to view the structure of selected Pay table set in XML format. System displays the same in a separate window.

B. Click Save to save the selected Pay table set in XML format. System opens Save As dialog box. Save the file in required location.

C. Click Cancel to cancel the export task. Click View link to view the details of currently assigned Pay table set. This link is adjacent to Current Pay Table Set field.

Importing Pay Table Set

Purpose: To import a Pay Table Set into Live Rewards server application. This may be in XML format. This adds the Pay Table set to the database which is available for copying, modifying, and assigning it to the Live Reward game.

Procedure: Follow these steps to import a Pay Table Set.

STEP 1. From the Live Rewards Management menu, go to Play Tables submenu and select Import Pay Table Sets.

STEP 2. Type path where you have kept the Pay Table Set (in XML format) to be imported in Select Pay Table Set (XML file) field. or, Click Browse to locate the required file name.

STEP 3. Click Load. System displays the contents of the file in a text field that appears shaded (in grey color) as shown below.

STEP 4. Click Import. The system imports the Pay table set into the LRS and displays the confirmation message, Pay Table Sets Imported Successfully. If you have specified a Pay table set that was already imported, the system displays an error message that the given game settings already exist.

Figure 38:
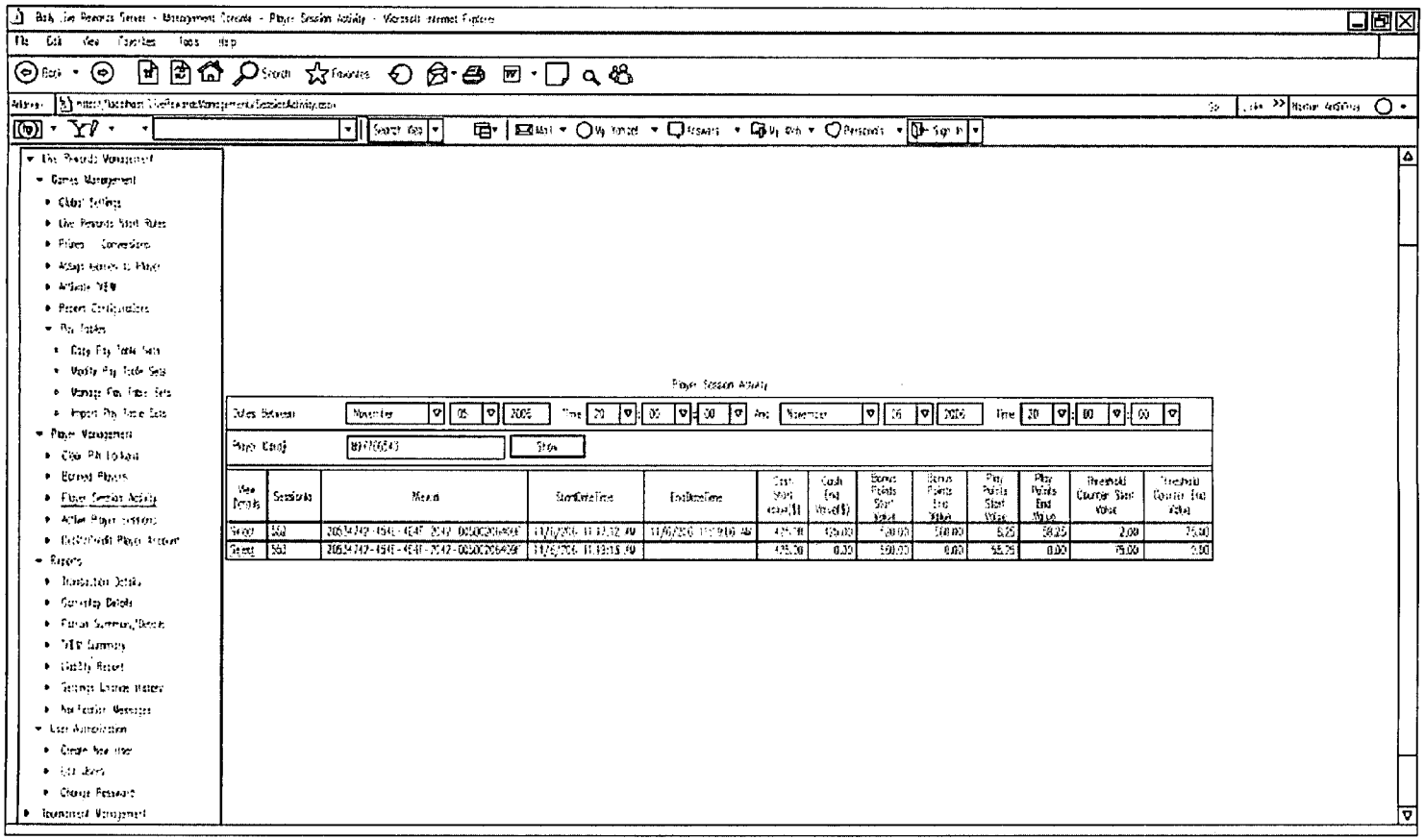
FIGS. 38, 38A (collectively referred to as FIG. 38) illustrate a pair of screenshots of the Live Rewards Server Player Session Activity feature. All Transactions that a player has done against his player buckets in the server are shown here.
Figure 38A:
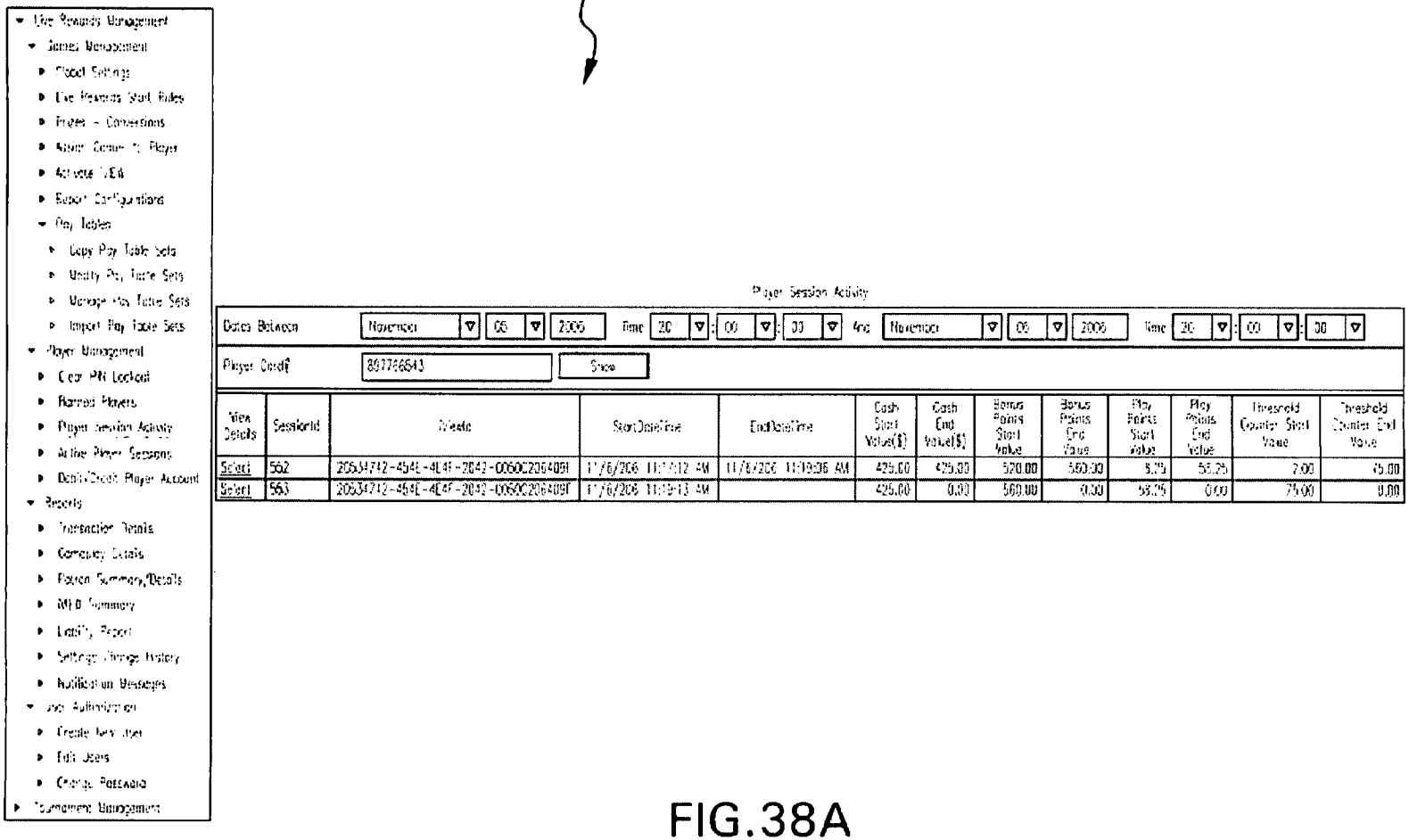

Referring to FIG. 38, a Player Session Activity panel is shown such as may be displayed on an Operator Control Console, such as a Bally Control Panel and/or a Bally Live Rewards Server Management Console, connected to a server network, such as a Bally SMS & CMS. A closeup view of the player session activity panel 3802 is shown in FIG. 38A. The operator control console may comprise a conventional personal computer with coding implemented to execute various processes associated with the network servers and gaming machines. The Player Session Activity panel may include fields for a Dates Between, Player Card Number, and Show.

The Dates Between and Player Card Number fields including editable areas for inputting the associated data, such as beginning and ending date and time and/or a player card number, respectively. The Player Session Activity panel also includes an area to display the requested data, such as information concerning each of the playing sessions of card holder xyz between a specified range of dates. The data display area may include fields, such as View Details, Session ID, iView ID, Start Date Time, End Date Time, Cash Start Value, Cash End Value, Bonus Points Start Value, Bonus Points End Value, Play Points Start Value, Play Points End Value, Threshold Counter Start Value, Threshold Counter End Value. The View Details field may have one or more activatable areas associated with specific sessions, each of which may be activatable to obtain the details of an associated player session.

Viewing Player Sessions

Purpose: To view historical player session details for a particular player card number. Plus, you can view the following player associated bucket details:

1. Player Buckets

Details regarding total winnings classified broadly as balances on the following:

Cash

Bonus points

Play points, and

Threshold counter.

In a casino, one player card is used by multiple players, so there can be many sessions for a single player card.

2. Session Deposits

Session-wise deposit details of the players. In other words, it displays all the transactions which are credited to the player card account.

Procedure: Follow these steps to view player session details.

STEP 1. From the Live Rewards Management menu, go to Player Management submenu and select Player Session Details.

STEP 2. By default, the system selects date and time as per the settings in Report Configuration screen. However, you can select required date (in Dates Between fields) and time period (in Time fields).

STEP 3. Type Player Card Number (May be mandatory).

STEP 4. Click Show or press Enter. System retrieves the details of the specified player card number.

STEP 5. Click Select under the View Details column to view player-associated transaction details for a particular session. By default, System displays the session deposits of the specified player.

STEP 6. Click the following links

A. Session Withdrawals to view session-wise withdrawals of the specified player card Number.

B. Session Games to view the details on games played during each session for the specified player card number.

Following is the list of fields, column headers and their description for the Player Session Activity screen:

| Field Name | Description |
|---|---|
| Dates Between, Time | Start date, time and end date, time. You can select date range (Month and day) and time range (Hours, Minutes, Seconds) from the drop-down list. The end date should be greater than the start date.<br>Start Date, Time<br>Dates Between<br>September 02 10 00 00<br>< > < > < > < > < ><br>End Date, Time<br>And<br>September 02 10 00 00<br>< > < > < > < > < > |
| Player Card # | Player Card Number. It is a unique code to identify the player. The player card number can be an alphanumeric value of 20 characters. |
| Sessionid/Session # | This is the identification code which is generated by the system for every session. |
| iViewId | A unique identification code of the iView device. The iView ID can be an alphanumeric value of 50 characters including special characters. |
| StartDateTime | The date and time when a particular session begins. The start date is in DD/MM/YYYY format and time in HH/MM/SS AM or PM format. |
| EndDateTime | The date and time when a particular session ends. The end date is in DD/MM/YYYY format and time in HH/MM/SS AM or PM format. |
| CashStartVaule($) | The total amount in the player's account when session starts. This must be a numeric value greater than or equal to zero. |
| CashEndVaule($) | The total amount in the player's account when session ends. This must be a numeric value greater than or equal to zero. |
| Bonus Points Start Value | The total number of bonus points maintained in the player's account when session starts. This must be a numeric value greater than or equal to zero. |
| Bonus Points End Value | The balance bonus points in the player's account when session ends. This must be a numeric value greater than or equal to zero. |
| Play Points End Value | The balance play points in the player's account when session ends. This must be a numeric value greater than or equal to zero. |
| Threshold Counter Start Value | The total number of threshold counter in the player's account when session starts. This must be a numeric value greater than or equal to zero. |
| Threshold Counter End Value | The balance threshold counter in the player's account when session ends. This must be a numeric value greater than or equal to zero. |
| Session Deposits and Session Withdrawals | |
| Tran# | The identification number of the transaction generated automatically by the system. |
| TransactionDateTime | The date and time of the transaction when it was created. The date is in DD/MM/YYYY format, and time in HH/MM/SS AM or PM format. |
| Source | Source of the transaction. The possible values are:<br>ALL<br>Session Bucket<br>iView<br>Game Play<br>Partial Withdrawal<br>Hand Pay<br>Live Rewards Server |
| SourceId | A unique identification code of the source. The possible source and their identifiers are:<br>Session Bucket: The identification code of the session, Session ID.<br>iView: The identification code of the |

-continued

| Field Name | Description |
|---|---|
| | iView device, iView ID.<br>Game Play: The identification code of the Live Reward game, GameHistory ID.<br>Partial Withdrawal: The identification code of the transaction, Transaction ID.<br>Hand Pay<br>Live Rewards Server |
| SourceDetails | A short description of the source. |
| Bucket | Type of the bucket/reward subject to the transaction. The possible values are:<br>Play Points<br>Threshold Counter<br>Bonus Points<br>Cash |
| Value | Amount of the transaction. This must be zero or greater than zero. |
| Jurisdiction | Jurisdiction condition of the transaction. Possible values are 'Yes' and 'No' |
| Status | Status of the Transaction. Possible values are:<br>Committed<br>Open<br>Rollback |
| Session Games | |
| HID | The game play history number. This is a unique sequential number that is generated by the system. |
| GameName | The name of the Bally Live Reward game. The game name can be an alphanumeric value of 50 characters including special characters. |
| iViewId | A unique identification code of the iView device. The iView Id can be an alphanumeric value of 50 characters including special characters. |
| CasinoId | A unique identification code of the casino. The Casino Id can be an alphanumeric value of 4 characters. |
| GmuId | The network identification code of the iView device. The Gmu Id can be an alphanumeric value of 32 characters including special characters. |
| Asset# | A unique identification code of the slot machine. The Asset# can be an alphanumeric value of 8 characters. |
| StartDateTime | The date and time when a particular Bally Live Reward game begins. The start date is in DD/MM/YYYY format and time in HH/MM/SS AM or PM format. |
| EndDateTime | The date and time when a particular Bally Live Reward game ends. The end date is in DD/MM/YYYY format and time in HH/MM/SS AM or PM format. |
| Score | This is the result of last played game and the current pay level number from descending. |
| Status | Status of the Transaction. Possible values are:<br>Committed<br>Open<br>Rollback |
| Pending HID | Pending game history identification number. If a game is pending on the iView device, HID will be non-zero so that you can cancel the game play. |
| Pending Withdrawal # | There could be only one pending withdrawal for any iView device and/or for any session. System displays '0', if the pending withdrawal is cleared, else the identification number of that transaction. |
| Pending Gameplay | There could be only one pending game or any iView device and/or for any session. System displays '0', if there are no pending game for the particular session, else the identification number of that transaction. |

-continued

| Field Name | Description |
|---|---|
| Pending Handpay | There could be only one pending handpay or any iView device and/or for any session. System displays '0', if there are no pending handpay for the particular session, else the identification number of that transaction. |
| Transaction_Amount | Amount of the transaction. This must be a numeric value greater than or equal to zero. |
| Commit_Amount | The amount that has been credited in the player's account. The commit amount |

Referring to FIG. 39, a Player Session Activity panel 3900 is shown with a Session Deposits Details display such as may be displayed on an Operator Control Console, such as a Bally Control Panel and/or a Bally Live Rewards Server Management Console, connected to a server network, such as a Bally SMS & CMS. A closeup view of the player session activity panel 3902 is shown in FIG. 39A. The operator control console may comprise a conventional personal computer with coding implemented to execute various processes associated with the network servers and gaming machines. The Player Session Activity panel with Session Deposits Details may be obtained by selecting a View Details for a player session identified the Player Session Activity panel 3800 of FIG. 38. The Player Session Activity Panel may be displayed in an area including fields for Session Deposits, Session Withdrawals, Session Games, and Close. Another field may be displayed upon selection of one or more of the aforenamed fields, for example a Session Deposits display area is shown in FIG. 39 and may include fields for a Session Number, Transaction Number, Transaction Date Time, Source (such as iView or Game Play), Source ID, Source Details, Bucket, Value, Jurisdiction, and Status.

Referring to FIG. 40, a Player Session Activity panel 4000 is shown with a Session Withdrawals Details display such as may be displayed on an Operator Control Console, such as a Bally Control Panel and/or a Bally Live Rewards Server Management Console, connected to a server network, such as a Bally SMS & CMS. A closeup view of the player session activity panel 4002 is shown in FIG. 40A. The operator control console may comprise a conventional personal computer with coding implemented to execute various processes associated with the network servers and gaming machines. The Player Session Activity panel 4000 with Session Withdrawals Details may be obtained by selecting a View Details for a player session identified the Player Session Activity panel 3800 of FIG. 38. The Player Session Activity Panel 4000 may be displayed in an area including fields for Session Deposits, Session Withdrawals, Session Games, and Close. Another field may be displayed upon selection of one or more of the aforenamed fields, for example a Session Withdrawals display area is shown in FIG. 40 and may include fields for a Session Number, Transaction Number, Transaction Date Time, Source (such as Game Play), Source ID, Source Details, Bucket, Value, Jurisdiction, and Status.

Each withdrawal transaction to the player account for an actively playing player is shown in the display area for a selected session. For example: if you spend your accrued play points, it gets debited from your player card account or if your cash winnings are transferred from the iVIEW to the slot machine, it gets debited from your Live Rewards account and credited to your main player account on the casino management system or onto the slot machine itself.

The following are the fields available on the above-referenced screen (panel):

| Field Name | Description |
|---|---|
| Source | Source of the transaction. The possible values are:<br>ALL<br>Session Bucket<br>iView<br>Game Play<br>Partial Withdrawal<br>Hand Pay<br>Live Rewards Server |
| SourceId | A unique identification code of the source. The possible source and their identifiers are:<br>Session Bucket: The identification code of the session, Session ID.<br>iView: The identification code of the iView device, iView ID.<br>Game Play: The identification code of the Live Reward game, GameHistory ID.<br>Partial Withdrawal: The identification code of the transaction, Transaction ID.<br>Hand Pay<br>Live Rewards Server |
| SourceDetails | A short description of the source. |
| Bucket | Type of the bucket/reward subject to the transaction. The possible values are:<br>Play Points<br>Threshold Counter<br>Bonus Points<br>Cash |
| Value | Amount of the transaction. This must be zero or greater than zero. |
| Jurisdiction | Jurisdiction condition of the transaction. Possible values are 'Yes' and 'No' |
| Status | Status of the Transaction. Possible values are:<br>Committed<br>Open<br>Rollback |
| Session Games | |

Referring to FIG. 41, a Player Session Activity panel 4100 is shown with a Session Games Details display such as may be displayed on an Operator Control Console, such as a Bally Control Panel and/or a Bally Live Rewards Server Management Console, connected to a server network, such as a Bally SMS & CMS. A player session activity panel 4102 is shown in FIG. 41A. The operator control console may comprise a conventional personal computer with coding implemented to execute various processes associated with the network servers and gaming machines. The Player Session Activity panel 4100 with Session Games Details may be obtained by selecting a View Details for a player session identified the Player Session Activity panel 3800 of FIG. 38. The Player Session Activity Panel 4100 may be displayed in an area including fields for Session Deposits, Session Withdrawals, Session Games, and Close. Another field may be displayed upon selection of one or more of the aforenamed fields, for example a Session Games display area is shown in FIG. 41 and may include fields for a Session Number, Transaction Number, Transaction Date Time, Source (Game Play), Source ID, Source Details, Bucket, Value, Jurisdiction, and Status.

All game transactions for a specific player and selected session are shown on the above-referenced screen. Available field and features are listed in the below chart:

| Field Name | Description |
|---|---|
| HID | The game play history number. This is a unique sequential number that is generated by the system. |
| GameName | The name of the Bally Live Reward game. |
| iViewId | A unique identification code of the iView device. |
| GmuId | The network identification code of the iView device. |
| Asset# | A unique identification code of the slot machine. |
| PLRCardNo | Player Card Number. This is a unique code to identify the player. |
| StartDateTime | The date and time when a particular Bally Live Reward game begins. |
| EndDateTime | The date and time when a particular Bally Live Reward game ends. |
| Source Details | The short description of the source. |
| Play Points Spent | Number of play points spent in playing a corresponding Bally Live Reward game. |
| Threshold Counter Spent | Number of threshold counter spent in playing a corresponding Bally Live Reward game. |
| Cash Won ($) | The amount won as cash (in dollars) by playing a corresponding Bally Live Reward game. |
| Bonus Points Won | The bonus points won by playing a Bally Live Reward game. These points are sent to Casino's CMS/CMP. |
| | Game Play Details |
| Game Name | Name of the Bally Live Rewards game. |
| StartDateTime | The date and time when a particular Bally Live Rewards game begins. |
| EndDateTime | The date and time when a particular Bally Live Rewards game ends. |
| Reward Level | Paytable name that was attained by the player for playing any particular game. |
| Score | This is the result of last played game which is a current pay level number from descending. |
| Pay Level | Pay level of particular Paytable won by the player. |

Referring to FIG. 42, a Prizes—Conversions panel 4200 is shown such as may be displayed on an Operator Control Console, such as a Bally Control Panel and/or a Bally Live Rewards Server Management Console, connected to a server network, such as a Bally SMS & CMS. A closeup view of the prizes-conversions panel 4202 is shown in FIG. 42A. The operator control console may comprise a conventional personal computer with coding implemented to execute various processes associated with the network servers and gaming machines. The Prizes—Conversions panel may include fields for Prize Type, Cashable, Dollar Value, Jurisdictional Include, Mapped Player Types, and Expire Day(s).

Live Rewards games are comprised of four types of payoffs/prizes. The below table depicts the features of these four types:

Features of Prize Types

| Prize Type | Cashable | Dollar Rate per Prize type | Applicable to Jurisdiction limits | Mapped Player Types | Expire Day(s) |
|---|---|---|---|---|---|
| Cash | Yes | 1 dollar | Yes | Gold Carded Silver Carded | Can be redeemed any time. |
| Bonus Points | Yes | 0.50 dollars | Yes | Gold Carded Silver Carded | Can be redeemed any time. This can be cashable or non-cashable depending on the settings in the CMS application of the respective casino. |

In one or more embodiments, winnings may be stored in the player's Live Rewards account. In one or more embodiments, cash winnings may be paid at the gaming machine, either directly from the game or at the player's request. On card insertion, the total value of Play Points, uncollected Bonus Points and cash including jackpots that require hand pay, and Live Rewards Game Start Threshold counters in the player's main account are transferred into a player session account on the LRS.

On player card removal, the player's session account is closed and any Play Points, Threshold Counters, Cash, and Bonus Points are added back into the player's main account. These are usable the next time the player inserts the card.

Multiple session accounts may be opened at any given time. Each session is reserved for itself whatever Play Points etc. that are not currently reserved by another open session.

Winnings from a Live Rewards game are immediately transferred to the player's session account at the end of the game.

Players may enter their Player's Club card PIN (Personal Identification Number) to collect cash winnings.

Player cash winnings are transferred to the slot machine using an electronic funds transfer or through a hand pay. All electronic funds transactions from the Live Rewards game to the base game are logged in the slot management system and on the LRS.

Bonus points won by a player are transferred to the player's account on the casino management system.

All the bonus point transactions are logged by the casino management system and LRS.

To View Prize Conversion Chart

Purpose: To view a chart on various type of prizes to be dispersed to players based on the features of the prizes (See "Features of Prize Types" on page 10). Two Administrator (Admin) users may be logged in to view the prize conversion chart.

Procedure: Follow these steps to view the prize conversion chart.

STEP 1. From the Live Rewards Management menu, go to Games Management submenu and select Prizes—Conversions.

STEP 2. System displays the chart on prize conversion as shown below.

Reports

Referring generally to FIG. 43 through 55, various reports may be generated using the Live Rewards management application. The Live Rewards management application helps you track revenues and the types of transactions happening on the iVIEW devices that are useful for accounting, auditing, and marketing purposes. These reports contain details of transactions of all game play and cash-out data for each iVIEW. Data is sent to the LRS on Card-in/Card-out, before and after a system game, when an electronic funds transfer is sent to the base game, or a hand pay occurs. Any data that was unable to be sent due to network or other issues is sent at initial power-up. You can view the reports on-screen or save it as a PDF document, excel spreadsheet, word document, or tab delineated text file. It is helpful when the casino needs to import any transactions details into their database. Any regular user can access Reports submenu from the Live Rewards Management menu.

Gameplay Details Report

Purpose: To generate report on game-wise transaction details. You can filter the report based on time frame, player card number, identification code of Asset and iVIEW devices, and game type.

This report lists identification code of Game play history, iVIEW device and slot machine, game name, network address of the device, player card number, date and time, of the begin and end transaction, number of play points and threshold counter played out, winnings on cash and bonus points.

Field Description

This section lists the different filters and their descriptions for the Gameplay Details report.

Report Column Description

This section lists the column headers and their description for the Gameplay Details report.

Procedure: Follow these steps to generate Gameplay Details report.

STEP 1. From the Live Rewards Management menu, go to Reports submenu and select Gameplay Details.

STEP 2. By default, system selects date and time as per settings in Report Configuration screen. However, you can select required date (in Dates Between fields) and time period (in Time fields).

STEP 3. Optionally, you can

A. Type any/all of the following:

iVIEW Id

PLR Card#

Asset#

Select Game from the drop-down list.

STEP 4. Once you have made all your selections, click Show to view the transaction report.

STEP 5. Select Export Format from the drop-down list to save the generated report into your desired output.

STEP 6. Next, click Save/Open. System prompts with you as "Do you want to open or save this file?".

A. Click Open to view the report through your selected medium.

B. Click Save. Specify required location to save the output in your selected medium.

C. Click Cancel to this task.

Referring to FIG. 43, a Report Configuration panel 4300 is shown such as may be displayed on an Operator Control Console, such as a Bally Control Panel and/or a Bally Live Rewards Server Management Console, connected to a server network, such as a Bally SMS & CMS. A closeup view of the report configuration panel 4302 is shown in FIG. 43A. The operator control console may comprise a conventional personal computer with coding implemented to execute various processes associated with the network servers and gaming machines. The Report Configuration panel may include fields for the Casino Name, Casino Address, Reports Default Time, and Save Settings.

Report Configurations

Purpose: To customize the parameters for generating reports. By default, the report gets generated every 24 hours.

Procedure: Follow these steps to set up default values for the reports.

STEP 1. Type name of the casino in Casino Name field (May be mandatory). The maximum length is 20 characters (including spaces and special characters).

STEP 2. Type street address of the casino in Casino Address1 field (May be mandatory). The maximum length is 50 characters (including spaces and special characters).

STEP 3. Type state and country of the casino in Casino Address2 field. The maximum length is 50 characters (including spaces and special characters).

STEP 4. Type contact details of the casino in Casino Address3 field. The maximum length is 50 characters (including spaces and special characters).

STEP 5. Select hour, minutes, seconds in Reports Default Time field. This is for setting up the time period while generating reports. The report generates for 24 hours. For example: If Time is set as 14:00:00, then the report may be generated from 14:00:00 (previous date) to 14:00:00 (current date).

STEP 6. Click Save Settings. System saves the settings and confirms the same by displaying the message as shown below.

Referring to FIG. 44, a Notification Messages panel 4400 is shown such as may be displayed on an Operator Control Console, such as a Bally Control Panel and/or a Bally Live Rewards Server Management Console, connected to a server network, such as a Bally SMS & CMS. A closeup view of the notification messages panel 4402 is shown in FIG. 44A. The operator control console may comprise a conventional personal computer with coding implemented to execute various processes associated with the network servers and gaming machines. The Notification Messages panel may include fields for Dates Between, iView or Live Rewards Server Notifications, Show, Select Export Format, Save/Open, and Request Summary. The Request Summary may include fields for Event Type, Event Date Time, iViewID, Asset Number, Error Code, Event Info.

All iVIEW events and Live Rewards server events are logged on one of the network servers and may be recalled for display on the Notification Messages panel. This feature is used to help casino personnel view error or other events for maintenance and customer service reasons.

| Field Name | Description |
|---|---|
| Event Info | The short description of the issue observed by the iView device. |

-continued

| Field Name | Description |
|---|---|
| Live Rewards Server Notifications | |
| DateTime | The date and time when the LRS encounters any run time error. |
| Application Name | The name of the application. |
| Module Name | The name of the module. |
| Message Type | The type of the message written by the Live Rewards management application. |
| Message Description | The short description of the message. |

Notification Messages Report

Purpose: To generate a report that displays the errors/debug observations posted by the iVIEW devices to the Live Rewards management application. This report also displays the internal logs written by the LRS. For example, tilt messages on the iVIEW.

Field Description

This section lists the different filters and their descriptions for the Notification Messages report.

Report Column Description

This section lists the column headers and their description for the Notification Messages report.

Procedure: Follow these steps to generate Notification Messages report.

STEP 1. From the Live Rewards Management menu, go to Reports submenu and select Notification Messages.

STEP 2. By default, system selects date and time as per the defaults set in Report Configuration screen. However, you can select required date (in Dates Between fields) and time period (in Time fields).

STEP 3. Select iVIEW Notifications or Live Rewards Server Notifications radio button.

STEP 4. Click Show to view the report based on your selection.

STEP 5. Select Export Format from the drop-down list to save the generated results into your desired output.

STEP 6. Next, click Save/Open. System prompts: Do you want to open or save this file?

A. Click Open to view the report through your selected medium.

B. Click Save. Specify the required location to save the output in your selected medium.

C. Click Cancel to this task.

Referring generally to FIG. 45-49, settings changes may be logged and recalled by an operator at a control console panel 4500.

Settings Change History Report

Purpose: To generate report that lists the history of changes made to the following components:

Global Settings

Live Rewards Start Rules

Games

Pay Table Sets

Banned Players

User Profile Changes, and

Users Logon Session details.

This report displays the date and time when these changes happened, primary and secondary users' IDs who are responsible for these changes and comments/reasons for the changes. This report can be used for auditing purpose.

Field Description

This section lists the different filters and their descriptions for the Settings Change History report.

Procedure: Follow these steps to generate Settings Change History report.

STEP 1. From the Live Rewards Management menu, go to Reports submenu and select Settings Change History.

STEP 2. By default, system selects date and time as per the defaults set in Report Configuration screen. However, you can select required date (in Dates Between fields) and time period (in Time fields).

STEP 3. Select any one of the following radio button

Global Settings

Live Rewards Start Rules

Games

Pay Table Sets

Banned Players

User Changes

Users Session

STEP 4. Click Show to view the report based on your selection.

STEP 5. Select Export Format from the drop-down list to save the generated results into your desired output.

STEP 6. Next, click Save/Open. System prompts with you as Do you want to open or save this file?.

A. Click Open to view the report through your selected medium.

B. Click Save. Specify the required location to save the output in your selected medium.

C. Click Cancel to this task.

Referring to FIG. 50, a Patron Account Activity Summary/Details panel 5000 is shown such as may be displayed on an Operator Control Console, such as a Bally Control Panel and/or a Bally Live Rewards Server Management Console, connected to a server network, such as a Bally SMS & CMS. A closeup view of the patron account activity panel 5002 is shown in FIG. 50A. The operator control console may comprise a conventional personal computer with coding implemented to execute various processes associated with the network servers and gaming machines. The Patron Account Activity Summary/Details panel may include fields for Dates Between, Summary, Details, Player Card Number, Show, Select Export Format (such as PDF), Save/Open, and Activity Summary/Detail.

Patron Summary/Details Report

Purpose: To generate a summary of player card number-wise transaction report. In addition, you can also generate detailed player-wise transaction report. You can filter the report based on time frame and Player Card number. The summary report in accordance with player card number lists Player card number, player name, total number of the games played, total number of games won, total number of play points accumulated and spent, total number of threshold counter accumulated and spent, total number of bonus points gained and deposited to player's account, and total amount won and got credited to the respective player's main account. The detailed report lists player card number, player name, date and time of the transaction, details about source of the Live Reward game, reward type and transaction details.

Field Description

This section lists the different filters and their descriptions for the Patron Summary/Details report.

Report Column Description

This section lists the column headers and their description for the Patron Summary/Details report.

Procedure: Follow these steps to generate Patron Account Activity Summary/Details report.

STEP 1. From the Live Rewards Management menu, go to Reports submenu and select Patron Summary/Details.

STEP 2. By default, system selects date and time as per settings in Report Configuration screen. However, you can select required date (in Dates Between fields) and time period (in Time fields).

STEP 3. Select Summary radio button to list summary of transactions in accordance to the player cards, or, Select Details radio button to list player-wise transactions.

STEP 4. Optionally, type PLR Card# to list transactions for a particular player card number.

STEP 5. Click Show to view the report based on your selection.

STEP 6. Select Export Format from the drop-down list to save the generated results into your desired output.

STEP 7. Next, click Save/Open. System prompts with you as "Do you want to open or save this file?".

A. Click Open to view the report through your selected medium.

B. Click Save. Specify required location to save the output in your selected medium.

C. Click Cancel to this task.

The charts below shows the fields and descriptions available on this Rewards Server Patron Summary/Details report:

| Field Name | Description |
|---|---|
| | Summary Report |
| PLRCarNo | Player Card Number. This is a unique code to identify the player. |
| PLRName | The name of the player. |
| TotalGamesPlayed | The total number of games played in accordance to the player card. |
| TotalGamesWon | The total number of games won that account to the player card. |
| TotalPlayPointsIn | The total number of play points accumulated in accordance to the player card. |
| TotalPlayPointsOut | The total number of play points played out in accordance to the player card. |
| TotalThresholdCounterIn | The total number of threshold counter accumulated in accordance to the player card. |
| TotalThresholdCounterOUt | The total number of threshold counter depleted in accordance to the player card. |
| TotalBonusPointsIn | The total number of bonus points won in accordance to the player card. |
| TotalBonusPointsOut | The total number of bonus points that got credited to the respective player's main account successfully. |
| TotalCashIn ($) | The total amount won in accordance to the player card. |
| TotalCashOut ($) | The total winning amount that got credited to the respective player's main account successfully. |
| | Detailed Report |
| TranDateTime | Date and Time of the transaction when it was created. |
| Source | Source of the transaction. The possible values are:<br>ALL<br>Session Bucket<br>iView<br>Game Play<br>Partial Withdrawal<br>Hand Pay<br>Live Rewards Server |
| SourceId | A unique identification code of the source. |
| SourceDetails | A short description of the source. |
| PrizeType | The type of the reward subject to the transaction. The possible values are:<br>All<br>Cash<br>Bonus Points |

-continued

| Field Name | Description |
|---|---|
| | Play Points<br>Threshold Counter |
| TranType | Type of the transaction. The possible values are Credit and Debit. |
| TranValue | Amount of the transaction. |
| Jurisdiction | Jurisdiction position of the transaction. Possible values are YES and NO. |
| Status | Status of the Transaction. Possible values are:<br>Committed<br>Open<br>Rollback |

Referring to FIG. 51, an iView (player interface unit) Summary panel 5100 is shown such as may be displayed on an Operator Control Console, such as a Bally Control Panel and/or a Bally Live Rewards Server Management Console, connected to a server network, such as a Bally SMS & CMS. A closeup view of the iView summary panel 5102 is shown in FIG. 51A. The operator control console may comprise a conventional personal computer with coding implemented to execute various processes associated with the network servers and gaming machines. The iView Summary panel may include fields for Dates Between, iView ID, Asset Number, Show, Select Export Format (such as PDF), Save/Open, and iView Summary.

Device specific reports (independent of player) may be recalled from the network database and displayed on this panel. Each of the fields displayed in the iView Summary may be described as:

| Field Name | Description |
|---|---|
| iViewId | A unique identification code of the iView device. |
| CasinoId | A unique identification code of the casino. |
| GmuId | The network identification code of the iView device. |
| AssetId | A unique identification code of the slot machine. |
| TotalGamesPlayed | The total number of games played on a particular iView device. |
| TotalGamesWon | The total number of games won on a particulart iView device. |
| TotalPlayPointsAccrued | The total number of play points accumulated on a particular iView. |
| TotalPlayPointsSpent | The total number of play points played out on a particular iView. |
| TotalCashWon($) | The total amount won in a particular iView device. |
| TotalBonusPointsWon | The total number of bonus points won on a particular iView device. |
| TotalCashWithdrawals($) | The total winning amount that got credited to the respective player's main account successfully. |

iVIEW Summary Report

Purpose: To generate report on summary of transactions for a particular iVIEW. You can filter the report based on time frame, identification code of iVIEW and/or slot machine.

The report lists identification code of iVIEW, Casino and Slot machine, network address of the iVIEW device, total number of the games played, total number of games won, total number of play points accumulated and spent, total amount won (in dollars), total number of bonus points gained and total amount transferred successfully to the respective player's account.

Field Description

This section lists the various filters and their descriptions for the iVIEW Summary report.

Report Column Description

This section lists the column headers and their description for the iVIEW Summary report.

Procedure: Follow these steps to generate iVIEW Summary report.

STEP 1. From the Live Rewards Management menu, go to Reports submenu and select iVIEW Summary.

STEP 2. By default, system selects date and time as per settings in Report Configuration screen. However, you can select required date (in Dates Between fields) and time period (in Time fields).

STEP 3. Optionally, you can

A. Type iVIEW ID to view summary of a particular iVIEW device.

B. Type Asset# to view summary of the iVIEW device on a particular slot machine.

STEP 4. Click Show to view the report based on your selection.

STEP 5. Select Export Format from the drop-down list to save the generated results into your desired output.

STEP 6. Next, click Save/Open. System prompts: Do you want to open or save this file?

A. Click Open to view the report through your selected medium.

B. Click Save to save the generated report in your selected medium. System opens Save As dialog box. Specify required location.

C. Click Cancel to this task.

Referring to FIG. 52, a Liability Report panel 5200 is shown such as may be displayed on an Operator Control Console, such as a Bally Control Panel and/or a Bally Live Rewards Server Management Console, connected to a server network, such as a Bally SMS & CMS. A closeup view of the liability report panel 5202 is shown in FIG. 52A. The operator control console may comprise a conventional personal computer with coding implemented to execute various processes associated with the network servers and gaming machines. The Liability Report panel may include fields for Date and Time, Show, Select Export Format, Save/Option, Prize Type, Opening Balance, Total In, Total Out, Expire Quantity, and Closing Balance.

Liability Report

Purpose: The Liability report displays the outstanding cash and play points, un-transferred bonus points and threshold counter values for a particular day, for the entire casino. It can also be generated as a patron liability report.

Field Description

This section lists the different filters and their descriptions for the Liability report.

Procedure: Follow these steps to generate Liability report.

STEP 1. From the Live Rewards Management menu, go to Reports submenu and select Liability Summary.

STEP 2. By default, system selects date as system date and time as per settings in Report Configuration screen. However, you can select required date (in On field) and time period (in Time fields).

STEP 3. Select Total Liability or Patron-wise Liability option. By default, system selects Total Liability option.

STEP 4. Click Show to view the report. System deploys the total outstanding cash and play points, un-transferred bonus points and fresh threshold counter values for the selected day.

STEP 5. Select Export Format from the drop-down list to save the generated results into your desired output.

STEP 6. Next, click Save/Open. System prompts with you as "Do you want to open or save this file?"

A. Click Open to view the report through your selected medium.

B. Click Save. Specify the required location to save the output in your selected medium.

C. Click Cancel to this task.

Referring to FIG. 53, a Patron Account Activity Summary/Details panel 5300 is shown such as may be displayed on an Operator Control Console, such as a Bally Control Panel and/or a Bally Live Rewards Server Management Console, connected to a server network, such as a Bally SMS & CMS. A closeup view of the patron account activity panel 5302 is shown in FIG. 53A. The operator control console may comprise a conventional personal computer with coding implemented to execute various processes associated with the network servers and gaming machines. The Patron Account Activity Summary/Details panel may include fields for Dates Between, Summary, Details, Player Card Number, Show, Select Export Format (such as PDF), Save/Open, and Activity Summary/Detail.

Patron Transaction Details

Purpose: To generate a transaction report for a particular player card number. You can filter the report based on time frame and prize type. The report in accordance with player card number lists player card number, transaction identifier, date and time of the transaction, details about source of the Live Reward game, reward type and transaction details.

Field Description

This section lists the different filters and their descriptions for the Patron Transaction Details report.

Procedure: Follow these steps to generate Patron Transaction Details report.

STEP 1. From the Live Rewards Management menu, go to Reports submenu and select Patron Transaction Details.

STEP 2. By default, system selects date and time as per settings in Report Configuration screen. However, you can select required date (in Dates Between fields) and time period (in Time fields).

STEP 3. Type Player Card# to list transactions for a particular player card number (May be a mandatory step).

STEP 4. Optionally, select Prize Type from the drop-down list.

STEP 5. Click Show to view the report based on your selection.

STEP 6. Select Export Format from the drop-down list to save the generated results into your desired output.

STEP 7. Next, click Save/Open. System prompts with: Do you want to open or save this file?

A. Click Open to view the report through your selected medium.

B. Click Save. Specify required location to save the output in your selected medium.

C. Click Cancel to this task.

Referring to FIG. 54, a Patron Account Activity Summary/Details panel 5400 is shown such as may be displayed on an Operator Control Console, such as a Bally Control Panel and/or a Bally Live Rewards Server Management Console, connected to a server network, such as a Bally SMS & CMS. A closeup view of the patron account activity panel 5402 is shown in FIG. 54A. The operator control console may comprise a conventional personal computer with coding implemented to execute various processes associated with the network servers and gaming machines. The Patron Account Activity Summary/Details panel may include fields for Dates Between, Summary, Details, Player Card Number, Show, Select Export Format (such as PDF), Save/Open, and Activity Summary/Detail. In this figure, Summary has been selected and the associated information is displayed. The steps are as described in FIG. 53, apart from this selection.

Referring to FIG. 55, a Transaction Details panel 5500 is shown such as may be displayed on an Operator Control Console, such as a Bally Control Panel and/or a Bally Live Rewards Server Management Console, connected to a server network, such as a Bally SMS & CMS. A closeup view of the transaction details panel 5502 is shown in FIG. 55A. The operator control console may comprise a conventional personal computer with coding implemented to execute various processes associated with the network servers and gaming machines. The Transaction Details panel may include fields for Dates Between, Source, Player Card Number, Prize Type, Transaction Type, Show, Select Export Format (such as PDF), Save/Open, and Transaction Detail report.

The transaction ID, data/time, which player card, source of transaction, source ID, prize type, transaction type (debit/credit), transaction value, jurisdictional event, and status may be shown in this panel.

Transaction Details Report

Purpose: To generate report for all types of transactions initiated by the iVIEW devices. You can filter the report based on time frame, source of transaction, Player Card Number, reward type, transaction type and source Id. This report lists the transactions with respect to all opened and closed sessions, begin and end game, play point and Threshold counter deposits, and player cash winning transactions initiated by an iVIEW device to the LRS.

Field Description

This section lists the different filters and their descriptions for the Transaction Details report.

Procedure: Follow these steps to generate Transaction Details report.

STEP 1. From the Live Rewards Management menu, go to Reports submenu and select Transaction Details.

STEP 2. By default, system selects date and time as per the defaults set in Report Configuration screen. However, you can select required date (in Dates Between fields) and time period (in Time fields).

STEP 3. Optionally, you can

A. Select any/all of the following from the respective drop-down list:

Source

Prize Type

Transaction Type in Tran. Type field

B. Type Player Card number in Player Card # field.

C. Type Source Id, if you want to view the report of particular Source.

STEP 4. Once you have made all your selections, click Show to view the transaction report.

STEP 5. Select Export Format from the drop-down list to save the generated report into your desired output.

STEP 6. Next, click Save/Open. System prompts with you as "Do you want to open or save this file?".

A. Click Open to view the report through your selected medium.

B. Click Save to save the output in your selected medium. System opens Save As dialog box. Save the file in required location.

C. Click Cancel to this task.

| Field Name | Description |
|---|---|
| Dates Between, Time . . . | Start date, time and end date, time. You can select date range (Month and day) and time range (Hours, Minutes, Seconds) from the drop-down list. The end date should be greater than the start date. |

-continued

| Field Name | Description |
|---|---|
| | Start Date, Time<br>Dates Between<br>September 02 10 00 00<br>< > < > < > < > < ><br>End Date, Time<br>And<br>September 02 10 00 00<br>< > < > < > < > < > |
| Source | This is a drop-down list that displays a source of the transaction. The possible values are:<br>ALL<br>Displays transacations from all sources.<br>Session Bucket<br>Not currently used.<br>iView<br>Displays transactions from all iView devices. This can be credit of play points or Threshold Counters to the player's session accounts or a debit from the session account to the base game in the case of cash withdrawals. (Partial withdrawals are handled separately. Excludes partial withdrawals.)<br>Game Play<br>Displays transactions occurred in the course of all Live Reward game plays. This can be Begin Game/End Game.<br>Partial Withdrawal<br>Displays all transactions with respect to the Partial Withdrawal category. For example, you attempt to transfer $250 to the base game, but the base game's allowable transfer limit is $100, so only $100 is transferred. This constitutes a partial withdrawal.<br>Hand Pay<br>Displays all transactions with respect to Hand Pay category. For example, if your winnings are more than the jurisdictional limit, you cannot transfer the winnings to the base game. You need to initiate hand pay by pressing Collect on the iView interface, entering your PIN number, and pressing Service to inform the casino that you need assistance. Then, the casino employee gets the appropriate IRS tax forms for you to sign and pays you the cash award by hand. For this source ID is Employee Number and source is Hand Pay.<br>Live Rewards Server (LRS)<br>Displays transactions that are caused by LRS. This can be debit/credit of the cash/bonus points threshold counter/play points directly to the player's main account through the Live Rewards management application. For these transactions, the source would be LRS and the source ID would be logged in User ID (Primary User). For example, for promotional purpose, casino introduces and declares that, if anyone registers newly, they give 100 play points. So that they can play Bally Live Reward games. These play points are credited to newly registered player's account through Live Rewards management application. For this a new transaction is created and the source is LRS.<br>By default, system selects ALL, to include all sources in the report. |
| Player Card # | Player Card Number. It is a unique code to identify the player. The player card number can be an alphanumeric value of 20 characters. |

-continued

| Field Name | Description |
|---|---|
| PrizeType | This is a drop-down list that displays reward types for the transaction. The possible values are:<br>All<br>Cash<br>Bonus Points<br>Play Points<br>Threshold Counter<br>By default, system selects ALL to include all types of rewards in the report. |
| TranType | Type of the transaction. The possible values are:<br>Credit - The amount withdrawn from your account.<br>Debit - The amount deposited to your account. |
| SourceId | A unique identification of the source. |

Referring to FIG. 56, a Create New User panel 5600 is shown such as may be displayed on an Operator Control Console, such as a Bally Control Panel and/or a Bally Live Rewards Server Management Console, connected to a server network, such as a Bally SMS & CMS. A closeup view of the create new user panel 5602 is shown in FIG. 56A. The operator control console may comprise a conventional personal computer with coding implemented to execute various processes associated with the network servers and gaming machines. The Create New User panel may include fields for User Name, User ID, Password, Re-enter Password, Administrator or Player Management Only, and Create User.

Managing Users

User Authorization options help you to set up access rights for Live Rewards management application users. Upon granting access, each user type, ID and password is verified before the application is made available to them. The user type defines the tasks available to the user.

User Types and Privileges

There are two types of users: Regular and Administrator. The privileges of these user types are:

Regular

A regular user can view reports. Depending on how this user type is configured, the Regular user can ban players from playing Live Rewards, maintain player session details and debit/credit transactions from player account.

Administrator

An administrator is granted the same privileges as a regular user, plus the ability to create and maintain the following:

User Profiles

Global Settings

Start Rules for Live Rewards

Pay Table Sets

The administrator user can also debit or credit a player account, activate and register iVIEW devices, set up the defaults for generating report. For regulatory purposes, two Administrator users are often required to access User Authorization.

Regular user can access Reports submenu from the Live Rewards Management menu. Regular user can also access Player Management submenu from the Live Rewards Management menu, provided the player management role is enabled for that user.

For regulatory purposes, two Administrators are often required to access Games Management and User Authorization from the Live Rewards Management menu. This control is incorporated in the login procedure as shown with the login panel figure.

Creating a New User Account

Purpose: To create a new user account. Plus, the user can set the administrator and player management rights for the new account. Two Administrator (Admin) users may be logged in to create a new user account.

Procedure: Follow these steps to create a new user account.

STEP 1. From the Live Rewards Management menu, go to User Authorization submenu and select Create New User.

STEP 2. Type User Name (Mandatory). The maximum length is twenty characters (including spaces and special characters).

STEP 3. Type User Id (Mandatory). The maximum length is eight characters and may contain five alphanumeric characters. No special characters are allowed except under score ().

STEP 4. Type Password (May be mandatory). For example, the maximum length may be twenty characters and may contain at least six characters including spaces and special characters. Biometric identification may be used as an alternative or in addition to passwords.

STEP 5. Type password again in Re-enter Password field to confirm the password (May be mandatory).

STEP 6. Select Is Administrator check box to give admin rights to the new user.

STEP 7. Select Player Management check box to give rights to ban players from playing Live Rewards, maintain player session details and debit/credit transaction from the player account.

Password input may be case sensitive. When you type passwords, you may only see ••••• (bullets). System displays an error message "Mismatch Passwords", if there is a mismatch in the passwords entered by you in Password and Re-enter Password fields.

If Player Management check box is selected, user can access the following screens under Player Management submenu from the Live Rewards Management menu:

Clear PIN Lockout
Banned Players
Player Session Details
Active Player Sessions
Debit/Credit Player Account.

STEP 8. Click Create User. System verifies the User Id for duplication. If it is not duplicated, system creates the new user and confirms the same by displaying the message as shown below.

Figures 1, 57:
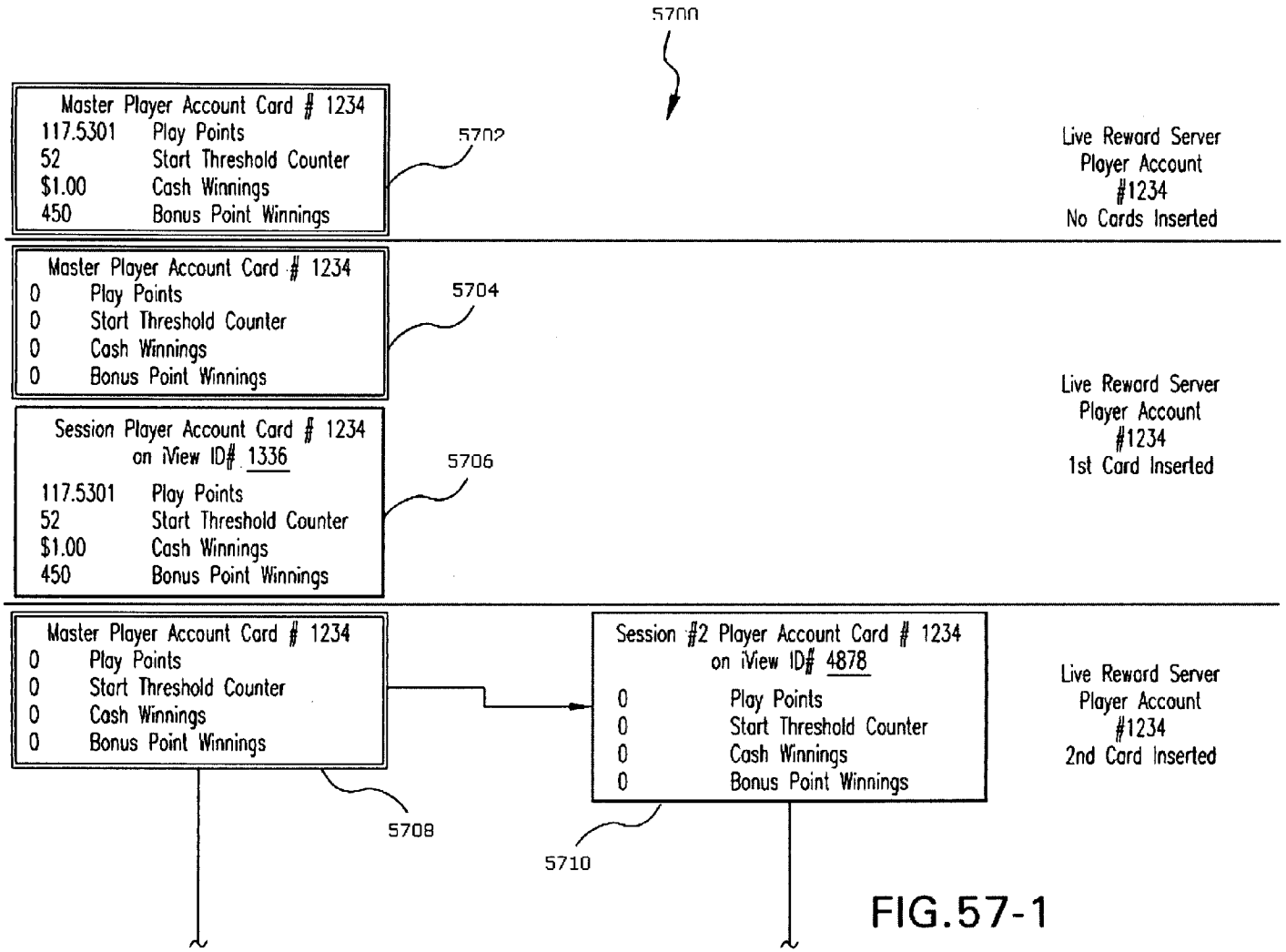
Figures 2, 57:
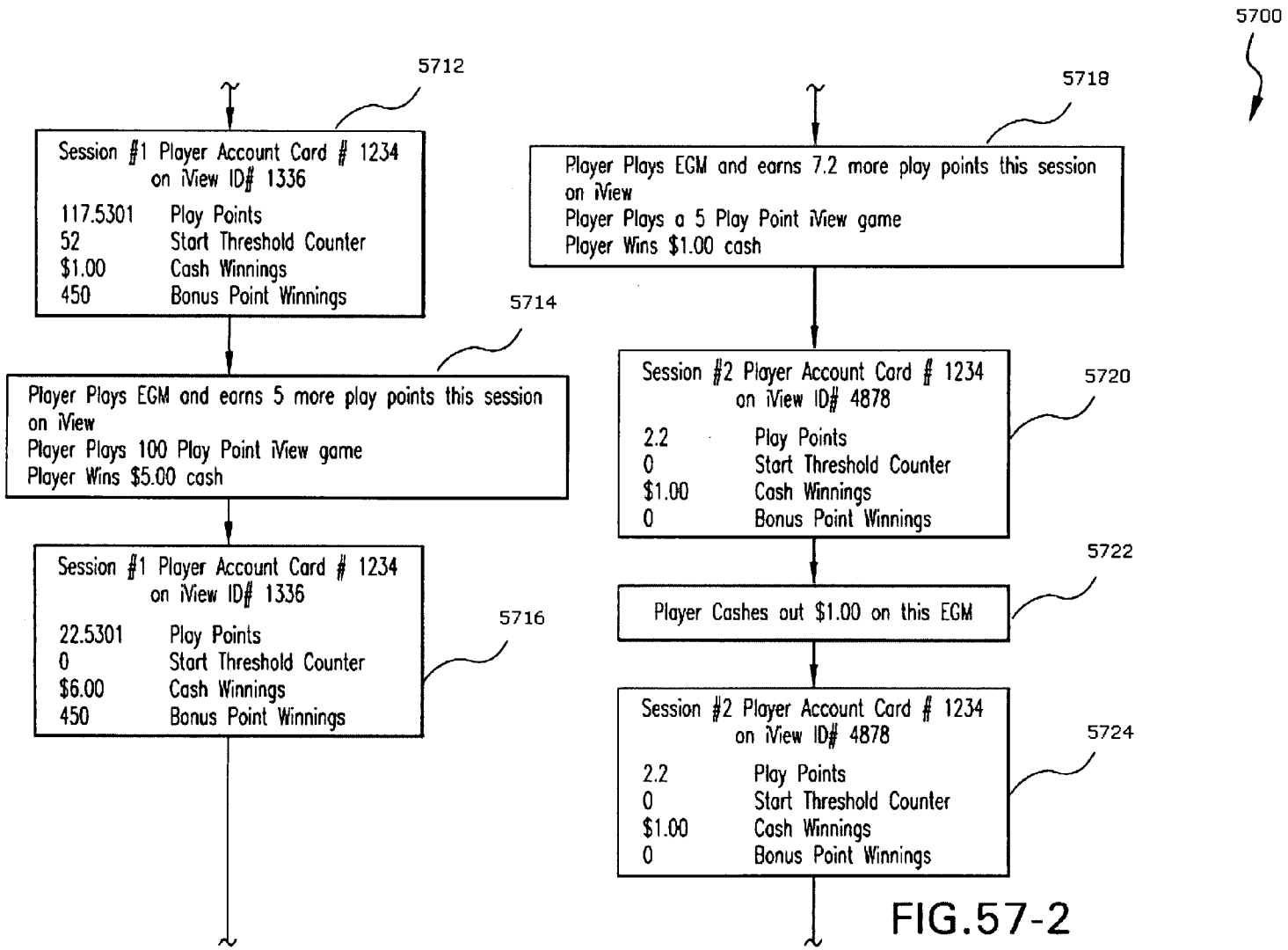
Figures 3, 57:
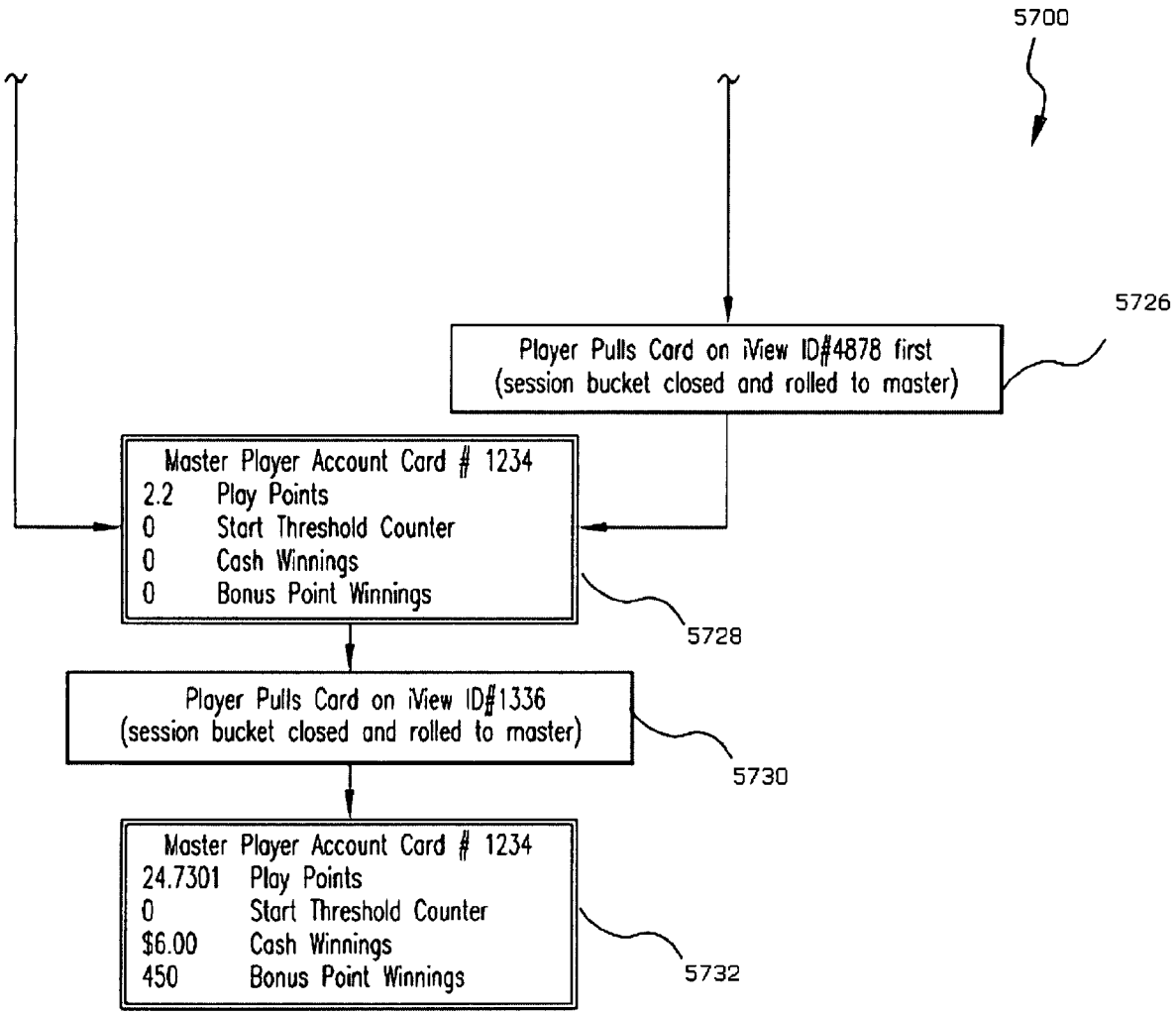

Referring to FIG. 57, a Live Reward flow graph 5700 with and without player card is shown such as may be used on an Operator Control Console, such as a Bally Control Panel and/or a Bally Live Rewards Server Management Console, connected to a server network, such as a Bally SMS & CMS. The operator control console may comprise a conventional personal computer with coding implemented to execute various processes associated with the network servers and gaming machines.

FIG. 57 is provided as FIGS. 57-1, 57-2 and 57-3. Process (graph) 5700 is illustrated with an initial state of a player account at module 5702. At module 5704, the player account is reset as the session information of module 5706 is updated with the player account data for the first player account card insertion. Basically, the first player account card insertion allows for use of the player account. At module 5708, the (empty) player account is available for a second session at module 5710, resulting from insertion of a second player card tied to the player account. From here, the two sessions occur in parallel.

At module 5712, the first session is played, with the original player account information. At module 5714, the player plays an EGM and wins, with accumulated winnings shown at module 5716. Meanwhile, at module 5718, the second session occurs, with winnings for the second session shown at module 5720. Additionally, as shown, the player cashes out at module 5722, and the session is updated at module 5724. At module 5726, the second session terminates with the player pulling the card, and data is rolled to the master account at module 5728. Likewise, at module 5730, the first session terminates and data is rolled to the master account at module 5732.

Referring to FIG. 58, a Live Rewards Session Accounts panel 5800 is shown such as may be used on an Operator Control Console, such as a Bally Control Panel and/or a Bally Live Rewards Server Management Console, connected to a server network, such as a Bally SMS & CMS. The operator control console may comprise a conventional personal computer with coding implemented to execute various processes associated with the network servers and gaming machines. The panel 5800 provides information about session accounts.

Figures 1, 59:
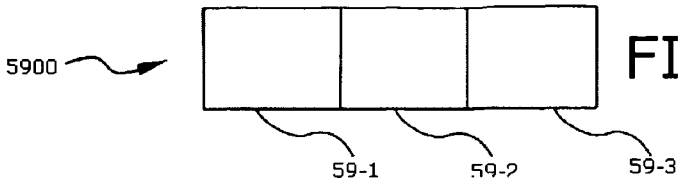

Referring to FIG. 59, a panel 5900 is shown such as may be displayed on an Operator Control Console, such as a Bally Control Panel and/or a Bally Live Rewards Server Management Console, connected to a server network, such as a Bally SMS & CMS. The operator control console may comprise a conventional personal computer with coding implemented to execute various processes associated with the network servers and gaming machines. The panel 5900 provides data from the process of updating an account.

Referring to FIG. 60-61, a Live Rewards Gaming Network is illustrated, which may include an Operator Control Console, such as a Bally Control Panel and/or a Bally Live Rewards Server Management Console, connected to a server network, such as a Bally SMS & CMS. The operator control console may comprise a conventional personal computer with coding implemented to execute various processes associated with the network servers and gaming machines.

In one embodiment, the following equipment is specified.

iView Equipment

In one embodiment, iVIEW is an LCD touch-screen display that replaces the 2-line, 2×20 display and keypad that are currently separate devices on the standard Enhanced Player Interface (EPI). iVIEW can upgrade any current EPI device, and supports all existing GMU functionality.

Live Rewards Server

The LRS communicates with iVIEW through Web Services over http/http(s).

Hardware

P/N: BS-90-0031

1 ea. external HP ProLiant DL 140G2 Rack 1U 1X Xeon 2.8/1M 1 ea. USB Floppy Disk Drive 2 ea. HP 36 GB 15K Ultra320 NHP Hard Drive DVD Option Kit DL145

ML110 SCSI RAID CTR WW (Adaptec 2120S).

Software

Microsoft Windows Server 2003 Standard Edition

Microsoft Windows SQL Server 2000 with Service Pack 3

Microsoft Internet Information Server 6.0 (IIS)

Microsoft .NET Framework 2.0

Crystal Reports—Redistribution Package iSeries Access for Windows (Service Pack 6082 and higher)

Gamenet.exe.1050 (Live Rewards are supported only with the Windows Gamenet)

iVIEW.bin.960

SMS_NT.HEX.10800

Gns.exe.2010 (Live Rewards are supported only with the Windows Gamenet Server).

Referring to FIG. 60, the system 6000 is shown with a client side device 6010 and a server side device 6050. Client device 6010 includes an Audio amplifier 6015, speakers 6020, iView processor 6025, card reader 6030, communications processor 6035 and EGM 6040. Server side devices 6050 includes an Ethernet switch 6055, Ethernet connections 6060, a live rewards server 6065, CMP 6085, SDS server 6080, gamenet bridge 6075, and slot line connector 6070 with optional intermediate board (harmonica board) if necessary to coordinate signals from multiple client devices 6010. Communications processor 6035 communicates via slot line 6070 with the gamenet bridge 6075, providing results from EGM 6040. iView processor 6025 communicates with the live rewards server 6065 via Ethernet connections 6060 to provide interactive player-specific information from the rewards system.

Referring to the illustration in FIG. 61, a gaming system 6100 is provided. The gaming system includes a client machine 6110, gamenet bridge 6135, SDS server 6160, CMS/CMP server 6150, rewards server 6140 and game to server communications link 6145. The client machine 6110 houses a game, with an iView module (rewards module) 6115, communications module 6120, game unit (base game 6125) and credit meter 6130. Also represented is a card slot. Communications module 6120 communicates using a slot line with gamenet bridge 6135, providing basic game information, such as wins, losses, credit information, etc. Likewise, rewards module 6115 communicates via game to server link 6145 with rewards server 6140, providing information about rewards status to the server, and conveying messages from the server to the player.

Referring to FIG. 62

FIG. 62 depicts a software flowchart 6200 showing how the Live Rewards bonus game frequency of play is controlled. The server side variables are configured as shown in FIG. 32. Events (6205, 6210, 6215, 6220, 6225) contribute to a threshold counter 6230. The threshold counter 6230 and the cost of the game are used to control the frequency of a player being able to play a live rewards game. Even if the player has enough play points to play the game may not be enabled to play unless the business rules on this figure are achieved.

The base game played 6280 provides play points to a total unused play points 6280. If the total unused play points are not enough to achieve a payment at module 6275, a determination of the percentage for starting the next game is made at module 6265. If the determination at module 6275 is that enough unused play points are present, then a determination of the percentage for starting the next game is made at module 6260. At module 6250, the threshold counter divided by the system game start threshold from module 6240 and the percentages from modules 6260 and/or 6265 are evaluated, and the percentage necessary for completion is displayed at module 6270.

Below is the software logic routine used by the iVIEW to calculate the ability for the player to play a bonus game and how close they are to playing so each game can tease the player into playing more on their primary game because the player sees progress to earning a bonus game. In the video poker game this shows 3 of the 5 cards are dealt to the player if the player is three-fifths the way to earning the bonus game.

There is a software function running in the iVIEW called BalanceUpdateData( ) or BUD that determines whether or not a player has earned enough playpoints and StartThresholdCounter points to start a Bonus game on iVIEW. This software can also run at the server in alternate embodiments. It also returns the percentage toward the next reward level the player is so that it may be shown in the console or game. The key variable set is the NextGamePercent variable that is used to determine the progress of the lights around the game button in the console browser or how close the player is to earning their bonus game inside a game. If the variable is 50 then 50% of the playfield in Poker would be shown (for example 50% of the cards would be visible). Meaning the player is 50% the way to their earning the Poker game.

These start threshold rules are configured in the Live Rewards Game Start rules configuration screen on the Live Rewards Server (refer to FIG. 32). Referring to FIG. 36 the Threshold number is the number of play points required to fund this specific paytable for this specific game. The player specific buckets that accrue as the player plays are called PlayPoints and TC's (or threshold counter points) are used in the BUD calculations with the Play Points required for the selected game and the Game Start rules configured as configured in FIG. 32).

The play points accrued determine the reward level of the game that will be played if the player chooses to play at this time. The reward level determines the games pay table. The more Play Points the player has the greater the reward level and better the pay table is for the player. A heavy wagerer will likely have a larger reward level and get better live rewards pay tables. A light wagerer will have smaller reward level bonus games but they will still be able to play if they met the start threshold conditions of BUD.

Referring to FIGS. 63-76, the figures illustrate an embodiment of the invention as developed for the ACSC iSERIES platform.

Referring specifically to FIG. 63, FIG. 63 is illustrated as FIGS. 63-1 and 63-2. Process 6300 provides a process for maintaining rewards data. Process 6300 initiates at module 6355. At module 6360, the NT starts up. At module 6365, it is determined whether the rewards feature is enabled. If the feature is turned off, at module 6370, points required to play the game are deducted. After the patron removes their card (completes the game), then at module 6375, information about the game is retrieved from the game machine and the rewards account for the player is adjusted.

If the rewards feature is turned on, at module 6305, a patron inserts a card into a game machine. At module 6315, the game machine receives information on the player rewards account, including information from module 6310 on criteria involved in playing the game. Data for the player may be maintained at module 6320, for example. At module 6325, the NT stores the updated patron data. At module 6335, the patron determines (and provides to the system) whether to continue using the rewards system or not. If not, and the player pulls the card, then at module 6340, data from the session is sent to the NT and at module 6345, the session terminates. Note that in the example illustrated, module 6330 indicates the player played and earned 4 points.

If the player keeps playing with the rewards system by playing a system game, then at module 6350, the player selects the system game (e.g. poker, bingo, etc.) If the player pulls their card at this point, the session information is transmitted at module 6380 and the session terminates at module 6382. If the player continues to play the system game, then at module 6385 the points for the game are deducted, and at module 6390 the result is transmitted to the rewards system. Additionally, the result is displayed graphically for the user at module 6395 and the process terminates at module 6397.

Various processes, as illustrated in FIGS. 64-67, come into play in using the rewards system. Process 6400 of FIG. 64 illustrates a process of handling a system game with a player card in the device. At module 6410, the machine receives the player card. At module 6420, the machine and rewards system interact. At module 6430, it is determined if rewards tracking is active. If not, the system returns (provides) the point balance to the machine at module 6440 and transfers the points to the machine at module 6450.

If the tracking system is active, at module 6460, the points request goes through the tracking system and at module 6465 the system sends the points to the machine. Additionally, at module 6470, the system is checked for a player balance at database 6480. The balance is returned to the system at module 6490, and this point balance will be the point balance provided at module 6465.

With points earned, process 6500 of FIG. 65 executes. At module 6510, points are earned at the machine. At module 6520, it is determined whether tracking of rewards is active. If not, then at module 6530, the system is notified of the points earned (for potential later tracking). If so, then at module 6540, the system points and any residual is send to the system. At module 6550, the system updates player balances in the system database 6560.

In general, the results of playing a game are illustrated in process 6600 of FIG. 66. With a system game played at module 6610, the process determines if the tracking system is active at module 6620. If not, the system is notified of the result at module 6630. If the tracking system is active, at module 6640 the results and player details are sent to the system. At module 6650, a determination is made as to whether cash or points are desired. (This may be a result of a user input, for example.) If cash, at module 6660 the cash notify system is provided the relevant information at database 6670. If points, at module 6680 the points are added to the player account of database 6690.

If withdrawal occurs, the process 6700 of FIG. 67 executes. At module 6710, the request for a withdrawal is received. At module 6720, the machine interacts with the tracking system and at module 6730, a determination is made as to whether the tracking system is operating. If no, at module 6735, a check is made as to whether the balance is ok (such as through an authorization request) and at module 6740, any credits which are authorized are added at the machine. If the tracking system is operating/connected, then at module 6750 a request for the withdrawal is sent to the tracking system. The system verifies whether the balance is available at module 6760 using the player balances database 6770, and returns to the machine whether the amount is available or not at module 6780. This response is then returned to the machine through the system interface at module 6755 (and thus the balance is added is possible). The following further illustrates how this functionality and these processes may be realized in some embodiments.

In one embodiment, this system provides the ability for patrons to earn System Game Play Points by playing the base game. Once the patron has earned enough System Game Play Points they may be able to play a System Game on iVIEW. The specifics of this system are discussed in the following paragraphs. The patron can select whichever System Game they wish (Poker, Bingo, etc.). Once the System Game is selected, the patron may Spend their System Game Play Points to play the System Game. The system is configurable for (Cash to points) and (points for System Game play). This System Game is just like playing the base game, only on iVIEW.

After a System Game is played, if the result of the System Game is loss, then the NT may send up a 229 transaction with Result field 0. After a System Game is played, if the result of the System Game is less than the Hand pay limit, one of two things can happen. If the System Game Win Deposit is set to I (iSERIES), the system game result transaction with the amount won may be sent to the iSERIES. The iSERIES may then create a System Game Award record. The patron can then draw against the System Game Award record until the full amount is collected. Please note that multiple System Game Award records can be maintained per patron and the accumulative amount available to be collected may be sent down with each patron request. The applied amounts are deducted from the System Game Award records in the order of creation. The casino has the flexibly to make the winnings either cashable or non-cashable depending on Regulatory approval. A new withdraw transaction 225 may be generated when a System Game transfer occurs (the EI and PC meter may increment when the system set to transfer cashable credit), and (the PI meter may increment when the system set to transfer non-cashable credit). In the event that the transfer fails, a new System Game transfer void transaction 226 may occur and the money may be applied back to the patron's account. If the patron does not wish to download their winnings to the base game, they can select to have their winnings carried on their account. The casino can set how long the winnings are kept in the patrons account.

If the System Game Win Deposit is set to E(ePROMO), the system game result transaction with the points won may be sent to the Gamenet Server. The Gamenet Server may add the points to the player's account. The patron can utilize the existing ePROMO feature in the system to withdraw money at the slot.

If the result of the System Game is greater than the Hand pay limit, then the NT may send up a 229 transaction with the Money Result field 1 (Hand pay), the Hand pay amount may be displayed on the System Game for 1 minute, then the system may return for more play. The system can be set up to automatically transfer the winnings to the base game at the time of win. If the transfer is successful a 229 transaction is generated with Money Result field 2 (Game), if the transfer is unsuccessful a 229 transaction is generated with Money Result field 0 (iSERIES).

The system can be set up to always display the System Game to the patron and autoplay the System Game when the required System Game Play Points are earned. With this configuration, the patron may see his progress to playing the System Game as he is playing the base game. For example, if poker is the System Game, and it take 10 points to play the System Game. The patron may see the back of 2½ cards when they he earned 5 System Game Play Points. Once they earn another 5 points, the System Game may start automatically.

By example, System Game may be supported with the Windows Gamenet Browser and Server (hereby incorporated by reference).

iSERIES:

The iSERIES may now have to reconcile the games cashless meter. For example, if a patron withdraws $5.00 from their account onto the machine both the NT's and Game's EI meter steps for $5.00. If the result of a System Game transfer is $5.00 to the game, the NT's and Game's EI meter may both step for $5.00. The current reports that are used for ePROMO/eFUND/eBONUS may have to offset the System Game Transfer.

The iSERIES may have a System Game menu that the following options may be configured and sent to the NT in a new 232 transaction:

1) iSERIES version running supports System Game (0—Disable, 1—Enable)

a) NOTE: This option can only be changed by the user after the license key and encryption key for number of assets is applied.

2) System Game active flag by card level—Turns on/off System Game for this patron by card level. (Bit 0=Lowest, Bit 1=Middle, Bit 2=Highest, Bit 3=No Card)

3) Auto play flag (0—patron select (Dashboard default screen, patron may press new System Game button on dashboard to play System Game)/1—auto play (System Game default screen, patron may select dashboard button on the System Game to go to dashboard)

4) Default System Game ID—36 digit GUID (Glo Unique ID)—Only applies to auto play mode 5) Hand pay limit—Minimum winning amount of $$ that may cause a hand pay. (0=No limit)

6) System Game Cashless Method for Carded Players—(0=Non-Cashable, 1=Cashable)

7) System Game Cashless Method for Non-Carded Players—(0=Non-Cashable, 1=Cashable)

8) Idle Time for abandon player reset—Only applies when System Game is enabled for non-carded play. (0=Never Terminate) NOTE: This parameter is represented in minutes 9) Pin Required for System Game winning's withdraw (0—Pin not required/1—Pin Required)

10) Cash Required to earn a System Game Play Point in cents

11) Minimum System Game Play Points to play a System Game

12) System Game Win Deposit (I=iSERIES (The winning may be transmitted to the iSERIES), G=Game (The winnings may be transmitted to the MPU), E=ePROMO (The winnings may be transmitted to the Gamenet Server to be added to the players ePROMO account)

13) Max Spend Multiplier (Max Bet for the System Game, the system game may multiply the Pay table with how many points are Spent)

14) Universal Card Supported (0=Not Supported, 1=Supported) NOTE: When Universal Card is supported, both System Game Play Points and residual may be maintained on the iSERIES. If Universal Card is not supported, both System Game Play Points and residual may be maintained on the Gamenet Server.

15) System Game Winning may be maintained on (0=iSERIES, 1=Gamenet Server)

16) Additional fields may be added for future support

These transactions may be sent down in the event of a change, and every echo test. The iSERIES may be able to force the 232 transaction down to the floor On Demand.

The iSERIES may send the following information to the Gamenet Server in the 200 glo transaction subcode "s":

1) iSERIES version running supports System Game (0-Disable, 1—Enable)

a) NOTE: This option can only be changed by the user after the license key and encryption key for number of assets is applied.

2) Cash played to earn a System Game Play Point

3) System Game active flag by card level—Turns on/off System Game for this patron by card level. (Bit 0=Lowest, Bit 1=Middle, Bit 2=Highest, Bit 3=No Card)

4) Auto play flag (0—patron select (Dashboard default screen, patron may press new System Game button on dashboard to play System Game)/1—auto play (System Game default screen, patron may select dashboard button on the System Game to go to dashboard)

5) Default System Game ID—36 digit GUID (Glo Unique ID) Only applies to auto play mode 6) Hand pay limit—Minimum winning amount of $$ that may cause a hand pay. (0=No limit)

7) System Game Cashless Method for Carded Players—(0=Non-Cashable, 1=Cashable)

8) System Game Cashless Method for Non-Carded Players—(0=Non-Cashable, 1=Cashable)

9) Idle Time for abandon player reset—Only applies when System Game is enabled for non-carded play. (0=Never Terminate) NOTE: This parameter is represented in minutes 10) Pin Required for System Game winning's withdraw (0—Pin not required/1—Pin Required)

11) Purge by card level—Amount of time the System Game Play Points and Cash Residual is available to the player.

12) Minimum System Game Play Points to play a System Game in cents

13) System Game Win Deposit (I=iSERIES (The winning may be transmitted to the iSERIES), G=Game (The winnings may be transmitted to the MPU), E=ePROMO (The winnings may be transmitted to the Gamenet Server to be added to the players ePROMO account)

14) Max Spend Multiplier (Max Bet for the System Game, the system game may multiply the Pay table with how many points are Spent)

15) Universal Card Supported (0=Not Supported, I=Supported)

16) NOTE: When Universal Card is supported, both System Game Play Points and residual may be maintained on the iSERIES. If Universal Card is not supported, both System Game Play Points and residual may be maintained on the Gamenet Server.

17) System Game Winning may be maintained on (0=iSERIES, 1=Gamenet Server)

18) Additional fields may be added for future support

This transaction may be sent down in the event of a change, and every echo test.

The iSERIES may have a configuration screen that may allow the operator control the following settings per System Game:

System Game name

System Game ID—36 digit GUID (Glo Unique ID)

IVIEW Show Number per System Game

Enable/disable by card level

Enable/disable by zone, denomination (cents)

System Game description

Once the configuration is complete, the iSERIES may convert the data into a SysGameConfig.xml file and then download the file to every gamenet. NOTE: The iSERIES may have the capability of sending down a 165 transaction subcode 8 to the Gamenet to send the SysGameConfig.xml immediately via non-interlaced/interlaced 0=Non-Interlaced 1=Interlaced The iSERIES may have a liability report that may provide the total amount of System Game Winning's to the Total amount paid via Withdraw/Hand pay.

The iSERIES may have a liability report that may provide the total number of Points for each patron and a total summary.

The iSERIES may integrate all System Game data to the following: Slot Analysis, GDW, Group Analysis, Drop Breakdown, DOR, Applicable E-drop reports.

The iSERIES may have a screen that may show the operator the following:

1. Theoretical Cost (This may be a formula calculated based off of System Game Play Points and System Game Credit criteria.
2. Actual Cost for day The iSERIES may turn off System Game when the operator threshold has been met. This threshold can be set by (day, week, ect.) If a threshold value is set by the user, the counters may started from that point. Once the threshold value is reached, an override option may be implemented allowing the operator to budget additional system game money. For example, if the threshold is $10,000.00 for one day, and the threshold is reached in 20 hours, the operator could set an override for an additional $5,000.00 dollars totaling $15,000.00 in 24 hours. The threshold can be set for automation or operator interaction. When set for operator interaction, once the threshold is reached, system game is shut down. When the System Game is shut down, the patrons may not be able to earn additional System Game Play Points, and/or play system games. The user may have to turn back on, the counter may be reset at that point.

The iSERIES may now enable a new bit in the 143 transaction that System Game is enabled for that asset. The iSERIES may be able to send the players points earned and residual to the Gamenet Server on a Re-build process in the event of a crash. The iSERIES may send down the following information to the NT in the 151 transaction:

1) System Game cash residual—cash left to be played before one System Game Play Point is earned. NOTE: The cash residual may only be downloaded to the first card in. The second card may receive a cash residual of % 100
2) System Game play points (accumulated)—Current amount of System Game Play Points earned but not yet Spent. NOTE: The System Game Play Points may only be downloaded to the first card in. The second card may receive a System Game Play Points of 0

Gamenet Server:

The GAMENET SERVER may send down the following new information to the NT in the 107 transaction:

1) System Game cash residual—cash already played before one System Game Play Point is earned. NOTE: The cash residual may only be downloaded to the first card in. The second card may receive a cash residual of 0
2) System Game play points (accumulated)—Current amount of System Game Play Points earned but not yet Spent. NOTE: The System Game Play Points may only be downloaded to the first card in. The second card may receive a System Game Play Points of 0
3) Game ID—36 digit GUID (Glo Unique ID)
4) Additional fields may be added for future support The following transactions may be updated to include System Game Play Point Balance and Residual:

Transaction 003—PPS ACCOUNT STATUS INQUIRY
Transaction 053—CONFIRM OF AS/400 DEPST/WITHDR
Transaction 096—PPS BALANCE TRANSACTION
Transaction 198—PATRON THRESHOLD REACHED NT to iVIEW:

Carded Players

When the System Game Flag is set for either (0—Card In, or 2—Both) and the Auto Play flag is set to 0—patron select:

a) The NT may instruct the iVIEW to display the System Game button.
b) As the patron plays the base game, the NT may calculate and update the iVIEW of current System Game Play Points earned.
c) Whenever the patron removes their card or abandon card occurs, the following additional fields may be included in the new System Game Play Point Transaction 228:
   i) System Game cash residual—cash already played before one System Game Play Point is earned.
   ii) System Game play points (accumulated during session)—Current amount of System Game Play Points earned but not yet Spent.

If the System Game button is pressed on iVIEW:

a) The iVIEW may send the button press to the NT.
b) The NT may instruct the iVIEW of all System Game parameters.

The following information is passed to the iVIEW when the patron presses the button:

1) Zone
2) Denomination
3) Card Level
4) GO to System Game Hub
5) System Game play points (accumulated)—Current amount of System Game Play Points earned but not yet Spent.
6) Minimum System Game Play Points to play a System Game
   i) NOTE: If response from the NT is not received by the iVIEW.bin, the system selection screen may not be displayed.
   b) The iVIEW.swf may display a System Game Selection Screen that may display the contents of the SysGameConfig.xml and Pay table.xml file for each active System Game that includes:
      i) System Game type
      ii) Pay table for each Card Level (No Card, Low Level, Middle Level, and High)
      iii) System Game description
7) Once a System Game is selected
   a) The iVIEW may run currently selected System Game.
      i) Note that NT may continually send the iVIEW updated System Game Play Point calculations as the base game is played.
   b) The System Game is playable when the minimum points to play is met.
   c) When a System Game is played:
      i) The iVIEW may report System Game play and results to NT.
8) Type of System Game—(Poker, Bingo, etc.)
9) Game ID—36 digit GUID (Glo Unique ID)
10) Result (Win/Loss)
11) System Game Play Points Spent
12) Win Amount (cash)
13) Hand Pay Flag (YIN)
14) System Game Cashable Flag
15) Random # Seed 1
16) Random # Seed 2
17) Random # Seed 3
18) Random # Seed 4
19) Pay Line that was hit (1-15)
   i) The NT may update it's current parameters.
      (1) If result is a win amount that exceeds Hand Pay Limit
         (a) System Game Play transaction 229 is sent up the system.
         (b) The System Game Play Transaction includes:
20) Type of System Game—(Poker, Bingo, etc.)
21) Result (Win/Loss)
22) System Game Play Points Spent
23) Win Amount (cash)
24) Money Result (1=Hand pay)
25) Reason Code (Not Used)

26) System Game Cashable Flag
27) Random # Seed 1
28) Random # Seed 2
29) Random # Seed 3
30) Random # Seed 4
31) Pay Line that was hit (1-15)
32) System Game ID—36 digit GUID (Glo Unique ID)
33) Patron Account (Note: if account=000000000 the iSERIES may not create eBONUS record)
34) Corp ID
35) Prop ID
36) Suffix
37) Card Type
38) Current NT meters
39) The Hand pay amount may display on the system game for 1 minute. After 1 minute the System Game may be enabled for game play.
40) System Game cash residual—cash already played before one System Game Play Point is earned.
41) System Game play points (accumulated during session)—Current amount of System Game Play Points earned but not yet Spent.
42) Points Won
43) NOTE: The System Game play points and System Game cash residual may be cleared to 0 after the 229 transaction is generated. The Balance may still be maintained on the NT.

(1) If the result is a win amount that does not exceed Hand Pay Limit and the System Game Win Deposit is set to A.

(a) System Game Play transaction 229 is sent up the system.

(b) The System Game Play Transaction includes:

44) Type of System Game—(Poker, Bingo, etc.)
45) Result (Win/Loss)
46) System Game Play Points Spent
47) Win Amount (cash)
48) Money Result (0=iSERIES, 4=ePROMO)
49) Reason Code (Not Used)
50) System Game Cashable Flag
51) Random # Seed 1
52) Random # Seed 2
53) Random # Seed 3
54) Random # Seed 4
55) Pay Line that was hit (1-15)
56) System Game ID—36 digit GUID (Glo Unique ID)
57) Patron Account (Note: if account=000000000 the iSERIES may not create eBONUS record)
58) Corp ID
59) Prop ID
60) Suffix
61) Card Type
62) Current NT meters
63) System Game cash residual—cash already played before one System Game Play Point is earned.
64) System Game play points (accumulated during session)—Current amount of System Game Play Points earned but not yet Spent.
65) Points Won
66) The System Game play points and System Game cash residual may be cleared to 0 after the 229 transaction is generated. The Balance may still be maintained on the NT. If the win is represented in Points, the NT may only send System Game winning points in the 229 transaction, the NT may only send ePROMO points earned on the card out transaction.

(a) The patron can select whether they wish to transfer their winnings to the base game or allow the winnings to be carried on their account.

(b) If the patron chooses to collect their winnings onto the slot. The patron may press the collect button on the System Game. The iVIEW may inform the NT of the Collect Button press. The NT may send a request to the iSERIES. The iSERIES may send down the balance. The patron may be prompted with their balance and a enter amount field. The patron can select in whole dollars, how much they would like to transfer. Once, the amount is selected an EFT may be performed, the result of the EFT may be treated the same way our EFT works today, only with different transactions.

(i) If the meter verifies the NT may send up a 226 transaction with subcode 000, (ii) If the transfer was ok but the meter does not verify, the NT may send up a 230 System Game Withdraw Tilt transaction.

(iii) If the transfer was rejected by the MPU the NT may send up a 226-1 System Game Void transaction followed by a 227 System Game Transfer Not Available transaction. with a subcode representing why the MPU did not accept the transfer.

If the result is a win amount that does not exceed Hand Pay Limit and the System Game Win Deposit is set to G. The Winning may automatically be transferred to the base game at the time of win. If the transfer is successful a 229 transaction is generated with Money Result field 2 (Game), if the transfer is unsuccessful a 229 transaction is generated with Money Result field 0 (iSERIES)

At this point the patron can continue to play the base game and earn more System Game Play Points, continue to play System Game if he/she still has System Game Play Points to Spend, or pull out his/her card.

When the System Game Flag is set for either (0—Card In, or 2—Both) and the Auto Play flag is set to 1—Auto Play:

At card in, the NT may instruct the iVIEW of all default System Game parameters. The following information is passed to the iVIEW:

1) Zone
2) Denomination
3) Card Level
4) GO to Default System Game
5) System Game play points (accumulated)—Current amount of System Game Play Points earned but not yet Spent.
6) Minimum System Game Play Points to play a System Game As the patron plays the base game, the NT may calculate and update the iVIEW of current System Game Play Points earned. The System Game may display the percentage of System Game Play Points earned. For example, if poker is the System Game, and it take 10 points to play the System Game. The patron may see the back of 2½ cards when they he earned 5 System Game Play Points. Once they earn another 5 points, the System Game may start automatically.

Whenever the patron either removes their card or abandon card occurs, the 228 transaction may contain the following additional fields:

i) System Game cash residual—cash already played before one System Game Play Point is earned.

ii) System Game play points (accumulated during session)—Current amount of System Game Play Points earned but not yet Spent.

b) The process from this point is the same as Patron Select above.

NT to iVIEW:

Non-Carded Players

When the System Game Flag is set (1—No Card In, 2—Both), Auto Play may only work in this mode.

As soon as the handle meter steps, the NT may instruct the iVIEW of all default System Game parameters. The following information is passed to the iVIEW when the patron presses the button:

1) Zone
2) Denomination
3) Card Level (This parameter may not be used)
4) GO to Default System Game
5) System Game play points (accumulated)—Current amount of System Game Play Points earned but not yet Spent.
6) Minimum System Game Play Points to play a System Game As the patron plays the base game, the NT may calculate and update the iVIEW of current System Game Play Points earned. The System Game may display the percentage of System Game Play Points earned. For example, if poker is the System Game, and it take 10 points to play the System Game. The patron may see the back of 2½ cards when they he earned 5 System Game Play Points. Once they earn another 5 points, the System Game may start automatically. If the player does not play the Base Game for the length of time the iSERIES has set, the System Game may be terminated immediately. The system game may not be interrupted by idle messages sent from iSERIES.

New iVIEW Files:

Two sets of files that get downloaded with the normal download procedure.

a) System Game SWF's may use SWF IVIEW ShowNumber's 300-321.

b) SysGameConfig.xml may be assigned IVIEW Show Number 119.

i) May use an XSD to ensure .xml file is valid before loaded to floor ii) May include:

(1) System Game name
(2) System Game ID—36 digit GUID (Glo Unique ID)
(3) IVIEW Show Number per System Game
(4) Enable/disable by card level
(5) Enable/disable by zone, denomination
(6) System Game description c) Pay table.xml i) May be assigned IVIEW Show Number 120 ii) May use an XSD to ensure .xml file is valid before loaded to floor iii) May include:

(1) System Game name
(2) System Game ID—36 digit GUID (Glo Unique ID)
(3) Pay table per System Game for both Cash and Points for each Card Level (No Card, Low, Middle, and High)

Pay table.xml may be handle and signed by. It may be downloaded via SMS Download Utility and may only be downloaded to the Gamenet as long as the MD5 file is validated.

iVIEW details:

1) The iVIEW may log the results of the last 50 System Games played.
2) The iVIEW may have battery backed up Ram for buffering information for when communication between the NT is down.
3) The iVIEW may have a button on the dashboard or in eCASH for Collect System Game Winnings. This way the patron can withdraw their winnings to the slot when System Game is disabled.

Example System Game Play Result

Type of System Game—30 bytes ASCII

Result—1 byte binary

0=Loss
1=Win

System Game Play Points Spent—4 bytes binary

Win Amount (cents)—8 bytes binary

Money Result—1 byte binary

0=iSERIES
1=Hand pay
2=Game
3=Tilt—
4=ePROMO
5=Loss

Reason Code—1 byte binary

6=Unconfirm
7=Reset

System Game Cashable Flag—1 byte binary

Random # Seed 1-2 bytes binary
Random # Seed 2-2 bytes binary
Random # Seed 3-2 bytes binary
Random # Seed 4-2 bytes binary
Pay Line—1 byte binary
System Game ID—36 digit GUID (Glo Unique ID)—36 bytes ASCII
Coin In—2 bytes
Coin Out—2 bytes
Hand pay—2 bytes
Handle Pulls—2 bytes
Coin Drop—2 bytes
Lucky Star—2 bytes
Coin Paid—2 bytes
Hand Paid—2 bytes
$1 Bills—2 bytes
$5 Bills—2 bytes
$10 Bills—2 bytes
$20 Bills—2 bytes
$50 Bills—2 bytes
$100 Bills—2 bytes
Promo In—2 bytes
Val Drop Door—2 bytes
Val Drop Box—2 bytes
EFT In—2 bytes
EFT Out—2 bytes
Promo Cash—2 bytes
Redeem Count MSB—2 bytes
Print Count MSB—2 bytes
Spare1—2 bytes
Spare2—2 bytes
Sequence Number—2 bytes
Patron Account—9 bytes (ASCII)
Corp Id—1 byte (ASCII)
Prop Id—1 byte (ASCII)
Card Type—2 bytes (ASCII)
Suffix—2 byte (ASCII)
System Game Cash Redidual—4 bytes binary
System Game Play Points Earned—4 bytes binary
Points Won—8 bytes binary Example SMS Transactions from NT to Gamenet:

Request for System Game Balance
Withdraw System Game Winnings
System Game Withdraw Confirmed
System Game Withdraw Void
System Game Withdraw Not Available
System Game Play Points Earned Transaction
System Game Play Result Transaction
System Game Withdraw Failed No Confirm with MPU
Reset during applying credits Example SMS Transactions from System to NT:
Set Coin Residual
Set Validator Parameters
Download SMS Patron Promo/Service Key Options
Send iVIEW Files immediate
System Game Balance Available
System Game Sufficient/Insufficient Funds
System Game NT Configuration
Gamenet Server System Game Configuration Referring to FIG. 68, Bally Technologies encrypted number of assets generation is illustrated with panel 6800:

Bally Technologies support personal, verifies that the customer requesting the encrypted number of assets has the right to use the Bally-Live-Rewards feature, if the customer has the right to use the feature, they verify the number assets (slot machines) the customer has the right to use the Bally-Live-Rewards feature on. These verifications should be retrieved from the customers Project Manager or their Sales representative.

To generate the encrypted number of assets values:

Access the program AVPR#ASSET and select the Bally-Live-Rewards feature:
Enter the customers Corporate ID:
Enter the customers Property ID:
Enter the customer's iSERIES serial number:
Enter the date (MM/DD/YY) that this control value is to expire; 99/99/99 indicates expiration date of Dec. 31, 2069 (highest date system can support).
Enter the number of assets that this customer is allowed to utilize the Bally-Live-Rewards on; 99999999 indicates unlimited number of assets.
Press F13 to generate the encrypted value.
This encrypted value should now be sent to the customer (e-mail), so that the customer can apply this encrypted value to their iSERIES.

Referring to FIG. 69

Bally-Live-Rewards Asset Controls are illustrated at panel 6900: Bally-Live-Rewards feature requires License Key SMS-015 to be active, and the encrypted number of valid assets must be set. Follow normal license key installation procedures to apply the SMS-015 license key. Once the required license key is activated, the user must set the encrypted number of valid assets, before activating the Bally-Live-Rewards feature. This procedure is as follows:

The customer receives the encrypted number of valid assets for the Bally-Live-Rewards feature.

To apply the encrypted value: From the Main ACSC Menu, select option 50-SMS System Control Menu.

FIG. 70 is a screenshot 7000 of the ACSC iSERIES Live Rewards administration page. This is where the player assigns specific Asset numbers (EGMS or game devices) to run Live Reward System Games. This is also where the encrypted license management keys are entered.

From the first Bally-Live-Rewards activation screen select the mode to Maintain Asset Controls, and press the F7 key.

Bally-Live-Rewards Asset Controls:

Bally-Live-Rewards feature requires License Key SMS-015 to be active, and the encrypted number of valid assets must be set. Follow normal license key installation procedures to apply the SMS-015 license key. Once the required license key is activated, the user must set the encrypted number of valid assets, before activating the Bally-Live-Rewards feature. This procedure is as follows:

The customer receives the encrypted number of valid assets for the Bally-Live-Rewards feature.

To apply the encrypted value:

On the Apply encrypted number of assets screen enter the encrypted value that you received from Bally Support department.

FIG. 71 is a screenshot of panel 7200, the ACSC iSERIES Live Rewards administration page where a the casino applies the encrypted number of valid assets to Run Live Rewards. Likewise, FIG. 72 is a screenshot of panel 7300, the ACSC iSERIES Live Rewards administration page where the total number of Asset licenses available and unused are shown. FIG. 73 is screenshot of panel 7300 of the ACSC iSERIES Live Rewards administration page where the site can maintain assets allowed to be part of the System Games. In this example this site has an unlimited number of licenses.

FIG. 74 is screenshot of panel 7400 of the ACSC iSERIES Live Rewards administration page where the site can maintain assets allowed to be part of the System Games. This site has a 5000 licenses available to be assigned.

FIG. 75 is a screenshot of panel 7500 of the ACSC iSERIES Live Rewards administration page where the site can maintain assets allowed to be part of the System Games. This site has a 5000 licenses available to be assigned. The site is assigning a specific asset number of 525 to be allowed to run the Live Rewards system game product.

FIG. 76 is a screenshot of panel 7600 of the ACSC iSERIES Live Rewards administration page where the site can control various global features.

Figure 77:
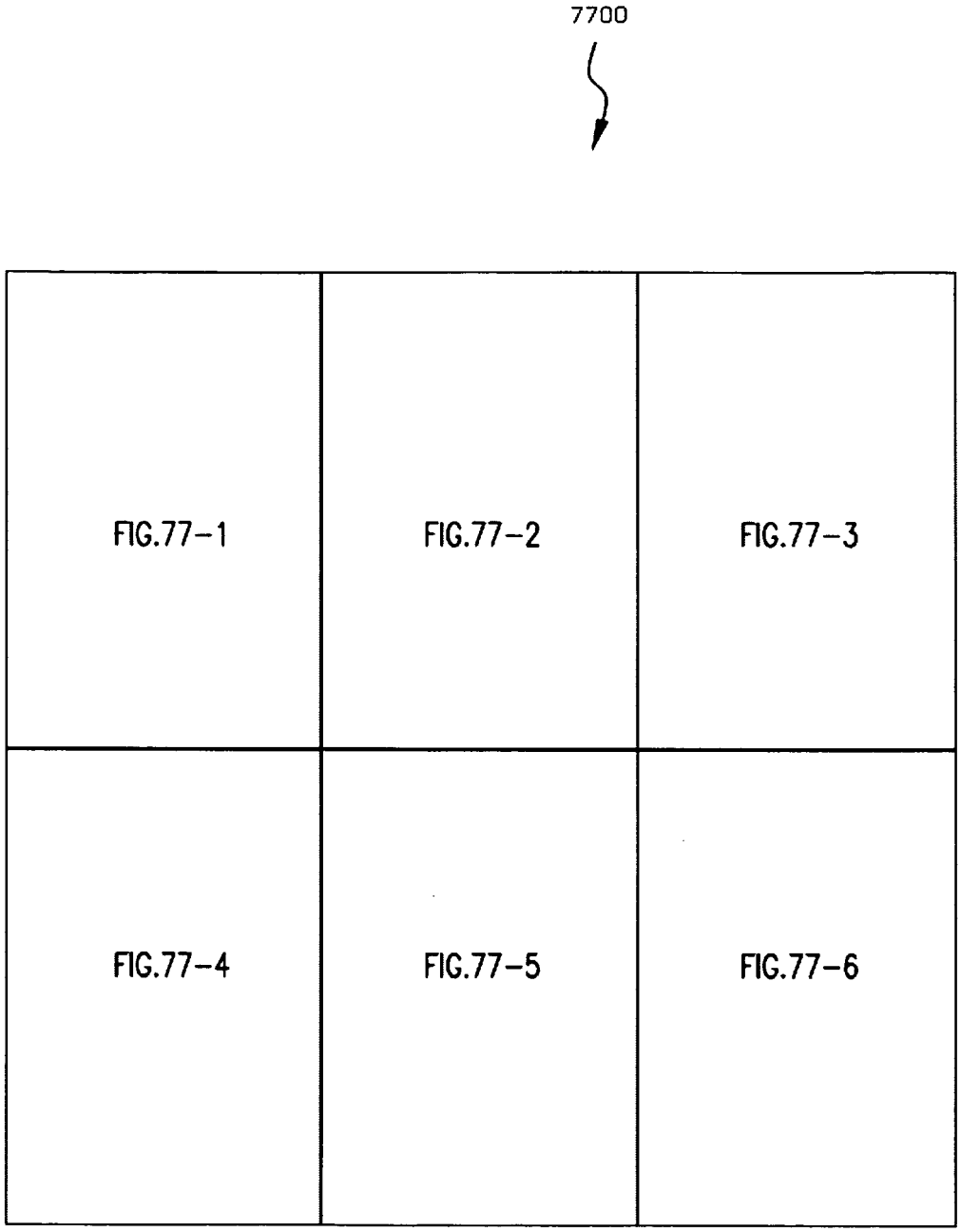
Figures 1, 77:
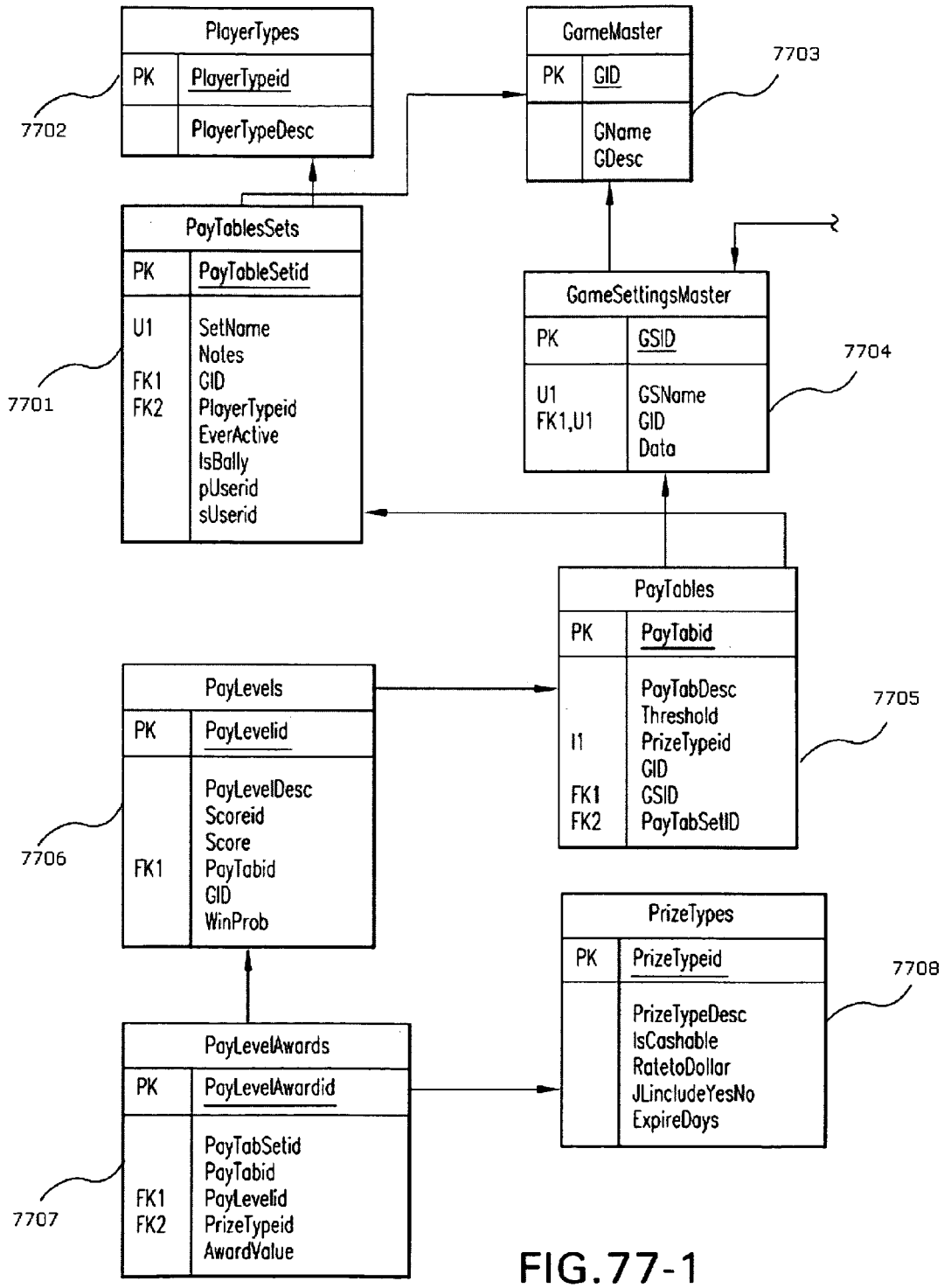
Figures 2, 77:
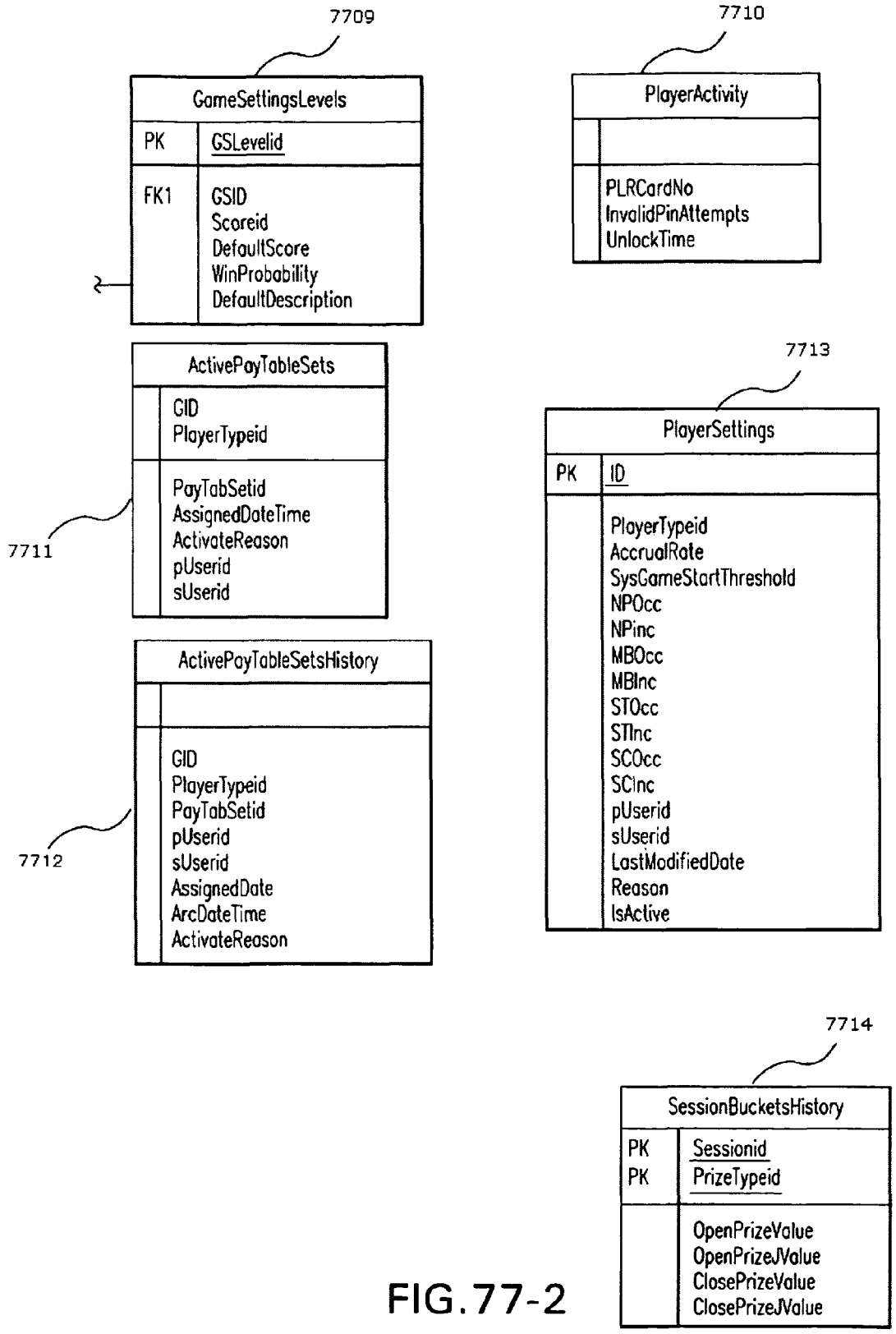
Figures 3, 77:
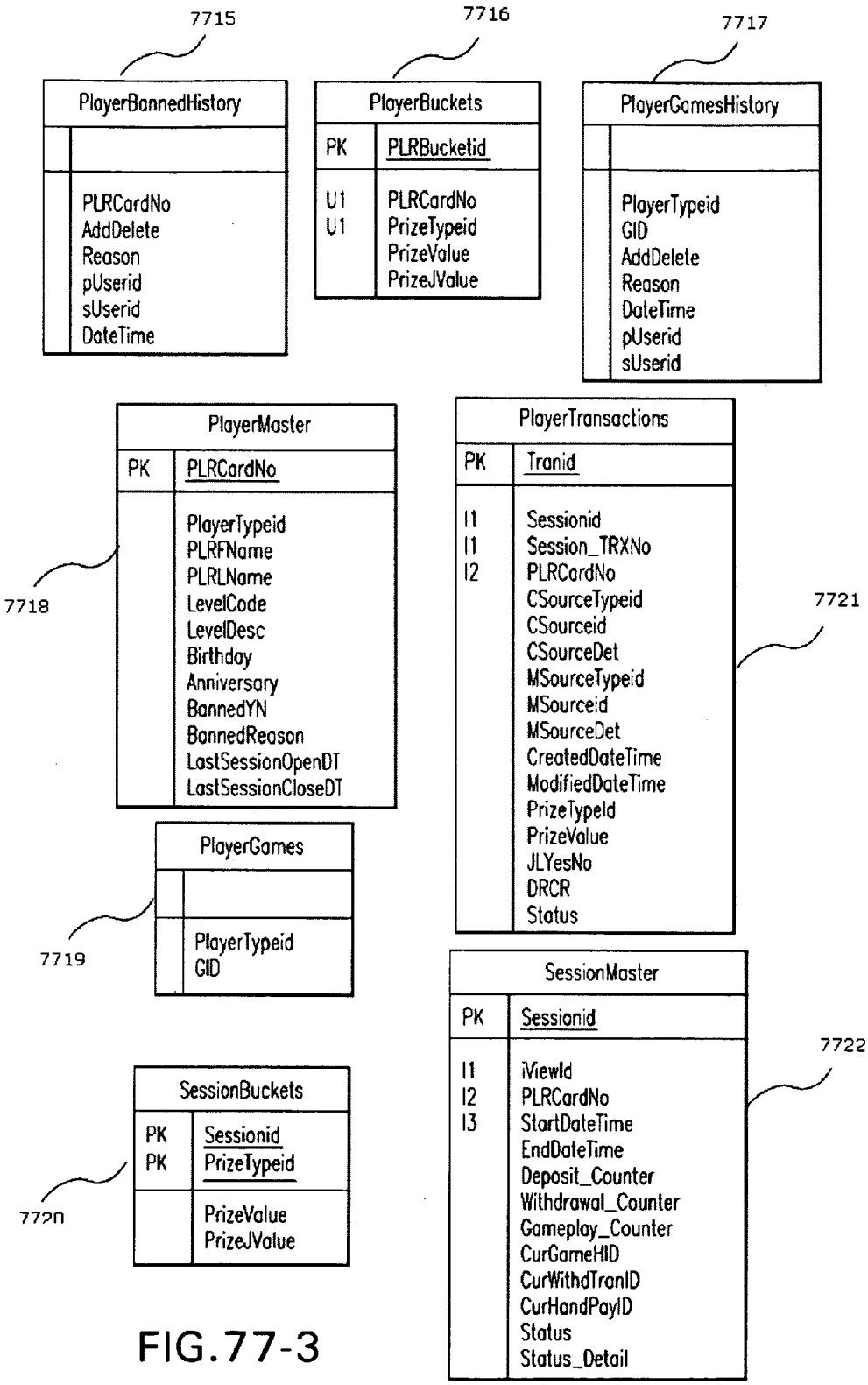
Figures 4, 77:
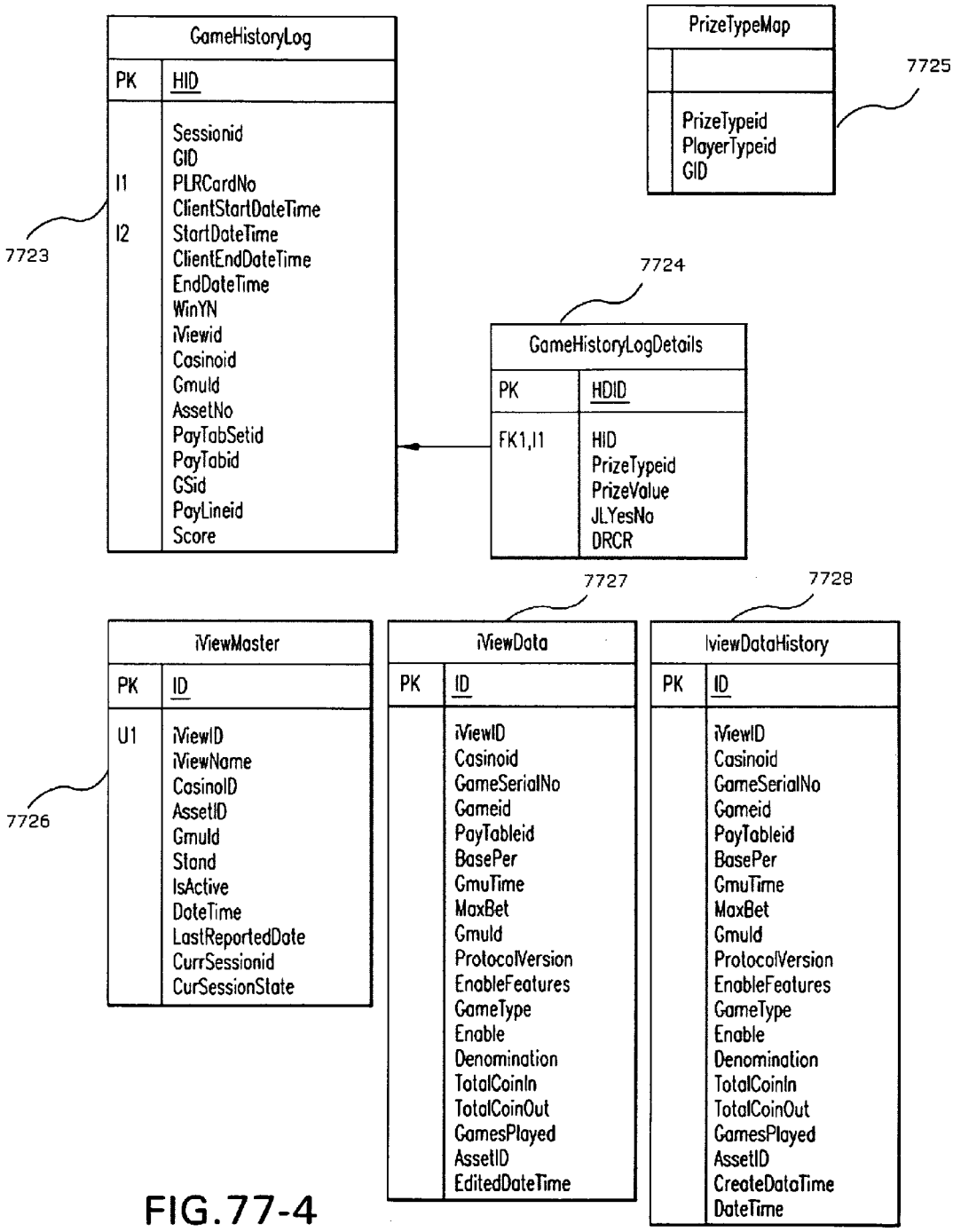
Figures 5, 77:
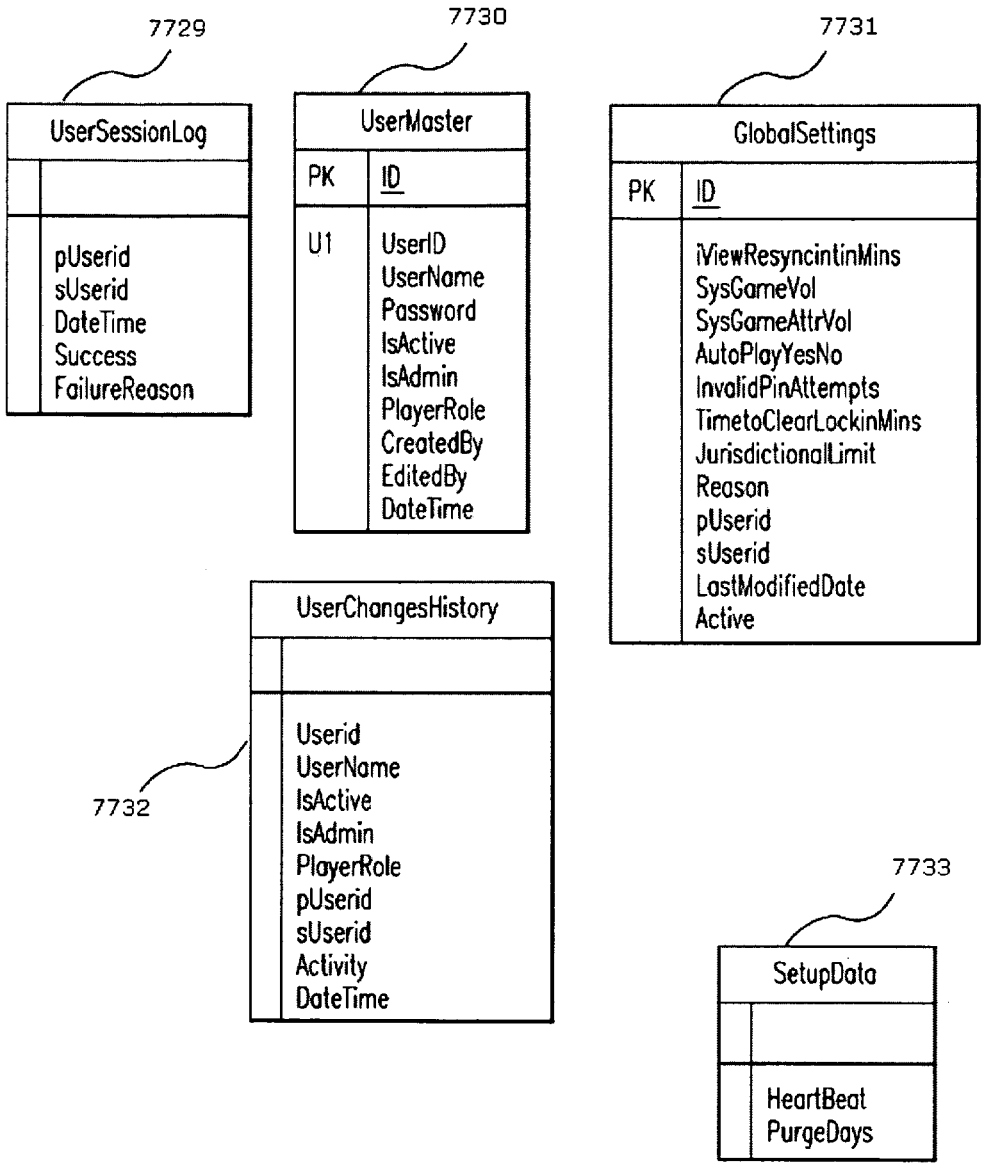
Figures 6, 77:
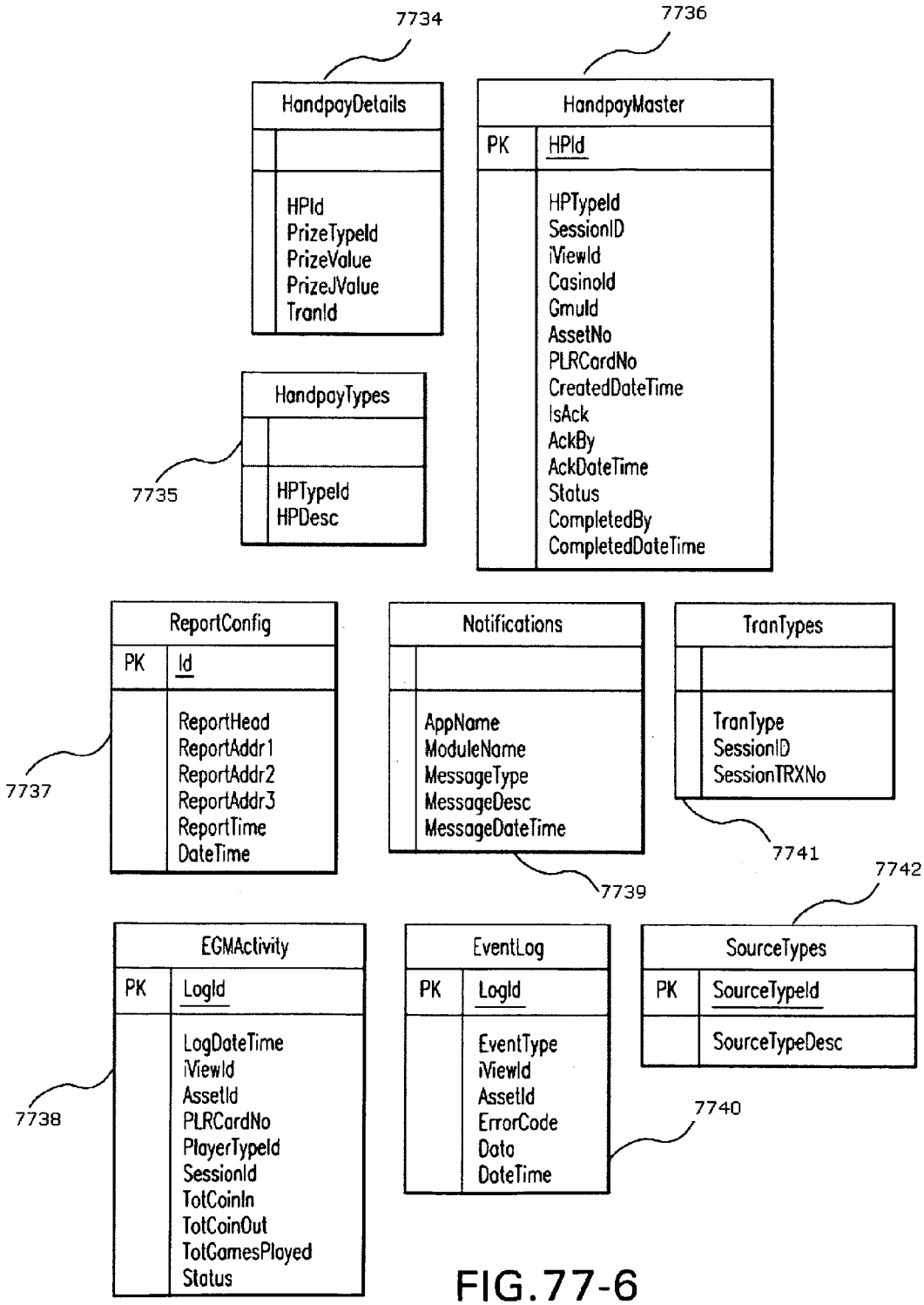

FIG. 77 is the database schema 7700 for the Live Rewards Server. This database schema 7700 illustrates the relationships between the various data elements in the following table:

| Data | Ref. No. |
|---|---|
| PlayerTypes | 7701 |
| PayTableSets | 7702 |
| GameMaster | 7703 |
| GameSettingsMaster | 7704 |
| PayTables | 7705 |
| PayLevels | 7706 |
| PayLevelAwards | 7707 |
| PrizeTypes | 7708 |
| GameSettingsLevels | 7709 |
| PlayerActivity | 7710 |
| ActivePayTableSets | 7711 |
| ActivePayTableSetsHistory | 7712 |
| PlayerSettings | 7713 |
| SessionBucketsHistory | 7714 |
| PlayerBannedHistory | 7715 |
| PlayerBuckets | 7716 |
| PlayerGamesHistory | 7717 |
| PlayerMaster | 7718 |
| PlayerGames | 7719 |
| SessionBuckets | 7720 |
| PlayerTransactions | 7721 |
| SessionMaster | 7722 |
| GameHistoryLog | 7723 |
| GameHistoryLogDetails | 7724 |
| PrizeTypeMap | 7725 |
| iViewMaster | 7726 |
| iViewData | 7727 |
| iViewDataHistory | 7728 |
| UserSessionLog | 7729 |
| UserMaster | 7730 |
| GlobalSettings | 7731 |
| UserChangesHistory | 7732 |
| SetupData | 7733 |
| HandPayDetails | 7734 |
| HandPayTypes | 7735 |

-continued

| Data | Ref. No. |
|---|---|
| HandPayMaster | 7736 |
| ReportConfig | 7737 |
| EGMActivity | 7738 |
| Notifications | 7739 |
| EventLog | 7740 |
| TranTypes | 7741 |
| SourceTypes | 7742 |

The database schema 7700 represents one embodiment of a database schema suitable for implementation of a database for tracking rewards data, accounting data, player activity, game activity, and many other features. Other embodiments of such a database and other configurations or schema may be used in other embodiments of gaming systems.

Figures 1, 78:
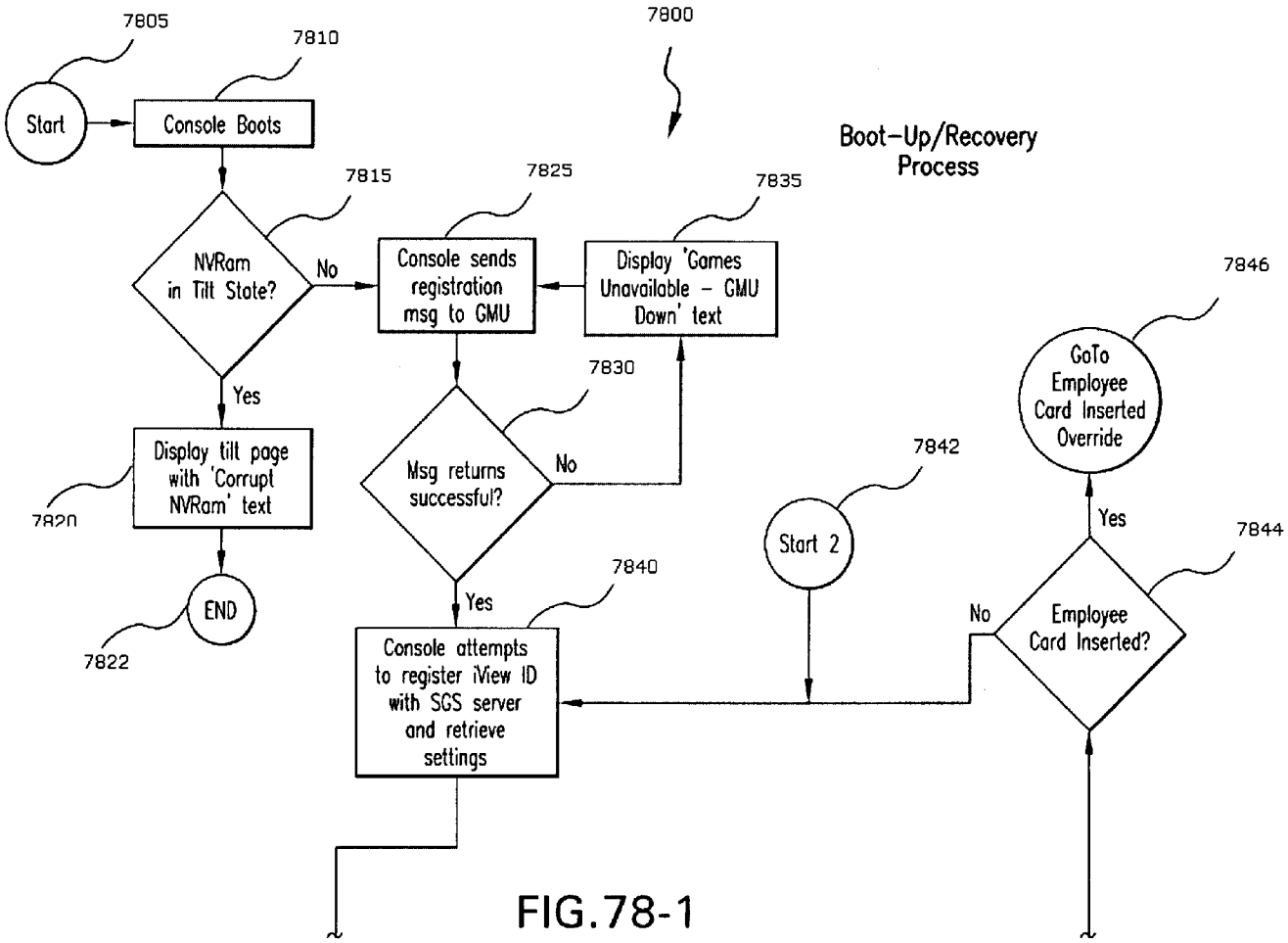
Figures 2, 78:
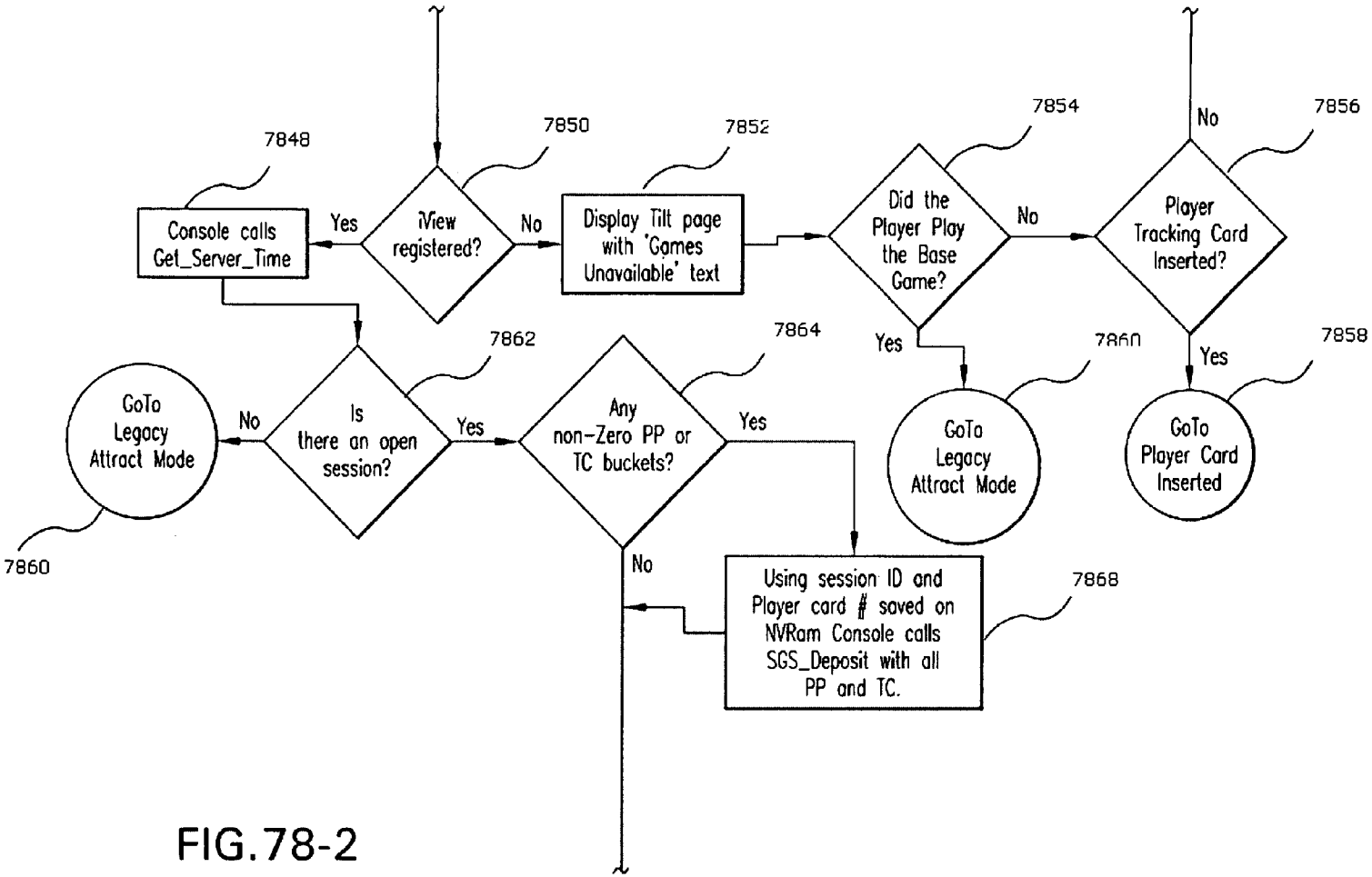
Figures 3, 78:
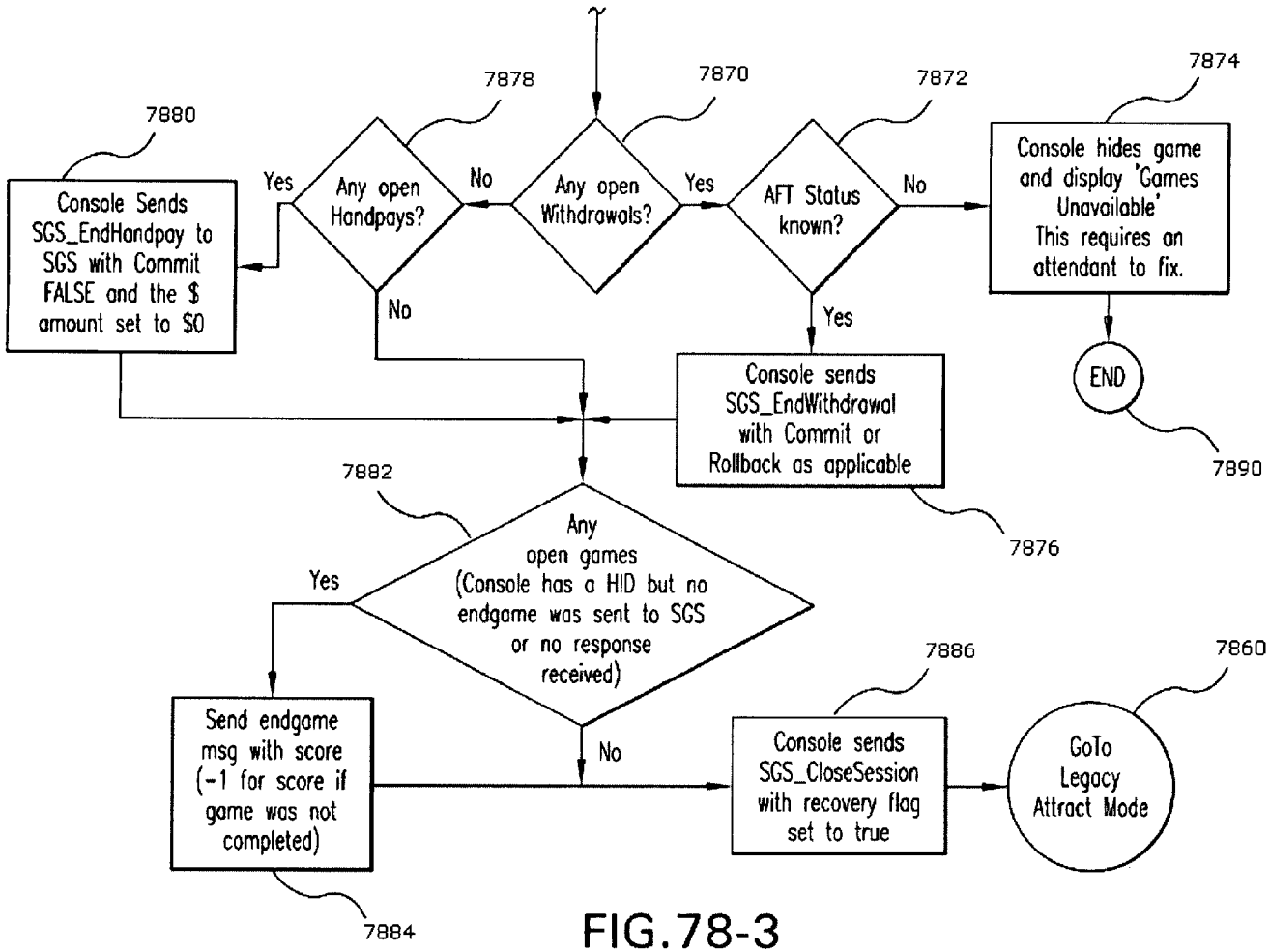

Various processes may be implemented in the embodiments described herein. The following processes provide further details of operation of one embodiment of a gaming system and components in the system. FIG. 78 (FIGS. 78-1, 78-2 and 78-3) is a flowchart of the Boot-up recovery process of the live rewards games on iVIEW. Process 7800 initiates at module 7805, and at module 7810 the console boots up. At module 7815, a determination is made as to whether the NVRAM was left in a Tilt State (e.g. the game was potentially tampered with). If yes, at module 7820 a message is displayed indicating the corrupted state, and the process terminates with module 7822 (the machine is not playable). If the NVRAM is not in a tilt state, then the console sends a registration message to the GMU at module 7825. It is determined at module 7830 if the registration message returned successfully. If not, then at module 7835 the game displays a message indicating the GMU is unavailable, and the system waits while retrying the GMU.

With the GMU registration completed, the console registers an iView ID with an SGS server at module 7840 and retrieves settings at module 7840. Note that the process can be started at this point when the system causes the machine to enter this process at module 7842. At module 7850, it is determined whether the iView registration succeeded. If not, at module 7852 the tilt games message is displayed, indicating the games are unavailable. At module 7854, a determination is made as to whether the player played the base game. If so, the process shifts to the legacy attract mode via module 7860. If the base game was not played, it is determined whether a player tracking card was inserted at module 7856. If so, the process shifts to the player tracking card inserted process via module 7858. If not, it is determined whether an employee card was inserted at module 7844. If so, the process shifts to the employee card inserted override process at module 7846, and the process attempts iView registration again at module 7840 otherwise.

With a successful iView registration, the console calls Get_Server_Time at module 7848 and determines at module 7862 if there is an open session available. If not, the process shifts to the legacy attract mode via module 7860. If so, it is determined whether there are any non-Zero PP or TC buckets (do players have points or other saved data on the game). If so, at module 7868, the saved data is deposited (e.g. points or winnings) at the server at module 7868. At module 7870, it is determined whether any open withdrawals still exist. If so, AFT status is checked (whether the status is known) at module 7872. If not, the game requires a fix by an attendant (e.g. to determine status) and the games unavailable message is displayed at module 7874 with the process terminating at module 7890. If the AFT status of any withdrawal(s) is known, at module 7876 the withdrawal(s) are terminated, either with a Commit or a Rollback as appropriate.

If there are no open withdrawals, at module 7878 it is determined whether there are any open Handpays, and if so, at module 7880, the Handpay is ended with a message to the server indicating that the Handpay was not paid. The process then moves to a determination as to whether any open games are present at module 7882. If so, at module 7884, the game is ended, either with a score or with no score if the game was incomplete. At module 7886, the machine sends a message indicating a recovery was accomplished, and the process then moves to the legacy attract mode via module 7860.

Another process implemented in some embodiments of the system is the attract mode process. FIG. 79 is a flowchart of the Attract mode logic. Process 7900 initiates at module 7905 and shows a legacy attract sequence at module 7910. It determines at module 7915 if a player tracking card was inserted. If so, it determines whether uncarded play points need to be saved at module 7945, and sends the uncarded play points to the server at module 7950. The process then shifts to the player card inserted process via module 7960.

If no player card is inserted, then at module 7920, the machine determines if it needs to save uncarded play points. If so, then at module 7970, the process determines whether the player is playing a base game. If so, the console adds the play points and TC to an internal counter. The process then moves to module 7930, and a determination is made as to whether the machine needs to get settings. If so, it gets settings at module 7940. The process then returns to module 7910.

Another process is used in some embodiments when the player card is inserted. FIG. 80 is a flowchart of what happens at Player Card insertion time. Process 8000 starts at module 8005. At module 8010, it is determined whether the iView is registered and active. If not, the process shifts to the legacy player process via module 8015.

If so, it is determined whether the player is at the Handpay screen at module 8020. If so, then at module 8040, the process determines if the same card is associated with the Handpay (or has a different card been inserted). If so, the console stays at the Handpay screen at module 8050, and shifts to the jurisdictional handpay process via module 8055. If a different card is involved, then at module 8060, the handpay process is rolled back and at module 8070 the session for the previous card is closed.

The process then moves to module 8030, and a new session is created. The console also sends the game data to the server at module 8080. The process then shifts to the legacy player process via module 8015.

Figures 1, 81:
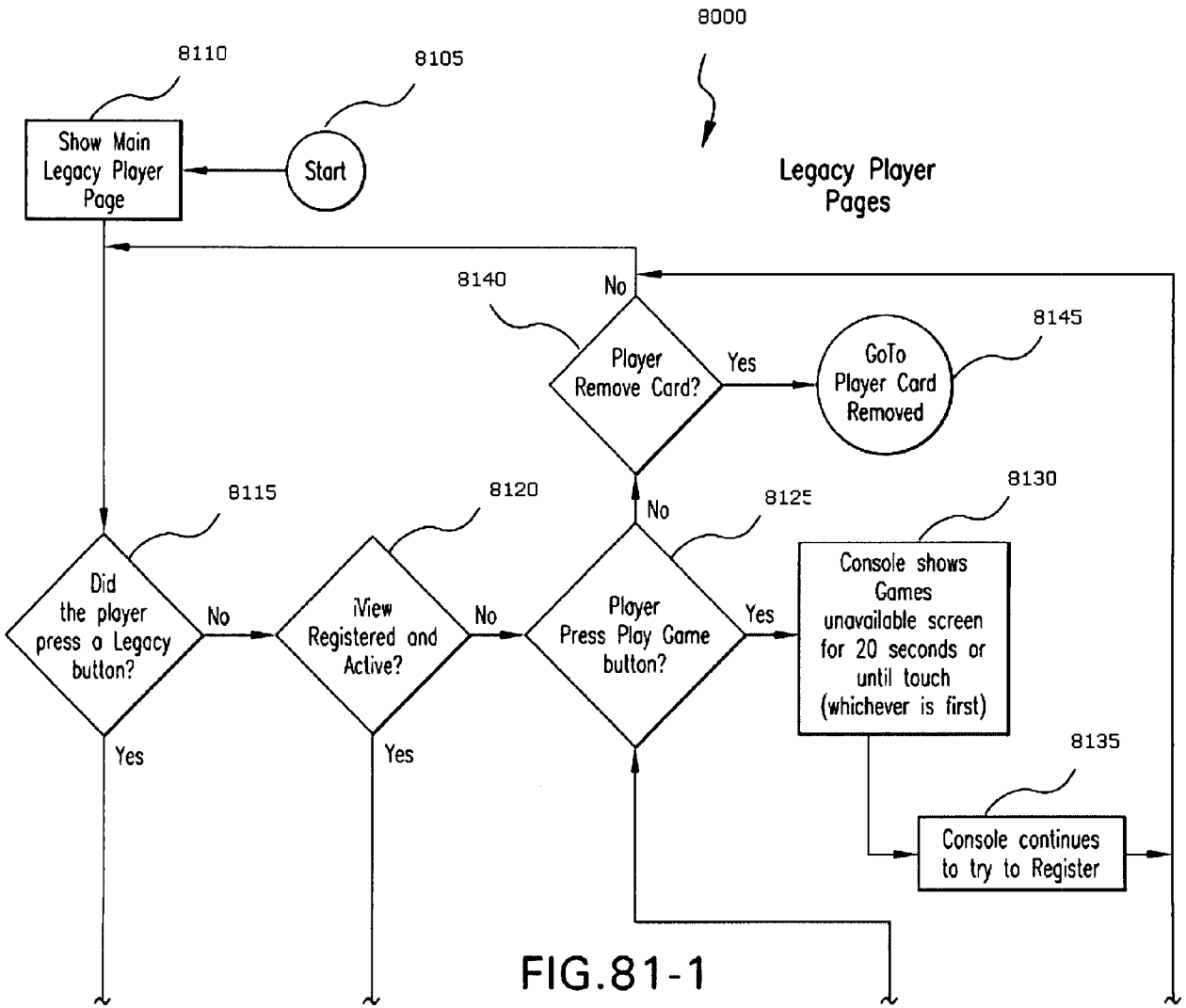
Figures 2, 81:
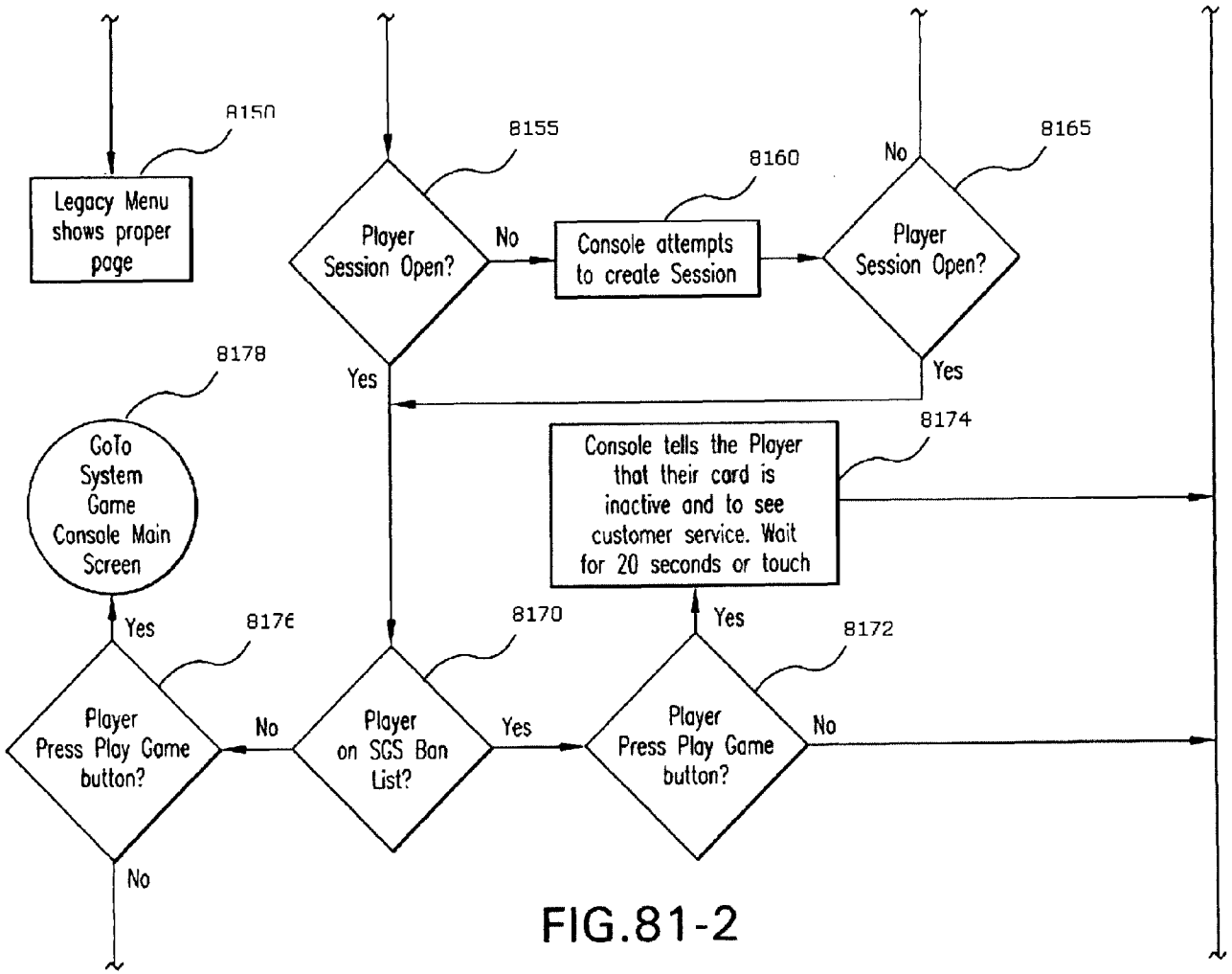
Figures 3, 81:
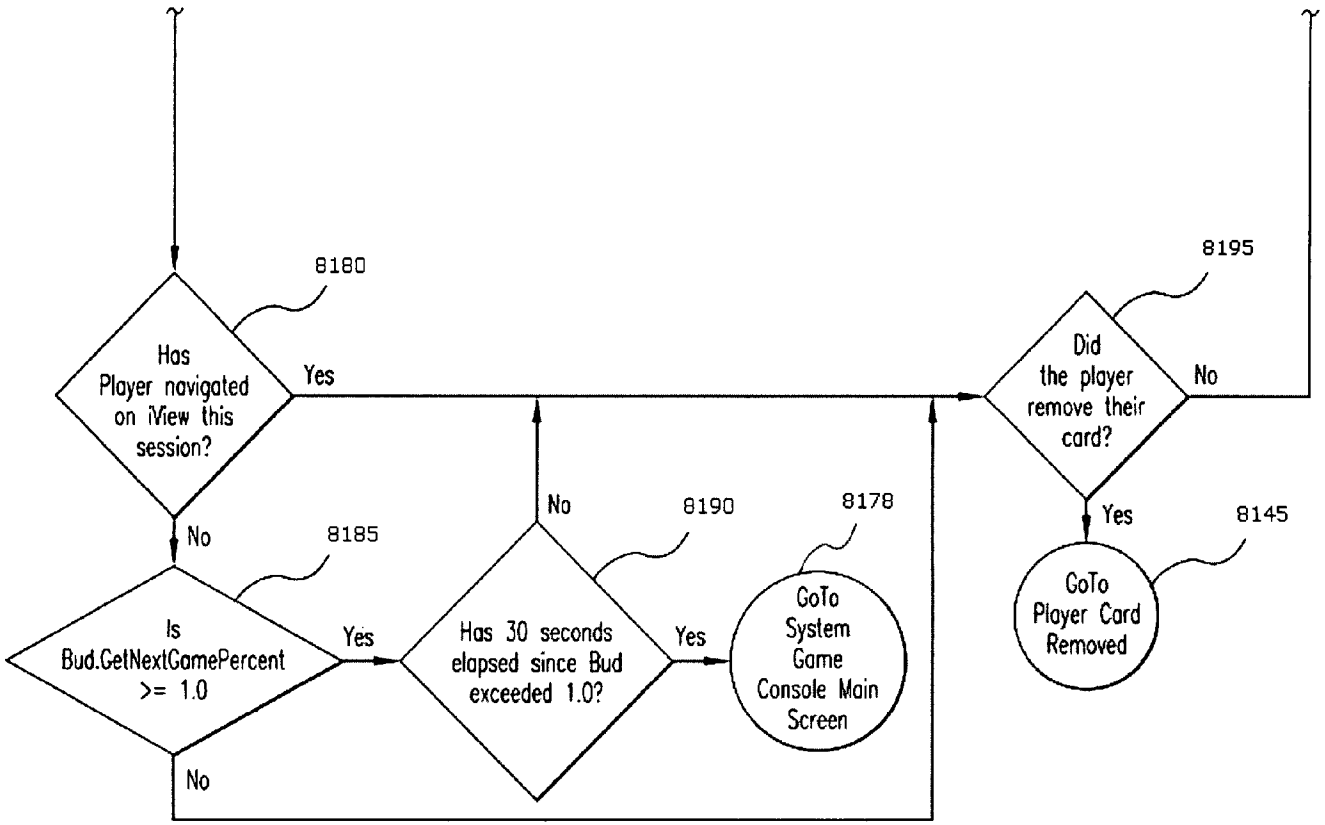

Another process used in some embodiments is the legacy attraction process or legacy player pages. FIG. 81 is a flowchart of what happens when the player interacts with the Legacy Player Pages. Process 8100 initiates at module 8105 and proceeds to module 8110 where the main legacy page or screen is displayed. At module 8115, it is determined whether the player pressed a legacy button. If so, then at module 8150, the legacy menu shows the proper page and the legacy system operates. If not (no legacy button pressed), then at module 8120 it is determined whether the iView system is registered and active. If not, then at module 8125 it is determined whether the player has pressed a "Play Game" or similar button. If not, then at module 8140, it is determined whether the player has removed the player card. If so, the process transitions to the player card removed process via module 8145.

If the player card has not been removed, the process returns to the determination of module 8115 (whether a legacy button was pressed). If the player did press a "Play Game" or similar button as determined at module 8125, the process moves to module 8130 and the games unavailable screen is shown. At module 8135, the game continues its attempts to register with iView or the rewards system and returns to the determination of module 8115.

If iView or the rewards system is registered and active at module 8120, the process determines at module 8155 whether the player session is open. If not, the console attempts to open the player session at module 8160. If the player session is still not open at module 8165, the process moves to the determination at module 8125. If the player session is open at either modules 8155 or 8165, then the process determines at module 8170 whether the current player is banned. If so, then at module 8172, the process determines whether the player has attempted to play the game (e.g. pressing a "Play Game" button). If so, a screen is displayed at module 8174 indicating the player cannot play and should see customer service (e.g. stating the player card is inactive). The process then returns to module 8115.

If the player is not banned, then at module 8176 it is determined whether the player has attempted to start the game. If so, the process transitions to the system game console main screen process via module 8178. If the player has not started the game, then it is determined whether the player has navigated on iView at module 8180. If not, at module 8185, the threshold for the next game on iView is checked. If the threshold is exceeded, then a time counter of 30 seconds is checked to see if the time has elapsed at module 8190. If so (the time has elapsed), the process transitions to the system game console main screen process via module 8178. If the time has not elapsed (at module 8190), if the threshold has not been met (at module 8185) or if the player has not navigated iView (at module 8180), then a determination is made at module 8195 as to whether the player has removed their card. If yes, the process transitions to the player card removed process via module 8145. If no, the process returns to the determination at module 8115.

Figures 1, 82:
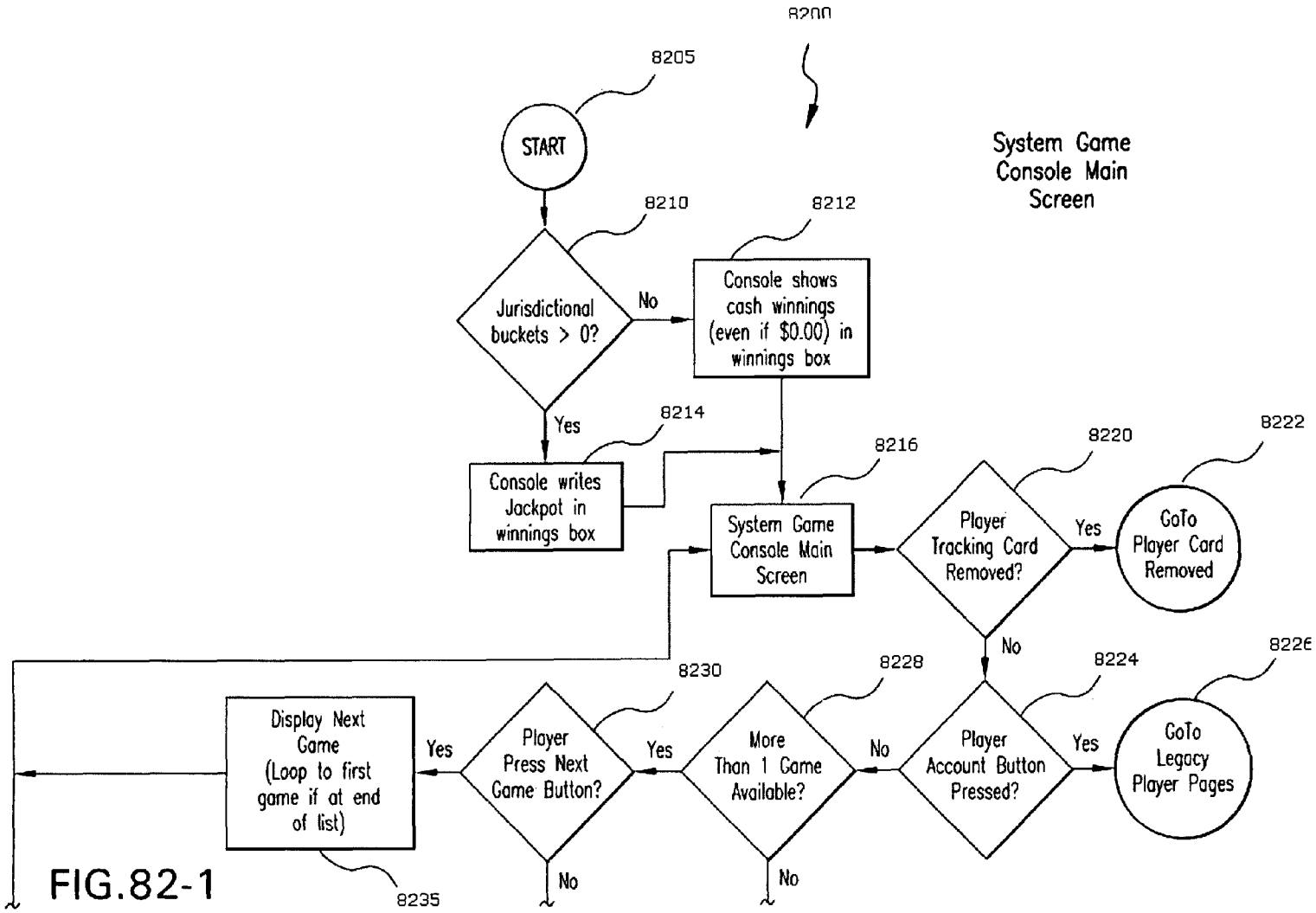
Figures 2, 82:
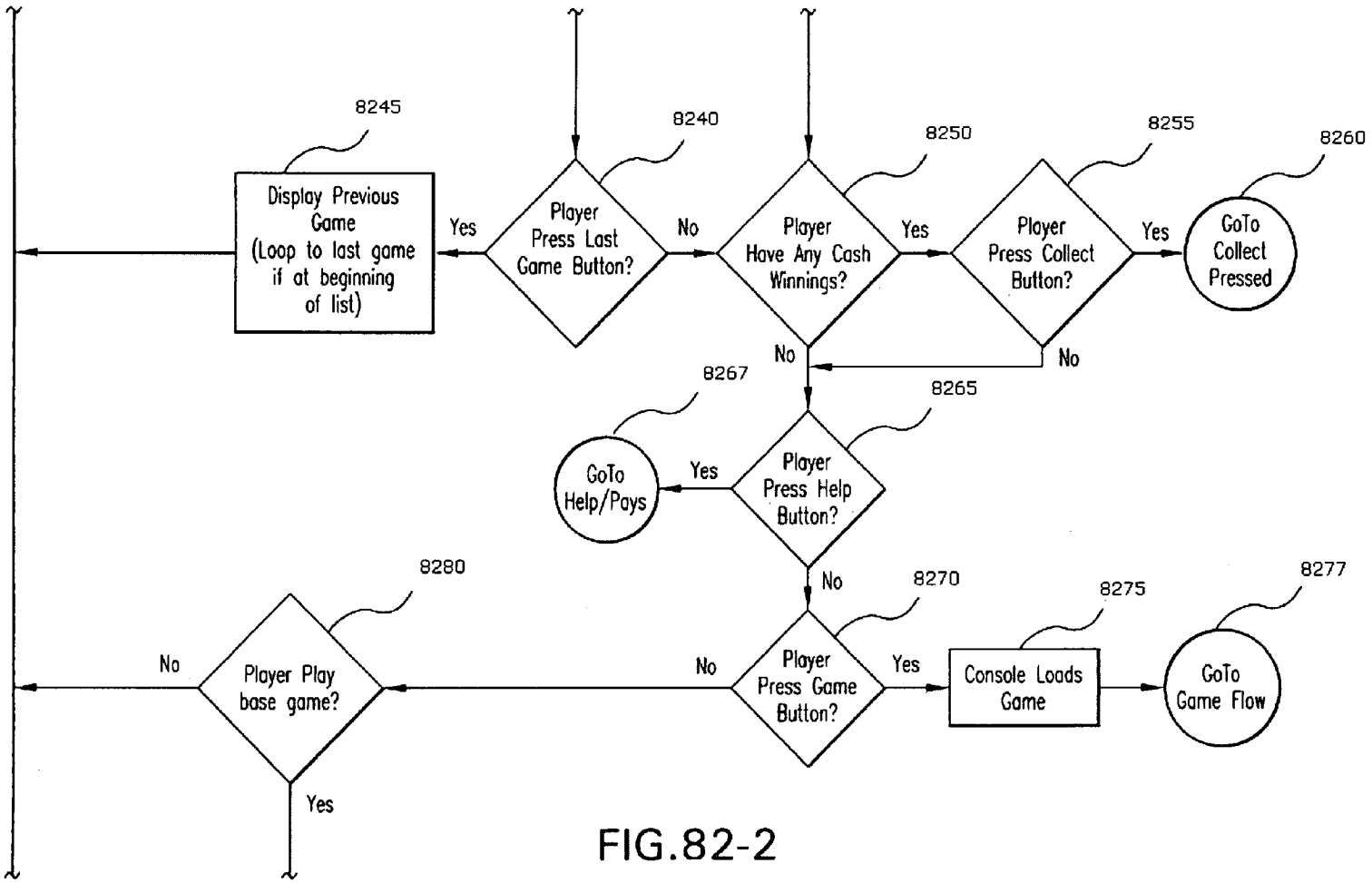
Figures 3, 82:
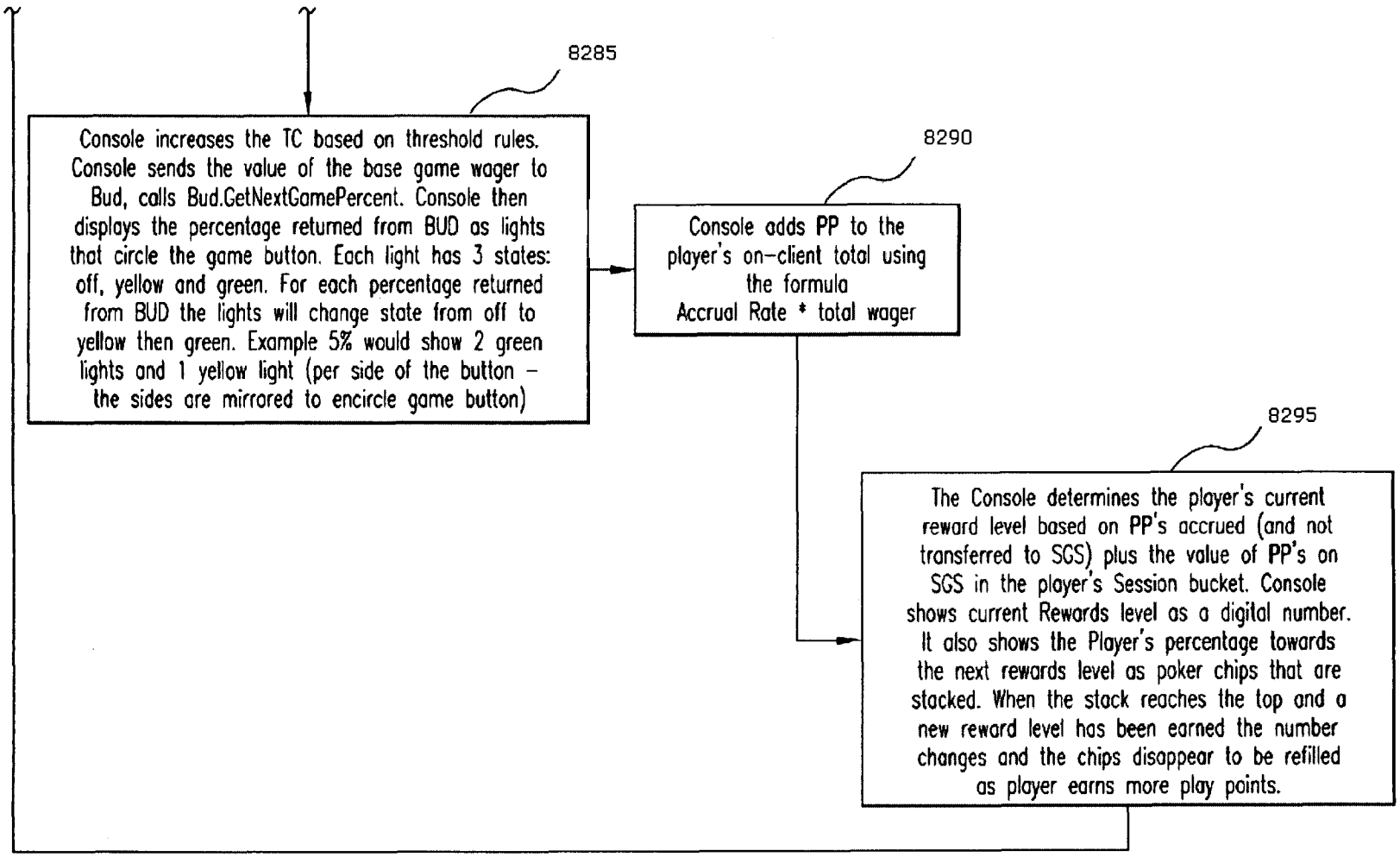

The system game console main screen provides the process which operates games on the machines within the system. FIG. 82 is a flowchart of what happens on the System Game Console Main game screen. Process 8200 initiates with start module 8205 and determines at module 8210 whether any jurisdictional buckets are non-zero (greater than zero). If not, then at module 8212, the console shows cash winnings in the winnings box. If so, then at module 8214, the console shows the jackpot in the winnings box. The console then shows the main screen at module 8216. At module 8220, it is determined whether the player tracking card has been removed. If so, the process transitions to the player tracking card removed process via module 8222.

If the player tracking card is present, then at module 8224 it is determined whether the player account button has been pressed. If so, the process transitions to the legacy pages process at module 8226 to allow access to account information. If not, it is determined at module 8228 whether more than 1 game is available to the player. If so, then at module 8230, it is determined whether the player has pressed the next game button or a similar indicator. If so, at module 8235, the next game is displayed (in a loop of games) and the process returns to module 8216. If not (no next game button pressed), then at module 8240, it is determined whether the player pressed a last game or previous game button or indicator. If so, the previous game in a loop is shown at module 8245 and the process returns to module 8216.

If not (no previous game request), or if only one game was available at module 8228, then at module 8250 it is determined whether the player has any cash winnings. If the player has cash winnings, it is determined at module 8255 whether the player has requested collection of the winnings. If so, then the process transitions to the collect pressed process at module 8260 to allow the player to collect winnings. If not, or if the player had not cash winnings, it is determined at module 8265 whether the player requested help. If so, the process transitions to the help/pays process via module 8267.

At module 8270, a determination is made as to whether the player pressed the game button (play a game, etc.) If so, at module 8275, the console loads the game and the process transitions to the game flow process at module 8277. If no game button press, the process determines at module 8280 whether the player has requested to play the base game. If not, the process returns to module 8216. If so, the process plays the base game and at module 8285 tracks the base game in relation to accrual of player points and winnings. At module 8290, the console adds the player points to the player's winnings and at module 8295, the console displays the player's points and rewards level. The process then returns to module 8216 and display of the system game page.

In the operation of the system, help may be requested by a player. FIG. 83 is a flowchart of what happens when the player enters the Help/Rewards pages on the iView. Process 8300 initiates at module 8305. At module 8310, it is determined whether the player is viewing a rewards page. If so, then at module 8340, the appropriate paytable is shown. If the player requests help, this is determined at module 8345, and the first help page is shown at module 8347. If the player is viewing the rewards page but is not requesting help, the player can navigate the rewards page, with a left or right arrow press determined at module 8350 (and corresponding page display at module 8355), and a similar up or down arrow press determination at module 8365 (and corresponding page display at module 8367). Each of these processes then return to module 8310.

If the player removes the tracking card at module 8370, the process transitions to the player card remove process via module 8337. If the player does not navigate and does not remove the player tracking card, a determination is made at module 8380 whether the player closed the rewards page. If not, a determination is made as to whether the player played the base game at module 8375. If the player did not play the base game, the process returns to module 8310. If the player did play the base game, or closed the rewards panel, then at module 8385 it is determined whether the system console launched the help page. If not, the process transitions to the game flow process via module 8395. If so, the process transitions to the system game main screen at module 8390.

If, at module 8310, the player is not viewing a rewards page, then at module 8315 the first help page is shown. At module 8320, it is determined whether a player rewards button was pushed. If so, at module 8325, the current rewards level is shown. If not, then at module 8330, it is determined whether the player is navigating the help pages (e.g. left or right arrow pushed). If so, the next help page corresponding to the navigation is displayed at module 8360 and the process returns to module 8310. If not, it is determined whether the player removed the card at module 8335. If so, then the process transitions to the player card remove process via module 8337. If not, the process moves to module 8380 to determine if the player closed the help screen.

Figures 1, 84:
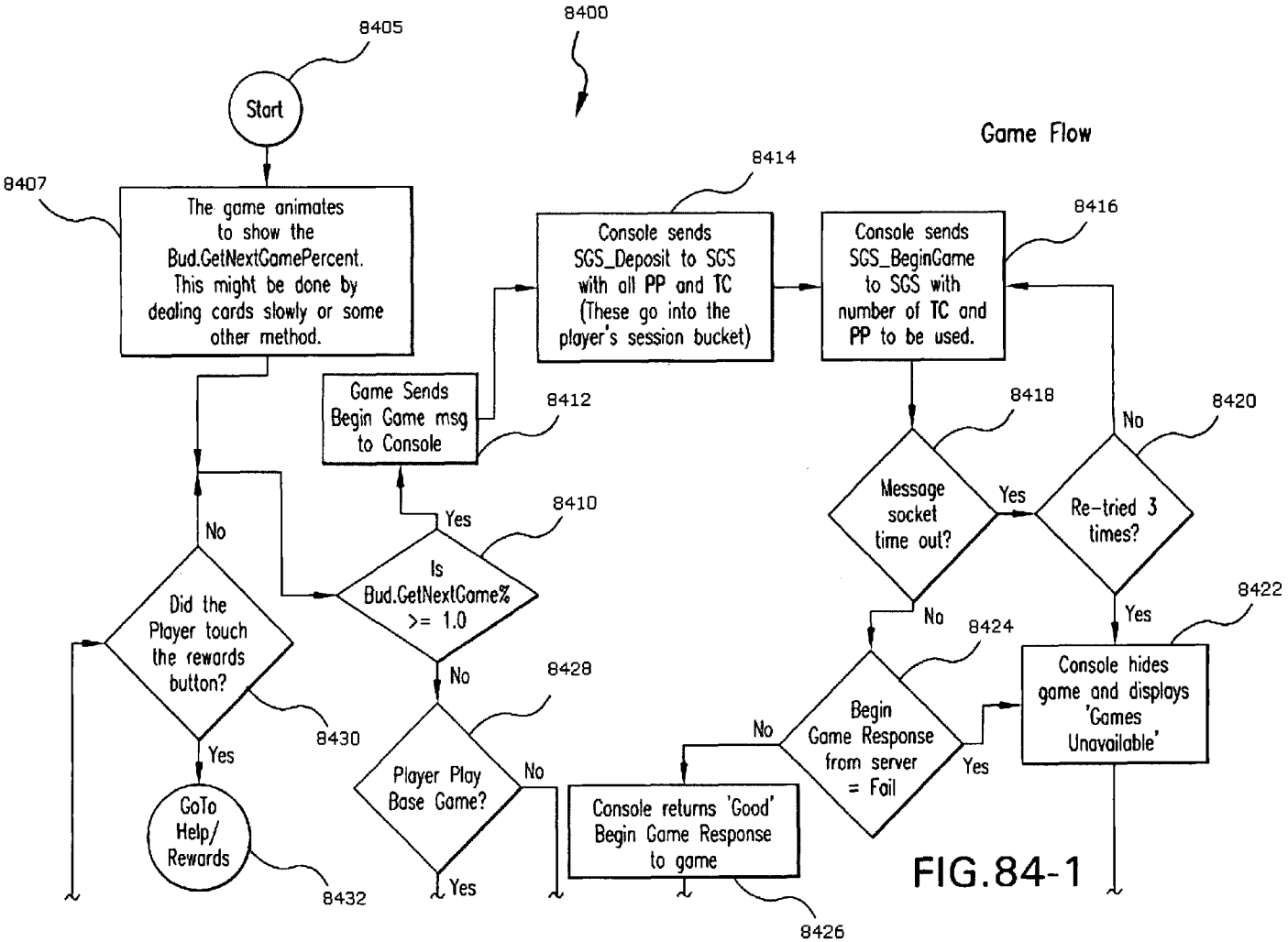
Figures 2, 84:
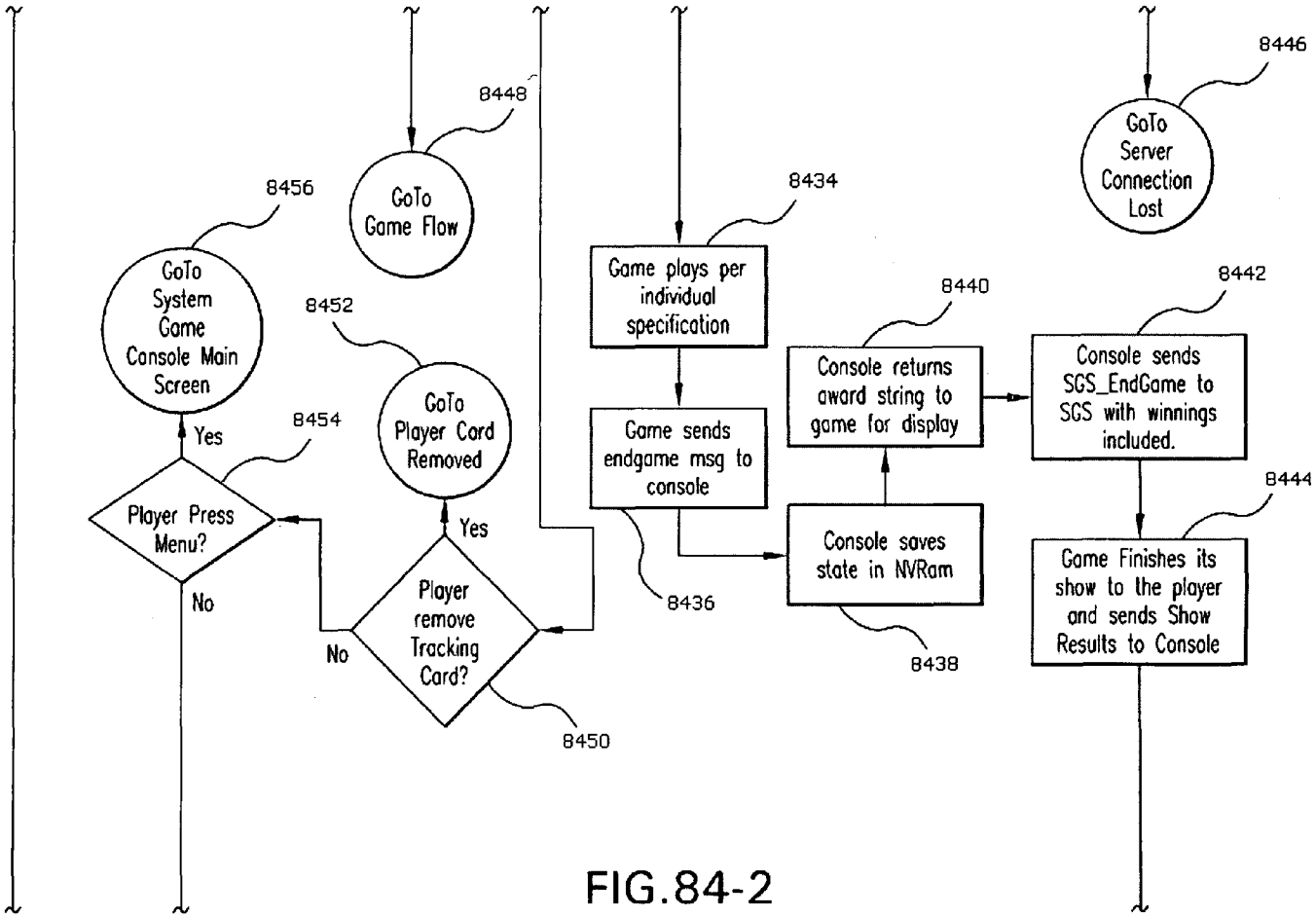
Figures 3, 84:
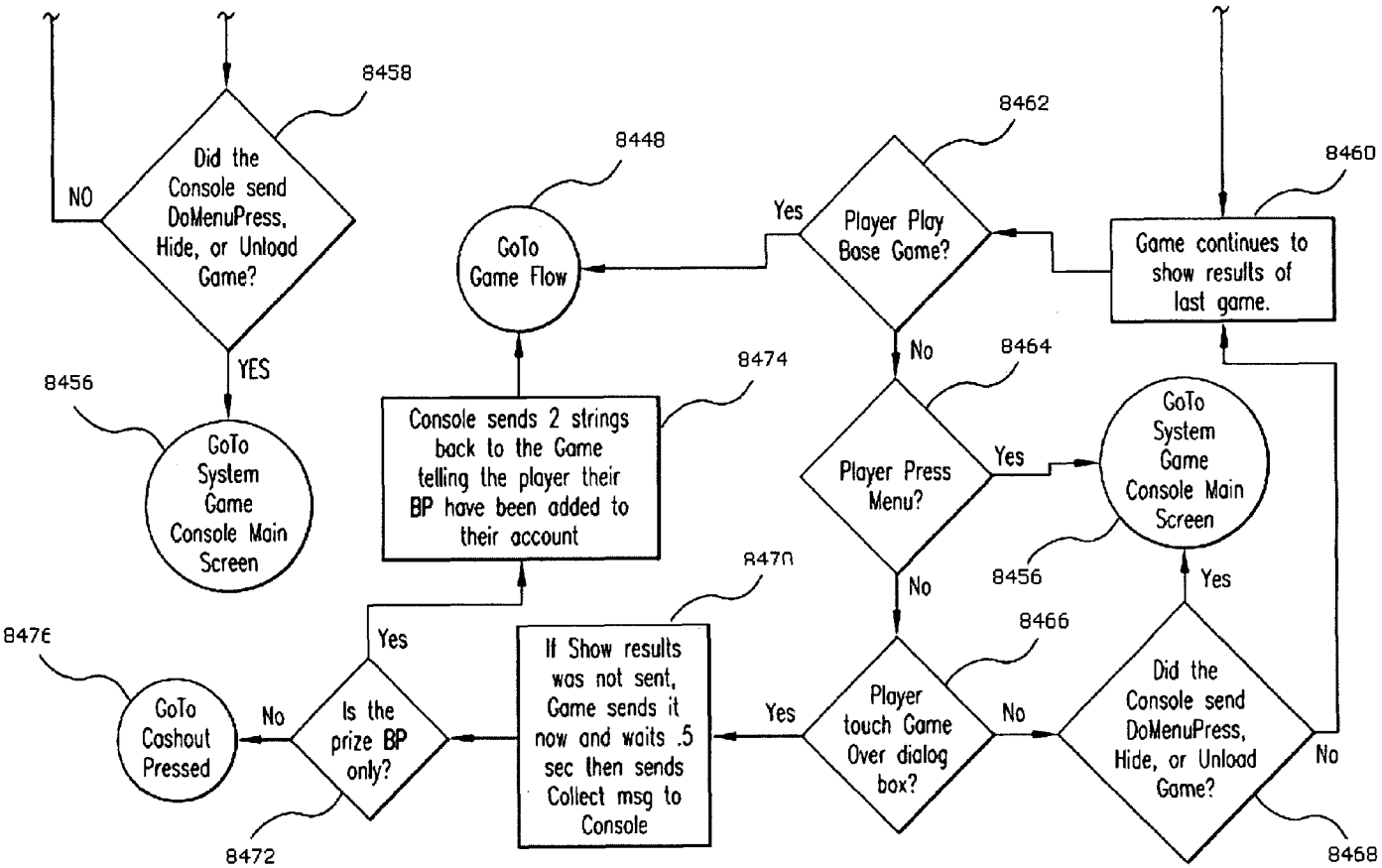

Another process which may be executed in the various embodiments is the game play process. FIG. 84 is a software flowchart of what happens during the game play process. Process 8400 initiates with module 8405, and proceeds to module 8407 where the game is started. Module 8407 illustrates loading of the game, and at module 8410, it is determined whether the game has loaded. If no, then at module 8428, it is determined whether the player is playing the base game. If so, the process transitions to the game flow process (for the base game) via module 8448. If not, it is determined whether the player removed the player card. If so, then at module 8452, the process transitions to the player card removed process via module 8452. If not, it is determined whether the player accessed the menu. If so, the process transitions to the system game console main screen process via module 8456. If not, at module 8458, it is determined whether the console sent a menu press, hide, or unload game command. If it did, then the process transitions to the system game console main screen process via module 8456. If not, then at module 8430 it is determined whether the player accessed the rewards information. If so, then at module 8430 the process transitions to the help/rewards (or pay) process via module 8432. Otherwise, the process loops back to loading the game and checking for loading at module 8410.

Once the game is loaded, at module 8412, the game sends a begin game message to the console or machine. At module 8414, the points and cash in the player account is transferred to the server. At module 8416, the required points and cash are deducted or reserved. At module 8418, the process determines if the game is responding. If not, at module 8420, the process determines if the response has failed three times. If not, the process loops back to module 8416. If the time out has occurred three times, the process moves to module 8422 and the games unavailable message is displayed. If the game does not time out, at module 8424, it is determined whether the game response failed. If so, the process likewise moves to module 8422. If the process fails and gets to module 8422, on the other hand, the process transitions to the server connection lost process via module 8446.

If not (the game response succeeded), the process returns a good game response at module 8426 and the game plays per individual specifications at module 8434. Eventually, the game sends an endgame message to the console at module 8436 and the console saves the state in NVRAM at module 8438. At module 8440 the console returns an award string for display, at module 8442 the console sends an end game message to the server with the winnings, and at module 8444 the game finishes and shows the results to the player.

At module 8460, the game continues to show its last results. At module 8462, it is determined whether the player has played the base game. If so, then the process transitions to the game flow via module 8448. If not, at module 8464, it is determined whether the player requested the menu. If so, the process transitions to the system game console main screen via module 8456. If not, at module 8466, it is determined whether the player touched the game over dialog box. If not, then at module 8468 it is determined whether the console sent a menu press, hide, or unload game command. If it did, then the process transitions to the system game console main screen process via module 8456. If not, the process returns to module 8460.

If the player did touch the game over dialog box at module 8466, then at module 8470 the game checks whether show results was sent, and sends it if necessary, then waits a delay before sending a collect message to the console. At module 8472, it is determined whether the prize is bonus points only. If not, the process transitions to the cashout pressed process via module 8476. If so, the console sends messages to the game indicating the points have been added, and the process transitions to the game flow process via module 8448.

Figures 1, 85:
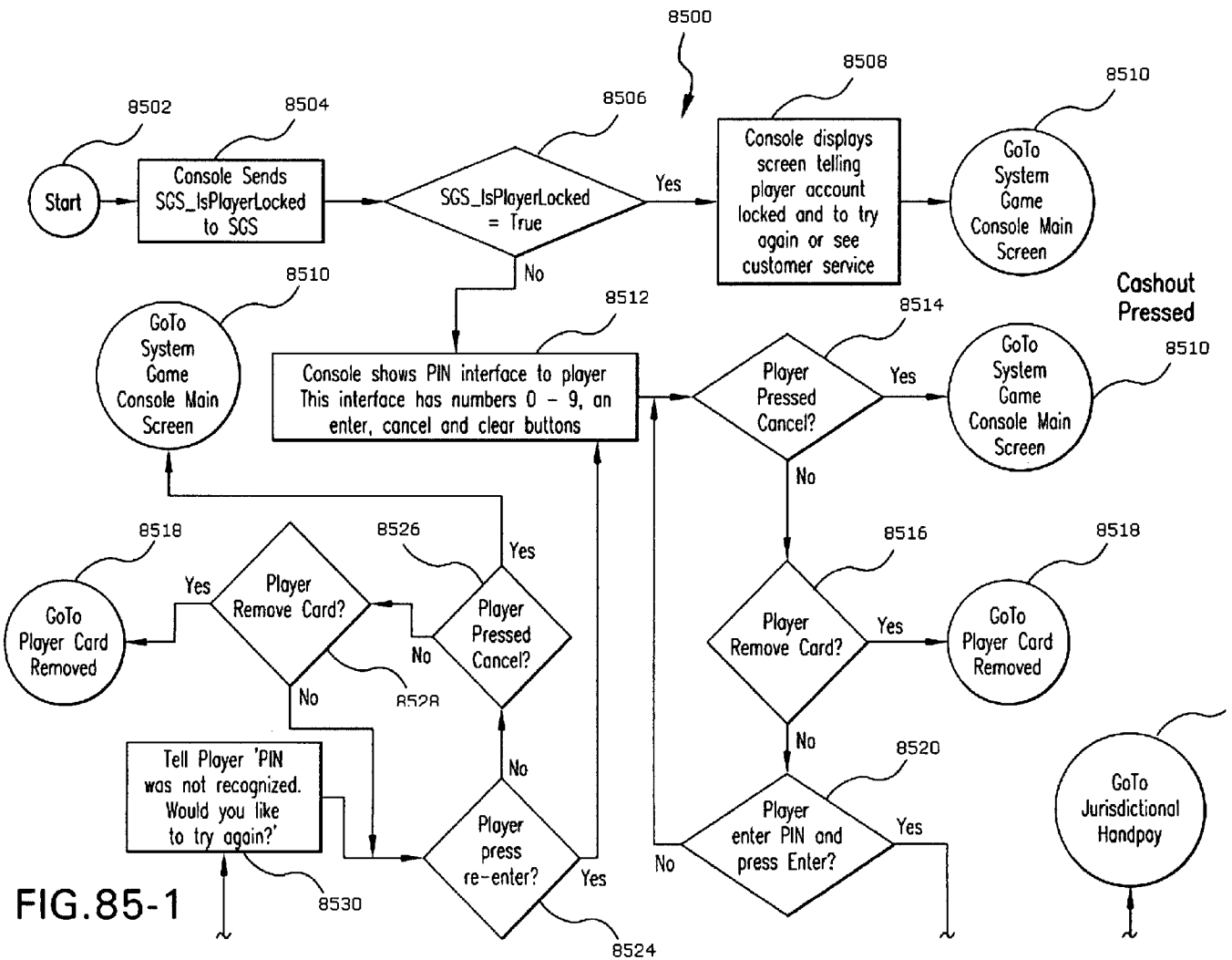
Figures 2, 85:
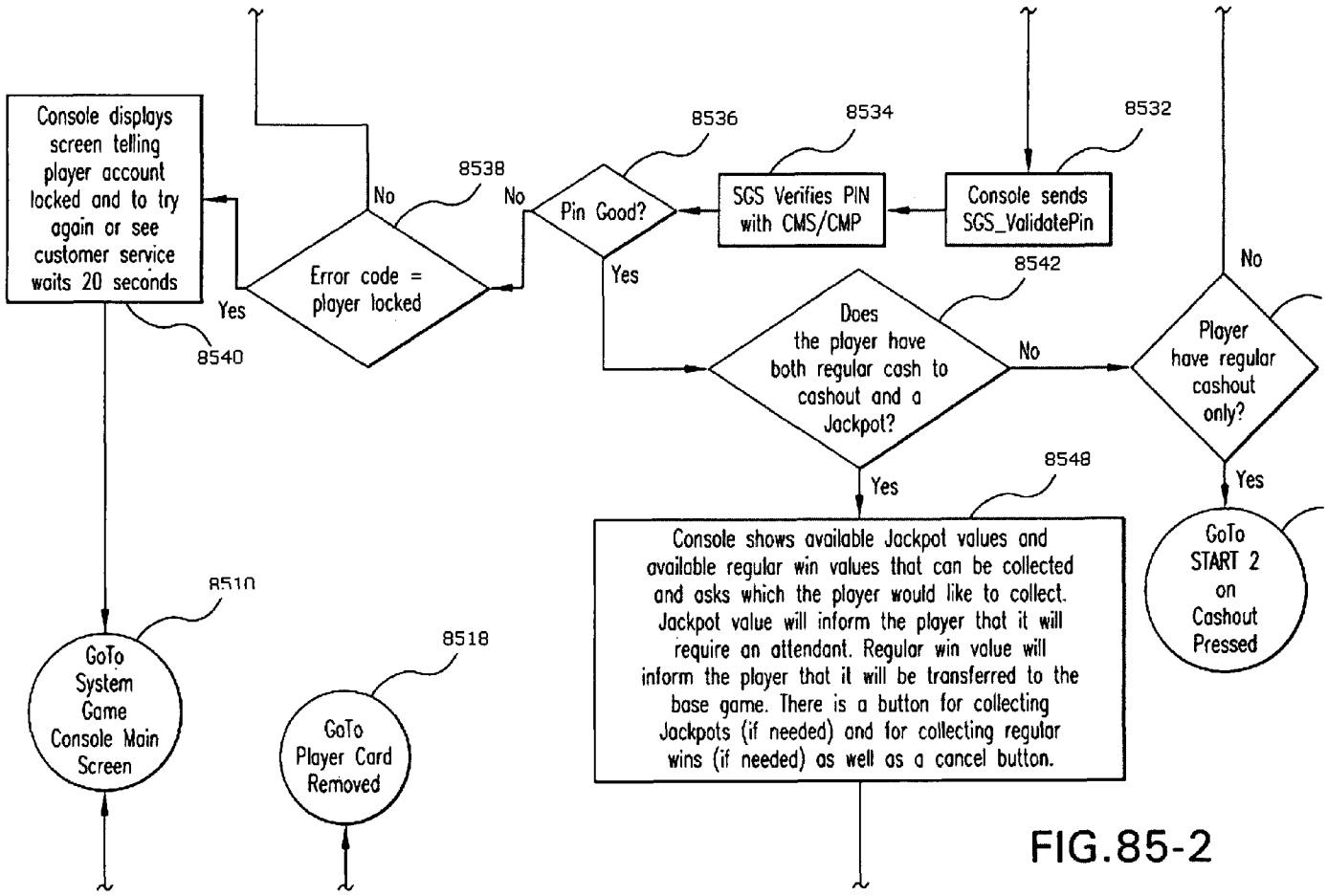
Figures 3, 85:
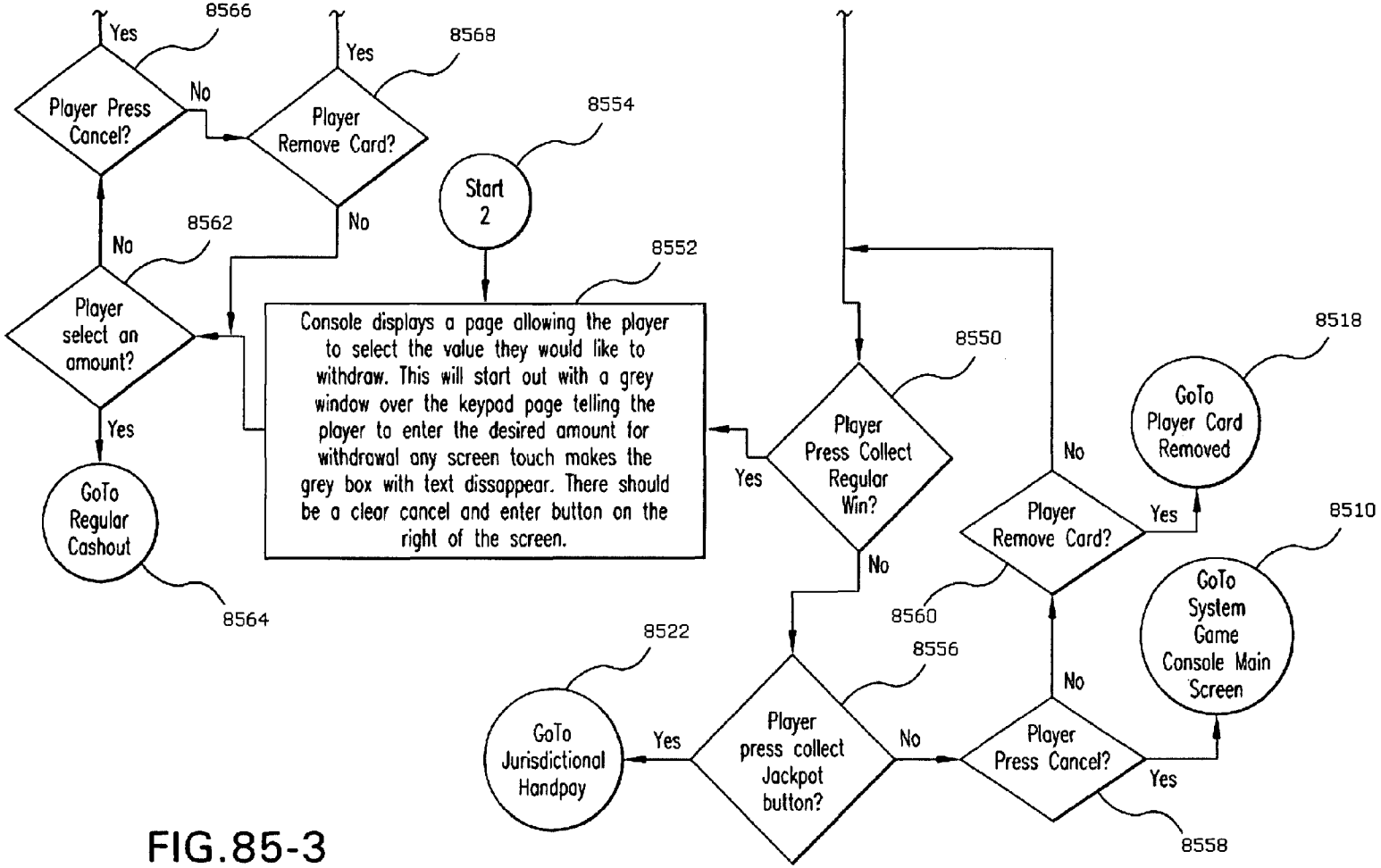

In general, the cashout pressed process handles cashing a player out. FIG. 85 is a software flowchart of what happens during the cash out process. The process 8500 initiates at module 8502, and at module 8504 sends a query as to whether a player is locked. At module 8506, a determination is made as to whether the player is locked. If yes, the console tells the player to see customer service at module 8508 and the process transitions to the system game console main screen via module 8510. If not, the process shows a PIN interface to the player at module 8512.

If the player cancels, this is determined at module 8514, and the process transitions to the system game console main screen via module 8510. If the player removes the player card, this is determined at module 8516, and the process transitions to the player card removed process via module 8518. Otherwise, the process determines if a PIN has been entered at module 8520, and waits for a PIN cycling through modules 8514 and 8516.

With the PIN entered, the process sends a validate PIN message to the server at module 8532. At module 8534, the server attempts to validate the PIN and returns a corresponding message. At module 8536, it is determined whether the PIN is good. If not it is determined at module 8538 whether the player is now locked out. If so, then at module 8540 a message is displayed telling the player the account is locked, and to either wait or see customer service. The process then transitions to the system game console main screen via module 8510.

If the player is not locked out, a message is displayed giving the player another chance at module 8530 and it is determined whether the player pressed a re-enter button at module 8524. If so, the process returns to module 8512 and display of the PIN pad. If not, it is determined if the player cancelled at module 8526. If yes, the process transitions to the system game console main screen via module 8510. If no, it is determined whether the player removed the player card at module 8528. If yes, the process transitions to the player card removed process via module 8518. If no, the process loops back to module 8524.

If the player enters a valid PIN, then at module 8542 it is determined whether the player has both a regular cashout and a jackpot. If not, if the player has only a regular cashout at module 8554, the process transitions to module 8544 via module 8546 (this will be detailed below). If so jackpot only) the process transitions to the jurisdictional handpay process via module 8522.

If the player has both a jackpot and a cashout amount, a variety of options are displayed at module 8548. At module 8550, it is determined whether the player requested collection of the regular win. If not, at module 8556, it is determined whether the player requested the jackpot payout. If so, the process transitions to the jurisdictional handpay process via module 8522. If not, it is determined whether the player cancelled at module 8558. If yes, the process transitions to the system game console main screen via module 8510. At module 8560, it is determined whether the player removed the player card. If so, the process transitions to the player card removed process via module 8518. If the player did not cancel or remove the player card, the process loops back to module 8550.

If the player requests payment of the regular win amount at module 8550, at module 8552 options are displayed allowing the player to withdraw a desired amount. Likewise, module 8554 takes the process to module 8552. If the player selects an amount, this is determined at module 8562, and the process transitions to the regular cashout process via module 8564. If the player has not selected an amount, cancellation can be detected at module 8566 and card removal can be detected at module 8568. If the player cancels, the process transitions to the system game console main screen via module 8510. If the player removes the card, the process transitions to the player card removed process via module 8518.

Figures 1, 86:
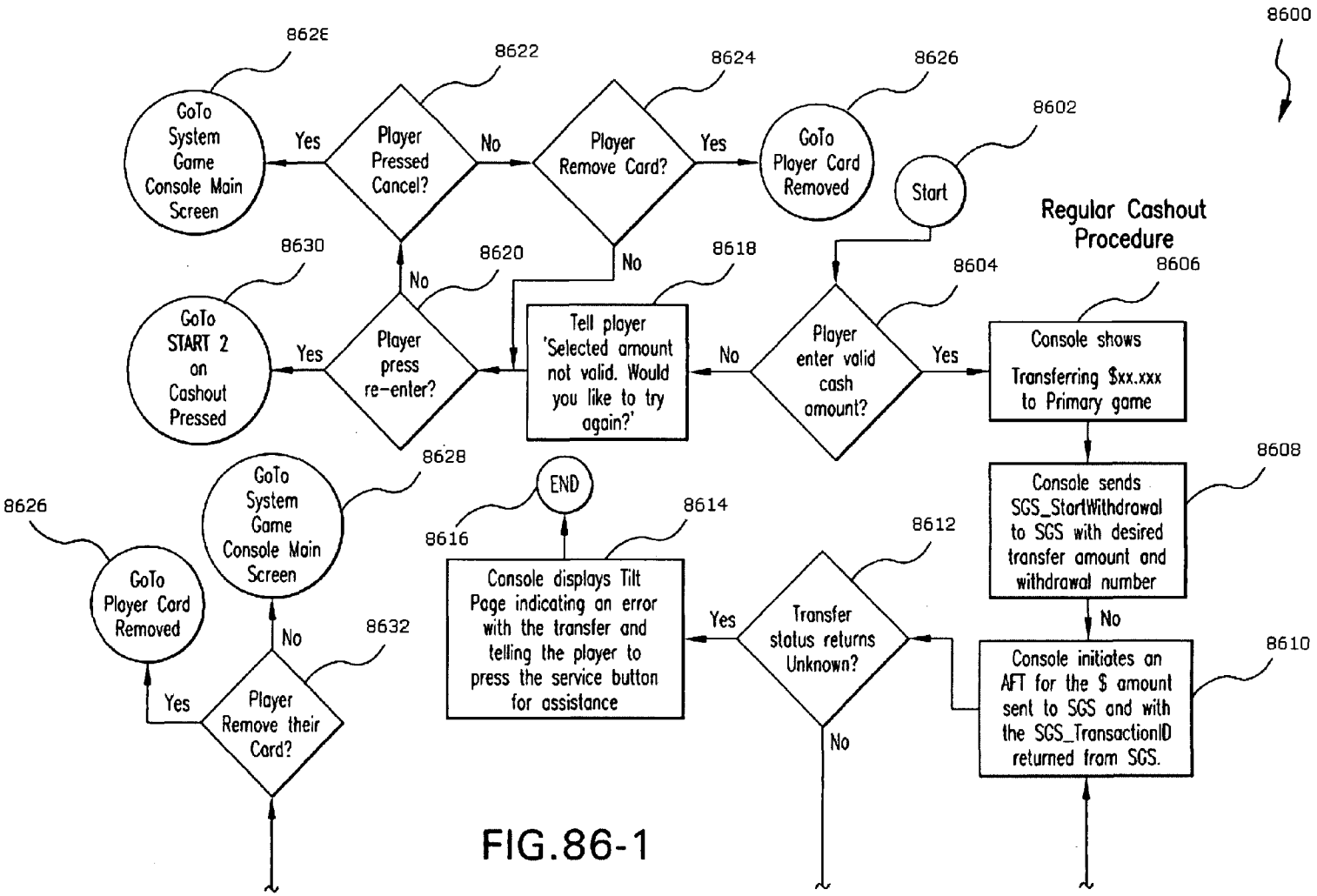
Figures 2, 86:
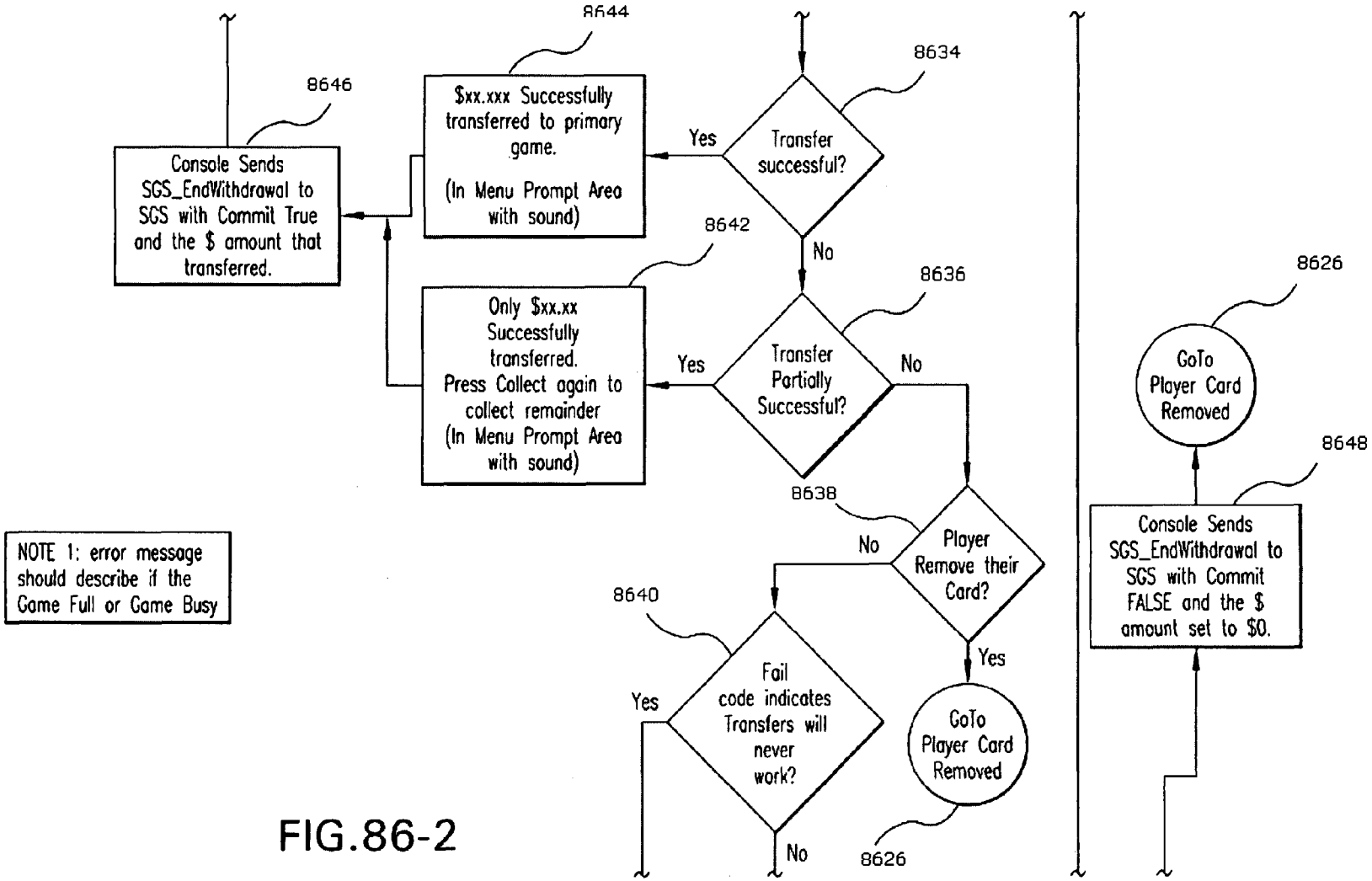
Figures 3, 86:
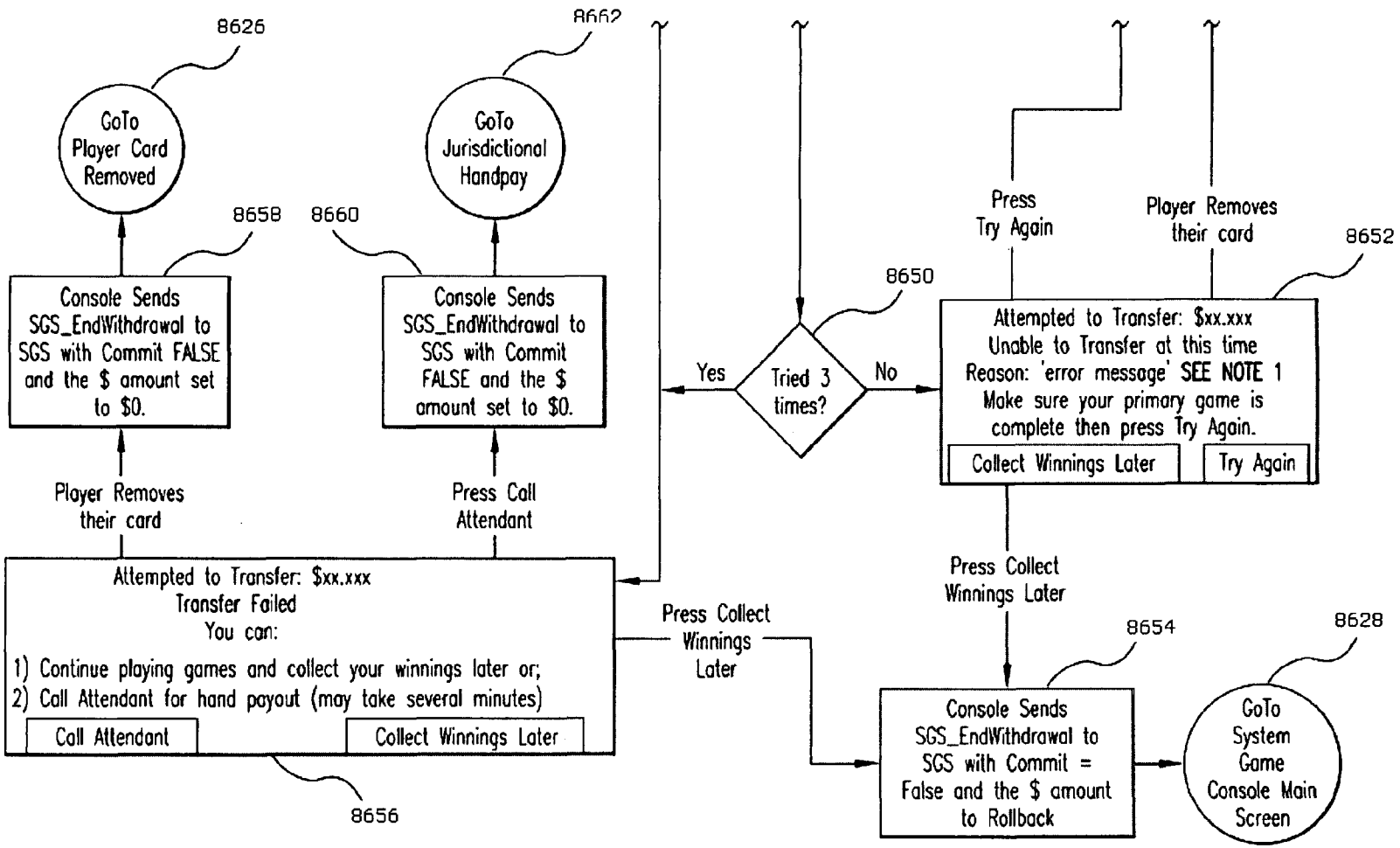

Another process frequently used is the regular cash out process. FIG. 86 is a software flowchart of what happens during a regular cash out procedure. Process 8600 initiates with module 8602, and then proceeds to a determination of whether a player entered a valid cash amount at module 8604. If not, at module 8618, the player is told the amount is not valid and offered the chance to select again. The process then checks whether the player chose to re-enter, cancel, or remove the player card. At module 8620, it is determined whether the player chose to re-enter an amount. If so, the process transitions to the cashout pressed process via module 8630. At module 8622, it is determined if the player cancelled the process. If so, the process transitions to the system game console main screen via module 8628. At module 8624, it is determined whether the player removed the player card. If so, the process transitions to the card removed process via module 8626. If not, the process loops back to module 8620, to allow for one of cancellation, re-entry or removal of the player card.

If the player entered a valid cash amount, at module 8606 the console shows a transfer to the primary game. At module 8608, the console requests the withdrawal from the server. At module 8610, the console initiates the transfer. At module 8612, a determination is made as to whether the transfer status was unknown. If so, at module 8614, a tilt mode is entered, and the player is advised to request service. The process then terminates at module 8616.

If the transfer status is not unknown, at module 8634, it is determined whether the transfer was successful. If so, then at module 8644, a message indicating a successful transfer is displayed. If not, then at module 8636 it is determined whether the transfer was partially successful. If so, at module 8642, a message describing the partial transfer is displayed. In either case, the process then moves to module 8646, and commits the transfer. At module 8632, it is determined if the player removed the player card. If so, the process transitions to the player card removed process via module 8626. If not, the process transitions to the system game console main screen via module 8628.

If the transfer is not even partially successful, then at module 8638, it is determined whether the player card was removed. If so, the process transitions to the player card removed process via module 8626. Otherwise, it is determined whether the fail code indicates the transfers will never work (e.g. the system is down) at module 8640. If not, then at module 8650, it is determined if the transfer was attempted three times. If the transfer was attempted three times, or if the fail code indicates the transfer will never work, then at module 8656 a message is displayed indicating the transfer failed and the player can either continue playing or collect by hand. Collecting winnings later (continuing to play) is addressed below. If the player presses a call attendant button, then at module 8660 the console ends the withdrawal indicating the withdrawal was cancelled, and the process transitions to the jurisdictional handpay process via module 8662. If the player removes the card, then at module 8658 the console ends the withdrawal indicating the withdrawal was cancelled, and the process transitions to the player card removed process via module 8626.

If the transfer has failed but fewer than three times (module 8650), and may still succeed (module 8640) then at module 8652, a message is displayed indicating failure and a reason for failure, such as Game Full or Game Busy is provided, along with the option to try again or collect winnings later. If the selection is collect winnings later, then at module 8654, the transfer is cancelled and rolled back. The process then transitions to the system game console main screen process via module 8628. Note that module 8654 may also be reached from module 8656 as a result of a similar choice to collect winnings later.

If, at module 8652, the player card is removed, the process ends the withdrawal at module 8648 and then transitions to the player card removed process at module 8626. If the player tries the withdrawal again from module 8652, the process returns to module 8610 and attempts the transfer again.

One of the options for paying winnings is a jurisdictional handpay. FIG. 87 is a software flowchart of what happens during a jurisdictional Hand pay. Jurisdictional payouts at the gaming device for awards won by playing games on iVIEW. Hand Pay for these types of wins. (See FIG. 19, FIG. 20, FIG. 30). These are for hand payments for bonus game awards over the jurisdictional amount (typ. $1200) on the iVIEW. This differs from Base Game hand payouts which are logged in the base game. FIG. 30 shows where this value is configured at the Server. Any game award payout over this amount will trigger a hand pay event for this dollar amount. To collect this amount the player must do a hand pay on any iVIEW on the floor. We hand pay the amount wherever the player tries to collect the winnings. Slot machines lock up only the specific machine that the award occurred upon. So even if a player won $1500 on one machine and pulled his card and went to another machine and inserted his card and tried to collect the winnings, This player would have to have the amount Hand paid verses being allowed to AFT to the base game. We maintain the jurisdictional buckets for the player independent of the device he played upon.

Process 8700 initiates with module 8705 and the console shows the handpay amount at module 8710. At module 8715, the console sends a message to the server to start the handpay process. At module 8720, the console sends a further message for tracking of the handpay. At module 8730, it is determined whether the player cancelled. If so, then at module 8445, the handpay process is cancelled with a zero transaction amount, and the process transitions to the system game console main process via module 8750. Alternatively, at module 8735, the player card may be removed, in which case the process transitions to the player card removed process at module 8740. If the player neither cancels nor removes their card, pressing the attendant call button should transition the process to module 8755.

At module 8755, the process initiates and at module 8760, it is determined whether the player has inserted their card. If so, then the process transitions to the player card inserted process via module 8790. If not, it is determined at module 8765 whether an employee has inserted their card. If not, the process returns to module 8760. If so, the process determines whether the GMU is working at module 8770. If not, the employee takes the machine out of service until the connection is fixed and processes the handpay at the cage at module 8788.

If the GMU is working, then at module 8772, the gaming machine displays the handpay information. At module 8774, it is determined whether the employee removed their card. If so, then at module 8776, the process transitions to the initiation module 8755. If not, at module 8778, it is determined whether the employee cancelled the handpay. If so, at module 8784 the game awaits removal of the employee card, and at module 8786, the process transitions to the jurisdictional handpay, employee cancel process. If the employee did not cancel, it is determined whether the employee committed the transaction at module 8780. If so, at module 8782, the process transitions to the employee commit jurisdictional handpay process. If not, the process cycles back to module 8774.

When processing a handpay, the most likely results are an employee commit or cancel process. FIG. 88 is a software flowchart of what happens when the employee commits the hand pay. Process 8800 initiates with module 8805, and at module 8810, the console sends the message committing the handpay to the server. At module 8812, a timeout is checked. If the message times out, at module 8855, it is determined whether this was tried three times. If no, the process retries at module 8810. If so, a message indicating failure is displayed at module 8852, and the process terminates at module 8860.

If the message does not time out, an error code is checked at module 8814. If the error code is zero (error code is no error), then the process closes the session at module 8816. Another message timeout is checked at module 8818 (for closing the session). If the message times out, at module 8835, it is determined whether this was tried three times. If not, the process cycles back to module 8816 to close the session again. If so, the console displays an error indicating the transaction completed but the session did not close at module 8840, and the process terminates at module 8850. If the message does not time out, then at module 8820 a message displays confirming winnings should be paid, and that reward points are being saved (have been saved). At module 8825, it is determined whether the employee card has been removed. If not, the process returns to the display module 8820. If so, the process transitions to the legacy attract mode at module 8830.

If there was a server error at module 8814, then at module 8842, server error code 42 is checked (a predetermined server error code). If this is not the error code, the machine tilts at module 8865, indicating a software bug, and the process terminates at module 8850. If server error code 42 is found, then at module 8844, the session is closed via message to the server. At module 8846, a time out is checked for the message. If the time out occurs, then at module 8848, it is determined if this was tried three times. If so, the process transitions to module 8852. If not, the message may be retried at module 8844 or the process may simply wait for a time out at module 8846.

If the message does not time out at module 8846, the console tells the employee the handpay was cancelled at module 8870. The employee may then determine if the handpay was paid out elsewhere (e.g. the cage, another terminal, etc.) or if the handpay has yet to be paid. At module 8875, the process determines whether the employee card has been removed. If not, the process waits for this event. If so, the process transitions to the legacy attract mode at module 8830.

Another option is for the employee to cancel the handpay. FIG. 89 is a software flowchart of what happens when the employee cancels the hand pay. Process 8900 initiates with module 8905, and the console sends a cancellation message at module 8910. At module 8915, time out on the message is checked. If the message times out, at module 8920, it is determined whether the message timed out three times. If not, the message is retried at module 8910. If so, the console indicates it could not connect to the server at module 8925, and the employee takes the machine out of service. At module 8930, the process transitions to the server connection lost process.

If the message completes at module 8915, then at module 8940, the console sends a close session message. At module 8945, the close session message time out is checked. If the message times out, at module 8950, it is determined whether the time out occurred three times. If not, the message is retried at module 8940. If so, the console indicates it could not connect to the server at module 8935, and the employee takes the machine out of service. At module 8930, the process transitions to the server connection lost process. If the message does not time out, the process waits for removal of the employee card at module 8960, and then transitions to legacy attract mode via module 8970.

Oftentimes, the player card may be removed. FIG. 90 is a software flowchart of what happens when the player removes the player card. Process 9000 initiates with module 9005 and determines whether a player session is open at module 9010. If not, the process transitions to the legacy attract process via module 9015. If so, the process determines if the player was at a handpay screen at module 9020. If so, the console deposits play points and threshold counter at the server at module 9025 (failure here is handled through the server connection lost process). At module 9030, the console continues to display the handpay screen, and at module 9035, the process transitions to the jurisdictional handpay process.

If the console was not at a handpay screen, at module 9040 it is determined whether a game was in progress. If so, then at module 9045 the console waits for the game to end. At module 9050, the console sends the end game message and at module 9055, the console sends the menu pressed message and waits for a display of results.

Whether a game was in progress or not, the console deposits play points and the threshold counter at module 9060. At module 9065, the console sends the close session message to the server. At module 9070, the console sends the end game data message to the server. The process then transitions to the legacy attract process via module 9015.

A connection to the server may be lost, in which case the machine experiences an override process. FIG. 91 is a software flowchart of what happens when the server connection is lost from the iVIEW. Process 9100 initiates at module 9110. At module 9120, the console has sent a message three times and it has timed out. At module 9130, a game unavailable message is displayed. At module 9140, the console sends a test message to the server. At module 9145, time out is checked. If the message times out, the process returns to module 9130. If the message does not time out, at module 9150 all unsent (queued) messages are sent to the server. At module 9160, it is determined whether any of these messages timed out. If yes, the process again returns to module 9130. If not, at module 9170, it is determined whether the player card is still inserted. If not, the process transitions to the player card removed process at module 9180. If so, the process transitions to the system game console process at module 9190.

In some instances, autoplay may be invoked. FIG. 92 is a software flowchart of how the Autoplay logic works. Process 9200 initiates at module 9205, and at module 9210, the autoplay setting is checked. If autoplay is off, the process terminates at module 9288. Otherwise, if iView is not at the console main screen at module 9215, the process terminates at module 9286. At module 9220, if the player has navigated on iView during the session, the process also terminates at module 9286. The process is not invoked when these indicia indicate a relatively active machine.

At module 9225, the autoplay timer is checked. If it is not on, at module 9230 the timer is turned on. At module 9235, it is determined whether the player navigated on iView. If so, the autoplay timer is turned off at module 9245 and the process terminates at module 9250. If not, at module 9240, an abandon card state is checked. If this is present, then at module 9250 the autoplay timer is reset and the process returns to module 9235.

If the abandon card state is not present, a tilt state is checked at module 9255. If the machine is in tilt mode, at module 9270 the autoplay timer is turned off, and the process terminates at module 9282. If the machine is not in tilt state, at module 9260, a warning is shown in the prompt area (e.g. the machine is about to automatically play a hand of poker). At module 9265, the autoplay timer is checked. If the time has not exceeded the limit, then the process returns to module 9235. If the time has exceeded the limit, than at module 9275 the console launches the appropriate game based on the state of the card and the accrued points. The process then transitions to the game flow process via module 9280.

In some instances, an employee card may be inserted. FIG. 93 is a software flowchart of what happens when the employee card is inserted. Process 9300 initiates at module 9310. At module 9320, an employee card insertion is detected. At module 9330, a determination is made as to whether the player is in a game. If so, the console waits for the game to end at module 9340. The process then shows the employee legacy menu at module 9350. At module 9360, it is determined whether the employee card was removed. If not, the process loops back to the menu at module 9350. If so, the process goes to the legacy attract process at module 9370.

In some instances, a heartbeat timer may override other processes. FIG. 94 is a software flowchart of heartbeat messages from the iVIEW to the Live Rewards server or SGS. Process 9400 initiates at module 9410 and determines at module 9420 whether a message was sent and received from the server. If so, the heartbeat timer is reset at module 9480 and the process terminates at module 9490. If not, at module 9430, it is determined whether the heartbeat timer has expired. If not, the process terminates at module 9440. If so, the console sends a time request to the server at module 9450. Additionally, the console sends game data to the server at module 9460, and terminates the process at module 9470. Thereby, the system is always updated, at least about every 14 minutes in one embodiment.

Other override conditions may occur, too. FIG. 95 is a software flowchart of what happens when abandoned player cards or directed messages come in from the Game monitoring unit. Process 9500 initiates at module 9505 and at module 9510 a message relating to an abandoned card or a directed message is received. At module 9515, a current game is checked. If there is a current game, at module 9590, the console ends the game with a menu pressed message and waits for game termination. If there is no game in progress, at module 9520 it is determined whether a withdrawal was started. If so, the console waits for completion of the transaction at module 9525. If no withdrawal, at module 9570, it is determined whether the player is at a handpay screen. If so, if the player does not cancel at module 9575, the handpay is processed at module 9580 and the process terminates at module 9585.

If the handpay is cancelled, if no handpay was in progress, or if the process is transitioning from modules 9590 or 9525, the process moves to module 9530 and determines is an abandoned card message was received. If so, the console goes to the abandoned card screen and continues to accrue player points and the threshold counter at module 9535. At module 9540, it is determined whether the player card was removed. If not, the process returns to module 9535 and if so, the process transitions to the player card removed process via module 9545.

If no abandoned card message was received, the console shows legacy pages at module 9550 until the timer for the pages is complete. At module 9555, it is determined whether the player card is still in. If not, the process transitions to the legacy attract mode via module 9560. If so, the process transitions to the system game main console screen via module 9565.

Another possibility is failure of NVRAM. FIG. 96 is a software flowchart of what happens when the writing to the non-volatile memory fails. Process 9600 initiates with module 9610 and at module 9615, an NVRAM failure is detected. The console sends an error message to the server at module 9620. At module 9625, the console attempts to send in log data. At module 9630, a determination is made as to whether a game was in progress. If so, at module 9665 the console sends an end game message with score and winnings. At module 9670, the console unloads the game. At module 9635, the console sends any play points and threshold counter data to the server and any withdrawal information, regardless of whether a game was in progress. At module 9640, a tilt message is displayed. At module 9645, a technician takes the machine out of service and may need to clean up the player session at another terminal (e.g. a cage terminal). The process terminates at module 9650.

The following lists the proposed features that make up the player's account movements:

On the server:

There may be a player account that contains (not limited to)

a) Useable Play Points b) A Threshold Counter value c) Un-transferred Bonus Points (BP's)

d) Un-collected Cash Winnings

This account may be accessible at all times to any number of cards that are inserted into an iVIEW.

When the LIVE REWARDS SERVER receives a card-in from an iView it may make a reserve account for that player linked by:

a) Card number b) IView ID

LIVE REWARDS SERVER may transfer the contents of the player's account into the reserve account for use by this player.

The reserve account may have a date/time stamp that is updated each time the iView either:

a) Deposits PP, TC, BP, or cash b) Transfers cash via AFT to base game c) Does a Begin Game or End Game call d) Sends a 'heartbeat' message If the date/time stamp is ever older than X minutes (server configurable) the values in the reserve account may rollback into the player's account.

On Begin game PP's and TC's are deducted from the reserve account to fund the game selected by the player.

On End Game: winnings from the played game are added into the player's reserve account.

Any BP's are immediately sent to the CMS from LIVE REWARDS SERVER.

On card-out the remaining values in the reserve account may roll back into the player's account.

Deposits from the iView in recovery mode are put in the player's account and any reserve account for this card #/iView ID are rolled back.

Use of Random Number Generator

Boom Bingo and Payday Poker utilize an RNG for parts of their game play. The specific RNG used is a KISS algorithm. Both games use the System Game GDK, KissRNG. It is used in the following way:

1. When a Game (such as Boom Bingo) Loads, the kissRNG class is seeded with the TickCount. This is the number of milliseconds elapsed since this device has booted: seed_ rand_kiss((uint)
(System.Environment.TickCount%uint.MaxValue));

2. Each gameloop (approximately 20 times per second), the random number is churned: rand_kiss( ); //Churn RNG 3. When a base games is played on the cabinet (a player generated event), the Random is reseeded with the next value of the current seed:
if(id==CMGDKSystemMessage.BaseGameStart) seed_rand_kiss(rand_kiss( ));

4. When a enough Base games have been played to start a System Game (Bingo or Poker), the Game may use the rand_kiss( ); as many times as needed to generate its outcome.

Usage of Random in Boom Bingo

Bingo uses the RNG in 2 ways:

To generate the bingo cards

To draw the balls

To generate a bingo card the game:

1. Picks a random number between 1 and 15 for the first column.

2. Repeats 5 times. Once for each square in the first column.

3. If a duplicate random number is picked, another random number is picked until all numbers within the column are unique.

4. Repeat the process for the other 4 columns using the following rules for the range of numbers:
column 1 (B) 1 thru 15
column 2 (I) 16 thru 30
column 3 (N) 31 thru 45
column 4 (G) 46 thru 60
column 5 (O) 61 thru 15

When drawing the balls the game:

1. Picks a random number between 1 and 75.

2. Repeat for all 10 balls that are displayed to player.

3. If a duplicate random number is picked, another random number is picked until all balls have a unique number.

Usage of Random in Poker

Poker uses the RNG to shuffle the deck of cards

To shuffle the deck:

1. A deck Object of 52 unique cards exists.

2. Starting with the first card in the deck a random card in the deck is selected. That card is swapped with the first card.

3. This process continues for all 52 cards in the deck.

4. If on any given card, the random card that was chosen is the current card, the card may not move.

5. This shuffle process may go through the deck 7 times.

6. The deck is then verified for accuracy to ensure no duplicates exist. In the case of a duplicate being found the deck may be reset to an ordered deck (ace-king for each suit) and then pass through the shuffle process again.

7. The deck is not ordered at the beginning of each hand. The deck from the prior hand is used and shuffled.

Bally Live Rewards Message Interface Definitions

Bally Live Rewards Server (BLRS) communicates with iVIEW's through Web Services over http/http(s). The following Web Service methods are provided by the Bally Live Rewards Server:

| Name | Purpose |
|---|---|
| registerIView | Register's the iVIEW with BLRS |
| getSGSDateTime | Returns the current BLRS Date time |
| getGlobalSettings | Returns the global settings for Live Reward Games |
| getAllPlayerSettings | Returns the player settings including available games, game start rules and play point value for all the player types |
| postEventLog | Logs the event message in to BLRS |
| getActivePayTableSets | Returns the active pay table sets, game settings for all the games and player types |
| getPayTableSet | Returns the requested pay table set object |
| unRegisterIView | Un registers the iVIEW with BLRS |
| SGS_CreateSession | Creates the Session for request player on a specified iVIEW and also returns weather the requested device is active or not. |
| SGS_ValidatePin | Validates the player PIN number with CMS/CMP |
| SGS_IsPlayerLocked | Verifies with the BLRS and returns weather the player is locked or not and also returns the time in minutes, how long that player will be locked |
| SGS_GetSessionBuckets | Returns the all player current session bucket balance values |
| SGS_Deposit | Deposits the requested player bucket transaction value in to the BLRS |
| SGS_StartWithdrawal | Initiates the withdrawal transaction with BLRS for a specified player bucket transaction value in BLRS |
| SGS_EndWithdrawal | Closes the opened withdrawal transaction |
| SGS_BeginGame | Initiates the begin game transaction with BLRS |
| SGS_EndGame | Closes the opened game play transaction |
| SGS_StartHandpay | Imitates the hand pay transaction with BLRS |
| SGS_EndHandpay | Closes the opened Hand pay |
| SGS_CloseSession | Closes the opened session |
| SGS_EGMGamePlay | Posts the EGM activity. i.e., total coin In, total coin Out and No-of games played to the BLRS. |
| SGS_QueryGameplayLog | Returns the game play transactions log for the requested device |
| SGS_QueryWithdrawals | Returns the withdrawal transactions log for the requested device |
| SGS_QueryHandpayLog | Returns the hand pay transactions log for the requested device |

Services Specs

Return Values

All web services will return an object. All return objects inherit from the same base class and therefore always contain the following fields:

| Response Parameter Name | Purpose |
|---|---|
| Result | Call result: 0 - success, non-zero - failure |
| errorString | Error description (empty if success) |

| Error Description | Error Code |
|---|---|
| GENERIC_SYSTEM_ERROR | −1 |
| SUCCESS | 0 |
| SUCCESS_WITH_DUPLICATE_TRANSACTION | 1 |
| INVALID_PARAMS | 2 |
| SESSION_ID_INVALID | 10 |
| SESSION_SUSPENDED | 11 |
| SESSION_CLOSED | 12 |
| SESSION_VALIDATION_FAILURE | 13 |
| SESSION_CLOSE_FAILURE_PENDING_TRANSACTIONS | 14 |
| INSUFFICIENT_FUNDS | 20 |
| INVALID_SESSSION_DEPOSIT_NUMBER | 21 |
| INVALID_SESSSION_WITHDROWAL_NUMBER | 22 |
| TRANSACTION_ID_INVALID | 23 |
| TRANSACTION_VALIDATION_FAILURE | 24 |
| ATTEMPT_TO_ROLLBACK_COMMITED_TRANSACTION | 25 |
| ATTEMPT_TO_COMMIT_ROLLEDBACK_TRANSACTION | 26 |
| NON_JURISDICTION_WITHDRAWALS_ONLY | 27 |
| JURISDICTION_WITHDRAWALS_ONLY | 28 |
| INVALID_HANDPAY_ID | 40 |
| HANDPAY_VALIDATION_FAILURE | 41 |
| ATTEMPT_TO_COMPLETE_CANCELLED_HANDPAY | 42 |
| ATTEMPT_TO_CANCEL_COMPLETED_HANDPAY | 43 |
| ATTEMPT_TO_COMPLETE_COMPLETED_HANDPAY | 44 |
| CMS_FUNCTION_FAILED | 70 |
| INVALID_HID | 80 |
| LAST_ERROR | 10000 |

Web Service: registerIView

The purpose of this message is to create a unique iVIEW Id on the Live Rewards Server; if that specified iVIEW Id (machine address of a device) already exists in the BLRS database it updates the related information with the same iVIEW Id. All the information that is stored along with the unique iVIEW Id is reference purpose to identify the device and its location.

| | Purpose | Type/Range |
|---|---|---|
| Request Parameter Name | | |
| iviewId | Machine address of iVIEW device | 0-50 characters |
| casinoId | Unique for each casino | 0-4 characters |
| gameSerialNo | Serial number of cabinet | 0-40 characters |
| gameId | Manufacturer type | 0-5 characters |
| payTableId | Unique Pay Table Id | 0-6 characters |
| basePer | Theoretical pay back | 0-10 characters |
| gmuTime | Gmu time | 0-6 characters |
| maxBet | Max bet for game | 0-12 characters |
| gmuId | Gmu network address | 0-32 characters |
| protocolVersion | Version number of protocol | 0-16 characters |
| enableFeatures | SAS related bit mapped field of features the game has enabled | 0-6 characters |
| gameType | Type of ecash game | 0-3 characters |
| Enable | Enable or disable Live Rewards Game messaging | True/False |
| denomination | No-of pennies in credit for game played | 0-12 characters |
| totalCoinIn | Coin in game meter in pennies | 0-12 characters |
| totalCoinOut | Coin out game meter in pennies | 0-12 characters |
| gamesPlayed | No-of games played | 0-12 characters |
| assetId | Unique identifier to the casino for the cabinet | 0-8 characters |
| Response Parameter Name | | |
| isActive | iVIEW device is active or not in the BLRS | True/False |
| Result | Call result: 0 - success, non-zero - failure | Int |
| errorString | Error description | 0-1000 characters |

The purpose of this message is to sync the iVIEW device clock with the Live Rewards Server clock. This message returns the current Live Rewards Server date and time.

| | Purpose | Type/Range |
|---|---|---|
| Request Parameter Name | | |
| None | | |

-continued

| | Purpose | Type/Range |
|---|---|---|
| Response Parameter Name | | |
| Result | Call result: 0 - success, non-zero - failure | Int |
| errorString | Error description | 0-1000 characters |
| CurrentDateTime | Current Live Rewards Server date and time | Date and time object |

Web Service: getGlobalSettings

The purpose of this message is to control the Live Rewards games/console on iVIEW depending on the settings defined on the server side. It returns the Global settings (these settings are common for all the iVIEW's) defined on the Live Rewards Server.

| | Purpose | Type/Range |
|---|---|---|
| Request Parameter Name | | |
| IviewId | Machine address of iVIEW device | 0-50 characters |
| Response Parameter Name | | |
| Resync Interval | Resync interval rate in mins for iVIEW to request the global settings, active pay table sets and player type settings from BLRS. | Double |
| System game mode volume | Live Rewards game volume in percentage | Int |
| Attract mode volume | iVIEW attract mode volume in percentage | Int |
| Auto Play | True - auto play enabled, False - auto play disabled | True/False |
| *Tilt Time | Time in mins to tilt the system games | Int |
| *Auto Remove Play points | Time in minutes to clear the not used Live Rewards game play points on the device. 0 = this feature is OFF | Int |
| Jurisdictional Limit | Array of Prize Type Limit objects. Each object contains prize type Id and limit number | Double |

*Means not used

Web Service: getAllPlayersSettings

It returns the player settings including accrual rate, Live Rewards game start threshold counter and Live Rewards game start rules for all the player types (ex: Gold, Silver, etc.) defined on the BLRS

| | Purpose | Type/Range |
|---|---|---|
| Request Parameter Name | | |
| IviewId | Machine address of iVIEW device | 0-50 characters |
| Response Parameter Name | | |
| Player Settings | Array of player Setting objects | |
| Each Player Type Settings Object contains | | |
| Player Type | Player type Id (Gold, Silver, etc) | Int |
| Accrual Rate | Play points accrual percentage | Double |
| System Game Start Threshold | Live Rewards game start counter | Int |
| System Game Start Rules | Array of Rules. Each Rule contains | |
| | Rule Id | Int |
| | Rule Description | 0-20 characters |
| | Occurrence counter | Int |
| | Increment Value | Int |
| Available Games | Array of Game objects. Each object contains | |
| | Game ID | 0-4 characters |
| | Game Name | 0-50 characters |

Web Service: postEventLog

The purpose of this message is to store the logs (error logs or events or information) in to the Live Rewards server database occurred in the iVIEW's, example tilt messages on iVIEW's.

| | Purpose | Type/Range |
|---|---|---|
| Request Parameter Name | | |
| eventType | Type of the event (0-Error, 1-Info, 2-debug) | 0-10 characters |
| iviewId | Machine address of a iVIEW device | 0-50 characters |
| assetId | Asset number assigned to this device or slot/base game | 0-8 characters |
| errCode | Error code defined by the iVIEW if any | 0-20 characters |
| Data | Information/message about the event | 0-200 characters |
| Response Parameter Name | | |
| Result | Call result 0 - success, non-zero - failure | Int |
| errorString | Error description | 0-1000 characters |

Web Service: unRegisterIView

The purpose of this message is to unregistered the registered iVIEW with the BLRS.

| | Purpose | Type/Range |
|---|---|---|
| Request Parameter Name | | |
| iviewId | Machine address of a iVIEW device | 0-50 characters |
| Response Parameter Name | | |
| Result | Call result: 0 - success, non-zero - failure | Int |
| errorString | Error description | 0-1000 characters |

Web Service: getActivePayTableSets

It returns all the active pay table sets, game settings for the Live Rewards games by player types (ex: Gold, Silver, etc.) defined on the BLRS

| | Purpose | Type/Range |
|---|---|---|
| Request Parameter Name | | |
| iviewId | Machine address of a iVIEW device | 0-50 characters |
| Response Parameter Name | | |
| PTabSets | All pay table sets | XML Node |
| Result | Call result: 0 - success, non-zero - failure | Int |
| errorString | Error description | 0-1000 characters |

Web Service: getPayTableSet

It returns the requested pay table set object from BLRS.

| | Purpose | Type/Range |
|---|---|---|
| Request Parameter Name | | |
| PayTableSetId | Pay table set Id | Int |
| Response Parameter Name | | |
| PTabSets | pay table set | XML Node |
| result | Call result: 0 - success, non-zero - failure | Int |
| errorString | Error description | 0-1000 characters |

Web Service: SGS_CreateSession

It creates the Session for requested player on a specified iVIEW. It reserves the buckets for that player in this session.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| Response Parameter Name | | |
| sessionId | A unique session Id | Int |
| Buckets | An array of buckets. Each bucket contains | |
| | prizeTypeId | Int |
| | jurisdiction | True/False |
| | TRX_Value | Double |
| | balance | Double |
| PlayerData | Player Data object contains | |
| | plrCardNo | 0-20 characters |
| | playerType | Int |
| | banned | True/False |
| IsDeviceActive | Weather the requested iVIEW device is active or not | True/False |
| result | Call result: 0 - success, non-zero - failure | Int |
| errorString | Error description | 0-1000 characters |

Web Service: SGS_ValidatePin

It verifies the Player Pin is correct or not through CMS/CMP servers.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| Pin | Pin number | UN KNOWN |
| Response Parameter Name | | |
| pinStatus | Valid or Not | True/False |
| isLocked | Locked or Not | True/False |
| lockTimeinMins | Lock time in minutes | Int |
| result | Call result: 0 - success, non-zero - failure | Int |
| errorString | Error description | 0-1000 characters |

Web Service: SGS_IsPlayerLocked

It checks weather the requested player is locked or not in BLRS. If the player is locked it returns lock time in minutes.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| Response Parameter Name | | |
| isLocked | Locked or Not | True/False |
| lockTimeinMins | Lock time in minutes | Int |
| result | Call result: 0 - success, non-zero - failure | Int |
| errorString | Error description | 0-1000 characters |

Web Service: SGS_GetSessionBuckets

It returns the requested player Session Bucket values from reserved buckets (session buckets).

| | Purpose | Type/Range |
|---|---|---|
| Request Parameter Name | | |
| iviewId | Machine address of a iVIEW device | 0-50 characters |
| plrCardNo | Player Card Number | 0-20 characters |
| sessionId | Session Number | Int |
| Response Parameter Name | | |
| Buckets | An array of buckets. Each bucket contains | |
| | prizeTypeId | Int |
| | jurisdiction | True/False |
| | TRX_Value | Double |
| | Balance | Double |
| result | Call result: 0 - success, non-zero - failure | Int |
| errorString | Error description | 0-1000 characters |

Web Service: SGS_Deposit

It deposits the requested buckets transaction values in to player's session buckets and it returns the current balances.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| sessionId | Session Number | Int |
| depositNumber | Deposit counter number | Int |
| Buckets | An array of buckets. Each bucket contains | |
| | prizeTypeId | Int |
| | jurisdiction | True/False |
| | TRX_Value | Double |
| | balance | Double |

-continued

| | | |
|---|---|---|
| Response Parameter Name | | |
| Buckets | An array of buckets. Each bucket contains | |
| | prizeTypeId | Int |
| | jurisdiction | True/False |
| | TRX_Value | Double |
| | balance | Double |
| result | Call result: 0 - success, non-zero - failure | Int |
| errorString | Error description | 0-1000 characters |

Web Service: SGS_StartWithdrawal

Initiates the withdrawal transaction for requested bucket and returns the BLRS Transaction Number to store in SDS Logs.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| sessionId | Session Number | Int |
| withdrawalNumber | Withdrawal counter number | Int |
| Bucket | Bucket contains | |
| | prizeTypeId | Int |
| | jurisdiction | True/False |
| | TRX_Value | Double |
| | balance | Double |
| Response Parameter Name | | |
| SGS_TransactionID | BLRS Transaction Number to store in the SDS | Int |
| result | Call result: 0 - success, non-zero - failure | Int |
| errorString | Error description | 0-1000 characters |
| Buckets | An array of buckets. Each bucket contains | |
| | prizeTypeId | Int |
| | jurisdiction | True/False |
| | TRX_Value | Double |
| | balance | Double |

Web Service: SGS_EndWithdrawal

It completes the withdrawal transaction for the requested BLRS Transaction Number and amount. If the amount is different than the Start amount, balance will deposited back to player account.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| sessionId | Session Number | Int |
| SGS_TransactionID | BLRS Transaction Number | Int |
| isCommit | Commit or Rollback | True/False |
| TRX_Value | Transaction Value to commit or rollback | Double |

-continued

| Response Parameter Name | | |
|---|---|---|
| SGS_TransactionID | BLRS Transaction Number to store in the SDS | Int |
| result | Call result: 0 - success, non-zero - failure | Int |
| errorString | Error description | 0-1000 characters |

Web Service: SGS_BeginGame

Creates the new Game play history Id (HID) and debits the requested buckets transaction values from player session buckets.

| | Purpose | Type/Range |
|---|---|---|
| Request Parameter Name | | |
| GamePlay | Gameplay object contains | |
| | GID | 0-4 characters |
| | IviewId | 0-50 characters |
| | plrCardNo | 0-20 characters |
| | sessionId | Int |
| | casinoId | 0-4 characters |
| | gmuId | 0-32 characters |
| | assetNo | 0-8 characters |
| | startDateTime | Date time |
| | payTabSetId | Int |
| | payTabId | Int |
| | gameSettingsId | Int |
| | Array of Buckets. each bucket contains | |
| | prizeTypeId | Int |
| | jurisdiction | True/False |
| | TRX_Value | Double |
| | balance | Double |
| Response Parameter Name | | |
| HID | Game play History Id | Int |
| Buckets | An array of buckets. Each bucket contains | |
| | prizeTypeId | Int |
| | jurisdiction | True/False |
| | TRX_Value | Double |
| | balance | Double |
| Result | Call result: 0 - success, non-zero - failure | Int |
| errorString | Error description | 0-1000 characters |

Web Service: SGS_EndGame

It closes the Game transaction for the specified HID and stores the bucket transaction values in to player session buckets if any WIN.

| | Purpose | Type/Range |
|---|---|---|
| Request Parameter Name | | |
| GamePlay | Gameplay object contains | |
| | HID | Int |
| | IviewId | 0-50 characters |
| | plrCardNo | 0-20 characters |
| | sessionId | Int |
| | endDateTime | Date time |
| | payLineId | Int |
| | score | Int |
| | Array of Buckets. each bucket contains | |
| | prizeTypeId | Int |
| | jurisdiction | True/False |
| | TRX_Value | Double |
| | balance | Double |
| Response Parameter Name | | |
| HID | Game play History Id | |
| Buckets | An array of buckets. Each bucket contains | |
| | prizeTypeId | Int |
| | jurisdiction | True/False |
| | TRX_Value | Double |
| | balance | Double |
| result | Call result: 0 - success, non-zero - failure | Int |
| errorString | Error description | 0-1000 characters |

Web Service: SGS_StartHandpay

Initiates the new Hand pay transaction and returns the Hand pay ID with the bucket values to send a message to cage.

| | Purpose | Type/Range |
|---|---|---|
| Request Parameter Name | | |
| HPType | Hand pay Type (Jurisdiction or player initiated) | Int |
| SessionId | Player Current Session Id | Int |
| IviewId | Machine address of a iVIEW device | 0-50 characters |
| CasinoId | Property Id | 0-4 characters |
| GmuId | Machine address of a device | 0-32 characters |
| AssetNo | Account number of a device | 0-8 characters |
| PLRCardNo | Player card number | 0-20 characters |
| Buckets | Array of Buckets. each bucket contains | |
| | prizeTypeId | Int |
| | jurisdiction | True/False |
| | TRX_Value | Double |
| | balance | Double |
| Response Parameter Name | | |
| HPID | Hand pay ID | Int |
| Result | Call result: 0 - success, non-zero - failure | Int |
| errorString | Error description | 0-1000 characters |

Web Service: SGS_EndHandpay

It closes the Hand pay transaction for the request hand pay ID.

| | Purpose | Type/Range |
|---|---|---|
| Request Parameter Name | | |
| IviewId | Machine address of a iVIEW device | 0-50 characters |
| Player Card Number | Player card number | 0-20 characters |
| SessionId | Player Current Session Id | Int |
| HandpayId | Hand pay Id | Int |
| isCommit | Commit the transaction or not | True/False |
| Completed By | Employee card number | 0-20 characters |

-continued

| Response Parameter Name | | |
|---|---|---|
| HPID | Hand pay ID | |
| Result | Call result: 0 - success, non-zero - failure | 0 or non-negative |
| errorString | Error description | 0-1000 characters |

Web Service: SGS_CloseSession

Closes the requested player session on specified iVIEW and moves the player session buckets in to player main account

| | Purpose | Type/Range |
|---|---|---|
| Request Parameter Name | | |
| iviewId | Machine address of a iVIEW device | 0-50 characters |
| plrCardNo | Player Card Number | 0-20 characters |
| sessionId | Session Number | Int |
| recoveryYN | Recovery session or normal | True/False |
| Response Parameter Name | | |
| result | Call result: 0 - success, non-zero - failure | 0 or 1 |
| errorString | Error description | 0-1000 characters |

Web Service: SGS_EGMGamePlay

It posts the EGM game play activity data in to the BLRS. i.e., total coin in, total coin out, # of games played. This data will be posted on every heart beat call to the server, before create session and before close session.

| | Purpose | Type/Range |
|---|---|---|
| Request Parameter Name | | |
| iviewId | Machine address of a iVIEW device | 0-50 characters |
| assetId | Account number of a device | 0-20 characters |
| sessionId | Session Number | Int |
| totCoinIn | Total coin in | Int |
| totCoinOut | Total coin out | Int |
| gamesPlayed | No of games played | Int |
| Status | Status of the device at the time of posting data | 0 = None<br>1 = Session Open<br>2 = Session in progress<br>3 = Session Closed |
| Response Parameter Name | | |
| result | Call result: 0 - success, non-zero - failure | 0 or 1 |
| errorString | Error description | 0-1000 characters |

Web Service: SGS_QueryWithdrawals

It returns the withdrawal transaction Log for the requested iVIEW and prize type.

| | Purpose | Type/Range |
|---|---|---|
| Request Parameter Name | | |
| iviewId | Machine address of a iVIEW device | 0-50 characters |
| prizeType | Prize type | Int |
| noofRecords | No-Of records to return | Int |
| Response Parameter Name | | |
| Withdrawl_Report | Array of Withdrawal_Report object.<br>Each Withdrawal_Report contains | |
| | tranId | Int |
| | sessionId | Int |
| | session_TrxId | Int |
| | plrCardNo | 0-20 characters |
| | sourceId | 0-50 characters |
| | tranDateTime | Date time |
| | prizeValue | Double |
| | jurisdiction | True/False |
| result | Call result: 0 - success, non-zero - failure | Int |
| errorString | Error description | 0-1000 characters |

Web Service: SGS_QueryGamePlayLog

It returns the Game play history transactions for the requested iVIEW.

| | Purpose | Type/Range |
|---|---|---|
| Request Parameter Name | | |
| iviewId | Machine address of a iVIEW device | 0-50 characters |
| noofRecords | No-Of records to return | Int |
| Response Parameter Name | | |
| GamePlay_Report | Array of Gameplay_Report object.<br>Each Gameplay_Report contains | |
| | HID | Int |
| | GID | Int |
| | IviewId | 0-50 characters |
| | plrCardNo | 0-20 characters |
| | sessionId | Int |
| | casinoId | 0-4 characters |
| | gmuId | 0-32 characters |
| | assetNo | 0-8 characters |
| | startDateTime | Date time |
| | endDateTime | Date time |
| | payTabSetId | Int |
| | payTabId | Int |
| | gameSettingsId | Int |
| | score | Int |
| | buckets Spent | Bucket values |
| | buckets Won | Bucket values |
| result | Call result: 0 - success, non-zero - failure | Int |
| errorString | Error description | 0-1000 characters |

Web Service: SGS_QueryHandpayLog

It returns the hand pay transactions for the requested iVIEW.

| | Purpose | Type/Range |
|---|---|---|
| Request Parameter Name | | |
| iVIEW Id | Machine address of a iVIEW device | 0-50 characters |
| noofRecords | No-Of records to return | Int |
| Response Parameter Name | | |
| HandPay_Report | Array of HandPay_Report object. Each HandPay_Report contains | |
| | HPID | Int |
| | HPDesc | 0-50 characters |
| | IviewId | 0-50 characters |
| | plrCardNo | 0-20 characters |
| | sessionId | Int |
| | casinoId | 0-4 characters |
| | gmuId | 0-32 characters |
| | assetNo | 0-8 characters |
| | createdDateTime | Date time |
| | completedDateTime | Date time |
| | completedBy | 0-20 characters |
| | buckets | Bucket values |
| result | Call result: 0 - success, non-zero - failure | Int |
| errorString | Error description | 0-1000 characters |

It may be useful to understand the overall system in some detail. FIG. 97 provides an overview of the system and the various servers used. System 9700 includes a game machine 9710, rewards server 9720, marketing server 9730, slot system 9750 and gamenet bridge 9740. Rewards server 9720 administers player loyalty rewards and maintains player profiles. Marketing system 9730 administers marketing to players and interacts with the rewards server to customize this marketing. It also interacts with slot system 9750. Slot system 9750 manages the slot system at a high level, administering payout rates and jackpots, for example. Gamenet bridge 9740 communicates with the individual game machines 9710 to track actual games (as opposed to rewards which are handled in communication with rewards server 9720).

Game 9710 is a gaming system with a GMU 9790, iView 9755, and base game processor 9780. Game 9710 also includes a display 9785, pinpad 9797 and card reader 9793 (in various embodiments). IView 9755 includes a casino magic interface 9760 with the rewards server 9720 which communicates with a game 9765 and with the iView shell 9770. The iView shell 9770 also communicates through a GMU service 9775 (or directly) with the base game processor 9780, and communicates directly with GMU 9790.

FIG. 98 illustrates an embodiment of an example process of operating a game such as may be used in the system of FIG. 97. Process 9800 and other processes of this document are described in terms of modules which may be executable code, components, subsystems, or other implementations of a system or method which accomplishes the function in question.

Process 9800 initiates at module 9810 with play of a game at a game device. At module 9820, base game data from the game (e.g. a result) is sent to a rewards server. At module 9830, the gaming device receives trigger(s) from a rewards server, such as a trigger to enter a bonus game or to award a bonus. At module 9840, the game device transmits a bonus amount (e.g. an ante or fee to play) to the rewards server to qualify for the triggered bonus opportunity. At module 9850, the gaming device is used to play the bonus game, such as an interactive game or a game with enhanced payouts, for example. At module 9860, the bonus game data is sent to the rewards server from the gaming device.

FIG. 99 illustrates an embodiment of a process of operating a rewards server such as may be used in the system of FIG. 97 and with the process of FIG. 98. Process 9900 initiates with receipt of game data at the rewards server from the gaming device at module 9910. At module 9920, the game data is analyzed, such as to determine if a rewards threshold has been met, or to accumulate rewards points. At module 9930, bonus data is sent to the gaming device, such as a bonus jackpot (increased prize) or a bonus trigger (or triggers), such as may trigger entry into a bonus game or tournament mode. At module 9940, the server receives bonus ante or entry fee from the gaming device which is required to enter the bonus game or bonus round. This requirement may be signaled along with the bonus trigger, or it may be standardized. At module 9950, the server receives bonus game results from the game device.

FIG. 100 illustrates an embodiment of a system using the game and rewards server of FIGS. 98 and 99. System 10000 may be a system similar to system 9700 of FIG. 97. Game 10010 is a gaming machine which is capable of bonus play and communicates with rewards server 10020. Rewards server 10020 administers player data (potentially in combination with another server) and also handles rewards data including triggering of bonus events. Rewards server 10020 may trigger bonus events on other games 10030, and tournament play may be part of a bonus event (e.g. tournament poker games may be the bonus). To enter the bonus event, rewards server 10020 may require an initial bet (e.g. an ante) or entry fee, for example, and may secure that before allowing the player to enter.

Further discussion of the protocols and the system of a specific implementation and embodiment may provide additional illustrations. The following discussion does not necessarily apply to all implementations or embodiments—it represents an example embodiment. Referring further to FIG. 97, an embodiment of a networked gaming system is shown with a player rewards server, a CMP/CMS server, an SDS or SMS server, a GameNet Bridge router, and a gaming machine, where each of the elements may be representative of multiple units which may be connected to function and connect as shown. Within the gaming machine, a game management unit (GMU) connects from the GameNetBridge to a base game processor board, such as a Bally Alpha game board, and to a player interface unit, such as a Bally iView. Within the player interface unit block, executable code is contemplated to be stored on a player interface processor board and may include operating system code, such as Bally iViewShell.exe, player rewards code or callable module, such as Bally CasinoMagic, game code, such as Game.exe, and GMU-related code for providing an information channel between the GMU, base game and player interface unit. Various communication protocols are shown on the respective connecting branches.

Message Protocols BLRS/iView

Bally Live Rewards Message Interface Definitions

Bally Live Rewards Server (BLRS) communicates with iVIEW's through Web Services over http/http(s).

Common Definitions, Acronyms and Abbreviations

| Term | Description |
|---|---|
| BLRS | Bally Live Rewards Server, formally SGS - System Game Server |
| iVIEW | System Game client device, installed on base EGM - Electronic Gaming Machine |
| GID | Unique identifier of a System Game (e.g. 104 - Blazing 7s) |
| HID | Unique identifier of a System Game Play associated with specific iVIEW, player card number, GID, SessionID, etc. |
| Bucket | A player account of certain currency type (like Cash, Bonus Points, Play Points, Threshold Counter, etc.) on BLRS. |
| Master Player Buckets | Master Player buckets contain all the funds for a player (identified with player card number). Only one set of Master Player buckets exists. |
| Session Buckets | When a player has his/her card inserted into an EGM with an iVIEW (opening a session with BLRS), all funds are moved from Master Player buckets to Session buckets. Multiple sets of Session buckets might exist at the same time. When card is removed (closing session with BLRS), all the funds from Session buckets are moved back to Master Player buckets. |

Bally Live Rewards Message Interface Definitions

Bally Live Rewards Server (BLRS, formally SGS—System Game Server) communicates with iVIEW's through Web Services over http/http(s). The following Web Service methods are provided by the Bally Live Rewards Server:

| Name | Purpose |
|---|---|
| registerIView | Register's the iVIEW with BLRS |
| getSGSDateTime | Returns the current BLRS Date time |
| getGlobalSettings | Returns the global settings for Live Reward Games |
| getAllPlayerSettings | Returns the player settings including available games, game start rules and play point accrual value for all the player types |
| postEventLog | Logs event message in to BLRS |
| getActivePayTableSets | Returns the active pay table sets, game settings for all the games and player types |
| getPayTableSet | Returns the requested pay table set object |
| unRegisterIView | Un registers the iVIEW with BLRS |
| SGS_CreateSession | Creates the Session for request player on a specified iVIEW and also returns whether the requested device is active or not. |
| SGS_ValidatePin | Validates the player PIN number with CMS/CMP |
| SGS_IsPlayerLocked | Verifies with the BLRS and returns weather the player is locked or not and also returns the time in minutes, how long that player will be locked. This is set after too many successive PIN verification failures |
| SGS_GetSessionBuckets | Returns the all player current session bucket balance values |
| SGS_Deposit | Deposits earned by a player session bucket values into the BLRS. |
| SGS_StartWithdrawal | Initiates the withdrawal transaction with BLRS for a session bucket value in BLRS |
| SGS_EndWithdrawal | Closes the opened withdrawal transaction |
| SGS_BeginGame | Initiates the begin game transaction with BLRS |
| SGS_BeginGameWithDeposits | Combined SGS_BeginGame and SGS_Deposit call |
| SGS_ProcessTournIntermediateScore | Performs intermediate score processing for a tournament game |
| SGS_EndGame | Closes the opened game play transaction |
| SGS_StartHandpay | Imitates the hand pay transaction with BLRS |
| SGS_EndHandpay | Closes the opened Hand pay |
| SGS_CloseSession | Closes the opened session |
| SGS_EGMGamePlay | Posts the EGM activity. i.e., total coin In, total coin Out and No-of games played to BLRS. |
| SGS_QueryGameplayLog | Returns the game play transactions log for the requested device |
| SGS_QueryWithdrawals | Returns the withdrawal transactions log for the requested device |

-continued

| Name | Purpose |
|---|---|
| SGS_QueryHandpayLog | Returns the hand pay transactions log for the requested device |
| SGS_GetPrizeTypes | Returns all available on BLRS prize types |

Services specs

Return values

All web services will return an object. All return objects inherit from the same base class and therefore always contain the following fields:

| Response Parameter Name | Purpose |
|---|---|
| Result | Call result: 0 - success, non-zero - failure |
| errorString | Error description (empty if success) |

Error Codes

| Error Description | Error Code |
|---|---|
| GENERIC_SYSTEM_ERROR | −1 |
| SUCCESS | 0 |
| SUCCESS_WITH_DUPLICATE_TRANSACTION | 1 |
| INVALID_PARAMS | 2 |
| AUTHORIZATION_FAILURE | 3 |
| SESSION_ID_INVALID | 10 |
| SESSION_SUSPENDED | 11 |
| SESSION_CLOSED | 12 |
| SESSION_VALIDATION_FAILURE | 13 |
| SESSION_CLOSE_FAILURE_PENDING_TRANSACTIONS | 14 |
| INSUFFICIENT_FUNDS | 20 |
| INVALID_SESSSION_DEPOSIT_NUMBER | 21 |
| INVALID_SESSSION_WITHDROWAL_NUMBER | 22 |
| TRANSACTION_ID_INVALID | 23 |
| TRANSACTION_VALIDATION_FAILURE | 24 |
| ATTEMPT_TO_ROLLBACK_COMMITED_TRANSACTION | 25 |
| ATTEMPT_TO_COMMIT_ROLLEDBACK_TRANSACTION | 26 |
| NON_JURISDICTION_WITHDRAWALS_ONLY | 27 |
| JURISDICTION_WITHDRAWALS_ONLY | 28 |
| INVALID_HANDPAY_ID | 40 |
| HANDPAY_VALIDATION_FAILURE | 41 |
| ATTEMPT_TO_COMPLETE_CANCELLED_HANDPAY | 42 |
| ATTEMPT_TO_CANCEL_COMPLETED_HANDPAY | 43 |
| ATTEMPT_TO_COMPLETE_COMPLETED_HANDPAY | 44 |
| NO_ASSET_NUMBER_FOUND | 60 |
| NO_GAME_SERIAL_NUMBER_FOUND | 61 |
| CMS_FUNCTION_FAILED | 70 |
| INVALID_HID | 80 |
| TOURNAMENT_BEGIN_GAME_FAILED | 81 |
| BEGIN_GAME_WITH_DEPOSITS_DEPOSIT_FAILED | 82 |
| BEGIN_GAME_WITH_DEPOSITS_BEGIN_GAME_FAILED | 83 |
| LAST_ERROR | 10000 |

Web Service: registerIView

The purpose of this message is to create a unique iVIEW Id on Live Rewards Server. If the iVIEW Id (machine address of a device) already exists in the BLRS database, all the associated data from previous registration call is logged into a separate (history) table and then current information is updated. Registration data associated with iVIEW Id provides detailed information about device, its location, and important metrics.

All the following data is obtained by iVIEW from GMU.

| Request Parameter Name | Purpose | Type/Range |
|---|---|---|
| iviewId | Machine address of iVIEW device | 0-50 characters |
| casinoId | Unique for each casino | 0-4 characters |
| gameSerialNo | Serial number of cabinet | 0-40 characters |
| gameId | Manufacturer type | 0-5 characters |
| payTableId | Unique Pay Table Id | 0-6 characters |

-continued

| | Purpose | Type/Range |
|---|---|---|
| basePer | Theoretical pay back | 0-10 characters |
| gmuTime | Gmu time | 0-6 characters |
| maxBet | Max bet for game | 0-12 characters |
| gmuId | Gmu network address | 0-32 characters |
| protocolVersion | Version number of protocol | 0-16 characters |
| enableFeatures | SAS related bit mapped field of features the game has enabled | 0-6 characters |
| gameType | Type of ecash game | 0-3 characters |

-continued

| | Purpose | Type/Range |
|---|---|---|
| Enable | Enable or disable Live Rewards Game messaging | True/False |
| denomination | Game play credit value in pennies | 0-12 characters |
| totalCoinIn | Coin-in game meter in pennies | 0-12 characters |
| totalCoinOut | Coin-out game meter in pennies | 0-12 characters |
| gamesPlayed | Number of games played | 0-12 characters |
| assetId | Unique identifier to the casino for the cabinet | 0-8 characters |
| Response Parameter Name | | |
| isActive | iVIEW device is active or not in the BLRS | True/False |
| Result | Call result: 0 - success, non-zero - failure | Int |
| errorString | Error description | 0-1000 characters |

Web Service: getSGSDateTime

The purpose of this message is to sync the iVIEW device clock with the Live Rewards Server clock. This message returns the current Live Rewards Server date and time.

| | Purpose | Type/Range |
|---|---|---|
| Request Parameter Name | | |
| None | | |
| Response Parameter Name | | |
| Result | Call result: 0 - success, non-zero - failure | Int |
| errorString | Error description | 0-1000 characters |
| CurrentDateTime | Current Live Rewards Server date and time | Date and time object |

Web Service: getGlobalSettings

The purpose of this message is to control the Live Rewards games/console on iVIEW depending on the settings defined on the server side. It returns the Global settings (these settings are common for all the iVIEW's) defined on the Live Rewards Server

| | Purpose | Type/Range |
|---|---|---|
| Request Parameter Name | | |
| IviewId | Machine address of iVIEW device | 0-50 characters |
| Response Parameter Name | | |
| Result | Call result: 0 - success, non-zero - failure | Int |
| errorString | Error description | 0-1000 characters |
| Global Settings object | Contains global settings (see below) | |
| Global Settings members | | |
| iviewResyncInt | iVIEW re-sync interval rate in mins for iVIEW to request the global settings, active pay table sets and player type settings from BLRS. | Int |
| sysGameVolume | Live Rewards game volume in percentage | Int |
| attractVolume | iVIEW attract mode volume in percentage | Int |
| autoPlayYesNo | True - auto play enabled, False - auto play disabled | True/False |
| *tiltTime | Time in minutes to tilt the system games | Int |
| *autoRemoveplayPoints | Time in minutes to clear not used Live Rewards game play points on the device. 0 = this feature is OFF | Int |
| jurisdictionLimit | Array of Prize Type Limit objects. Each object contains prize type Id and limit number. If the limit is exceeded by a single game win, a hand pay event is triggered | Decimal |
| playerCardFormat | A character string used by iVIEW as a mask on player card number reported by GMU. This is required for proper communications with CMP/CMS. | 0-20 characters |
| cashoutType | Defines if cash funds in player's account are cashable (1) or restricted (2). "Restricted" signifies that a player has to spend the funds on system game. A player with cash amounts in his player buckets will either have restricted (promotional) or cashable credits transferred based on this setting. | Int |
| databankLog_Enabled | Controls whether iVIEW should perform base game activity logging to a DataBank database. DataBank logging is used for creating game volatility tables which essential for normalized tournament scoring. Also, DataBank data will enable player-centric gaming providing game activity repository. | True/False |

Web Service: getAllPlayersSettings

It returns the player settings including accrual rate, Live Rewards game start threshold counter and Live Rewards game start rules for all the player types (ex: Gold, Silver, etc.) defined on the BLRS

| | Purpose | Type/Range |
|---|---|---|
| Request Parameter Name | | |
| IviewId | Machine address of iVIEW device | 0-50 characters |
| Response Parameter Name | | |
| Result | Call result: 0 - success, non-zero - failure | Int |
| errorString | Error description | 0-1000 characters |
| Player Settings | Array of player setting objects | |
| Player Settings Members | | |
| playerType | Player type Id (Gold, Silver, etc) | Int |
| description | Description of player type (platinum, gold, silver . . . ) | 0-20 characters |
| accrualRate | Play points accrual percentage (of wagers) | Decimal |
| sysGameStartThreshold | System game start threshold counter (TC). This number should be achieved by a player in order to authorize a system game. | Int |
| sysGameStartRules | iVIEW utilizes these rules for accruing Play Points and Threshold Counter Points (TCs). Different player types might use different accrual rules. | Int |
| | For instance, a rule with RuleID "01" and event description "Normal Base Game play" specifies accrual increment value of 1 and occurrence counter of 1. Which means that every base game-play, a player will have his TCs incremented by 1. | 0-20 characters |
| | Now, let's say a rule with RuleID "02" and event description "Base Game Max Bet" specifies accrual increment value of 20 and occurrence counter of 1. This means that if a player will have his TCs incremented by 20 every time he plays Max Bet on a base game. | Int |
| | Array of Rules. Each Rule contains | |
| | Rule Id | Int |
| | Rule Description | |
| | Occurrence counter | |
| | Increment Value | |
| availableGames | These are games available for this player type | 0-4 characters |
| | Actual executables of the games and all the assets for them are preloaded onto iVIEW but only the ones brought with this call will be enabled and presented to this player. Optionally, the games can be downloaded dynamically upon player selection. | 0-50 characters |
| | Array of Game objects. Each object contains | |
| | Game ID | Int |
| | Game Name | |
| | Game Type (Classic, Tournament, etc.) | |

Web Service: postEventLog

The purpose of this message is to store the logs (error logs or events or information) in to the Live Rewards server database occurred in the iVIEW's, example tilt messages on iVIEW's.

-continued

| | Purpose | Type/Range |
|---|---|---|
| Request Parameter Name | | |
| eventType | Type of the event (0 - Error, 1 - Info, 2 - debug) | 0-10 characters |
| iviewId | Machine address of a iVIEW device | 0-50 characters |
| assetId | Asset number assigned to this device or slot/base game | 0-8 characters |

-continued

| | Purpose | Type/Range |
|---|---|---|
| errCode | Error code defined by the iVIEW if any | 0-20 characters |
| Data | Information/message about the event | 0-200 characters |
| Response Parameter Name | | |
| result | Call result: 0 - success, non-zero - failure | Int |
| errorString | Error description | 0-1000 characters |

Web Service: unRegisterIView

The purpose of this message is to un-register (deactivate) an active iVIEW with the BLRS. Re-activation of an un-registered iVIEW requires a manual input by an operator at BLRS.

| | Purpose | Type/Range |
|---|---|---|
| Request Parameter Name | | |
| iviewId | Machine address of a iVIEW device | 0-50 characters |
| Response Parameter Name | | |
| result | Call result: 0 - success, non-zero - failure | Int |
| errorString | Error description | 0-1000 characters |

Web Service: getActivePayTableSets

It returns all the active pay table sets and game settings for system games by player types (ex: Gold, Silver, etc.) defined in BLRS. Each pay table in a pay table set contains the required Play Points cost and game settings file. For a player to play a system game with a specific pay table it's required to earn Play Points matching or exceeding Play Points cost value for this pay table. The actual pay table played by a player will cause the game to be reconfigured at the start of the game using the game settings for this actual pay table.

| | Purpose | Type/Range |
|---|---|---|
| Request Parameter Name | | |
| iviewId | Machine address of a iVIEW device | 0-50 characters |
| Response Parameter Name | | |
| PTabSets | All pay table sets | XML Node |
| Result | Call result: 0 - success, non-zero - failure | Int |
| errorString | Error description | 0-1000 characters |

Web Service: getPayTableSet

It returns the requested pay table set object from BLRS for a specific PayTableSetId.

| | Purpose | Type/Range |
|---|---|---|
| Request Parameter Name | | |
| PayTableSetId | Pay table set Id | Int |
| Response Parameter Name | | |
| PTabSets | pay table set | XML Node |
| result | Call result: 0 - success, non-zero - failure | Int |
| errorString | Error description | 0-1000 characters |

Web Service: SGS_CreateSession

Upon player card insertion into EGM, iVIEW performs this call to create a unique Session Id for a specific player on a specific iVIEW. This call creates foundation for all system game communications between iVIEW and BLRS since all iVIEW calls to BRLS between card-in and card-out events will contain this unique Session Id.

When Session Id is created, BLRS creates player specific Session buckets (explained lower) associated with it and moves all funds available in Master Player buckets into Session buckets. In case of multiple identical player cards insertion into multiple EGMs, only Session buckets for the earliest Session Id will contain complete balances of the Master Player buckets. The Buckets for subsequently created sessions will start with zero balances.

When a player card is removed from an EGM, an SGS_CloseSession call is performed which closes (deactivates) the session and moves all the balances from Session buckets back into Master Player buckets.

A BUCKET is an account of certain currency type (like Cash, Bonus Points, Play Points, Threshold Counter, etc.) Buckets are used to hold balances of respective currencies for any purpose utilized by BLRS, e.g. to accrue Play Points and Threshold Counter, to spend Play Points on system game play, to hold player's winnings in Cash and/or Bonus Points, etc.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| Response Parameter Name | | |
| sessionId | A unique session Id | Int |
| Buckets | An array of buckets objects. Each bucket contains | |
| | prizeTypeId | Int |
| | jurisdiction | True/False |
| | TRX_Value | Decimal |
| | balance | Decimal |
| PlayerData | Player Data object contains | |
| | plrCardNo | 0-20 characters |
| | playerType | Int |
| | banned | True/False |
| IsDeviceActive | Whether the requested iVIEW device is active or not | True/False |
| result | Call result: 0 - success, non-zero - failure | Int |
| errorString | Error description | 0-1000 characters |

Web Service: SGS_ValidatePin

It verifies the Player Pin is correct or not through CMS/CMP servers. PIN validation is necessary to authorize withdrawals of funds from BLRS to iVIEW or base game.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| Pin | Pin number | UN KNOWN |
| Response Parameter Name | | |
| pinStatus | Valid or Not | True/False |
| isLocked | Locked or Not | True/False |
| lockTimeinMins | Lock time in minutes | Int |
| result | Call result: 0 - success, non-zero - failure | Int |
| errorString | Error description | 0-1000 characters |

Web Service: SGS_IsPlayerLocked

It checks weather the requested player is locked or not in BLRS. If the player is locked it returns lock time in minutes. This is used to prevent a player from defeating the PIN validation security at cashout. It will prevent cashouts from this account until lock time is expired.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| Response Parameter Name | | |
| isLocked | Locked or Not | True/False |
| lockTimeinMins | Lock time in minutes | Int |
| result | Call result: 0 - success, non-zero - failure | Int |
| errorString | Error description | 0-1000 characters |

Web Service: SGS_GetSessionBuckets

It returns the requested player Session Bucket values from reserved buckets (session buckets).

| | Purpose | Type/Range |
|---|---|---|
| Request Parameter Name | | |
| iviewId | Machine address of a iVIEW device | 0-50 characters |
| plrCardNo | Player Card Number | 0-20 characters |
| sessionId | Session Number | Int |
| Response Parameter Name | | |
| Buckets | An array of buckets. Each bucket contains | |
| | prizeTypeId | Int |
| | jurisdiction | True/False |
| | TRX_Value | Decimal |
| | Balance | Decimal |

-continued

| | Purpose | Type/Range |
|---|---|---|
| result | Call result: 0 - success, non-zero - failure | Int |
| errorString | Error description | 0-1000 characters |

Web Service: SGS_Deposit

It deposits the earned buckets values into player's Session buckets and it returns the newly updates balances. Most often the buckets that are getting deposited are recently accrued Play Points and Threshold Counter values. This call is performed periodically (about 90 seconds) or on certain events: card-out, begin system game.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| sessionId | Session Number | Int |
| depositNumber | Deposit counter number | Int |
| Buckets | An array of buckets. Each bucket contains | |
| | prizeTypeId | Int |
| | jurisdiction | True/False |
| | TRX_Value | Decimal |
| | balance | Decimal |
| Response Parameter Name | | |
| Buckets | An array of buckets. Each bucket contains | |
| | prizeTypeId | Int |
| | jurisdiction | True/False |
| | TRX_Value | Decimal |
| | balance | Decimal |
| result | Call result: 0 - success, non-zero - failure | Int |
| errorString | Error description | 0-1000 characters |

Web Service: SGS_StartWithdrawal

Initiates the withdrawal transaction for requested bucket and returns the BLRS Transaction Number to store in SDS Logs and base game for audit reasons.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| sessionId | Session Number | Int |
| withdrawalNumber | Withdrawal counter number | Int |
| Bucket | Bucket contains | |
| | prizeTypeId | Int |
| | jurisdiction | True/False |
| | TRX_Value | Decimal |
| | balance | Decimal |
| Response Parameter Name | | |
| SGS_TransactionID | BLRS Transaction Number to store in the SDS | Int |
| result | Call result: 0 - success, non-zero - failure | Int |

-continued

| | Purpose | Type/Range |
|---|---|---|
| errorString | Error description | 0-1000 characters |
| Buckets | An array of buckets. Each bucket contains | |
| | prizeTypeId | Int |
| | jurisdiction | True/False |
| | TRX_Value | Decimal |
| | balance | Decimal |

Web Service: SGS_EndWithdrawal

It completes the withdrawal transaction for the requested BLRS unique Transaction Number and amount. If the amount is different than the Start amount, balance will deposited back to player account. The base game will sometimes only accept a partial transfer of desired amount. The successfully transferred amount is logged on BLRS, SDS and the base game. In case of partial transfer, remained funds stay back at player's session buckets.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| sessionId | Session Number | Int |
| SGS_TransactionID | BLRS Transaction Number | Int |
| isCommit | Commit or Rollback | True/False |
| TRX_Value | Transaction Value to commit or rollback | Decimal |
| Response Parameter Name | | |
| SGS_TransactionID | BLRS Transaction Number to store in the SDS | Int |
| result | Call result: 0 - success, non-zero - failure | Int |
| errorString | Error description | 0-1000 characters |

Web Service: SGS_BeginGame

Creates a unique dame play history Id (HID) and debits the requested buckets transaction values from player Session buckets. On BLRS, the HID serves as a unique identifier of a System Game played by a player. HID is utilized by other calls like SGS_ProcessTournamentIntermediateScore and SGS_EndGame to update the score achieved during the game as well as perform tournament processing and winnings distribution (if necessary).

For tournament games, this call performs additional processing for associated tournament instance (tournInstID field in Gameplay object). In particular, it will bind newly created HID with a specific tournament instance ID which will guarantee that the score from this game (HID) will be processed against that tournament instance.

| | Purpose | Type/Range |
|---|---|---|
| Request Parameter Name | | |
| GamePlay | Gameplay object contains | |
| | HID | Int |
| | GID | 0-4 characters |
| | IviewId | 0-50 characters |
| | plrCardNo | 0-20 characters |
| | sessionId | Int |
| | casinoId | 0-4 characters |
| | gmuId | 0-32 characters |
| | assetNo | 0-8 characters |
| | startDateTime | Date time |
| | payTabSetId | Int |
| | payTabId | Int |
| | gameSettingsId | Int |
| | score | Int |
| | tournInstID (unique tournament identifier, for tournament games only) | Int |
| | Array of Buckets. each bucket contains | |
| | prizeTypeId | Int |
| | jurisdiction | True/False |
| | TRX_Value | Decimal |
| | balance | Decimal |
| Response Parameter Name | | |
| HID | Game play History Id | Int |
| Buckets | An array of buckets. Each bucket contains | |
| | prizeTypeId | Int |
| | jurisdiction | True/False |
| | TRX_Value | Decimal |
| | balance | Decimal |
| G2SMessage | A serialized G2S message which contains tournament end conditions (G2S tournamentInfo class) | 0-400 characters |
| Result | Call result: 0 - success, non-zero - failure | Int |
| errorString | Error description | 0-1000 characters |

Web Service: SGS_BeginGameWithDeposits This call is a combination of two calls SGS_Deposit and SGS_BeginGame; it's created for efficiency purposes. The order of execution is as follows:

deposits are made to Session buckets validation is performed for sufficient funds to start a system game required funds are debited from player Session buckets game history id (HID) is created HID and current Session buckets' balances are returned to iVIEW

| | Purpose | Type/Range |
|---|---|---|
| Request Parameter Name | | |
| depositNumber | Deposit counter number | Int |
| depositBuckets | An array of buckets. Each bucket contains | |
| | prizeTypeId | Int |
| | jurisdiction | True/False |
| | TRX_Value | Decimal |
| | balance | Decimal |
| gamePlayObj | GamePlay object - see SGS_BeginGame call | |
| Response Parameter Name | | |
| DepositAck | SGS_Deposit_Ack object - this object contains everything that a normal SGS_Deposit call would return | |
| BeginGameAck | SGS_BeginGameAck object - this object contains everything that a normal SGS_BeginGame call would return | |

Web Service: SGS_ProcessTournamentInterrnediateScore

This call is used by iVIEW in case a tournament game requires server-side intermediate tournament score calculation. Scoring algorithms vary based on an XML settings file on BRLS.

| | Purpose | Type/Range |
|---|---|---|
| Request Parameter Name | | |
| bgDataArray | Array of BaseGameTournamentData objects. Each BaseGameTournamentData object contains: | |
| | GameComboID (a combination of Game Theme, Paytable ID and denomination) | 10-30 characters |
| | PlayerCardNo | 0-20 characters |
| | SessionID | Int |
| | HID | Int |
| | GID | Int |
| | CreditValue (in pennies) | Long |
| | PayoutPercent (100-based number) | Decimal |
| | AmountBet | Long |
| | AmountWon | Long |
| | MeterValidationCode | Int |
| | GamesPlayed | Long |
| | MaxBet | Long |
| | StartTime | DateTime |
| | EndTime | DateTime |
| | GameLengthMS | Long |
| | JackpotWon | Long |
| | AveTimeBetweenGamesMS | Long |
| | TotalMaxBets | Long |
| | BaseGameHID | Int |
| | TournInstID | Long |
| | TournGameTimeElapsedMS | Long |
| | TimeBetweenGamesMS | Long |
| | HasTournEnded | True/False |
| Response Parameter Name | | |
| Score | Cumulative intermediate tournament score | Decimal |
| ScoreContribution | Contribution from this call to total tournament score | Decimal |
| Rank | Rank of current intermediate score against tournament leader board | Int |
| BaseGameHID | Unique base game ID for this system game HID (usually, BaseGameHIDs are sequential from 1 to X, where X is a total number of base games required to be played to complete this system game in iVIEW). | Int |
| LeaderBoardData | Serialized leader board XML data for current tournament | 0-400 characters |
| HasTournamentGameEnded | Signifies the completion of tournament game | True/False |
| result | Call result: 0 - success, non-zero - failure | Int |
| errorString | Error description | 0-1000 characters |

Web Service: SGS_EndGame

It closes the Game transaction for the specified HID and stores the bucket transaction values into player session buckets in case of a system game win. For tournament games, this call also performs processing of score for an associated tournament (tournInstID field in Gameplay object). For tournaments, this game's score is processed and put on the tournament's leader board (if score qualifies).

| | Purpose | Type/Range |
|---|---|---|
| Request Parameter Name | | |
| GamePlay | Gameplay object - see SGS_BeginGame call | |

-continued

| | Purpose | Type/Range |
|---|---|---|
| Response Parameter Name | | |
| HID | Game play History Id | |
| Buckets | An array of buckets. Each bucket contains | |
| | prizeTypeId | Int |
| | jurisdiction | True/False |
| | TRX_Value | Decimal |
| | balance | Decimal |
| result | Call result: 0 - success, non-zero - failure | Int |
| errorString | Error description | 0-1000 characters |

Web Service: SGS_StartHandpay

Initiates the new iVIEW Hand pay transaction and returns the Hand pay ID with the bucket values to send a message to cage.

| | Purpose | Type/Range |
|---|---|---|
| Request Parameter Name | | |
| SGSHandPay object | See below | |
| SGSHandPay members | | |
| HPId | Unique ID of a hand pay | |
| HPTypeId | Hand pay Type (Jurisdiction or player initiated) | Int |
| SessionId | Player Current Session Id | Int |
| IviewId | Machine address of a iVIEW device | 0-50 characters |
| CasinoId | Property Id | 0-4 characters |
| GmuId | Machine address of a device | 0-32 characters |
| AssetNo | Account number of a device | 0-8 characters |
| PLRCardNo | Player card number | 0-20 characters |
| CompletedBy | Employee card number | 0-20 characters |
| Status | Status of this hand pay | Int |
| Buckets | Array of Buckets. each bucket contains | |
| | prizeTypeId | Int |
| | jurisdiction | True/False |
| | TRX_Value | Decimal |
| | balance | Decimal |
| Response Parameter Name | | |
| HPID | Hand pay ID | Int |
| Result | Call result: 0 - success, non-zero - failure | Int |
| errorString | Error description | 0-1000 characters |

Web Service: SGS_EndHandpay

It closes the Hand pay transaction for the request hand pay ID. This is normally done when an employee has been identified and is paying the patron. A cancellation of a hand pay may occur as well—by employee or the patron.

| | Purpose | Type/Range |
|---|---|---|
| Request Parameter Name | | |
| iviewId | Machine address of a iVIEW device | 0-50 characters |
| playerCardNumber | Player card number | 0-20 characters |
| sessionID | Player Current Session Id | Int |
| handPayID | Hand pay Id | Int |
| isCommit | Commit the transaction or not | True/False |
| completedBy | Employee card number | 0-20 characters |
| Response Parameter Name | | |
| HPID | Hand pay ID | |
| Result | Call result: 0 - success, non-zero - failure | 0 or non-negative |
| errorString | Error description | 0-1000 characters |

Web Service: SGS_CloseSession

Closes the specified player Session on specified iVIEW and moves all the balances from Player Session buckets into Player Master buckets. This makes all player funds available for any new session created for the same player card number. iView will close any previously opened sessions after re-powering.

| | Purpose | Type/Range |
|---|---|---|
| Request Parameter Name | | |
| iviewId | Machine address of a iVIEW device | 0-50 characters |
| plrCardNo | Player Card Number | 0-20 characters |
| sessionId | Session Number | Int |
| recoveryYN | Recovery session or normal | True/False |
| Response Parameter Name | | |
| result | Call result: 0 - success, non-zero - failure | 0 or 1 |
| errorString | Error description | 0-1000 characters |

Web Service: SGS_EGMGamePlay

It posts the EGM game play activity data in to the BLRS. i.e., total coin in, total coin out, number of games played. This data will be posted on every heart beat call to the server, before SGS_CreateSession and before SGS_CloseSession calls.

| | Purpose | Type/Range |
|---|---|---|
| Request Parameter Name | | |
| iviewId | Machine address of a iVIEW device | 0-50 characters |
| assetId | Account number of a device | 0-20 characters |
| sessionId | Session Number | Int |
| totCoinIn | Total coin in | Int |
| totCoinOut | Total coin out | Int |
| gamesPlayed | No of games played | Int |
| Status | Status of the device at the time of posting data | 0 = None<br>1 = Session Open<br>2 = Session in progress<br>3 = Session Closed |
| Response Parameter Name | | |
| result | Call result: 0 - success, non-zero - failure | 0 or 1 |
| errorString | Error description | 0-1000 characters |

Web Service: SGS_QueryWithdrawals

It returns the withdrawal transaction Log for the requested iVIEW and prize type. This data is shown on employee pages on iView.

| | Purpose | Type/Range |
|---|---|---|
| Request Parameter Name | | |
| iviewId | Machine address of a iVIEW device | 0-50 characters |
| prizeType | Prize type | Int |
| noofRecords | No-Of records to return | Int |
| Response Parameter Name | | |
| Withdrawl_Report | Array of Withdrawal_Report object. Each Withdrawal_Report contains | |
| | tranId | Int |

-continued

| | Purpose | Type/Range |
|---|---|---|
| | sessionId | Int |
| | session__TrxId | Int |
| | plrCardNo | 0-20 characters |
| | sourceId | 0-50 characters |
| | tranDateTime | Date time |
| | prizeValue | Decimal |
| | jurisdiction | True/False |
| | status | 0-20 charachters. |
| result | Call result: 0 - success, non-zero - failure | Int |
| errorString | Error description | 0-1000 characters |

Web Service: SGS_QueryGamePlayLog

It returns the Game play history transactions for the requested iVIEW. This data is shown on employee pages on iView.

| | Purpose | Type/Range |
|---|---|---|
| Request Parameter Name | | |
| iviewId | Machine address of a iVIEW device | 0-50 characters |
| noofRecords | No-Of records to return | Int |
| Response Parameter Name | | |
| GamePlay__Report | Array of Gameplay__Report object. Each Gameplay__Report contains | |
| | HID | Int |
| | GID | Int |
| | IviewId | 0-50 characters |
| | plrCardNo | 0-20 characters |
| | sessionId | Int |
| | casinoId | 0-4 characters |
| | gmuId | 0-32 characters |
| | assetNo | 0-8 characters |
| | startDateTime | Date time |
| | endDateTime | Date time |
| | payTabSetId | Int |
| | payTabId | Int |
| | gameSettingsId | Int |
| | score | Int |
| | buckets Spent | Bucket values |
| | buckets Won | Bucket values |
| result | Call result: 0 - success, non-zero - failure | Int |
| errorString | Error description | 0-1000 characters |

Web Service: SGS_QueryHandpayLog

It returns the hand pay transactions for the requested iVIEW. This data is shown on employee pages on iView.

| | Purpose | Type/Range |
|---|---|---|
| Request Parameter Name | | |
| iVIEW Id | Machine address of a iVIEW device | 0-50 characters |
| noofRecords | No-Of records to return | Int |
| Response Parameter Name | | |
| HandPay__Report | Array of HandPay__Report object. Each HandPay__Report contains | |
| | HPID | Int |
| | HPDesc | 0-50 characters |
| | IviewId | 0-50 characters |
| | plrCardNo | 0-20 characters |
| | sessionId | Int |
| | casinoId | 0-4 characters |
| | gmuId | 0-32 characters |
| | assetNo | 0-8 characters |
| | createdDateTime | Date time |
| | completedDateTime | Date time |
| | completedBy | 0-20 characters |
| | buckets | Bucket values |
| result | Call result: 0 - success, non-zero - failure | Int |
| errorString | Error description | 0-1000 characters |

Web Service: SGS_GetPrizeTypes

It returns all available prize types. This call does not require any parameters.

| Response Parameter Name | Purpose | Type/Range |
|---|---|---|
| result | Call result: 0 - success, non-zero - failure | 0 or 1 |
| errorString | Error description | 0-1000 characters |
| AllPrizeTypes | Array of SGSPrizeType objects. Each SGSPrizeType object contains: | |
| | PrizeTypeID | Int |
| | Description | 0-20 characters |
| | RateToDollar | Decimal |
| | IsJurInclude - this determines whether this type of prize should be considered as a part of jurisdictional trigger and cause a hand pay. | True/False |

While the example embodiments have been described with relation to a gaming environment, it will be appreciated that the above concepts can also be used in various non-gaming environments. For example, such rewards can be used in conjunction with purchasing products, e.g., gasoline or groceries, associated with vending machines, used with mobile devices or any other form of electronic communications. Accordingly, the disclosure should not be limited strictly to gaming.

The foregoing description, for purposes of explanation, uses specific nomenclature and formula to provide a thorough understanding of the invention. It should be apparent to those of skill in the art that the specific details are not required in order to practice the invention. The embodiments have been chosen and described to best explain the principles of the invention and its practical application, thereby enabling others of skill in the art to utilize the invention, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

The invention claimed is:

1. A method for implementing a networked gaming system comprising:

operating a plurality of gaming machines each having a magnetic card reader that accepts a player-identification card having a magnetic stripe, wherein each gaming machine enables a user to play a base game, and wherein each gaming machine is selectively enabled to enable a rewards-qualified user to play one or more system games;

operating a rewards server coupled to the plurality of gaming machines by a network to provide one or more system games to the plurality of gaming machines;

identifying a user at one of the plurality of gaming machines by using the magnetic card reader to read the magnetic stripe of the player-identification card;

identifying at the rewards server the user as a rewards-qualified user, wherein identifying the user as a rewards-qualified user causes authorizing debit of an account of the rewards-qualified user at the rewards server for play of a system game and initiation of system game play, upon successful qualification for a rewards mode involving at least another of the plurality of gaming machines;

initiating at the rewards server a system game history ID reflective of transactions of the system game;

sending over the network a record of the authorizing and the system game history ID to one or more of the plurality of gaming machines from the rewards server when the system game is initiated;

sending results of the system game played at one or more of the plurality of gaming machines to the rewards server with the system game history ID;

authorizing via the rewards server an award to the rewards-qualified user;

receiving at the rewards server from the rewards-qualified user a request to pay the award;

determining at the rewards server the award exceeds a predetermined threshold, wherein the threshold is based on a jurisdictional requirement for payment; and requesting manual payment of the award.

2. The method as recited in claim 1 wherein rewards qualification results from meeting a threshold winning level.

3. The method as recited in claim 1 wherein rewards qualification results from meeting a threshold rewards points level.

4. The method as recited in claim 1 wherein rewards qualification requires sufficient funds in the user account at the rewards server.

5. The method as recited in claim 1 wherein identifying the user is accomplished via a combination of the magnetic stripe reader and entry of a keypad code.

6. The method as recited in claim 1 wherein the system game is a bonus game upon successful qualification for a bonus mode.

7. A method for implementing a networked gaming system comprising:

operating one or more gaming machines, wherein each gaming machine enables a user to play a base game, and wherein each gaming machine is selectively enabled to enable a rewards-qualified user to play one or more system games;

operating a rewards server coupled to the one or more gaming machines over a network to provide one or more system games to the one or more gaming machines, wherein the rewards server maintains an account associated with the rewards-qualified user at the one or more gaming machines and wherein winnings of the rewards-qualified user from the one or more gaming machines are deposited into the account;

identifying the rewards-qualified user at one of the one or more gaming machines, wherein identifying the rewards-qualified user causes authorizing debit of the account of the rewards-qualified user at the rewards server for play of a system game and initiation of system game play, upon successful qualification for a rewards mode involving at least another of the one or more gaming machines;

initiating a system game history ID reflective of transactions of the system game;

sending a record of the authorizing and the system game history ID to the one of the one or more gaming machines from the rewards server when the system game is initiated;

sending results of the system game played at the one or more gaming machines from the one or more gaming machines to the rewards server with the system game history ID;

authorizing via the rewards server an award for the rewards-qualified user of one of the one or more gaming machines;

receiving at the one of the one or more gaming machines a request to pay the award at the one of the one or more gaming machines;

determining at the one of the one or more gaming machines the award exceeds a predetermined threshold based upon a jurisdictional requirement; and requesting manual payment of the award at the one of the one or more gaming machines.

8. The method as recited in claim 7 wherein rewards qualification results from meeting a threshold winning level.

9. The method as recited in claim 7 wherein rewards qualification results from meeting a threshold rewards points level.

10. The method as recited in claim 7 wherein rewards qualification requires sufficient funds in the user account at the rewards server.

11. The method as recited in claim 7 wherein identifying the user is accomplished via at least one of a magnetic card reader to read a magnetic stripe of a player-identification card and a fingerprint identification.

12. The method as recited in claim 7 wherein identifying the user is accomplished via a combination of a magnetic card reader to read a magnetic stripe of a player-identification card and entry of a keypad code.

13. The method as recited in claim 7 wherein the system game is a bonus game upon successful qualification for a bonus mode.

14. A method for implementing a networked gaming system comprising:

operating a plurality of gaming machines each having at least one of a magnetic card reader that accepts a player-identification card having a magnetic stripe and a fingerprint reader, wherein each gaming machine enables a user to play a base game, and wherein each gaming machine is selectively enabled to enable a rewards-qualified user to play one or more system games;

operating a rewards server coupled to the plurality of gaming machines by a network to provide one or more system games to the plurality of gaming machines, wherein the rewards server maintains an account associated with the rewards-qualified user at the plurality of gaming machines and wherein winnings of the rewards-qualified user from the plurality of gaming machines are deposited into the account;

identifying the rewards-qualified user at one of the plurality of gaming machines by using the magnetic card reader to read the magnetic stripe of the player-identification card or reading the fingerprint of the rewards-qualified user;

identifying at the rewards server the rewards-qualified user, wherein identifying the rewards-qualified user causes authorizing debit of the account of the rewards-qualified user at the rewards server for play of a system game and initiation of system game play, upon successful qualification for a rewards mode involving at least another of the plurality of gaming machines;

initiating at the rewards server a system game history ID reflective of transactions of the system game;

sending over the network a record of the authorizing and the system game history ID to one or more of the plurality of gaming machines from the rewards server when the system game is initiated;

sending results of the system game played at one or more of the plurality of gaming machines to the rewards server with the system game history ID;

authorizing via the rewards server an award to the rewards-qualified user of one of the plurality of gaming machines;

receiving at the rewards server from the rewards-qualified user a request to pay the award;

determining at the rewards server the bonus amount exceeds a predetermined threshold, wherein the threshold is based on a jurisdictional requirement for payment; and requesting manual payment of the award.

15. The method as recited in claim 14 wherein rewards qualification results from meeting a threshold winning level.

16. The method as recited in claim 14 wherein rewards qualification results from meeting a threshold rewards points level.

17. The networked gaming system as recited in claim 14 wherein rewards qualification requires sufficient funds in the user account at the rewards server.

18. The method as recited in claim 14 wherein identifying the user is accomplished via the magnetic card reader to read a magnetic stripe of a player-identification card.

19. The method as recited in claim 18 wherein identifying the user is accomplished via a combination of the magnetic card reader to read the magnetic stripe of the player-identification card and entry of a keypad code.

20. The method as recited in claim 14 wherein the system game is a bonus game upon successful qualification for a bonus mode.

* * * * *